United States Patent [19]

Klaus et al.

[11] 4,217,652

[45] Aug. 12, 1980

[54] MULTI-USER ANALOG/HYBRID SYSTEM

[75] Inventors: John F. Klaus, Lincroft; F. James Liotta, Long Branch, both of N.J.

[73] Assignee: Electronic Associates, Inc., West Long Branch, N.J.

[21] Appl. No.: 882,329

[22] Filed: Mar. 1, 1978

[51] Int. Cl.[2] ..... G06J 1/00

[52] U.S. Cl. ..... 364/601

[58] Field of Search ... 364/600, 601, 602, 200 MS File, 364/900 MS File

[56] References Cited

U.S. PATENT DOCUMENTS

| | | | |
|---|---|---|---|
| 3,493,731 | 2/1970 | Lemonde | 364/601 |
| 3,501,624 | 3/1970 | Grandine | 364/600 |
| 3,529,297 | 9/1970 | Landauer et al. | 364/600 |
| 3,582,628 | 6/1971 | Brussolo | 364/601 |
| 3,587,055 | 6/1971 | Gilbert | 364/601 |

*Primary Examiner*—Joseph F. Ruggiero
*Attorney, Agent, or Firm*—Frailey & Ratner

[57] ABSTRACT

A multi-user, multi-task analog/hybrid system having a digital computer and a main digital memory. The programs are run with one of the analog and digital programs becoming time critical. A linkage system having ADC and DAM channels link the data flow between the analog computers and the digital computer. The linking system is controlled to substantially allocate all of the data flow to the time critical analog and digital programs and as available data flow is allocated to non-time critical programs. After allocation, there is automatic data transfer without digital computer intervention.

56 Claims, 65 Drawing Figures

FIG. 8
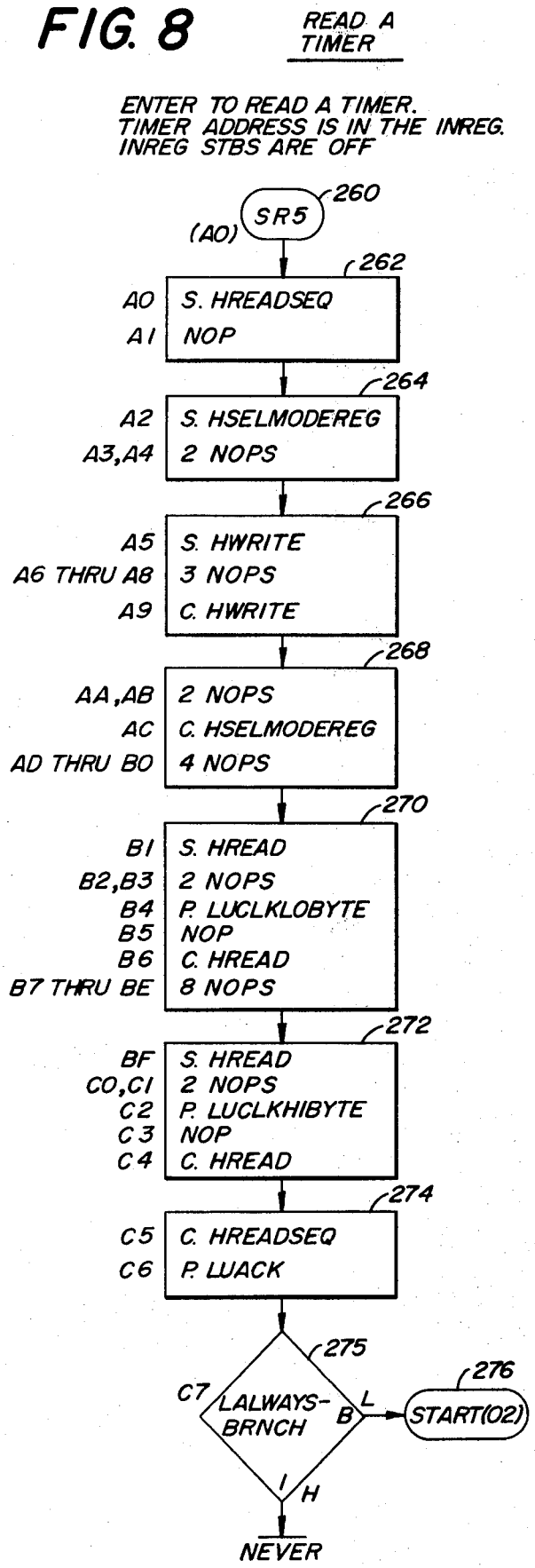
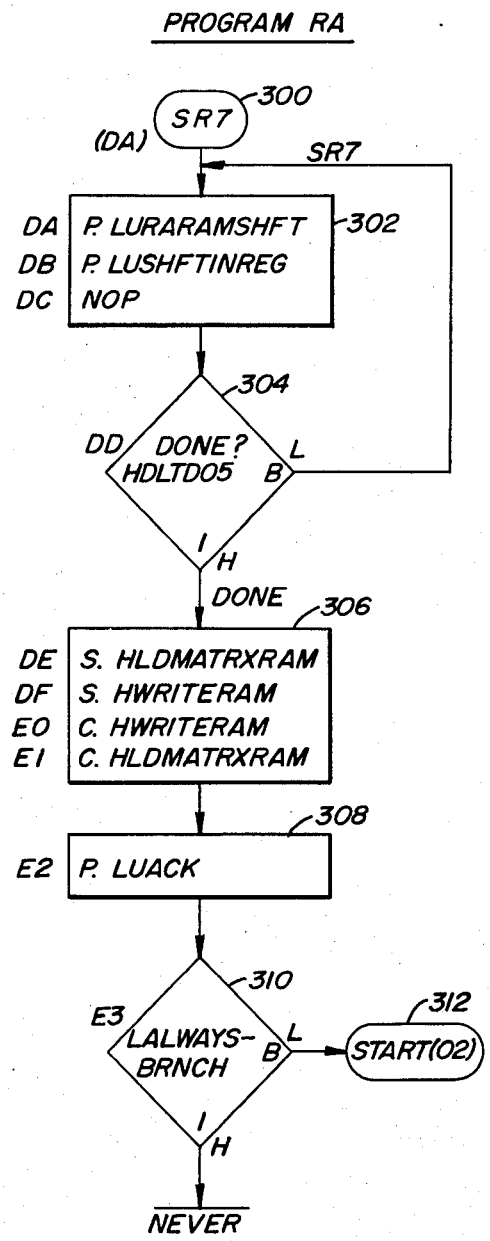
FIG. 9

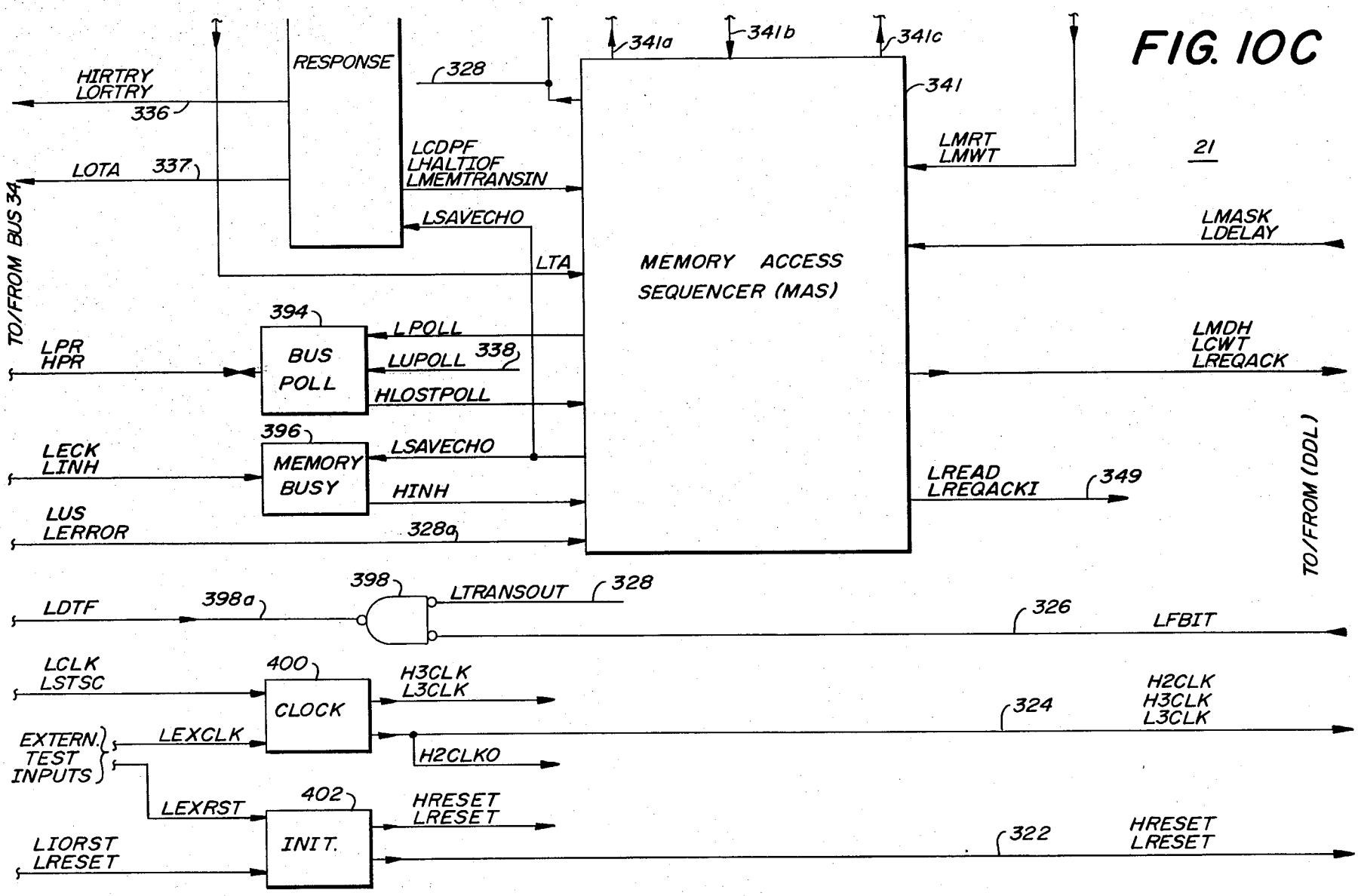
FIG. 10C
21
TO/FROM (DDL)
LMASK
LDELAY
LMDH
LCWT
LREQACK
LFBIT
H2CLK
H3CLK
L3CLK
HRESET
LRESET
349
326
324
322
LMRT
LMWT
LREAD
LREQACKI
341
341c
341b
341a
MEMORY ACCESS
SEQUENCER (MAS)
328
LTRANSOUT
LCDPF
LHALTIOF
LMEMTRANSIN
LSAVECHO
LTA
LPOLL
LUPOLL
338
HLOSTPOLL
LSAVECHO
HINH
328a
398
H3CLK
L3CLK
H2CLKO
HRESET
LRESET
RESPONSE
394
BUS
POLL
396
MEMORY
BUSY
400
CLOCK
402
INIT.
398a
LEXCLK
LEXRST
HIRTRY
LOFTRY
336
337
LOTA
LPR
HPR
LECK
LINH
LUS
LERROR
LDTF
LCLK
LSTSC
EXTERN.
TEST
INPUTS
LIORST
LRESET
TO/FROM BUS 34

TOP(08)
458
INIT(00)
420
INIT
00 NOP
421
01 NOP
421a
START
2D JMP
CKDDL
04 MWT
428
MWT (90)
427
05 MRT
430
MRT (99)
429
06 DINT
432
DINT (B0)
431
07 CDH
434
TOP
08 ARSTX
436
ARSTX/RSTX (0E)
438
09 WDOT
474
WDOT (48)
476
0A AICT
433
AICT/ICT (B6)
435
0B JMP START
START(02)
422
START
02 PUSPCLR
423
03 JMP
425
2C CDH
426
2B HALTIOF
424
HALT
TOP

440
ARSTX(0E)
0E PULSE μ ACK
442
0F PULSE μ RDY
444
10 PULSE μ LDTO
446
READY FOR RSTX
12 CLKS?
CPU WAS INTERRUPTED
CKCDH2
11 CDH
448
12 TO
450
13 JMP START
452
CKRSTX
454
14 RSTX
15 JMP TOP
456

FIG. 23
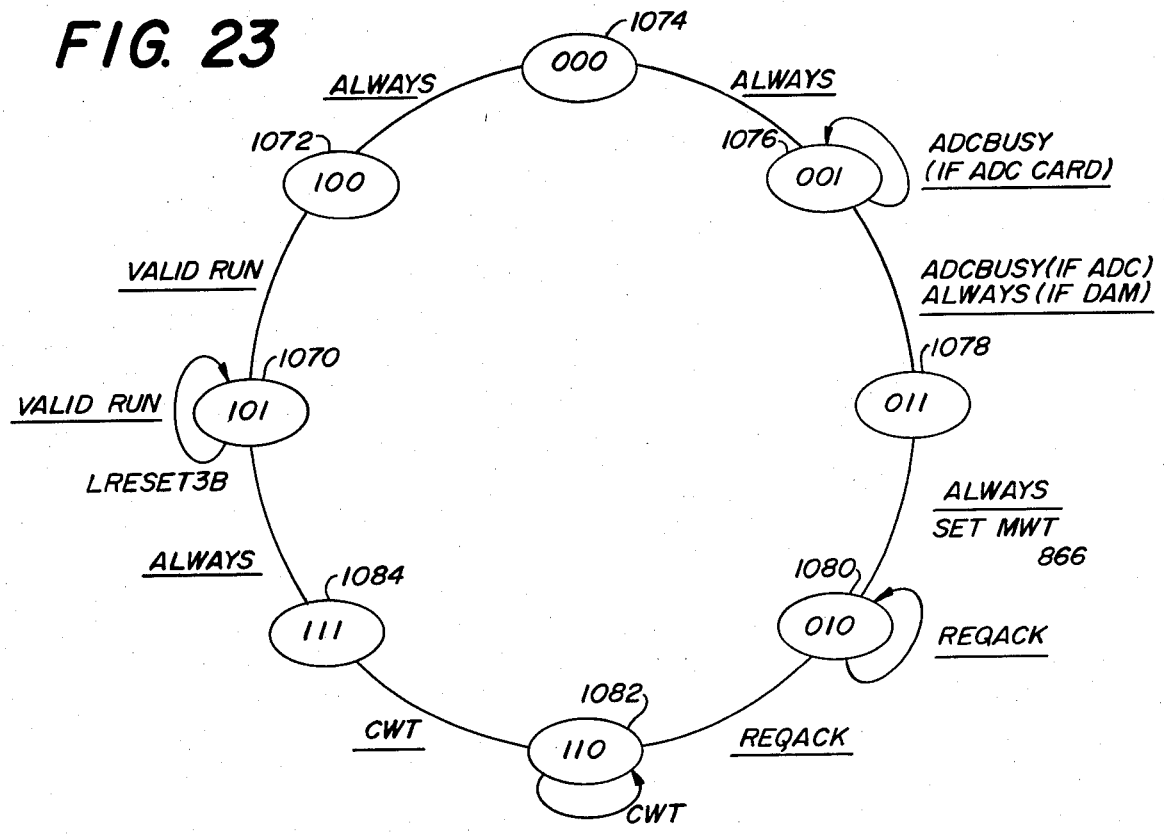
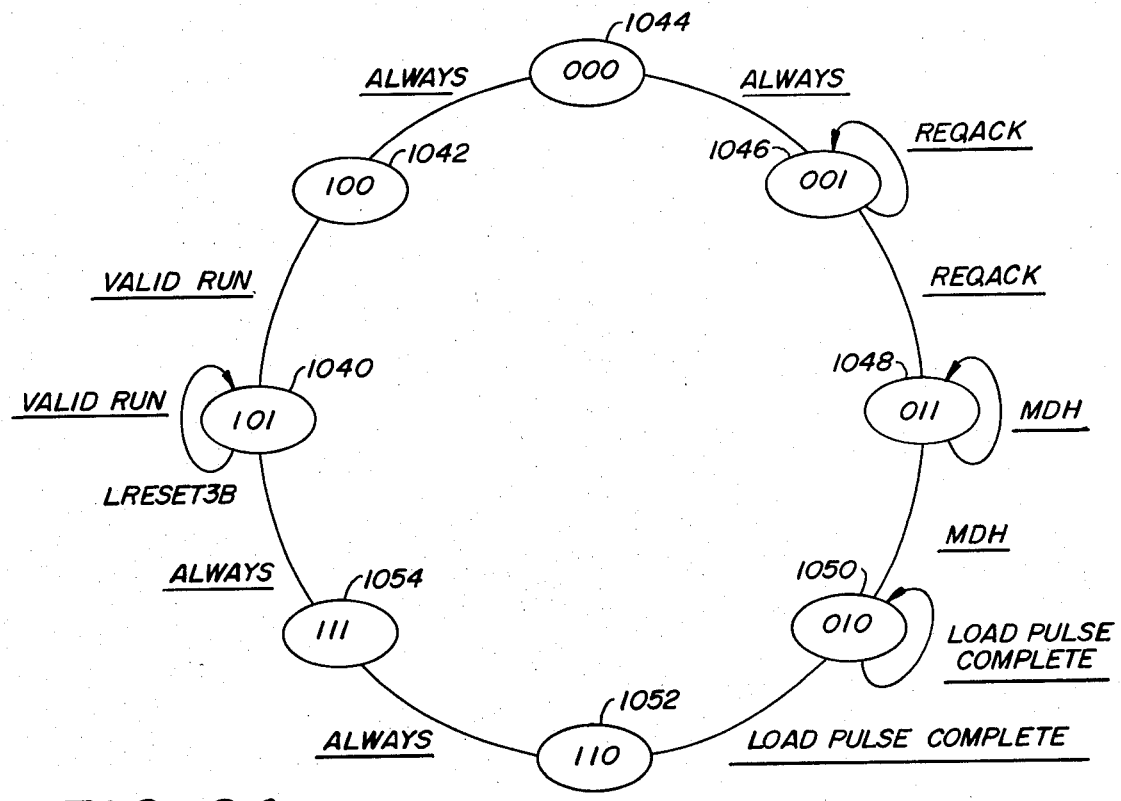
FIG. 24

1 OF 72 MULTIPLEXERS 1654

MEMORY SEQUENCER BRANCH CONDITIONS 341

ROUND ROBIN GORILLA 830

1108
HCDLD
LCDUTCW
HTCWLD
HDRF
LHOLDCT
1217
LDOLRSP
1106
F/F
J
K
Q
1204
1202
1212
1210
1220
1218
D
LINACT
LRSTX8/4
LRSTX2
HREQF
LREQF
HDRD
1216
1206
1200
1208
HCDBITS
HTCWDATA
HDATA REQ
LPAMBSY
HIMHZA
LT4

MULTI-USER ANALOG/HYBRID SYSTEM

TABLE OF CONTENTS

ABSTRACT OF THE DISCLOSURE
BACKGROUND OF THE INVENTION
I. FIELD OF THE INVENTION
II. PRIOR ART
SUMMARY OF THE INVENTION
BRIEF DESCRIPTION OF THE DRAWINGS
ACRONYMS
DESCRIPTION OF ILLUSTRATIVE EMBODIMENTS
I. GENERAL OPERATION
A. System 10 Theory and Organization
B. Organization of DCM 25
II. INTERRUPT TIMER CONTROL (ITC) 26
A. Block Diagram Description
B. ITC Microsequencer 134 Firmware Flowchart
C. ITC Instruction Format for Microsequencer 134
III. BASIC BUS INTERFACE (BBI) 21
A. Block Diagram Description
B. BBI Microsequencer 340 Firmware Flowchart
C. BBI Memory Access Sequencer 341 State Diagram
D. BBI-DDL Signal Descriptions
IV. DATA CONVERSION MULTIPLEXER (DCM) 25
A. General Description
B. Block Diagram Description
C. DCM Microsequencer 860 Firmware Flowchart
D. State Diagram For Loading DAM's 24 & Reading ADC 22 or DAM 24
V. PARALLEL ANALOG MULTIPLEXER (PAM) 20
A. Block Diagram Description
VI. DETAILED EXPLANATION OF CIRCUITS
A. ITC 26
1. RTHC and DCM Timer Controls 121, 126
2. Timer Initial Value Buffers 114, 116 and Registers 118 and 128
3. CPU Bus Interface
4. Microsequencer 134
5. Resource Allocator 104
B. BBI 21
1. Physical Address Recognition & Generator 372
2. Response to CPU System 392
3. Tag Register & Decode 388 and Tag Output Encode 390
4. Memory Access Sequencer (MAS) 341
5. Last Accept Register and Last Retry Register 376, 378
6. Service Interrupt Poll 380 and Bus Poll 394
7. In Register 356 and Address Register and Counter 362
8. Status Block 346
C. DCM 25
1. Run Control 816
2. Gorilla Round Robin 830
3. Active Pending Register 786
4. Active Register 794
D. PAM 20
1. Echo or Wait for Read Block 1108
2. Control Timing 1118
VII. TABLE OF COMPONENTS VIII. LISTING OF THE FIRMWARE FOR GORILLA ROUND ROBIN 830
IX. HOS AND HIOCS SOFTWARE SYSTEMS

BACKGROUND OF THE INTENTION

I. Field of the Invention

This invention relates to data processing systems and particularly to analog/hybrid computing systems.

II. Prior Art

Analog/hybrid computing systems are known in the art such as Pacer 700 manufactured by Electronic Associates, Inc. Some of these prior hybrid computing systems have operated with a plurality of analog consoles to run hybrid simulations. However, prior systems have been limited in that they could not effectively run more than one hybrid simulation at a time. During the running of a single hybrid simulation for a user there are gaps of time when no computation or computation at slow speed takes place. For example, a user may be checking his program, he may be debugging his program or he may be examining results before the beginning of computation. Further, he may be waiting for initial conditions to be reached. During these times when the user waited or used slow speeds, the full resources of the hybrid computing system were not being taken advantage of. This resulted in a substantial effective loss in computer time of a costly system. A further drawback of these prior hybrid systems has been that they could not operate in a true multi-task mode. While they could run one hybrid simulation for a user they could not at the same time perform other important tasks for other users to effect maximum cost effectiveness of the hybrid system.

SUMMARY OF THE INVENTION

An analog/hybrid system for at least two hybrid users which has a digital computer and a main digital memory with each of the hybrid users having their own analog and digital programs. A plurality of analog computers run on individual analog programs with at least one of the analog programs becoming time critical. A system provides for linking data flow between the analog computers and the digital computer under the control of the main digital memory. Multiplex means control the linking system for substantially allocating all of the data flow to the time critical analog program and as available for allocating data flow to the nontime critical analog program.

BRIEF DESCRIPTION OF THE DRAWINGS

FIGS. 6A–C, 7A–D, 8 and 9 taken together illustrate flowcharts for the firmware of the ITC microsequencer of FIGS. 5A–B;

FIGS. 10A–C taken together illustrate in more detail and in block diagram form the BBI section of FIG. 1;

FIG. 23 illustrates a state diagram for reading and ADC/DCM;

FIG. 24 illustrates a state diagram for loading DAM's;

| ACRONYMS | |
|---|---|
| ADC | analog to digital converter |
| BBI | basic bus interface |
| CD | command device |
| CPCW | channel programming control word |
| CPU | central processing unit |
| DAM | digital to analog multipliers |
| DCM | data conversion multiplexer |
| DDL | device dependent logic |
| DMA | direct memory access |
| GPI | general purpose interrupt |
| HIS | hybrid interrupt system |
| ITC | interrupt timer controller |
| MAS | memory access sequencer |
| MRT | memory read transfer |
| MWT | memory write transfer |
| PAM | parallel analog multiplexer |
| RTHC | real time hybrid clock |
| RTM | real time monitor program (SEL) |
| SEL | Systems Engineering Laboratories, Fort Lauderdale, Florida |
| signal names | The first letter indicates the active state signals, either L for low or H for high. The next three letters indicate source such as ADC, DAM, etc. The next set of letters is the operation to be performed such as CL for clock, R for reset, OPR for operate, 0 for zero |
| TCR | transfer control register |
| TCW | transfer control word |
| TSS | terminal support subsystem |
| 2000/4000/8000 | SEL level designations |

DESCRIPTION OF ILLUSTRATIVE EMBODIMENT

I. General Operation

A. System 10 Theory and Organization

Figure 1:
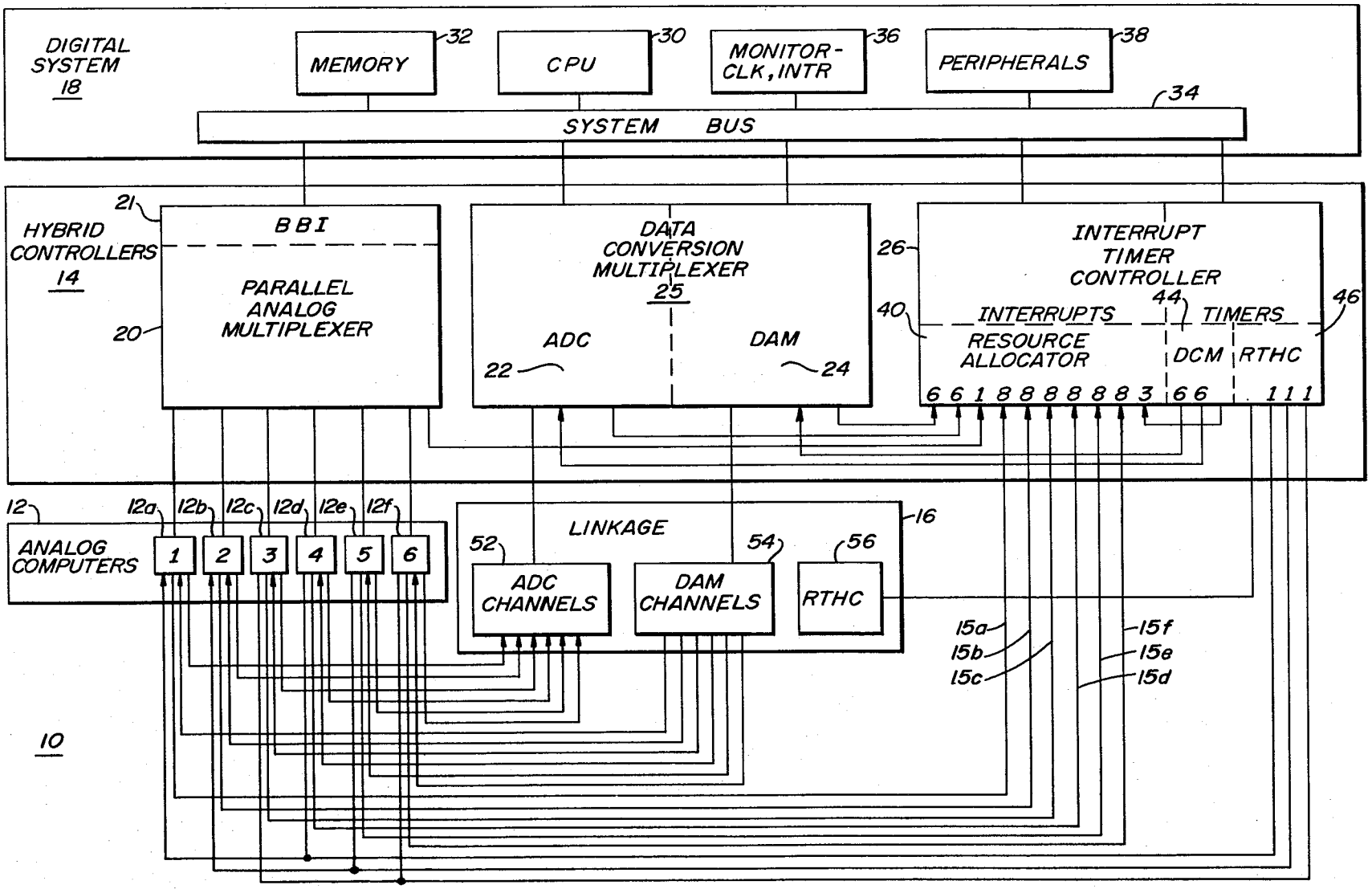
FIG. 1 illustrates in basic block diagram form a multi-user analog/hybrid system embodying the invention.
Figure 2:
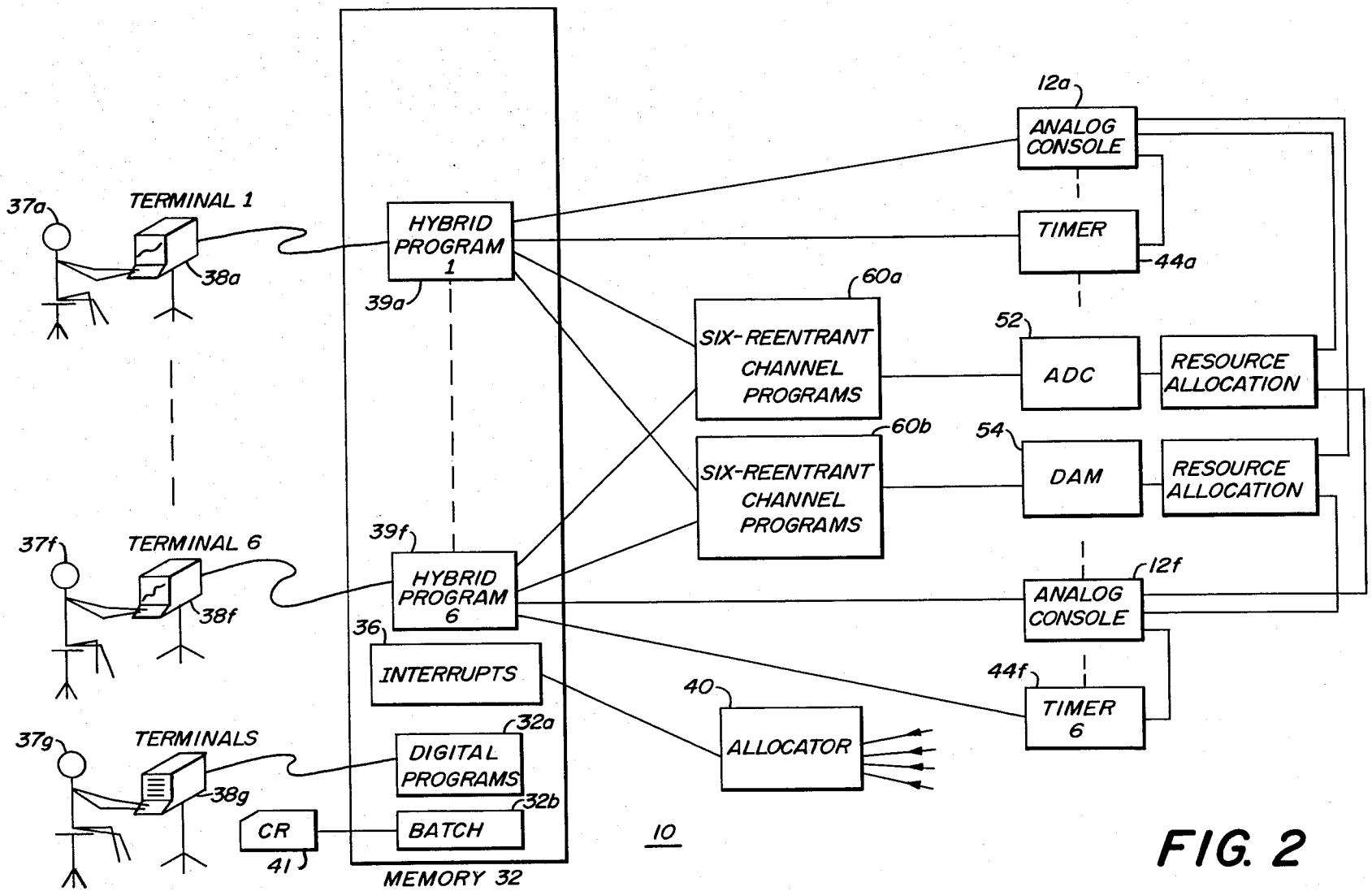
FIGS. 2 and 3 functionally represent in basic block diagram form portions of the organization of FIG. 1.
Figure 3:
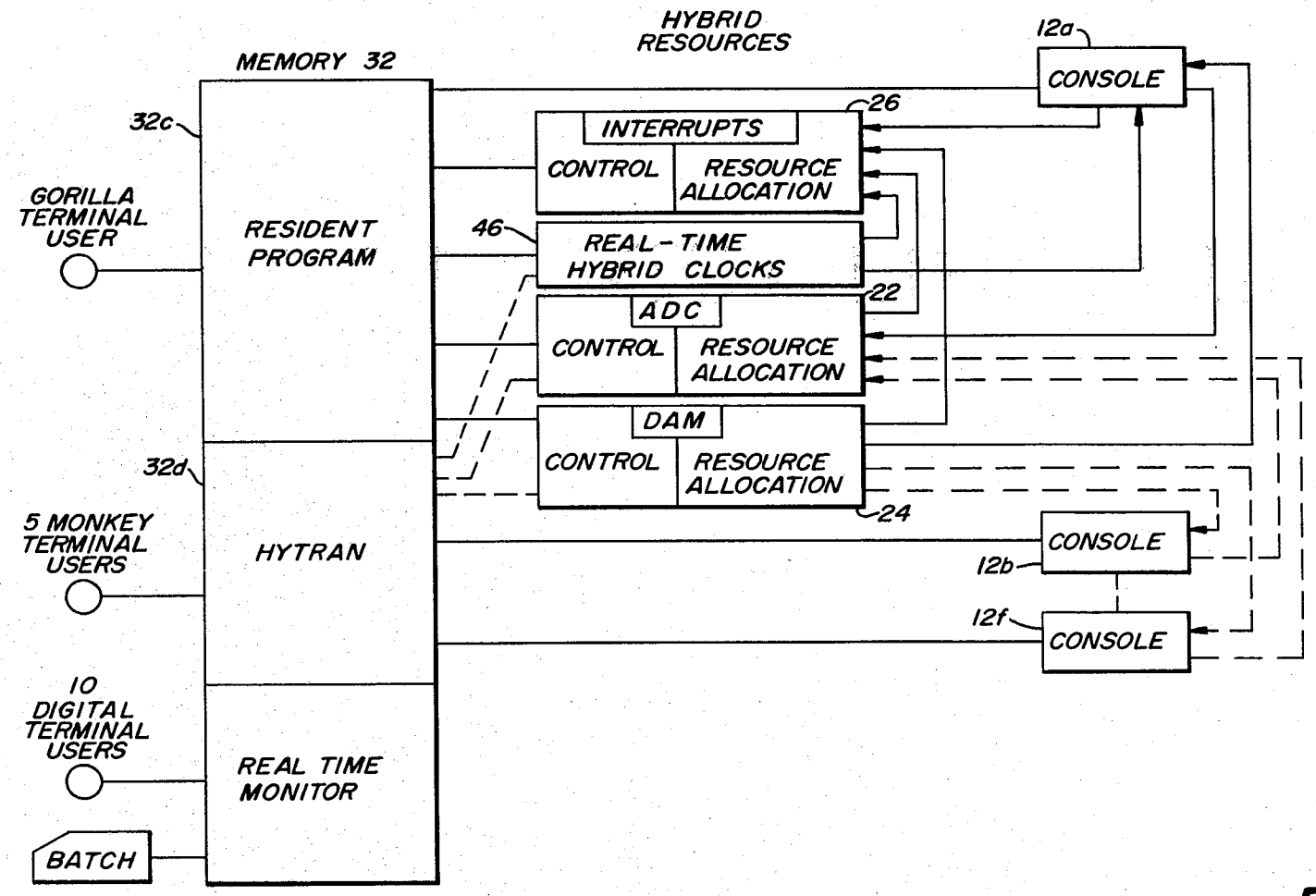

FIGS. 1–3 show the basic concept of sharing hybrid resources among at least two hybrid users in analog/hybrid system 10. System 10 comprises a digital system 18, hybrid controllers 14, linkage 16 and a group of analog computers 12. Digital system 18 includes a central processing unit (CPU) 30 having a main digital memory 32 of, for example, 128 k words, peripherals 38 and related monitors, clocks, interrupts, etc. 36. Digital system 18 includes a system bus 34 which is coupled through hybrid controllers 14 and linkage system 16 to analog computers or consoles 12*a–f*. Analog consoles 12*a–f* are programmed to run analog programs. Hybrid users 37*a–f* control the analog programs as well as their hybrid (digital) programs 39*a–f* stored in memory 32 by means of terminals 38*a–f* of peripherals 38. It will be understood that each hybrid user 37*a–f* may use more than one of consoles 12*a–f*.

CPU 30 is programmed in memory 32 with time sharing programs such as a SEL real time monitor (RTM) program and a terminal support subsystem (TSS) program. In this manner, digital system 18 is shared in a multi-user, multi-task environment so that analog computers 12*a–f* may be assigned to one or more of hybrid users 37*a–f* depending on how many users there are in system 10. The data flow through linkage 16 by way of ADC channels 52 and DAM channels 54 between computers 12 and controllers 14 may be defined as a resource of the system 10 which will be shared amount the hybrid users of the system. After these channels have been allocated, data flows through them without intervention by CPU 30.

There are three types of general users of system 10. The first type is a real time hybrid user which is defined as a user who is going to be time critical (descriptively called the "gorilla"). The second type are hybrid users who run their HYTRAN or HOI simulation programs (Electronic Associates, Inc.) or FORTRAN programs in the debug mode although they may be in a simulation mode which does not require time critical operation. These nontime critical hybrid users are called "monkeys" to distinguish them from the gorilla. The third type of user is a standard digital user such as a user 37*g* on terminal 38*g* who may be doing batch programming and other tests that are applicable to digital work in digital system 18.

System 10 operates multi-task with a plurality of hybrid users such as six, for example, and allows at least one of the hybrid users to become time critical with the others being nontime critical. Data flow between the analog and digital computers is substantially allocated to the gorilla and available to the monkeys. At the same time, other digital users 37*g* may be running with other digital tasks and additionally there may be batch mode 41 running.

FIG. 2 functionally shows an expanded multi-user system 10 comprising six analog computers 12*a–f*, six terminals 38*a–f* dedicated to hybrid users and up to ten terminals 38*g* running digital programs while the remaining mode 41 is batch. This operation occurs substantially all at the same time by means of time sharing. In time sharing, the human reaction of a user is such that he believes that he has all the resources of the system while in fact, the operation is serial in nature. It is understood that it takes about 16–20 milliseconds just for the finger of user 37*a* to hit a button and in that period of time an entire hybrid simulation may be run.

Six hybrid programs 39*a–f* are shown in FIG. 2 running in memory 32. A plurality of interrupts 36 are connected to entire system 10 and additionally, there are digital programs 32*a* as well as batch programs 32*b*. It will be understood that these programs are not required to be resident at the same time and they may roll in and roll out.

Analog consoles 12*a –f* may be assigned to hybrid programs 39*a –f*. In FIG. 2, this assignment is functionally shown as through resource allocation, ADC 52 and DAM 54 and then through reentrant channel programs 60*a, b.* In this manner, there is an environment in which a six console system runs with six separate hybrid users 37*a–f* all using the same ADC and DAM subsystem 52,54 through resource allocation later described. Further, some of interrupts 36 may be controlled by allocator 40 depending upon the desires of the time critical user or gorilla desires. The time critical user may choose any one of eight interrupts from each of consoles 12*a–f* with allocator 40 able to control other hybrid interrupts.

FIG. 3 shows generally from a functional vantage point a time critical user or gorilla and nontime critical users or monkeys. When one of the monkeys decides that he wants his simulation to go time critical, that user then effectively obtains the entire system 10. A user would request to go time critical when he wants his simulation to operate in real time with little or no delay in simulating real time functions. Specifically, a user's simulation would need microsecond responses from system 10 resources. On the other hand, the user who does not need to be time critical may operate with approximately 1000 microsecond responses and essentially time is not important. To go time critical, the user would call for a request real time subroutine (the listings of which are later given) which allows the user's analog programs as well as his digital program to run in real time, viz, become time critical.

A monkey may also become time critical by way of a request signal from the analog program itself. If the request is granted by the digital computer 30, that user then becomes the gorilla and he gets as much of system 10 as he wants, i.e., the resources are substantially allocated to him. After allocation of the data flow channels 52,54, data flow through these channels is automatically controlled by DCM 25 without CPU 30 request or intervention and thus, CPU 30 is able to take care of other tasks. It is to be stressed that as available data flow channels may be allocated to nontime critical analog and digital programs.

As shown in FIG. 3, the gorilla has a resident program 32*c* with the solid lines from the resident program connected to all of the important hybrid interface resources that he requires to run his hybrid simulation. However, it will be understood that simultaneously in a time sharing mode, the monkeys are allowed to run. These are indicated by the dotted line function to the hybrid interface resources with the exception of interrupts 26. The gorilla has interrupts 26 exclusively with complete control over the respective resource allocation.

Monkey programs 32*d* are given different priorities from resident programs 32*c*. These programs may be rolled in and rolled out between core and disc. The program with a higher priority may be rolled in from disc to core and executed and then upon completion of that execution, the checkpointed program that was in core of the lower priority may be rolled back in and executed.

It will be understood that system 10, FIG. 1, may include any number of analog computers 12 and this embodiment provides for a total of six analog computers 12*a –f.* As shown, hybrid controllers 14 include a parallel analog multiplexer (PAM) 20 which couples analog computers 12*a–f* to system bus 34. Controllers 14 also include an ADC portion (ADC/DCM) 22 of data conversion multiplexer (DCM) 25 which couples system bus 34 to ADC channels 52 of linkage system 16. DAM/DCM 24 couples bus 34 to DAM channels 54. In this way, the function of ADC/DCM 22 and DAM/DCM 24 is to connect linkage system 16 with system bus 34 where linkage system 16 is coupled to analog computers 12*a–f* by means of analog interconnections.

The remaining major function of hybrid controllers 14 is the interrupt timer controller (ITC) 26. ITC 26 provides the interrupt resources for system 10 and also provides timer resources for the system. Resource allocator section 40 of ITC 26 controls 16 of the total number of interrupts by way of system bus 34. ITC 26 has a timer resource section 44,46 which provides a total of 15 timers. These 15 timers are distributed through system 10 as a resource.

B. Organization of DCM 25

Figure 4:
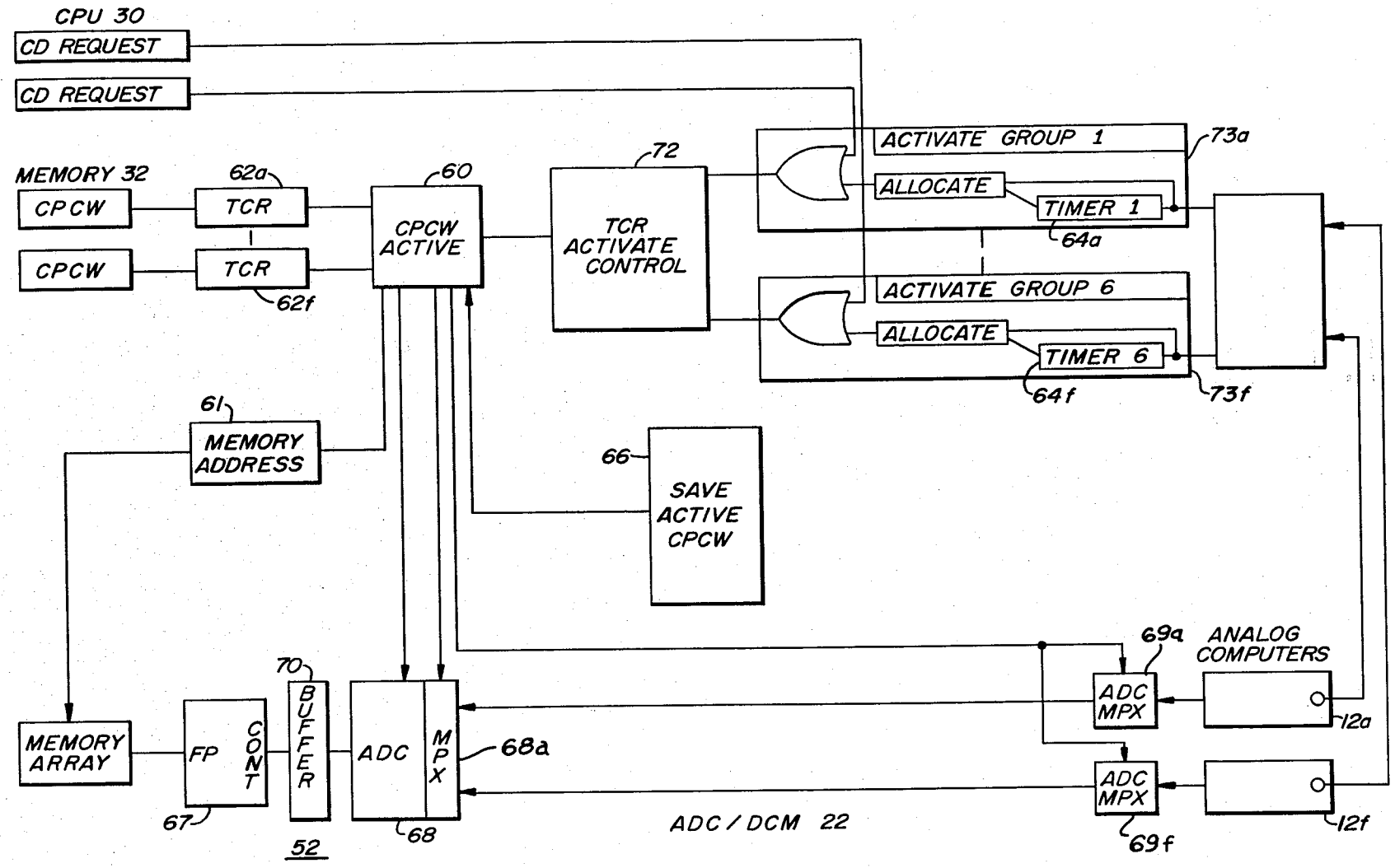
FIG. 4 illustrates in basic block diagram form the DCM section of FIG. 1.

As shown in FIG. 1, DCM 25 comprises ADC/DCM 22 and DAM/DCM 24. Since the ADC 22 and DAM 24 are identical in structure, only one of them, ADC 22, will have its organization described. In FIG. 4, it will be shown that by the use of channel programming control words (CPCW) and related systems and channel programming subroutines, that ADC/DCM 22 is effective to automatically control the data flow channels 52 so that after allocation data flows automatically without intervention by CPU 30. In this manner, ADC 22 and the CPCW system provides for data transfer without request or intervention by CPU 30 so that the CPU can take care of other tasks.

Specifically, FIG. 4 shows a single ADC for six users shown from a general functional viewpoint. CPCW active block 60 indicates a function which provides that any data which is loaded into that function controls the data coming from analog consoles 12*a–f* and going into memory 32 as for example at a selected memory address 61. As shown, there is a data path through a conventional floating point converter 67, a buffer 70 and an analog digital converter 68 and multiplexer 68*a* (ADC 52). When anyone of the users wants to obtain data acquisition from his console 12*a–f* through the mechanism of CPCW active 60, the user addresses through first control signals (produced by the active CPCW) a particular multiplexer 69*a–f* assigned to his console. Accordingly, data flows from analog consoles through multiplexers 69*a–f,* multiplexer 68*a,* ADC 68, buffer 70, converter 67 and into a memory array of memory 32 under the control of second control signals (produced by the active CPCW). In this manner, there is a transition from a scaled fraction to floating point with an automatic loading of the array starting from a location 804*c,* for example.

With regard to the CPCW's, six CPCW's in memory 32 may be transferred to respective transfer control registers 62*a–f.* These CPCW's wait in register 62*a–f* for some stimuli. The stimuli comes from one of the activate groups 73*a–f.* Each of groups 73*a–f* has three basic request functions: (1) patch panel control, (2) timer and (3) digital instruction. Any one of these three request functions can cause a CPCW to become active. Once that CPCW is active, ADC and multiplexer 68 is then automatically controlled. With ADC 68 controlled, the data flow from the analog computers is controlled and is stored in memory under the control of the CPCW by way of memory address 61.

In this manner, there are six CPCW's over a period of time dynamically going in and coming out of active area 60. Further, if ADC 68 is in the process of servicing a monkey and that monkey is swapped out because a gorilla preempts the resources, then the monkey's information is saved in save active CPCW 66 while the gorilla is being placed in the CPCW active area. As soon as the gorilla is finished with system 10, the hardware of ADC/DCM 22 automatically places the particular monkey that was interrupted, back into the system and allows that monkey to continue. In this manner, the resources are independent of any particular user and the hardware is reentrant.

It will now be understood that each of the six analog consoles 12*a–f* may have all the basic functions required to run a separate hybrid simulation with each simulation having a separate hybrid user. The gorilla or time critical user has the principal allocation of the resources and the gorilla user may in fact use up to six consoles 12*a–f* if he wishes, though he may need to use only one. As previously described, only the gorilla can use the interrupt resources through the data flow resources may be used by the monkeys as available. Thus, in FIG. 4, CPCW active block 60 defines the ADC function that is active at that time with the other five functions waiting to become active. Once the ADC function is completed, then that function is saved if required and the next one of higher priority is loaded into the active area.

II. Interrupt Timer Control (ITC) 26

A. Block Diagram Description

Figure 5A:
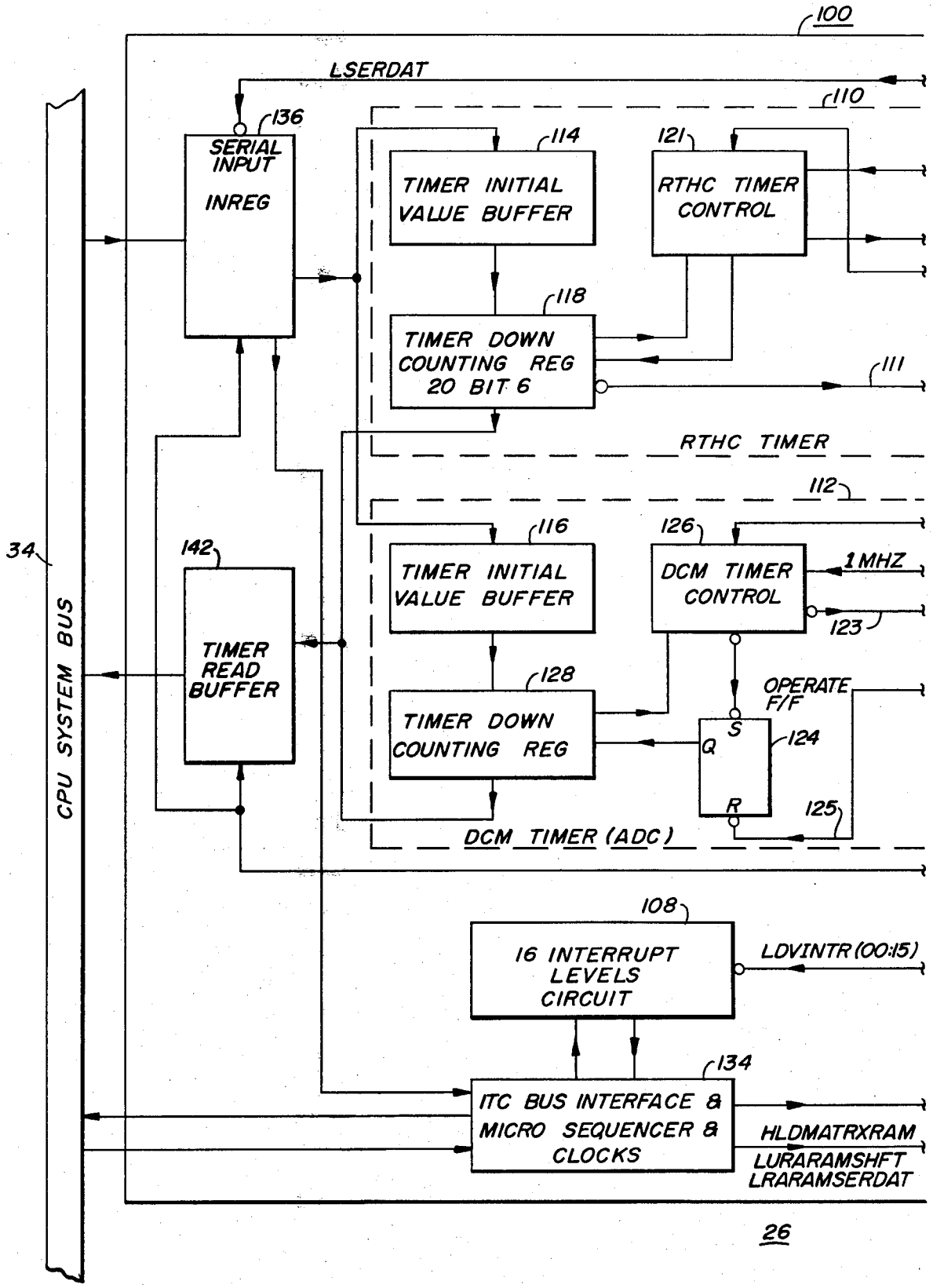
FIGS. 5A–B taken together illustrate in more detail and in block diagram form the ITC section of FIG. 1.
Figure 5B:
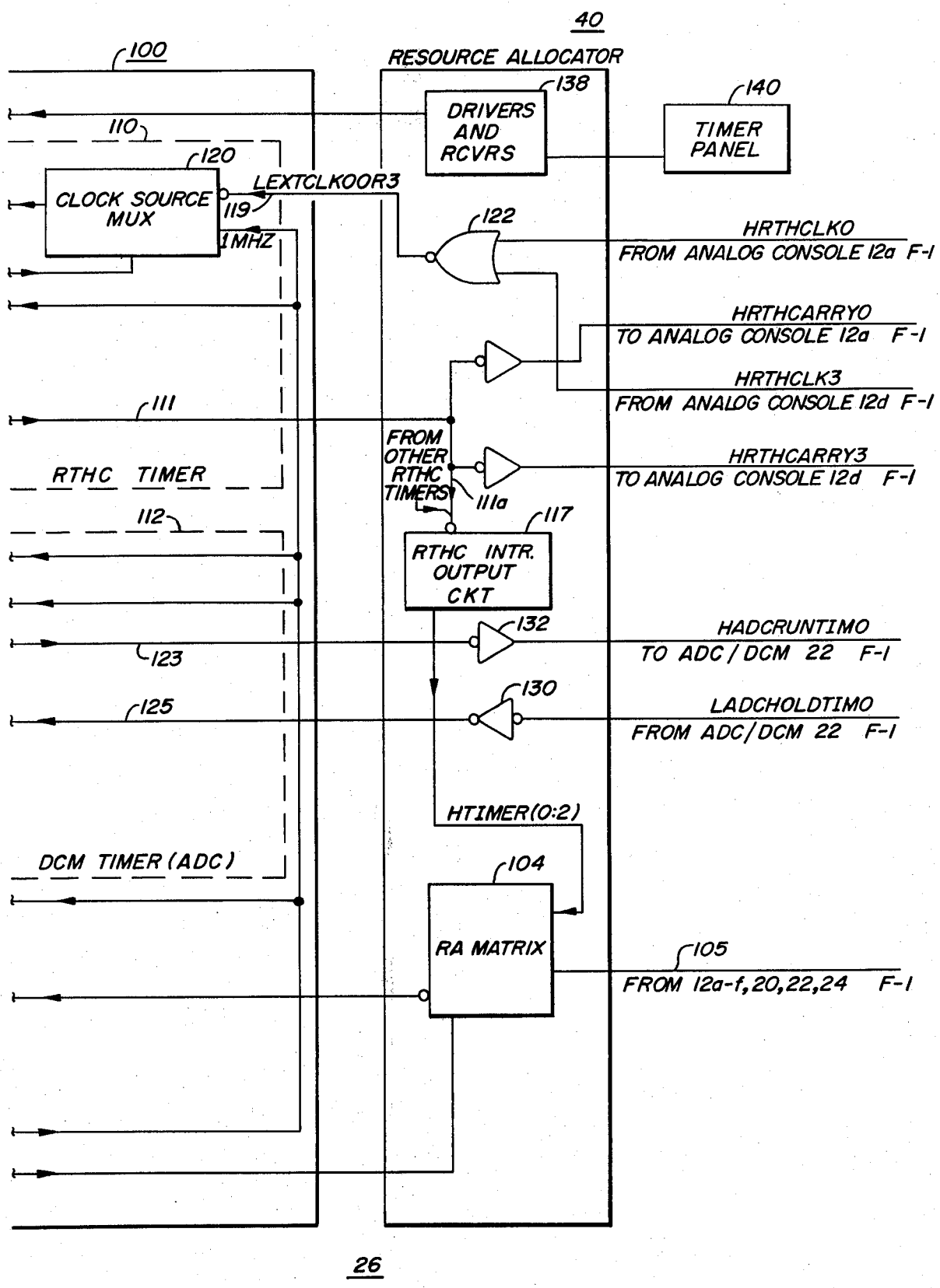

In FIGS. 5A–B, there is shown a generalized block diagram of ITC 26 in which the entire resource allocator 40 has been illustrated. For purposes of simplification only one of the three real-time hybrid clock (RTHC) timers 46 has been shown as RTHC timer 110. Only one of the twelve data conversion multiplexer (DCM) timers 44 has been shown as DCM timer (ADC) 112. It will be understood that the remaining two RTHC timers, the five DCM timers (ADC) and the six DCM timers (DAM) are of similar construction and operation. ITC system 100 comprises all of the RTHC and DCM timers as well as the 16 interrupt levels circuit 108, ITC bus interface 134, INREG 136 and timer read buffer 142.

ITC system 100 serves two general functions. The first function is to control 16 interrupt levels, and the other function is to handle 15 timer circuits. The interrupt level function comprises circuits to enable, disable, activate, deactivate and request interrupt on 16 different levels in the system.

More particularly, resource allocator 40 comprises an RA matrix 104. RA matrix 104 is a switching matrix that connects 16 of the 72 lines 105 which come from various interrupt sources (1) ADC/DCM, (2) DAM/DCM and (3) PAM. The 16 outputs from RA matrix 104 are labeled as indicated and provide the inputs to 16 interrupt levels circuit 108, which provides for the 16 interrupt levels. Multiuser analog/hybrid system 10 has approximately 72 sources of interrupt within the entire system. However, circuit 108 only handles 16 interrupts. Under program control which is later described, RA matrix 104 selects which of these 16 interrupts are important at a time for a particular time critical user (gorilla).

It will be understood that some of the sources on lines 105 are general purpose interrupts (GPI) indicated by lines 15*a–f*, FIG. 1. There are eight of these interrupts for each analog console of an analog computer 12*a–f*. There is also an amplifier overload from each console. Additionally, from DAM/DCM controller 24 and the ADC/DCM controller 22, FIG. 1, there are six inputs that are used as interrupt sources and applied by way of lines 105. Resource allocator 40 selects 16 of the foregoing sources to be applied to circuit 108. In this way, circuit 108 accepts the signal from an interrupt source that has been selected by RA matrix 104 and requests an interrupt from CPU 30 in accordance with the program in memory 32.

RA matrix 104 is programmable in a manner later to be described so that the user program in memory 32 includes instructions that define the matrix to select the 16 interrupt sources of interest.

Of the 72 lines of interrupt 105, there are also three interrupts originating within ITC system 100. As shown, one of these interrupts is applied from RTHC timer 110 by way of line 111 and then through line 111*a* to RTHC interrupt output circuit 117 and then to RA matrix 104.

All of the RTHC timers and DCM timers are loaded under control of the program in memory 32. The timers each have a 20-bit binary initial value register or buffer 114, 116. The user program includes an instruction which starts a selected timer and, at the same time, determines the timer mode of operation. Each of the RTHC timers 110 has three control bits included in the instruction with the 20-bit initial count value. The first bit determines whether the counter is running in a single-cycle or multicycle mode. The second bit determines the source used to down-count the timer. The third bit determines whether or not the counter starts operation upon the load of the initial value or stays in hold mode until a subsequent instruction is issued.

The difference between multicycle and single-cycle mode is illustrated as follows. During loading of the initial value register 114, the initial value is automatically transferred to the timer down-counting register 118. When register 118 starts counting, it decrements the number until the count is all zero. Zero is the terminal count, and then a pulse is applied indicating that the end of count interval has occurred. If it is in a single-cycle mode, timer 110 stops at this point since it has gone through a single timing cycle.

If the control bit for multicycle mode has been selected at the end of the interval, buffer 114 is effective to reload the initial value to down-counting register 118 and to allow that register to continue down-counting. Timer 110 cycles continuously until a specific program instruction is issued to either reload it again or to place it in the hold mode.

The source of decrementing pulses will now be discussed. The source of clock pulses is selected by clock source multiplexer 120, which is effective to select either of two inputs. One of the block sources is marked 1 MHz. A 20-bit counter decrementing at a 1 MHz rate therefore yields a maximum time interval of somewhat more than one second.

The other source is from the low external clock, which is generated by an analog computer in conventional manner. Accordingly, a user may select an external clock, and he can apply a pulse or signal to down-count it at a maximum rate of $\frac{1}{2}$ MHz all the way down to occasional pulses.

Furthermore, RTHC timer 110 may be used to load precise time intervals from the program in memory 32, which determines the time when a carry pulse 111 may be generated. The foregoing may be used as a source of interrupt if it is selected by RA matrix 104. In this manner, a great amount of flexibility is produced in the hybrid program. In addition to loading RTHC timer 110 from the program, a real-time hybrid clock may also be loaded externally from a timer panel 140 which allows setting of a 20-bit value and also the selection of three control bits. Option 1 establishes whether the timer should start immediately or wait until it is started from a program instruction. Option 2 determines whether it is running multicycle or single-cycle. Option 3 decides whether the clock source is the external clock from the analog computer or is using an internal 1 MHz clock.

As previously described, there are 12 DCM timers in ITC 26, with six assigned to ADC and six assigned to DAM. These DCM timers are only loadable through the user's program and only run in multicycle mode. The clock source to a DCM timer, as for example DCM timer (ADC) 112, is a 1 MHz internal clock. A digital computer instruction starts the timer from the user's program. The only way to turn DCM timer 112 off once it is started is by means of a signal from a predetermined DCM, which resets the operate flip-flop 124. Operate flip-flop 124 has its S input connected to DCM timer control 126. A pulse at this S input provides at the Q output a one state which allows a timer down-counting register 128 to begin counting. It will be understood that user program instructions initially activate the S input by way of DCM timer control 126.

As previously described, input R of operate flip-flop 124 is coupled through a buffer 120 to an ADC, since in this example timer 112 is ADC. The nomenclature of the signal indicates that it is an ADC timer 0, and the signal is clear operate. There would be a total of 12 such signals of this type coming through resource allocator 40.

Register 128 reaches its end-of-interval count and outputs a pulse on line 123 as indicated. That pulse passes through inverter 132 and is then applied to the ADC/DCM 22 and produces the same action as a run signal on an analog computer patch panel in conventional manner. In this manner, this signal indicates thart the ADC/DCM 22 is to process a block of data.

When all the blocks have been run, ADC/DCM 22 FIG. 1 sends a pulse back and operates the operate flip-flop 124 to an off state by way of line 125. Typically, when the programmer desires to generate a block of data, DCM timer 112 is set, and at the end of the timed interval the signal on line 123 is sent out to ADC/DCM 22 as HADCRUNTIMO. In this manner, a block of data is then generated. This pulse generates a new block of data every time it is produced until logic on ADC/DCM 22 indicates all the data blocks are finished. The reset signal on line 125 is produced to turn timer 112 off by way of the R input to operate flip-flop 124.

It will be understood that timer initial value buffer 116 is identical to buffer 114, with register 128 being the same as register 118.

It will be understood that only the RTHC timers may all be turned off at once. DCM timers may all be turned on simultaneously, but not off simultaneously.

ITC bus interface block 134 includes a microsequencer and clocks. This block recognizes when CPU 30 is attempting to make a bus transfer to ITC system 100. Accordingly, it controls the data accepted into register 136 and coordinates communication between CPU system bus 34 and system 100.

Drivers and receivers 138 are drivers and receivers accessed from timer panel 140. RTHC interrupt output circuit 117 generates a 1-microsecond pulse to RA matrix 104 whenever RTHC timer 110 reaches the end of an interval. The 1-microsecond pulse serves as the interrupt request to the interrupt circuit.

B. ITC Microsequencer 134 Firmware Flowchart

The following is a description of the firmware flowchart for microsequencer 134. It will be understood that the microsequencer functions in a manner similar to a small computer, since it has a stored program in memory (PROM).

In the symbology of the flowcharts a diamond represents a branch instruction. A box represents order instructions, and an oval signifies a connector. A two-digit number to the left of a block represents a hexadecimal number and corresponds to the address location in microsequencer or PROM 134 of the specified instruction. The hexadecimal numbers enclosed in parenthesis are for reference and are mainly found on another sheet.

Figure 6A:
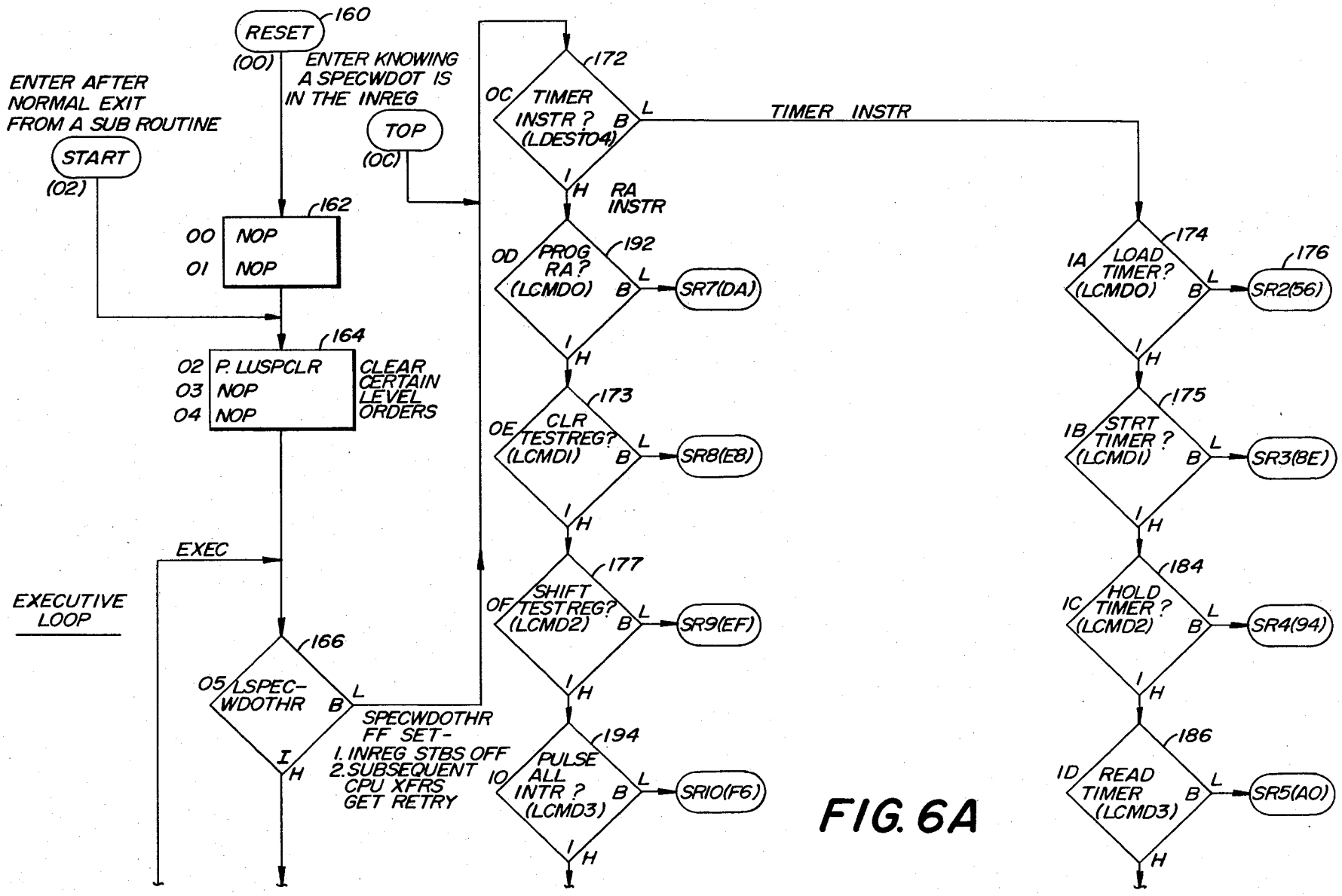
Figure 6B:
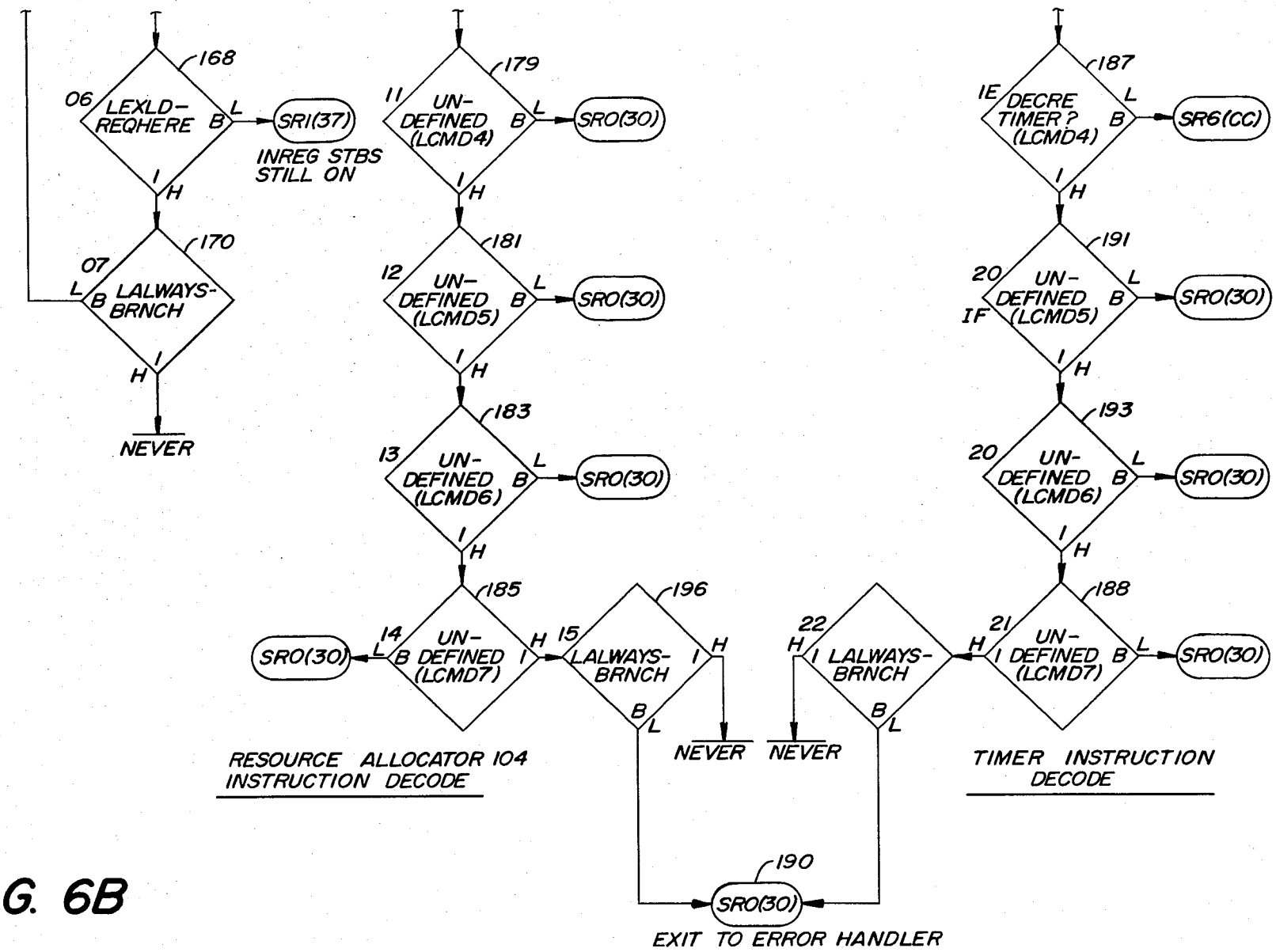

Starting with the flowchart in FIGS. 6A–B, for example, entering from a system reset would start at oval 160 and would then go to memory location 0 at box 162. A NOP instruction is then executed.

If the system reset is pressed on computer 30, a pulse is transmitted to all of the controllers 14 in system 10. This is the general sheet function so that all the parts of the system start at a known state. At reset, microsequencer 134 goes to address memory location 00, pulls out the instruction, decodes the instruction, and finds that it is an NOP (no operation). This is a special case of an order instruction where neither of the pulses are generated and no level is changed.

Microsequencer 134 then goes to the next sequential location, which is 01 as shown in box 162. The next instruction is then pulled out and it is an NOP again. The next location 02 is then incremented in box 164, which is an order instruction where the P represents pulse. The pulse is a signal L micro special clear. This signal will clear certain level orders and it is an initializing type of function. Next are two FOP's followed by an executive loop as shown.

Most of the time, microsequencer 134, if it were examined with a logic analyzer, would be sequencing between these three branch instructions, viz, memory locations 05, 06, 07. From 07, the executive loop goes back to 05.

In location 05, as shown in diamond 166, the decision is based on the query: is the signal L special WDOT here? It is deciding whether or not CPU 30 has made a transfer out of ITC 100 to load a timer. If that signal is low, it is going to branch. For purposes of terminology, the L exits if that signal is low. On the other hand, the H exits if the signal is high. Within diamond 166, the B signifies that microprocessor 134 is doing a branch, and the I indicates that is is just incrementing to the next consecutive memory location.

Assuming that CPU 30 has not transferred in, the signal will be high, which means that there is to be an incrementing down to location 06, diamond 168. At that diamond the question asked at 06 is whether the timer panel 140 is trying to load a timer. If not, it goes down to the next diamond 170 and tests the Signal Low Always Branch. This signal is always held low so that it is an unconditional branch back to location 05.

In the executive loop, the microsequencer 134 is waiting for CPU 30 to transfer some data into system 100 or waiting for panel 140 to actuate a timer load. When either of these events occurs, branch will occur in microsequencer 134. For example, when an ITC instruction in CPU 30 is executed, the first branch at location 05, diamond 166 is made to location OC, diamond 172.

At diamond 172 a decision is made as to whether it is a timer instruction or an instruction to program a resource allocator matrix 104. If it is a timer instruction, the branch exit is taken to location 1A, diamond 174, and the data from CPU 30 is held in ITC system 100 so that the kind of timer instruction may be determined.

Microsequencer 134 basic decision making process is illustrated here. When a condition causes a branch, the branch is made to a subroutine. For example, in loading a timer at address 1A, a load timer instruction is found as the condition. The branch to SR2, oval 176, is taken and that location is 56.

All other instructions are similar. The type of instruction is determined, and then branches to a subroutine are made to increment a given instruction. Diamond 175 indicates start timer, diamond 184 indicates hold timer, diamond 186 designates read timer, and diamond 187 indicates decrement timer where the timer is any one of the RTHC timers 110 or DCM timers 112.

The following are the instructions for loading the timer. The first instruction is oval 202 FIG. 7B. Data is stable in input register 136, and the strobes of the input register are turned off due to the fact that a special WDOT command from CPU 30 has come in or the input-register-busy flip-flop is set. In this case, it is the special WDOT flip-flop that has been set. The listed instructions are executed, and finally the branch diamond 204 cycles back to start oval 206, and the timer is loaded.

In loading the timer from the TCP, oval 200 is entered when loading the timer from the timer panel 140. The switches in this panel that place a 20-bit interval value into an RTHC timer 110 have been set. There are three other control switches. One is for selecting the external clock or the internal clock, one is to specify whether it is to be a multicycle or single-cycle mode of operation, and the third determines whether the timer starts upon loading or whether the timer should just be loaded. This does not apply to a DCM timer 112. The instructions accessed from oval 200 are activated when the load switch on timer panel 140 is pushed. Microsequencer 134 then serially shifts in all the bit information, both initial value and control bits. These bits are brought in serially and loaded into IN register 136. Once register 136 is loaded, then the timer is loaded just as it is under program control. At the end of SR 1, the branch in diamond 208 goes to SR 2 oval block 210 FIG. 7A.

Figures 7B, 7C, 7D:
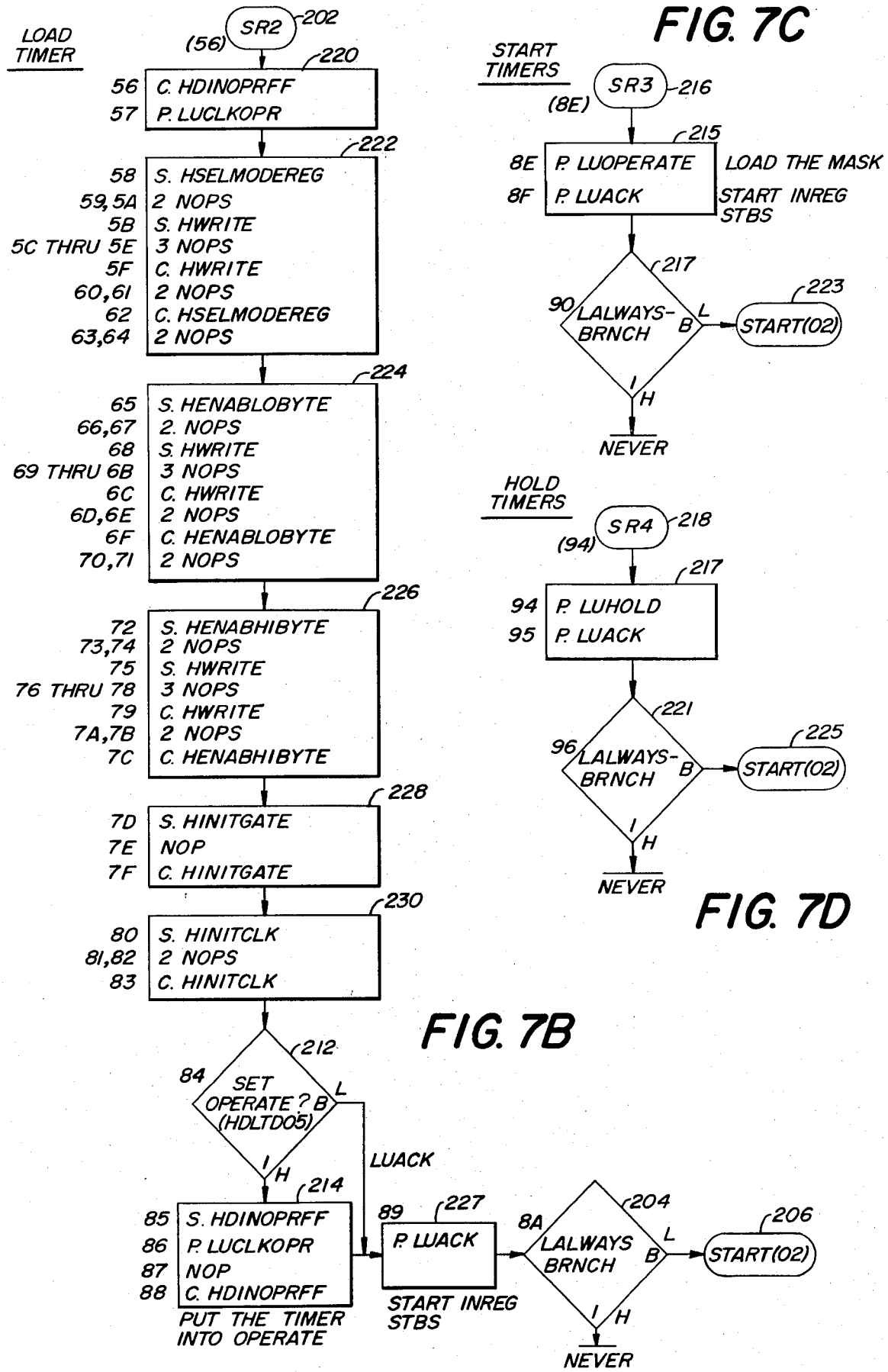

Diamond 212 in SR 2 FIG. 7B decides whether the timer should run immediately. It can go into operate or it can stay in hold. Depending upon this decision, it performs the instructions in box 214 to start. This determines whether it is supposed to start, or bypass box 214, or whether it is supposed to stay in hold.

SR 3 oval 216 accesses a subroutine to allow the program to start all fifteen timers (shown in FIG. 1 as timers 44, 46) or any number of these timers at the same instant. In the subroutine, the timers may be placed into operation if a bit in the program instruction is set.

SR 4 oval 218 FIG. 7D is a hold-timers instruction and is applicable only to the RTHC timers 110. This is a type of inverse instruction of the start-timers SR 3. All three RTHC timers may be placed in hold at the same time or in any combination.

SR 5 oval block 260 FIG. 8 is a read-timer instruction. For example, if a timer was loaded, the programmer might want to read it back and make sure it was loaded. Further, if the timer was down-counting, the programmer might want to read the timer to see what the present count is. The programmer would implement this program instruction in CPU 30 to accomplish this. This is really a two-part instruction. The programmer executes two different instructions in CPU 30 to read a timer. The first instruction goes to system 100 tells which timer is to be read, causes the respective timer to be read, takes the present count, and places it in timer-read buffer 142. Once this has been accomplished, it can be following with a second instruction of the read sequence, which goes out and just transfers the data in that read buffer back into the program. In order to read the timer, the programmer has to provide a series of pulses to get it programmed correctly, that is, to actually get the data out of it and to get it loaded into the timer-read buffer.

The following instructions are all related to resource allocator matrix 104. SR 7 oval 300 FIG. 9 is a program resource allocator instruction, and this subroutine allows the program to select 1 of the 72 interrupt source inputs and connect it to one of the 16 outputs. To fully program the resource allocator, 16 of these instructions are required to be executed to connect all 16 outputs.

The code in box 302, ending in a branch instruction in diamond 304 asking the question: Done?, is taking the data and shifting it serially into an RA matrix 104. Once this data has been shifted out at box 306, there is a signal high load matrix RAM. That signal is asserted and turns off RA 104, which has been operating. Then a strobe is generated to write the data into Ra 104 and then the RA logic is turned back on again at hold load matrix RAM.

Figures 6C, 7A:
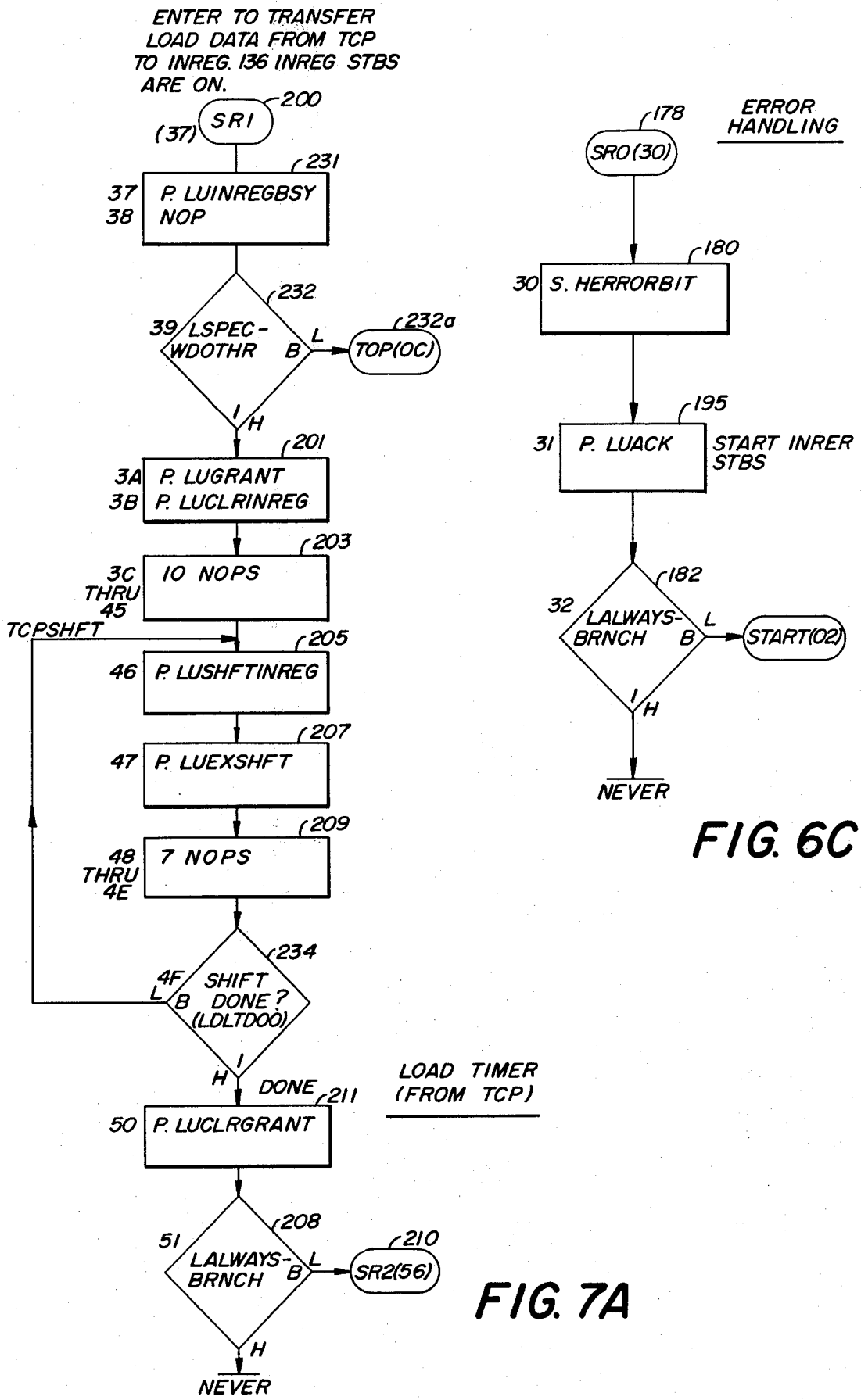

SR 0 oval 178 FIG. 6C is a default instruction. If something happens in microsequencer 134, it branches somewhere it should not because of a logic malfunction. It should branch to this subroutine indicated at oval 178 and set an error bit in box 180. A technician can then connect an oscilloscope to a test socket to see if it is set.

The following additional information relates to the instructions listed in the blocks of the ITC microsequencer 134 firmware flowcharts.

| Block | Instructions |
|---|---|
| 216 | Enter to parallel-load the OPR FF's based on the mask in the INREG. A LO mask bit will set its OPR FF to operate state. |
| 217 | Load the mask. Start INREG STBS |
| 218 | Enter to parallel-load the operate FF's based on the mask in the INREG. A LO mask bit will set its operate FF to the hold state. |
| 220 | Put the timer into hold by clearing its operate FF |
| 222 | Load the timers mode REG. |
| 224 | Load the LO BYTE of the MS group. |
| 226 | Load the HI LYTE of the MS group. Also set jam carry if both BYTES were zero. |
| 228 | Initialize the gate input of the timer and load the LS group bits into the timer buffer. |
| 230 | Initialize the clock input of the timer and load the LS group bits from the timer buffer into the timer count register. |
| 231 | Stop INREG 136 STBS and give retry to subsequent CPU transfers. |
| 232 | Exit because a CPU transfer has sneaked in. INREG STBS are off. |
| 234 | Shifting is done when the marker bit reaches this position in the INREG. |
| 262 | Enable outputs of LS group REG. Prep mode REG for a latch read. |
| 264 | Gate mode REG to bus. Chip address = mode REG enable 2 MHz clock to LS group read buffer. |

-continued

| Block | Instructions |
|---|---|
| 266 | Write the mode word. |
| 270 | Read the LO BYTE of the MS group and clock it into the read buffer. |
| 272 | Read the HI BYTE of the MS group and clock it into the read buffer. Also clock the timers address into the read buffer. |
| 276 | Exit with the timer interval value in the timer read buffer. A special CD "RSTX" will transfer the contents of the buffer to CPU's GPRO. INREG STBS are on. |
| 300 | Enter to load RA RAM. INREG STBS off. INREG bits 21–31 is RAM value. INREG bit 20 in the shift marker is low. All other INREG bits are high. |
| 302 | Shift bit into RA. Then shift next bit out of INREG. |
| 304 | Marker bit not in DLTD05 yet - continue. |
| 306 | Freeze RA logic. Generate write RAM STB. |
| 308 | Start INREG STBS. |
| 312 | Exit - one of the RA RAMS 16 locations has been loaded. |
| 201 | Enable the closest requesting TCP. Clear INREG so the marker bit (a logic HI) may be recognized. |
| 203 | Wait for 1430 ns (min) to allow the first data bit from the TCP to become valid. |
| 205 | Shift a TCP data bit into the LSB of the INREG. |
| 206 | Exit - Timer is loaded. |
| 207 | Shift next bit out of the TCP |
| 209 | Wait for 1012 ns (min) to allow the TCP bit to become valid at the INREG. |
| 210 | Exit with timer load data stored in the INREG. INREG STBS off. |
| 211 | Clear the grant FF of the TCP just serviced. |

C. ITC Instruction Format for Microsequencer 134

Microsequencer 134 has two different instructions. One is the order-type instruction in which it can output one of a number of pulses, or it can output another pulse, or it can change the level of a signal from a high to low or a low to a high. The other type of instruction is a branch instruction which branches on condition true or on condition false to some other part of the microsequencer memory. Each memory location in the microsequencer PROM then contains instructions which are either branch instructions or order instructions.

The following are the two different types of format:

TABLE I

| | | | | | | | | | | | | | | | | |
|---|---|---|---|---|---|---|---|---|---|---|---|---|---|---|---|---|
| CONTROL PROM OUTPUT (16 BITS) | 0 | 1 | 2 | 3 | 4 | 5 | 6 | 7 | 8 | 9 | 10 | 11 | 12 | 13 | 14 | 15 |
| | INSTR. FIELD 'A' | | | | | | | | INSTR. FIELD 'B' | | | | INSTR. FIELD 'C' | | | |
| ORDER INSTRUCTION FORMAT | ϕ | LEVEL ORDER | | | 1 = SET<br>0 = RST | | | | PULSE ORDER "X" | | | | PULSE ORDER "Y" | | | |
| | OP CODE | | | | | | | | | | | | | | | |
| CONDITIONAL BRANCH INSTRUCTION FORMAT | 1 | INPUT TESTED | | | | | | | BRANCH ADDRESS | | | | | | | |

TABLE II

| Level Order Group | | |
|---|---|---|
| Field 'A' (HEX) | | MNEMONIC OF LEVEL GENERATED |
| To RST | To SET | |
| 00 | 01 | NOP |
| 02 | 03 | HDIN |
| 04 | 05 | HWRITE |
| 06 | 07 | HREAD |
| 08 | 09 | HLDMATRXRAM |
| 0A | 0B | HWRITERAM |
| 0C | 0D | HPULSALLINTR |
| 0E | 0F | HENABHIBYTE |
| 10 | 11 | HENABLOBYTE |
| 12 | 13 | HREADSEQ |
| 14 | 15 | HSELMODEREG |
| 16 | 17 | HINITGATE |
| 18 | 19 | HINITCLK |
| 20 | 21 | HERRORBIT |

| Pulse Order Group 'X' | | Pulse Order Group 'Y' | |
|---|---|---|---|
| Field 'B' (HEX) | MNEMONIC OF PULSE | Field 'C' (HEX) | MNEMONIC OF PULSE |
| 0 | NOP | 0 | NOP |
| 1 | LUOPERATE | 1 | LUCLRGRANT |
| 2 | LUHOLD | | |
| 3 | LUACK | | |
| 4 | LUSPCLR | | |
| 5 | LUINREGBSY | | |
| 6 | LUSHFTINREG | | |
| 7 | LUCLRINREG | | |
| 8 | LUCLKOPR | | |
| 9 | LUCLKHIBYTE | | |
| A | LUCLKLOBYTE | | |
| B | LURARAMSHFT | | |
| C | LUSHFTESTREG | | |
| D | LUCLRTESTREG | | |
| E | LUGRANT | | |
| F | LUEXSHFT | | |

| TEST INPUTS | | | |
|---|---|---|---|
| Field 'A' (HEX) | | MNEMONIC OF TEST INPUT | LEVEL OF TI TO CAUSE BRANCH |
| When BR. AD. MSB. = 0 | When BR. AD. MSB. = 1 | | |
| 80 | 81 | LALWAYSBRNCH | L |
| 82 | 83 | LSPECWDOTHR | L |
| 84 | 85 | LDLTDOO | L |
| 86 | 87 | HDLTDO5 | L |
| 88 | 89 | LEXLDREQHERE | L |
| 8A | 8B | LDEST02 | L |
| 8C | 8D | LDEST04 | L |
| 8E | 8F | LRTHCGRP | L |
| 90 | 91 | LCMD0 | L |
| 92 | 93 | LCMD1 | L |
| 94 | 95 | LCMD2 | L |
| 96 | 97 | LCMD3 | L |
| 98 | 99 | LCMD4 | L |
| 9A | 9B | LCMD5 | L |
| 9C | 9D | LCMD6 | L |
| 9E | 9F | LCMD7 | L |
| A0 | A1 | LIMHZSYN | L |
| A2 | A3 | HIMHZSYN | L |

III. BASIC BUS INTERFAC (BBI) 21

A. Block Diagram Description

Figure 10A:
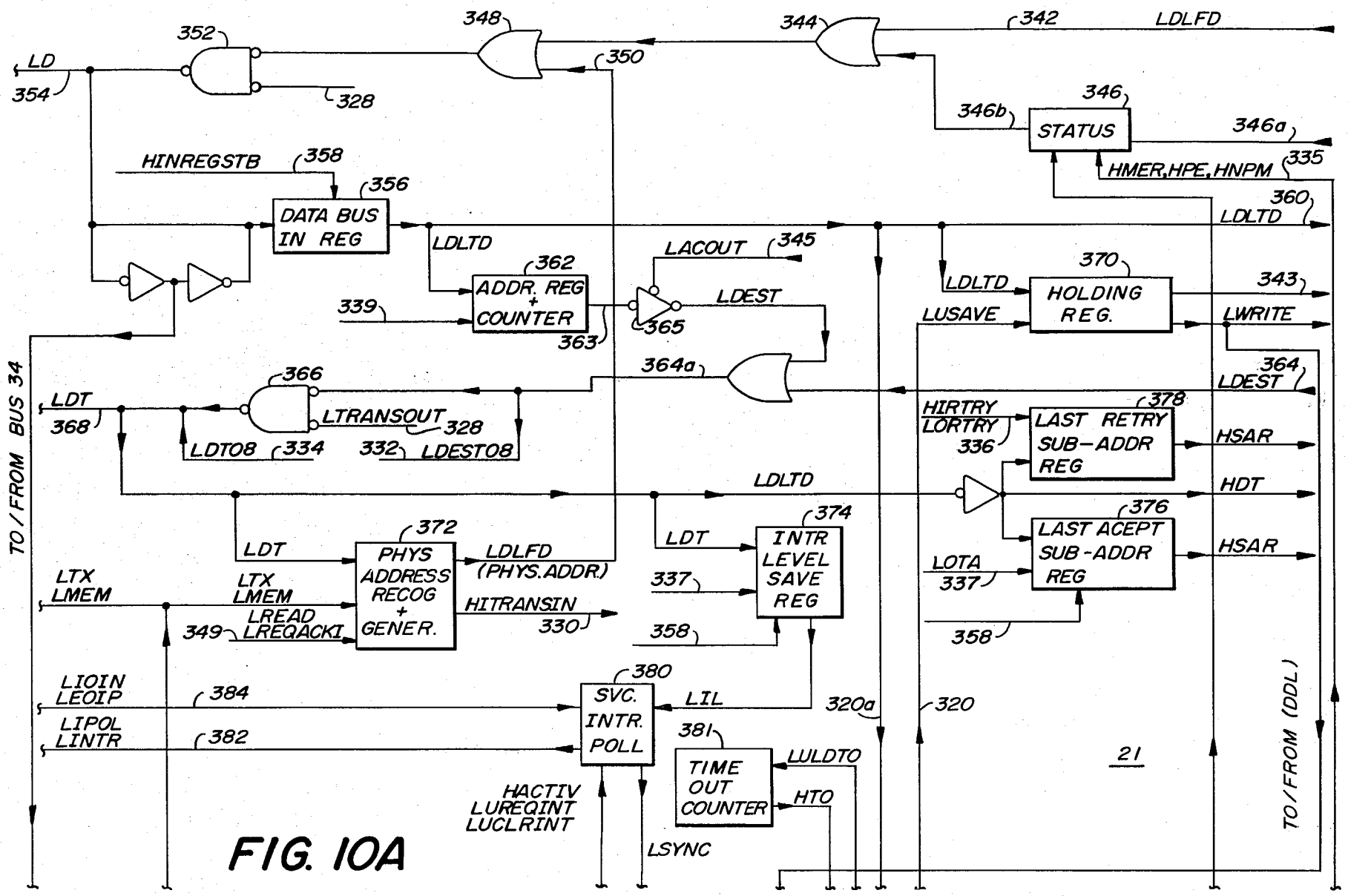
Figure 10B:
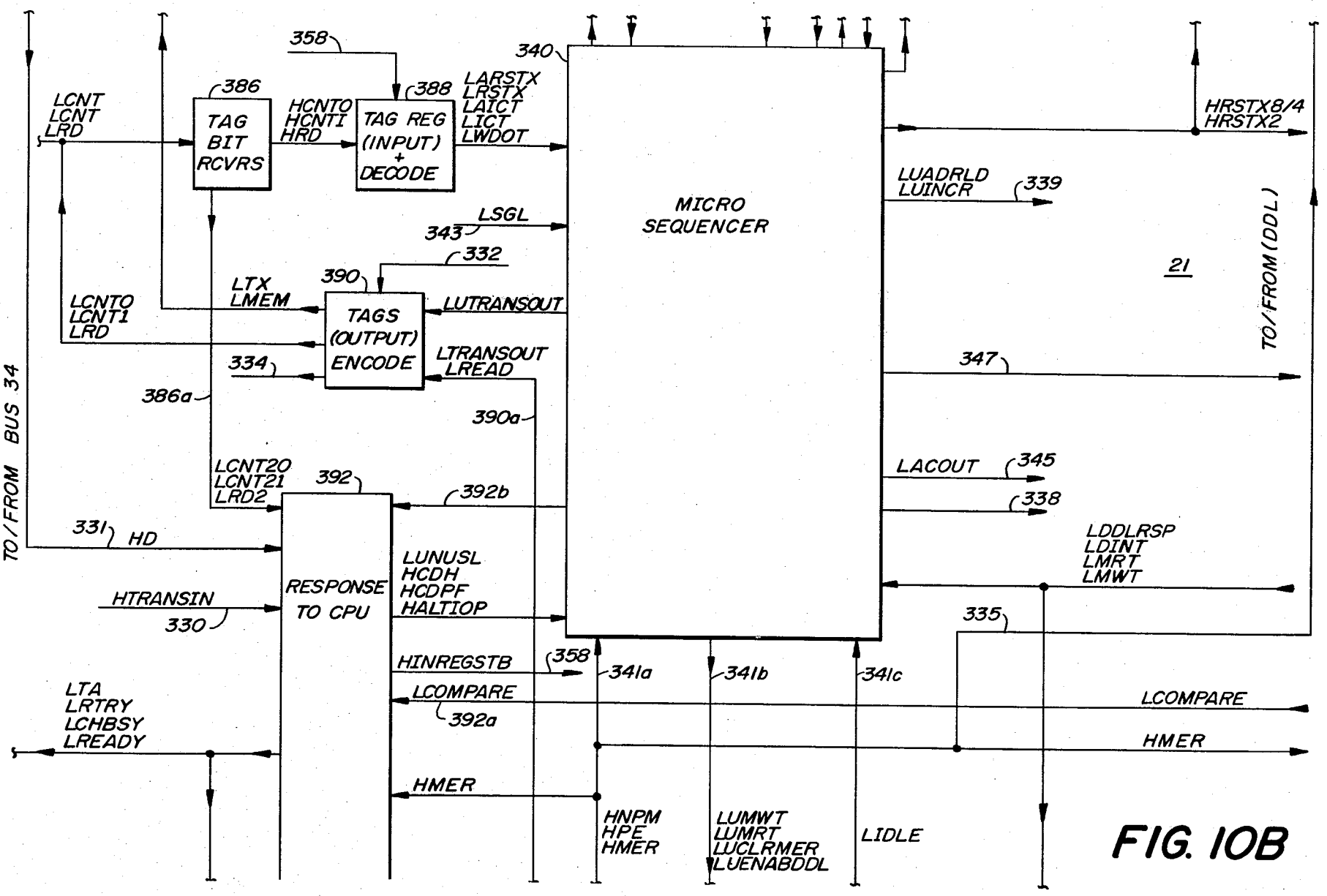

Basic bis interface (BBI) 21 is used in the parallel analog multiplexer 20. In addition, a modified form of BBI 21 is used in ADC/DCM 22 and DAM/DCM 24. As shown in FIGS. 10A–C, BBI 21 interfaces with CPU system bus 34, and the signal nomenclature is that used with SEL 3200 series computer. BBI 21 also interfaces, for example, with the devices of PAM 20, and these devices are defined as device-dependent logic (DDL). The details of this nomenclature will be described later in detail.

The purpose of BBI 21 is to simplify the interfacing with CPU system bus 34 to take care of the protocol. In addition, the interfacing of the bus itself provides the user with signals to allow transfers between memory 32 and also allow other inputs/outputs without having to operate within the structure of the timing of bus 34. Microsequencer 340 is very similar to microsequencer 134 of ITC 26 except that the flowchart is different since it has been programmed for a different purpose. However, the same concepts are used; for example there are two instructions, viz, a branch instruction and an order instruction. The flowchart for the BBI also has an executive loop. The executive loop of microsequencer 134 checks to see whether or not a CPU transfer has occurred.

Simpler than microsequencer 340 is the memory access sequencer (MAS) 341, which handles the control signals to perform memory read and memory write transfers. MAS 341 is normally inactive until microsequencer 340 recognizes the DDL logic request as, for example, a memory write. The DDL logic places the address on the destination bus lines and puts the data on the data lines. The DDL logic then asserts a requesting memory write service, and microsequencer 340 recognizes that signal and invokes MAS 341. Microsequencer 340 then accepts the memory address and the memory data and activates some of the lines of CPU bus 34, thereby giving access to the bus. This transfers information in the address to the memory bus controller of CPU 30, which then takes over and does the writing into memory 32.

Memory read works in a similar fashion. The DDL user, in order to access data from memory, has to supply memory address called a destination bus, LDEST 364. Then a signal is asserted requesting some memory read service from microsequencer 340. Microsequencer 340 recognizes that and, in each case, sends back to the DDL logic a signal recognizing the request. It then invokes the MAS 341, which gives the address to the memory bus controller of CPU 30. A few cycles later the CPU memory bus controller sends the required data back to BBI 21, and the BBI then asserts a signal to the DDL saying that the data is present.

For memory read and memory write, there are three modes of operation, viz, fast mode, delay mode and slow mode. In the fast mode, for memory write the DDL has a block of data, and it makes this data available to BBI 21 fast enough so that the BBI operates at its maximum rate in transferring data to memory 32. In the slow mode, the DDL sends one word at a time, and the BBI 21 runs at something less than full rate. The delay mode is somewhere in between where the DDL logic can have its data available faster than the slow mode but not quite as fast as the fast mode.

One of the other services provided by the BBI is the interrupt service in which the DDL can require a service interrupt. The DDL senses a signal which is an interrupt request, and microsequencer 340 recognizes it and returns a signal which is a request acknowledge. BBI 21 then goes through the procedure of generating an interrupt request to CPU 30.

Another service of BBI 21 allows the programmer to send information out of the BBI. In this case, CPU 30 executes a command device instruction or a test device instruction. The CPU interprets and codes these instructions and outputs data. There are several different command device instructions and several different test device instructions. Whenever one of these transfers is made to BBI 21, the BBI (depending on which type of transfer it is) asserts a signal to the DDL, notifying the DDL that there is some kind of data from CPU 30. The DDL accepts it, and microsequencer 340 is then done.

Lines 342 are 32-bit lines designated LDLFD, and the user puts data on this bus primarily when requested to by BBI 21. An OR gate 344 ORs this data with data from a status block 346 which provides status bits. The output of gate 344 is ORed by gate 348 with physical address data on lines 350. The output of gate 348 is applied to one input of an AND gate 352, the output of which is applied to bus 34. In this manner, information may be driven on to bus 34, or 32 bits may be taken off the bus and loaded into a data bus input register 356. Register 356 is always loaded.

Every 150 nanoseconds, the input register 356 is loaded from bus 34 whether the data on the bus is for BBI 21 or not. When the data is for BBI 21, coincident with that transfer another signal to BBI 21 indicates the data should be saved. The signal is high in lines 358 at that time. The output of register 356 becomes the signal LTLTD on lines 360, and that is the DDL source of data from the CPU.

At different times there is different information on bus 34. At times there is an address destined for counter 362. BBI 21 can save data which is an address in register 362, and then the output lines 363 may be driven to the next bus **364*a* by way of a gate 365. Another bus driver or AND gate 366 drives bus 34 by way of bus LDT 368. Another register 370 is fed from the output lines 360 of register 356. Register 370 is called a holding register, which holds several bits specifying the type of instruction on bus 34. The destination bus 368 from bus 34 is also a bidirectional bus. Bus 368 has 19 lines, some of which are coupled to a physical address recognition and generator circuit 372. Other lines go to interrupt level save register 374. The remaining three lines from bus 368 drive the last accepted subaddress register 376 and last retried self-addressed register 378. Selection of which of these registers is used is determined by decoded control bits of the instruction, which places the address on bus 368**.

A service interrupt poll 380 has applied to it inputs from an interrupt level save register 374 and from microsequencer 340. Poll 380 has two output lines 382 to bus 34 called LIPOL and LINTR, as well as two input lines 384. Block 380 is primarily concerned with DDL request for service interrupt. This logic at the request of microsequencer 340 generates service interrupt requests to CPU 30.

A tag bit receiver 386 drives a tag register input and decoder 388. Receivers 386 and 388 are effective to decode bits to determine what kind of CPU transfers are being made to BBI 21. Output encode 390 operates so that when BBI 21 is performing a transfer to either memory 32 or back to CPU 30, it configures tag bits correctly.

Response to CPU 392 is the logic that recognizes that the physical address of BBI 21 is on destination bus 368. It says that CPU 30 is trying to transfer to BBI 21, and the decision must be made as to whether the transfer may be accepted, because BBI 21 is not busy, or whether to reject this CPU transfer, because BBI is at a state in which it cannot accept the input transfer.

Bus poll 394 is used every time BBI 21 is required to transfer data onto bus 34, to make sure that no other controller is transferring at the same time. This circuit determines whether a higher priority controller wishes to use the bus and if not, it seizes the bus, and no controller of a lower priority can use the bus. Memory-busy 396 attempts to ensure that memory 32 is not going to be busy the next time it is accessed. This block uses the principle that the last memory module accessed is going to be the next memory module accessed; that is, the same one is accessed. AND gate 398 provides an output LDTF 398*a*, which supplies a bit that is used to determined what kind of transfer is being made. Namely, whether it is a word transfer, a half-word transfer, or a byte transfer. Clock 400 accepts the master clock signal from bus 34 and generates four or five different clocking signals for use on BBI 21. Initialize 402 accepts the reset signal from CPU 30 which occurs when the system reset button is pressed on the front panel of CPU 30. Initialize 402 generates a general reset pulse to the logic on BBI 21 including microsequencer 340 which forces the microsequencer back to address location 0.

Lines 347 from microsequencer 340 have the following designations:

HCDPNDG
HTCWA
HCDBITS
HIOADR
HALTREQ
LUSTOP
HTCWDATA
DHATAREQ
HDINTACK
HACTIV
HHENBLD
HQUED
HRQPNG

Lines 346*a* to status block 346 have the following designations

LPROGVIO
LCNTLRACTIVE
LTDBCC1
LTD4CC4
LTD2CC1
LTD2CC3
LTD2CC4

Also from status block 346, lines 346*b* have the following designations

LDLFD00
LDLFD02
LDLFD03
LDLFD16
LDLFD(28:31)

Further, response to CPU 392, lines 392*b* have the following designations

LUCLRCDPF
LUCLRHALTIO
LUACK
LURDY
HSELO
HSEL1

B. BBI Microsequencer 340 Firmware Flowchart

Figures 11A, 11B:
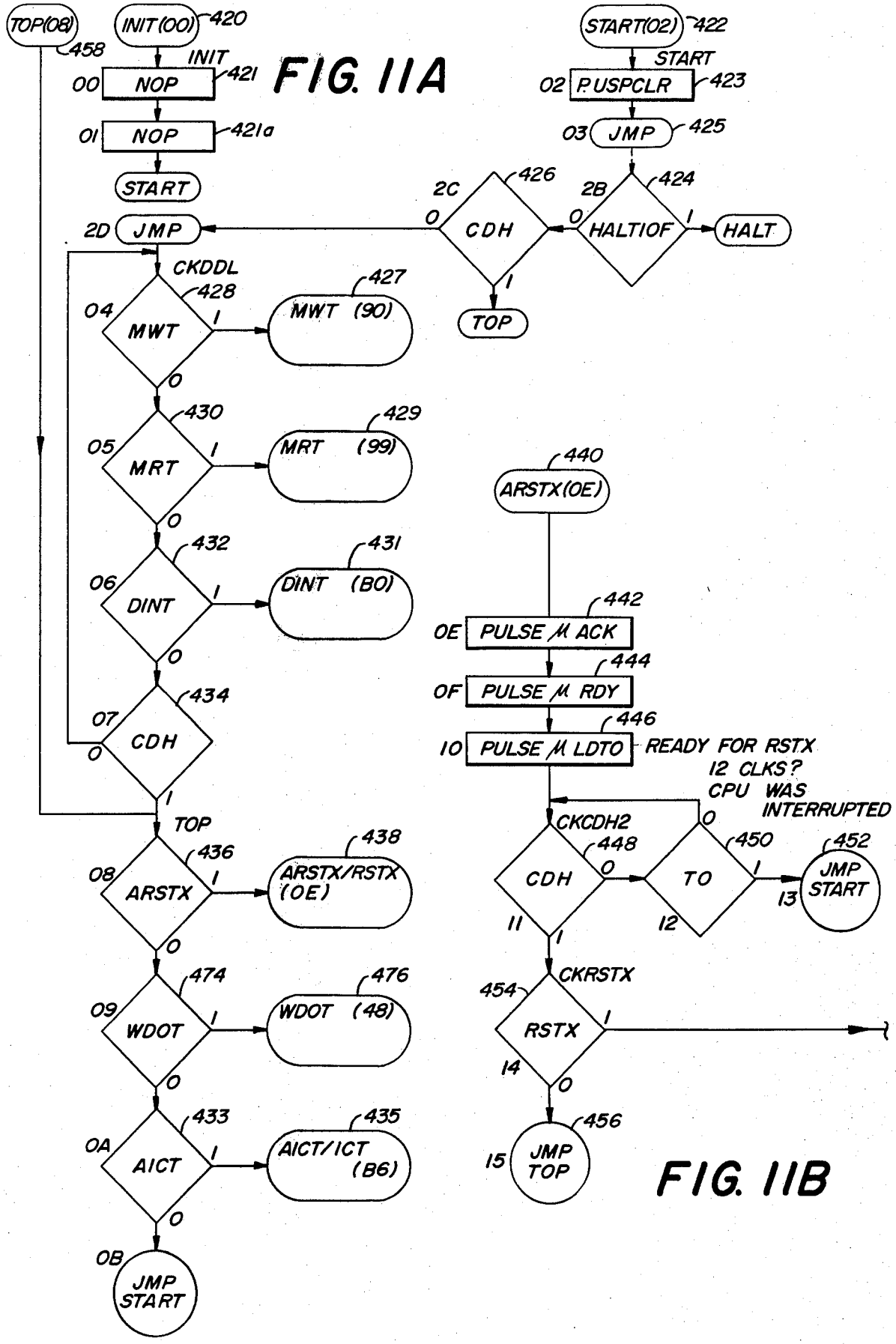
FIGS. 11A–C, 12A–B, 13A–B and 14 taken together illustrate flowcharts for the firmware of the BBI microsequencer of FIGS. 10A–C.

An executive loop FIG. 11A includes diamonds 428–434 labeled respectively MWT, MRT, DINT and CDH. Initial oval 420 indicates the path that microsequencer 340 would take when a system reset button is pushed on the console. It initializes the microsequencer to location 00 in box 421, and the microsequencer begins to sequence. Several NOP's are executed and then there is a branch to start block 423. Intializing is then performed with checks to see if the half IOF flip-flop is set as in diamond 424. If this flip-flop is not set, there is a check to see if CPU data is in CDH diamond 426 with a jump to diamond 428. These four diamonds: 428, 430, 432 and 434 constitute what is called the executive loop.

When BBI 21 is inactive, microsequencer 340 continues sequencing through the executive loop, and the BBI serves the device-dependent logic (DDL) such as PAM logic or DCM logic. The first diamond MWT 428 is memory write transfer, and it is deciding whether or not the DDL user is requesting that the data be written to memory. MRT diamond 430 is deciding whether the DDL wants to read some data from memory 32. The next diamond DINT 432 is deciding whether the DDL wants interrupt service. Finally CDH diamond 434 is deciding whether or not CPU 30 needs some kind of data transfer. The executive loop is continuously scanning these four items.

For example, CPU 30 has decided to transfer some data. When microsequencer 340 goes to diamond 434, the CDH signal would not be 0, but would be a 1, so that a branch would occur down. The code that it would execute would be the ARSTX diamond 436. CPU 30 has labeled some of the bus transfers with various names such ARSTX transfer, RSTX but transfer, WDOT bus transfer, AICT bus transfer and ICT bus transfer. All of these are SEL identification. A transfer to BBI 21 is indicated because of a branch down. It is now required to determine what type of transfer is coming from bus 34.

In the event that it was an ARSTX transfer, the sequencer does a branch out to location OE shown as oval 438. There are four different reasons why CPU 30 should make an ARSTX or advanced read status transfer. One is to gain status information on what is called the 8,000/4,000 level. Another is to obtain status information on the 2,000 level, where these levels are SEL identification. A third reason is that there is a CPU instruction called transfer current word address TCWA in diamond 472. A fourth reason is that there is an RSTX transfer called acknowledge interrupt which occurs as a result of BBI 21 performing a system interrupt.

Figure 11C:
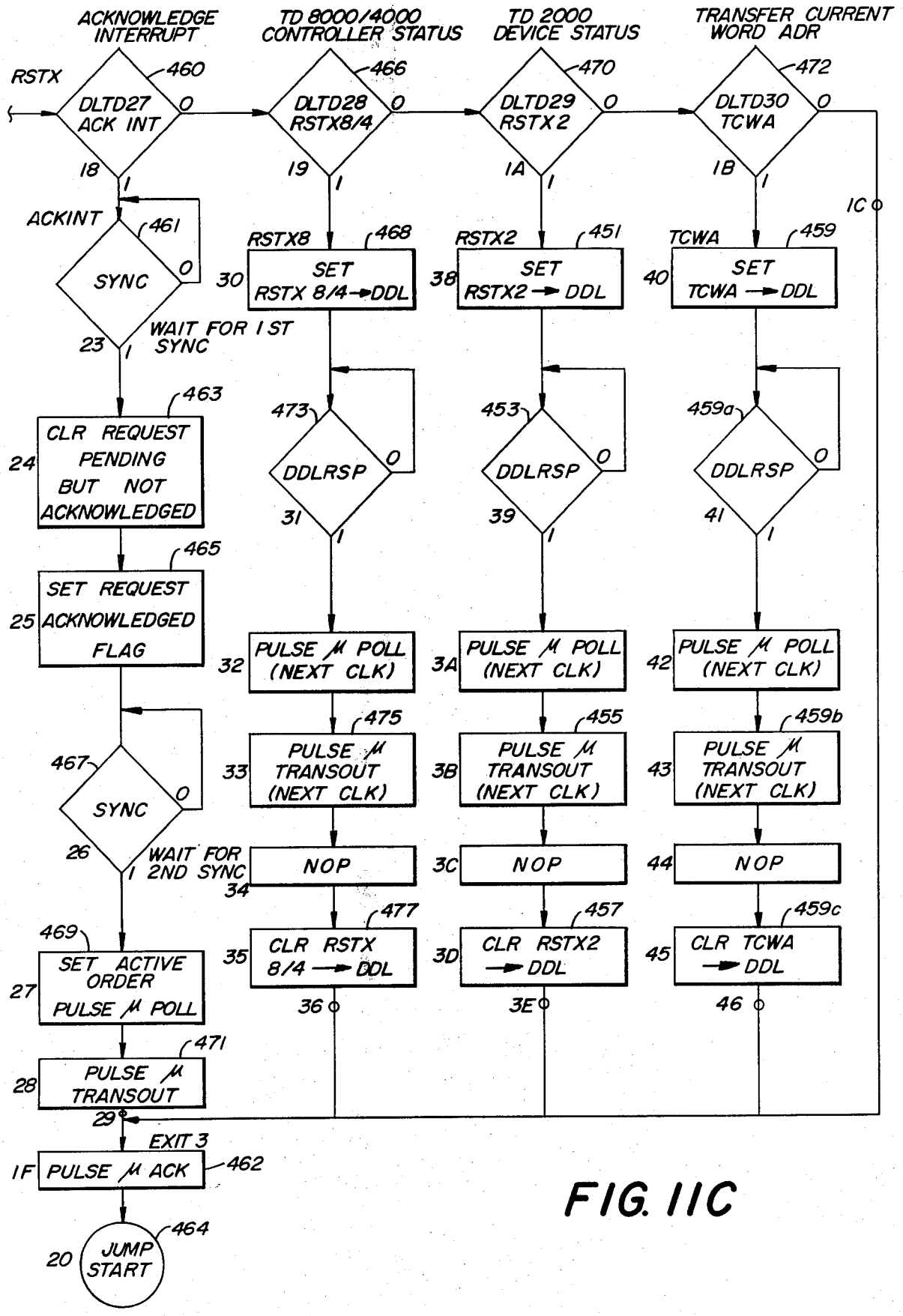

From oval 440, FIGS. 11B–C information is sent to CPU 30, by way of boxes 442, 444, indicating that the transfer was accepted and that an RSTX transfer is now expected. Accordingly, the box indicating pulse LDTO 446 starts a timer. Diamond CDH 448 is executed to check whether the CPU is now transferring the RSTX transfer. If not, the branch to the right to diamond time out 450 is taken to check whether the timer is timed out. If not, the program waits between blocks 448 and 450. It will do that twelve times to give CPU 30 some time to send the RSTX transfer.

At the end of the time out, if CPU 30 has not transferred a new transfer, the CPU has probably been interrupted by some other system on bus 34, and this entire sequence is repeated at some later time. To abort this loop, the branch to the right to oval 452 jumps back to start, and the executive loop is entered again to wait for the next transfer. In the event the next transfer occurs, the branch out to CDH diamond 448 to RSTX diamond 454 is taken which asks the question: is it the executed RSTX transfer? If not, the program jumps to block 456.

If it was not an RSTX transfer, then following block 458, the decision diamonds starting with diamond 436 are executed to find the nature of the transfer. If it was assumed there was an RSTX. then there is a branch out of RSTX 454 to the right to four decision diamonds which test to find out which one of the RSTX transfers it is. If it was an acknowledge interrupt tested by diamond 460, the branch down is taken, and pulses from the microsequencer are sent to the interrupt circuit on BBI 21. The last box executed by diamond 462 is an acknowledge back with a transfer to CPU 30 saying that everything is taken care of. The final jump in jump 464 returns execution to start, which enters the executive loop and waits for the next transfer.

If the RSTX was not an acknowledge interrupt, the next question is whether is was a status check at the 8,000/4,000 level in diamond 466. If it was the branch down, a signal is sent to DDL at box 468 which says the CPU 30 wants status information at 8,000/4,000. A fixed amount of time is given to the DDL to collect that information and give it to the BBI. The flow then continues to do a bus transfer of that information back to CPU 30. After this is finished, the program goes back to start through jump 464.

If it was not that status level check the program goes to the right to the next diamond 470 for a 2,000 level status decision. The 2,000 level status is almost identical to the 8,000/4,000 level status code except that a different signal is sent to the DDL, indicating that it is a 2,000 level status that is to be sent back. If such is in the CPU, then there is a jump back to start through jump 464.

The last type of RSTX check is called transfer current word address block 472. It will be assumed for purposes of explanation that it has been found out that there was a CPU transfer. The manner in which the CPU activates the ARSTX/RSTX type transfer has been described. On the other hand, it may be assumed that the transfer was not of that type and that it was a WDOT transfer. This transfer is checked in the executive loop at WDOT diamong 474. From there there is a branch out to the WDOT code as shown in oval 476.

Figure 12A:
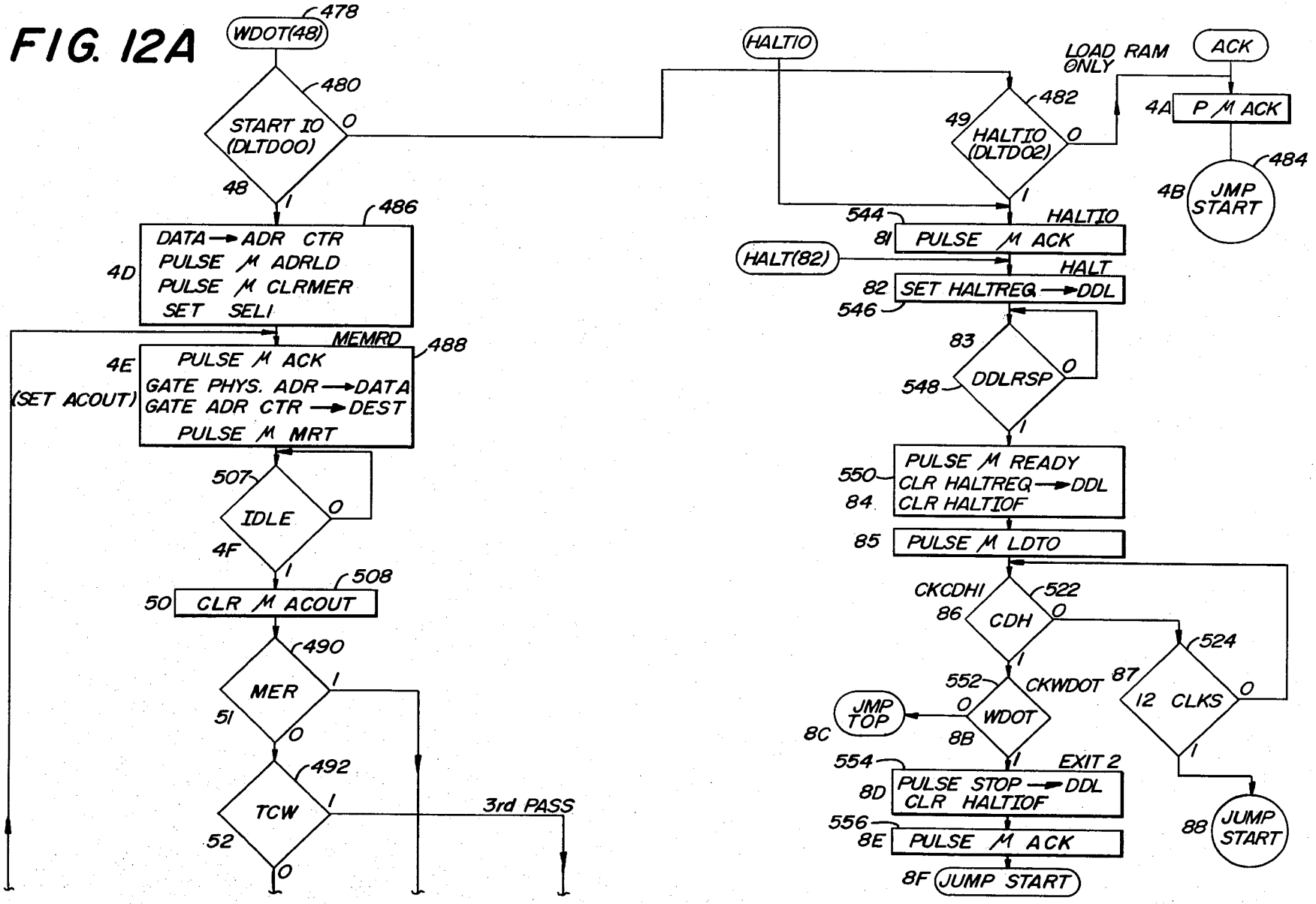

In the WDOT transfer, FIG. 12A there are several different ones that can come through bus 34. These transfers usually indicate that the programmer has placed in a dedicated memory location in memory 32 certain information that is to be transferred out to BBI 21. This information is not directly transferred to BBI 21, but CPU 30 does send a WDOT out. Part of the information in WDOT is the address where this information is in memory 32. It is then the responsibility of BBI 21 to actually go into memory 32 with this address, read out the data, and find out what it should do with the data. The only other WDOT is called HALTIO or terminate transfer. This is used to inform the card that if it is in the process of writing to memory it is to stop writing to memory.

From WDOT block 478 there is a branch diamond 480. If there is not a start IO, the branch is to the right, and it must be an HALTIO instruction that is tested at diamond 482. If it is not an HALTIO it would branch to the right again and jump back to start at block 484.

Figure 12B:
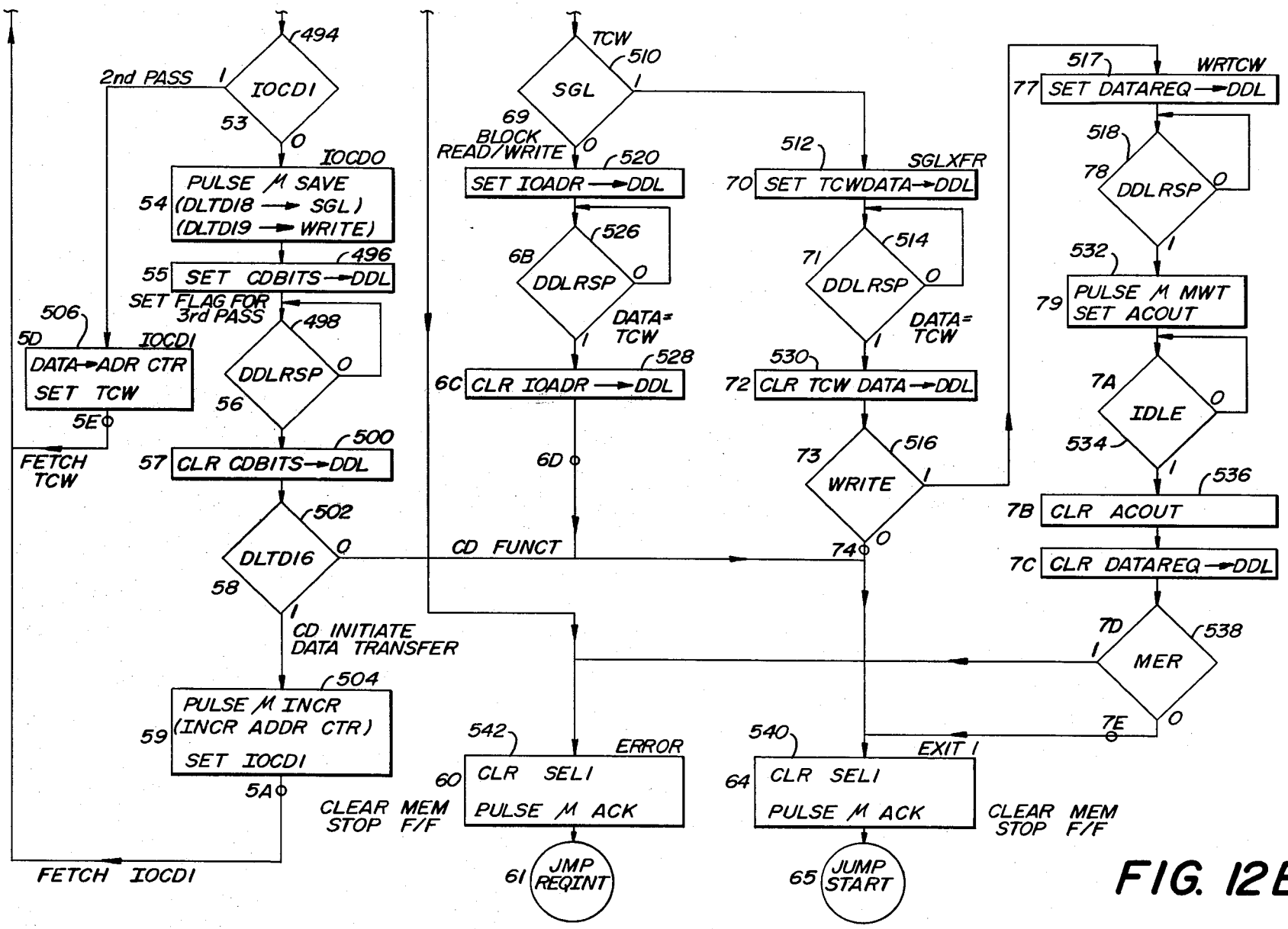

A start IO instruction branches out the bottom exit of start IO diamond 480, FIGS. 12A–B. The BBI goes through a procedure, starting at box 486, reading from memory the data which actually comprises two consecutive memory locations called input/output command double word (IOCD). In the second part of the IOCD is the address which points to TCW memory location. BBI 21 is going to do three memory reads, pull out information, and then pass it on to DDL as shown in box 488.

Starting at box 486 and continuing through box 488, BBI 21 goes out to read a single memory location. Continuing through MER diamond 490, the TCW diamond 492 and diamond 494 are in a first pass. Three passes are to be made. In the first pass, the program continues to box 496, with an arrow pointing to DDL. BBI 21 has thus gone out to memory and read in IOCD word 0. In that word, there are 12 bits of information, placed in the command device instruction by the programmer, that he executed and that resulted in WDOT being sent out by CPU 30. BBI 21 sets signal CDBITS, which tells the DDL that this information is available and that the DDL should pick it up. The program then goes to diamond 498 DDL response and waits for the DDL to confirm that it has the data and that the program may proceed. Continuing down in the program, it is set to read the second word from memory 32. Accordingly, the program goes through diamond 498, box 500, diamond 502 and box 504. From box 504 there is a branch all the way back to box 488 again. The steps required to read the next piece of information in memory 32 are from box 488 down to diamond 490. BBI 21 picks up that second word which has an address to the tCW. The TCW has been loaded by the programmer before he actually executed the command device instruction. The programmer inserts some specific information that he wishes to pass to the BBI.

Diamond 494 indicates that the program is now on the second pass, or that IOCD 1 has just been read, and that the answer is yes. The program branches to the left down to box 506 and reloads the address counter for this new address, which is the address of the TCW. There is a branch up to box 488 again to perform a third memory read.

In this manner, all the characters of the TCW are being read out, and the program is down to diamond 492. In a branch to the right, diamond 510 indicates that there are several different types of transfers. Diamond 510 shows a single word transfer, with a branch to the right to box 512 to set a signal for the DDL which says the TCW is available and that the program is to go to diamond 514.

There are two single-type transfers. In one of these, the programmer wants to output 32 bits of data to the DDL, and in the other the end result is that the DDL is to take 32 bits of data and have the BBI transfer it down to TCW. If it is assumed that there is an output of 32 bits to the DDL, when diamond 516 (write diamond) is reached, there is a branch out of the bottom indicating the completion of 32 bits of information. If it is desired that 32 bits of data should be read from the DDL and written down to the TCW, the instruction would branch to the right from diamond 516. A signal would go to the DDL saying that 32 bits of data are wanted and would indicate what data was available.

The other variation of this instruction is shown in diamond 510. If it was not a single-type transfer, the branch would go out the bottom. A signal would be sent to the DDL called IO address in box 520. This indicates the address of a block of information in memory, and the DDL would then read that information out of memory.

The other WDOT is HALTIO. This is used in a situation where, for example, an address is given and the DDL is reading or writing some information in memory that the programmer decides he wants to halt. There is a command device instruction called terminate IO (or halt IO) that tells the DDL to stop the IO. In that case, starting at WDOT, diamond 478, the program goes to start IO branch at diamond 480. It is not a start IO so there is a branch to the right over to diamond 482, which is a HALTIO instruction. BBI 21 sends a signal to the DDL called "halt request for stopping transfers" and then waits to receive a response. A transfer is sent back to CPU 30 saying that the BBI is set to stop but hasn't stopped yet. In a state between diamonds 522 and 524 the time-out feature started, and there is a wait for 12 time cycles for the CPU to send another WDOT transfer. A pulse is then sent to the DDL stating that it is the time to stop, and then there is a jump back to start.

Figure 13A:
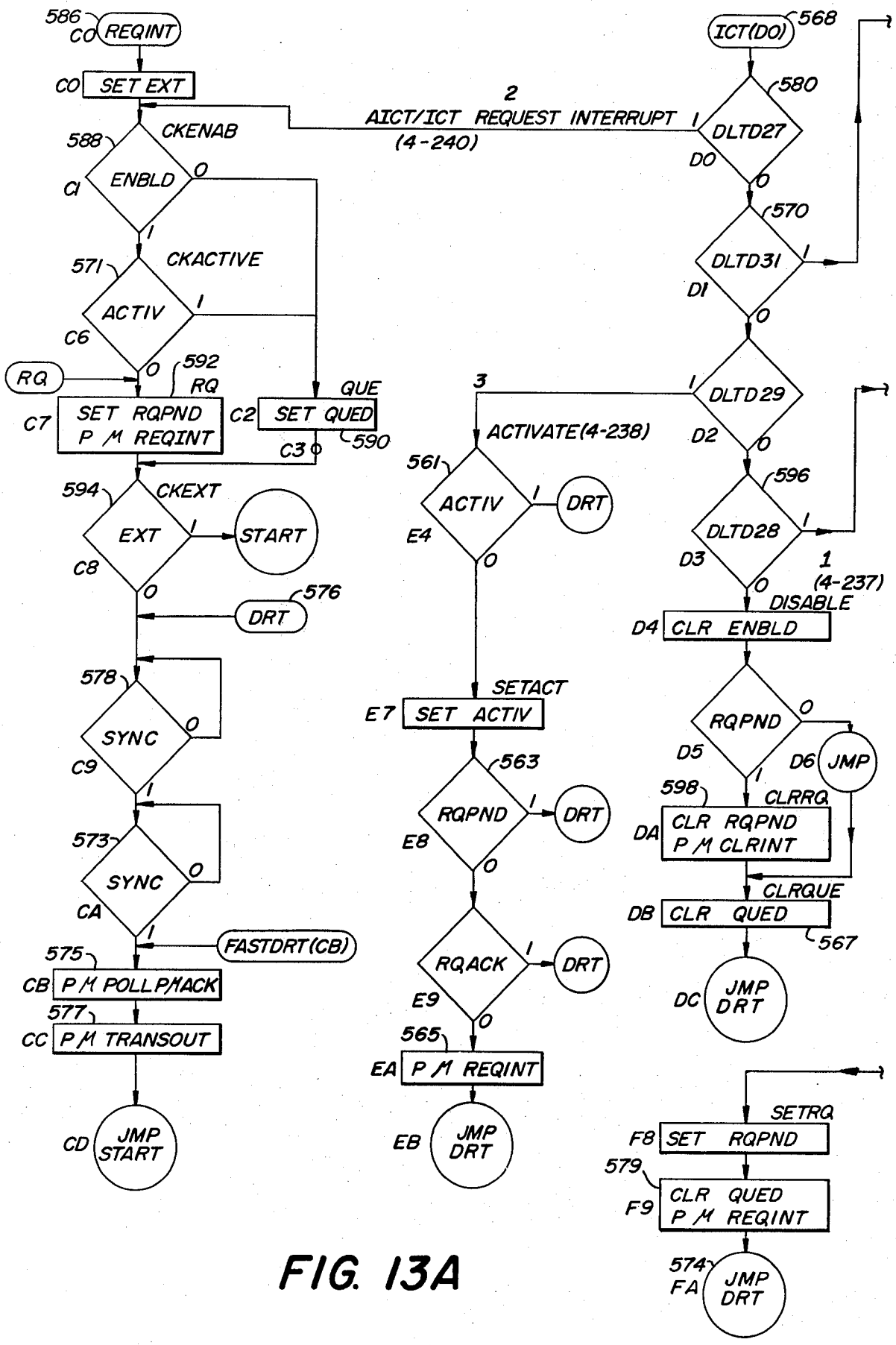
Figure 13B:
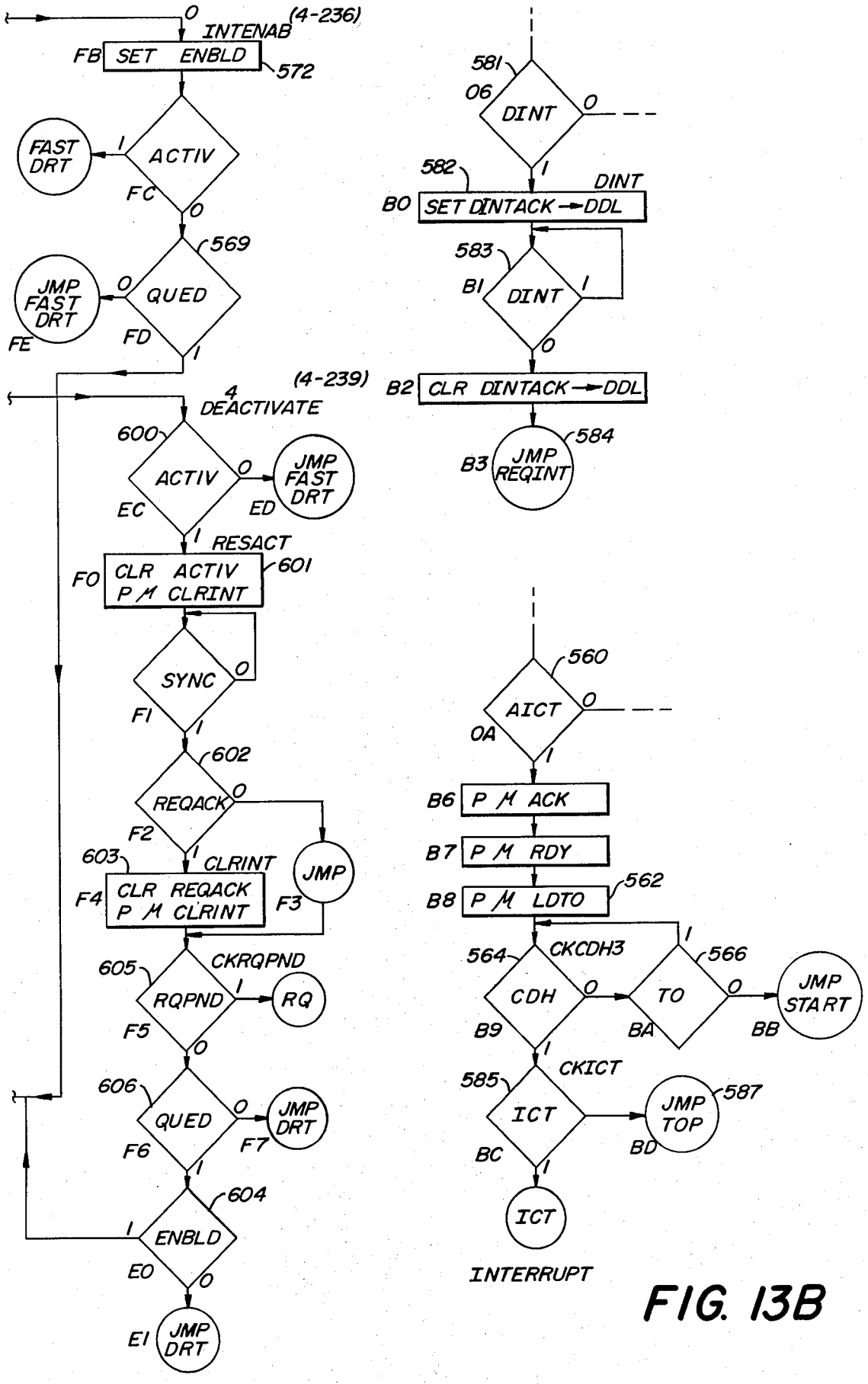

Interrupt flow sequencers are shown on FIG. 13B as a result of the DDL requesting interrupt service by asserting a signal to BBI 21 called DINT. Another manner in which to obtain the flow is to use certain programmed instructions available that will activate, deactivate, enable, disable, and request particular service interrupts by a program instruction. None of the interrupts will operate until they are enabled. One of the program interrupt instructions is to enable interrupts. The program interrupt instructions always result in an AICT/ICT bus transfer as defined by SEL.

Returning to the executive loop, CDH would be set because CPU 30 would make a transfer. If it is determined that an AICT has occurred, there is a branch down to send a signal back called "ready" to CPU 30. This signal states that there is a transfer, and the CPU is set for the next transfer, which is probably the ICT. In box 562, the timeout timer is again started and in diamond 564, there is a toggle between this diamond and diamond 566, waiting for the CPU to transfer ICT in.

When ICT does come in, there is a branch to location DO in oval 568, and then there is a determination as to which one of the ICT's it is. There are five different types of ICT's and the one in question is to enable interrupts. Further, there is a branch out of diamond 570 over to box 572 to set the bit called "enabled". Some checking is performed to determine the state of the previous interrupts, and then there is flow through circle 574, to oval 576 FIG. 13A, to diamond 578 to send the transfer back to CPU 30, indicating that the instructions have been executed. There are four other interrupt control instructions. These are decoded in similar fashion by way of ICT diamond 580.

The other way to get into the interrupt circuit is at the request of DDL logic which wishes to generate a service interrupt request to CPU 30. In the executive loop, diamond 432 shows that when the DINT signal is asserted by the DDL, it is going to cause a branch to the interrupt circuit at location 06. The branch goes down to box 582 FIG. 13B, which acknowledges to the DDL. BBI 21 is thereby telling the DDL that it has the request for interrupt and it will be taken care of. Thus, the DDL can go about its operation.

Once the BBI 21 acknowledges the DINT signal, it does a jump at circle 584 to oval 586. This flow is doing a request for interrupt out to CPU 30. Diamond 588 FIG. 13A indicates that if this level has been enabled, everything is fine and there is a branch down. If it has not been enabled, there is a branch to the right to box 590, and the interrupt would be pulled.

In diamond 588, it is determined whether the level has been enabled. If it has, an interrupt can be pulled if the level is nonactive. If the level is active, Q flip-flop output is set so that there is a branch around. If it is not active, there is a branch to box 592 to actually request an interrupt to CPU 30. Diamond 594 shows a DINT request from the DDL, which is considered an external interrupt request. There is a branch back to start, in contrast with the program interrupt request instruction, which would cause a branch down to send a transfer back to CPU 30 indicating that the instruction was completed, with a jump back to start.

Figure 14:
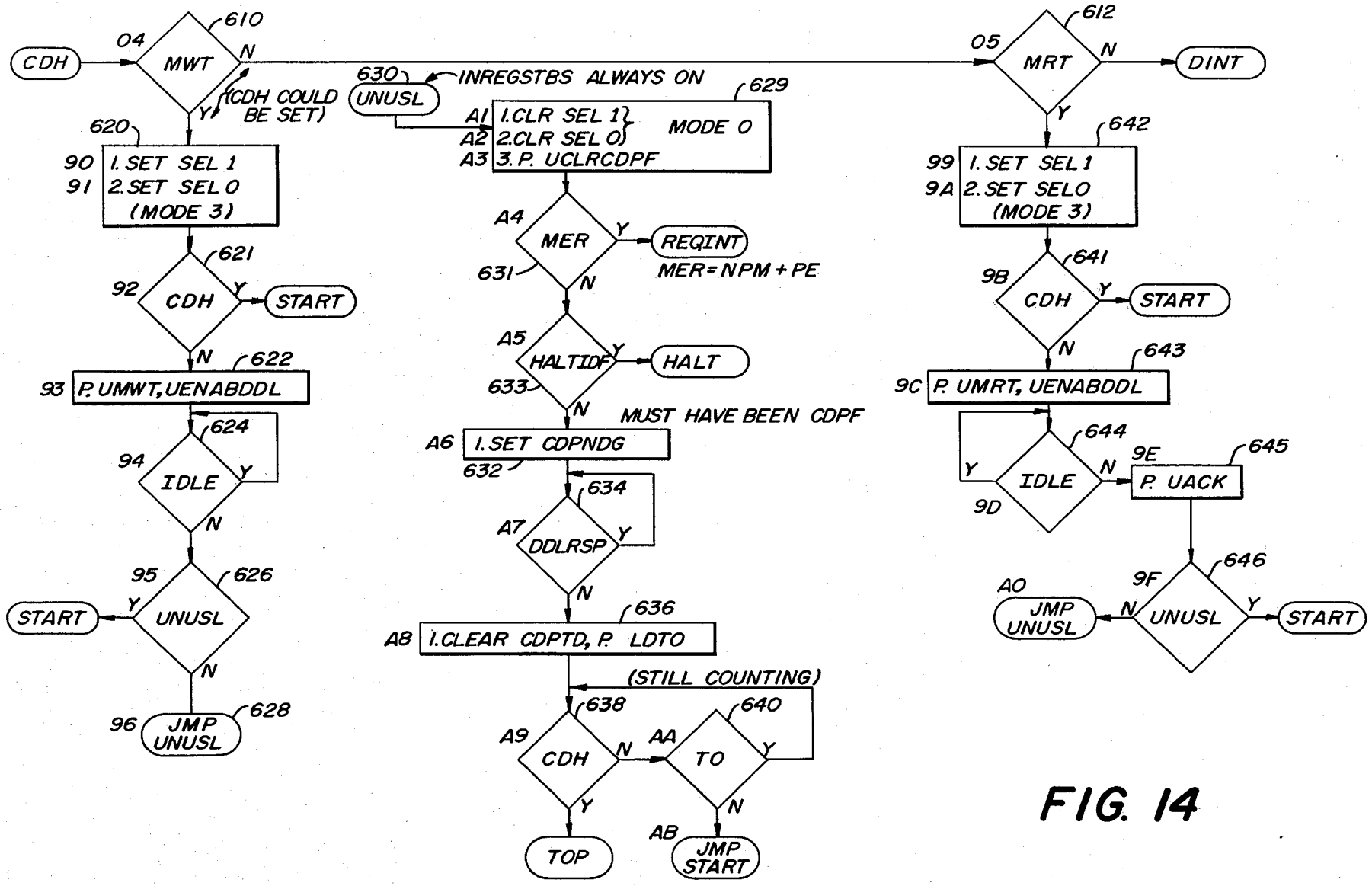

The following is a description of when the DDL wants to write something or read something from memory. This flow is gotten into from the executive loop. There are two signals from the DDL, viz, MWT and MRT. FIG. 14.

If a memory write transfer is required, there is a branch through box 620, and at box 622 the BBI pulses the signal $\mu$ MWT. At that point, memory access sequencer 341 logic is activated, and it assumes it has been loaded with an address. This address accesses the bus to memory and either requests a read or a write memory. In the meantime, microsequencer 340 goes to diamond 624 and waits for MAS 341 to go back into idle. As long as MAS 341 is turning away reading and writing to memory, it is not in the idle state, so there is a wait in the loop for it to go back to idle. Once MAS 341 goes back to idle, it branches down to diamond 626. If nothing unusual occurs during the memory write it would just branch back to start. In the event of an unusual occurrence, there is a branch or jump from block 628 to block 630. Unusual conditions are defined as those that arise when the write is progressing and the CPU 30 tries to make a transfer to BBI 21. Another unusual condition would be where the CPU tries to halt the BBI so that HALTIO flip-flop is set.

If it was a memory transfer, the convention is to request an interrupt. If not, then was it the HALTIO flip-flop? If it was, there is a branch into the HALTIO flow. If it was neither of these, it must have been the fact that CPU 30 was trying to do a transfer to BBI 21. Accordingly, a signal is set to the DDL at box 632. At diamond 634, there is a wait for the DDL to acknowledge the message and to signify its readiness to proceed. At box 636, the time-out timer is again started, and there is a toggle between diamond 638 and diamond 640, waiting for CPU 30 to retry the transfer that it had tried before. When it comes, it will branch back and decode to see what kind of CPU transfer it was.

The following additional instruction relates to the instructions listed in the blocks of the BBI microsequencer 340 firmwave flowcharts.

| Blocks | Instructions |
|---|---|
| 486 | Load ADR CTR with addresses of IOCD word 0<br>Lockout CN |

-continued

| Blocks | Instructions |
|---|---|
| | Respond with retry (μ SEL 1) |
| 488 | Release INPUT REG for MRT |
| | Preface to read |
| | IOC: word 0 - 1st pass |
| | IOCP: word 1 - 2nd pass |
| | TCW - 3rd pass |
| | Start memory sequencer |
| 507 | Wait for completion of memory lead |
| 508 | MER = NPM + PE |
| | Check for non-present memory or parity error |
| 532 | Write data from DDL into TCW |
| 544 | Release INPUT REG |
| | CLR CDH FF TC start |
| | IN REG STBS |
| 548 | Wait until DDL is ready to halt |
| 556 | Clear CDHFF that was set from second WDOT HALTR to get IN REG running |
| 620 | Set to response Mode 3 to allow DDL to control the type of rejection of CPU input transfers. |
| 621 | A CPU transfer has sneaked in |
| 622 | Start the memory access sequencer (MAS) and enable signals between MAS and DDL |
| 629 | Set to allow next CPU transfer to be accepted |
| 632 | Tell DDL that it must prepare to accept a CPU input transfer, also start SEL bus input register strobe if stopped. |
| 636 | Clear signal to DDL to complete handshake. Also, start 12-cycle time-out counter. |
| 638,640 | Wait for CPU transfer for 12 cycles |

C. BBI Memory Access Sequencer 341—State Diagram

Figure 15:
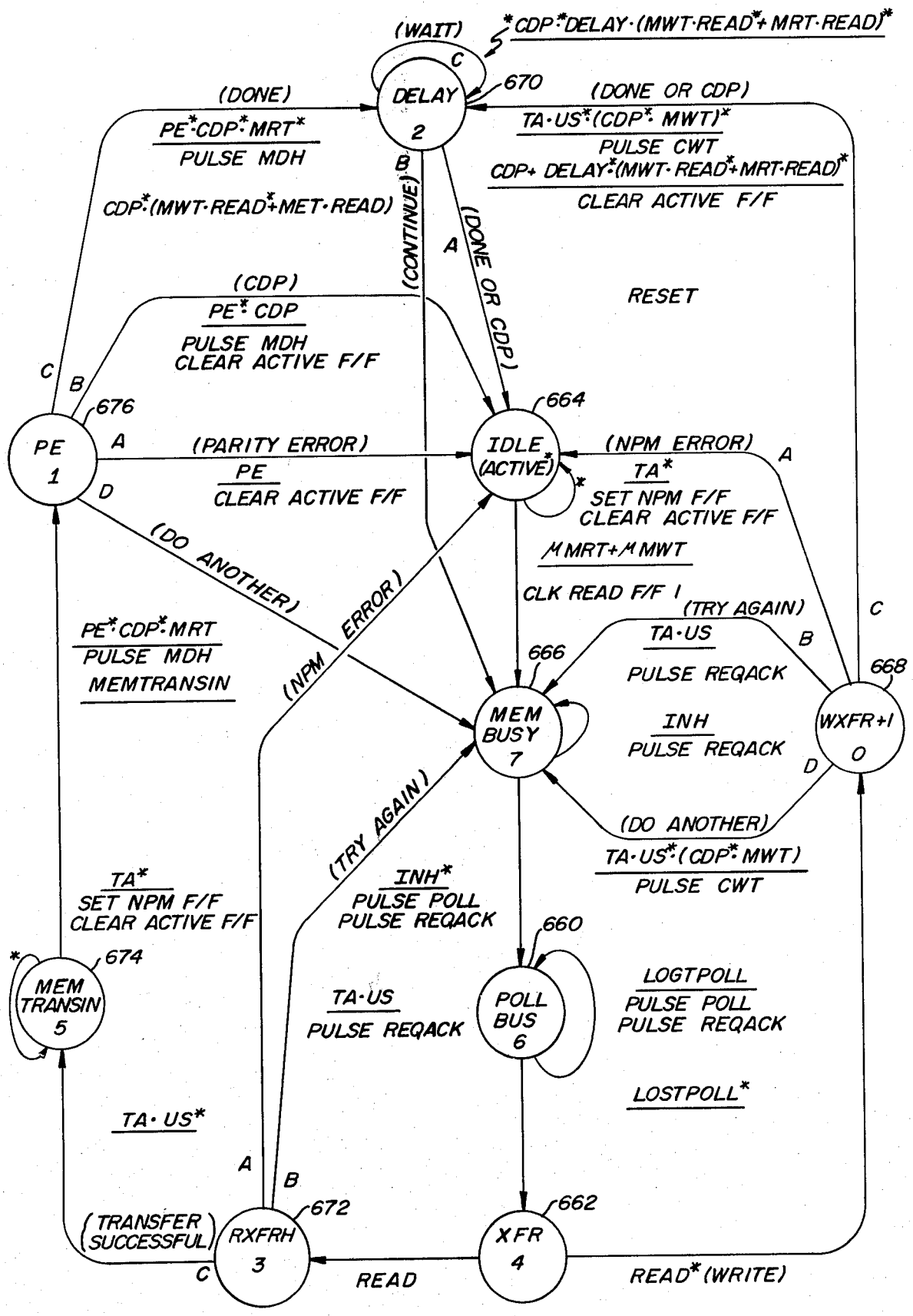
FIG. 15 illustrates a state diagram for the BBI memory access sequencer of FIGS. 10A–C.

In FIG. 15, the circles represent states in the logic, and the directed line having an arrowhead indicates a transition from one state to another.

Starting at state 6, circle 660, a poll bus is shown. In this state, MAS 341 is polling bus 34 to determine whether or not any user has a high priority. At the bottom of the circle, an arrow goes to the top of this same circle, and the signal associated with that is a lost poll. Any time that signal is true, MAS 341 stays in the same state. It is also to be noted that lost poll is underlined and that there are some signals listed below. None of these signals occur when it branches back and it stays in that same location.

When a lost signal becomes false, the state is changed to state 4, circle 662, which is the transfer state. It will be understood that the sequencer is in the idle state of circle 664. The only way the sequencer 341 is activated is when microsequencer 340 pulses the μMRT signal or μMWT signal. Once this is accomplished, there is a transition out of the idle state down to the memory-busy state 7, circle 666. There is a check to determine whether the memory bus controller last contacted is busy at the moment. If it is busy, the sequencer remains in state 7 until a signal inhibit becomes false. Once the signal inhibit becomes false, the MAS drops into state 6, circle 660, in which the bus is checked to see that no user with a higher priority is going to transfer. Once this bus priority is one, there is a drop to state 4, circle 662, to actually transfer the address and data to bus 34 in the case of memory write. The address in memory will be picked up by the memory bus controller.

From this point, there may be a branch in two directions. In the case of the memory write, there is a branch to the right to state 0, circle 668. There are four ways to transition out of this state. If another consecutive write is desired, there is a branch out the D exit to state 7, circle 666, to do another memory write. On the other hand, it may be found that the memory bus controller was actually busy, so it sent a signal to try again, so that there is now a branch out the B exit to circle 666. Alternatively, it may be that the address put on bus 34 did not exist.

In the event of completion, there is a transition out of Exit C to go back to state 2, circle 670, which is the delay state and transition back to the idle state. In the event that there is a memory read, as opposed to memory write, the action is the same down to state 4, circle 662. However, there is a transition to the left to state 3, circle 672. In this state, there is a check to determine whether or not the transfer to memory was successful. If it was a successful transfer, there is a transition out exit C to state 5, circle 674. In the event that there was a nonpresent memory error, there is an exit to idle circle 664 to set a flip-flop that can be read later on. In the event that memory 32 was busy, there is a transition out of exit B to circle 666 to try again.

In the event of a successful transfer, there is a transition to state 5, circle 674, to wait for the memory bus controller to look up information and send it back. The MAS remains in state 5 until memory data is transferred back in, and then there is a transition to state 1, circle 676. In the event that a sequencer read is being performed and there is not difficulty, there is a branch out exit B to go back to state 7, circle 666, to continue reading another piece of information. In a memory read, parity error may be invoked, which is a memory error. In that event, there is a transition out exit A back to the idle state, circle 664, setting a parity error flip-flop. This would cause an interrupt to occur, and the program would be able to come back and find out what had gone wrong.

In the event that the CPU 30 is trying to make transfers, there is a transition out exit B going back to the idle state in circle 664. In the event of completion, there is a transition out of exit C to the delay state, circle 670 and then down to the idle state.

The following is a description of the terms used in the state diagram of FIG. 15 of memory access sequencer 341.

DELAY—A DDL controlled signal that will allow the MAS to enter a delay state at the completion of an access rather than return to the idle state should the DDL have to drop MRT or MWT due to slow transfer capability. The MAS will wait in the delay state for another MRT or MWT. This feature is used when the next MRT or MWT is expected shortly since micro seq. is tied up waiting for the MAS to return to the idle state.

μMWT—Pulse command from μ sequencer to initiate a memory write.

TA—Transfer acknowledge, from memory

US—Unsuccessful—from memory. Says memory was busy and didn't accept your transfer μMRT—Pulse command from μsequencer to begin a memory read transfer INH—Inhibit—High if the last MBC accessed by the card is currently busy.

LOST POLL—says you tried but failed to become bus master.

READ—Tells which command pulse (μMRT or μMWT) activated this sequence.

MEMTRANSIN—Active near the end of bus cycle when a memory DRT is directed to this card.

MRT—DDL request for mem. read transfer

MWT—DDL request for mem. write transfer.

PE—Parity error—sent by MBC

SAVECHO—Save MBC echo bits. These bits identify the MBC that contains the mem. loc. just accessed.

CDP—CPU data transfer pending—says that a CPU transfer attempt has been made to this card. CDP=HALTIOF+CDPF MDH—Memory data here—to DDL—signifies requested data is available and that mem. ADR may be changed REQACK—to DDL—says that the MWT or MRT request has been recognized. DDL may lower the request.

CWT—Completed write transfer, to DDL—says that data write has been completed successfully.

TRANSOUT—Pulse that drives info to SEL bus during the transfer cycle

XFR—The state where this controller is the source of the info on the SEL bus

POLL—A pulse that causes the controller to actively compete for bus mastership by polling.

NPM—Nonpresent memory

RESET—Systemwide reset

MASK—(Not shown) A DDL controlled signal that can be used to disable the CDP signal.

In the state diagram FIG. 15, the following are notes to the drawing.

1. Read FF is set by μMWT.

2. The asterisk denotes the logical negation of the variable and not to the signal level.

3. The signals between the MAS and the DDL are normally disabled. They will be enabled by the micro sequencer when it recognizes that the memory access was requested by the DDL. The signals are again disabled when the MAS returns to the idle state. These signals are:

| To DDL | From DDL |
|---|---|
| MDH | MRT |
| CWT | MWT |
| REQACK | DELAY |
| | MASK |

The truth table of the ROM sequencer in memory access sequencer 341 is as follows:

TABLE III

| CONDITIONS FOR NEXT STATE | | PROM INPUTS LMEMTR-ANSIN | HLOST-POLL | HINH | LAC-TIVE ($\overline{CE}$) | HA4 $A_4$ | HA3 $A_3$ | HPSB2 $A_2$ | HPSB1 $A_1$ | HPSBϕ $A_0$ | PRE-SENT STATE |
|---|---|---|---|---|---|---|---|---|---|---|---|
| CPU DATA PNDG OR DONE | C | X | X | X | O | O | O | O | O | O | ϕ |
| UNSUCCESSFUL, TRY AGAIN | B | X | X | X | O | O | 1 | O | O | O | ϕ |
| DO ANOTHER | D | X | X | X | O | 1 | O | O | O | O | ϕ |
| NPM ERROR | A | X | X | X | O | 1 | 1 | O | O | O | ϕ |
| DONE | C | X | X | X | O | O | O | O | O | 1 | 1 |
| DO ANOTHER | D | X | X | X | O | O | 1 | O | O | 1 | 1 |
| CPU DATA PNDG | B | X | X | X | O | 1 | O | O | O | 1 | 1 |
| PARITY ERROR | A | X | X | X | O | 1 | 1 | O | O | 1 | 1 |
| CAN'T OCCUR | | X | X | X | O | O | O | O | 1 | O | 2 |
| WAIT (STAY IN DELAY STATE) | C | X | X | X | O | O | 1 | O | 1 | O | 2 |
| CONTINUE (DO ANOTHER) | B | X | X | X | O | 1 | O | O | 1 | O | 2 |
| CPU DATA PNDG OR DONE | A | X | X | X | O | 1 | 1 | O | 1 | O | 2 |
| UNSUCCESSFUL, TRY AGAIN | B | X | X | X | O | O | O | O | 1 | 1 | 3 |
| TRANSFER SUCCESSFUL | C | X | X | X | O | O | 1 | O | 1 | 1 | 3 |
| NPM ERROR | A | X | X | X | O | 1 | O | O | 1 | 1 | 3 |
| | A | X | X | X | O | 1 | 1 | O | 1 | 1 | 3 |
| CAN'T OCCUR | | X | X | X | O | O | O | 1 | O | O | 4 |
| CAN'T OCCUR | | X | X | X | O | O | 1 | 1 | O | O | 4 |
| READ FROM MEMORY | | X | X | X | O | 1 | O | 1 | O | O | 4 |
| WRITE TO MEMORY | | X | X | X | O | 1 | 1 | 1 | O | O | 4 |
| CAN'T OCCUR | | X | X | X | O | O | O | 1 | O | 1 | 5 |
| CAN'T OCCUR | | X | X | X | O | O | 1 | 1 | O | 1 | 5 |
| CAN'T OCCUR | | X | X | X | O | 1 | O | 1 | O | 1 | 5 |
| WHEN LMEMTRANSIN IS LOW MAS FORCED TO STATE 1 | | 1/O | X | X | O | 1 | 1 | 1 | O | 1 | 5 |
| CAN'T OCCUR | | X | X | X | O | O | O | 1 | 1 | O | 6 |
| CAN'T OCCUR | | X | X | X | O | O | 1 | 1 | 1 | O | 6 |
| CAN'T OCCUR | | X | X | X | O | 1 | O | 1 | 1 | O | 6 |
| WHEN HLOST POLL IS LOW (WON POLL) MAS FORCED TO STATE 4 | | | | | | | | | | | |
| TRANSOUT | | X | 1/O | X | O | 1 | 1 | 1 | 1 | O | 6 |
| CAN'T OCCUR | | X | X | X | O | O | O | 1 | 1 | 1 | 7 |
| CAN'T OCCUR | | X | X | X | O | O | 1 | 1 | 1 | 1 | 7 |
| CAN'T OCCUR | | X | X | X | O | 1 | O | 1 | 1 | 1 | 7 |
| WHEN HINH IS LOW (MEM NOT BUSY) MAS FORCED TO STATE 6 AND POLL | | X | X | 1/O | O | 1 | 1 | 1 | 1 | 1 | 7 |
| PROMS DISABLE, OUTPUT HI IN IDLE STATE | | X | X | X | 1 | X | X | X | X | X | IDLE |

TABLE III-continued

PROM OUTPUTS

MAS PROM 1
EAI #B00 592 0

| NEXT STATE | LROM7 $O_8$ | LROM6 $O_7$ | LENAB2 $O_6$ | LENAB1 $O_5$ | LENABϕ $O_4$ | HNSB2 $O_3$ | HNSB1 $O_2$ | HNSBϕ $O_1$ | PROM ADDRESS (DECIMAL) |
|---|---|---|---|---|---|---|---|---|---|
| 2 | O | 1 | 1 | 1 | 1 | O | 1 | O | O |
| 7 | 1 | 1 | 1 | 1 | 1 | 1 | 1 | 1 | 8 |
| 7 | O | 1 | 1 | 1 | 1 | 1 | 1 | 1 | 16 |
| IDLE | 1 | 1 | 1 | 1 | 1 | 1 | 1 | 1 | 24 |
| 2 | 1 | 1 | 1 | 1 | 1 | O | 1 | O | 1 |
| 7 | 1 | 1 | 1 | 1 | 1 | 1 | 1 | 1 | 9 |
| IDLE | 1 | 1 | 1 | 1 | 1 | 1 | 1 | 1 | 17 |
| IDLE | 1 | 1 | 1 | 1 | 1 | 1 | 1 | 1 | 25 |
| IDLE | 1 | 1 | 1 | 1 | 1 | 1 | 1 | 1 | 2 |
| 2 | 1 | 1 | 1 | 1 | 1 | O | 1 | O | 10 |
| 7 | 1 | 1 | 1 | 1 | 1 | 1 | 1 | 1 | 18 |
| IDLE | 1 | 1 | 1 | 1 | 1 | 1 | 1 | 1 | 26 |
| 7 | 1 | 1 | 1 | 1 | 1 | 1 | 1 | 1 | 3 |
| 5 | 1 | 1 | 1 | 1 | 1 | 1 | O | 1 | 11 |
| IDLE | 1 | 1 | 1 | 1 | 1 | 1 | 1 | 1 | 19 |
| IDLE | 1 | 1 | 1 | 1 | 1 | 1 | 1 | 1 | 27 |
| IDLE | 1 | 1 | 1 | 1 | 1 | 1 | 1 | 1 | 4 |
| IDLE | 1 | 1 | 1 | 1 | 1 | 1 | 1 | 1 | 12 |
| 3 | 1 | O | 1 | 1 | 1 | O | 1 | 1 | 20 |
| ϕ | 1 | O | 1 | 1 | 1 | O | O | O | 28 |
| IDLE | 1 | 1 | 1 | 1 | 1 | 1 | 1 | 1 | 5 |
| IDLE | 1 | 1 | 1 | 1 | 1 | 1 | 1 | 1 | 13 |
| IDLE | 1 | 1 | 1 | 1 | 1 | 1 | 1 | 1 | 21 |
| 5/1 | 1 | 1 | O | 1 | 1 | 1 | O | 1 | 29 |
| IDLE | 1 | 1 | 1 | 1 | 1 | 1 | 1 | 1 | 6 |
| IDLE | 1 | 1 | 1 | 1 | 1 | 1 | 1 | 1 | 14 |
| IDLE | 1 | 1 | 1 | 1 | 1 | 1 | 1 | 1 | 22 |
| 6/4 | 1 | 1 | 1 | O | 1 | 1 | 1 | O | 30 |
| IDLE | 1 | 1 | 1 | 1 | 1 | 1 | 1 | 1 | 7 |
| IDLE | 1 | 1 | 1 | 1 | 1 | 1 | 1 | 1 | 15 |
| IDLE | 1 | 1 | 1 | 1 | 1 | 1 | 1 | 1 | 23 |
| 7/6 | 1 | 1 | 1 | 1 | O | 1 | 1 | 1 | 31 |
| 7 | 1 | 1 | 1 | 1 | 1 | 1 | 1 | 1 | |
| | LOWT | LSAVECHO | LENAB2 | LENAB1 | LENABϕ | HNSB2 | HNSB1 | HNSBϕ | |

PROM OUTPUTS

MAS PROM2
EAI #B00 592 0

| NEXT STATE | LCRACT $O_8$ | LJNPMF $O_7$ | LROM15 $O_6$ | LROM14 $O_5$ | LROM13 $O_4$ | LROM12 $O_3$ | LROM11 $O_2$ | LROM10 $O_1$ | PROM ADDRESS (DECIMAL) |
|---|---|---|---|---|---|---|---|---|---|
| 2 | 1 | 1 | O | 1 | O | O | 1 | 1 | O |
| 7 | 1 | 1 | O | 1 | O | O | O | 1 | 8 |
| 7 | 1 | 1 | O | 1 | O | O | 1 | 1 | 16 |
| IDLE | O | O | O | 1 | O | O | 1 | 1 | 24 |
| 2 | 1 | 1 | O | 1 | O | O | 1 | O | 1 |
| 7 | 1 | 1 | O | 1 | O | O | 1 | O | 9 |
| IDLE | O | 1 | O | 1 | O | O | 1 | O | 17 |
| IDLE | O | 1 | O | O | O | O | 1 | 1 | 25 |
| IDLE | O | 1 | O | 1 | O | O | 1 | 1 | 2 |
| 2 | 1 | 1 | O | 1 | O | O | 1 | 1 | 10 |
| 7 | 1 | 1 | O | 1 | O | O | 1 | 1 | 18 |
| IDLE | O | 1 | O | 1 | O | O | 1 | 1 | 26 |
| 7 | 1 | 1 | O | 1 | O | O | O | 1 | 3 |
| 5 | 1 | 1 | O | 1 | O | O | 1 | 1 | 11 |
| IDLE | O | O | O | 1 | O | O | 1 | 1 | 19 |
| IDLE | O | O | O | 1 | O | O | 1 | 1 | 27 |
| IDLE | O | 1 | O | 1 | O | O | 1 | 1 | 4 |
| IDLE | O | 1 | O | 1 | O | O | 1 | 1 | 12 |
| 3 | 1 | 1 | O | 1 | O | O | O | 1 | 20 |
| ϕ | 1 | 1 | O | 1 | O | O | O | 1 | 28 |
| IDLE | O | 1 | O | 1 | O | O | 1 | 1 | 5 |
| IDLE | O | 1 | O | 1 | O | O | 1 | 1 | 13 |
| IDLE | O | 1 | O | 1 | O | O | 1 | 1 | 21 |
| 5/1 | 1 | 1 | O | 1 | O | O | 1 | 1 | 29 |
| IDLE | O | 1 | O | 1 | O | O | 1 | 1 | 6 |
| IDLE | O | 1 | O | 1 | O | O | 1 | 1 | 14 |
| IDLE | O | 1 | O | 1 | O | O | 1 | 1 | 22 |
| 6/4 | 1 | 1 | O | 1 | O | O | O | 1 | 30 |
| IDLE | O | 1 | O | 1 | O | O | 1 | 1 | 7 |
| IDLE | O | 1 | O | 1 | O | O | 1 | 1 | 15 |
| IDLE | O | 1 | O | 1 | O | O | 1 | 1 | 23 |
| 7/6 | 1 | 1 | O | 1 | O | O | O | 1 | 31 |
| 7 | 1 | 1 | 1 | 1 | 1 | 1 | 1 | 1 | |

TABLE III-continued

| | | | | | | | |
|---|---|---|---|---|---|---|---|
| LCLRACT | LJNPMF | (SPARE) | LJPEE | (SPARE) | (SPARE) | LREQACK | LMDH |

D. BBI—DDL Signal Descriptions

The following is a listing and explanation of BBI—DDL signal nomenclature used herein and shown in the drawings. The signals are grouped by function.

Memory Access
- LMRT—Request for memory read
- LMWT—Request for memory write

LMASK2—Maintain block integrity
LDELAY—Maintain MAS control for med. speed transfers
LMDH—Memory data here
LCWT—Completed write transfer
LREQACK—Request acknowledged
LCOMPARE—Control rejection of CPU transfers
LFBIT—Define mode of transfer (BYTE, ½ word, etc.)
- HMER—NPM or PE memory error occurred Handshaking Sequences
- HCDBITS—16 bits from CD instruction here
- HIOADR—IO address and some data here
- LWRITE—Direction of memory transfers
- HTCWDATA—Data from TCW here
- HDATAREQ—DDL supplies data for TCW location
- HCDPNDG—DDL must get ready for a CPU input transfer
- HTCWA—DDL supplies data for TCW location
- HALTREQ—DDL should prepare to halt
- LUSTOP—DDL should halt
- HRSTX8/4—DDL supplies status
- HRSTX2—DDL supplies status
- LDDLRSP—DDL's response line Service Interrupts
- LDINT—Request for interrupt
- HDINTACK—Acknowledgement for LDINT
- HACTIV—Interrupt level active
- HENBLD—Interrupt level enabled
- HRQPNDG—Interrupt request to CPU pending
- HQUED—Interrupt request queued
- HRQACK—Leading edge indicates intr. svc. routine about to begin Status Transfers
- LTD8CC1
- LPROGVIO (LTD8CC2)
- LTD4CC4
- LTD2CC1
- LTD2CC3
- LTD2CC4
- LCNTLRACTIVE—Default status control bit Buses
- LDLFD (00:31)—32 bit data bus from DDL
- LDLTD (00:31)—32 bit data bus to DDL
- LDEST (00:23)—32 bit addr. bus from DDL
- HDT (20:23)—Bus level device sub-addr
- HSAR (0H:3H)—Device sub-addr of last accepted CPU transfer
- HSAR (0P:3P)—Device sub-addr of last retried CPU transfer
- HCDBITS—A "Here Is" handshaking signal, says that the rightmost 16 bits of the CD instruction are on the data bus to the DDL, LDLTD (16:31). DDL responds with LDDLRSP signal.
- HCDPNDG—A"Get Ready" handshaking signal. Tells DDL to prepare itself for an input transfer. When ready the DDL responds with LDDLRSP.
- LCOMPARE—The compare signal is used by the DDL during DDL initiated memory access sequences. The signal controls the rejection of CPU input transfers to the controller once the BBI has accepted the request for memory accesses.
- LCWT—"Completed Write Transfer" is generated by the memory access sequencer (MAS) as a result of a DDL initiated memory write sequence.
- LDEST (00:23)—"Destination Bus", a 24 bit tri-state address bus from DDL. DDL places address of memory location on this bus during MWT sequences. DDL should use the LREQACK to enable its tri-state bus drivers.
- LDINT—"DDL Interrupt" is a "Will You" handshaking signal. Used to request a service interrupt (requests execution of an interrupt service routine).
- HDINTACK—"DDL Interrupt Acknowledge" is generated by the BBI when it has recognized the DDL's request for interrupt (LDINT).
- LDLFD (00:31)—"Data Lines from DDL". The 32 bit tri-state data bus from the DDL. DDL passes all information other than addresses on this bus.
- LDLTD (00:31)—"Data Lines to DDL" 32 bit data bus to device. All info (data or address) from the BBI will pass over this bus during "Here Is" sequences. The DDL may use the LDDLRSP line to store the info from the bus.
- HDT (20:23) (To DDL) "Data Lines" These four lines come directly from the SEL bus (through receivers). These lines can be used with the LCOMPARE signal and the last accept sub-address lines [HSAR(0H:3H)] to dynamically reject CPU input transfers.
- HALTREQ—"Halt Request" is a "Get Ready" signal that warns the DDL that it should get ready to halt its I/O operation or some similar system-defined function. The DDL respond when ready with LDDLRSP.
- LFBIT—Used in conjunction with the two least significant bits of the destination bus (LDEST22 & LDEST23) to specify the data format mode of memory accesses.
- HIOADR—"I/O Address" is a "Here Is" signal and signifies that an address is right-hand justified on the data lines to DDL. The DDL should take the address and initiate a memory access in the direction specified by the LWRITE signal.
- LMASK—"Mask" is a control line that the DDL may assert during memory access sequences to allow the sequence to go to completion without being interrupted by any event except a memory error.
- LMDH—"Memory Data Here" is generated by the MAS during memory read sequence. It tells the DDL that the current read has been completed successfully and that the memory data is available.
- LMRT—"Memory Read Transfer Request" Asserted by DDL when it requires a memory read sequence. This is a "Will You" handshaking signal.
- LMWT—"Memory Write Transfer Request" A "Will You" handshaking signal used to request memory write transfer sequence. DDL must supply data.

HMER—"Memory Error". Signal set when the BBI detects a memory error as the result of the BBI accessing memory.

LPROGVIO—"Program Violation" is a status bit that is under DDL control and should be supplied to the BBI.

LREQACK—"Request Acknowledged" is generated by the MAS during MRT and MWT memory access sequences.

HRSTX8/4—"Read Status Transfer, 8000/4000 Level". This is a "Give Me" signal requesting 8000 and 4000 level status from the controller. The DDL may place information in these user defined bits:

LTD8CC1
LTD4CC3
LTD4CC4

HRSTX2—"Read Status Transfer, 2000 Level" This is a "Give Me" signal requesting 2000 level status from the controller. The DDL may place user defined status information in the following bits:

TD2CC1
TD2CC3
TD2CC4

HTCWDATA—(To DDL) "TCW Data" is a "Here Is" handshaking signal telling the DDL that 32 bits of data (from the TCW location) are available.

LWRITE—(To DDL) The "Write" line may be checked by DDL when the "Here Is" HIOADR sequence is in progress.

IV. DATA CONVERSION MULTIPLEXER (DCM)25

A. General Description

As previously described with respect to FIG. 4, the sequence of events to transfer words is to first load one of six transfer control registers 62*a–f* from memory locations in memory 32. TCR 62*a–f* hold six double words which describe the proper transfer to take place. For example, the first and last channel of the ADC 52 is described. These words also describe the data array address of CPU 30 where these words are to be transferred and the type of transfer (whether loop, chain, jam, transfer on end of block, hold, scaled fraction or floating point) and whether it is to or from memory.

After loading TCRs, these words wait in the locations until an activate request is received. This activate request can come from CPU 30, from the run patch panel hole of analog computers 12*a–f*, or the carry output from timers 64*a–f*. All of these activate requests are brought together, and any one of these requests can activate TCR 62*a–f* and actually start the transfers by way of CPCW active block 60.

The main function of ADC/DCM 22 is to decide which of the six TCRs 62*a–f* is next to get access to ADC 52. A transfer control register (TCR) may be labeled time-critical or non-time-critical. Assume that the priorities are worked out so that number five TCR 62*e* is presently active. Accordingly, when a transfer is completed, the next priority to come up would then be TCR 62*f* followed by 62*a*, 62*b*, 62*c* and 62*d*.

If any gorilla wants to come in at any time while the monkeys are active, then the gorilla takes priority and gains control. When one of the TCRs 62*a–f* is preempted by either a CD pending from CPU 30 or another transfer request, then that updated TCR is stored back into the save active CPCW register 66. TCR 62*a–f* and register 66 comprise a single active pending RAM, described below, which is a 16-word 32-bit wide-programmable RAM.

It will be understood that FIG. 4 represents ADC/DCM DAM/DCM 24 is similar in circuitry except that the data flow is in reverse. Accordingly, only the ADC/DCM has been described in detail.

A portion of ADC channel 52, FIG. 1 is shown in FIG. 4 and comprises a floating point conversion block 67. Accordingly, information flows from ADC 68 as a scaled fraction, and if the TCR desires the information to be changed into floating point format, then it goes through a floating point conversion before going into memory 32.

B. Block Diagram Description

Figure 16A:
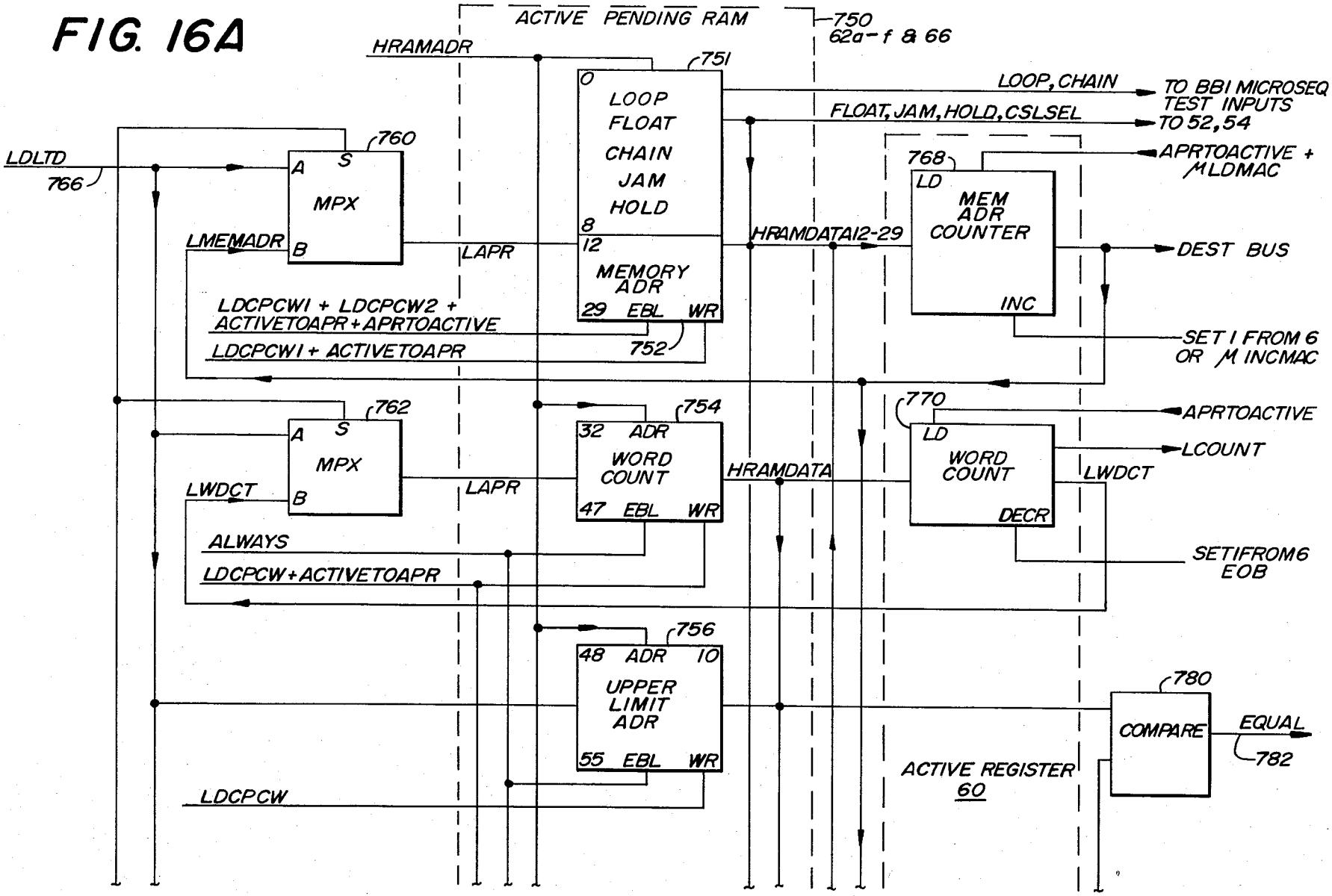
FIGS. 16A–B, 17A–B and 18A–B taken together illustrate in more detail and in block diagram form the DCM section of FIG. 1.
Figure 16B:
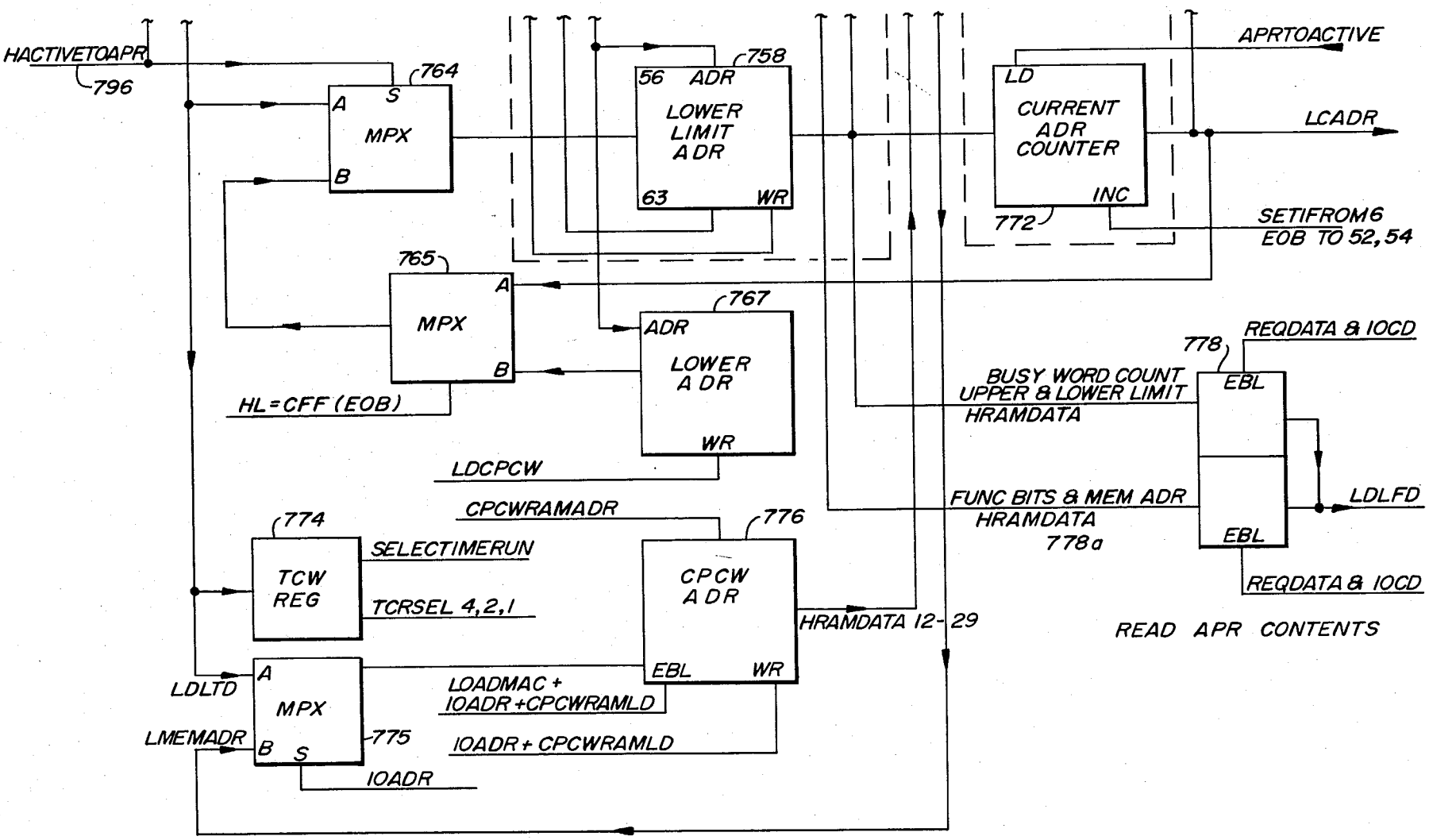

In FIGS. 16A–B, the active pending register is referred to in its entirety as register 750, and a portion of the register 751 stores loop, float, jam, chain, and hold. Register portion 752 stores memory address, portion 754 stores word count, portion 756 stores upper limit address, and portion 758 stores lower limit address. RAM 750 may be loaded from CPU 30 by way of multiplexer blocks 760, 762, and 764. Specifically, data from CPU 30 is transferred from a modified BBI 21 by way of line 766 and then loaded into the active pending register during a CPCW load sequence.

When a particular TCR 62*a–f* wins the priority poll of the round robin later to be described, then that particular TCR is transferred to the active register 60, which comprises three counters 768, 770 and 772. The memory address from active pending register 752 is transferred into memory address counter 768 of active register 60. In turn, all of the counters of active register 60 are loaded. As soon as this information is in the active register, the ADC/DCM 22 recognizes that it has to start the transfer.

Accordingly, the first word will be transferred from ADC 68 into memory 32; word counter 770 will decrement by 1, and memory address counter 768 will increment by 1. In addition, the current address counter 772 will also increment by 1. In this manner, the block of transfers continues until word counter 770 reaches 0. At that time, the active TCR is completed, and there will be no further transfers to be performed on that TCR.

However, before the end of the foregoing transfers, another transfer request may come from either a gorilla or a monkey. During the rest period an updated memory address from counter 768, word counter 770, and current address counter 772 will be loaded back into the active pending registers 752, 754, and 758 respectively. Thus, the word that was active and is now saved has to wait in the pending registers until it again wins priority and comes out to the active register.

The two methods of priority allow the gorilla to always have priority over the monkey. The gorilla is transferred into active register 60, and unless another gorilla requests a transfer, the gorilla will go to the end of its block (block transfer) without being interrupted. At the end of the block, during the time a gorilla is running, a window is provided for another computer command to come in or another transfer to take place.

TCW register 774 holds address 1–6 of a particular command which is trying to talk to DCM 22 from CPU 30. For instance, if CPU 30 wants to hold the transfer, it indicates which of the six TCR's 62*a–f* it wishes to hold. This information is loaded into a TCW register 774 and is decoded to hold the particular TCR. CPCW address register 776 has the same memory address counter used for the transfer, and it is also used for bringing out six CPCW double words to load TCR 62a–f. Specifically, register 776 comprises a RAM that is loaded with memory address where the CPCW's are resident and that allows DCM 22 to access CPU memory 32 and bring out the CPCW's. In block 778, bits on line 778a are used for the CPU 30 to read the status of DCM 22. In this way, all of the TCR's may be read, as well as the current word count, current first and last address, whether the DCM is busy and whether a particular TCR is busy or not. Block 778 shows the manner in which status is read back to CPU 30. In DCM 22 there is a signal called equal or end of block. On line 782 block 780 compares the upper limit address to the current address counter so that if channel 0–6 is required to be transferred, then when a current address counter reaches 6, it recognizes that the end of the block has been reached, and an equal signal on line 782 is produced. This is used throughout DCM 22 to signify an end of block.

Figure 17A:
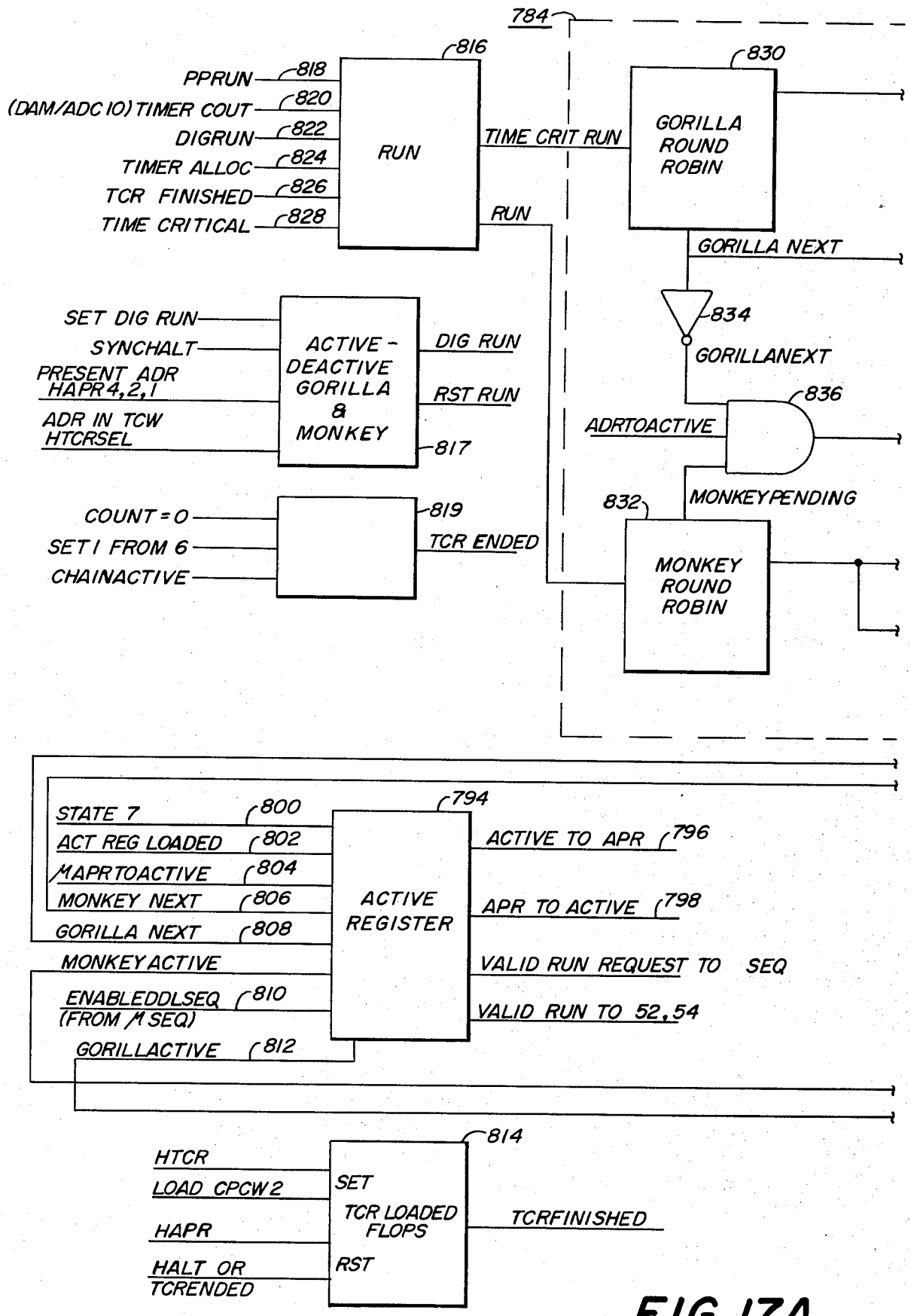
Figure 17B:
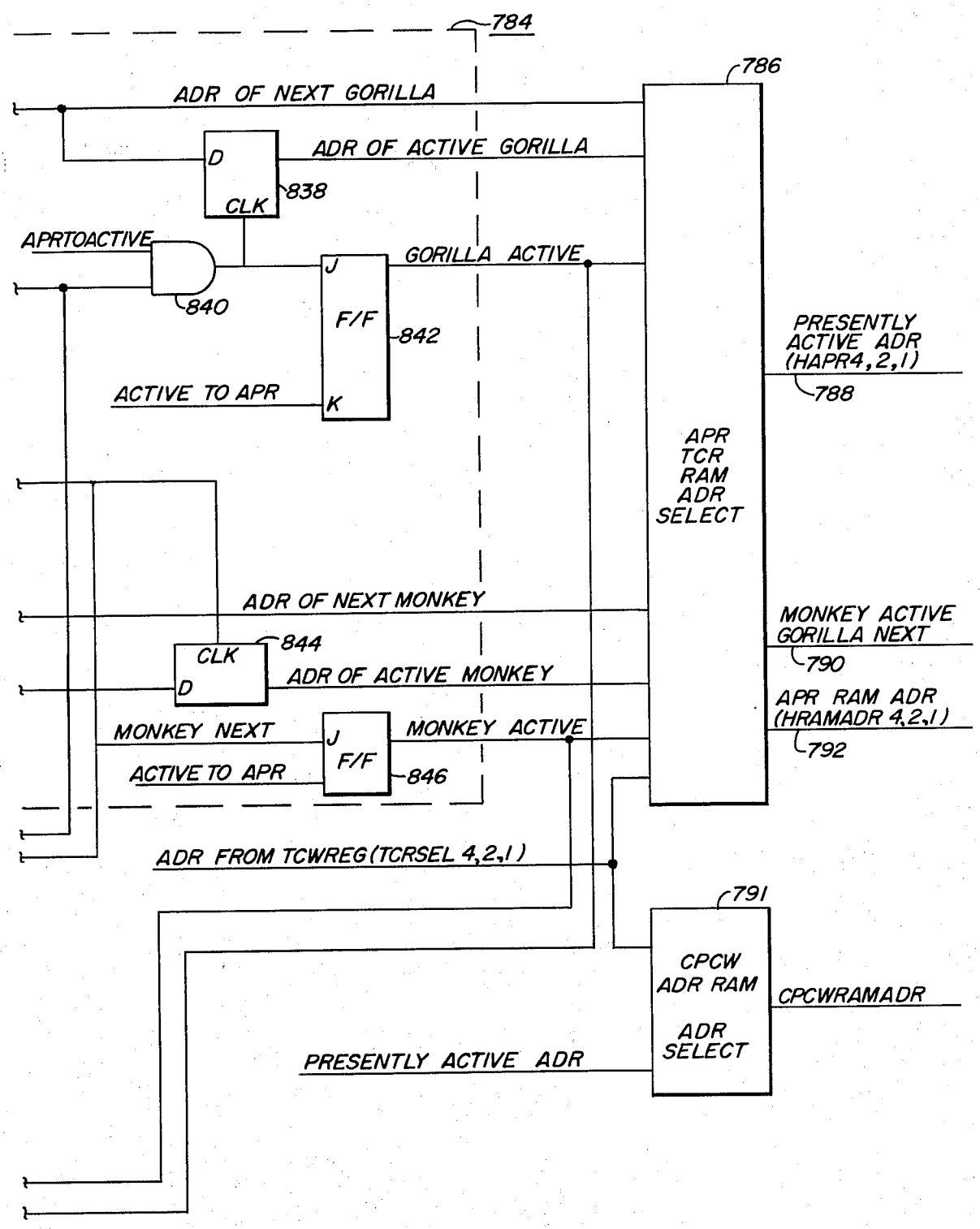

System 784 (included in TCR activate control 72, FIG. 4) indicates a gorilla round robin and a monkey round robin which are effective to decide the priority of TCR's 62a–f. System 784 FIGS. 17A–B is programmed with information which allows the gorilla to have top priority and the monkey second priority within TCR's 62a–f, if the first TCR 62a is active. Then the circuit allows TCR 62b to have the next priority, 62c the next priority, and so on. If TCR 62f is presently active, then the next priority is TCR 62a, etc. The foregoing is shown as feeding into address select box 786. This block takes information from the priority decoder in system 784 and instructs the rest of the circuit that the presently active address lines 788 indicate whether a monkey is active or a gorilla is next on line 790 and shows the address of APR RAM address line 792.

It will be understood that one gorilla may have more than one TCR allocated to it. With a gorilla having more than one TCR, then its respective TCR's become time critical when the gorilla becomes time critical. It is these TCR's which would operate in a round robin fashion in gorilla round robin 830.

Active register 794 takes the state from ADC channels 51, FIG. 1, and assigns the timing of loading the active registers. Further, it decides the timing of unloading the active register 60 back to the active pending register 750. Active to APR line 796 indicates that its TCR has been preempted, that it is going back into APR 750, and that it again has to wait to win priority. APR to active line 798 indicates that a new TCR is now going into the active register 60 and when it will start transferring to or from the ADC 22 or DAM 24.

The inputs to register 794 are state 7, line 800, which comes from the channels 52. Active register loaded line 802 indicates that there is presently a TCR in the active register 60. Line 804 actually does the transfer, and it is an output from the modified BBI gorilla/monkey priority hardware. Enable DDL sequencer line 810 is from BBI firmware in microsequencer 340, with gorilla active line 812 coming from the same circuitry as the gorilla next line 808.

TCR loaded flip-flops 814 indicate that until a TCR is loaded, then even though there are signals from the patch panel of consoles 12a–f or from CPU 30 or from timers 44, 46, the TCR still cannot be activated. Wnen CPCW is loaded into active pending register 750, this is effective to set a TCR loaded flip-flop 814. Similarly when a transfer is completed, th word count is 0. There are no more transfers depending on that TCR, and that TCR loaded flip-flop 814 is reset.

Run control 816 shows the "OR" tie of six signals which can activate either a gorilla or a monkey, once signals are obtained from patch panel run holes of consoles 12a–f. Three of these six signals consist of the six inputs from the patch panel on line 818, six inputs from timer carry out signals on line 820, and six digital run signals from the CPU on line 822. The remaining three are described as follows: Six timer-allocate signals on line 824, which determine whether timer 64a–f is to start the activation or whether the patch panel is to start activation; six signals on line 826 which are fed into block 816 to inhibit run signals once the TCR is finished, and finally, the six-timer critical signals on line 828, which are fed through block 816 into gorilla round robin 830 and which allow the gorilla to take priority over the monkey.

Figure 18A:
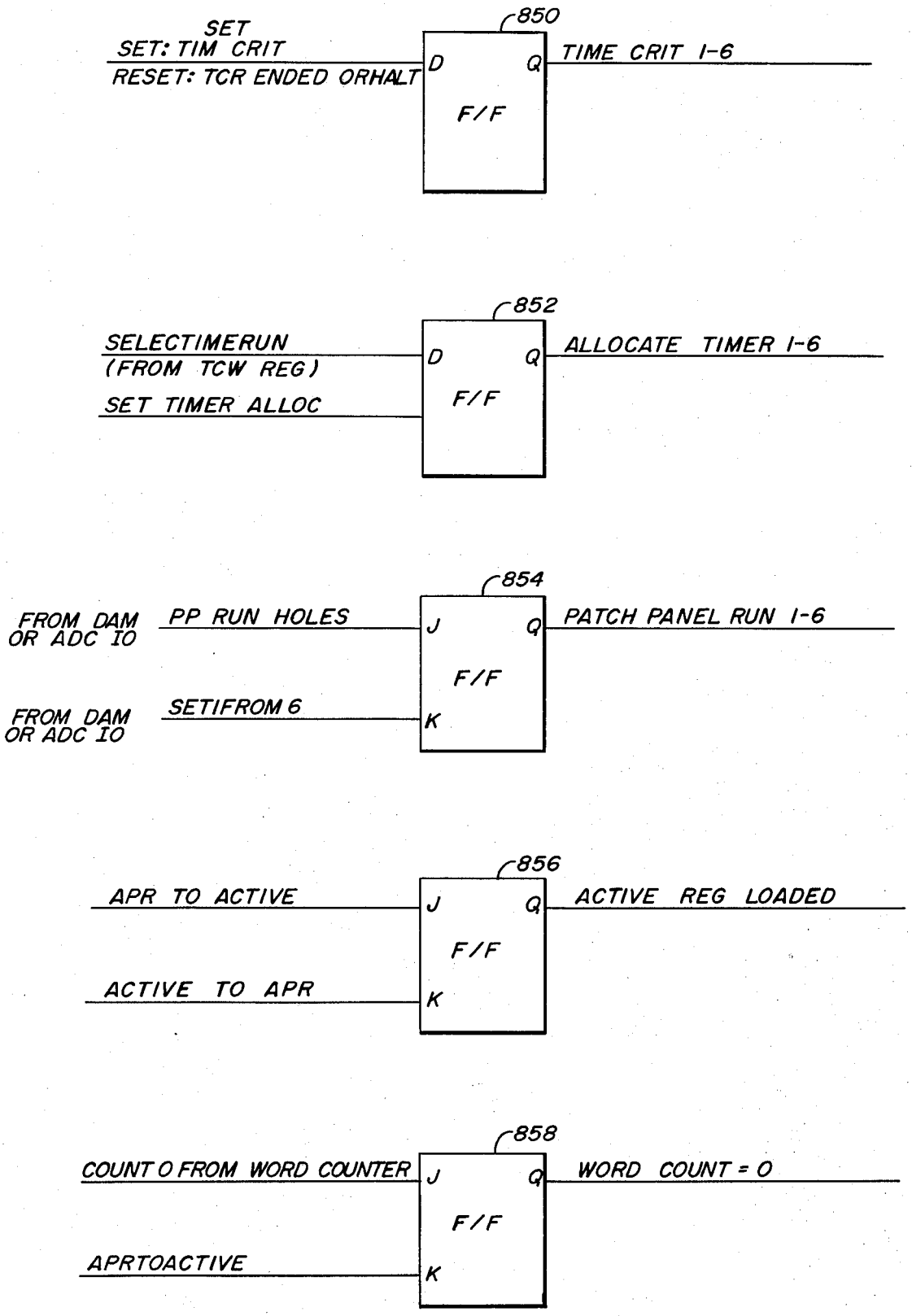
Figure 18B:
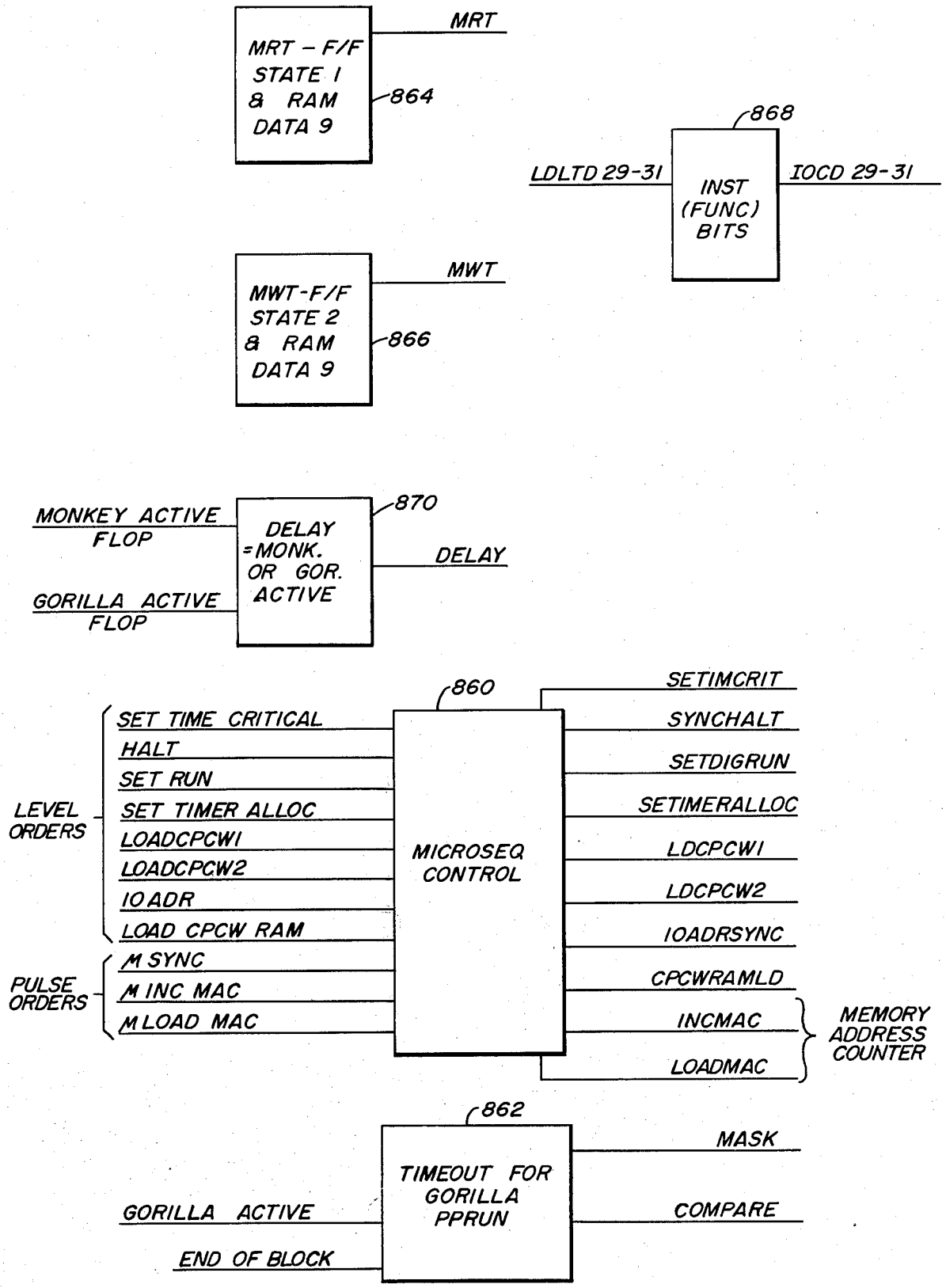

Six-timer critical flip-flops 850 FIGS. 18A–B are set by command of CPU 30. There is a select timer run 852, which also allocates timer blocks 1–6. These are set by CPU 330 to select the timer to activate the TCR's rather than permitting the patch panel to activate the TCR's. Block 854 indicates the six patch panel run holes which are fed in to set the six JK flip-flops within block 854. These flip-flops are set when a pulse arrives from the patch panel, and they are reset when a transfer is complete. Block 856 is set when there is an APR to active signal and is reset when there is an active to APR signal. Block 858 indicates when a word count reaches 0. When the word count is finally decremented to 0, the TCR is finished and is used to indicate that the end of the transfer is for that particular TCR.

MRT, MWT and delay blocks 864, 866 and 870 are used for signals from DCM 22 to tell BBI 21 when it wants to read or write or delay.

Microsequencer 860 is part of microsequencer 340 and is used for DCM functions. The firmware for these functions is a modification and addition to standard BBI firmware shown in the BBI firmware flowchart. The signals on the left of block 860 indicate the outputs from the programmable ROM's of microsequencer 340. The additional inputs are shown on the right-hand side.

Time-out 862 provides for a set up of priorities so that if a gorilla is running from the patch panel, it has priority over all of the other TCR's 62a–f. Unless the signals in the patch panel come frequently, it could hold up all of the other transfers until a gorilla reaches its end of block. Time-out 862 makes sure that unless the pulse signals of the patch panel when a gorilla is running come in less than 100 microseconds apart priority is dropped and another CD pending, or monkey transfer, is allowed to come in.

The following setting instructions are provided for the respective circuits.

| | |
|---|---|
| time critical 850 | Set by a 123 instr. RST by HALT INSTR 122 Count O. Chain Master Reset |
| allocate timer 852 | Set/reset by Instr 120 |
| patch panel run 854 | Set by PP run hole Reset after each conversion or transfer |
| word count 858 | Set when word counter reaches EOC and reset on a new APR to active |

C. DCM Microsequencer 860 Firmware Flowchart

The following is a firmware flowchart for microsequencer 860. This firmware is in addition to the BBI microsequencer 340 firmware previously described.

Figure 19:
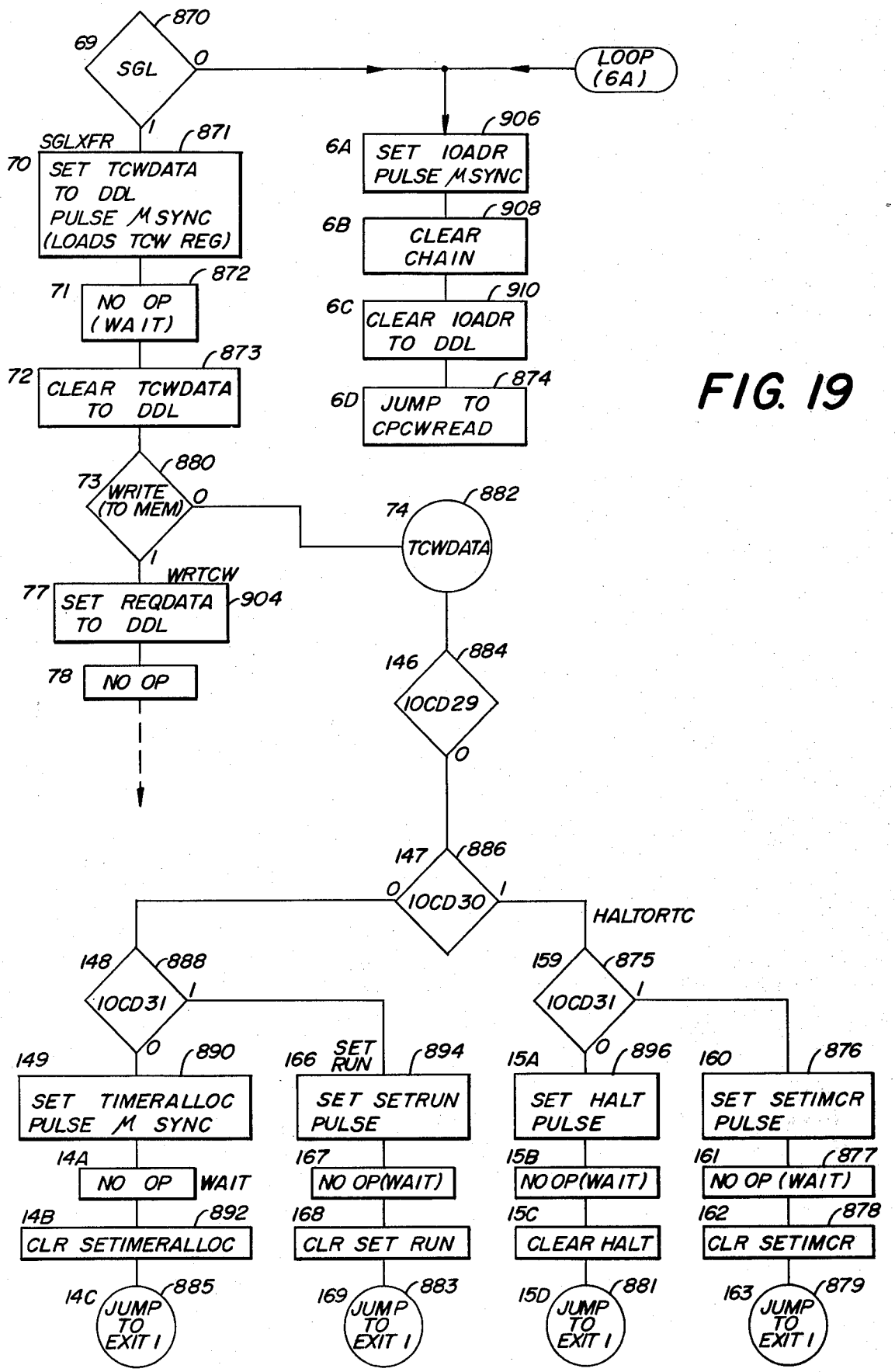
FIGS. 19, 20, 21 and 22 illustrate flowcharts for the firmware of the DCM microsequencer.

Blocks 870–873 and 880 FIG. 19 are similar to blocks of the BBI firmware flowchart which arrive at write diamond 880, which provides for a transfer from CPU 30 to DCM 22. TCW data in jump 882 indicates that there is information on bus 34 which describes an instruction address to the DCM. Diamonds 884, 886, and 888 decode one of six instructions to the DCM. For example, if IOCD 29 is not set as indicated in diamond 884 (location 146) and IOCD 30 is not set as indicated in diamond 886 (location 147), then the program goes to diamond 888. A pulse is provided by the firmware to set the timer to allocate block. Thus, in block 852, the set timer allocate signal is applied as the clock pulse to set one of the six D flops. A clear timer allocate sends one pulse over to the D flops and sets the correct timer allocate as determined from the information in the TCW register 774.

Similarly, if IOCD 31 is set in block 888, then a set run pulse is provided by block 894 to another six blocks which allow the TCR to become activated.

The third command is to halt the TCR. All of the jumps 879, 881, 883, 885 provide a single pulse which is used to carry out the particular command. In the case of the set halt pulse in block 896, the TCR loaded flip-flops 814 are reset, and that essentially stops any more transfers on that particular TCR.

In locations 160–163, as shown in blocks 876–879, the time-critical flops are reset and that carries to block 850. These previous instructions are the six functions that the DCM performs under control of CPU 30, viz set timer allocate flops, set run flops, set halt flops, set time-critical flops. These are all single-word transfers from CPU memory 32 to DCM 25 to perform each of those six functions.

Figure 20:
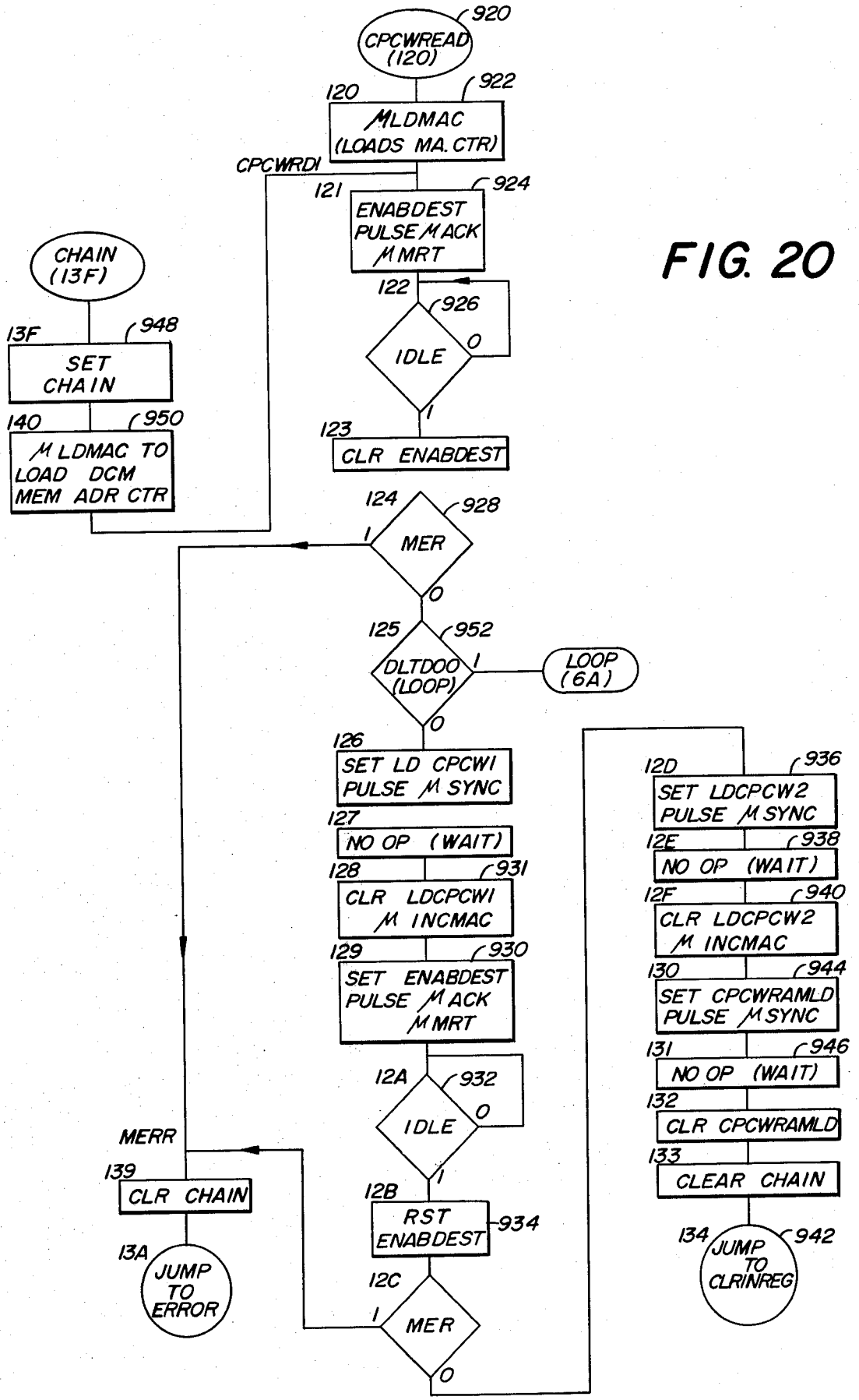

FIG. 20 shows a sequence which allows the DCM to access CPU memory 32 and store the CPCW double words into active pending registers 750. CPCW read is shown in circle 920, which comes from the BBI firmware. In reading from CPU to memory, it is first required that the CPU be told at which location this information is being stored. When the informaton comes from the CPU and is available in the BBI, it is loaded into TCR *62a–f*.

Starting at block 922, the memory address counter 768 is loaded with address of the two CPCW's. In box 924, the destination bus is enabled, to allow the address to be sent to the CPU 30, and pulse acknowledge and MRT indicate that a read is requested.

There is a wait in idle diamond 926 to allow the memory access sequencer in CPU 30 to actually perform that transfer. When out of idle, the data of the first CPCW is available at the DCM. At that point, the address going to the CPU is a clear enable destination bus and check in block 928 for memory error. If there is no memory error, then the first bit of data is considered, which is the data line to device 00 to see whether this is a loop instruction or not.

Assuming that it is a loop, then CPCW 1 is loaded into the appropriate TCR register or active pending register 60. The next CPCW is then brought up. Since that word is a double word, the first word in CPCW 1 is loaded into active pending register 750. In block 930, the end memory address counter is incremented to send a new address to CPU memory 32. The same sequence is continued for block 930 and 932, waiting for the memory access sequencer in block 934 to reset the enable destination bus. Memory error is then checked in block 936, and CPCW 2 is loaded into the active pending register. In blocks 938–940, the memory access counter is incremented and stored in the CPCW RAM 776. In the event that the TCR is activated, a chain bit is set, and two more CPCW's are brought out for the next incremental address.

From diamond 952, a loop is taken, and to the left of this block a chain bit is shown. The purpose of the loop and chain is so that the DCM can continue doing an entire sequence of transfers without requiring to be loaded from CPU 30. If a chain bit is set when the TCR is initially loaded and if the word count reaches 0 in that TCR, then the chain bit is interrogated to see whether the DCM should bring another two CPCW's or whether it should just finish the TCR. Thus, without using any commands, the DCM may go on continually chaining through the entire memory, bringing in new CPCW's. Specifically, blocks 940, 944, and 946 show that the CPCW RAM 776 address which holds the address of the next pair of CPCW's is always incrementing, whether the chain bit is set or not. When the TCR is activated and reaches word count 0, a block 970 FIG. 21 indicated as disable DDL is provided. In block 972, chain active is interrogated, and if the chain bit is set when word count 0 has been reached, then block 948 is entered. Assuming that the chain bit is set, then blocks 948 and 950 FIG. 20 are reached and the program continues up to block 924, which again starts the accessing of two more CPCW's from the CPU memory 32.

In the loop function, the loop bit is interrogated when the first CPCW is brought in and before it is loaded into the TCR. The reason for this is that if the loop bit is set, the CPCW 1 has a different meaning than normal CPCW 1. The normal CPCW 1 bits 12–31 describe the data array address of the transfer. If the loop bit is set, bits 12–31 describe the new CPCW address.

The reason for the looping feature is that the first CPCW 1 and 2 are brought in and completed to the end of the word count and then the chain bit is set. Another CPCW pair is brought out, and if this pair has the loop bit set, then instead of working on the next pair, the program goes back to the first CPCW 1 and 2 and brings in that original pair. In this way, without another CPU command, the first CPCW 1 and 2 can be looped and looped repeatedly until halted by the CPU.

In diamond 952, if the data line to device 00 is set when CPCW 1 is available to the DCM, then there is a loop to block 906, 908 and 910. In this manner, CPCW address is loaded from the data line to devices 12–31, which are presently available to the DCM. This brings in the address of the next CPCW pair, and that goes through blocks 906, 908 and 910 and then back to oval 920, which is the normal address of the CPCW pair.

Figures 21, 22:
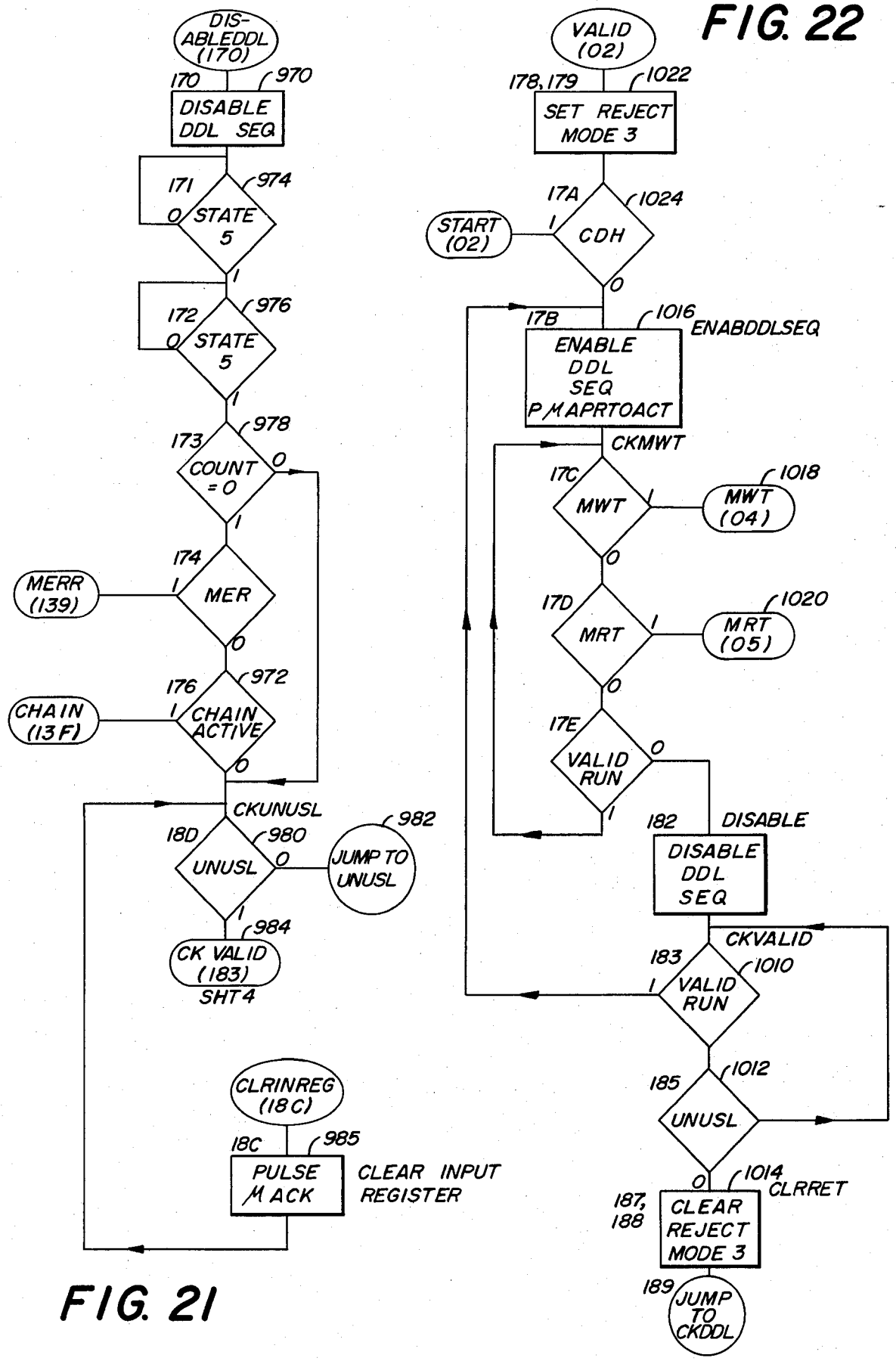

Block 970 FIG. 21 is entered when a transfer has been completed by either a gorilla or a monkey. This allows the firmware to check whether there are any commands CD pending or whether another monkey or gorilla has requested a transfer. Diamonds 974 and 976 check whether the ADC or DAM I/O card is in its rest state 5. At that point, the word count could be checked to see whether it has reached 0 or whether it is in an end of block, whether the chain is set, whether the loop is set, or whether there is a CD pending. Diamond 978 checks whether the count has equaled 0. If it has not, then there is no further checking for memory error or chain active, and the program goes straight to diamond 980. If there is an unusual signal, this means there is a CD pending; if there is a monkey running, the BBI firmware will service that CP pending. If there is a gorilla running and it is not the end of block, then the signal unusual will be inhibited until the end of block. A gorilla will not look to see whether the CD is pending.

Assuming that there is a CD pending and that either this is a monkey running or the gorilla has reached the end of block, then the program ges to circle 982, which is in the BBI flowchart. If there is not a CD pending, the program goes to oval 984. Diamond 1010 FIG. 22 checks whether there is a TCR requesting to run. If there is not, unusual is again checked, and the program stays in loop diamonds 1010, 1012. The reason this occurs is that if there is no CD pending, then there is no point in wasting time. The program just waits until a valid run signal occurs. If there is a CD pending, then unusual will branch from diamond 1012 and into the normal servicing of CD pending.

A valid run means that the TCR is loaded and activate signal high means that a particular TCR is requesting a transfer sequence. Accordingly, in diamond 1010, when a valid run signal occurs, there is a branch out of the left-hand to box 1016. Accordingly, the DDL sequencer is an enable, and there is a search through to see whether the DCM is requesting a memory write, memory read, or if it is a valid run or not. In this manner, an idle loop waiting for a memory write or memory read sequence is provided. If there is a transfer from the ADC, it would be a memory write. If there is a load of the DAM, it would be a memory read. MWT and MRT oval blocks, 1018 and 1020 respectively, go to the BBI flow chart.

Box 1022 FIG. 22 is reached from the BBI flowchart, and valid means that a TCR has been loaded and a run request has been received from CPU 30 or a timer or the patch panel. Diamond 1024 checks whether the CD pending has not sneaked through while reject mode 3 was being set. Assuming no CD pending is waiting, then the program goes to box 1016 to enable the DDL sequencer and wait for memory write or memory read request from DCM 25.

The BBI flowchart FIGS. 11A–C has been modified for DCM use as follows. Taking the start loop at oval 422 through blocks 423, 425, 424, 426, there is a jump to location 2D. Instead of jumping to this BBI location, DCM jumps from location 2D to 06, which is a device interrupt interrogator of the DCM. From location 06 to 07, there is a check to see whether there is a CD pending in diamond 434. If there is no CD pending, the program comes back to diamond 428, which checks for a valid run. The idle sequence of the BBI when it is used as a DCM therefore uses blocks 428, 432, 434 and then back to blocks 428, 432, 434. If there is a valid run, the program jumps to decision diamond 430, which is within the DCM flowchart.

The following additional information relates to the instructions listed in the blocks of the DCM control flowcharts FIGS. 19, 20, 21, 22.

| Block | Instructions |
|---|---|
| 170 | Enter from MWT or MRT sequence when MAS goes idle, i.e.,<br>Monkeyactive gorilla next<br>EOB monkey or gorilla<br>Monkeyactive CD pending<br>Note: Chain may be set |

-continued

| Block | Instructions |
|---|---|
| | Word count may = 0 |
| 871 | Loads TCW REG from LDLTD00, 03–05 |
| 906 | Load CPLW ADR from LDLTD 12–29 to CPCW ADR RAM & TCW REG from LDLTD 0, 3–5 |
| 931 | INC MEM ADR counter |
| 940 | INC MAC & store in CPCWRAM in case chain is set at end of block |
| 950 | Use active TCR ADR to select CPCW ADR RAM |
| 1012 | CD Pending caused UNUSL is inhibited if MASK activated by DDL.<br>Unless gorilla is at EOB or is timed out it will wait in tight loop for next run pulse. |

D. State Diagram for Loading DAM's 24 Reading ADC 22 or DAM 24

The state diagram for loading DAM's is shown in FIG. 24, with state 5 being the idle state in oval 1040. I/O controller 16 waits in this idle state for a valid run signal. Valid run means that a TCR 62*a–f* has been loaded and the run flop has been activated in one of three methods. When a valid run has been received, the change to state 4, oval 1042, sets the delay which enables the transfers to progress as fast as they can. A mask is set if this is a gorilla, and this inhibits the CD pending from coming in until the end of the block. When count equals 0 the flip-flop is reset, and active-register-loaded flip-flop 856 is set. From state 4 in oval 1042 to zero, oval 1044 there is always a transfer, as there is no signal to wait for to go to state 0. This will decrement the word count by one, and update the last equals-current flip-flop.

From state 0, oval 1044, to state 1, oval 1046 there is always a transfer and this is the time when MRT 864 is activated to indicate to the BBI that memory read has been requested. State 1 waits for request acknowledge from the BBI, and as soon as the request acknowledge is received, the diagram goes to state 3, oval 1048. During that period, the MRT is disabled, and the destination bus is enabled with the address of the data array. There is a wait for memory data in oval 1048, with the memory data allowing the diagram to go from state 3 in oval 1048 to state 2 in oval 1050. During that time, the data buffer is loaded and the destination bus disabled.

In oval 1050, there is a wait for the load pulse to be completed. During that waiting time, a load pulse is applied to DAM 24, and there is a transfer pulse if the jam flop is set. As soon as the load pulse is completed, the diagram goes to state 6 in oval 1052, which activates the TCR if the counter equals zero and the chain is not set. The time-critical flop is reset under the same conditions.

During transition from state 6, oval 1052, to state 7, oval 1054 there is always a transfer, and during this time there is an increment in the current address counter if it is not the end of block. If it is the end of block, the run flop is reset in the normal mode. During this time, the patch panel run flop is also reset and the memory address is incremented. During transition from state 7, oval 1054, back to state 5, oval 1040, there is always a transfer. During this time, the active to APR signal is produced, and the mask is cleared if it is the end of block to thereby reset the delay . Back in state 5, the system waits in the idle state for another valid run.

In the state diagram for loading DAM's 24, FIG. 24 the following are notes to the ovals and between the ovals.

| Oval | Instructions |
|---|---|
| oval 1040 | TCR loaded & run flop set<br>will enable APR to active<br>& valid run |
| between ovals<br>1040 & 1054 | Active to APR<br>Clear MASK if EOB<br>Reset Delay |
| between ovals<br>1054 & 1052 | INCR CURR ADR CTR if EOB<br>Reset Run flop if EOB (Normal Mode)<br>if count = 0 } Diag<br>& chain } Mode<br>Reset patch panel run flop<br>INCR memory address |
| between ovals<br>1052 & 1050 | Activate TCR ended } If count = 0<br>Reset time-crit flop } & chain |
| oval 1050 | Load pulse to DAM<br>Trans. pulse to DAM (if IAM) |
| between ovals<br>1050 & 1048 | Load data buffer (DAM I/O)<br>Disable DEST bus |
| between ovals<br>1048 & 1046 | Disable MRT 864<br>Enable DEST bus |
| between ovals<br>1046 & 1044 | Activate MRT 864 |
| between ovals<br>1044 & 1042 | Decrement word count<br>Update L = CFF (EOB) |
| between ovals<br>1042 and 1040 | Set Delay<br>Set MASK if gorilla<br>(via 100 μSEC 1 shot)<br>Reset count = 0 flop<br>Set ACT REG LOADED flop |

Referring now to FIG. 23, the state diagram for reading ADC 22 or DAM's 24 is shown. State 5, oval 1070, is in the idle condition waiting for a valid run, which means that a TCR is loaded and the run flop is activated. During this valid run, the delay is to be set and the mask is to be set if this is a gorila or time-critical request. In addition, the read-back signal to DAM file is activated, the count-equals-0 flop is reset and the active-register-loaded flop is set. Accordingly, state 4, oval 1072, is reached. During transition from oval 1072 to state 0, oval 1074, there is always a transfer, and during that time the word count is decremented and the last equals-current flip-flop is updated.

During transition from state 0, oval 1074, to state 1, oval 1076, there is always a transfer, and in ADC system a convert pulse is sent to ADC 22. This is a wait in state 1, oval 1076, during the time the ADC 22 is busy. At the end of the convert pulse, the ADC goes not busy, and there is a transition from state 1, oval 1076, to state 3, oval 1078. During this time, ADC data is loaded to the buffer or DAM information is loaded to the buffer.

During transition from state 3, oval 1078, to state 2, oval 1080, there is always a transfer. During this time, the MWT 866 is set. The system remains in state 2 waiting for a request acknowledge from the BBI. When that acknowledge arrives, there is a transition from state 2, oval 1080, to state 6, oval 1082. During that period, the destination and data buses are enabled and the TCR ended is activated. In addition, the time-critical flop is reset if the count equals 0 and the chain bit is not set.

In state 6, there is a wait for CWT. When CWT arrives, there is a transition from state 6 to state 7, oval 1084. During that period, the destination and data buses are disabled, the current address counter is incremented if not the end of block, the run flop is reset if end of block (normal mode), and the run flop is reset if the count equals 0 and the chain bit is not set. In addition, the patch panel run flop is reset, and the memory address incremented. During transition from state 7, oval 1084, back to state 5, oval 1070, there is always a transfer. During that period the mask is cleared, if end of block, and the delay is reset.

In the state diagram for reading ADC 22 or DAM's 22, FIG. 23, the following are notes to the ovals and between the ovals.

| Oval | Instructions | |
|---|---|---|
| oval 1070 | TCR loaded and run flop set<br>will enable APR to active<br>& valid run | |
| between ovals<br>1070 & 1084 | Active to APR 75<br>Clear MASK if EOB reset delay | |
| between ovals<br>1084 & 1082 | Disable DEST & Data Buses<br>INCR current ADR counter if EOB<br>Reset run flop if EOB (normal mode)<br>Reset patch panel run flop 854<br>NCR memory address | |
| between ovals<br>1082 & 1080 | Lower MWT<br>Enable DEST & Data Buses | |
| | Activate TCRENDED<br>Reset time CRIT flop 850 | } If count = 0 & Chain |
| between ovals<br>1078 & 1076 | Load ADC or<br>DAM to Buffer | |
| between ovals<br>1076 & 1074 | Convert pulse to ADC | |
| between ovals<br>1074 & 1072 | Decrement word count<br>Update L = CFF (EOB) | |
| between ovals<br>1072 & 1070 | Set delay<br>Set MASK if gorilla<br>Signal to DAM file<br>Set<br>ACTREGLOADED flop | Activate Readback<br>Reset Count = 0 flop |

V. PARALLEL ANALOG MULTIPLEXER (PAM) 20

A. Block Diagram Description

Figure 25A:
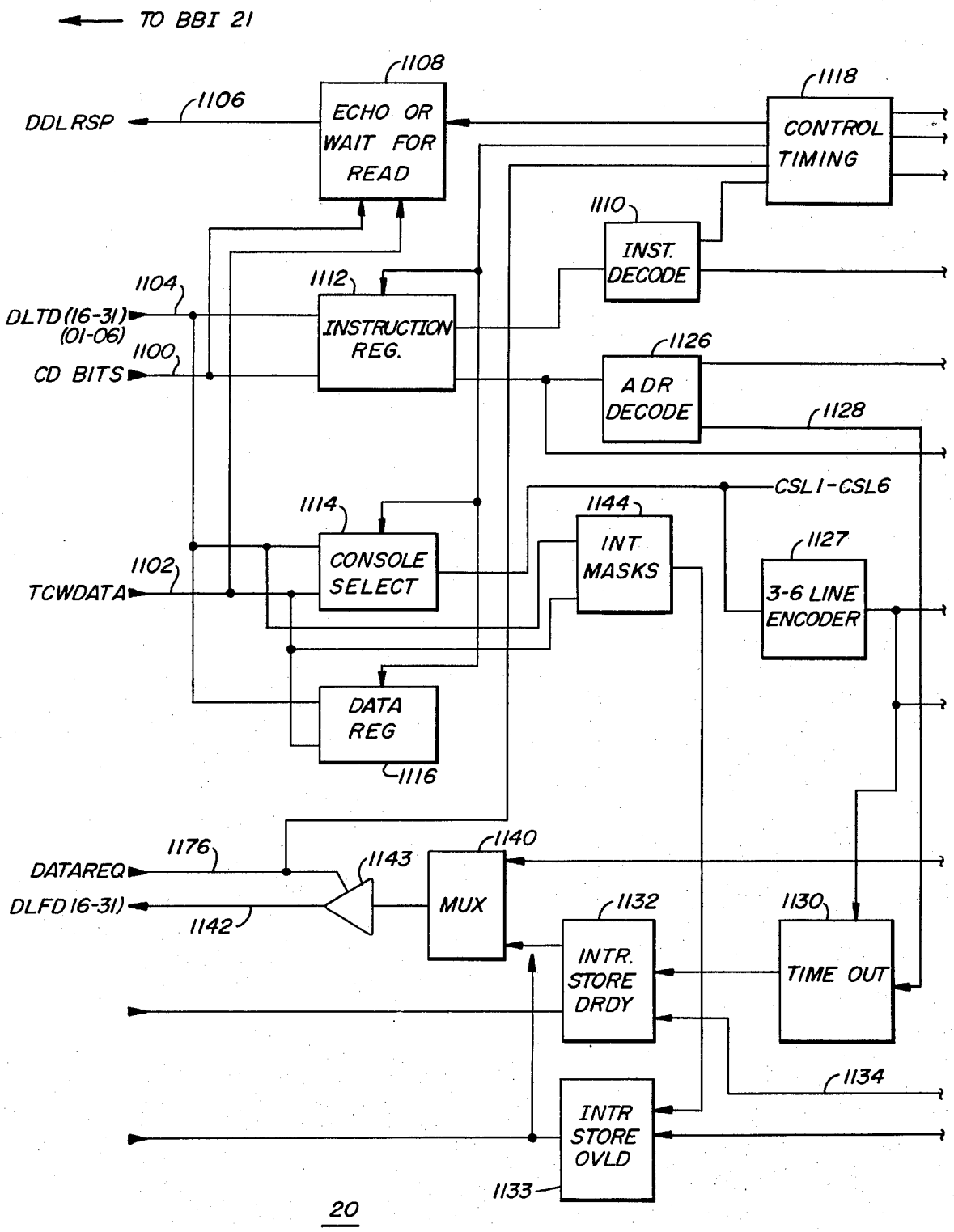
FIGS. 25A–B taken together illustrate in more detail and in block diagram form the PAM section of FIG. 1.
Figure 25B:
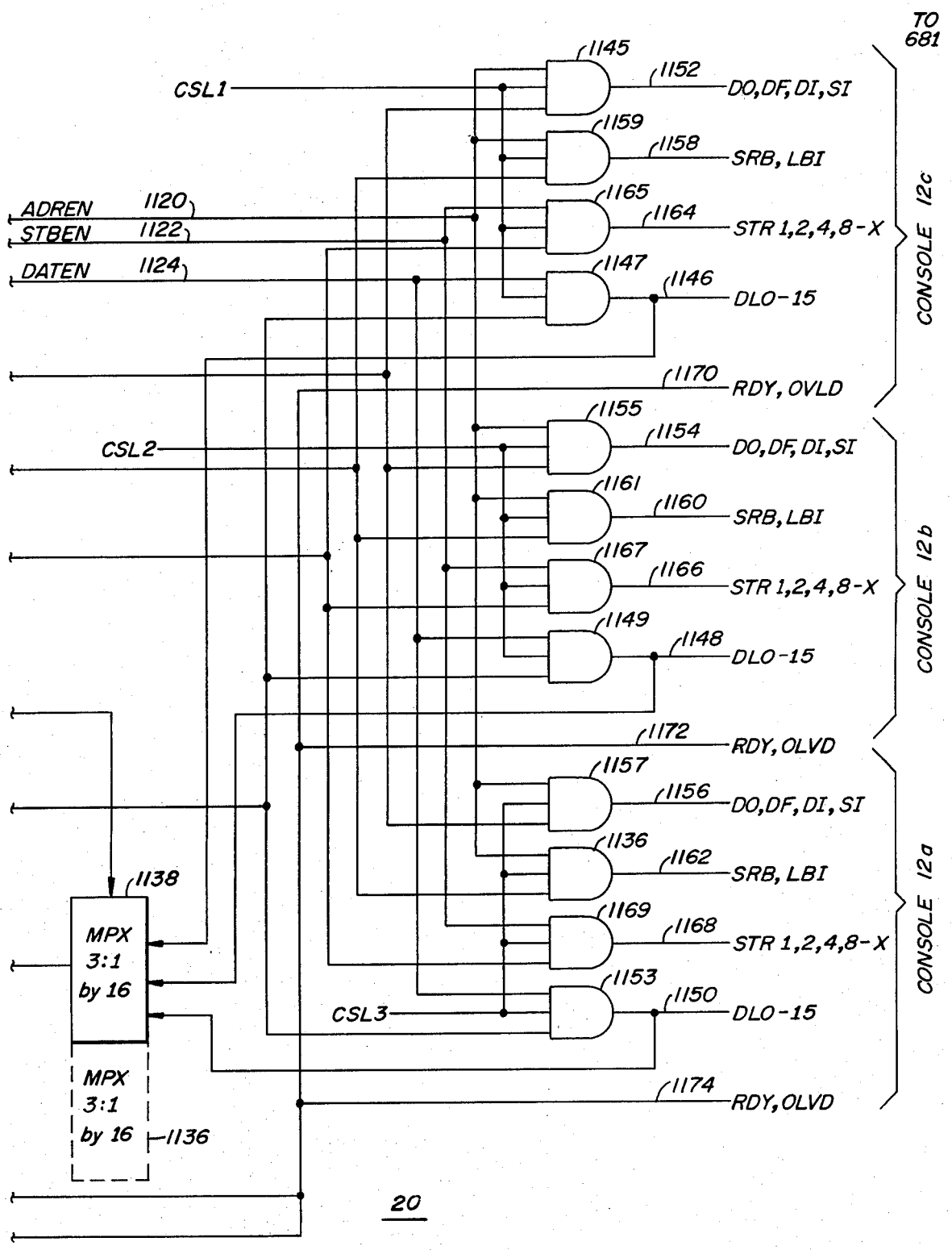

Parallel analog multiplexer (PAM) 20, FIG. 25A, B is an interface system and operates to talk to one analog computer 12*a–f* at a time. PAM 20 is coupled between BBI 21 and the analog computer.

Data transfer from BBI 21 is in 32-bit words which are stored in registers in PAM 20. Specifically, these words are stored in instruction register 1112, console select register 1114, and data register 1116. The CD word in a signal called CD bits is applied by way of line 1100, which indicates that BBI 21 has CD data available. The least significant 12 bits of the CD word contain the address of the device in the analog computer 12*a–f* which is being communicated with.

The TCW word is also stored in PAM 20, along with a TCW data signal on line 1102 that informs PAM 20 that the TCW word is available. Bits 1–6 of this word are the console select bits for analog computers 12*a–f*. Bits 16–31 are data bits shown together as line 1104. Each command, such as CD bits or TC data or data request coming from BBI 21, is required to be answered with a SP DDLR signal on line 1106, which is a device dependent logic response. This answering is performed by an echo command circuit 1108.

CD data is decoded by instruction decoder 1110. There are four types of instructions, and they are analogous to instructions of the Pacer computer of Electronics Associates, Inc. These four types of instructions are data out, device function, status in, and data in. These instructions start the control timing circuit 1118. Circuit 1118 operates the signals going to the analog computers and also operates the echo circuit to wait for signals coming back from the analog computer before issuing a response. The signals leaving control timing 1118 are address enable 1120, strobe enable 1122, and data enable 1124. The first signal to become active is data enable 1124, which allows data lines to be activated going out to a selected analog console 12*a–f*. The next signal is address enable 1120, which allows the address to go out. The last signal is strobe enable 1122, which allows the PAM 20 to issue a strobe to a selected analog console. The strobe is the first to go inactive, followed by the address and data lines going inactive. The information of which console 12*a–f* is selected is stored in console select register 1114.

Address decode 1126 has eight lines coming from the eight least significant bits of the CD word. These least significant bits relate to eight lines coupled to ADR decode 1126 from instruction register 1112, and also relate to the selection of control lines or mode control in the analog computer.

In conventional manner, an analog computer develops the signal called "device ready" on slow instructions. Therefore, there is a signal path from address decode line 1128 to a time-out block 1130 for function relay, time-scale changes and mode changes. Accordingly, there is a time-out for the length of time that it would take the analog computer to perform this function and then give a device-ready signal to interrupt storage 1132. Device-ready signals come directly from the analog console by way of line 1134 and are applied to device-ready interrupt storage 1132.

The console select register also operates a multiplexer 1136, 1138 to receive signals from the analog computers to select which of the analog computers is going to be talking back to BBI 21. Multiplexer 1138 has 16 lines applied to it from the three analog consoles 12*a–c*. For consoles 11*d–f*, an expansion multiplexer 1136 is provided, and the connections are made in similar member.

The device-ready and the overload interrupt also come from an analog console and are multiplexed together in block 1140, with the data lines feeding the BBI 21 on lines DLFD (data lines from device) 1142. The device-ready and the overload interrupt are also stored in flip-flops and are sent back to BBI 21. The interrupts are maskable by an interrupt mask register 1144, which masks the overload interrupt. There is one bit in register 1144 for each console.

From consoles 12*a–c*, it may be seen that there are signals DLO-15 on lines 1146, 1148 and 1150, these data lines being bidirectional. If a control line is to be set, a data line is assigned to a specific control line, and that data line would be in a 1 state to set that particular control line. Similarly, if sense lines are being read, each data line would be assigned a sense line and, if that line should be in a 1 state, the sense line would be set. These incoming data lines go to multiplexer 1138.

There are further functions that the analog computer will perform for data out, device function, data in, status in, as indicated on lines 1152, 1154 and 1156. Additional steering-register-bit and link-bit-1 lines 1158, 1160 and 1162 relate to address information. When the steering register bit is through, this is a signal to the analog console itself.

Lines 1164, 1166 and 1168 are binary encoded steering lines to select one of 16 devices. Further, there is a device-ready signal and overload signal on lines 1170, 1172 and 1174. These perform interrupt functions to BBI 21.

Control timer 1118 has 16 states. In the normal operation there is a short instruction which uses four of these states to transmit information to the analog console. When data is to be read back from the analog console it must also be synchronized with BBI 21, so there is a wait state. The control timer 1118 counts from 0–4 and then waits for BBI 21 to request the data by raising line 1176. The control timer then continues to advance.

CD bit signal on line 1100, TCW data signal on line 1102 and data request signal on line 1176 each require a response back to BBI 21, to inform the BBI that PAM 20 has acknowledged that command. PAM 20 receives these signals and stores them as long as the PAM is not busy performing another function. Then these signals are applied to a shift register in echo or wait-for-read circuit 1108. Activating any one of these signals generates a strobe pulse which applies the data into a data register in block 1108. The ORing of any of these circuits sets a flip-flop that sends a DDLRSP signal on line 1106 back to BBI 21, acknowledging command. Thereafter,, BBI 21 lowers the active signal. A DDLRSP is not issued until the wait period is over, and then such a signal is issued and BBI 21 reads the data from PAM 20.

VI. DETAILED EXPLANATION OF CIRCUITS

A. ITC 26

1. RTHC and DCM Timer Controls 121, 126

Figure 26:
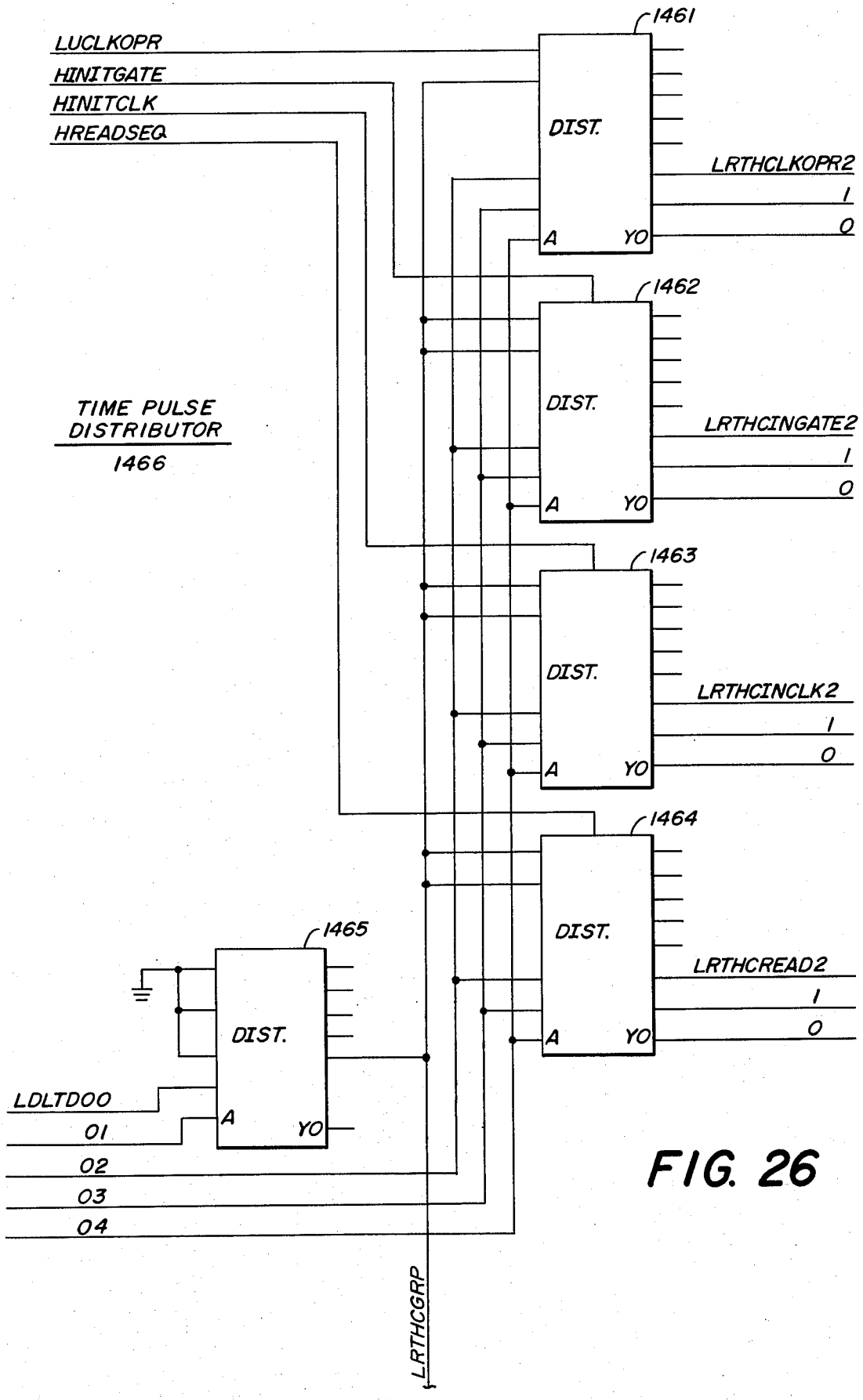
FIGS. 26–37 illustrate in more detail and in block diagram form specific circuits of the ITC section of FIGS. 5A–B.

The circuitry of both timer controls 121, 126 is similar, thus only one of them, RTHC timer control 121 will be described in detail. The basic circuitry is a timer pulse distributor 1466, FIG. 26, in which four signals are produced by any one of the 15 timers of timer system 1460, FIG. 29, formed by an 8253 LSI circuit (Intel), with each of the timers being 16 bits wide. Three of the four signals are used in loading timer 1460, and one is used in reading the timer. Accordingly, the timer pulse distributor generates four pulses as required as a result of signals coming from microsequencer 134 at the proper time. In addition to these four pulses, there is an address specifying which one of the timers of system 1460 is the correct pulse to go to. The distributor then transmits the pulse to the correct address and the correct timer, with the addresses having the designations LDLTD 00, 01, 02, 04. It will be understood that in distributor 1466, only one set of four circuits, 1461–1464, has been shown and that two more sets of four are used with similar connections to the first set.

Figure 27:
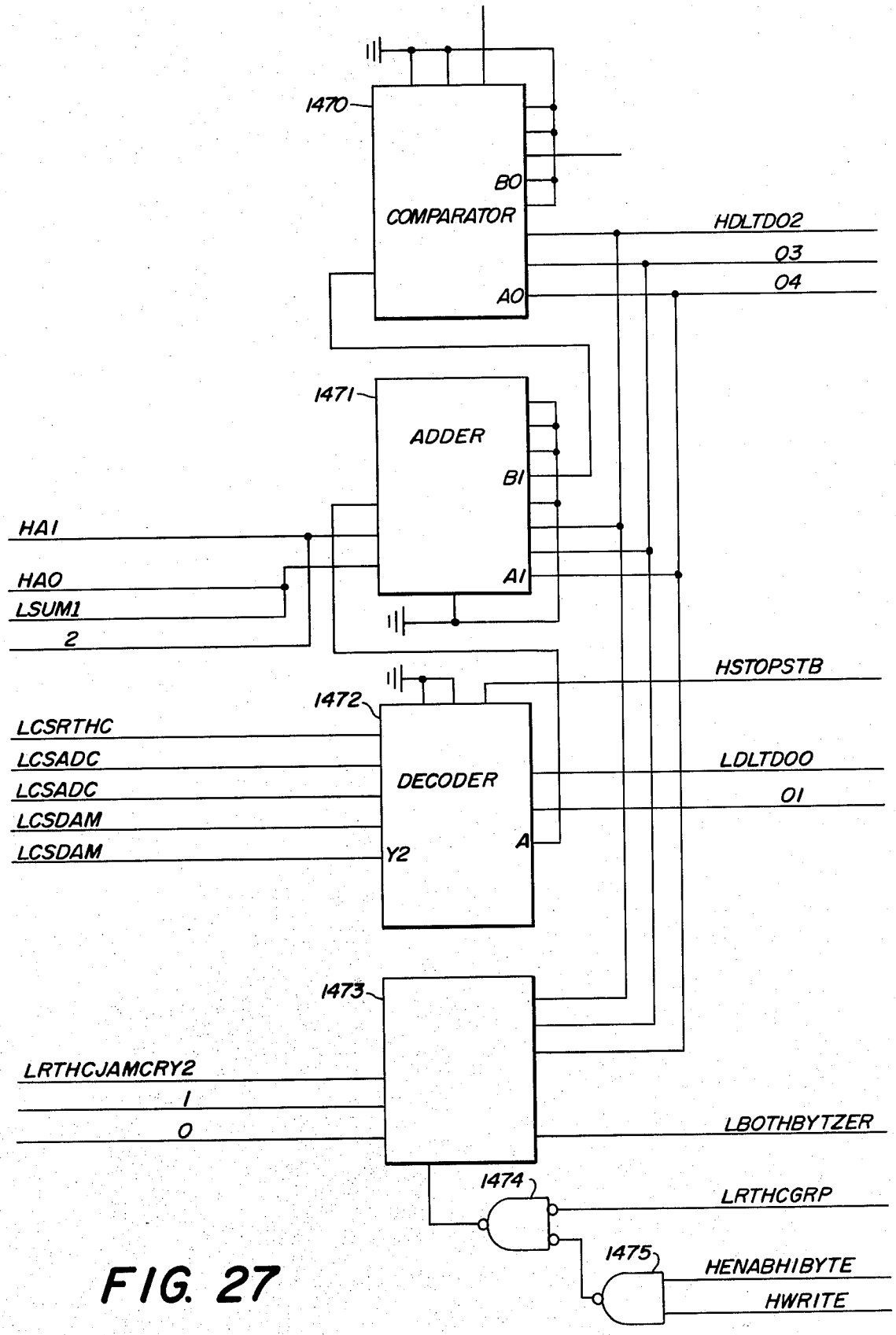

FIG. 27 shows a timer address comparator 1470 and a chip select decoder 1472. These circuits take the address as it comes from the program in memory 32. By the address it is meant that the programmer is attempting to specifically address one of the timers of system 1460 to do something to the timer such as reading and loading it, etc. Comparator 1470 converts from one format of code into another compatible with timer 1460.

RTHC jam carry latch 1473 is used when loading a real time hybrid clock, and the upper 16 bits at the interval value are 0, so that the bit is latched.

Figure 28A:
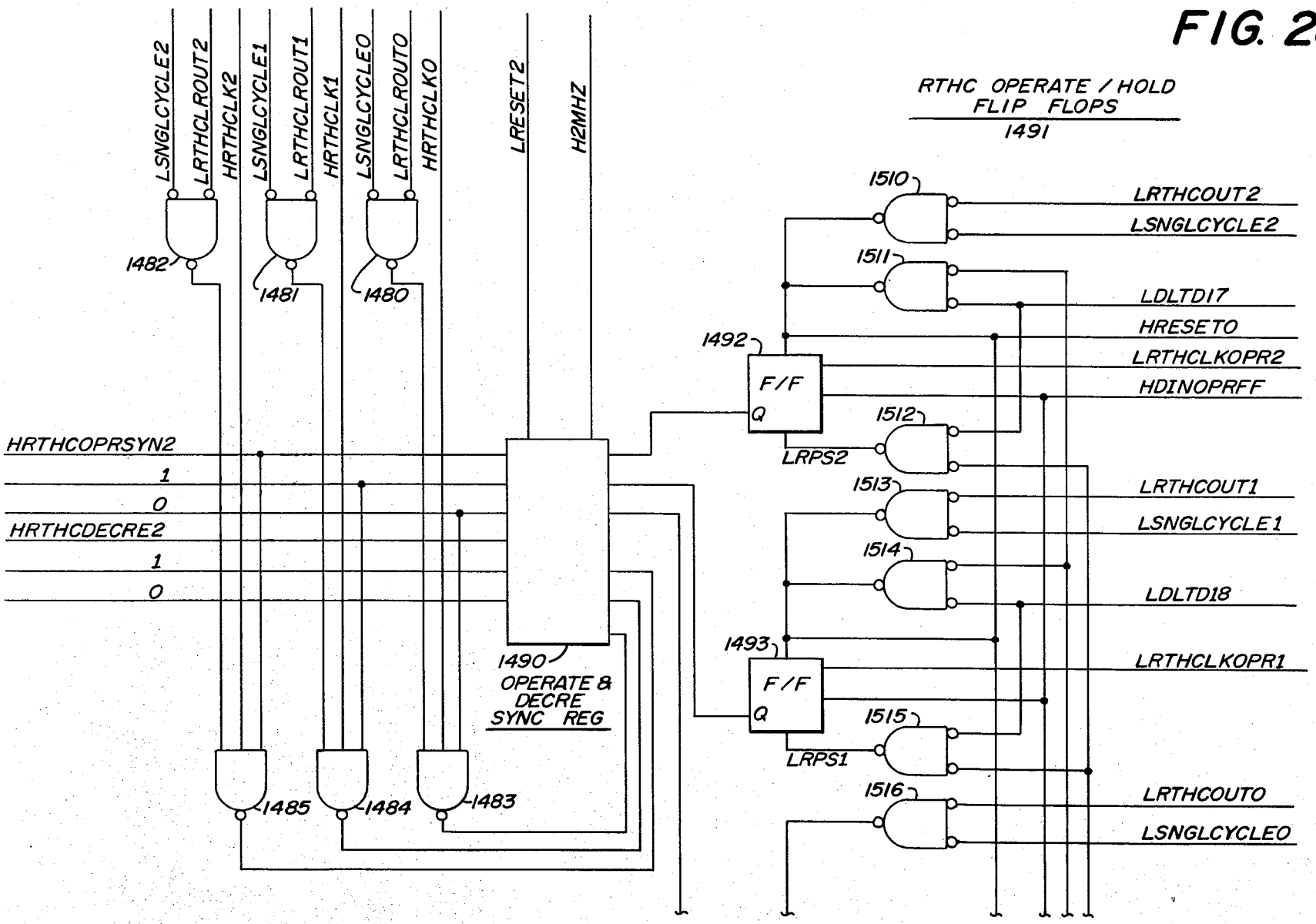
Figure 28B:
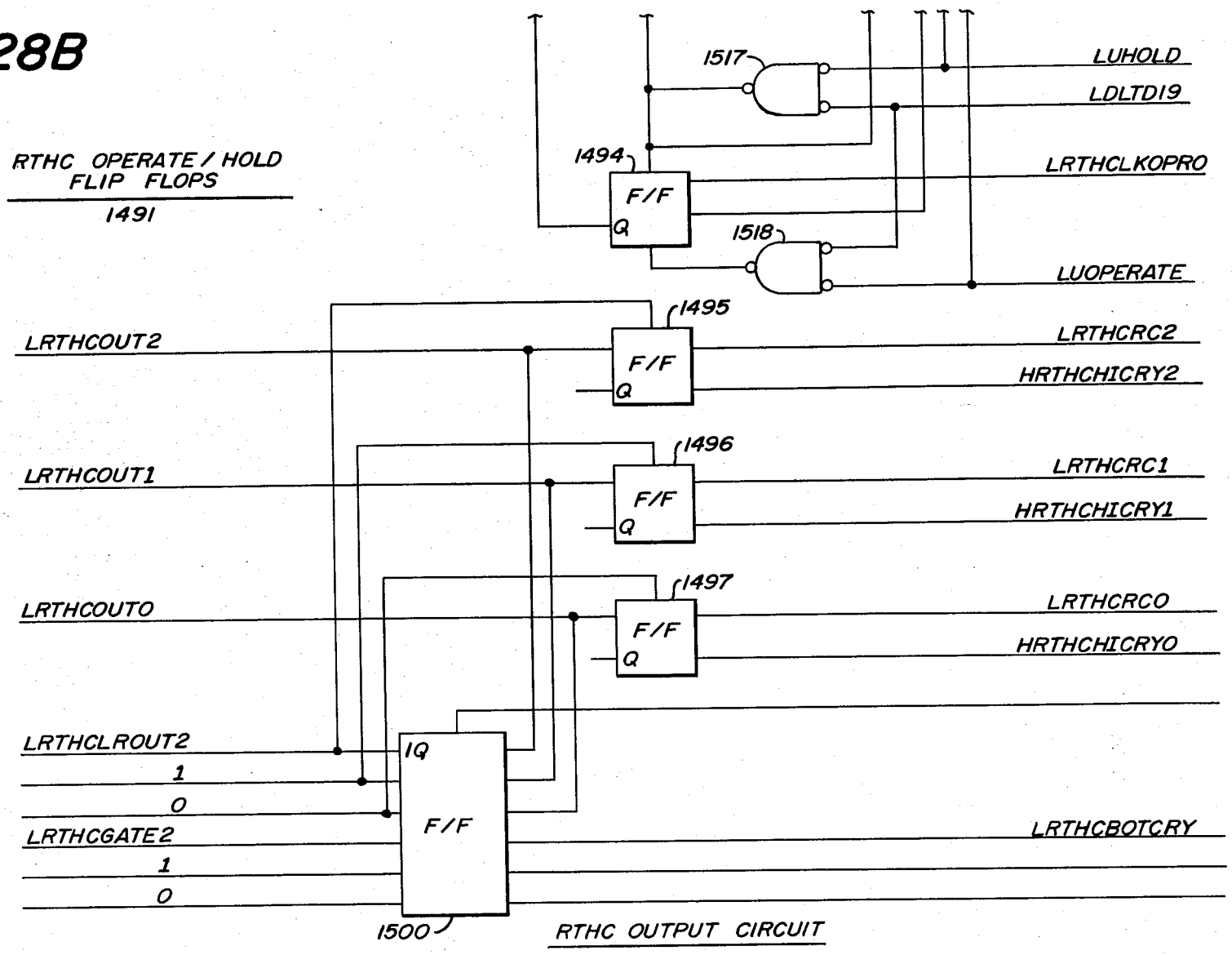

FIGS. 28A,B shows an operate/hold flip-flop 1491 and a subcircuit defined as an operate and decrement sync register 1490. These circuits operate primarily on the inputs to timer 110 in which the clock signals are decremented. The function of sync register 1490 is to take the synchronous clock signals and synchronize them up to the clock used in the timer circuits. Specifically, flip-flops 1491–1494 operate as on and off switches with respect to the timer 1460. On the other hand, flip-flops 1495–7 are called operate/hold flip-flops. Each one of these flip-flops corresponds to one of the timers in the real time hybrid clock timer. If the flip-flop is clear, then the circuit is thought of as being in the hold mode in which the timer is not running to turn off. The associated gating allows the programmer to come with an instruction that will either start the timer or stop the timer. In effect, the programmer has the ability to throw a switch and to turn the timer on or off.

There is a further mode of operation in which once the timer is started and its down-count reaches a 0 count, it will reload itself with the initial value and continue counting. This is called multicycle mode. This is in contrast to the single-cycle mode, in which the programmer would load a value up to the timer, start the timer or put in an operate. Once the timer down-counts and reaches 0, the timer would turn itself off. The operate flip-flops 1492–1494 operate the sync register 1490.

2. Timer Initial Value Buffers 114, 116 and Registers 118 and 128

Figure 29:
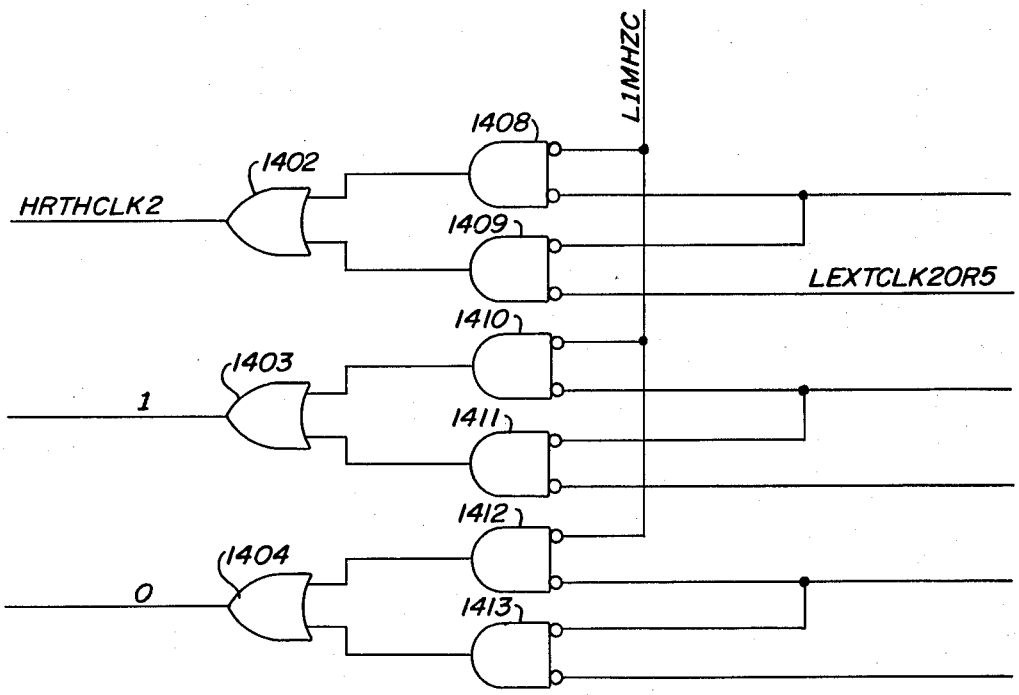
Figure 29:
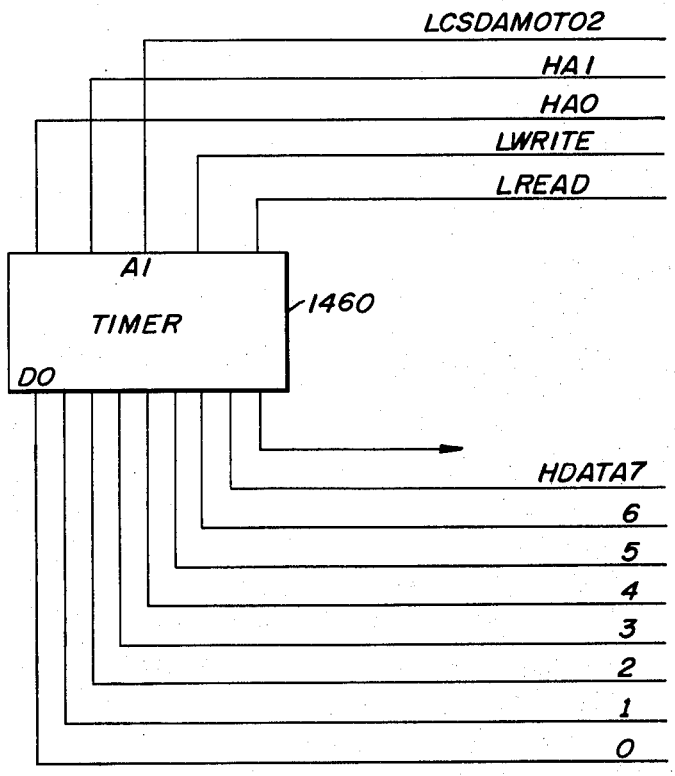

Fifteen timer system 1460, FIG. 29, operates as a clock source multiplexer. This circuit selects whether the decrementing clock or the real-time hybrid timer comes from the 1 MHz. internal clock or whether it comes externally from a patch panel hold on one of the analog computer consoles 12*a–f*. As previously described, 15 timers of system 1460 are provided by an 8253 LSI, and that circuit has initial value buffering in addition to control circuitry which provides the timing for timer 110.

Figure 30:
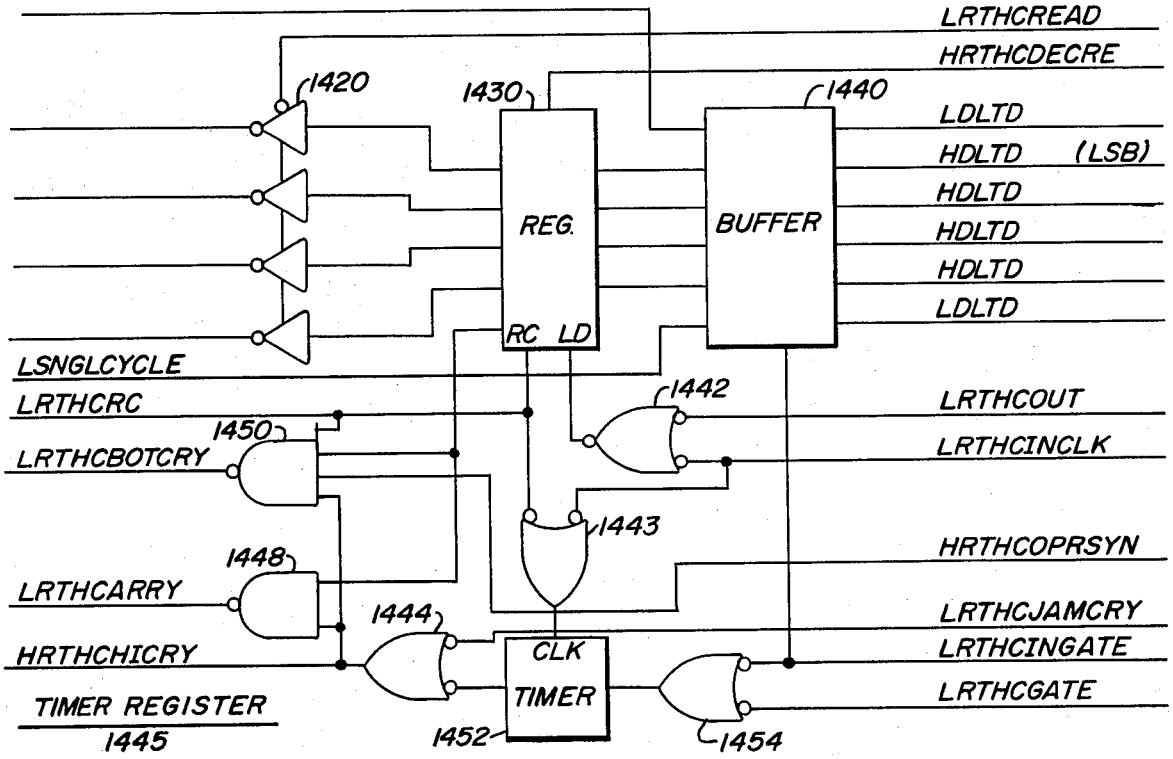

FIG. 30 shows one of the 15 RTHC timer registers 1445. Since all of the timer registers are identical, only one of them is shown in detail. The ITC timer length is 20 bits. Since 15 timer system 1460 constitutes a 16-bit timer, register 1445 has a four-bit initial value buffer and a four-bit counter. In this manner, timer 1460 provides an effective 20-bit timer. Specifically, circuit 1440 is an initial value buffer, and circuit 1430 is a down-counting register for the least significant four bits of this timer 1445. When down-counting register 1430 reaches 0, it generates a carry to timer 1452. When that timer 1452 reaches 0, it carries over to timer 1460. When both timers have carried, this signifies that the entire 20-bit count value has reached 0 and it is time to generate a carry pulse. The remaining gates 1444, 1448 and 1450 are used to generate various carry pulses out of timer 1445. In this manner, the drivers allow the reading of the current value of the time down-counting register on program control.

It will be understood that, if you desire to read the current value of one of the 15 timers of system 1460, there is a read construction the programmer can execute that will cause microsequencer 134 to go with the specified timer, read out the current 20-bit value, and cause it to be loaded into a predetermined register. Once this is accomplished, the programmer can execute another instruction that will cause the predetermined register to be emptied back to the program.

3. CPU Bus Interface

Further, CPU bus interface circuits are provided for bus 34. These circuits function as a result of CPU 30 attempting to transfer information into ITC 26. Such interface circuits respond back to CPU 30 when an appropriate signal says that the ITC is busy at a particular moment and it cannot accept an input transfer from CPU 30. In the event that the ITC is not busy and it does accept the input transfer, the data is clocked off bus 34 into register 136. At the same time, a signal is sent back to CPU 30 indicating that the transfer has been accepted and microsequencer 134 should be signaled that there is a new instruction in input register 136 that should be processed.

A subfunction of this circuit is to recognize the physical address of the ITC so that a particular CPU transfer may be recognized and targeted. This circuit decodes that type of transfer and provides signals to microsequencer 134, so that it knows what kind of instruction it is and how it should go about processing it. These circuits are identical to SEL RTOM circuits as defined with respect to circuit 108.

4. Microsequencer 134

Microsequencer 134 is the heart of the congtrol of ITC 26. The microsequencer operates as a small computer having two instructions: a branch instruction and an order instruction. An order instruction generates a change of level signal and at the same time generates at most two pulses as selected by the instruction.

A branch instruction causes microsequencer 134 to branch away from its sequential flow to the firmware to some other point in the firmware. A particular branch instruction specifies which one of 24 test inputs should be tested. The input is tested and then, if the input is true, a branch occurs to another part of the firmware. If the input is false, then the microsequencer simply increments to the next sequential instruction in the firmware.

Figure 31:
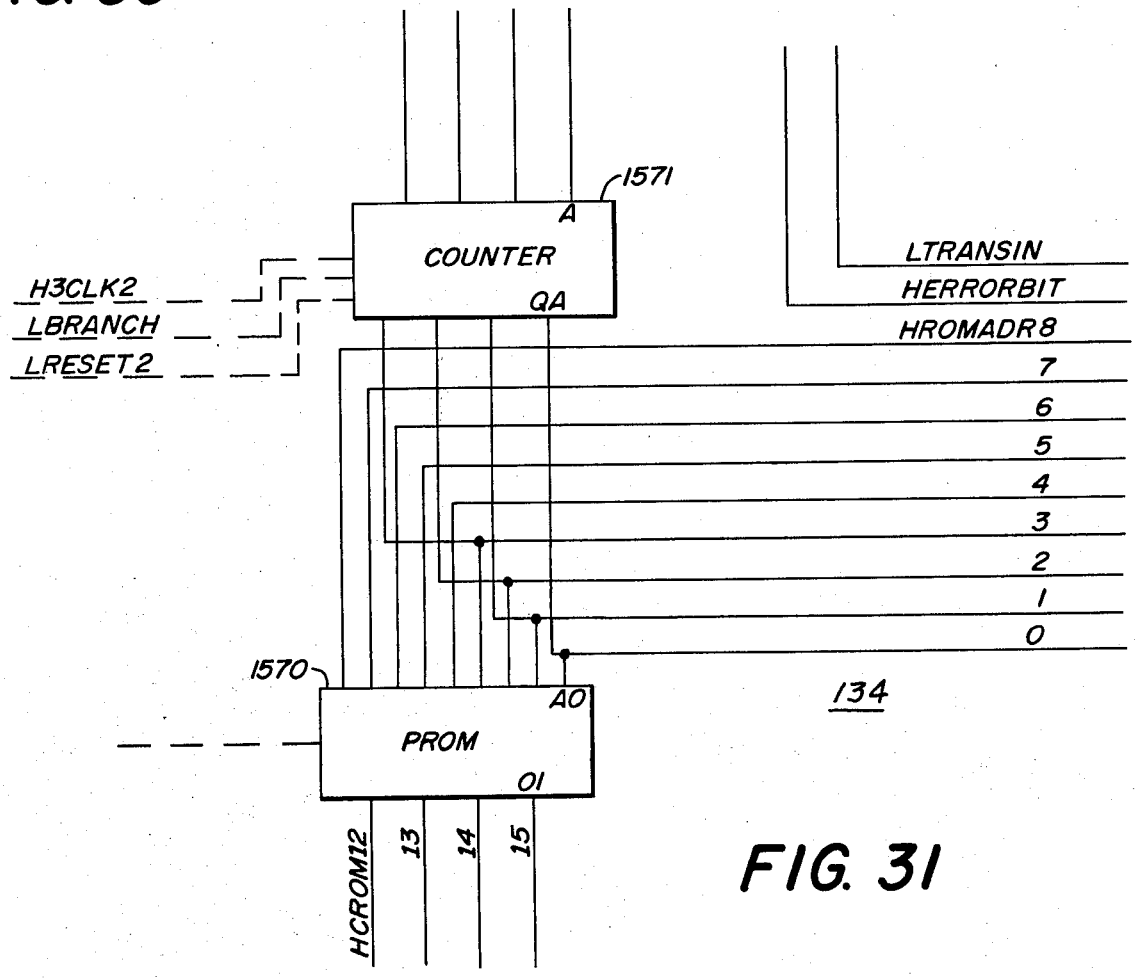

FIG. 31 shows a control ROM and program counter having a counter circuit 1571. It will be understood that two other identical counter circuits are provided and identically connected to the lines between counter circuit 1571 and PROM chip 1570. Similarly, three other identical PROM chips are provided and similarly connected. The microsequencer firmware is stored in the four PROM chips.

Figure 32:
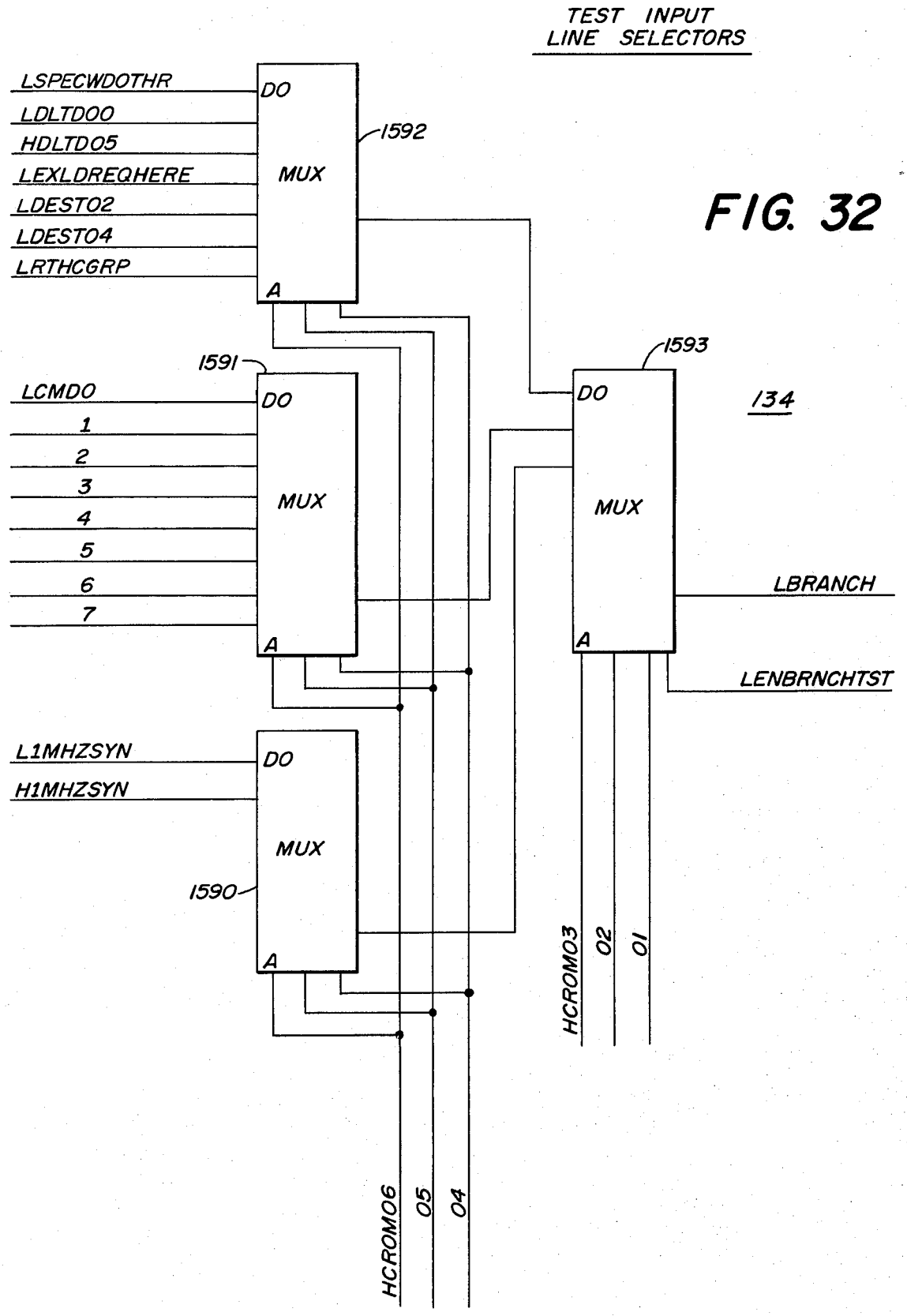

FIG. 32 shows a test structure comprising four select circuits 1590–3 which select which one of 24 inputs is to be tested for a branch instruction. Each of circuits 1590–3 is a multiplexer that selects one of its eight input lines and connects the selected line to an output of the respective circuit.

Figure 33:
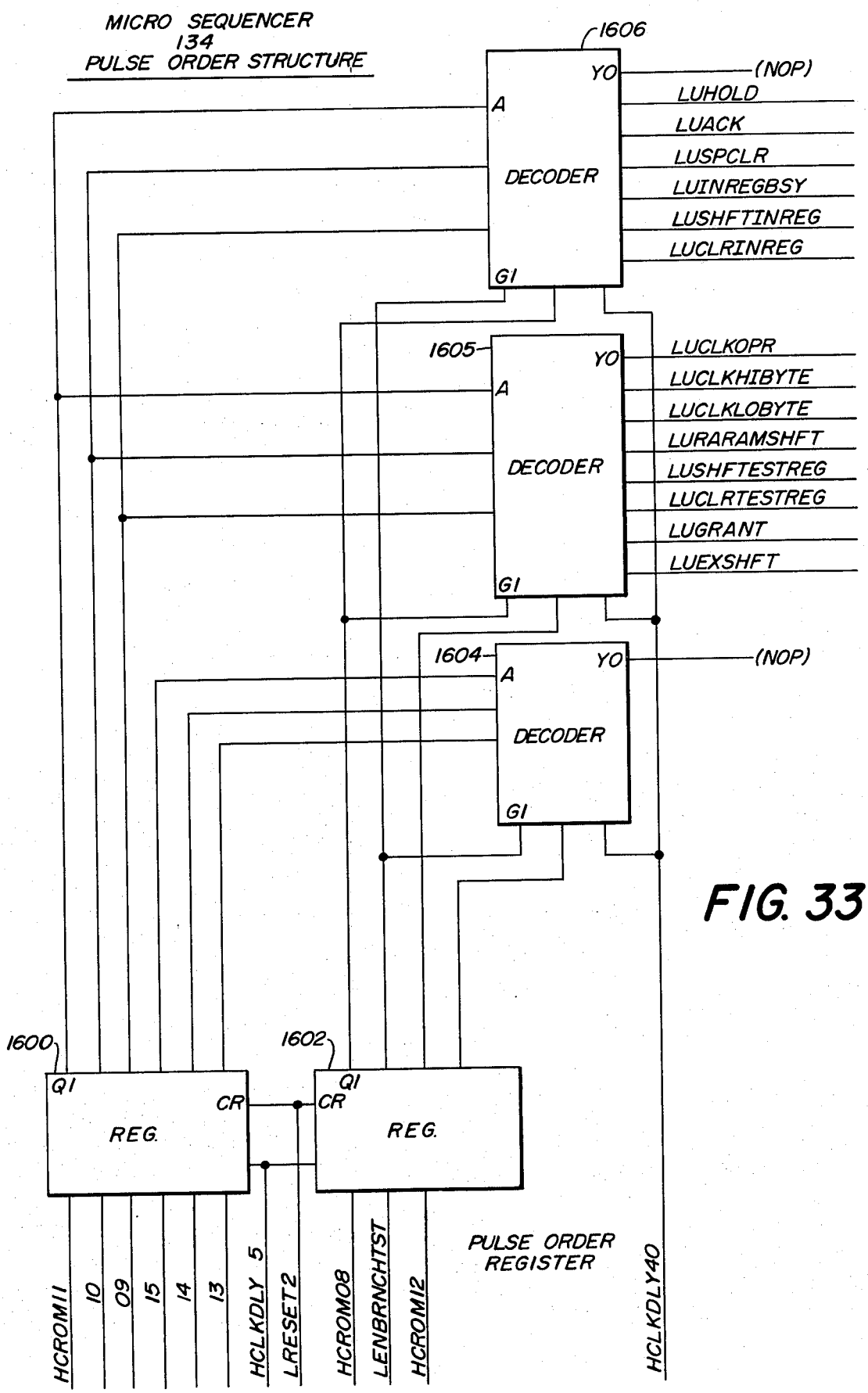

FIG. 33 is part of the pulse order structure of microsequencer 134. If a particular instruction is an order instruction specifying a pulse, one of the decoders 1604–6 produces an output pulse at one of its eight output lines. The outputs of decoder 1604 are defined as pulse group "Y", while the outputs of decoder 1604–6 are defined as pulse group "X". Given an order instruction, one pulse may be applied in "Y" group and one pulse may come out of the 16 lines of the "X" group.

Figure 34:
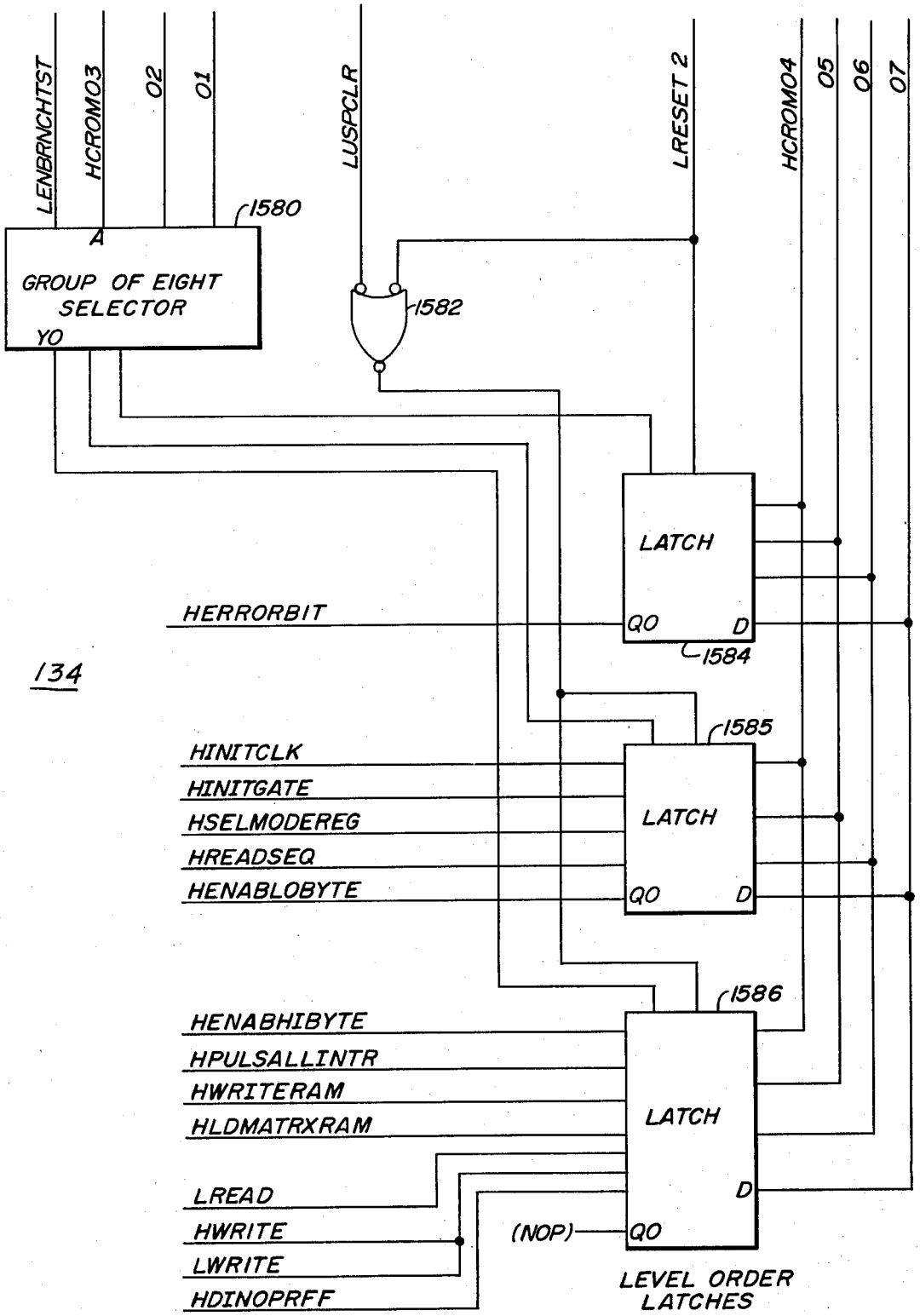

FIG. 34 shows level order structure for microsequencer 134. This structure provides 24 output lines from latches 1584–6. From an order instruction previously described, it is possible to specify which one of the foregoing 24 outputs should access or change. In addition, these latches specify in which way the output should be changed; either in a set state or a cleared state.

5. Resource Allocator 104

There are two modes of operation: the running mode and the loading mode. When resource allocator 104 is in the running mode, 20 MHz clock 1674 drives binary counter 1678, which cycles continuously. When in the loading mode, the output of counter 1678 continuously cycles RAM's 1670–1. The output of these RAM's, which is a function of the particular address input, provides the addressing for the 1 of 72 multiplexers 1654.

One of 72 multiplexers 1654 comprises a group of multiplexers and obtains its inputs from analog computer consoles 12*a–f*. As shown on FIG. 35, these inputs are applied to a bank of eight low-order secondary multiplexers 1650, the outputs of which are applied to a primary multiplexer 1652. Multiplexer 1652 is connected to high/low-order multiplexer 1655, which is also connected to high-order multiplexer 1656. The combination of these multiplexers provides the 1 of 72 multiplexers 1654.

When 1 of 72 multiplexers 1654 has selected its particular input from this addressing data, the output that corresponds to that address will appear at its output. This signal will be clocked into the serial shift register 1690 by way of line LDECIN.

Figures 35, 37:
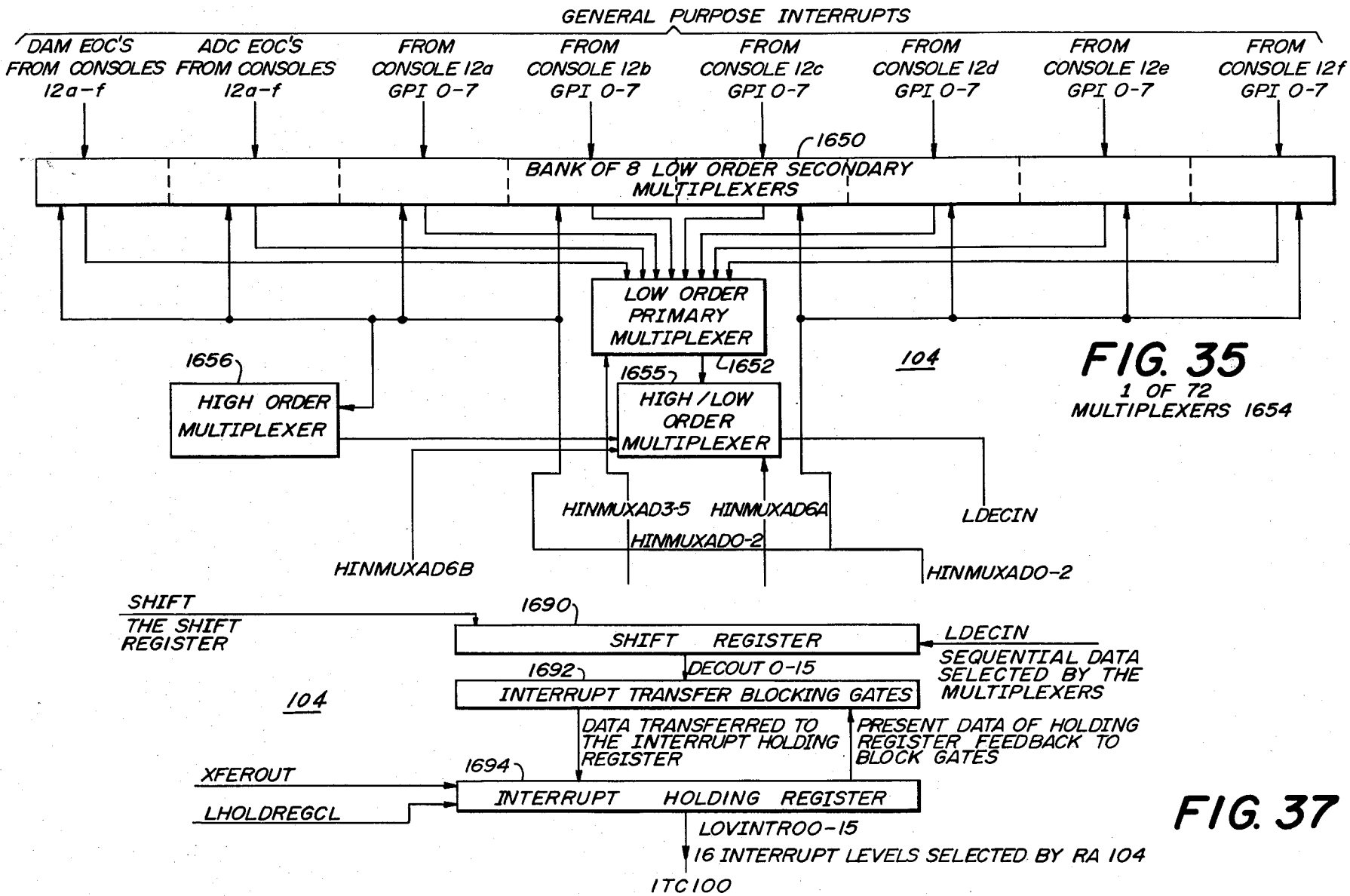

Shift register 1690, FIG. 37, is effective to shift in the data from the multiplexer by way of the output of the same binary counter 1678 that addressed RAM's 1670–1. In this respect, the foregoing is synchronous. It is synchronized with the RAM addressing of the multiplexer. The foregoing continues throughout the entire 15 cycles of binary counter 1678. At the end of this cycle, shift register 1690 will be loaded with 16 data bits derived from 16 different addressings of the 1 of 72 multiplexers 1654. At this point, binary counter 1678 is decoded, so that the particular point in time when shift register 1690 is full is known. Accordingly, at this time, the decoded output creates a pulse which transfers the contents of shift register 1690 through an interrupt transfer blocking gate 1692 into an interrupt holding register 1694.

The purpose of blocking gates 1692 is to correct a problem involved in the resource allocator 104. Specifically, if one of the inputs into multiplexer 1654 was active for a period of time that would allow two cycles of the binary counter 1678, the counter would cycle twice so that this active input would have been looked at twice. Thus, the output to interrupt holding register 1694 would show an active pulse that would be twice as long as it should be. Blocking gates 1692 obtains feedback from holding register 1694. If it determines that one of its output lines is already active, then it will not allow as input the next active data. Due to timing, the divide-by-16 binary counter 1678 addresses RAM's 1670–1 at approximately two data locations ahead of the actual data that is shifting into shift register 1690. Solving this timing problem requires decoding of the output of binary counter 1678, to recognize when the 16-bit shift register 1690 is correctly full.

Figure 36A:
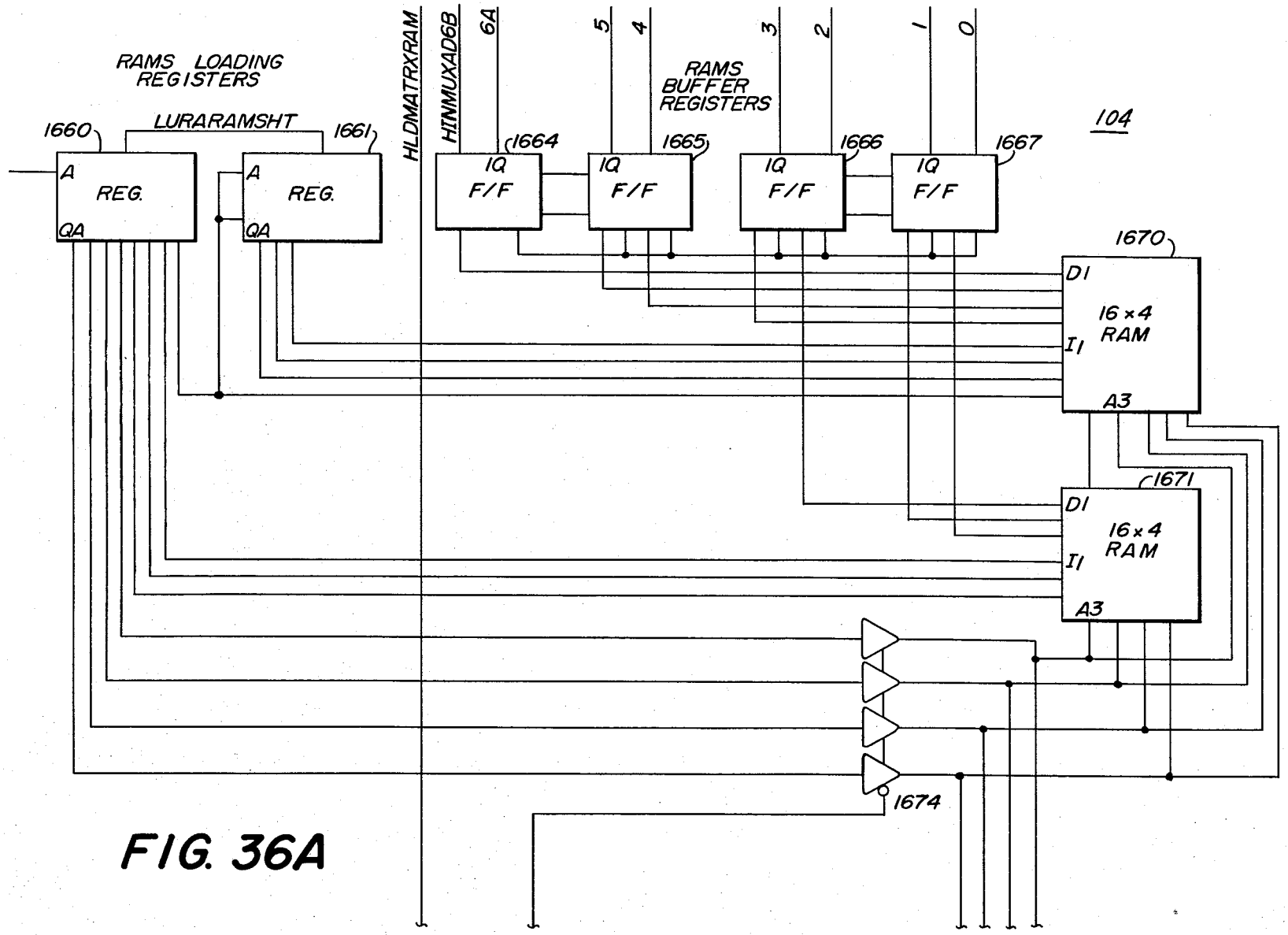
Figure 36B:
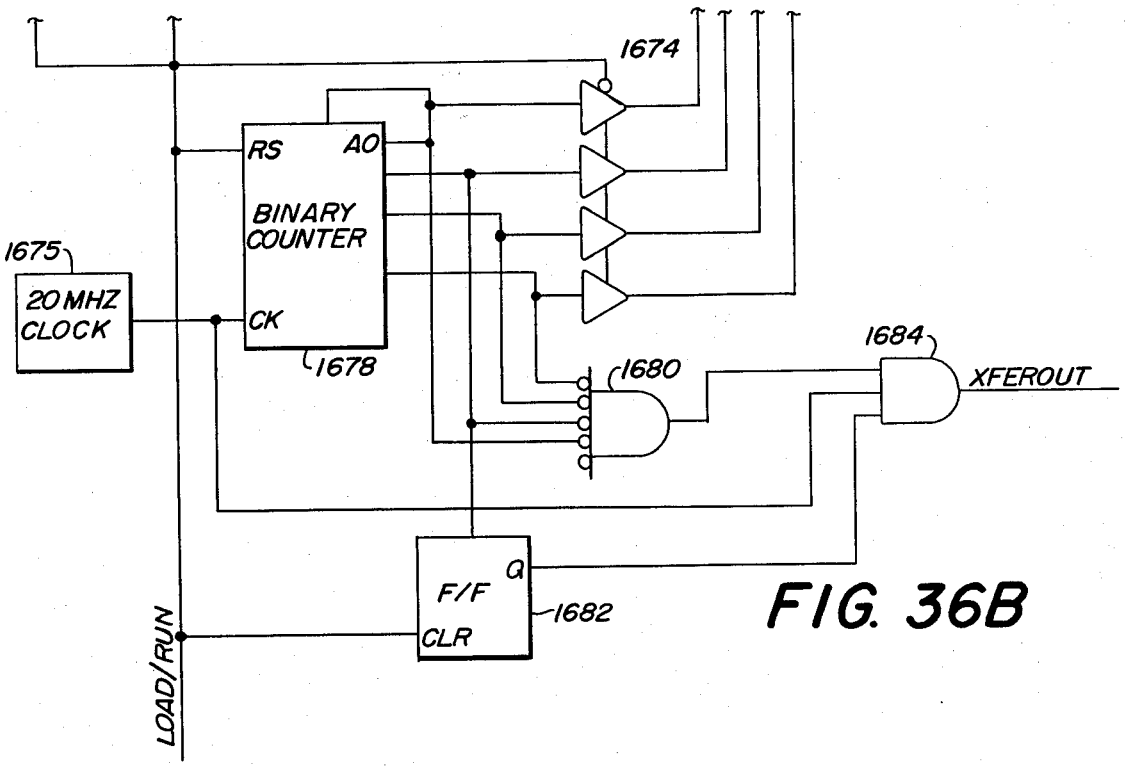

The following is the operation of the loading of RAM's 1670–1 (FIGS. 36A–B). When it is desired to load the RAM's, an active level is brought in on line high load matrix RAM. This is effective to turn off clock 1675, which has been driving binary counter 1678. It also clears this binary counter. This in effect shuts down the cycling of the entire resource allocator 104. This loading active level that turned off the clock also drives tristate gates 1674 to redirect the addressing of RAM's 1670–1 from counter 1678 to the RAM's loading register 1660–1. These registers have been loaded at some previous time independent of the predescribed operation. With registers 1660–1 loaded and ready, the data therein is effective to address locations in the RAM's. Another part of the data in the loading register 1660–1 will actually be loaded into that location in the RAM's. In this manner, a loading of 1 of 16 data locations of the RAM is provided. When the high load matrix RAM line drops back to an inactive level, the clock is again enabled, and binary counter 1678 starts cycling again. Accordingly, resource allocator 104 restarts its operation, as previously described, with new data loaded into the particular location as provided by the RAM floating register 1660–1.

The following table shows the instruction for programming RAM's 1670–1 from CPU 30 together with the codes that select which one of the 72 inputs will be connected to 16 output lines.

TABLE IV

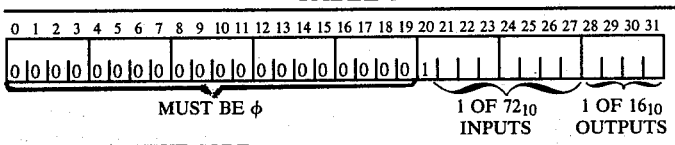

| INPUT CODE 21 | 22 | 23 | 24 | 25 | 26 | 27 | SPECIFIED INPUT | |
|---|---|---|---|---|---|---|---|---|
| 0 | 0 | 0 | 0 | 0 | 0 | 0 | | GPIϕ |
| 0 | 0 | 0 | 0 | 0 | 0 | 1 | | GPI1 |
| 0 | 0 | 0 | 0 | 0 | 1 | 0 | | GPI2 |
| 0 | 0 | 0 | 0 | 0 | 1 | 1 | CONSOLE 12a | GPI3 |
| 0 | 0 | 0 | 0 | 1 | 0 | 0 | | GPI4 |
| 0 | 0 | 0 | 0 | 1 | 0 | 1 | | GPI5 |
| 0 | 0 | 0 | 0 | 1 | 1 | 0 | | GPI6 |
| 0 | 0 | 0 | 0 | 1 | 1 | 1 | | GPI7 |
| 0 | 0 | 0 | 1 | 0 | 0 | 0 | | GPIϕ |
| 0 | 0 | 0 | 1 | 0 | 0 | 1 | | GPI1 |
| 0 | 0 | 0 | 1 | 0 | 1 | 0 | | GPI2 |
| 0 | 0 | 0 | 1 | 0 | 1 | 1 | CONSOLE 12b | GPI3 |
| 0 | 0 | 0 | 1 | 1 | 0 | 0 | | GPI4 |
| 0 | 0 | 0 | 1 | 1 | 0 | 1 | | GPI5 |
| 0 | 0 | 0 | 1 | 1 | 1 | 0 | | GPI6 |
| 0 | 0 | 0 | 1 | 1 | 1 | 1 | | GPI7 |
| 0 | 0 | 1 | 0 | 0 | 0 | 0 | | GPIϕ |
| 0 | 0 | 1 | 0 | 0 | 0 | 1 | | GPI1 |
| 0 | 0 | 1 | 0 | 0 | 1 | 0 | | GPI2 |
| 0 | 0 | 1 | 0 | 0 | 1 | 1 | CONSOLE 12c | GPI3 |
| 0 | 0 | 1 | 0 | 1 | 0 | 0 | | GPI4 |
| 0 | 0 | 1 | 0 | 1 | 0 | 1 | | GPI5 |
| 0 | 0 | 1 | 0 | 1 | 1 | 0 | | GPI6 |
| 0 | 0 | 1 | 0 | 1 | 1 | 1 | | GPI7 |
| 0 | 0 | 1 | 1 | 0 | 0 | 0 | | GPIϕ |

TABLE IV-continued

| | | | | | | | | |
|---|---|---|---|---|---|---|---|---|
| 0 | 0 | 1 | 1 | 0 | 0 | 1 | | GPI1 |
| 0 | 0 | 1 | 1 | 0 | 1 | 0 | | GPI2 |
| 0 | 0 | 1 | 1 | 0 | 1 | 1 | CONSOLE 12d | GPI3 |
| 0 | 0 | 1 | 1 | 1 | 0 | 0 | | GPI4 |
| 0 | 0 | 1 | 1 | 1 | 0 | 1 | | GPI5 |
| 0 | 0 | 1 | 1 | 1 | 1 | 0 | | GPI6 |
| 0 | 0 | 1 | 1 | 1 | 1 | 1 | | GPI7 |
| 0 | 1 | 0 | 0 | 0 | 0 | 0 | | GPIϕ |
| 0 | 1 | 0 | 0 | 0 | 0 | 1 | | GPI1 |
| 0 | 1 | 0 | 0 | 0 | 1 | 0 | | GPI2 |
| 0 | 1 | 0 | 0 | 0 | 1 | 1 | CONSOLE 12e | GPI3 |
| 0 | 1 | 0 | 0 | 1 | 0 | 0 | | GPI4 |
| 0 | 1 | 0 | 0 | 1 | 0 | 1 | | GPI5 |
| 0 | 1 | 0 | 0 | 1 | 1 | 0 | | GPI6 |
| 0 | 1 | 0 | 0 | 1 | 1 | 1 | | GPI7 |
| 0 | 1 | 0 | 1 | 0 | 0 | 0 | | GPIϕ |
| 0 | 1 | 0 | 1 | 0 | 0 | 1 | | GPI1 |
| 0 | 1 | 0 | 1 | 0 | 1 | 0 | | GPI2 |
| 0 | 1 | 0 | 1 | 0 | 1 | 1 | CONSOLE 12f | GPI3 |
| 0 | 1 | 0 | 1 | 1 | 0 | 0 | | GPI4 |
| 0 | 1 | 0 | 1 | 1 | 0 | 1 | | GPI5 |
| 0 | 1 | 0 | 1 | 1 | 1 | 0 | | GPI6 |
| 0 | 1 | 0 | 1 | 1 | 1 | 1 | | GPI7 |
| 0 | 1 | 1 | 0 | 0 | 0 | 0 | ADC EOC ϕ | |
| 0 | 1 | 1 | 0 | 0 | 0 | 1 | ADC EOC 1 | |
| 0 | 1 | 1 | 0 | 0 | 1 | 0 | ADC EOC 2 | |
| 0 | 1 | 1 | 0 | 0 | 1 | 1 | ADC EOC 3 | |
| 0 | 1 | 1 | 0 | 1 | 0 | 0 | ADC EOC 4 | |
| 0 | 1 | 1 | 0 | 1 | 0 | 1 | ADC EOC 5 | |
| 0 | 1 | 1 | 0 | 1 | 1 | 0 | UNSPECIFIED | |
| 0 | 1 | 1 | 0 | 1 | 1 | 1 | UNSPECIFIED | |
| 0 | 1 | 1 | 1 | 0 | 0 | 0 | DAM EOC ϕ | |
| 0 | 1 | 1 | 1 | 0 | 0 | 1 | DAM EOC 1 | |
| 0 | 1 | 1 | 1 | 0 | 1 | 0 | DAM EOC 2 | |
| 0 | 1 | 1 | 1 | 0 | 1 | 1 | DAM EOC 3 | |
| 0 | 1 | 1 | 1 | 1 | 0 | 0 | DAM EOC 4 | |
| 0 | 1 | 1 | 1 | 1 | 0 | 1 | DAM EOC 5 | |
| 0 | 1 | 1 | 1 | 1 | 1 | 0 | UNSPECIFIED | |
| 0 | 1 | 1 | 1 | 1 | 1 | 1 | UNSPECIFIED | |
| 1 | 0 | 0 | 0 | 0 | 0 | 0 | HTIMER ϕ | |
| 1 | 0 | 0 | 0 | 0 | 0 | 1 | HTIMER 1 | |
| 1 | 0 | 0 | 0 | 0 | 1 | 0 | HTIMER 2 | |
| 1 | 0 | 0 | 0 | 0 | 1 | 1 | UNSPECIFIED | |
| 1 | 0 | 0 | 0 | 1 | 0 | 0 | UNSPECIFIED | |
| 1 | 0 | 0 | 0 | 1 | 0 | 1 | UNSPECIFIED | |
| 1 | 0 | 0 | 0 | 1 | 1 | 0 | UNSPECIFIED | |
| 1 | 0 | 0 | 0 | 1 | 1 | 1 | OV'LD | |

| OUTPUT CODE | | | | SPECIFIED OUTPUT |
|---|---|---|---|---|
| 0 | 0 | 0 | 0 | LDVINTRϕϕ |
| 0 | 0 | 0 | 1 | LDVINTRϕ1 |
| 0 | 0 | 1 | 0 | LDVINTRϕ2 |
| 0 | 0 | 1 | 1 | LDVINTRϕ3 |
| 0 | 1 | 0 | 0 | LDVINTRϕ4 |
| 0 | 1 | 0 | 1 | LDVINTRϕ5 |
| 0 | 1 | 1 | 0 | LDVINTRϕ6 |
| 0 | 1 | 1 | 1 | LDVINTRϕ7 |
| 1 | 0 | 0 | 0 | LDVINTRϕ8 |
| 1 | 0 | 0 | 1 | LDVINTRϕ9 |
| 1 | 0 | 1 | 0 | LDVINTR1ϕ |
| 1 | 0 | 1 | 1 | LDVINTR11 |
| 1 | 1 | 0 | 0 | LDVINTR12 |
| 1 | 1 | 0 | 1 | LDVINTR13 |
| 1 | 1 | 1 | 0 | LDVINTR14 |
| 1 | 1 | 1 | 1 | LDVINTR15 |

B. BBI 21

1. Physical Address Recognition and Generator 372

Figure 41:
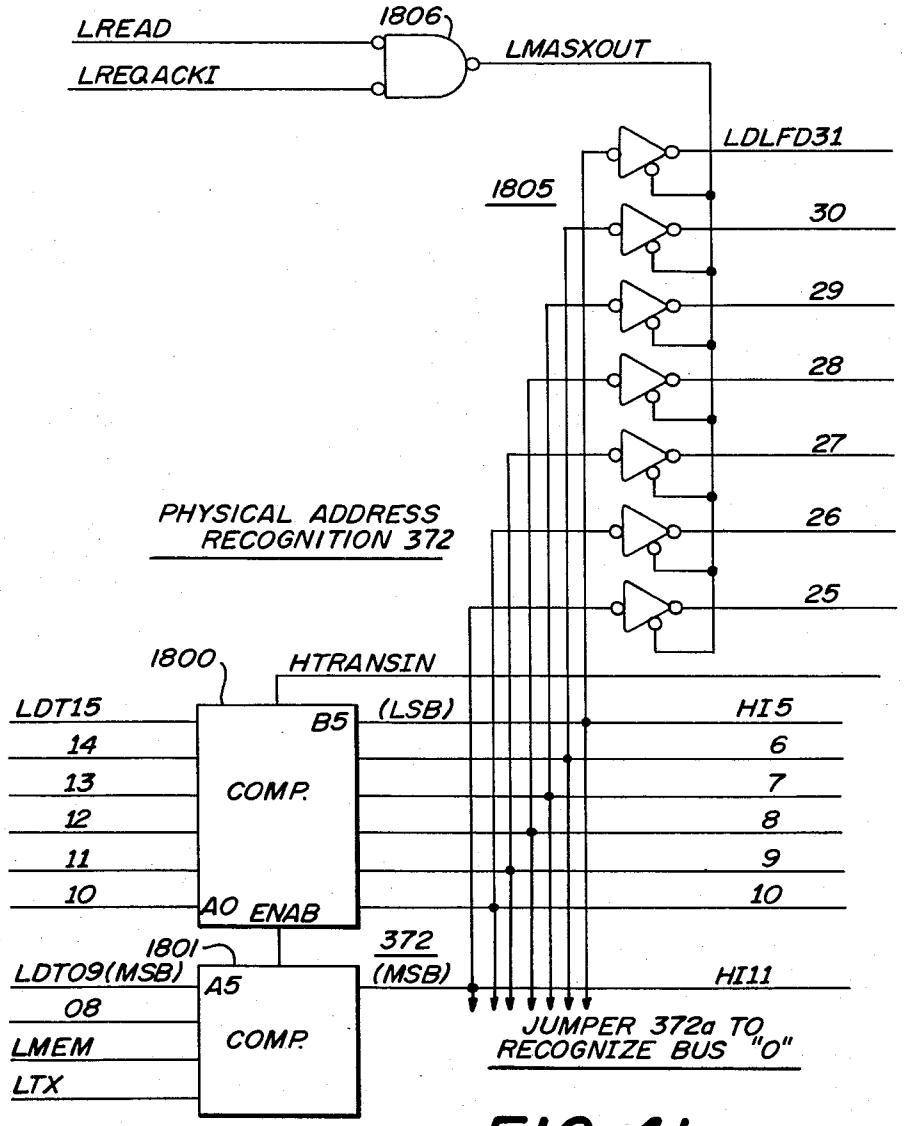

Jumpers 372*a*, FIG. 41, are set up by the user to reflect a unique address of BBI 21. Comparators 1800–1 are effective to compare the jumper configuration with the address bits coming from CPU bus 34. When a comparison shows that the address on bus 34 is the same as the address on jumper 372*a*, a signal called HIGH TRANS IN is generated. This signal is the first indication that BBI 21 has some kind of bus transfer existing.

Tri-state gates 1805 take the configuration of jumper 372*a* and drive it back into bus 34 during memory read transfer, as compared with memory write transfer. When BBI 21 is requesting data from memory 32, the BBI has to supply the memory with a physical address so that at some later time memory 32 may come back and readdress the BBI and send the data back. This is the generation part of the circuit. A further portion of the circuit is a memory-busy having an S151 device (not shown) that determines which memory module has accessed last. The assumption is that there will be the same module access the next time to select an inhibit line from the memory module that allows monitoring of the busy state of the memory. The next time memory is accessed, the memory inhibit line is checked, and if the memory is inhibited, there is a delay in the request to memory until the line becomes noninhibited when the memory is not busy. This memory-busy 396 may be the busy circuit of the IOM card of System Engineering Laboratories, SEL Publication 325-32-9000-000.

2. Response to CPU System 392

There are three responses that BBI 21 can return to CPU 30 or to the device originating the transfer to BBI 21. The BBI may not be busy, in which case a transfer may be accepted and, in so doing, data on bus 34 would be captured. Accordingly, a signal is then returned called "transfer acknowledge" which indicates that BBI 21 has accepted the transfer from bus 34. BBI 21 may be temporarily busy, in which case an indication is sent back to the originator of the transfer by means of a signal called "retry". The retry signal informs the transmitting system that the BBI is going to be busy for at least a short while and that the transmitting system should come back and try the transfer again shortly. A third response is that BBI is going to be busy for an extended period of time and the transmitting system should cease transmitting and not retransmit for an extended period of time. In that case, BBI 21 would send back a signal called "channel busy". The foregoing is accomplished by circuit 392, FIG. 38.

Only in the case of the acceptance of a transfer does circuit 392 generate a required signal to clock into input register 1712 that data is out on bus 34. Also, at this time, a signal would be generated called "CPU data here," which tells miscrosequencer 340 that this input transfer in the input register has begun to process the instruction. There are three responses: transfer acknowledge, retry and channel-busy, which are required to be sent out one clock time after the attempt to transfer. Register 1712 is a type of circuit that delays the signals one clock time.

Input transfers come from two sources. Unsolicited transfers come from CPU 30 by way of the bus 34. The other type of transfer is a response from the memory-busy controller when BBI 21 has asked the controller to read some information from memory 32 and return it. This circuit also recognizes the memory transfer in type of transfer.

3. Tag Register and Decode 388 and Tag Output Encode 390

Figure 38:
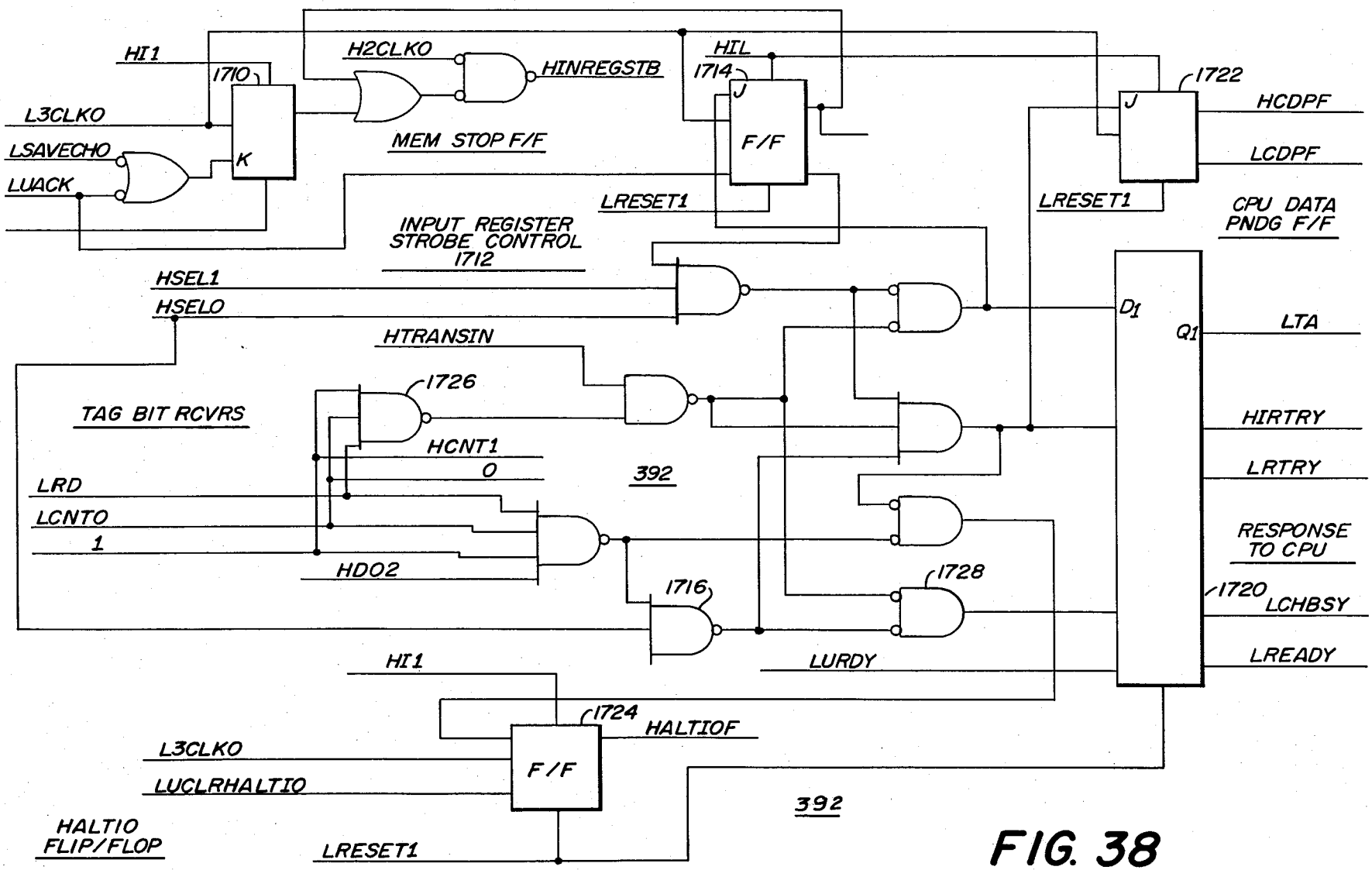

The tag bits are SEL terminology for a set of bus lines that are used and are active during bus transfers. When BBI 21 receives a bus input transfer, it decodes the tag bit line to determine what type of transfer it is. When BBI 21 has to make a memory transfer, it generates the tag bits so that other circuitry can determine what type of transfer is being made. Accordingly, register 388 constitutes an S138 decoder. Encoder 390 comprises a series of OR gates to provide the encoding. The tag bit receivers 386 are shown in FIG. 38.

4. Memory Access Sequencer (MAS) 341

As previously described, BBI 21 is used as a foundation or building block for PAM 20 and for DCM 25 as used in System 10. These controllers 14 support direct memory access, which means that a controller on its own can initiate memory read and memory write transfers. MAS 341 is the means by which BBI 21 accomplishes these memory transfers.

Figure 40:
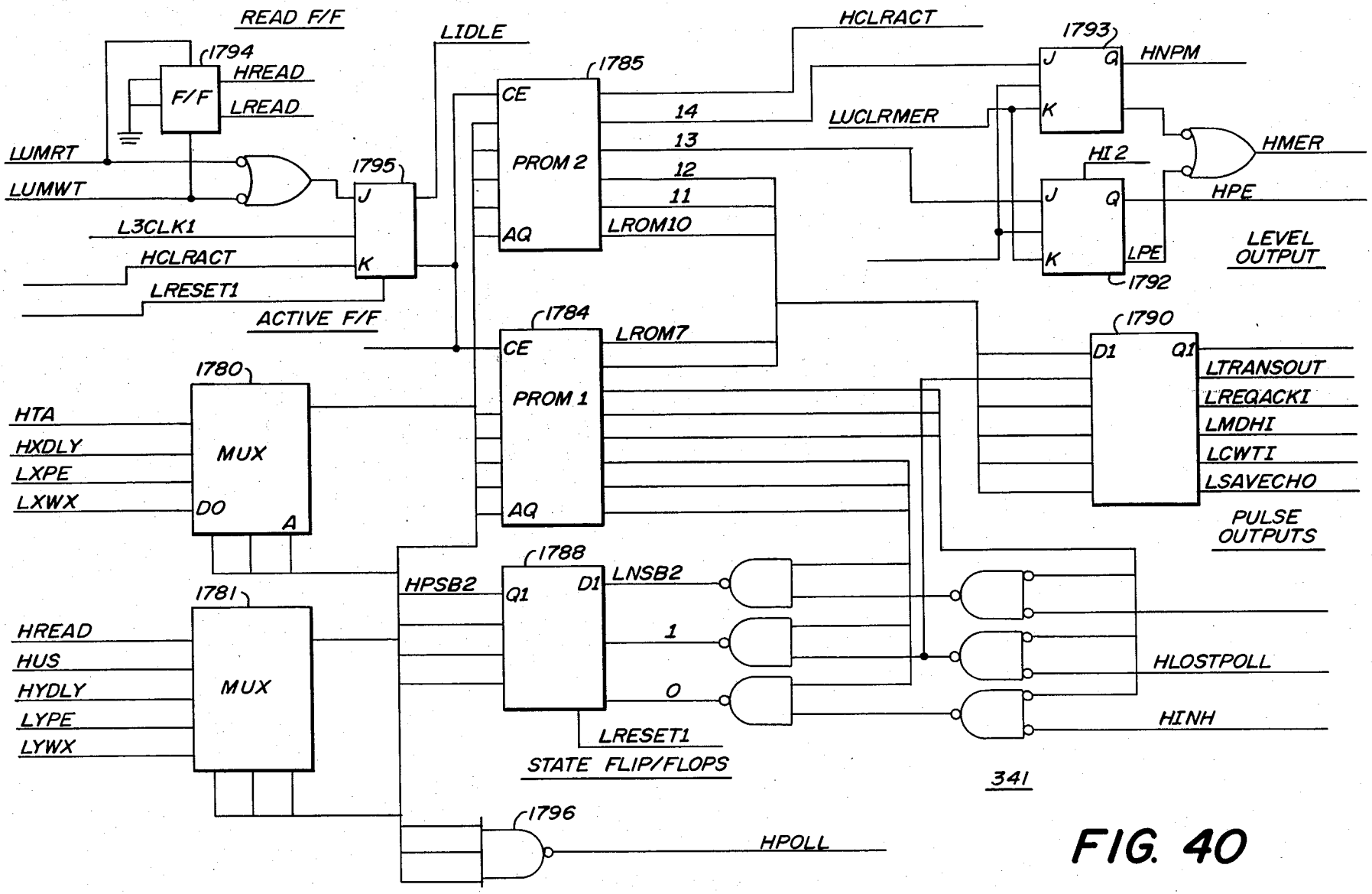

The heart of MAS 341 is PROM's 1784–5 (FIG. 40) similar to microsequencer 340 except that the circuitry is simpler. As previously described, the DDL logic signals BBI 21 that it would like to read something to memory or read something from memory. Microsequencer 340 recognizes this signal and acknowledges back to the DDL that it has accepted the request. Microsequencer 340, which is identical to the ITC microsequencer 134, signals to MAS 341 to start its operation by sequencing through a series of five states if it is a memory write transfer, and seven states if it is a memory read transfer. As MAS 341 sequences through the various states, the associated control lines are activated to accomplish the memory transfer out to bus 34.

Two signals called LUMRT and LUMWT are coupled to flip-flop 1795. The MRT signal is the pulse that would come in from microsequencer 340, commanding MAS 341 to start a memory read transfer. The other signal would be generated by microsequencer 340 if this was a memory write transfer. Either one of these signals sets one of the flip-flops 1794–5 that enables PROM memory 1784–5. The outputs of PROM 1784–5 are dedicated to setting or resetting level signals that are command signals to accomplish the bus interfacing for the transfer. Other output lines are dedicated to forming the next address for the firmware within the PROM's. The next address is fed back through the state flip-flops 788 and then becomes part of the next address at the input of PROM 1784–5. Two of the next address bits of the PROM are coming through a multiplexer 1780–1. Depending on the current state of flip-flop 1788, it selects various inputs to pass. At any instant, flip-flop 1788 would be in a given state, and the next state it would go to is dependent upon the state it is in as well as the next state of information being transmitted by multiplexer 1780.

Flip-flops 1792–3, as well as register 1790, comprise the circuitry that is set or reset by the control output of PROM's 1784–5. This circuitry generates action signals to bus 34 to gate the bus at the proper time after memory transfer.

Figure 39:
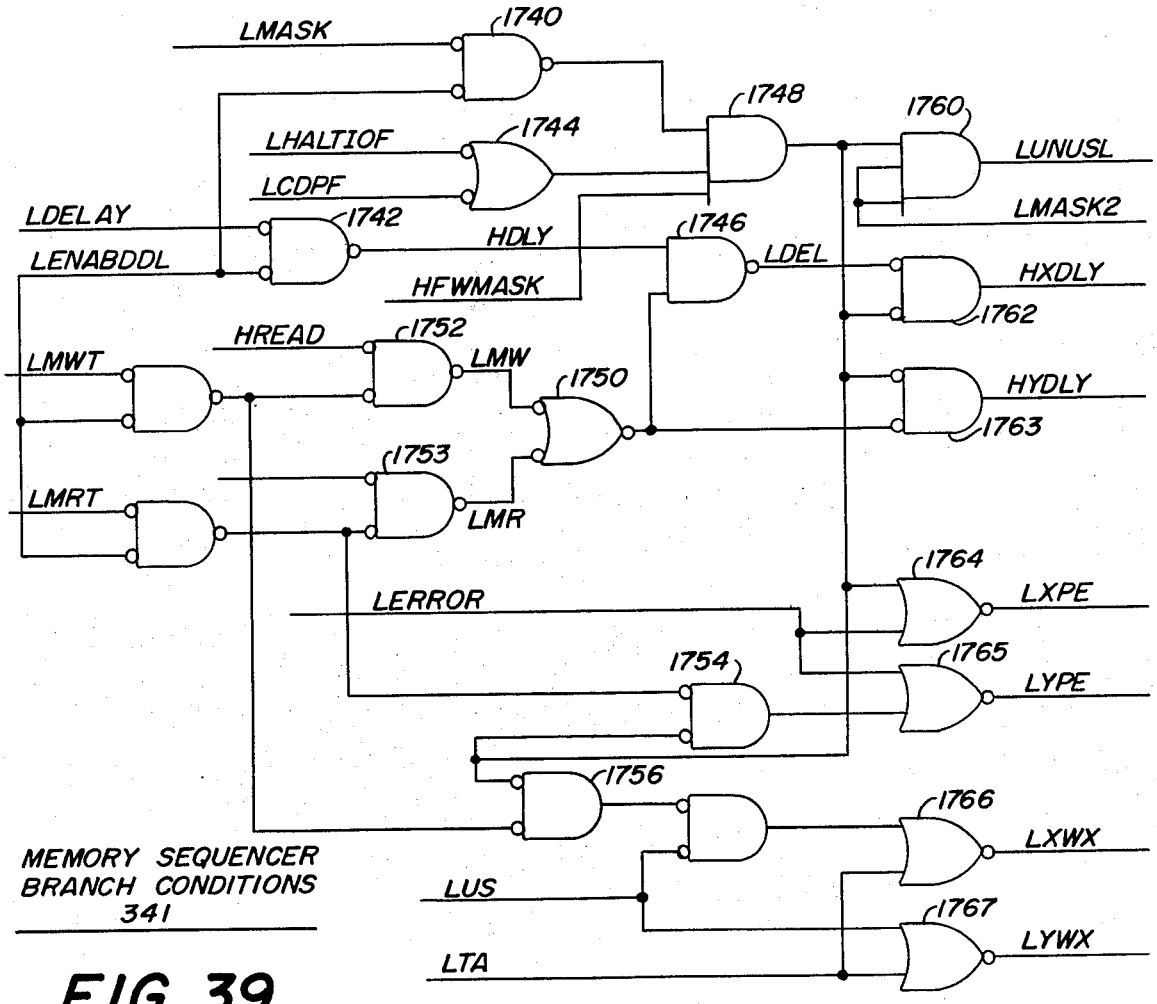
FIGS. 38–42 illustrate in more detail and in block diagram form specific circuits of the BBI section of FIGS. 10A–C.

Further, MAS 341 has gating FIG. 39 (including gates 1740, 1742, 1746, etc.) that aids in forming a branch signal identity throughout BBI 21. The signals produced by these gates are applied to a multiplexer 1780–1 which provides the next state information.

5. Last Accept Register and Last Retry Register 376, 378

Subaddressing allows devices in BBI 21 to be accessed. When an input transfer arrives, it always contains subaddressing information. The four bits of the subaddressing information point to which one of the subcontrollers is coupled to BBI 21. The last acceptance of the transfer register 376 holds the subaddress of the last bus transfer that has been accepted by BBI 21. On the other hand, the last retry subaddress register 378 holds the subaddress of the last transfer that was rejected, either with a retry or channel-busy signal, by BBI 21.

Interrupt level save register 374 receives transfers of seven bits of information which represent the system interrupt level assigned to BBI 21. Register 374 holds this information.

6. Service Interrupt Poll 380 and Bus Poll 394

These circuits are shown in detail in the SEL IOM system previously identified. Within SEL 3200 series digital computer there are 128 different interrupt levels identified by a seven-bit counter. Assigning any one of the interrupt levels depends upon the contents of an interrupt level save register. If BBI 21 is required to generate an interrupt request on this level, microsequencer 340 asserts various signals that come into poll 380 and generates the appropriate signals onto SEL bus 34 to accomplish the interrupt request. Thus, poll 380 makes the interrupt request and performs the interrupt poll.

Before BBI 21 can make a bus transfer, bus poll 394 determines whether or not any other controller 14 of a higher priority also wishes to make that transfer. If this is not the case, BBI 21 waits until the device for the higher priority has completed the transfer, and BBI 21 then goes out and makes the transfer.

7. In Register 356 and Address Register and Counter 362

System bus 34 is made up of two major buses, one of which is a 32-bit data bus and the other a 24-bit destination bus. The data bus is bidirectional. In register 356 captures the information and holds it locked in the register for the length of the time needed to process the information. Most of the time, register 356 is continually clocking in or "snapshotting" the information from the data bus every system clock cycle. Only when it is determined that the information is actually needed on the bus is the information in register 356 frozen. A bus transfer is made in a period of 140 nanoseconds, at which time there is an enabling signal called LANYX-OUT that turns a driver on for the 150-nanosecond time period.

Address register and counter 362 is coupled to the destination bus of bus 34; the information on that bus is usually a memory address. The address counter of counter chips later defined provides a parallel loading to take an address from the destination bus and load it and then redrive it back onto the bus. A transfer would come from CPU 30 as an address and indicate that there is information in memory 32, for example, that should be read out. The address given is the memory address information. BBI 21 then assembles a memory read transfer. One of the pieces of information that must be supplied in a memory read transfer is the address in memory of the data to be accessed. That address is now located in address register 362. After accessing that location, memory 32 sends back the data.

8. Status Block 346

Figure 42:
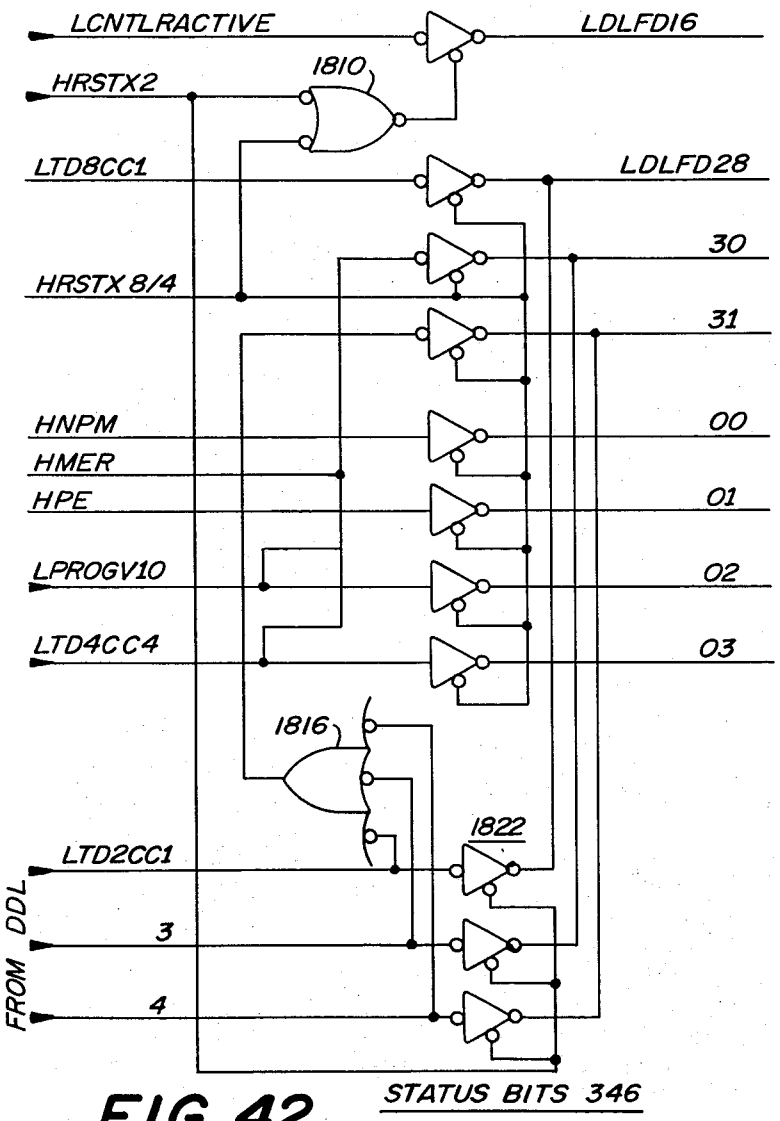

As previously described, tag bits have been used to define different types of bus 34 transfers that come to BBI 21. Three types of status transfers are used by CPU 30 to obtain information from BBI 21, such as whether it is busy, etc. During these transfers, BBI 21 gates the various status bits, as shown on FIG. 42, back to CPU 30. There are 12 status bits dedicated to predetermined functions. The majority of these functions are left open for defining the type of information represented by these bits for a particular application.

C. DCM 25

1. Run Control 816

Figure 43:
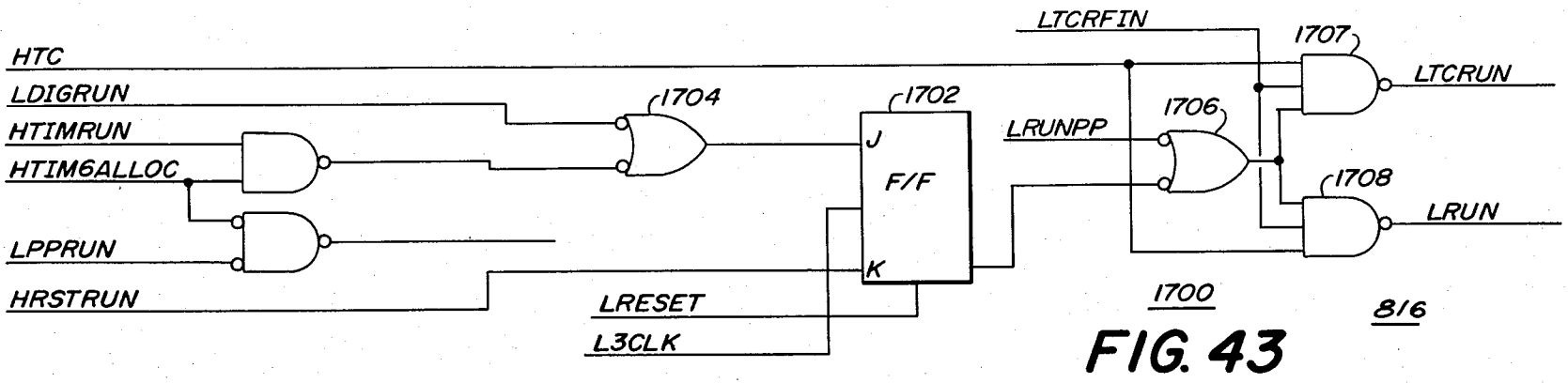
FIGS. 43–46 illustrate in more detail and in block diagram form specific circuits of the DCM section of FIGS. 16A–B, 17A–B and 18A–B.

FIG. 43 shows one of six identical circuits that comprise run control 816. All of the run control circuits are identical, and therefore only one of them need be described. A run request LTCRUN or LRUN may be activated in three different ways. A command labeled LDIGRUN may come from computer 30, a signal may be provided from an external timer designated HTIM-RUN or there may be a patch panel request LPPRUN. Any one of these signals sets a flip-flop 1702 which, through a series of gates 1706–8, provides a signal LTCRUN if it has been previously selected as time-critical, or LRUN if it is non-time-critical.

The six LRUN signals are applied to monkey round robin circuit 832. The six timer-critical circuits LTCRUN are applied to the gorilla round robin 830.

2. Gorilla Round Robin 830

Gorilla round robin 830 (FIG. 44) is identical to monkey round robin 832 with the exception that if a gorilla is active, then a signal feeds into round robin 832 from circuit 830, preventing any monkeys from become active. Accordingly, only circuit 830, in which six inputs are identified as LTCRUN 1–6, will be described in detail. These inputs are applied to PROM 1710, which selects which gorilla is to be the next one acted upon. Assuming that gorilla 4 is presently active, and if there are simultaneous run requests from all of the remaining LTCRUN 1–6, for example, then the next active gorilla will be No. 5, etc. The remainder of circuit 830 is employed in synchronizing and storage of the signals. The lines defining the presently active gorilla are labeled HACTIVEGORILLA 4, 2, 1, and the lines defining the next active gorilla are HNEXTGOR 4, 2, 1. The lines to flip-flop 1716 are used to inhibit a monkey from becoming active while a gorilla is active. The firmware program for PROM 1710 is described later in detail, and this program is also used for the PROM for the monkey round robin 832.

3. Active Pending Register 786

Figure 45:
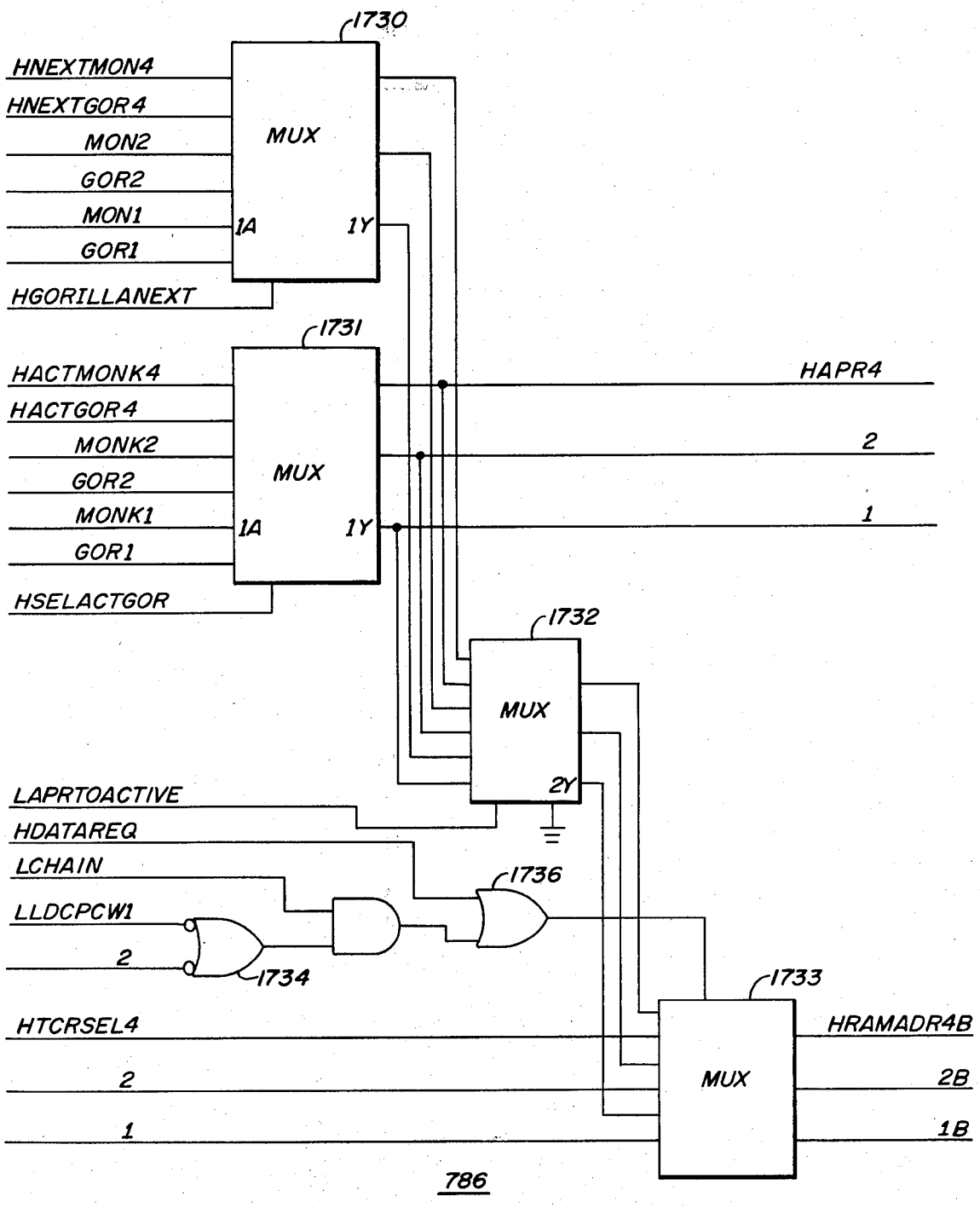

The six addresses of active pending register 786 may come from one of five sources, viz, HNEXTMON, HACTMONK, HNEXTGOR, HACTGOR and HTCRSEL. These addresses enable the ADC/DCM 22 to address a particular transfer control register in the active pending RAM 750. Accordingly, the output of APR 786 is an HRAM address which provides three addressing lines to active pending RAM 750. The foregoing five address sources are applied to multiplexers 1730–2 (FIG. 45) to provide inputs to multiplexer 1733.

4. Active Register 794

Figure 46:
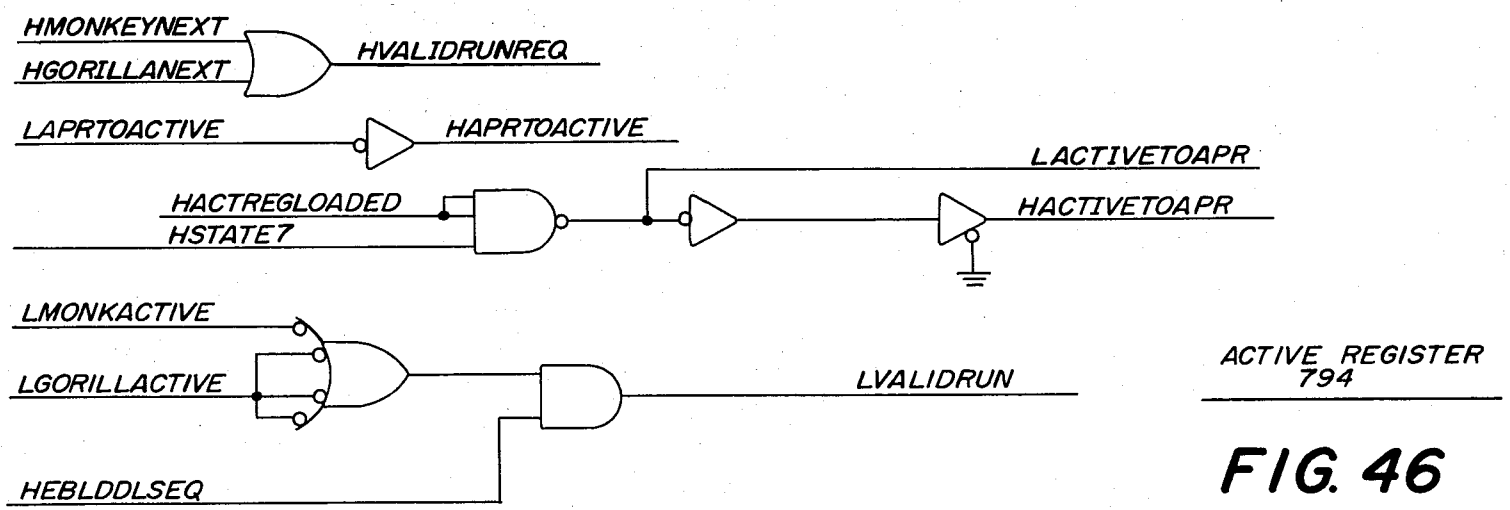

The gates show details of active register 794 (FIG. 46). There are two output signals: HAPRTOACTIVE, which moves the active pending register to the active register, and HACTIVETOAPR, which moves the active register back to the active pending RAM 750.

It will be understood that interface circuits of analog computers 12*a–f*, including ADC and DAM driver circuits such as those in Pacer 100 of Electronic Associates, Inc., are coupled to the float, jam, halt, lines of APR 751. Activate-deactivate gorilla and monkey circuit 817 selects one of six outputs, while TCR loaded flops 814 indicate which TCR is active and when it goes inactive.

D. PAM 20

1. Echo or Wait for Read Block 1108

Figure 47:
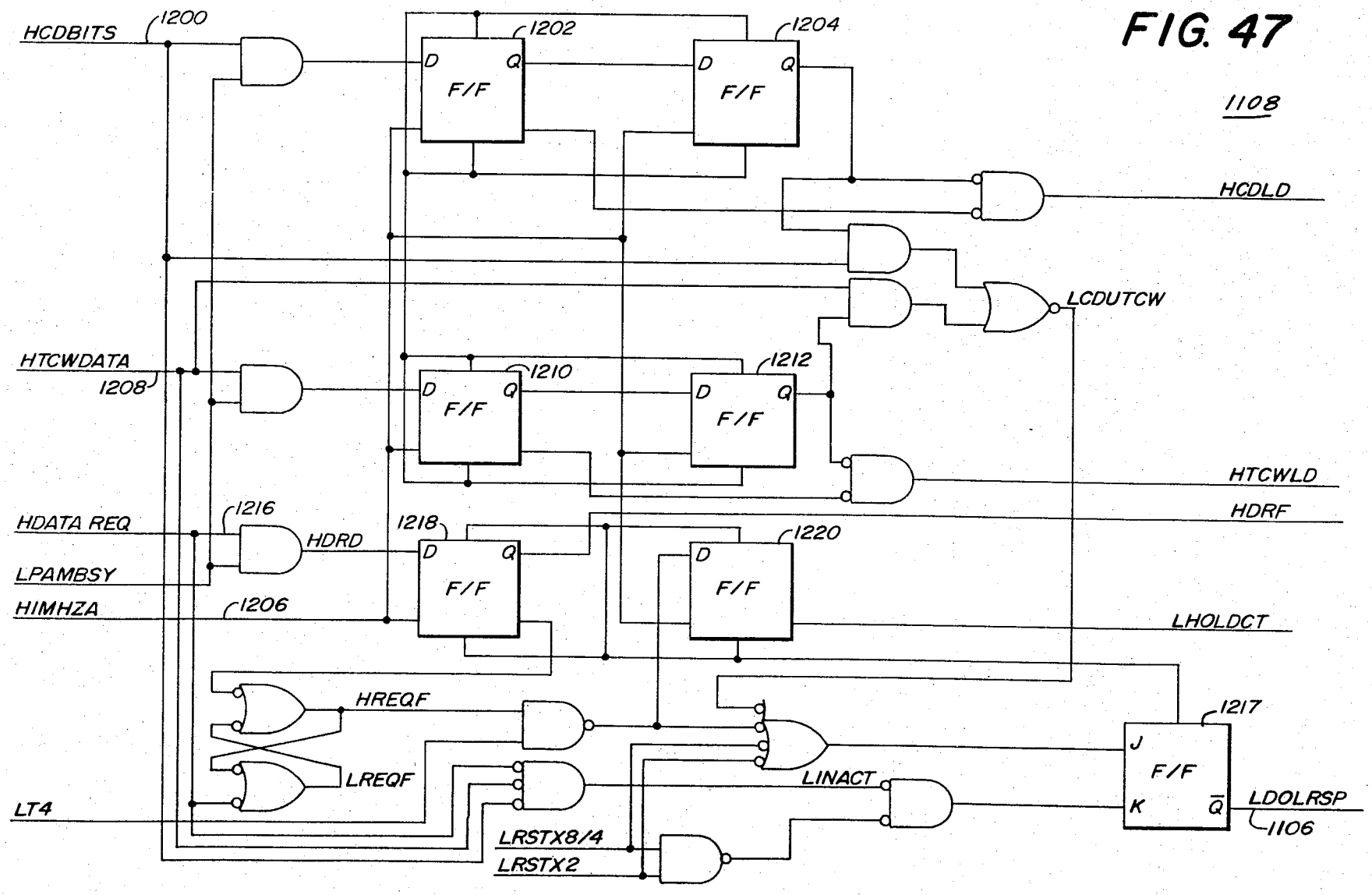
FIGS. 47–48A–B illustrate in more detail and in block diagram form specific circuits of the PAM section of FIGS. 25A–B.

A CD bits signal on line 1200 is applied from BBI 21 to a flip-flop 1202 (FIG. 47). The flip-flop clocks the signal with a 1 MHz clock, used by the analog consoles 12*a–f* by way of line 1206. The resultant signal is clocked into a second flip-flop 1204, and in the time between the first and second flip-flop a strobe is generated to load the data from the CD word.

At the trailing edge of this period, a signal is sent back to BBI 21 indicating to the BBI that PAM 20 has acknowledged the command and that it has been stored. The same operation is accomplished with respect to TCW data line 1208. That line is coupled through flip-flops 1210 and 1212 to generate a 1-microsecond period for a strobe to load the data and, at the trailing edge, to generate a DDLRSP on line 1106.

Data request line 1216 is also coupled through flip-flops 1218 and 1220. When the controlled timing counter gets beyond state 4 and data request is high, there is a response with a DDLRSP on line 1106. Accordingly, the signals coming from BBI 21 are CD bits, TCW data and data request. These signals all require a DDLRSP to unlock the communications and allow BBI 21 to go on and capture another signal. In this manner, the DDLRSP is effectively an echo of the command coming from the BBI in which there is a two-microsecond wait to send it back.

2. Control Timing 1118

Figure 48A:
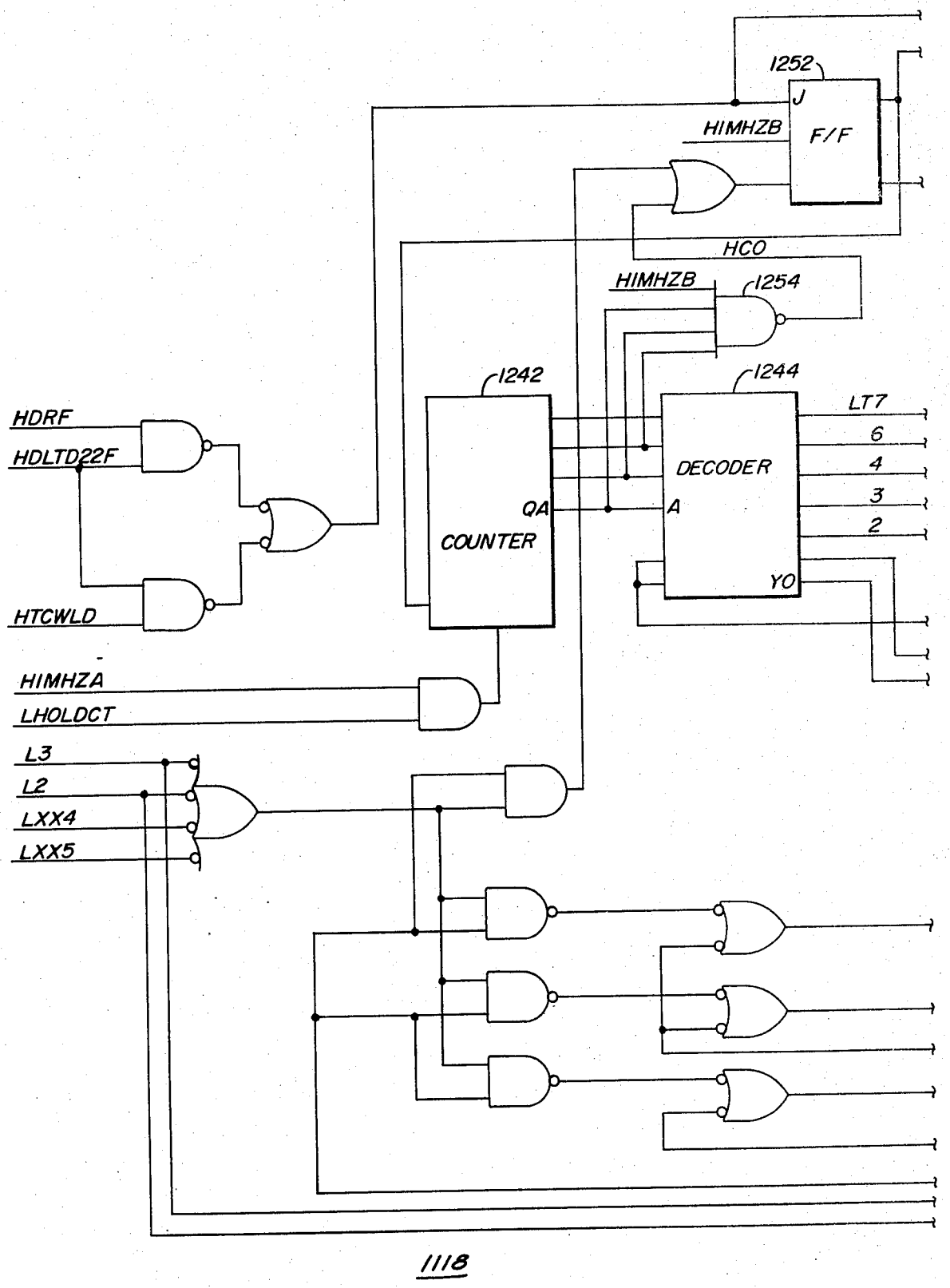
Figure 48B:
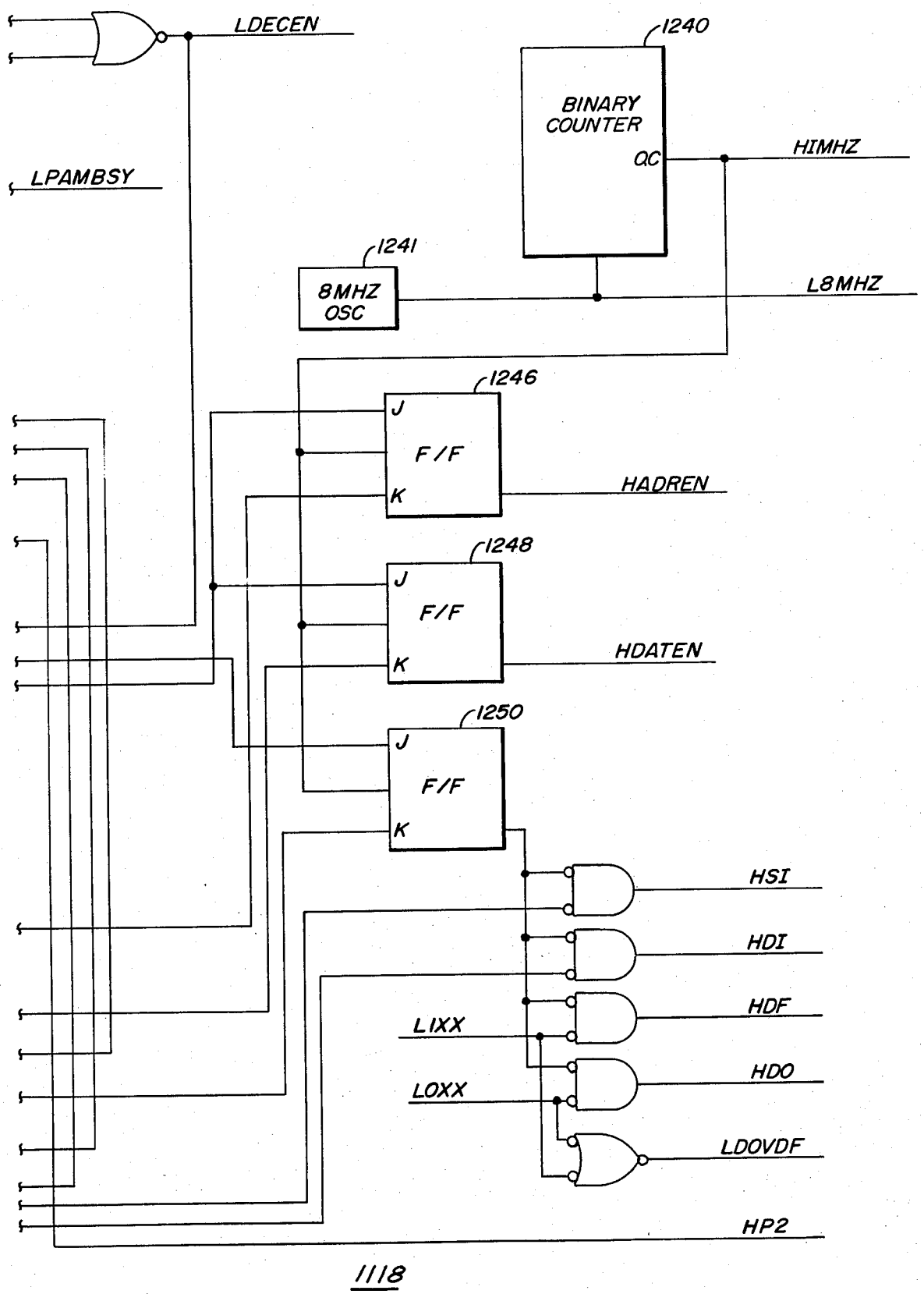

An oscillator 1241 (FIG. 48A,B) provides an 8 MHz signal to a binary counter 1240, which divides the signal down to 1 MHz. It will be understood that the 8 MHz signal is used throughout PAM 20 to clock the flip-flops. The control timing circuitry is initiated by either a read or a write command coming from BBI 21.

Initially, a control counter 1242 is first cleared, and this counter feeds a 3 to 8 line decoder 1244, which divides the output of counter 1242 into eight timing steps, viz, LT0–LT7. These timing steps are used to enable the setting of a group of flip-flops 1246, 1248 and 1250. Flip-flop 1246 is used for address enable, flip-flop 1248 is used for data enable, and flip-flop 1250 is used for strobe enable. Additionally, there is a busy flip-flop 1252, to indicate when the control timer is activated. Flip-flop 1252 is set by a read or write command and reset by either state 4 or state D of control counter 1242.

Further, gate 1254 is effective to AND the 1 MHz signal with a signal hold count. The signal hold count is activated for read from an analog computer, since it requires more time to get the data back from the analog computer than to just transfer it in one direction. The address enable flip-flop 1246, data enable 1248, and strobe enable 1250 provide outputs to the PAM 20 to activate by way of lines 1120, 1122 and 1126 the output buffers (FIGS. 25A,B) in the proper timing sequence. This strobe is inside both the data and the address. At the completion of an instruction, counter 1242 is again cleared and held in a zero state waiting for the next instruction.

VII. TABLE OF COMPONENTS

| | | |
|---|---|---|
| digital system 18 | 3200 Series computer | System Engineering Laboratories |
| 12a-f | Models 681, 781 and 2000 | Electronic Associates, Inc. |
| 52 | GMAD 2 (40.858–0) (EAI) | Preston Scientific, Inc. |
| 54 | 40.810, 40.811 | Electronic Associates, Inc. |
| 108 | RTOM, Drawing 130-103079 3200 Series | System Engineering Laboratories |

| Reference Character | Device No. | Reference Character | Device No. |
|---|---|---|---|
| 117 | 74S175 | 768 | 74S163 (5X) |
| 136 | 74S194 (7X) | 770 | 74S163 (4X) |
| 142 | 74LS175 (4X) 74S174 (2X) | 772 | 74S163 (2X) |
| | | 774, 838, 844 | 74LS175 |
| 356 | 74S174 (6X) | | |
| | | 776 | 74S189 (5X) |

-continued

| Reference Character | Device No. | Reference Character | Device No. |
|---|---|---|---|
| 362 | S169 (6X) | | |
| | | 778 | 8T98 (12X) |
| 370, 381 | S163 | | |
| | | 780 | LS85 (2X) |
| 374 | 74S174 (2X) | | |
| | | 791 | 74LS157 |
| 376, 378 | S174 (2X) | | |
| | | 814, 850, 852 | 74259 |
| 388 | S138 | | |
| | | 817 | 74LS138 (3X) |
| 751, 754, 756, 758, 767 | 74S189 (2X) | 819 | 74LS10 |
| 752 | 74S189 (4X) | 842, 846, 856, 858, 864, 866, | |
| 760, 775 | 74S157 (5X) | 870 | LS112 |
| 762 | 74S157 (4X) | 854 | LS112 (3X) |
| 764, 765 | 74S157 (2X) | 862 | 74LS123 |

| Reference Character | Device No. | Reference Character | Device No. |
|---|---|---|---|
| 868 | LS175 | 1430 | 74191 |
| 1110, 1126 | 74S139 | 1440, 1490, 1492, 1493, 1494, 1495 | 74S174 |
| 1112 | 74S175 (3X) | | |
| | | 1461–1465 | 74S138 (13X) |
| 1114, 1144 | 74S175 (2X) | | |
| | | 1470 | 74S85 |
| 1116 | 74S175 (4X) | | |
| | | 1473, 1584, 1585, 1586 | 74259/9334 |
| 1127 | 9318 | | |
| 1130 | 74123 (12X) | 1496, 1497, 1664, 1665, 1666, 1667 | 74S74 |
| 1132, 1133 | 74LS74 (6X) | | |
| | | 1570 | IM5624 (4X) |
| 1138 | 74LS253 (8X) | | |
| | | 1571 | 74S163 (3X) |
| 1140 | 74S251 (4X) | | |
| | | 1590, 1591, 1592, 1593 | 74S151 |
| 1143 | 1898 (3X) | | |
| 1202, 1204, 1210, 1212, 1218, 1220 | LS74 | 1600 | 74S174 |
| | | 1602 | 74S175 |
| 1240, 1242 | 74S163 | | |
| | | 1650 | 74S151 (8X) |
| 1244, 1472, 1604, 1605, 1606, 1580 1246, 1248, 1250, | 74S138 | 1652, 1656 1655 | 74S151 74S00 (3X) |
| 1252 | 74LS112 | | |
| | | 1660, 1661 | 74164 |

| Reference Character | Device No. | Reference Character | Device No. |
|---|---|---|---|
| 1670, 1671 | 74S189 | 1730, 1731, 1732, 1733 | S157 |
| 1678 | 82S91 | | |
| | | 1780, 1781 | S151 |
| 1682 | 74S74 | | |
| | | 1784, 1785 | IM5600 |
| 1690 | 82S71 (4X) | | |
| | | 1788 | S175 |
| 1712, 1720 | 74LS174 | | |
| | | 1790 | S174 |
| 1710 | IM5624 | | |
| | | 1800, 1801 | 93S46 |
| 1714 | LS175 | | |
| | | 1692 | 74S02 (16X) |
| 1716 | LS112 | | |

-continued

| Reference Character | Device No. | Reference Character | Device No. |
|---|---|---|---|
| | | 1694 | 74S175 (4X) |

VIII. LISTING OF THE FIRMWARE FOR GORILLA ROUND ROBIN 830

Figure 44:
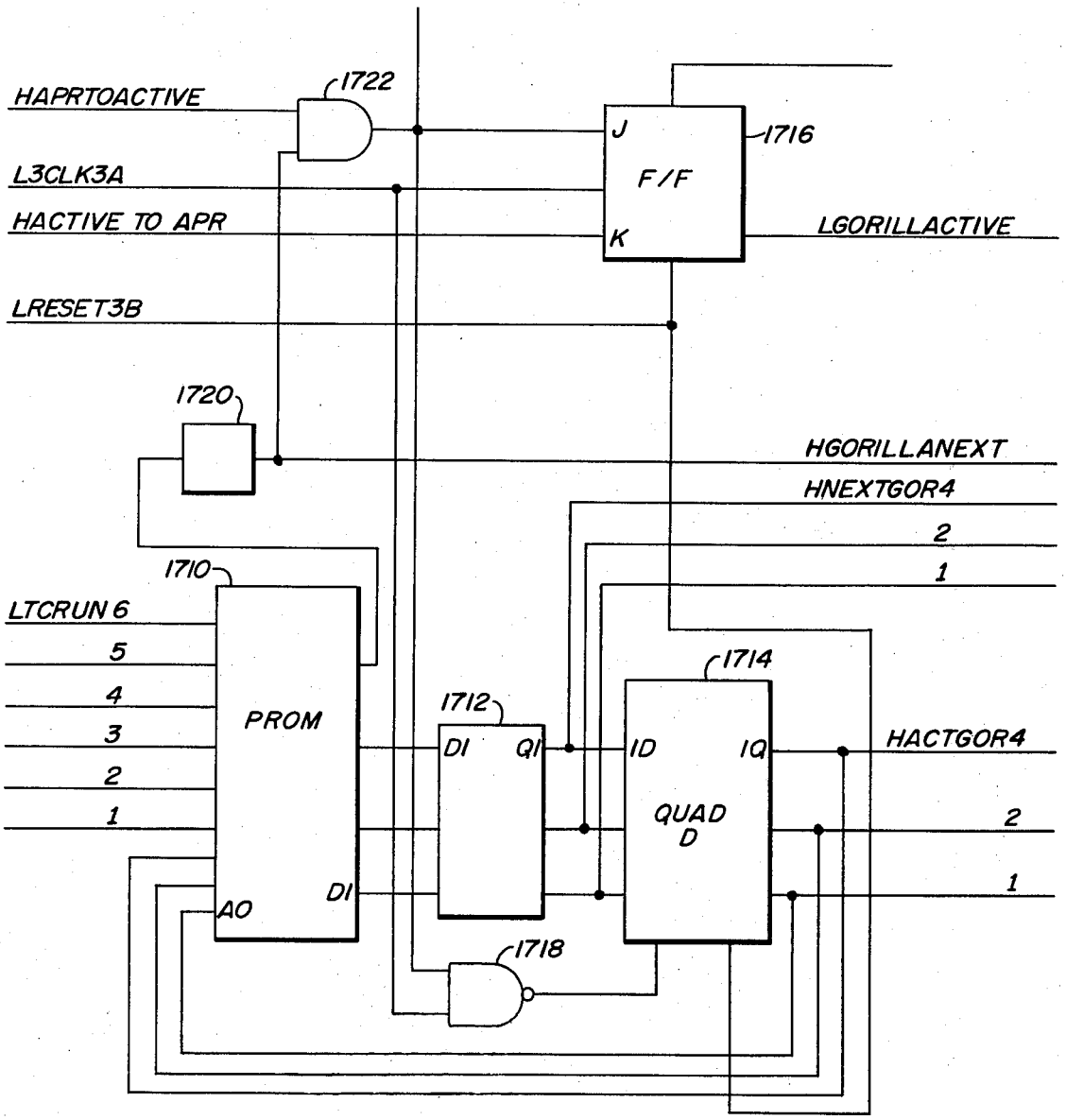

The following is a listing for the firmware for PROM 1710 of gorilla round robin 830 as shown in FIG. 44. As previously described, the aforegoing listing is the same as that used in monkey round robin 832.

| ROM INPUTS: Run Reqst. Low True 6 5 4 3 2 1 | ROM INPUTS: Active TCR 4 2 1 | Next Active ADR | ROM ADR | ROM Output |
|---|---|---|---|---|
| RUN | | | | |
| 0 0 0 0 0 0 | 0 0 0 | 1 | 0 0 0 | 9 |
| 0 0 0 0 0 0 | 0 0 1 | 2 | 0 0 1 | A |
| 0 0 0 0 0 0 | 0 1 0 | 3 | 0 0 2 | B |
| 0 0 0 0 0 0 | 0 1 1 | 4 | 0 0 3 | C |
| 0 0 0 0 0 0 | 1 0 0 | 5 | 0 0 4 | D |
| 0 0 0 0 0 0 | 1 0 1 | 6 | 0 0 5 | E |
| 0 0 0 0 0 0 | 1 1 0 | 1 | 0 0 6 | 9 |
| 0 0 0 0 0 0 | 1 1 1 | 1 | 0 0 7 | 9 |
| 0 0 0 0 0 1 | 0 0 0 | 2 | 0 0 8 | A |
| 0 0 0 0 0 1 | 0 0 1 | 2 | 0 0 9 | A |
| 0 0 0 0 0 1 | 0 1 0 | 3 | 0 0 A | B |
| 0 0 0 0 0 1 | 0 1 1 | 4 | 0 0 B | C |
| 0 0 0 0 0 1 | 1 0 0 | 5 | 0 0 C | D |
| 0 0 0 0 0 1 | 1 0 1 | 6 | 0 0 D | E |
| 0 0 0 0 0 1 | 1 1 0 | 2 | 0 0 E | A |
| 0 0 0 0 0 1 | 1 1 1 | 2 | 0 0 F | A |
| 0 0 0 0 1 0 | 0 0 0 | 1 | 0 1 0 | 9 |
| 0 0 0 0 1 0 | 0 0 1 | 3 | 0 1 1 | B |
| 0 0 0 0 1 0 | 0 1 0 | 3 | 0 1 2 | B |
| 0 0 0 0 1 0 | 0 1 1 | 4 | 0 1 3 | C |
| 0 0 0 0 1 0 | 1 0 0 | 5 | 0 1 4 | D |
| 0 0 0 0 1 0 | 1 0 1 | 6 | 0 1 5 | E |
| 0 0 0 0 1 0 | 1 1 0 | 1 | 0 1 6 | 9 |
| 0 0 0 0 1 0 | 1 1 1 | 1 | 0 1 7 | 9 |
| 0 0 0 0 1 1 | 0 0 0 | 3 | 0 1 8 | B |
| 0 0 0 0 1 1 | 0 0 1 | 3 | 0 1 9 | B |
| 0 0 0 0 1 1 | 0 1 0 | 3 | 0 1 A | B |
| 0 0 0 0 1 1 | 0 1 1 | 4 | 0 1 B | C |
| 0 0 0 0 1 1 | 1 0 0 | 5 | 0 1 C | D |
| 0 0 0 0 1 1 | 1 0 1 | 6 | 0 1 D | E |
| 0 0 0 0 1 1 | 1 1 0 | 3 | 0 1 E | B |
| 0 0 0 0 1 1 | 1 1 1 | 3 | 0 1 F | B |
| 0 0 0 1 0 0 | 0 0 0 | 1 | 0 2 0 | 9 |
| 0 0 0 1 0 0 | 0 0 1 | 2 | 0 2 1 | A |
| 0 0 0 1 0 0 | 0 1 0 | 4 | 0 2 2 | C |
| 0 0 0 1 0 0 | 0 1 1 | 4 | 0 2 3 | C |
| 0 0 0 1 0 0 | 1 0 0 | 5 | 0 2 4 | D |
| 0 0 0 1 0 0 | 1 0 1 | 6 | 0 2 5 | E |
| 0 0 0 1 0 0 | 1 1 0 | 1 | 0 2 6 | 9 |
| 0 0 0 1 0 0 | 1 1 1 | 1 | 0 2 7 | 9 |
| 0 0 0 1 0 1 | 0 0 0 | 2 | 0 2 8 | A |
| 0 0 0 1 0 1 | 0 0 1 | 2 | 0 2 9 | A |
| 0 0 0 1 0 1 | 0 1 0 | 4 | 0 2 A | C |
| 0 0 0 1 0 1 | 0 1 1 | 4 | 0 2 B | C |
| 0 0 0 1 0 1 | 1 0 0 | 5 | 0 2 C | D |

| Note ROM Output Bits 4 | 3 2 1 |
|---|---|
| = Hi if any TCR is next | Next Active |

| | | | |
|---|---|---|---|
| 0 0 0 1 0 1 1 0 1 | 6 | 0 2 D | E |
| 0 0 0 1 0 1 1 1 0 | 2 | 0 2 E | A |
| 0 0 0 1 0 1 1 1 1 | 2 | 0 2 F | A |
| 0 0 0 1 1 0 0 0 0 | 1 | 0 3 0 | 9 |
| 0 0 0 1 1 0 0 0 1 | 4 | 0 3 1 | C |
| 0 0 0 1 1 0 0 1 0 | 4 | 0 3 2 | C |
| 0 0 0 1 1 0 0 1 1 | 4 | 0 3 3 | C |
| 0 0 0 1 1 0 1 0 0 | 5 | 0 3 4 | D |
| 0 0 0 1 1 0 1 0 1 | 6 | 0 3 5 | E |
| 0 0 0 1 1 0 1 1 0 | 1 | 0 3 6 | 9 |
| 0 0 0 1 1 0 1 1 1 | 1 | 0 3 7 | 9 |
| 0 0 0 1 1 1 0 0 0 | 4 | 0 3 8 | C |
| 0 0 0 1 1 1 0 0 1 | 4 | 0 3 9 | C |
| 0 0 0 1 1 1 0 1 0 | 4 | 0 3 A | C |
| 0 0 0 1 1 1 0 1 1 | 4 | 0 3 B | C |
| 0 0 0 1 1 1 1 0 0 | 5 | 0 3 C | D |
| 0 0 0 1 1 1 1 0 1 | 6 | 0 3 D | E |
| 0 0 0 1 1 1 1 1 0 | 4 | 0 3 E | C |
| 0 0 0 1 1 1 1 1 1 | 4 | 0 3 F | C |
| 0 0 1 0 0 0 0 0 0 | 1 | 0 4 0 | 9 |
| 0 0 1 0 0 0 0 0 1 | 2 | 0 4 1 | A |
| 0 0 1 0 0 0 0 1 0 | 3 | 0 4 2 | B |
| 0 0 1 0 0 0 0 1 1 | 5 | 0 4 3 | D |
| 0 0 1 0 0 0 1 0 0 | 5 | 0 4 4 | D |
| 0 0 1 0 0 0 1 0 1 | 6 | 0 4 5 | E |
| 0 0 1 0 0 0 1 1 0 | 1 | 0 4 6 | 9 |
| 0 0 1 0 0 0 1 1 1 | 1 | 0 4 7 | 9 |
| 0 0 1 0 0 1 0 0 0 | 2 | 0 4 8 | A |
| 0 0 1 0 0 1 0 0 1 | 2 | 0 4 9 | A |
| 0 0 1 0 0 1 0 1 0 | 3 | 0 4 A | B |
| 0 0 1 0 0 1 0 1 1 | 5 | 0 4 B | D |
| 0 0 1 0 0 1 1 0 0 | 5 | 0 4 C | D |
| 0 0 1 0 0 1 1 0 1 | 6 | 0 4 D | E |
| 0 0 1 0 0 1 1 1 0 | 2 | 0 4 E | A |
| 0 0 1 0 0 1 1 1 1 | 2 | 0 4 F | A |
| 0 0 1 0 1 0 0 0 0 | 1 | 0 5 0 | 9 |
| 0 0 1 0 1 0 0 0 1 | 3 | 0 5 1 | B |
| 0 0 1 0 1 0 0 1 0 | 3 | 0 5 2 | B |
| 0 0 1 0 1 0 0 1 1 | 5 | 0 5 3 | D |
| 0 0 1 0 1 0 1 0 0 | 5 | 0 5 4 | D |
| 0 0 1 0 1 0 1 0 1 | 6 | 0 5 5 | E |
| 0 0 1 0 1 0 1 1 0 | 1 | 0 5 6 | 9 |
| 0 0 1 0 1 0 1 1 1 | 1 | 0 5 7 | 9 |
| 0 0 1 0 1 1 0 0 0 | 3 | 0 5 8 | B |
| 0 0 1 0 1 1 0 0 1 | 3 | 0 5 9 | B |
| 0 0 1 0 1 1 0 1 0 | 3 | 0 5 A | B |
| 0 0 1 0 1 1 0 1 1 | 5 | 0 5 B | D |
| 0 0 1 0 1 1 1 0 0 | 5 | 0 5 C | D |
| 0 0 1 0 1 1 1 0 1 | 6 | 0 5 D | E |
| 0 0 1 0 1 1 1 1 0 | 3 | 0 5 E | B |
| 0 0 1 0 1 1 1 1 1 | 3 | 0 5 F | B |
| 0 0 1 1 0 0 0 0 0 | 1 | 0 6 0 | 9 |
| 0 0 1 1 0 0 0 0 1 | 2 | 0 6 1 | A |
| 0 0 1 1 0 0 0 1 0 | 5 | 0 6 2 | D |
| 0 0 1 1 0 0 0 1 1 | 5 | 0 6 3 | D |
| 0 0 1 1 0 0 1 0 0 | 5 | 0 6 4 | D |
| 0 0 1 1 0 0 1 0 1 | 6 | 0 6 5 | E |
| 0 0 1 1 0 0 1 1 0 | 1 | 0 6 6 | 9 |
| 0 0 1 1 0 0 1 1 1 | 1 | 0 6 7 | 9 |
| 0 0 1 1 0 1 0 0 0 | 2 | 0 6 8 | A |
| 0 0 1 1 0 1 0 0 1 | 2 | 0 6 9 | A |
| 0 0 1 1 0 1 0 1 0 | 5 | 0 6 A | D |
| 0 0 1 1 0 1 0 1 1 | 5 | 0 6 B | D |
| 0 0 1 1 0 1 1 0 0 | 5 | 0 6 C | D |
| 0 0 1 1 0 1 1 0 1 | 6 | 0 6 D | E |

| | | | | | | | | | | | |
|---|---|---|---|---|---|---|---|---|---|---|---|
| 0 | 0 | 1 | 1 | 0 | 1 | 1 | 1 | 0 | 2 | 0 6 E | A |
| 0 | 0 | 1 | 1 | 0 | 1 | 1 | 1 | 1 | 2 | 0 6 F | A |
| 0 | 0 | 1 | 1 | 1 | 0 | 0 | 0 | 0 | 1 | 0 7 0 | 9 |
| 0 | 0 | 1 | 1 | 1 | 0 | 0 | 0 | 1 | 5 | 0 7 1 | D |
| 0 | 0 | 1 | 1 | 1 | 0 | 0 | 1 | 0 | 5 | 0 7 2 | D |
| 0 | 0 | 1 | 1 | 1 | 0 | 0 | 1 | 1 | 5 | 0 7 3 | D |
| 0 | 0 | 1 | 1 | 1 | 0 | 1 | 0 | 0 | 5 | 0 7 4 | D |
| 0 | 0 | 1 | 1 | 1 | 0 | 1 | 0 | 1 | 6 | 0 7 5 | E |
| 0 | 0 | 1 | 1 | 1 | 0 | 1 | 1 | 0 | 1 | 0 7 6 | 9 |
| 0 | 0 | 1 | 1 | 1 | 0 | 1 | 1 | 1 | 1 | 0 7 7 | 9 |
| 0 | 0 | 1 | 1 | 1 | 1 | 0 | 0 | 0 | 5 | 0 7 8 | D |
| 0 | 0 | 1 | 1 | 1 | 1 | 0 | 0 | 1 | 5 | 0 7 9 | D |
| 0 | 0 | 1 | 1 | 1 | 1 | 0 | 1 | 0 | 5 | 0 7 A | D |
| 0 | 0 | 1 | 1 | 1 | 1 | 0 | 1 | 1 | 5 | 0 7 B | D |
| 0 | 0 | 1 | 1 | 1 | 1 | 1 | 0 | 0 | 5 | 0 7 C | D |
| 0 | 0 | 1 | 1 | 1 | 1 | 1 | 0 | 1 | 6 | 0 7 D | E |
| 0 | 0 | 1 | 1 | 1 | 1 | 1 | 1 | 0 | 5 | 0 7 E | D |
| 0 | 0 | 1 | 1 | 1 | 1 | 1 | 1 | 1 | 5 | 0 7 F | D |
| 0 | 1 | 0 | 0 | 0 | 0 | 0 | 0 | 0 | 1 | 0 8 0 | 9 |
| 0 | 1 | 0 | 0 | 0 | 0 | 0 | 0 | 1 | 2 | 0 8 1 | A |
| 0 | 1 | 0 | 0 | 0 | 0 | 0 | 1 | 0 | 3 | 0 8 2 | B |
| 0 | 1 | 0 | 0 | 0 | 0 | 0 | 1 | 1 | 4 | 0 8 3 | C |
| 0 | 1 | 0 | 0 | 0 | 0 | 1 | 0 | 0 | 6 | 0 8 4 | E |
| 0 | 1 | 0 | 0 | 0 | 0 | 1 | 0 | 1 | 6 | 0 8 5 | E |
| 0 | 1 | 0 | 0 | 0 | 0 | 1 | 1 | 0 | 1 | 0 8 6 | 9 |
| 0 | 1 | 0 | 0 | 0 | 0 | 1 | 1 | 1 | 1 | 0 8 7 | 9 |
| 0 | 1 | 0 | 0 | 0 | 1 | 0 | 0 | 0 | 2 | 0 8 8 | A |
| 0 | 1 | 0 | 0 | 0 | 1 | 0 | 0 | 1 | 2 | 0 8 9 | A |
| 0 | 1 | 0 | 0 | 0 | 1 | 0 | 1 | 0 | 3 | 0 8 A | B |
| 0 | 1 | 0 | 0 | 0 | 1 | 0 | 1 | 1 | 4 | 0 8 B | C |
| 0 | 1 | 0 | 0 | 0 | 1 | 1 | 0 | 0 | 6 | 0 8 C | E |
| 0 | 1 | 0 | 0 | 0 | 1 | 1 | 0 | 1 | 6 | 0 8 D | E |
| 0 | 1 | 0 | 0 | 0 | 1 | 1 | 1 | 0 | 2 | 0 8 E | A |
| 0 | 1 | 0 | 0 | 0 | 1 | 1 | 1 | 1 | 2 | 0 8 F | A |
| 0 | 1 | 0 | 0 | 1 | 0 | 0 | 0 | 0 | 1 | 0 9 0 | 9 |
| 0 | 1 | 0 | 0 | 1 | 0 | 0 | 0 | 1 | 3 | 0 9 1 | B |
| 0 | 1 | 0 | 0 | 1 | 0 | 0 | 1 | 0 | 3 | 0 9 2 | B |
| 0 | 1 | 0 | 0 | 1 | 0 | 0 | 1 | 1 | 4 | 0 9 3 | C |
| 0 | 1 | 0 | 0 | 1 | 0 | 1 | 0 | 0 | 6 | 0 9 4 | E |
| 0 | 1 | 0 | 0 | 1 | 0 | 1 | 0 | 1 | 6 | 0 9 5 | E |
| 0 | 1 | 0 | 0 | 1 | 0 | 1 | 1 | 0 | 1 | 0 9 6 | 9 |
| 0 | 1 | 0 | 0 | 1 | 0 | 1 | 1 | 1 | 1 | 0 9 7 | 9 |
| 0 | 1 | 0 | 0 | 1 | 1 | 0 | 0 | 0 | 3 | 0 9 8 | B |
| 0 | 1 | 0 | 0 | 1 | 1 | 0 | 0 | 1 | 3 | 0 9 9 | B |
| 0 | 1 | 0 | 0 | 1 | 1 | 0 | 1 | 0 | 3 | 0 9 A | B |
| 0 | 1 | 0 | 0 | 1 | 1 | 0 | 1 | 1 | 4 | 0 9 B | C |
| 0 | 1 | 0 | 0 | 1 | 1 | 1 | 0 | 0 | 6 | 0 9 C | E |
| 0 | 1 | 0 | 0 | 1 | 1 | 1 | 0 | 1 | 6 | 0 9 D | E |
| 0 | 1 | 0 | 0 | 1 | 1 | 1 | 1 | 0 | 3 | 0 9 E | B |
| 0 | 1 | 0 | 0 | 1 | 1 | 1 | 1 | 1 | 3 | 0 9 F | B |
| 0 | 1 | 0 | 1 | 0 | 0 | 0 | 0 | 0 | 1 | 0 A0 | 9 |
| 0 | 1 | 0 | 1 | 0 | 0 | 0 | 0 | 1 | 2 | 0 A1 | A |
| 0 | 1 | 0 | 1 | 0 | 0 | 0 | 1 | 0 | 4 | 0 A2 | C |
| 0 | 1 | 0 | 1 | 0 | 0 | 0 | 1 | 1 | 4 | 0 A3 | C |
| 0 | 1 | 0 | 1 | 0 | 0 | 1 | 0 | 0 | 6 | 0 A4 | E |
| 0 | 1 | 0 | 1 | 0 | 0 | 1 | 0 | 1 | 6 | 0 A5 | E |
| 0 | 1 | 0 | 1 | 0 | 0 | 1 | 1 | 0 | 1 | 0 A6 | 9 |
| 0 | 1 | 0 | 1 | 0 | 0 | 1 | 1 | 1 | 1 | 0 A7 | 9 |
| 0 | 1 | 0 | 1 | 0 | 1 | 0 | 0 | 0 | 2 | 0 A8 | A |
| 0 | 1 | 0 | 1 | 0 | 1 | 0 | 0 | 1 | 2 | 0 A9 | A |
| 0 | 1 | 0 | 1 | 0 | 1 | 0 | 1 | 0 | 4 | 0 AA | C |
| 0 | 1 | 0 | 1 | 0 | 1 | 0 | 1 | 1 | 4 | 0 AB | C |
| 0 | 1 | 0 | 1 | 0 | 1 | 1 | 0 | 0 | 6 | 0 AC | E |
| 0 | 1 | 0 | 1 | 0 | 1 | 1 | 0 | 1 | 6 | 0 AD | E |
| 0 | 1 | 0 | 1 | 0 | 1 | 1 | 1 | 0 | 2 | 0 AE | A |
| 0 | 1 | 0 | 1 | 0 | 1 | 1 | 1 | 1 | 2 | 0 AF | A |

| | | | | |
|---|---|---|---|---|
| 0 1 0 1 1 0 0 0 0 | 1 | 0 | B0 | 9 |
| 0 1 0 1 1 0 0 0 1 | 4 | 0 | B1 | C |
| 0 1 0 1 1 0 0 1 0 | 4 | 0 | B2 | C |
| 0 1 0 1 1 0 0 1 1 | 4 | 0 | B3 | C |
| 0 1 0 1 1 0 1 0 0 | 6 | 0 | B4 | E |
| 0 1 0 1 1 0 1 0 1 | 6 | 0 | B5 | E |
| 0 1 0 1 1 0 1 1 0 | 1 | 0 | B6 | 9 |
| 0 1 0 1 1 0 1 1 1 | 1 | 0 | B7 | 9 |
| 0 1 0 1 1 1 0 0 0 | 4 | 0 | B8 | C |
| 0 1 0 1 1 1 0 0 1 | 4 | 0 | B9 | C |
| 0 1 0 1 1 1 0 1 0 | 4 | 0 | BA | C |
| 0 1 0 1 1 1 0 1 1 | 4 | 0 | BB | C |
| 0 1 0 1 1 1 1 0 0 | 6 | 0 | BC | E |
| 0 1 0 1 1 1 1 0 1 | 6 | 0 | BD | E |
| 0 1 0 1 1 1 1 1 0 | 4 | 0 | BE | C |
| 0 1 0 1 1 1 1 1 1 | 4 | 0 | BF | C |
| 0 1 1 0 0 0 0 0 0 | 1 | 0 | C0 | 9 |
| 0 1 1 0 0 0 0 0 1 | 2 | 0 | C1 | A |
| 0 1 1 0 0 0 0 1 0 | 3 | 0 | C2 | B |
| 0 1 1 0 0 0 0 1 1 | 6 | 0 | C3 | E |
| 0 1 1 0 0 0 1 0 0 | 6 | 0 | C4 | E |
| 0 1 1 0 0 0 1 0 1 | 6 | 0 | C5 | E |
| 0 1 1 0 0 0 1 1 0 | 1 | 0 | C6 | 9 |
| 0 1 1 0 0 0 1 1 1 | 1 | 0 | C7 | 9 |
| 0 1 1 0 0 1 0 0 0 | 2 | 0 | C8 | A |
| 0 1 1 0 0 1 0 0 1 | 2 | 0 | C9 | A |
| 0 1 1 0 0 1 0 1 0 | 3 | 0 | CA | B |
| 0 1 1 0 0 1 0 1 1 | 6 | 0 | CB | E |
| 0 1 1 0 0 1 1 0 0 | 6 | 0 | CC | E |
| 0 1 1 0 0 1 1 0 1 | 6 | 0 | CD | E |
| 0 1 1 0 0 1 1 1 0 | 2 | 0 | CE | A |
| 0 1 1 0 0 1 1 1 1 | 2 | 0 | CF | A |
| 0 1 1 0 1 0 0 0 0 | 1 | 0 | D0 | 9 |
| 0 1 1 0 1 0 0 0 1 | 3 | 0 | D1 | B |
| 0 1 1 0 1 0 0 1 0 | 3 | 0 | D2 | B |
| 0 1 1 0 1 0 0 1 1 | 6 | 0 | D3 | E |
| 0 1 1 0 1 0 1 0 0 | 6 | 0 | D4 | E |
| 0 1 1 0 1 0 1 0 1 | 6 | 0 | D5 | E |
| 0 1 1 0 1 0 1 1 0 | 1 | 0 | D6 | 9 |
| 0 1 1 0 1 0 1 1 1 | 1 | 0 | D7 | 9 |
| 0 1 1 0 1 1 0 0 0 | 3 | 0 | D8 | B |
| 0 1 1 0 1 1 0 0 1 | 3 | 0 | D9 | B |
| 0 1 1 0 1 1 0 1 0 | 3 | 0 | DA | B |
| 0 1 1 0 1 1 0 1 1 | 6 | 0 | DB | E |
| 0 1 1 0 1 1 1 0 0 | 6 | 0 | DC | E |
| 0 1 1 0 1 1 1 0 1 | 6 | 0 | DD | E |
| 0 1 1 0 1 1 1 1 0 | 3 | 0 | DF | B |
| 0 1 1 0 1 1 1 1 1 | 3 | 0 | DF | B |
| 0 1 1 1 0 0 0 0 0 | 1 | 0 | E0 | 9 |
| 0 1 1 1 0 0 0 0 1 | 2 | 0 | E1 | A |
| 0 1 1 1 0 0 0 1 0 | 6 | 0 | E2 | E |
| 0 1 1 1 0 0 0 1 1 | 6 | 0 | E3 | E |
| 0 1 1 1 0 0 1 0 0 | 6 | 0 | E4 | E |
| 0 1 1 1 0 0 1 0 1 | 6 | 0 | E5 | E |
| 0 1 1 1 0 0 1 1 0 | 1 | 0 | E6 | 9 |
| 0 1 1 1 0 0 1 1 1 | 1 | 0 | E7 | 9 |
| 0 1 1 1 0 1 0 0 0 | 2 | 0 | E8 | A |
| 0 1 1 1 0 1 0 0 1 | 2 | 0 | E9 | A |
| 0 1 1 1 0 1 0 1 0 | 6 | 0 | EA | E |
| 0 1 1 1 0 1 0 1 1 | 6 | 0 | EB | E |
| 0 1 1 1 0 1 1 0 0 | 6 | 0 | EC | E |
| 0 1 1 1 0 1 1 0 1 | 6 | 0 | ED | E |
| 0 1 1 1 0 1 1 1 0 | 2 | 0 | EE | A |
| 0 1 1 1 0 1 1 1 1 | 2 | 0 | EF | A |
| 0 1 1 1 1 0 0 0 0 | 1 | 0 | F0 | 9 |
| 0 1 1 1 1 0 0 0 1 | 6 | 0 | F1 | E |

| | | | |
|---|---|---|---|
| 0 1 1 1 1 0 0 1 0 | 6 | 0 F2 | E |
| 0 1 1 1 1 0 0 1 1 | 6 | 0 F3 | E |
| 0 1 1 1 1 0 1 0 0 | 6 | 0 F4 | E |
| 0 1 1 1 1 0 1 0 1 | 6 | 0 F5 | E |
| 0 1 1 1 1 0 1 1 0 | 1 | 0 F6 | 9 |
| 0 1 1 1 1 0 1 1 1 | 1 | 0 F7 | 9 |
| 0 1 1 1 1 1 0 0 0 | 6 | 0 F8 | E |
| 0 1 1 1 1 1 0 0 1 | 6 | 0 F9 | E |
| 0 1 1 1 1 1 0 1 0 | 6 | 0 FA | E |
| 0 1 1 1 1 1 0 1 1 | 6 | 0 FB | E |
| 0 1 1 1 1 1 1 0 0 | 6 | 0 FC | E |
| 0 1 1 1 1 1 1 0 1 | 6 | 0 FD | E |
| 0 1 1 1 1 1 1 1 0 | 6 | 0 FE | E |
| 0 1 1 1 1 1 1 1 1 | 6 | 0 FF | E |
| 1 0 0 0 0 0 0 0 0 | 1 | 1 0 0 | 9 |
| 1 0 0 0 0 0 0 0 1 | 2 | 1 0 1 | A |
| 1 0 0 0 0 0 0 1 0 | 3 | 1 0 2 | B |
| 1 0 0 0 0 0 0 1 1 | 4 | 1 0 3 | C |
| 1 0 0 0 0 0 1 0 0 | 5 | 1 0 4 | D |
| 1 0 0 0 0 0 1 0 1 | 1 | 1 0 5 | 9 |
| 1 0 0 0 0 0 1 1 0 | 1 | 1 0 6 | 9 |
| 1 0 0 0 0 0 1 1 1 | 1 | 1 0 7 | 9 |
| 1 0 0 0 0 1 0 0 0 | 2 | 1 0 8 | A |
| 1 0 0 0 0 1 0 0 1 | 2 | 1 0 9 | A |
| 1 0 0 0 0 1 0 1 0 | 3 | 1 0 A | B |
| 1 0 0 0 0 1 0 1 1 | 4 | 1 0 B | C |
| 1 0 0 0 0 1 1 0 0 | 5 | 1 0 C | D |
| 1 0 0 0 0 1 1 0 1 | 2 | 1 0 D | A |
| 1 0 0 0 0 1 1 1 0 | 2 | 1 0 E | A |
| 1 0 0 0 0 1 1 1 1 | 2 | 1 0 F | A |
| 1 0 0 0 1 0 0 0 0 | 1 | 1 1 0 | 9 |
| 1 0 0 0 1 0 0 0 1 | 3 | 1 1 1 | B |
| 1 0 0 0 1 0 0 1 0 | 3 | 1 1 2 | B |
| 1 0 0 0 1 0 0 1 1 | 4 | 1 1 3 | C |
| 1 0 0 0 1 0 1 0 0 | 5 | 1 1 4 | D |
| 1 0 0 0 1 0 1 0 1 | 1 | 1 1 5 | 9 |
| 1 0 0 0 1 0 1 1 0 | 1 | 1 1 6 | 9 |
| 1 0 0 0 1 0 1 1 1 | 1 | 1 1 7 | 9 |
| 1 0 0 0 1 1 0 0 0 | 3 | 1 1 8 | B |
| 1 0 0 0 1 1 0 0 1 | 3 | 1 1 9 | B |
| 1 0 0 0 1 1 0 1 0 | 3 | 1 1 A | B |
| 1 0 0 0 1 1 0 1 1 | 4 | 1 1 B | C |
| 1 0 0 0 1 1 1 0 0 | 5 | 1 1 C | D |
| 1 0 0 0 1 1 1 0 1 | 3 | 1 1 D | B |
| 1 0 0 0 1 1 1 1 0 | 3 | 1 1 E | B |
| 1 0 0 0 1 1 1 1 1 | 3 | 1 1 F | B |
| 1 0 0 1 0 0 0 0 0 | 1 | 1 2 0 | 9 |
| 1 0 0 1 0 0 0 0 1 | 2 | 1 2 1 | A |
| 1 0 0 1 0 0 0 1 0 | 4 | 1 2 2 | C |
| 1 0 0 1 0 0 0 1 1 | 4 | 1 2 3 | C |
| 1 0 0 1 0 0 1 0 0 | 5 | 1 2 4 | D |
| 1 0 0 1 0 0 1 0 1 | 1 | 1 2 5 | 9 |
| 1 0 0 1 0 0 1 1 0 | 1 | 1 2 6 | 9 |
| 1 0 0 1 0 0 1 1 1 | 1 | 1 2 7 | 9 |
| 1 0 0 1 0 1 0 0 0 | 2 | 1 2 8 | A |
| 1 0 0 1 0 1 0 0 1 | 2 | 1 2 9 | A |
| 1 0 0 1 0 1 0 1 0 | 4 | 1 2 A | C |
| 1 0 0 1 0 1 0 1 1 | 4 | 1 2 B | C |
| 1 0 0 1 0 1 1 0 0 | 5 | 1 2 C | D |
| 1 0 0 1 0 1 1 0 1 | 2 | 1 2 D | A |
| 1 0 0 1 0 1 1 1 0 | 2 | 1 2 E | A |
| 1 0 0 1 0 1 1 1 1 | 2 | 1 2 F | A |
| 1 0 0 1 1 0 0 0 0 | 1 | 1 3 0 | 9 |
| 1 0 0 1 1 0 0 0 1 | 4 | 1 3 1 | C |
| 1 0 0 1 1 0 0 1 0 | 4 | 1 3 2 | C |
| 1 0 0 1 1 0 0 1 1 | 4 | 1 3 3 | C |

| | | | |
|---|---|---|---|
| 1 0 0 1 1 0 1 0 0 | 5 | 1 3 4 | D |
| 1 0 0 1 1 0 1 0 1 | 1 | 1 3 5 | 9 |
| 1 0 0 1 1 0 1 1 0 | 1 | 1 3 6 | 9 |
| 1 0 0 1 1 0 1 1 1 | 1 | 1 3 7 | 9 |
| 1 0 0 1 1 1 0 0 0 | 4 | 1 3 8 | D |
| 1 0 0 1 1 1 0 0 1 | 4 | 1 3 9 | C |
| 1 0 0 1 1 1 0 1 0 | 4 | 1 3 A | C |
| 1 0 0 1 1 1 0 1 1 | 4 | 1 3 B | C |
| 1 0 0 1 1 1 1 0 0 | 5 | 1 3 C | D |
| 1 0 0 1 1 1 1 0 1 | 4 | 1 3 D | C |
| 1 0 0 1 1 1 1 1 0 | 4 | 1 3 E | C |
| 1 0 0 1 1 1 1 1 1 | 4 | 1 3 E | C |
| 1 0 0 1 1 1 1 1 1 | 4 | 1 3 F | C |
| 1 0 1 0 0 0 0 0 0 | 1 | 1 4 0 | 9 |
| 1 0 1 0 0 0 0 0 1 | 2 | 1 4 1 | A |
| 1 0 1 0 0 0 0 1 0 | 3 | 1 4 2 | B |
| 1 0 1 0 0 0 0 1 1 | 5 | 1 4 3 | D |
| 1 0 1 0 0 0 1 0 0 | 5 | 1 4 4 | D |
| 1 0 1 0 0 0 1 0 1 | 1 | 1 4 5 | 9 |
| 1 0 1 0 0 0 1 1 0 | 1 | 1 4 6 | 9 |
| 1 0 1 0 0 0 1 1 1 | 1 | 1 4 7 | 9 |
| 1 0 1 0 0 1 0 0 0 | 2 | 1 4 8 | A |
| 1 0 1 0 0 1 0 0 1 | 2 | 1 4 9 | A |
| 1 0 1 0 0 1 0 1 0 | 3 | 1 4 A | B |
| 1 0 1 0 0 1 0 1 1 | 5 | 1 4 B | D |
| 1 0 1 0 0 1 1 0 0 | 5 | 1 4 C | D |
| 1 0 1 0 0 1 1 0 1 | 2 | 1 4 D | A |
| 1 0 1 0 0 1 1 1 0 | 2 | 1 4 E | A |
| 1 0 1 0 0 1 1 1 1 | 2 | 1 4 F | A |
| 1 0 1 0 1 0 0 0 0 | 1 | 1 5 0 | 9 |
| 1 0 1 0 1 0 0 0 1 | 3 | 1 5 1 | B |
| 1 0 1 0 1 0 0 1 0 | 3 | 1 5 2 | B |
| 1 0 1 0 1 0 0 1 1 | 5 | 1 5 3 | D |
| 1 0 1 0 1 0 1 0 0 | 5 | 1 5 4 | D |
| 1 0 1 0 1 0 1 0 1 | 1 | 1 5 5 | 9 |
| 1 0 1 0 1 0 1 1 0 | 1 | 1 5 6 | 9 |
| 1 0 1 0 1 0 1 1 1 | 1 | 1 5 7 | 9 |
| 1 0 1 0 1 1 0 0 0 | 3 | 1 5 8 | B |
| 1 0 1 0 1 1 0 0 1 | 3 | 1 5 9 | B |
| 1 0 1 0 1 1 0 1 0 | 3 | 1 5 A | B |
| 1 0 1 0 1 1 0 1 1 | 5 | 1 5 B | D |
| 1 0 1 0 1 1 1 0 0 | 5 | 1 5 C | D |
| 1 0 1 0 1 1 1 0 1 | 3 | 1 5 D | B |
| 1 0 1 0 1 1 1 1 0 | 3 | 1 5 E | B |
| 1 0 1 0 1 1 1 1 1 | 3 | 1 5 F | B |
| 1 0 1 1 0 0 0 0 0 | 1 | 1 6 0 | 9 |
| 1 0 1 1 0 0 0 0 1 | 2 | 1 6 1 | A |
| 1 0 1 1 0 0 0 1 0 | 5 | 1 6 2 | D |
| 1 0 1 1 0 0 0 1 1 | 5 | 1 6 3 | D |
| 1 0 1 1 0 0 1 0 0 | 5 | 1 6 4 | D |
| 1 0 1 1 0 0 1 0 1 | 1 | 1 6 5 | 9 |
| 1 0 1 1 0 0 1 1 0 | 1 | 1 6 6 | 9 |
| 1 0 1 1 0 0 1 1 1 | 1 | 1 6 7 | 9 |
| 1 0 1 1 0 1 0 0 0 | 2 | 1 6 8 | A |
| 1 0 1 1 0 1 0 0 1 | 2 | 1 6 9 | A |
| 1 0 1 1 0 1 0 1 0 | 5 | 1 6 A | D |
| 1 0 1 1 0 1 0 1 1 | 5 | 1 6 B | D |
| 1 0 1 1 0 1 1 0 0 | 5 | 1 6 C | D |
| 1 0 1 1 0 1 1 0 1 | 2 | 1 6 D | A |
| 1 0 1 1 0 1 1 1 0 | 2 | 1 6 E | A |
| 1 0 1 1 0 1 1 1 1 | 2 | 1 6 F | A |
| 1 0 1 1 1 0 0 0 0 | 1 | 1 7 0 | 9 |
| 1 0 1 1 1 0 0 0 1 | 5 | 1 7 1 | D |
| 1 0 1 1 1 0 0 1 0 | 5 | 1 7 2 | D |
| 1 0 1 1 1 0 0 1 1 | 5 | 1 7 3 | D |
| 1 0 1 1 1 0 1 0 0 | 5 | 1 7 4 | D |

| | | | |
|---|---|---|---|
| 1 0 1 1 1 0 1 0 1 | 1 | 1 7 5 | 9 |
| 1 0 1 1 1 0 1 1 0 | 1 | 1 7 6 | 9 |
| 1 0 1 1 1 0 1 1 1 | 1 | 1 7 7 | 9 |
| 1 0 1 1 1 1 0 0 0 | 5 | 1 7 8 | D |
| 1 0 1 1 1 1 0 0 1 | 5 | 1 7 9 | D |
| 1 0 1 1 1 1 0 1 0 | 5 | 1 7 A | D |
| 1 0 1 1 1 1 0 1 1 | 5 | 1 7 B | D |
| 1 0 1 1 1 1 1 0 0 | 5 | 1 7 C | D |
| 1 0 1 1 1 1 1 0 1 | 5 | 1 7 D | D |
| 1 0 1 1 1 1 1 1 0 | 5 | 1 7 E | D |
| 1 0 1 1 1 1 1 1 1 | 5 | 1 7 F | D |
| 1 1 0 0 0 0 0 0 0 | 1 | 1 8 0 | 9 |
| 1 1 0 0 0 0 0 0 1 | 2 | 1 8 1 | A |
| 1 1 0 0 0 0 0 1 0 | 3 | 1 8 2 | B |
| 1 1 0 0 0 0 0 1 1 | 4 | 1 8 3 | C |
| 1 1 0 0 0 0 1 0 0 | 1 | 1 8 4 | 9 |
| 1 1 0 0 0 0 1 0 1 | 1 | 1 8 5 | 9 |
| 1 1 0 0 0 0 1 1 0 | 1 | 1 8 6 | 9 |
| 1 1 0 0 0 0 1 1 1 | 1 | 1 8 7 | 9 |
| 1 1 0 0 0 1 0 0 0 | 2 | 1 8 8 | A |
| 1 1 0 0 0 1 0 0 1 | 2 | 1 8 9 | A |
| 1 1 0 0 0 1 0 1 0 | 3 | 1 8 A | B |
| 1 1 0 0 0 1 0 1 1 | 4 | 1 8 B | C |
| 1 1 0 0 0 1 1 0 0 | 2 | 1 8 C | A |
| 1 1 0 0 0 1 1 0 1 | 2 | 1 8 D | A |
| 1 1 0 0 0 1 1 1 0 | 2 | 1 8 E | A |
| 1 1 0 0 0 1 1 1 1 | 2 | 1 8 F | A |
| 1 1 0 0 1 0 0 0 0 | 1 | 1 9 0 | 9 |
| 1 1 0 0 1 0 0 0 1 | 3 | 1 9 1 | B |
| 1 1 0 0 1 0 0 1 0 | 3 | 1 9 2 | B |
| 1 1 0 0 1 0 0 1 1 | 4 | 1 9 3 | C |
| 1 1 0 0 1 0 1 0 0 | 1 | 1 9 4 | 9 |
| 1 1 0 0 1 0 1 0 1 | 1 | 1 9 5 | 9 |
| 1 1 0 0 1 0 1 1 0 | 1 | 1 9 6 | 9 |
| 1 1 0 0 1 0 1 1 1 | 1 | 1 9 7 | 9 |
| 1 1 0 0 1 1 0 0 0 | 3 | 1 9 8 | B |
| 1 1 0 0 1 1 0 0 1 | 3 | 1 9 9 | B |
| 1 1 0 0 1 1 0 1 0 | 3 | 1 9 A | B |
| 1 1 0 0 1 1 0 1 1 | 4 | 1 9 B | C |
| 1 1 0 0 1 1 1 0 0 | 3 | 1 9 C | B |
| 1 1 0 0 1 1 1 0 1 | 3 | 1 9 D | B |
| 1 1 0 0 1 1 1 1 0 | 3 | 1 9 E | B |
| 1 1 0 0 1 1 1 1 1 | 3 | 1 9 F | B |
| 1 1 0 1 0 0 0 0 0 | 1 | 1 A0 | 9 |
| 1 1 0 1 0 0 0 0 1 | 2 | 1 A1 | A |
| 1 1 0 1 0 0 0 1 0 | 4 | 1 A2 | C |
| 1 1 0 1 0 0 0 1 1 | 4 | 1 A3 | C |
| 1 1 0 1 0 0 1 0 0 | 1 | 1 A4 | 9 |
| 1 1 0 1 0 0 1 0 1 | 1 | 1 A5 | 9 |
| 1 1 0 1 0 0 1 1 0 | 1 | 1 A6 | 9 |
| 1 1 0 1 0 0 1 1 1 | 1 | 1 A7 | 9 |
| 1 1 0 1 0 1 0 0 0 | 2 | 1 A8 | A |
| 1 1 0 1 0 1 0 0 1 | 2 | 1 A9 | A |
| 1 1 0 1 0 1 0 1 0 | 4 | 1 AA | C |
| 1 1 0 1 0 1 0 1 1 | 4 | 1 AB | C |
| 1 1 0 1 0 1 1 0 0 | 2 | 1 AC | A |
| 1 1 0 1 0 1 1 0 1 | 2 | 1 AD | A |
| 1 1 0 1 0 1 1 1 0 | 2 | 1 AE | A |
| 1 1 0 1 0 1 1 1 1 | 2 | 1 AF | A |
| 1 1 0 1 1 0 0 0 0 | 1 | 1 B0 | 9 |
| 1 1 0 1 1 0 0 0 1 | 4 | 1 B1 | C |
| 1 1 0 1 1 0 0 1 0 | 4 | 1 B2 | C |
| 1 1 0 1 1 0 0 1 1 | 4 | 1 B3 | C |
| 1 1 0 1 1 0 1 0 0 | 1 | 1 B4 | 9 |
| 1 1 0 1 1 0 1 0 1 | 1 | 1 B5 | 9 |

| | | | |
|---|---|---|---|
| 1 1 0 1 1 0 1 1 0 | 1 | 1 B6 | 9 |
| 1 1 0 1 1 0 1 1 1 | 1 | 1 B7 | 9 |
| 1 1 0 1 1 1 0 0 0 | 4 | 1 B8 | C |
| 1 1 0 1 1 1 0 0 1 | 4 | 1 B9 | C |
| 1 1 0 1 1 1 0 1 0 | 4 | 1 BA | C |
| 1 1 0 1 1 1 0 1 1 | 4 | 1 BB | C |
| 1 1 0 1 1 1 1 0 0 | 4 | 1 BC | C |
| 1 1 0 1 1 1 1 0 1 | 4 | 1 BD | C |
| 1 1 0 1 1 1 1 1 0 | 4 | 1 BE | C |
| 1 1 0 1 1 1 1 1 1 | 4 | 1 BF | C |
| 1 1 1 0 0 0 0 0 0 | 1 | 1 C0 | 9 |
| 1 1 1 0 0 0 0 0 1 | 2 | 1 C1 | A |
| 1 1 1 0 0 0 0 1 0 | 3 | 1 C2 | B |
| 1 1 1 0 0 0 0 1 1 | 1 | 1 C3 | 9 |
| 1 1 1 0 0 0 1 0 0 | 1 | 1 C4 | 9 |
| 1 1 1 0 0 0 1 0 1 | 1 | 1 C5 | 9 |
| 1 1 1 0 0 0 1 1 0 | 1 | 1 C6 | 9 |
| 1 1 1 0 0 0 1 1 1 | 1 | 1 C7 | 9 |
| 1 1 1 0 0 1 0 0 0 | 2 | 1 C8 | A |
| 1 1 1 0 0 1 0 0 1 | 2 | 1 C9 | A |
| 1 1 1 0 0 1 0 1 0 | 3 | 1 CA | B |
| 1 1 1 0 0 1 0 1 1 | 2 | 1 CB | A |
| 1 1 1 0 0 1 1 0 0 | 2 | 1 CC | A |
| 1 1 1 0 0 1 1 0 1 | 2 | 1 CD | A |
| 1 1 1 0 0 1 1 1 0 | 2 | 1 CE | A |
| 1 1 1 0 0 1 1 1 1 | 2 | 1 CF | A |
| 1 1 1 0 1 0 0 0 0 | 1 | 1 D0 | 9 |
| 1 1 1 0 1 0 0 0 1 | 3 | 1 D1 | B |
| 1 1 1 0 1 0 0 1 0 | 3 | 1 D2 | B |
| 1 1 1 0 1 0 0 1 1 | 1 | 1 D3 | 9 |
| 1 1 1 0 1 0 1 0 0 | 1 | 1 D4 | 9 |
| 1 1 1 0 1 0 1 0 1 | 1 | 1 D5 | 9 |
| 1 1 1 0 1 0 1 1 0 | 1 | 1 D6 | 9 |
| 1 1 1 0 1 0 1 1 1 | 1 | 1 D7 | 9 |
| 1 1 1 0 1 1 0 0 0 | 3 | 1 D8 | B |
| 1 1 1 0 1 1 0 0 1 | 3 | 1 D9 | B |
| 1 1 1 0 1 1 0 1 0 | 3 | 1 DA | B |
| 1 1 1 0 1 1 0 1 1 | 3 | 1 DB | B |
| 1 1 1 0 1 1 1 0 0 | 3 | 1 DC | B |
| 1 1 1 0 1 1 1 0 1 | 3 | 1 DD | B |
| 1 1 1 0 1 1 1 1 0 | 3 | 1 DE | B |
| 1 1 1 0 1 1 1 1 1 | 3 | 1 DF | B |
| 1 1 1 1 0 0 0 0 0 | 1 | 1 E0 | 9 |
| 1 1 1 1 0 0 0 0 1 | 2 | 1 E1 | A |
| 1 1 1 1 0 0 0 1 0 | 1 | 1 E2 | 9 |
| 1 1 1 1 0 0 0 1 1 | 1 | 1 E3 | 9 |
| 1 1 1 1 0 0 1 0 0 | 1 | 1 E4 | 9 |
| 1 1 1 1 0 0 1 0 1 | 1 | 1 E5 | 9 |
| 1 1 1 1 0 0 1 1 0 | 1 | 1 E6 | 9 |
| 1 1 1 1 0 0 1 1 1 | 1 | 1 E7 | 9 |
| 1 1 1 1 0 1 0 0 0 | 2 | 1 E8 | A |
| 1 1 1 1 0 1 0 0 1 | 2 | 1 E9 | A |
| 1 1 1 1 0 1 0 1 0 | 2 | 1 EA | A |
| 1 1 1 1 0 1 0 1 1 | 2 | 1 EB | A |
| 1 1 1 1 0 1 1 0 0 | 2 | 1 EC | A |
| 1 1 1 1 0 1 1 0 1 | 2 | 1 ED | A |
| 1 1 1 1 0 1 1 1 0 | 2 | 1 EE | A |
| 1 1 1 1 0 1 1 1 1 | 2 | 1 EF | A |
| 1 1 1 1 1 0 0 0 0 | 1 | 1 F0 | 9 |
| 1 1 1 1 1 0 0 0 1 | 1 | 1 F1 | 9 |
| 1 1 1 1 1 0 0 1 0 | 1 | 1 F2 | 9 |
| 1 1 1 1 1 0 0 1 1 | 1 | 1 F3 | 9 |
| 1 1 1 1 1 0 1 0 0 | 1 | 1 F4 | 9 |
| 1 1 1 1 1 0 1 0 1 | 1 | 1 F5 | 9 |
| 1 1 1 1 1 0 1 1 0 | 1 | 1 F6 | 9 |

| | | | |
|---|---|---|---|
| 1 1 1 1 1 0 1 1 1 | 1 | 1 F7 | 9 |
| 1 1 1 1 1 1 0 0 0 | 0 | 1 F8 | 0 |
| 1 1 1 1 1 1 0 0 1 | 0 | 1 F9 | 0 |
| 1 1 1 1 1 1 0 1 0 | 0 | 1 FA | 0 |
| 1 1 1 1 1 1 0 1 1 | 0 | 1 FB | 0 |
| 1 1 1 1 1 1 1 0 0 | 0 | 1 FC | 0 |
| 1 1 1 1 1 1 1 0 1 | 0 | 1 FD | 0 |
| 1 1 1 1 1 1 1 1 0 | 0 | 1 FE | 0 |
| 1 1 1 1 1 1 1 1 1 | 0 | 1 FF | 0 |

RFADY

IX. HOS AND HIOCS SOFTWARE SYSTEMS

As previously described, the software required for operation of system 10 must support real time multi-task hybrid operations. The following software integrates with the SEL real time monitor (RTM) and SEL terminal support subsystem (TSS) software. Specifically, the hybrid input/output control system (HIOCS) and hybrid operations subroutines (HOS) are set forth although other hybrid programs and utilities may also be used. The HIOCS package is integrated into RTM to mate with the hybrid hardware controllers. This allows one resident copy of these input/output routines to service several users in a multi-task environment.

HOS is the user interface to the hybrid software system for real time use. HOS allos the allocation of various resources such as TCR's 62*a–f*, analog consoles 12*a–f*, channels 52,54 and interrupt sources to a proper user's application program. The following are HOS subroutines divided into four major categories or sets of subroutines. The HOS listings are later set forth in detail.

System Initialization Subroutines

System Initialization (QJOB)
Allocate An Analog Console 12*a–f* (QSACI)
Select Analog Console 12*a–f* (QSC)

Channel Programming Subroutines

Allocate an ADC/DCM 22 Transfer Control Register 62*a–f* (QSADCTCR)
Construct ADC/DCM 22 Channel Program (QRBADCPR)
Chain ADC/DCM 22 Control Words (QSADCHN)
Loop ADC/DCM 22 Channel Program (QSADLOOP)
Initiate an ADC/DCM 22 Channel Program (QIADCP)
Digitally Activate a Block of ADC's (QSADCTRA)
Halt an ADC/DCM 22 Channel Program (QHADCP)
Read ADC/DCM 22 Channel Program Status (QRADSI)
Load an ADC/DCM 22 Timer (QWADDCMT)
Read an ADC/DCM 22 Timer (QRADDCMT)
Start ADC/DCM 22 Timer(s) (QSADTMR)
Allocate a DAM/DCM 24 Transfer Control Register (QSDMICR)
Construct DAM/DCM 24 Channel Program (QWBDACPR)
Chain DAM/DCM 24 Control Words (QSDACHN)
Loop DAM/DCM 24 Channel Program (QSDALOOP)
Initiate a DAM/DCM 24 Channel Program (QIDACP)
Digitally Activate a Block of DAM's (QSDAMIRA)
Halt a DAM/DCM 24 Channel Program (QHDACP)
Read DAM/DCM 24 Channel Program Status (QRADSI)
Load a DAM/DCM 24 Timer (QWDADCMI)
Read a DAM/DCM 24 Timer (QRDADCMI)
Start DAM/DCM 24 Timer(s) (QSDATMR)

Interrupt Connect Subroutine

Connect Subroutine to Hybrid Interrupt (QCONCT)

Request Real Time Subroutine

Real Time Hybrid Usage Request (QSGORT)

In the above first category of initialization, the first subroutine that a programmer must call is QJOB. This subroutine initializes the user's program to the hybrid interface. It also initializes the software determining which method the user wishes to run. For example, the user may wish to have run time errors that are sensed by the subroutine logged on a CRT line printer 38. In this subroutine, there are arguments that he can use to operate the method of his further execution.

The next initialization subroutine is QSACI which is a subroutine the user invokes to allocate to an analog console 12*a–f*. If the user calls this subroutine to allocate a console and the console is not being used by another task in the system, the request will be okayed by the subrouting. If this console is being used by another task, the user request will be denied and he will be aborted. The user may allocate as many consoles 12*a–f* as there are within system 10. One program may be running on two consoles. As a result, subroutine QSC selects a previously allocated console. All subsequent calls to the HOS subroutines will be directed to the console that was last selected.

The second set of subroutines are channel programming subroutines which are called prior to a real time run in the static test mode of operation. Only the ADC/DCM subroutines will be discussed as the DAM/DCM subroutines are similar. The first subroutine to be called is QSADCTCR which attempts to allocate one of six TCR's 62*a–f*. If there are no TCR's available to this user, as other users are using them, the request will be denied. If there is a free TCR, the user would be granted the TCR. This is the hardware component that the next call will be directed to when constructing a channel program. Once the user has successfully allocated a TCR, he calls a subroutine to construct a channel program. In this subroutine, the user tells the software the channels that are to convert and read the ADC, where in the FORTRAN program this data is to be transferred and other arguments, QSADCHN subroutine enables the user to chain and loop channel programs. The maximum allowed is four chain channel programs or three chain channel programs which can be looped at the top of the chained stack. The user may also desire to do ADC transfer synchronously using the built in timers of the TCR's 62*a–f*. To use these timers, the user loads an initial value into these timers by calling channel program subroutine QWADDCMT. Also there is a call to start the timers in channel programming subroutine (QSADTMR).

After the user has constructed the CPCW, the last subroutine to be called is QIADCP which initiates the ADC channel program. This subroutine instructs the currently selected TCR to fetch the first CPCW pair in core. The TCR would then attempt to perform the I/O but only if the TCR is activated will the I/O be completed. The activation is provided by one of: patch panel control, timer timing out of a previously loaded value or a digital instruction. If the TCR is not active, no I/O will occur until later in the real time phase of the program.

The next subroutine set is the subroutine to connect the user written FORTRAN subroutine directly to a hybrid interrupt. This subroutine is also called in the nonreal time portion of this program. The actual physical connection in hardware instruction occurs when the user at a later call is granted real time use. In general, this subroutine recognizes the interrupts that the user wishes to use and the subroutines the user wishes to drive directly with those interrupts.

The last subroutine set is QSGORT which defines that the user desired to go real time. There are three arguments in this subroutine. A first argument tells the software which of the users prior allocated TCR's should be time critical. This means that this TCR will be able to preempt other users TCR's data transfers. Thus, if a user has requested real time usage and one of his TCR's has become active, he will get full control of ADC 52 at that time. Another argument relates to a similar situation for the DAM TCR's. The last argument is the ordering of resource allocator matrix 104 to indicate the interupts from the hybrid interface to go to priority levels in digital system 10. If the user passes the calling of this subroutine, that indicates no one else is using the real time subroutine and he will be granted full usage of system 10. Normally, the user suspends his task and the RTM has no knowledge of this task being resident in core. Upon occurrence of external stimuli of interrupts, the directly connected FORTRAN subroutines will do his simulation work in real time.

HIOCS is executed on a very high priority interrupt level in system 18. It is invoked through the usage of the illegal instruction trap so therefore it is higher than any software and most other hardware interrupts. HIOCS serves two broad purposes. The first purpose is to allocate hybrid resources amongst users. This guarantees system integrity of linkage 16 and controllers 14. Another purposes is to keep system integrity in digital computer 30. Mistakes of one user will not destroy another user's program or change I/O state of the system or destroy anything within monitor 36. The user is enabled to run in the unprivileged mode of operation. HIOCS also performs post hybrid task clean up in case a user forgets to perform post execution clean up operation. For example, if the user would give me a loop to channel program at the end of his task, HIOCS will issue a halt command to that channel program so that when RTM realizes that this task has ended, it loads another program into the same core memory, that memory will not be overlaid with ADC values.

HOS and HIOCS listings follow.

```
00002                                   * TITLE: REAL TIME HYBRID USAGE REQUEST(WSGORT)        REV. LEV. A000 1
00003                                   * DATE: APRIL 1977
00004                                   * COPYRIGHTED BY ELECTRONIC ASSOCIATES, INC.
00005                                   * 600/32 VERSION
00006                                   *
00007                                   *              CALLING SEQUENCE:
00008                                   *
00009                                   *              CALL WSGORT(IDAMLO,IADLLO,INTARY)
00010                                   *
00011                                   *              INPUT ARGUMENTS:
00012                                   *              IDAMLO; INTEGER ARRAY THAT DEFINES
00013                                   *                      WHICH DAM TCR(S) WILL BECOME TIME CRITICAL.
00014                                   *                      IF IDAMLO IS A SCALAR AND EQUALS 0, NO
00015                                   *                      DAM TCR(S) WILL BECOME TIME CRITICAL. IF AN
00016                                   *                      ARRAY THE LAST ELEMENT MUST BE A=1.
00017                                   *              IADLLO; INTEGER ARRAY THAT DEFINES WHICH ADC TCR(S)
00018                                   *                      WILL BECOME TIME CRITICAL. IF IADLLO IS A
00019                                   *                      SCALAR AND EQUALS 0, NO ADC TCR(S) WILL
00020                                   *                      BECOME TIME CRITICAL. IF AN ARRAY THE LAST
00021                                   *                      ELEMENT MUST BE A=1.
00022                                   *              INTARY; INTEGER ARRAY THAT CONTAINS THE HYBRID INTERRUPT
00023                                   *                      LOGICAL NUMBERS IN DESCENDING PRIORITY, DELIMITED
00024                                   *                      BY A -1.
00025                                   *
00026                                   *              ERROR CONDITIONS:
00027                                   *
00028                                   *              26= HYBRID I/O TIMED OUT
00029                                   *              67= ILLEGAL IDAMLO OR IADLLO ELEMENT
00030                                   *              50 ILLEGAL MEMBER OF INTARY
00031                                   *              69= REAL-TIME REQUEST DENIED DUE TO ANOTHER
00032                                   *                  GORILLA IN THE SYSTEM
00033                                   *
00034                                           PROGRAM   WSGORT
00035                                           DEF       WSGORT
00036                                           EXT       WWALLOSL
00037                                           EXT       WWMTMOUT,WFPR,WWDALTCR,WWADLTCR,WWMTMI,WWGORLPR
00038                                           EXT       WWERRORS,WWPSINPI
00039                                           EXT       WWERISOE
00040  P00000                                   M.EQUS
                                                EQUM
00041  P00000                                   4.HEQUS6
                                                EQUM
00042  P00000                           RIN9    RES       1W
00043  P00004  D4000000    P00000      WSGORT  STW       R0,RIN9
00044  P00008  F8800001    X00000              BL        WFPR
00045  P0000C  00000006                        DATAW     3W
00046  P00010                           IDAMLO  RES       1W
00047  P00014                           IADLLO  RES       1W
00048  P00018                           INTARY  RES       1W
00049                                   *
00050                                   *              EVIT THE DAM LOGICAL TCR ARRAY MEMBERS
00051                                   *
00052  P0001C  9880001I    P00011              SEM       9,IDAMLO        INDIRECT LOAD INDEXED BY R2 THROUGH
00053                                   *                                  THE IDAMLO ARRAY
00054  P00020  0026                            ZR        R2              CLEAR THE INDEX REGISTER
       P00022      0002
00055  P00024  AF900010    P00010              LW        R7,*IDAMLO      FETCH 1ST MEMBER
00056  P00028  EE000070    P0007C              BCI       EW,NODAMTC      IF = 0 => NO DAM TCR IS TIME CRITICAL
00057  P0002C  C885FFFF                        CI        R7,-1           PREMATURE DELIMETER ??
00058  P00030  EE000290    P0029C              BCI       EW,ERR67
00059  P00034  D1800000    X00000              LEA       R3,WDALTCR      PERFORM A LOGICAL TO PHYSICAL TCR
00060  P00038  F8800201    P00200              BL        LTCRPTCR        MAPPING R4 HAS THE PHYSICAL TCT IN LSB(S)
```

```
00061  P0003C  EC000290  P0029C          BU      ERR67          ILLEGAL IDAMLU MEMBER
00062  P00040  D6000300  P00300          STW     R4,PDATCRIB
00063  P00044  CA80FFFB                  LI      R5,-5          R5 USED FOR ITERATION CONTROL
00064  P00048  C9010004            DATCRLP ADI   R2,1W          BUMP THE INDEX REGISTER
00065  P0004C  AF900010  P00010          LW      R7,*IDAMLU     FETCH 2ND/NEXT MEMBER OF IDAMLU
00066  P00050  CB85FFFF                  CI      R7,-1          DELIMETER FOUND?
00067  P00054  EE000070  P0007C          BCI     EQ,NODAMIC
00068  P00058  D1800034  Y00034          LEA     R3,QQDALICR    PERFORM THE LOGICAL TO PHYSICAL MAP
00069  P0005C  F8800201  P00200          BL      LICRPICR
00070  P00060  EC000290  P0029C          BU      ERR67          ILLEGAL IDAMLU MEMBER
00071  P00064  D6000300  P00300          STW     R4,PDATCRIB,R2 STORE 2ND/NEXT PHYSICAL ICR
00072  P00068  F6800049  P00048          BIB     R5,DATCRLP
00073  P0006C  C9010004                  ADI     R2,1W          DID THIS GUY MAKE 6 ICR(S) TIME
00074  P00070  AF900010  P00010          LW      R7,*IDAMLU     CRITICAL?
00075  P00074  CB85FFFF                  CI      R7,-1          CHECK FOR DELIMETER
00076  P00078  F2000290  P0029C          BCF     EQ,ERR67       /TH MEMBER OF IDAM LU NOT = -1.
00077                               *
00078                               *              EDIT THE ADC LOGICAL ICR ARRAY MEMBERS
00079                               *
00080  P0007C                       NODAMIC EQU     $
00081  P0007C  98680015  P00015          SBM     9,IADLLU       INDIRECT THEN INDEXED BY R2
00082                               *                             THROUGH THE IADLLU ARRAY
00083  P00080  0D20                       ZR      R2             CLEAR INDEX REGISTER
       P00082       0002
00084  P00084  AF900014  P00014          LW      R7,*IADLLU     FETCH 1ST MEMBER
00085  P00088  EE000000  P0000C          BCI     EQ,NOADLIC     IF = 0 => NO ADC ICR IS TIME CRITICAL
00086  P0008C  CB85FFFF                  CI      R7,-1          PREMATURE DELIMETER?
00087  P00090  EE000290  P0029C          BCI     EQ,ERR67
00088  P00094  D1800000  X00000          LEA     R3,QQADLICR    PERFORM A LOGICAL TO PHYSICAL ICR
00089  P00098  F8800201  P00200          BL      LICRPICR       MAPPING
00090  P0009C  EC000290  P0029C          BU      ERR67          ILLEGAL IADLLU MEMBER
00091  P000A0  D6000318  P00318          STW     R4,PADICRIB
00092  P000A4  CA80FFFB                  LI      R5,-5          ITERATION CONTROL
00093  P000A8  C9010004            ADICRLP ADI   R2,1W          BUMP INDEX REGISTER
00094  P000AC  AF900014  P00014          LW      R7,*IADLLU     FETCH 2ND/NEXT MEMBER OF IADLLU
00095  P000B0  CB85FFFF                  CI      R7,-1          DELIMETER FOUND?
00096  P000B4  EE000000  P0000C          BCI     EQ,NOADLIC
00097  P000B8  D1800094  Y00094          LEA     R3,QQADLICR    PERFORM THE LOGICAL TO PHYSICAL MAP
00098  P000BC  F8800201  P00200          BL      LICRPICR
00099  P000C0  EC000290  P0029C          BU      ERR67          ILLEGAL IADLLU MEMBER
00100  P000C4  D6000318  P00318          STW     R4,PADICRIB,R2 STORE 2ND/NEXT PHYSICAL ICR
00101  P000C8  F6800049  P00048          BIB     R5,ADICRLP
00102  P000CC  C9010004                  ADI     R2,1W          DID THIS GUY MAKE 6 ICR(S)
00103  P000D0  AF900014  P00014          LW      R7,*IADLLU     TIME CRITICAL?
00104  P000D4  CB85FFFF                  CI      R7,-1          CHECK DELIMETER
00105  P000D8  F2000290  P0029C          BCF     EQ,ERR67
00106  P000DC                       NOADLIC EQU     $
00107                               *
00108                               *              EDIT MEMBERS OF INTARY
00109                               *
00110  P000DC  0C90                       ZR      R1             R1 INDEXES THROUGH INTARY
       P000DE       0002
00111  P000E0  99080019  P00019          SBM     10,INTARY      INDIRECT THEN INDEXED ADDRESSING MODE
00112  P000E4  AF900018  P00018          LW      R7,*INTARY     1ST MEMBER
00113  P000E8  EE000141  P00140          BCI     ZR,NORAINTS    IF 0 => INTERRUPTS ARE NOT REORDERED
00114  P000EC  ED8002AD  P002AC          BCI     LT,ERR30       < 0 ?
00115  P000F0  CB850040                  CI      R7,64
00116  P000F4  ED0002AD  P002AC          BCI     GT,ERR30       > 64 ?
00117  P000F8  D7880330  P00330          STB     R7,PHYSINTB    SAVE FOR LATER USE
00118  P000FC  CB00FFF1                  LI      R6,-15
00119  P00100  0D20                       ZR      R2             EMPLOY R2 AS BYTE INDEX FOR PHYSINTB
       P00102       0002
```

```
00120  P00104  C8810004                PHYSINIL ADI     R1,1W          BUMP INDEX
00121  P00108  AF900018   P00018               LW      R7,*INTARY     FETCH 2ND/NEXT INTARY MEMBER
00122  P0010C  EE0002AD   P002AC               BCI     EQ,ERR30       = 0 => INVALID (ERROR 30)
00123  P00110  C865FFFF                        CI      R7,-1
00124  P00114  EE000141   P00140               BCI     EQ,LOADRA      DELIMETER FOUND
00125  P00118  ED8002AD   P002AC               BCI     LT,ERR30       < -2 => ERROR 30
00126  P0011C  C8850040                        LI      R7,64
00127  P00120  ED0002AD   P002AC               BCI     GT,ERR30
00128  P00124  C9010001                        ADI     R2,1B          BUMP PHYSINIB BYTE INDEX
00129  P00128  D7C80330   P00330               STB     R7,PHYSINIB,R2
00130  P0012C  F7000105   P00104               BIB     R6,PHYSINIL
00131  P00130  C8010004                        ADI     R1,1W          IS THE 17TH MEMBER OF INTARY
00132  P00134  AF900018   P00018               LW      R7,*INTARY     = TO THE DELIMETER
00133  P00138  C865FFFF                        CI      R7,-1
00134  P0013C  F20002AD   P002AC               BCF     EQ,ERR30
00135  P00140                       LOADRA   EQU     $
00136  P00140                       NORAINIS EQU     $
00137                                *
00138                                *                ALL ARGUMENTS HAVE BEEN EDITED FOR VALIDITY
00139                                *
00140                                *                REQUEST REAL TIME USAGE
00141                                *
00142  P00140  C8800508                        LI      R1,USGORIX     I/O INDEX
00143  P00144  F8800001   X00000               BL      WGHYBOUT
00144  P00148  EC000285   P00284               BU      ERR69          ANOTHER GORILLA IS ALIVE IN SYSTEM!!
00145                                *
00146                                *                WE ARE NOW A GORILLA
00147                                *
00148                                *                DYNAMICALLY RAISE THE PRIORITY OF THIS TASK
00149                                *                TO THE PRIORITY ON THE DATA PASE  (WGPARMS)
00150                                *
00151  P0014C                                   M.PRIL   WGGORLPR
                                                LIST     NONG
       P0014C  0F60                             ZR       0
       P0014E      1BF3                         SBR      R7,S1
       P00150  AE800000   X00000               LW       5,WGGORLPR
       P00154  304A                             CALM     X'4A'
                                                LIST     NGLIST
                                                ENDM
00152                                *
00153                                *                SET THE ADC TCR(S) TIME CRITICAL (IF ANY)
00154                                *
       P00156      0002
00155  P00158  C980FFE8                        LI      R3,-6W         R3 = ITERATION AND INDEX
00156  P0015C  AD800330   P00330   PADLOOP    LW      R2,PADTCRTB+6W,R3 FETCH 1ST/NEXT ADC PHYSICAL TCR
00157  P00160  ED800175   P00174               BCI     LT,PADTCRDN    = -1 => DELIMETER
00158  P00164  C8800204                        LI      R1,WSADTIMC    I/O INDEX
00159  P00168  F8800145   Y00144               BL      WGHYBOUT
00160  P0016C  EC0002A5   P002A4               BU      ERR26          HYBRID I/O TIMED OUT
00161  P00170  F5C00150   P00150               BIW     R3,PADLOOP     2,4,6,8 LET'S ITERATE
00162  P00174                       PADTCRDN EQU     $
00163                                *
00164                                *                SET THE DAM TCR(S) TIME CRITICAL (IF ANY)
00165                                *
00166  P00174  C980FFE8                        LI      R3,-6W
00167  P00178  AD800318   P00318   PDALOOP    LW      R2,PDATCRTB+6W,R3   FETCH 1ST/NEXT DAM PHYSICAL TCR
00168  P0017C  ED800191   P00190               BCI     LT,PDATCRDN    = -1 => DELIMETER
00169  P00180  C8800304                        LI      R1,WSDATIMC    I/O INDEX
00170  P00184  F8800169   Y00168               BL      WGHYBOUT
00171  P00188  EC0002A5   P002A4               BU      ERR26          HYBRID I/O TIMED OUT
00172  P0018C  F5C00179   P00178               BIW     R3,PDALOOP
```

```
00173  P00190                          PDATCRDN EQU      $
00174                                  *
00175                                  *          REORDER THE INTERRUPT RESOURCE ALLOCATION MATRIX
00176                                  *
00177  P00190  C960FFF0                         LI       R3,-16B          R3 = INDEX AND ITERATION CONTROL
00178  P00194  ACE80340   P00340       RALOADLP LB       R1,PHYSINTB+16B,R3 FETCH/1ST/NEXT PHYSICAL INT. #
00179  P00198  C88500FF                         CI       R1,X'FF'         DELIMETER FOUND ??
00180  P0019C  EE000215   P00214               BCT      EQ,RADONE
00181  P001A0  C8850034                        CI       R1,52
00182  P001A4  ED0001CD   P001CC               BCT      GT,RATCRS        SPECIAL CASE FOR ADC AND DAM EOC(S)
00183  P001A8  AD28033F   P0033F               LB       R2,RAINPTAB-16,R1 FETCH BITS 20-27 OF DATA WORD
00184  P001AC  7144                           SLL      R2,4             MOVE TO BITS 20-28
00185  P001AE       2F30                RAMERGE  IRR      R3,R6
00186  P001B0  C8010010                        ADI      R6,16            CALCULATE OUTPUT LINE AS FUNCTION
00187  P001B4  0960                           ORR      R6,R2            OF R3 = ITERATION CONTROL
       P001B6       0002
00188  P001B8  C8800403                        LI       R1,QPROGRAX      I/O INDEX
00189  P001BC  F8800185   Y00184               BL       QOMYBOOT         LOAD 1ST NEXT RA
00190  P001C0  EC0002A5   P002A4               BU       ERR26            HYBRID I/O TIMED OUT
00191  P001C4  F5800195   P00194               BIB      R3,RALOADLP      ITERATE
00192  P001C8  EC000215   P00214               BU       RADONE
00193                                  *
00194                                  *          COMES HERE IF THE PHYSICAL INTERRUPT #
00195                                  *          IS FOR ADC OR DAM EOC(S)
00196                                  *
00197                                  *          MUST DETERMINE IN WHAT ORDER THE USER
00198                                  *          SELECTED TCR(S)
00199                                  *
00200  P001CC                          RATCRS   EQU      $
00201  P001CC  C885003A                        CI       R1,58            IF > 58 => DAM EOC
00202  P001D0  ED0001F5   P001F4               BCT      GT,DAMRAINT
00203                                  *
00204                                  *          FALLS THROUGH FOR ADC EOC INTERRUPT
00205                                  *
00206  P001D4  C881FFCB                         ADI      R1,-53           FORM WORD INDEX OUT OF R1 (0W-5W)
00207  P001D8  70C2                           SLL      R1,2             TO INDEX THROUGH THE
       P001DA       0002
00208  P001DC  C8810018                        ADI      R1,6W            BIAS PAST THE LOGICAL UNIT TABLE
00209  P001E0  AD200068   Y00068               LW       R2,QQADLTCR,R1   R2 = PHYSICAL TCR (SELECTED IN THE
00210                                  *                                 ORDER POINTED TO BY R1-6W
00211  P001E4  ED8002C9   P002C8               BCT      LT,ERR70         ABORT THIS TURKEY
00212  P001E8  AD480373   P00373               LB       R2,ADEOCINT-16,R2  FETCH BITS 20-27 OF DATA WORD
00213  P001EC  7144                           SLL      R2,4             MOVE TO BITS 20-27
       P001EE       0002
00214  P001F0  EC0001AF   P001AE               BU       RAMERGE
00215                                  *
00216                                  *          COMES HERE FOR DAM EOC INTERRUPT
00217                                  *
00218  P001F4  C881FFC5                DAMRAINT ADI      R1,-59           FORM INDEX OUT OF R1(0W-5W)
00219  P001F8  70C2                           SLL      R1,2
       P001FA       0002
00220  P001FC  C8810018                        ADI      R1,6W            BIAS PAST LOGICAL UNIT TABLE
00221  P00200  AD200058   Y00058               LW       R2,QQDALTCR,R1   R2 = PHYSICAL TCR
00222  P00204  ED8002C9   P002C8               BCT      LT,ERR70         ABORT THIS TURKEY
00223  P00208  AD480379   P00379               LB       R2,DAEOCINT-16,R2  FETCH BITS 20-27 OF DATA WORD
00224  P0020C  7144                           SLL      R2,4             MOVE TO BITS 20-27
       P0020E       0002
00225  P00210  EC0001AF   P001AE               BU       RAMERGE
00226  P00214                          RADONE   EQU      $
00227                                  *
00228                                  *          INVOKE HIOCS TO CONNECT HYBRID INTERRUPTS
00229                                  *          DIRECTLY TO FORTRAN SUBROUTINES AS PREVIOUSLY
00230                                  *          CONSTRUCTED IN PRIOR CALLS TO QCONCT
```

```
00231                                   *
00232  P00214  D1000000   X00000                LEA     R2,GOFSTRP1     R2 POINTS TO THE 1ST R/A TRAP LOCATION
00233                                   *                                 NEXT IS THE GOINITAB
00234  P00218  C8800502                         LI      R1,GCONLTX      I/O INDEX
00235  P00220  F8800180   Y00180                BL      GOHYBOUT
00236  P00220  0000                             HALT                    NO ERROR POSSIBLE (WILL NEVER
00237  P00222       0002                        NOP                     EXECUTE THE HALT)
00238  P00224                          GOODRTN EQU     $
00239                                   *
00240                                   *            SEE IF THE USER WANTS TO DIRECTLY CONNECT ANY OF
00241                                   *            THE DCM HYBRID ERROR INTERRUPTS TO ANY SUBROUTINES
00242                                   *
00243  P00224  C880FFE8                         LI      R7,-24          R7 = ITERATION CONTROL
00244  P00228  0080                             ZR      R3              R3 = INDEX
       P0022A       0002
00245  P0022C  AE600000   X00000      CONERLOP LR      R4,GOERISUB,R3
00246  P00230  EE000281   P00280                BCT     ZR,NOERCON
00247  P00234  2E80                             IRR     R3,R5           FALLS THROUGH IF ONE IS FOUND
       P00236       0002
00248  P00238  CA810004                         ADI     R5,1W           IF R5 = 0 => ADC OVERSCALE
00249  P0023C  0E40                             ZR      R4              IF R5 = 1 => ADC DATA RATE ERROR
       P0023E       0002
00250  P00240  CA040018                         OVI     R4,8W           IF R5 = 3 => DAM FLT. PT. ERROR
00251  P00244  CA01FFFC                         ADI     R4,-1W
00252  P00248  2CC0                             IRR     R4,R1           R1 POINTS TO THE TCR #
       P0024A       0002
00253  P0024C  C8810018                         ADI     R1,8W           BIAS PAST LOGICAL TABLE
00254  P00250  CA850001                         CI      R5,1
00255  P00254  ED000261   P00260                BCT     GT,DAMERMP
00256  P00256  AD2001E0   Y001E0                LR      R2,GOADLTCR,R1
00257  P0025C  EC000265   P00264                BU      $+2W
00258  P00260  AD200200   Y00200      DAMERMP  LR      R2,GOGALTCR,R1
00259  P00264  ED8002C9   P002C8                BCT     LT,ERR70        THIS PHYSICAL ONE HAS NOT BEEN SELCTD
00260  P00268  715A                             SLL     R2,26           SHIFT PHYSICAL TCR# TO BITS 3-5
00261  P0026A       7200                        SLL     R5,29           SHIFT WHICH INTERRUPT TO BITS 1-2
00262  P0026C  0950                             ORR     R5,R2           PACK INTO R2
       P0026E       0002
00263  P00270  B960022C   Y0022C                ORMW    R2,GOERISUB,R3  R2 NOW HAS COMPLETE DATA WORD
00264  P00274  C8800507                         LI      R1,GCONERIN     I/O INDEX
00265  P00278  F8800210   Y00210                BL      GOHYBOUT
00266  P0027C  0000                             HALT                    NO ERROR POSSIBLE
       P0027E       0002
00267  P00280  C9810004                         ADI     R3,1W
00268  P00284  F7800220   P0022C                BIB     R7,CONERLOP
00269                                   *
00270                                   *            TURN ON THE AMP OVERLOAD MASK FOR ALL CSL(S)
00271                                   *            SELECTED IN CASE THE USER EMPLOYS AMP OVERLOAD INTERRUPT
00272                                   *
00273  P00288  AD000000   X00000                LR      R2,GOALLCSL
00274  P0028C  C8800108                         LI      R1,GSAOMSKX     I/O INDEX
00275  P00290  F8800279   Y00278                BL      GOHYBOUT
00276  P00294  EC0002A5   P002A4                BU      ERR26           HYBRID I/O TIMED OUT
00277  P00298  EC100001   P00000                BU      *RTN9
00279                                   *
00280                                   *            ERROR PROCEDURES
00281                                   *
00282  P0029C  C9000043                 ERR67   LI      R2,67
00283  P002A0  EC000269   P00268                BU      ERROUT
00284  P002A4  C900001A                 ERR26   LI      R2,26
00285  P002A8  EC000269   P00268                BU      ERROUT
00286  P002AC  C900001E                 ERR30   LI      R2,30
00287  P002B0  EC000269   P00268                BU      ERROUT
00288  P002B4  C9000045                 ERR69   LI      R2,69
```

```
00289  P002B8  C8800045              ERROUT  LI      R1,MSGGURI      ROUTINE ID
00290  P002BC  A0800000   P00000            LA      R3,RIN9         FORTRAN LOCATION
00291  P002C0  F8800001   X00000            BL      NGERRORS
00292  P002C4  EC100001   P00000            MO      *RIN9
00293  P002C8  AE800380   P00380   ERR70   LA      R5,=C'ERR70'    ABORT THIS GUY
00294  P002CC  3057                        CALR    X'57'
00295                                 *
00296                                 *          THIS ROUTINE PERFORMS A LOGICAL TCB TO PHYSICAL TCB
00297                                 *          MAPPING EITHER THROUGH THE TOAMCU ARRAY OR THE TADCCU
00298                                 *          ARRAY (DEPENDING ON R5). IF A MATCH IS FOUND R5 PASSES
00299                                 *          BACK THE PHYSICAL TCB #. AND THE LINK-OUT IS BUMPED
00300                                 *          PAST THE ERROR RETURN. R7 CONTAINS THE INCOMING LOGICAL
00301                                 *          TCB9 R4 HAS THE ISOMORPHIC PHYSICAL TCB. SHIFTED TO
00302                                 *          BITS 1-5
00303                                 *
       P002CE      0002
00304  P002D0  CA00FFFA              LTCRPTCB LI     R4,-6           ITERATION CONTROL
00305  P002D4  AE800000     00000    LPTRLOOP LA     R6,0,R5         FETCH 1ST/NEXT LOGICAL TCB
00306  P002D8  1370                        CAR     R7,R6           = ?
       P002DA      0002
00307  P002DC  EE0002ED   P002EC            BCT     EQ,LPTCRMTH     BRANCH IF A MATCH HAS BEEN FOUND
00308  P002E0  C9810004                    ADI     R3,1W           BUMP POINTER THROUGH LOGICAL TABLE
00309  P002E4  F6000205   P002D4            BIB     R4,LPTRLOOP
00310  P002E8  2800                        TRSM    R0              ERROR RETURN--NO MATCH
       P002EA      0002
00311  P002EC  C9810018              LPTCRMTH ADI    R3,6W           POINT TO PHYSICAL TABLE ENTRY
00312  P002F0  AE800000     00000            LW      R4,0,R5         R4 NOW HAS PHYSICAL TCB
00313  P002F4  725A                        SLL     R4,26           SHIFT TO BIT 1-5
       P002F6      0002
00314  P002F8  C8010004                    ADI     R0,1W           BUMP LINK OUT PAST ERROR RETURN
00315  P002FC  2800                        TRSM    R0              GOOD RETURN
       P002FE      0002
00316  P00300  FFFFFFFF              PDATCRTB DATAW  -1,-1,-1,-1,-1,-1   THIS TABLE WILL CONTAIN THE
       P00304  FFFFFFFF
       P00308  FFFFFFFF
       P0030C  FFFFFFFF
       P00310  FFFFFFFF
       P00314  FFFFFFFF
00317                                 *                                   PHYSICAL TCB #S IN BITS 1-5 OF
00318                                 *                                   THE DAM TCB(S) TO BE TIME CRITICAL
00319  P00318  FFFFFFFF              PADTCRTB DATAW  -1,-1,-1,-1,-1,-1   THIS TABLE WILL CONTAIN THE
       P0031C  FFFFFFFF
       P00320  FFFFFFFF
       P00324  FFFFFFFF
       P00328  FFFFFFFF
       P0032C  FFFFFFFF
        00320                         *                                   PHYSICAL TCB #S IN BITS 1-5 OF
        00321                         *                                   THE ADC TCB(S) TO BE TIME CRITICAL
        00322  P00330  FFFFFFFF       PHYSINTR DATAB  -1,-1,-1,-1         THIS TABLE WILL CONTAIN THE PHYSICAL
        00323  P00334  FFFFFFFF                DATAB  -1,-1,-1,-1         INTERRUPT NUMBERS 0<#<65 OF THE
        00324  P00338  FFFFFFFF                DATAB  -1,-1,-1,-1         HYBRID INTERRUPTS TO BE REORDERED
        00325  P0033C  FFFFFFFF                DATAB  -1,-1,-1,-1
        00326  P00340  80             RAINPTAB DATAB  X'80'             CONSOLE 1  GPI 0
        00327  P00341    81                    DATAB  X'81'             CONSOLE 1  GPI 1
        00328  P00342      82                  DATAB  X'82'             CONSOLE 1  GPI 2
        00329  P00343        83                DATAB  X'83'             CONSOLE 1  GPI 3
        00330  P00344  84                      DATAB  X'84'             CONSOLE 1  GPI 4
        00331  P00345    85                    DATAB  X'85'             CONSOLE 1  GPI 5
        00332  P00346      86                  DATAB  X'86'             CONSOLE 1  GPI 6
        00333  P00347        87                DATAB  X'87'             CONSOLE 1  GPI 7
        00334  P00348  88                      DATAB  X'88'             CONSOLE 2  GPI 0
        00335  P00349    89                    DATAB  X'89'             CONSOLE 2  GPI 1
        00336  P0034A      8A                  DATAB  X'8A'             CONSOLE 2  GPI 2
```

```
00337  P00348        8B                    DATAB    X'8B'          CONSOLE 2  GPI 3
00338  P00349  8C                          DATAB    X'8C'          CONSOLE 2  GPI 4
00339  P00349     8D                       DATAB    X'8D'          CONSOLE 2  GPI 5
00340  P0034A        8E                    DATAB    X'8E'          CONSOLE 2  GPI 6
00341  P0034B        8F                    DATAB    X'8F'          CONSOLE 2  GPI 7
00342                              *              FOLLOWING IS THE TABLE FOR THE INPUTS OF THE RA
00343                              *              IT IS BITS 20-27 OF THE RA DATA-WORD
00344                              *
00345  P00350  90                          DATAB    X'90'          CONSOLE 3  GPI 0
00346  P00351     91                       DATAB    X'91'          CONSOLE 3  GPI 1
00347  P00352        92                    DATAB    X'92'          CONSOLE 3  GPI 2
00348  P00353        93                    DATAB    X'93'          CONSOLE 3  GPI 3
00349  P00354  94                          DATAB    X'94'          CONSOLE 3  GPI 4
00350  P00355     95                       DATAB    X'95'          CONSOLE 3  GPI 5
00351  P00356        96                    DATAB    X'96'          CONSOLE 3  GPI 6
00352  P00357        97                    DATAB    X'97'          CONSOLE 3  GPI 7
00353  P00358  98                          DATAB    X'98'          CONSOLE 4  GPI 0
00354  P00359     99                       DATAB    X'99'          CONSOLE 4  GPI 1
00355  P0035A        9A                    DATAB    X'9A'          CONSOLE 4  GPI 2
00356  P0035B        9B                    DATAB    X'9B'          CONSOLE 4  GPI 3
00357  P0035C  9C                          DATAB    X'9C'          CONSOLE 4  GPI 4
00358  P0035D     9D                       DATAB    X'9D'          CONSOLE 4  GPI 5
00359  P0035E        9E                    DATAB    X'9E'          CONSOLE 4  GPI 6
00360  P0035F        9F                    DATAB    X'9F'          CONSOLE 4  GPI 7
00361  P00360  A0                          DATAB    X'A0'          CONSOLE 5  GPI 0
00362  P00361     A1                       DATAB    X'A1'          CONSOLE 5  GPI 1
00363  P00362        A2                    DATAB    X'A2'          CONSOLE 5  GPI 2
00364  P00363        A3                    DATAB    X'A3'          CONSOLE 5  GPI 3
00365  P00364  A4                          DATAB    X'A4'          CONSOLE 5  GPI 4
00366  P00365     A5                       DATAB    X'A5'          CONSOLE 5  GPI 5
00367  P00366        A6                    DATAB    X'A6'          CONSOLE 5  GPI 6
00368  P00367        A7                    DATAB    X'A7'          CONSOLE 5  GPI 7
00369  P00368  A8                          DATAB    X'A8'          CONSOLE 6  GPI 0
00370  P00369     A9                       DATAB    X'A9'          CONSOLE 6  GPI 1
00371  P0036A        AA                    DATAB    X'AA'          CONSOLE 6  GPI 2
00372  P0036B        AB                    DATAB    X'AB'          CONSOLE 6  GPI 3
00373  P0036C  AC                          DATAB    X'AC'          CONSOLE 6  GPI 4
00374  P0036D     AD                       DATAB    X'AD'          CONSOLE 6  GPI 5
00375  P0036E        AE                    DATAB    X'AE'          CONSOLE 6  GPI 6
00376  P0036F        AF                    DATAB    X'AF'          CONSOLE 6  GPI 7
00377  P00370  B0                          DATAB    X'B0'          RING 1
00378  P00371     B1                       DATAB    X'B1'          RING 2
00379  P00372        B2                    DATAB    X'B2'          RING 3
00380  P00373        B7                    DATAB    X'B7'          AMP OVERLOAD
00381  P00374  B8                  ADEOCINT DATAB    X'B8'          ADC TCR 1 EOC INT
00382  P00375     B9                       DATAB    X'B9'          ADC TCR 2 EOC INT
00383  P00376        BA                    DATAB    X'BA'          ADC TCR 3 EOC INT
00384  P00377        BB                    DATAB    X'BB'          ADC TCR 4 EOC INT
00385  P00378  BC                          DATAB    X'BC'          ADC TCR 5 EOC INT
00386  P00379     BD                       DATAB    X'BD'          ADC TCR 6 EOC INT
00387  P0037A        BE                 DAEOCINT DATAB    X'BE'          DAM TCR 1 EOC INT
00388  P0037B        BF                    DATAB    X'BF'          DAM TCR 2 EOC INT
00389  P0037C  BA                          DATAB    X'BA'          DAM TCR 3 EOC INT
00390  P0037D     BB                       DATAB    X'BB'          DAM TCR 4 EOC INT
00391  P0037E        BC                    DATAB    X'BC'          DAM TCR 5 EOC INT
00392  P0037F        BD                    DATAB    X'BD'          DAM TCR 6 EOC INT
       P00380  48593730
00393  P00384                             END
*  0000  ERRORS IN GSGORT
```

```
00002                                   PROGRAM   ADCLCK
00003                                   DEF       WWADCTCR
00004                                   DEF       WRADSI
00005                                   DEF       WRBADCPR
00006                                   DEF       WSADLOOP,WIADCP,WSADCMN
00007                                   DEF       WRADDCMI,WWADCP,WSADCTRA
00008                                   DEF       WSADCTCR
00009                                   DEF       WSTADTMR
00010                                   EXT       WGTSKNUM,WWCSLNUM
00011                                   EXT       WWERRORS,WEPR,WWTYBIN,WWTYHOUT
00012                                   EXT       WWLSTADC
00013  P00000                        M.REQS
                                       ENDM
00014  P00000                        M.REQUS6
                                       ENDM
00015                            * TITLE: ALLOCATE AN ADC TRANSFER CONTROL REGISTER(WSADCTCR) R.L. A000 1
00016                            * DATE:  APRIL 1977
00017                            * COPYRIGHTED BY ELECTRONIC ASSOCIATES INC., 1976
00018                            * 600/32 VERSION
00019                            *
00020                            *              CALLING SEQUENCE:
00021                            *
00022                            *              CALL WSADCTCR(LOGUNIT,METHOD)
00023                            *
00024                            *              INPUT ARGUMENTS:
00025                            *
00026                            *              LOGUNIT; INTEGER VARIABLE OR CONSTANT THAT DEFINES THE
00027                            *                       USER'S LOGICAL NAME FOR THIS TRANSFER CONTROL
00028                            *                       REGISTER. THE USER WILL SUPPLY THIS ARGUMENT
00029                            *                       WHEN CONSTRUCTING A CHANNEL PROGRAM VIA LATER
00030                            *                       CALLS TO WRBADCPR,WSADCMN,WSADLOOP,WIADCP,
00031                            *                       WSADCTRA,WWADCP,WRADSI,WWADDCMI, AND WSGORI.
00032                            *
00033                            *              METHOD,  INTEGER VARIABLE OR CONSTANT THAT DEFINES THE
00034                            *                       METHOD OF ADC TRANSFER.
00035                            *
00036                            *                       IF METHOD = -1; ADC BLOCKS WILL ONLY BE
00037                            *                            DIGITAL INSTRUCTION. NO PP HOLE IS USED
00038                            *
00039                            *
00040                            *                       IF METHOD = 1; ADC BLOCKS WILL BE TRANSFERED
00041                            *                            VIA THE TIMER ASSOCIATED WITH THIS TCR.
00042                            *
00043                            *                       IF METHOD = 0; ADC TRANSFERS WILL BE ENABLED
00044                            *                            VIA THE RUN CONTROL
00045                            *
00046                            *
00047                            *              ERROR CONDITIONS
00048                            *
00049                            *              26-   HYBRID I/O TIMED OUT
00050                            *              42-   ILLEGAL METHOD OR TCRTL ARGUMENT
00051                            *              43-   NO TRANSFER CONTROL REGISTER (TCR) IS AVIALBLE
00052                            *              58-   LOGUNIT HAS BEEN USED TWICE BY THE SAME USER
00053                            *
00054  P00000                    RTN1     RES       1W
00055  P00004  D4000000  P00000  WSADCTCR STR       R0,RTN1          PASS THE ARGUMENTS
00056  P00008  F8000001  X00000           BL        WEPR
00057  P0000C  00000008                   DATAW     2W
00058  P00010                    LOGUNIT  RES       1W
00059  P00014                    METHOD   RES       1W
00060                            *
```

```
00061                                  *          FETCH TASK BOUNDS TO INSURE SYSTEM INTEGRITY WHEN
00062                                  *          CONSTRUCTING A CHANNEL PROGRAM IN LATER CALLS TO
00063                                  *          WKBADCPK
00064                                  *
00065  P00018                                 M.ADRS                    R6=LOWER BOUND : R7=UPPER BOUND
       P00018  3044                           CALM      X'44'
                                              ENDM
       P0001A      0002
00066  P0001C  D7800SF8   P005F8              STW       R7,TASKUL       SAVE UPPER LIMIT
00067  P00020  D7000SF4   P005F4              STW       R6,TASKLL       SAVE LOWER LIMIT
00068  P00024  C8800049                       LI        R7,NOSADCIC     SAVE ROUTINE I.D.
00069  P00028  D7800604   P00604              STW       R7,ROUTNUM
00070  P0002C  AF800000   P00000              LW        R7,FIN1         SAVE FORTRAN LOCATION
00071  P00030  D7800608   P00608              STW       R7,FORTLOC
00072  P00034  F800061C   P0061C              ZMW       TCRINDEX        RESET INDEX THROUGHOUT TCR STACK
00073                                  *
00074                                  *          VERIFY THAT THE USER HAS NOT ATTEMPTED TO
00075                                  *          ALLOCATE THE SAME LOGICAL TCR NAME TWICE
00076                                  *
00077  P00038  AF900010   P00010              LW        R7,*LOGUNIT FETCH LOGUNIT
00078  P0003C  C880FFE8                       LI        R1,-6X          R1 = INDEX AND ITERATION CONTROL
00079  P00040  93A00638   P00638    TCREDIT   CAMW      R7,LTCRTAB+6W,R1    COMAPRE
00080  P00044  EE0005D9   P005D8              BCT       EQ,ERR56        REDUNDANT LOGICAL NAME USAGE
00081  P00048  F4C00041   P00040              DIW       R1,TCREDIT      2,4,6,8 LET'S ITERATE
00082                                  *
00083                                  *          FETCH AND EDIT METHOD ARGUMENT
00084                                  *
00085  P0004C  AD100014   P00014              LW        R2,*METHOD
00086  P00050  EE000086   P0008C              BCT       EQ,PPMETHOD     PP CONTROL METHOD??
00087  P00054  C905FFFF                       CI        R2,-1           DIGITAL METHOD??
00088  P00058  EE00009D   P0009C              BCT       EQ,DIGMETHD
00089  P0005C  C9050001                       CI        R2,1            TIMER METHOD??
00090  P00060  F2000579   P00578              BCF       EQ,ERR42
00091                                  *
00092                                  *          FALLS THROUGH FOR TIMER
00093                                  *
00094  P00064                          TIMERMTH EQU     $
00095  P00064  C8800600                       LI        R1,WAADCTCR     I/O INDEX FOR S/W ALLOC FOR NON-PP
00096  P00068  AE000002   X00000              LD        R4,WNTSKNUM
00097  P0006C  F8800001   X00000              BL        WGMYBOOT
00098  P00070  EC000581   P00580              BO        ERR43           NO TCR STACKS AVAILABLE
00099  P00074  AC800610   P00610              LW        R1,LTCRINX      FETCH PHYSICAL TCR INDEX
00100  P00078  D5200638   P00638              STW       R2,PTCRTAB,R1   STORE ALLOCATED TCR ONTO STACK
00101  P0007C  D5000618   P00618              STW       R2,CURRTCRP     STORE IN CURRENT TCR
00102  P00080  AF900010   P00010              LW        R7,*LOGUNIT     STORE THE LOGICAL UNIT IN THE TMRLOTAB
00103  P00084  D7A00670   P00670              STW       R7,TMRLOTAB,R1  IN THE SAME POSITION AS THE PHYSICAL TAB
00104                                  *
00105                                  *          PERFORM PHYSICAL TCR ALLOCATION
00106                                  *
00107  P00088  715A                            SLL       R2,26           TCR # IN BITS 1-5
00108  P0008A      1820                        SBR       R2,0            SET BIT 0 FOR TIMER
00109  P0008C  C8800200                       LI        R1,WAADCRNX     I/O INDEX
00110  P00090  F8800060   Y0006C              BL        WGMYBOOT
00111  P00094  EC0005E5   P005E4              BO        ERROUT
00112  P00098  EC0000F1   P000F0              BO        SAVELOGU
00113  P0009C  C8800600                 DIGMETHD LI      R1,WAADCTCR     I/O INDEX TO S/W ALLOC. NON-PP TCR
00114  P000A0  AE00006A   Y0006B              LD        R4,WNTSKNUM
00115  P000A4  F8800091   Y00090              BL        WGMYBOOT
00116  P000A8  EC000581   P00580              BO        ERR43           NO TCR(S) AVAILABLE
00117  P000AC  AC800610   P00610              LW        R1,LTCRINX      FETCH INDEX
00118  P000B0  D5200638   P00638              STW       R2,PTCRTAB,R1   STORE AWAY ALLOCATED TCR
00119  P000B4  D5000618   P00618              STW       R2,CURRTCRP     STORE IN CURRENT TCR
```

```
00120  P000B8  EC0000F1  P000F0          BU        SAVELOGU
00121  P000BC  C8800605            PPMETHOD LI      R1,WAADTCRP     I/O INDEX FOR PP TCR ALLOCATION
00122  P000C0  AD000000  X00000          LW        R2,WWCSLNUM     CSL # = DATA WORD FOR THIS ALLOCATION
00123  P000C4  AE0000A2  Y000A0          LD        R4,WWTSKNUM
00124  P000C8  F8B000A5  Y000A4          BL        WGHYBOOT
00125  P000CC  EC000581  P00580          BU        ERR43
00126                                *
00127                                *          IN THIS CASE CSL# = TCR #
00128                                *
00129  P00000  AC800610  P00610          LW        R1,LTCRINX      STACK INDEX
00130  P00004  AD0000C0  Y000C0          LW        R2,WWCSLNUM     = TCR# ))))))
00131  P00008  D5200638  P00638          STW       R2,PTCRTAB,R1   STORE IN PHYS. TCR TABLE
00132  P0000C  D5000618  P00618           STW       R2,CURRTCRP
00133                                *
00134                                *          PERFORM PHYSICAL TCR RUN ALLOCATION
00135                                *
00136                                *
00136  P000E0  715A                   SLL       R2,26           TCR IN BITS 1-5
       P000E2      0002
00137  P000E4  C8800200               LI        R1,WAADCRNX     I/O INDEX
00138  P000E8  F8B000C9  Y000C8       BL        WGHYBOOT
00139  P000EC  EC0005E5  P005E4       BU        ERROOT
00140                                *
00141                                *          COMES HERE TO SAVE LOGICAL TCR# AND SPLIT
00142                                *
00143  P000F0  AF900010  P00010  SAVELOGU LW      R7,*LOGUNIT     FETCH USER'S LOGICAL UNIT
00144  P000F4  AD000610  P00610          LW        R2,LTCRINX      STACK INDEX
00145  P000F8  D7C00620  P00620          STW       R7,LTCRTAB,R2
00146  P000FC  D7800614  P00614          STW       R7,CURRTCRL     SAVE THE CURRENT LOGICAL TCR #
00147  P00100  A2880613  P00613          ABM       29,LTCRINX      BUMP INDEX BY 1 WORD
00148  P00104  EC100001  P00000          BU        *RTN1           SPLIT
00150                                * TITLE: CONSTRUCT ADC CHANNEL PROGRAM(GRBADCPR)   REV. LEV  A000  L
00151                                * DATE:  AUGUST 1976
00152                                * COPYRIGHTED BY ELECTRONIC ASSOCIATES INC., 1976
00153                                * 600/32 VERSION
00154                                *
00155                                *          CALLING SEQUENCE
00156                                *
00157                                *          CALL GRBADCPR(LOGUNIT,IFCH,ILCH,NBLKS,VALARY,IHOLD)
00158                                *
00159                                *          INPUT ARGUMENTS:
00160                                *
00161                                *
00162                                *          LOGUNIT; THE IDENTICAL INTEGER VARIABLE OR CONSTANT
00163                                *                   THAT WAS EMPLOYED IN THE LAST CALL TO GSADCTCR
00164                                *          IFCH; INTEGER VARIABLE OR CONSTANT SPECIFYING
00165                                *                   THE FIRST ADC CHANNEL WITHIN THE BLOCK(S)
00166                                *          ILCH; INTEGER VARIABLE OR CONSTANT SPECIFYING
00167                                *                   THE LAST ADC CHANNEL WITHIN THE BLOCK(S)
00168                                *          NBLKS; INTEGER VARIABLE OR CONSTANT SPECIFYING THE
00169                                *                   NUMBER OF BLOCKS TO TRANSFER
00170                                *          VALARY; NAME OF THE ADC REAL INPUT ARRAY
00171                                *          IHOLD;  INTEGER VARIABLE OR CONSTANT THAT DECLARES IF THE
00172                                *                  ADC (S) ARE TO BE PLACED INTO HOLD STATE PRIOR
00173                                *                  TO CONVERSION AND READING
00174                                *              IF IHOLD = 1: THE ADC(S) WILL BE PUT INTO HOLD
00175                                *              IF IHOLD = 0: THE ADC(S) WILL REMAIN IN SAMPLE STATE
00176                                *
00177                                *          ERROR CONDITIONS:
00178                                *
00179                                *          1-    NO ERROR
00180                                *          40-   IFCH OR ILCH ILLEGAL
```

```
00181                                  *                41-   NBLKS TOO LARGE
00182                                  *                46-   TCB STACK OVERFLOW
00183                                  *                47-   ILLEGAL INOLD
00184                                  *                52-   ATTEMPT TO TRANSFER DATA OUTSIDE OF TASK AREA
00185                                  *                55-   CALLED AFTER GSADLOOP AND PRIOR TO GIADCP
00186                                  *                55-   CALLED AFTER GSADLOOP AND PRIOR TO GIADCP
00187                                  *                57-   LOGUNIT IS NOT THE IDENTICAL INTEGER VARIABLE OR
00188                                  *                      CONSTANT THAT WAS EMPLOYED IN THE LAST CALL TO
00189                                  *                      GSADCTCB
00190                                  *
00191  P00108                          RTN      RES        1W
00192  P0010C  04000108   P00108       GRBADCPR STW        R0,RTN
00193  P00110  F8800009   Y00008                ML         GFPR          PASS ARGUMENTS
00194  P00114  00000018                         DATAW      6W
00195  P00118                          LOGUNIT  RES        1W
00196  P0011C                          IFCH     RES        1W
00197  P00120                          ILCH     RES        1W
00198  P00124                          NBLKS    RES        1W
00199  P00128                          VALARY   RES        1W
00200  P0012C                          INOLD    RES        1W
00201  P00130  AD000108   P00108                LA         R2,RTN        PUT PROPER ADR OF USER'S
00202  P00134  D5000608   P00608                STW        R2,FORTLOC    LINK-IN INTO THE FORTLOC VARIABLE
00203  P00138  C9000048                         LI         R2,GWRBADCP   STORE ROUTINE IDENTIFIER
00204  P0013C  D5000604   P00604                STW        R2,ROUTNUM
00205  P00140  AD000600   P00600                LA         R2,LOOPFLG    CHECK FOR ERROR 55
00206  P00144  F2000561   P00560                BCF        ZW,ERR55
00207                                  *
00208                                  *                EDIT ALL ARGS PRIOR TO CONTROL WORD CONSTRUCTION
00209                                  *
00210  P00148  AC90011C   P0011C                LA         R1,*IFCH      EDIT 1ST CHANNEL
00211  P0014C  ED800569   P00568                BCT        LT,ERR40
00212  P00150  90800000   X00000                CAMW       R1,=0LSTADC
00213  P00154  ED000569   P00568                BCT        GT,ERR40
00214  P00158  AD900120   P00120                LA         R3,*ILCH      EDIT LAST CHANNEL
00215  P0015C  1190                           CAR        R1,R3
       P0015E       0002
00216  P00160  ED800569   P00568                BCT        LT,ERR40
00217  P00164  91800150   Y00150                CAMW       R3,=0LSTADC
00218  P00168  ED000569   P00568                BCT        GT,ERR40
00219  P0016C  AD100124   P00124                LA         R2,*NBLKS     EDIT NBLKS
00220  P00170  EF000571   P00570                BCT        LE,ERR41
00221                                  *
00222                                  *                DETERMINE IF # OF TRANSFERS ARE TOO LARGE
00223                                  *
00224  P00174  3D90                             SDR        R1,R3         R3 = ILCH-IFCH
       P00176       0002
00225  P00178  C9810001                         AUI        R3,1          R3 = ILCH-IFCH+1
00226  P0017C  C1100124   P00124                MPMW       R2,=NBLKS     R3 = (ILCH-IFCH+1)*NBLKS
00227  P00180  C981FFFF                         AUI        R3,-1         R3 = (ILCH-IFCH+1)*NBLKS - 1
00228  P00184  91800084   P00084                CAMW       R3,=X'FFFF'   GREATER THAN 16 BITS WIDE??
00229  P00188  ED000571   P00570                BCT        GT,ERR41
00230                                  *
00231                                  *                DETERMINE IF DAA + # OF TRANS OUTSIDE OF TASK BOUNDS
00232                                  *
00233  P0018C  01100128   P00128                LEA        R2,*VALARY    PICK UP ADR. OF VALARY
00234  P00190  85000088   P00088                ANMW       R2,=X'FFFFC'  STRIP AWAY POSSIBLE LEA BITS FOR 1
00235  P00194  2F20                             TRR        R2,R6         SAVE DAA IN R6
00236  P00196       2F80                        TRR        R3,R7
00237  P00198  73C2                             SLL        R7,2          R7 = 4*(# OF TRANS) FOR WORD ADDRESS
00238  P0019A       3970                        ADR        R7,R2         R2 = DAA +(4 OF TRANS IN WORDS)
00239  P0019C  91000FF8   P00FF8                CAMW       R2,TASKOL
00240  P001A0  EE800561   P00560                BCT        GE,ERR52      OUT OF BOUNDS
```

```
00241                                   *
00242                                   *              DOES THE LOGUNIT ARGUMENT MATCH THE ONE
00243                                   *              FROM THE LAST CALL TO WSADCTCR?
00244                                   *
00245  P001A4  AC900118     P00118            LW      R1,*LOGUNIT1
00246  P001A8  90800614     P00614            LAMW    R1,CURRTCRL
00247  P001AC  F2000501     P00500            BLF     EQ,ERR57
00248                                   *
00249                                   *              CONSTRUCT THE CPCW(S)  - CPCW1  IN R2
00250                                   *
00251  P001B0  2D60                              IBR     R6,R2          R2 HAS ADR OF DAA
       P001B2       0002
00252  P001B4  AF000004     Y00004            LW      R6,WGCSLNDX    FETCH CURRENTLY SELECTED CONSOLE
00253  P001B8  7357                              SLL     R6,23          SHIFT TO BITS 6-8
00254  P001BA       0960                         ORR     R6,R2          OR INTO CPCW1
00255  P001BC  AF10012C     P0012C            LW      R6,*INDCD      FETCH AND EDIT INDCD
00256  P001C0  EE0001C0     P001CC            BCT     EQ,$+3W
00257  P001C4  C8050001                        CI      R6,1
00258  P001C8  F2000599     P00598            BLF     EQ,ERR47
00259  P001CC  735A                              SLL     R6,26          SHIFT TO BIT 5.
00260  P001CE       0960                         ORR     R6,R2          OR INTO CPCW
00261                                   *
00262                                   *              CONSTRUCT CPCW2 IN  R6
00263                                   *
00264  P001D0  7100                              SLL     R5,16          SHIFT # OF TRANS TO BITS 0-15
00265  P001D2       2F30                         IBR     R5,R6          PLACE SHIFTED # OF TRANS IN R6
00266  P001D4  AF900120     P00120            LW      R7,*ILCH       FETCH LAST CHANNEL
00267  P001D8  73C8                              SLL     R7,8           MOVE TO BITS 16-23
00268  P001DA       0B70                         ORR     R7,R6          "OR" IN LAST CHANNEL
00269  P001DC  AC90011C     P0011C            LW      R1,*IFCH       FETCH 1ST CHANNEL
00270  P001E0  0B10                              ORR     R1,R6          "OR" IN FIRST CHANNEL
       P001E2       0002
00271  P001E4  AD80061C     P0061C            LW      R5,TCRINDEX    FETCH TCR INDEX ADR CHECK OVERFLOW
00272  P001E8  C9850010                        CI      R5,4W
00273  P001EC  EE000591     P00590            BCT     GT,ERR46
00274  P001F0  C8800001                        CI      R1,WLADCCPX    I/O INDEX
00275  P001F4  AF800618     P00618            LW      R7,CURRTCRP    FETCH PHYSICAL TCR #
00276  P001F8  F8800E9     Y000E8            BL      WGNYB001
00277  P001FC  EC000201     P00200            BU      $+1W           NO ERROR POSSIBLE
00278  P00200  A208061F     P0061F            ABM     2B,TCRINDEX    BUMP TCRINDEX BY 2 WORDS
00279  P00204  F800060C     P0060C            ZMW     CHNFLG         RESET THE CHAIN FLAG
00280  P00208  988805FF     P005FF            SBM     $1,WRADFLG     SET WRADFLG TO SIGNIFY THAT THIS
00281                                   *                            ROUTINE HAS BEEN CALLED
00282  P0020C  EC100609     P00608            BU      *FORTLOC       SPLIT
00284                                   * TITLE: CHAIN AUC CONTROL WORDS(WSADCHN)    REV. LEV. A000        L
00285                                   * DATE:  AUGUST 1976
00286                                   * COPYRIGHTED BY ELECTRONIC ASSOCIATES INC., 1976
00287                                   * 000732 VERSION
00288                                   *
00289                                   *              CALLING SEQUENCE:
00290                                   *
00291                                   *              CALL WSADCHN(LOGUNIT)
00292                                   *
00293                                   *              ARGUMENT:
00294                                   *              LOGUNIT:  THE IDENTICAL INTEGER VARIABLE OR CONSTANT THAT
00295                                   *                        WAS EMPLOYED IN THE LAST CALL TO WSADCTCR
00296                                   *
00297                                   *              ERROR CONDITIONS
00298                                   *
00299                                   *              1-     NO ERROR
00300                                   *              49-    ATTEMPT TO CALL THIS ROUTINE PRIOR
00301                                   *                     TO CALLING WRBADCPR
```

```
00302                                  *              55-   CALLED AFTER WSADLOOP AND PRIOR TO WIADCP
00303                                  *              57-  LOGUNIT DIFFERS FROM THE LAST ONE EMPOLYED IN THE
00304                                  *                   LAST CALL TO WSADCTCR
00305                                  *              59-  MORE THAN TWO CALLS TO THIS ROUTINE WITH THE SAME
00306                                  *                   LOGUNIT PRIOR TO A CALL TO WIADCP
00307                                  *
00308  P00210                          WSADCHN  EQU       $
00309  P00210  C900004D                        LI        R2,WWSADCHN      STORE ROUTINE IDENTIFIER
00310  P00214  D5000604    P00604              STW       R2,ROUTNUM
00311  P00218  D4000608    P00608              STW       R0,FORTLOC       STORE FORTRAN LOCATION
00312  P0021C  AFA00000     00000              LW        R7,0,R1          FETCH LOGUNIT
00313  P00220  93800614    P00614              CAMW      R7,CURRTCRL      IS IT = OF CURRENT LOGUNIT?
00314  P00224  F2000501    P005D0              BCF       E0,ERR57
00315  P00228  AD000600    P00600              LW        R2,LOOPFLG       CHECK FOR ERROR 55
00316  P0022C  F2000501    P005C0              BCF       2R,ERR55
00317  P00230  AC0005FC    P005FC              LW        R1,WRADFLG       IF WRADFLG = 0 => NO CP TO CHAIN FROM
00318  P00234  EE0005A1    P005A0              BCI       2R,ERR49
00319  P00238  AD80061C    P0061C              LW        R3,TCRINDEX      FETCH DYNAMIC TCR INDEX
00320  P0023C  C9850014                        CI        R3,5W            HAS HE OVER CHAINED?
00321  P00240  ED0005E1    P005E0              BCI       G1,ERR59
00322  P00244  C981FFF8                        ADI       R3,-2W           GO BACK 2 SPACES
00323  P00248  C8800002                        LI        R1,WCHADCPX      I/O INDEX
00324  P0024C  AF800618    P00618              LW        R7,CURRTCRP      FETCH PHYSICAL TCR #
00325  P00250  F8000IF9    Y001F8              BL        WGHYBOOT
00326  P00254  EC000259    P00258              BU        $+1W             NO ERROR POSSIBLE
00327  P00258  988800DF    P0060F              SBM       7,CHNFLG+3       IF THIS FLAG IS STILL 1 WHEN EQIPCP
00328                                  *                                  IS CALLED "> WSADCHN HAS BEEN CALLED
00329                                  *                                  WITHOUT A CALL TO WRHADCPR.
00330  P0025C  EC100609    P00608              BU        *FORTLOC         SELIT
00332                                  * TITLE: LOOP ADC CHANNEL PROGRAM(WSADLOOP)  REV. LEV. A000        L
00333                                  * DATE:  AUGUST 1976
00334                                  * COPYRIGHTED BY ELECTRONIC ASSOCIATES INC., 1976
00335                                  * 600/32 VERSION
00336                                  *
00337                                  *              CALLING SEQUENCE
00338                                  *
00339                                  *               CALL WSADLOOP(LOGUNIT)
00340                                  *
00341                                  *               ARGUMENT
00342                                  *               LOGUNIT; THE IDENTICAL INTEGER VARIABLE OR CONSTANT
00343                                  *                        THAT WAS EMPLOYED IN THE LAST CALL TO WSADCTCR
00344                                  *
00345                                  *               ERROR CONDITIONS
00346                                  *
00347                                  *               1-    NO ERROR
00348                                  *               49-   CALLED WITHOUT CALLING WRHADCPR
00349                                  *               55-   CALLED AFTER WSADLOOP AND PRIOR TO WIADCP
00350                                  *               57-  LOGUNIT IS NOT THE IDENTICAL INTEGER VARIABLE OR
00351                                  *                    CONSTANT THAT WAS EMPOLYED IN THE LAST CALL TO
00352                                  *                    WSADCTCR
00353                                  *
00354  P00260                          WSADLOOP EQU       $
00355  P00260  C900004F                        LI        R2,WWSADLOO      STORE ROUTINE IDENTIFIER
00356  P00264  D5000604    P00604              STW       R2,ROUTNUM
00357  P00268  D4000608    P00608              STW       R0,FORTLOC       STORE FORTRAN LOCATION
00358  P0026C  AD000600    P00600              LW        R2,LOOPFLG       CHECK FOR ERROR 55
00359  P00270  F2000501    P005C0              BCF       2R,ERR55
00360                                  *
00361                                  *               DOES THE LOGUNIT ARGUMENT MATCH THE ONE
00362                                  *               FROM THE LAST CALL TO WSADCTCR?
00363                                  *
00364  P00274  AFA00000     00000              LW        R7,0,R1          FETCH LOGUNIT
```

```
00365  P00278  93800614   P00614          CAMW    R7,CURRICRL
00366  P0027C  F2000501   P00500          BCF     EQ,ERR57
00367                                 *
00368                                 *          HAS GRBADCPR BEEN CALLED?
00369                                 *
00370  P00280  AC8005FC   P005FC          LW      R1,GRADFLG
00371  P00284  EE0005A1   P005A0          BCT     ZR,ERR49
00372                                 *
00373                                 *          SET CHAIN IN THE LAST CPCW
00374                                 *
00375  P00288  AD80061C   P0061C          LW      R3,ICRINDEX     FETCH ICR INDEX
00376  P0028C  C981FFF8                  ADI     R3,-2W          GO BACK 2 SPACES
00377  P00290  C8800602                  LI      R1,WCHADCPX     INDEX TO CHAIN
00378  P00294  AF800618   P00618         LW      R7,CURRICRP     FETCH CURRENT PHYSICAL ICR #9
00379  P00298  F8800251   P00250         BL      WAITBUSY
00380  P0029C  EC0002A1   P002A0         BU      $+1W            NO ERROR POSSIBLE
00381                                 *
00382                                 *          LOOP 11
00383                                 *
00384  P002A0  AD80061C   P0061C          LW      R3,ICRINDEX     ICR INDEX
00385  P002A4  C8800603                  LI      R1,WCPADCPX     I/O INDEX
00386  P002A8  F8800299   P00298         BL      WAITBUSY
00387  P002AC  EC000281   P00280         BU      $+1W            NO ERROR POSSIBLE
00388                                 *
00389                                 *          NOW LOOPFLG #1 SO GIADCP = ONLY VALID CALL
00390                                 *
00391  P002B0  A3880603   P00603         ADM     7,LOOPFLG+3$
00392  P002B4  F800060C   P0060C         ZRW     CHNFLG          RESET THE CHAIN FLAG
00393  P002B8  EC100609   P00608         BU      *FORTLOC
00395                                 * TITLE: INITIATE AN ADC CHANNEL PROGRAM(GIADCP) REV. LEV. A000    L
00396                                 * DATE:  AUGUST 1976
00397                                 * COPYRIGHTED BY ELECTRONIC ASSOCIATES INC., 1976
00398                                 * 600/32 VERSION
00399                                 *
00400                                 *          CALLING SEQUENCE:
00401                                 *
00402                                 *          CALL GIADCP(LOGUNIT)
00403                                 *
00404                                 *          ARGUMENTS:
00405                                 *          LOGUNIT; THE IDENTICAL INTEGER VARIABLE OR CONSTANT THAT
00406                                 *                   WAS EMPLOYED IN THE LAST CALL TO GSADCTCR
00407                                 *
00408                                 *          ERROR CONDITIONS:
00409                                 *
00410                                 *          1-    NO ERROR
00411                                 *          26-   HYBRID I/O TIMED OUT
00412                                 *          44-   NO VALID CHANNEL PROGRAM HAS BEEN CONSTRUCTED
00413                                 *          57-   LOGUNIT DIFFERS FROM THE LAST ONE USED IN THE
00414                                 *                LAST CALL TO GSADCTCR
00415                                 *
00416  P002BC                         GIADCP  EQU     $
00417  P002BC  C9000050                  LI      R2,NGIADCP      STORE ROUTINE IDENTIFIER
00418  P002C0  D5000604   P00604         STW     R2,ROUTNUM
00419  P002C4  D4000608   P00608         STW     R0,FORTLOC      STORE FORTRAN LOCATION
00420                                 *
00421                                 *          IS LOGUNIT THE SAME AS LAST CALL TO GSADCTCR?
00422                                 *
00423  P002C8  AFA00000    00000         LW      R7,0,R1         FETCH LOGUNIT
00424  P002CC  93800614   P00614         CAMW    R7,CURRICRL
00425  P002D0  F2000501   P00500         BCF     EQ,ERR57
00426                                 *
00427                                 *          HAS GRBADCPR BEEN CALLED
00428                                 *
```

```
00429  P00204  AD0005FC   P005FC          LW      R2,WRADFLG
00430  P00208  EE000589   P00588          BCT     ZR,ERR44
00431                              *
00432                              *          HAS WSADCHN BEEN CALLED AND NOT A CALL TO WRBADPR
00433                              *          WHICH WOULD ALLOW THE DCM TO ACCESS A CONTROL
00434                              *          DOUBLEWORD OF GARBAGE
00435                              *
00436                              *
00437  P002DC  AD00060C   P0060C          LW      R2,CHNFLG
00438  P002E0  F2000589   P00588          BCF     ZR,ERR44
00439                              *
00440                              *          LET'S POP THE CLUTCH
00441                              *
00442                              *
00443                              *          DATA WORD = PICK IS IN BITS 1-5
00444                              *
00445  P002E4  AD000618   P00618          LW      R2,CORRTCRP
00446  P002E8  715A                      SLL     R2,26
       P002EA      0002
00447  P002EC  C8800201                  LI      R1,WWADCPRX     INDEX TO START ADC CHANNEL PROGRAM
00448  P002F0  F88002A9   Y002A8         BL      WWMYBOUT
00449  P002F4  EC0005E5   P005E4         BU      ERROUT          MIOCS HAS DETECTED ERROR 26
00450                              *
00451                              *          RESET FLAGS
00452                              *
00453  P002F8  F80005FC   P005FC          ZMW     WRADFLG
00454  P002FC  F8000600   P00600          ZMW     LOOPFLG
00455  P00300  F80006OC   P0060C          ZMW     CHNFLG
00456  P00304  EC100609   P00608          BU      *FORTLOC        SPLIT
00458                              * TITLE: DIGITALLY ACTIVATE A BLOCK OF ADC'S(WSADCTRA) REV. LEV. A000  L
00459                              * DATE:  APRIL 4 1976
00460                              * COPYRIGHTED BY ELECTRONIC ASSOCIATES INC., 1976
00461                              * 800/32 VERSION
00462                              *
00463                              *          CALLING SEQUENCE
00464                              *
00465                              *          CALL WSADCTRA(LOGUNIT)
00466                              *
00467                              *          INPUT ARGUMENT:
00468                              *
00469                              *          LOGUNIT: THE IDENTICAL INTEGER VARIABLE OR CONSTANT
00470                              *                   THAT WAS EMPLOYED IN A PREVIOUS CALL
00471                              *                   TO WSADCTCR
00472                              *
00473                              *          ERROR CONDITIONS:
00474                              *
00475                              *          26=  HYBRID I/O TIMED OUT
00476                              *          57   LOGUNIT HAS NOT BEEN PREVIOUSLY DEFINED
00477                              *               VIA A PRIOR CALL TO WSADCTCR
00478                              *
00479  P00308                      WSADCTRA EQU    $
00480  P00308  D4000608   P00608          STW     R0,FORTLOC      SAVE LINK-OUT
00481  P0030C  C900005F                   LI      R2,RGSADCTR     ROUTINE ID
00482  P00310  D5000604   P00604          STW     R2,ROUTNUM
00483  P00314  AE200000    00000          LW      R4,0,R1         FETCH LOGICAL TCR #.
00484  P00318  F86004BD   P004BC          BL      TCRMAP          FETCH PHYSICAL TCR IN BITS 1-5 OF R2
00485  P0031C  C8800202                   LI      R1,WSADCRWX     I/O INDEX
00486  P00320  F88002F1   Y002F0         BL      WWMYBOUT
00487  P00324  EC0005E5   P005E4         BU      ERROUT          MIOCS DETECTED ERROR 26
00488  P00328  EC100609   P00608          BU      *FORTLOC        SPLIT
```

```
00490                                  * TITLE: HALT AN ADC CHANNEL PROGRAM(GHADCP)        REV. LEV. A000  L
00491                                  * DATE:  APRIL 5 1976
00492                                  *COPYRIGHTED BY ELECTRONIC ASSOCIATES, INC., 1976
00493                                  * 600/32 VERSION
00494                                  *
00495                                  *                CALLING SEQUENCE:
00496                                  *
00497                                  *                CALL GHADCP(LOGUNIT)
00498                                  *
00499                                  *                ARGUMENT:
00500                                  *
00501                                  *                LOGUNIT; THE IDENTICAL INTEGER VARIABLE OR CONSTANT
00502                                  *                         THAT WAS EMPLOYED IN A PREVIOUS CALL TO
00503                                  *                         GSDAMTCR
00504                                  *
00505                                  *                ERROR CONDITIONS:
00506                                  *
00507                                  *                26-  HYBRID I/O TIMED OUT
00508                                  *                56-  DCM FAILED TO HALT
00509                                  *                57-  LOGUNIT HAS NOT BEEN PREVIOUSLY DEFINED
00510                                  *                     VIA A PRIOR CALL TO GSDAMTCR
00511                                  *
00512  P0032C                          GHADCP   EQU       $
00513  P0032C  D4000608    P00608               STW       R0,FORTLOC       SAVE LINK-OUT
00514  P00330  D5000604    P00604               STW       R2,ROUTNUM       SAVE ROUTINE ID
00515                                  *
00516                                  *                CALCULATE THE INDEX TO FETCH THE
00517                                  *                PHYSICAL TCR NUMBER
00518                                  *
00519  P00334  AE200000     00000               LW        R4,0,R1          FETCH LOGUNIT
00520  P00338  F8000480    P0048C               BL        TCRMAP           FETCH PHYSICAL TCR IN BITS 1-5 OF R2
00521  P0033C  C8800203                         LI        R1,GHADCCPX      I/O INDEX
00522  P00340  F8000321    X00320               BL        GDMYBOUT
00523  P00344  EC0005E5    P005E4               BU        ERROUT           HIOCS DETECTED ERROR 26
00524                                  *
00525                                  *                READ STATUS TO SEE IF IT ACTUALLY DID HALT
00526                                  *
00527  P00348  C8800100                         LI        R1,GRADSTAX      I/O INDEX
00528  P0034C  2FA0                             TBR       R2,R7
       P0034E       0002
00529  P00350  F8000001    X00000               BL        GDMYBIN
00530  P00354  EC0005E5    P005E4               BU        ERROUT           HIOCS DETECTED ERROR 26
00531  P00358  2420                             TBR       R2,0
       P0035A       0002
00532  P0035C  EC8005C9    P005C8               BCT       SET,ERR56        STILL BUSY
00533                                  *
00534                                  *                RESET FLAGS TO ENABLE THE USER TO RE-CONSTRUCT A CHANNEL
00535                                  *                PROGRAM USING THE SAME TCR
00536                                  *
00537  P00360  F8000600    P00600               ZMW       LOOPFLG
00538  P00364  F800060C    P0060C               ZMW       CHNFLG
00539  P00368  F80005FC    P005FC               ZMW       GRADFLG
00540  P0036C  F800061C    P0061C               ZMW       TCRINDEX
00541  P00370  EC100609    P00608               BU        *FORTLOC         SPLIT CITY
00543                                  * TITLE: READ ADC CHANNEL PROGRAM STATUS(GRADSI) REV. LEV. A000  L
00544                                  * DATE:  AUGUST 1976
00545                                  * COPYRIGHTED BY ELECTRONIC ASSOCIATES INC., 1976
00546                                  * 600/32 VERSION
00547                                  *
00548                                  *                CALLING SEQUENCE:
00549                                  *                CALL GRADSI(LOGUNIT,INUSY,TCR)
00550                                  *
```

```
00551                                  *              ARGUMENTS:
00552                                  *              LOGUNIT;  THE IDENTICAL INTEGER VARIABLE OR CONSTANT
00553                                  *                        THAT WAS EMPLOYED IN A PREVIOUS CALL TO
00554                                  *                        QSADCTCR
00555                                  *              IBUSY; INTEGER VARIABLE WHICH REFLECTS IF AN ADC CHANNEL
00556                                  *                     PROGRAM IS ACTIVE  IBUSY =1 => CP IN OPERATION
00557                                  *              ICR;  INTEGER VARIABLE WHICH REFLECTS THE NUMBER OF
00558                                  *                     DATA TRANSFERS REMAINING
00559                                  *
00560                                  *              ERROR CONDITIONS:
00561                                  *              26 - HYBRID I/O TIMED OUT
00562                                  *              57-  LOGUNIT HAS NOT BEEN PREVIOUSLY DEFINED
00563                                  *                   VIA A CALL TO QSCANTCR
00564  P00374                          RTN2     RES      1W
00565  P00378  D4000374   P00374       QRADSI   STW      R0,RTN2
00566  P00370  F8800111   Y00110                BL       UEPR
00567  P00380  000000C                          DATAW    3W
00568  P00384                          LOGUNITS RES      1W
00569  P00388                          IBUSY    RES      1W
00570  P003BC                          ICR      RES      1W
00571                                  *
00572                                  *              CALCULATE THE INDEX TO FETCH THE PHYSICAL
00573                                  *              ICR NUMBER
00574                                  *
00575  P00390  AC800374   P00374                LW       R1,RTN2
00576  P00394  D4800608   P00608                STW      R1,FORTLOC
00577  P00398  C8800055                         LI       R1,NQRADSI      ROUTINE ID
00578  P0039C  D4800604   P00604                STW      R1,ROUTNUM
00579  P003A0  AE100384   P00384                LW       R4,*LOGUNITS    FETCH LOGUNIT
00580  P003A4  F88004BD   P004BC                BL       ICRMAP          FETCH PHYSICAL ICR IN BITS 1-5 OF R2
00581  P003A8  C8800100                         LI       R1,QRADSIAX     I/O INDEX
00582  P003AC  2FA0                             IRR      R2,R7
00582  P003AC  2FA0                             IRR      R2,R7
       P003AE       0002
00583  P00380  F8800351   Y00350                BL       QQMYBIN
00584  P00384  EC0005E5   P005E4                BO       ERRHDT          MODES DETECTED ERROR 26
00585  P00388  2DA6                             IRR      R2,R3
00586  P003BA       /11F                        SRL      R2,31           SHIFT BUSY BIT TO BIT 31
00587  P003BC  D5100388   P00388                STW      R2,*IBUSY       PASS TO USER
00588  P003C0  91800664   P00664                LAMW     R5,=X'FFFF'     SPECIAL CASE FOR NO TRANSFERS LEFT
00589  P003C4  EE0003D5   P003D4                BCT      EQ,ZED
00590  P003C8  C9810001                         ADI      R5,1            BUMP BY ONE (H/W COUNT LESS BY 1)
00591  P003CC  D590038C   P0038C   STORECR      STW      R5,*ICR
00592  P003D0  EC100375   P00374                BO       *RTN2           SPLIT
00593  P003D4  0DB0                     ZED     ZR       R3              NO COUNTS
       P003D6       0002
00594  P003D8  EC0003C0   P003CC                BO       STORECR
00596                                  * TITLE: LOAD A ADC DCR TIMER(QRADDCMT)      REV. LEV A000          L
00597                                  * DATE:  AUGUST 1976
00598                                  * COPYRIGHTED BY ELECTRONIC ASSOCIATES INC., 1976
00599                                  * 600/32 VERSION
00600                                  *
00601                                  *              CALLING SEQUENCE:
00602                                  *
00603                                  *              CALL QRADDCMT(LOGUNIT,TIME)
00604                                  *
00605                                  *              ARGUMENTS:
00606                                  *
00607                                  *              LOGUNIT; THE IDENTICAL INTEGER VARIABLE OR CONSTANT THAT
00608                                  *                       WAS EMPLOYED IN A PREVIOUS CALL TO QSADCTCR
00609                                  *              TIME;    INTEGER VARIABLE OR CONSTANT SPECIFYING THE TIME
00610                                  *                      OR NUMBER OF COUNTS IN USECS. TO BE LOADED
00611                                  *
```

```
00612                                  *                ERROR CONDITIONS:
00613                                  *
00614                                  *                26- HYBRID I/O TIMED OUT
00615                                  *                31- ILLEGAL TIME
00616                                  *                57- LOGUNIT HAS NOT BEEN DEFINED
00617                                  *
00618  P003DC                          RIN4     RES     1W
00619  P003E0  D40003DC    P003DC      GRADDCMI STW     R0,RIN4
00620  P003E4  F8800370    Y0037C               BL      GFPR          PASS THE ARGUMENT ADDRESSES
00621  P003E8  00000008                         DATAW   2W
00622  P003EC                          LOGUNIT4 RES     1W
00623  P003F0                          TIME4    RES     1W
00624  P003F4  C8800061                         LI      R1,NGRADDCM   ROUTINE ID
00625  P003F8  D4800604    P00604               STW     R1,ROUTNUM
00626  P003FC  AC8003DC    P003DC               LW      R1,RIN4       SAVE FORTRAN LOCATION
00627  P00400  D4800608    P00608               STW     R1,FORTLOC
00628  P00404  AE1003EC    P003EC               LW      R4,*LOGUNIT4  FETCH LOGICAL TCR UNIT
00629  P00408  F8800480    P00480               BL      TCRMAP        FETCH PHYSICAL TCR NUMBER
00630  P0040C  BD00006A8   P006A8               SUMW    R2,TIMEKAD    SUB 1 TO CHANGE ADR RANGE FROM
00631  P00410  7142                             SLL     R2,2          1-6 TO 0-5
       P00412      0002
00632  P00414  890006AC    P006AC               ORMW    R2,ADCTIMER   ADC GROUP BIT
00633  P00418  AE1003F0    P003F0               LW      R4,*TIME4     FETCH TIME VALUE
00634  P0041C  92000680    P00680               CAMW    R4,MAXTIME    = 1048575
00635  P00420  ED000559    P00558               BGT     GT,ERR31
00636  P00424  0940                             ORR     R4,R2
       P00426      0002
00637  P00428  C8800401                         LI      R1,GRADTRXB   I/O INDEX
00638  P0042C  F8800341    Y00340               BL      GGHYBOUT
00639  P00430  EC0005E5    P005E4               BU      ERROUT        HIOCS DETECTED ERROR 26
00640  P00434  EC1003DD    P003DC               BU      *RIN4         SPLIT
00642                                  * TITLE: READ AN ADC TIMER(GRADDCMI)                REV. LEV. A000  L
00643                                  * DATE:  APRIL 1977
00644                                  * COPYRIGHTED BY ELECTRONIC ASSOCIATES INC., 1976
00645                                  * 000732 VERSION
00646                                  *
00647                                  *                CALLING SEQUENCE:
00648                                  *
00649                                  *                CALL GRADDCMI(LOGUNIT,TIME)
00650                                  *
00651                                  *                ARGUMENTS:
00652                                  *
00653                                  *                LOGUNIT; THE IDENTICAL INTEGER VARIABLE OR CONSTANT THAT
00654                                  *                         WAS EMPLOYED IN A PREVIOUS CALL TO GSADCTCR
00655                                  *                TIME;    INTEGER VARIABLE WHERE THE COUNTS WILL BE
00656                                  *                         RETURNED
00657                                  *
00658                                  *                ERROR CONDITIONS
00659                                  *
00660                                  *                26- HYBRID I/O TIMED OUT
00661                                  *                57- LOGUNIT HAS NOT BEEN PREVIOUSLY DEFINED VIA
00662                                  *                    A CALL TO GSADCTCR
00663                                  *
00664  P00438                          RIN5     RES     1W
00665  P0043C  D4000438    P00438      GRADDCMI STW     R0,RIN5
00666  P00440  F88003E5    Y003E4               BL      GFPR
00667  P00444  00000008                         DATAW   2W
00668  P00448                          LOGUNIT5 RES     1W
00669  P0044C                          TIME5    RES     1W
00670  P00450  C8800063                         LI      R1,NGRADDCM   ROUTINE ID
00671  P00454  D4800604    P00604               STW     R1,ROUTNUM
00672  P00458  AC800438    P00438               LW      R1,RIN5       FORTRAN LOCATION
```

```
00673  P0045C  D4800608   P00608          STW     R1,FORTLOC
00674  P00460  AE100448   P00448          LW      R4,*LOGUNITS     FETCH LOGICAL TCR UNIT
00675  P00464  F8800480   P0048C          BL      TCRMAP           FETCH PHYSICAL TCR NUMBER
00676  P00468  B00006A8   P006A8          SUMW    R2,TIMERAD       SUB 1 TO CHANGE ADR RANGE FROM
00677  P0046C  7142                       SLL     R2,2             1-6 TO 0-5
       P0046E      0002
00678  P00470  890006AC   P006AC          ORMW    R2,ADCTIMER      ADC GROUP BIT
00679  P00474  2FA0                       IRR     R2,R7
       P00476      0002
00680  P00478  D7800640   P006A0          STW     R7,CURRTIM       SAVE CURRENT ADC TIMER ADDRESS
00681  P0047C  C980FFFB                   LI      R3,-5
00682  P00480  C8800300                   LI      R1,GRADTRXS      I/O INDEX
00683  P00484  F8800381   Y003B0   RADC1  BL      GWMYBIN          SET UP TO READ ADC TIMER
00684  P00488  EC0005E5   P005E4          BU      ERR001
00685  P0048C  C8800301                   LI      R1,GRADTRXB
00686  P00490  F8800485   Y00484          BL      GWMYBIN          READ ADC TIMER
00687  P00494  EC0005E5   P005E4          BU      ERR001
00688  P00498  2E20                       IRR     R2,R4
       P0049A      0002
00689  P0049C  860006A4   P006A4          ANMW    R4,TIMEADRL
00690  P004A0  920006A0   P006A0          CAMW    R4,CURRTIM       MAKE SURE TIMER ADR COMPARES
00691  P004A4  EE000481   P00480          BCT     EQ,RADC2
00692  P004A8  F5800485   P00484          BIB     R3,RADC1
00693  P004AC  EC000561   P00560          BU      ERR34
00694  P004B0  850006B0   P006B0   RADC2  ANMW    R2,MAXTIME       REMOVE TIMER ADDRESS
00695  P004B4  D510044C   P0044C          STW     R2,*TIMES        PASS TIME TO USER
00696  P004B8  EC100439   P00438          BU      *RTNS            SPLIT CITY!
00697  P004BC                      TCRMAP  EQU     $
00698                               *
00699                               *               FIND THE CORRESPONDING PHYSICAL TCR #
00700                               *               AS A FUNCTION OF THE LOGICAL TCR NUM
00701                               *
00702  P004BC  C980FFEB                   LI      R3,-6W           R3 = ITERATION AND INDEX
00703  P004C0  92600670   P00670   TRARCRF CAMW    R4,TRRLUTAB,R3
00704  P004C4  EE000401   P00400          BCT     EQ,$+3W
00705  P004C8  F5C004C1   P004C0          BIB     R3,TRARCRF
00706  P004CC  EC000501   P00500          BU      ERR57            LOGUNIT IS UNDEFINED
00707  P004D0  C9810018                   ADI     R3,6W            R3 = INDEX OF PHYSICAL TCR TABLE
00708  P004D4  AD000638   P00638          LW      R2,PTCRTAB,R3    FETCH PHYSICAL TCR #.
00709  P004D8  715A                       SLL     R2,26            MOVE TO BITS 1-5
00710  P004DA      2800                   IRSW    R0               RETURN
00712                               * TITLE: START ADC DLM TIMER(S) (GSADTMR)     REV. LEV. A000          L
00713                               * DATE:  JULY 1977
00714                               * COPYRIGHTED BY ELECTRONIC ASSOCIATES INC., 1977
00715                               * 600/32 VERSION
00716                               *
00717                               *               CALLING SEQUENCE:
00718                               *
00719                               *               CALL GSTADTMR(LOARRAY)
00720                               *
00721                               *               INPUT ARGUMENT:
00722                               *
00723                               *               LOARRAY: INTEGER ARRAY THAT CONTAINS THE LOGICAL UNITS,
00724                               *                        AS SPECIFIED IN CALL(S) TO GSADCTCR, OF ALLOCATED
00725                               *                        ADC TRANSFER CONTROL REGISTERS THAT EMPLOY THE
00726                               *                        TIMERS. THE LAST ELEMENT OF LOARRAY MUST BE A
00727                               *                        -1.
00728                               *
00729                               *               ERROR CONDITION.
00730                               *
00731                               *               26 - HYBRID I/O TIMED OUT
00732                               *               57 - A MEMBER OF LOARRAY HAS NOT BEEN ALLOCATED FOR
```

```
00733                                  *                    TIMER USAGE
00734  P004DC  D4000608    P00608    WSTADTMR STW     R0,FORTLOC      SAVE LINK-OUT
00735  P004E0  C800006A                        LI      R0,NWSTADTM
00736  P004E4  D4000604    P00604              STW     R0,ROUTNUM      SAVE ROUTINE I.D.
00737  P004E8  0D20                            ZR      R2              ZERO OUT DATA WORD
       P004EA      0002
00738  P004EC  F8800519    P00518              BL      LTOPTMR         PROCESS FIRST LOARRAY MEMBER
00739  P004F0  EC000501    P00500              BU      ERR57           1ST ELEMENT IS INVALID
00740  P004F4  C800FFFA                        LI      R6,-6           MAX OF 5 MORE LOGICAL UNITS
00741  P004F8  F8800519    P00518    LOOPTMR   BL      LTOPTMR         KEEP PROCESING LOARRAY MEMBERS
00742  P004FC  EC000509    P00508              BU      FINITMR
00743  P00500  F70004F9    P004F8              BTB     R6,LOOPTMR
00744  P00504  EC000501    P00500              BU      ERR57           NO DELINETER FOUND
00745  P00508  C8800402                FINITMR LI      R1,WSTADTMX     I/O INDEX
00746  P0050C  F8800420    P0042C              BL      WOMYBOUT
00747  P00510  EC0005E5    P005E4              BU      ERROUT          ERROR 26 ENCOUNTERED
00748  P00514  EC100609    P00608              BU      *FORTLOC        SPLIT
00749                                  *
00750                                  *              FOLLOWING SUBROUTINE MAPS LOGICAL TCR UNITS OF TCR'S THAT
00751                                  *              EMPLOY TCR TIMERS TO THE PHYSICAL TIMERS AND PACKS THE
00752                                  *              PHYSICAL TCR BITS IN 1-6 OF R2
00753                                  *
00754  P00518  AFA00000     00000    LTOPTMR LW       R7,0,R1         FETCH CURRENT LOARRAY ELEMENT
00755  P0051C  C885FFFF                        LI      R7,-1
00756  P00520  F2000529    P00528              BCF     EQ,$+2W
00757  P00524  2800                            TRSW    R0              RETURN DELIMETER FOUND OR 1ST
00758                                  *                               ELEMENT = A BOGUS -1
       P00526      0002
00759  P00528  C980FFE8                        LI      R3,-6W          USE R3 AS INDEX THROUGH TMRLUTAB
00760  P0052C  AEE00688    P00688    TMRMAPX LW       R5,TMRLUTAB+6W,R3 FETCH 1ST/NEXT TMRLUTAB ELEMENT
00761  P00530  1300                            LAR     R5,R7           = ?
       P00532      0002
00762  P00534  EE000541    P00540              BCT     EQ,TMRMATCH
00763  P00538  F5C0052D    P0052C              BTW     R3,TMRMAPX
00764  P0053C  2800                            TRSW    R0              ERROR RETURN NO MATCH FOUND
       P0053E      0002
00765  P00540  C9810018                TMRMATCH ADI     R3,6W           FORM INDEX FOR PHYSICAL TCR PICK-UP
00766  P00544  ADE00638    P00638              LW      R3,PTCRTAB,R3   R3 HAS THE PHYSICAL TCR #
00767  P00548  71C1                            SLL     R3,1            R3 = HALF WORD INDEX
       P0054A      0002
00768  P0054C  AEE00687    P00686              LH      R5,R2BITTAB-1H,R3 CONSTRUCT PROPER SET BIT IN R2
00769  P00550  0950                            ORR     R5,R2
00770  P00552      2283                        ABR     R0,29           BUMP LINK OUT BY 1 WORD
00771  P00554  2293                            ABR     R1,29           LOOK AT NEXT LOARRAY MEMBER
00772  P00556      2800                        TRSW    R0              GOOD RETURN
00774                                  *
00775                                  *                                    ERROR PROCS. AND STORAGE AREAS
00776                                  *
00777  P00558  C900001F                ERR31   LI      R2,31
00778  P0055C  EC0005E5    P005E4              BU      ERROUT
00779  P00560  C9000022                ERR34   LI      R2,34
00780  P00564  EC0005E5    P005E4              BU      ERROUT
00781  P00568  C9000028                ERR40   LI      R2,40
00782  P0056C  EC0005E5    P005E4              BU      ERROUT
00783  P00570  C9000029                ERR41   LI      R2,41
00784  P00574  EC0005E5    P005E4              BU      ERROUT
00785  P00578  C900002A                ERR42   LI      R2,42
00786  P0057C  EC0005E5    P005E4              BU      ERROUT
00787  P00580  C900002B                ERR43   LI      R2,43
00788  P00584  EC0005E5    P005E4              BU      ERROUT
00789  P00588  C900002C                ERR44   LI      R2,44
00790  P0058C  EC0005E5    P005E4              BU      ERROUT
```

```
00791  P00590  C900002E                ERR46   LI      R2,46
00792  P00594  EC0005E5   P005E4               BU      ERROUT
00793  P00598  C900002F                ERR47   LI      R2,47
00794  P0059C  EC0005E5   P005E4               BU      ERROUT
00795  P005A0  C9000031                ERR49   LI      R2,49
00796  P005A4  EC0005E5   P005E4               BU      ERROUT
00797  P005A8  C9000033                ERR51   LI      R2,51
00798  P005AC  EC0005E5   P005E4               BU      ERROUT
00799  P005B0  C9000034                ERR52   LI      R2,52
00800  P005B4  EC0005E5   P005E4               BU      ERROUT
00801  P005B8  C9000035                ERR53   LI      R2,53
00802  P005BC  EC0005E5   P005E4               BU      ERROUT
00803  P005C0  C9000037                ERR55   LI      R2,55
00804  P005C4  EC0005E5   P005E4               BU      ERROUT
00805  P005C8  C9000038                ERR56   LI      R2,56
00806  P005CC  EC0005E5   P005E4               BU      ERROUT
00807  P005D0  C9000039                ERR57   LI      R2,57
00808  P005D4  EC0005E5   P005E4               BU      ERROUT
00809  P005D8  C900003A                ERR58   LI      R2,58
00810  P005DC  EC0005E5   P005E4               BU      ERROUT
00811  P005E0  C900003B                ERR59   LI      R2,59
00812  P005E4  AC800604   P00604       ERROUT  LW      R1,ROUTNUM
00813  P005E8  A0800608   P00608               LW      R3,FORTLOC
00814  P005EC  F8800001   X00000               BL      QGERRORS
00815  P005F0  EC100609   P00608               BU      *FORTLOC
00816                                  *
00817                                  *               STORAGE AND FLAGS
00818                                  *
00819  P005F4                          TASKLL  RES     1W                      TASK LOWER BOUND
00820  P005F8                          TASKUL  RES     1W                      TASK UPPER BOUND
00821  P005FC  00000000                QRADFLG DATAW   0                       IF NOT 0 => QRADCPR HAS BEEN CALLED
00822  P00600  00000000                LOOPFLG DATAW   0                       IF 0 => QSADLOOP HAS NOT BEEN CALLED
00823  P00604                          ROUTNUM RES     1W                      ROUTINE IDENTIFIER
00824  P00608                          FORTLOC RES     1W                      FORTRAN LOCATION
00825  P0060C  00000000                CHNFLG  DATAW   0
00826  P00610  00000000                LTCRINX DATAW   0       INDEX FOR SAVING MULTIPLE LOGICAL TCR UNITS
00827  P00614                          CURRTCRL RES    1W      USER'S LOGICAL NAME FOR CURRENT TCR.
00828  P00618                          CURRTCRP RES    1W      PHYSICAL TCR # FOR CURRENT TCR
00829  P0061C                          TCRINDEX RES    1W      DYNAMIC TCR STACK INDEX
00830  P00620                          QQADLTCR EQU    $
00831  P00620  FFFFABCD                LTCRTAB DATAW   X'FFFFABCD'     THIS 6 DEEP QUEUE WILL CONTAIN
00832  P00624  FFFFABCD                        DATAW   X'FFFFABCD'
00833  P00628  FFFFABCD                        DATAW   X'FFFFABCD'
00834  P0062C  FFFFABCD                        DATAW   X'FFFFABCD'
00835  P00630  FFFFABCD                        DATAW   X'FFFFABCD'     USER'S LOGICAL TCR UNITS
00836  P00634  FFFFABCD                        DATAW   X'FFFFABCD'
00837  P00638  FFFFDCBA                PTCRTAB DATAW   X'FFFFDCBA'     THIS 6 DEEP QUEUE WILL CONTAIN
00838  P0063C  FFFFDCBA                        DATAW   X'FFFFDCBA'
00839  P00640  FFFFDCBA                        DATAW   X'FFFFDCBA'
00840  P00644  FFFFDCBA                        DATAW   X'FFFFDCBA'
00841  P00648  FFFFDCBA                        DATAW   X'FFFFDCBA'     USER'S ALLOCATED PHYSICAL TCR #(S).
00842  P0064C  FFFFDCBA                        DATAW   X'FFFFDCBA'
00843  P00650  00000000                TINCTAB DATAW   0               THIS TABLE WILL HAVE BIT 0 SET IF
00844  P00654  00000000                        DATAW   0               THE CORRESPONDING TCR HAS BEEN
00845  P00658  00000000                        DATAW   0               ALLOCATED AS THE GORILLA TCR.
00846  P0065C  00000000                        DATAW   0
00847  P00660  00000000                        DATAW   0
00848  P00664  00000000                        DATAW   0
00849                                  *
00850                                  *               THE FOLLOWING TABLE COUNTS THE # OF ALOC. REQUESTS
00851                                  *               THAT EMPLOY PATCH PANEL CONTROLS
00852                                  *
```

```
00853  P00668  00000000        CSL1CNT  DATAB     0,0,0,0,0,0
       P0066C  0000
00854                          *
00855                          *          FOLLOWING IS A TABLE OF LOGICAL UNITS THAT EMPLOY
00856                          *          TIMERS THE ELEMENTS ARE IN THE SAME POSITION AS IN
00857                          *          PICKTAB )
       P0066E      0002
00858  P00670  00000000        TMRLUTAB DATAW     0,0,0,0,0,0
       P00674  00000000
       P00678  00000000
       P0067C  00000000
       P00680  00000000
       P00684  00000000
00859  P00688  00000040        K2BITTAB DATAW     X'40',X'80',X'100',X'200',X'400',X'800'
       P0068C  00000080
       P00690  00000100
       P00694  00000200
       P00698  00000400
       P0069C  00000800
00860  P006A0                  CURRTIM  RES       1W
00861  P006A4  +8000000        TIMEADRL DATAW     X'F8000000'
00862  P006A8  00200000        TIMERAD  DATAW     X'200000'
00863  P006AC  40000000        ADCTIMER DATAW     X'40000000'
00864  P006B0  000FFFFF        MAXTIME  DATAW     X'FFFFF'
       P006B4  0000FFFF
       P006B8  000FFFFC
00865  P006BC                          END
*  0000  ERRORS IN ADCDCM
00002                                  PROGRAM   DAMDCP
00003                                  DEF       GGDALTCR
00004                                  DEF       GRDASI
00005                                  DEF       GRDADCMI,GMDADCMI,GMDACP,GSDAMTRA
00006                                  DEF       GSDAMTCP
00007                                  DEF       GMBDACPR
00008                                  DEF       GSDACLOOP,GIDACP,GSDACHN
00009                                  DEF       GSTDATMR
00010                                  EXT       GGERRORS,GFPR,GGMTBIN,GGMTBOUT
00011                                  EXT       GGCLSTDA
00012                                  EXT       GGTSKNUM
00013                                  EXT       GGCSLNUM
00014  P00000                          M.REGS
                                       ENDM
00015  P00000                          M.REGDSG
                                       ENDM
00016                          * TITLE: ALLOCATE A DAM TRANSFER CONTROL REGISTER(GSDMTCR)REV.LEV.A000 L
00017                          * DATE:  APRIL 1977
00018                          * COPYRIGHTED BY ELECTRONIC ASSOCIATES INC., 1976
00019                          * 600/32 VERSION
00020                          *
00021                          *          CALLING SEQUENCE:
00022                          *
00023                          *          CALL GSDAMTCR(LOGUNIT,METHOD)
00024                          *
00025                          *          INPUT ARGUMENTS:
00026                          *
00027                          *          LOGUNIT; INTEGER VARIABLE OR CONSTANT THAT DEFINES THE
00028                          *                   USER'S LOGICAL NAME FOR THIS TRANSFER CONTROL
00028                          *                   USER'S LOGICAL NAME FOR THIS TRANSFER CONTROL
00029                          *                   REGISTER. THE USER WILL SUPPLY THIS ARGUMENT
00030                          *                   WHEN CONSTRUCTING A CHANNEL PROGRAM VIA LATER
00031                          *                   CALLS TO GMDACPR,GSDACHN,GSDALOOP,GIDACP,
00032                          *                   GSDAMTRA,GMDACP,GRDASI,GMDADCMI, AND GSGORI.
```

```
00033                                   *
00034                                   *                METHOD:  INTEGER VARIABLE OR CONSTANT THAT DEFINES THE
00035                                   *                          METHOD OF DAM DATA TRANSFERS.
00036                                   *
00037                                   *                         IF METHOD = -1; DAM BLOCKS WILL BE TRANSFERED
00038                                   *                               VIA DIGITAL INSTRUCTION
00039                                   *                          IF METHOD = 1; DAM BLOCKS WILL BE TRANSFERED
00040                                   *                                          VIA THE TIMER ASSOCIATED WITH
00041                                   *                                          THIS TCR. THE ICTRL ARGUMENT
00042                                   *                         IF METHOD = 0; DAM TRANSFERS WILL BE ENABLED
00043                                   *                               VIA THE RUN CONTROL
00044                                   *
00045                                   *
00046                                   *                FRROR CONDITIONS:
00047                                   *
00048                                   *                26-        HYBRID I/O TIMED OUT
00049                                   *                42-        ILLEGAL METHOD OR ICTRL ARGUMENT
00050                                   *                43-        NO TRANSFER CONTROL REGISTER (TCR) IS AVAILABLE
00051                                   *                56-        LOGUNIT HAS BEEN USED TWICE BY THE SAME USER
00052                                   *
00053  P00000                           RTN1     RES       1W
00054  P00004  D4000000   P00000        GSDAMTCR STW       R0,RTN1          PASS THE ARGUMENTS
00055  P00008  F8000001   X00000                 BL        WPR
00056  P0000C  00000008                           DATAW     2W
00057  P00010                           LOGUNIT  RES       1W
00058  P00014                           METHOD   RES       1W
00059                                   *
00060                                   *                FETCH TASK BOUNDS TO INSURE SYSTEM INTEGRITY WHEN
00061                                   *                CONSTRUCTING A CHANNEL PROGRAM IN ALATER CALL
00062                                   *                TO GWBALPR
00063                                   *
00064  P00018                                    M.ADRS                     R6 = LOWER BOUND R7 = UPPER LIMIT
       P00018  3044                              CALM      X'44'
                                                 ENDM
       P0001A     0002
00065  P0001C  D7800618   P00618                 STW       R7,TASKUL        SAVE UPPER LIMIT
00066  P00020  D7000610   P00610                 STW       R6,TASKLL        SAVE LOWER LIMIT
00067  P00024  C8000048                          LI        R7,WSDAMTC       SAVE ROUTINE I.D
00068  P00028  D7800610   P00610                 STW       R7,ROUTNUM
00069  P0002C  AF800000   P00000                 LW        R7,RTN1          SAVE FORTRAN LOCATION
00070  P00030  D7800614   P00614                 STW       R7,FORTLOC
00071  P00034  F8000620   P00620                 ZMW       TCRINDEX         RESET INDEX THROUGHOUT THE TCR STACK
00072                                   *
00073                                   *                VERIFY THAT THE USER HAS NOT ATTEMPTED TO
00074                                   *                ALLOCATE THE SAME LOGICAL TCR NAME TWICE
00075                                   *
00076  P00038  AF900010   P00010                 LW        R7,*LOGUNIT      FETCH THE USER'S LOGICAL UNIT NUMBER
00077  P0003C  C880FFE8                           LI        R1,-6W
00078  P00040  93A00644   P00644     TCREDIT    CAMW      R7,LTCRTAB+6W,R1    COMPARE
00079  P00044  EE0005E5   P005E4                 BCL       EQ,ERR56
00080  P00048  F4C00041   P00040                 BIW       R1,TCREDIT       2,4,6,8 LET'S ITERATE
00081                                   *
00082                                   *                FETCH AND EDIT METHOD ARGUMENT
00083                                   *
00084  P0004C  AD100014   P00014                 LW        R2,*METHOD
00085  P00050  EE000080   P00080                 BCL       EQ,PPMETHOD      PP CONTROL METHOD??
00086  P00054  C905FFFF                           CI        R2,-1            DIGITAL METHOD??
00087  P00058  EE00009D   P0009C                 BCL       EQ,DIGMETHO
00088  P0005C  C9050001                           CI        R2,1             TIMER METHOD??
00089  P00060  F2000585   P00584                 BCF       EQ,ERR42
00090                                   *
00091                                   *                FALLS THROUGH FOR TIMER
00092                                   *
```

```
00093  P00064                          TIMERMIN EQU     $
00094  P00064  C8800700                        LI      R1,WADAMICR      I/O INDEX FOR S/W ALLOC FOR NON-PP
00095  P00068  AE000002   X00000               LD      R4,WOISKNOM
00096  P0006C  F8800001   X00000                BL      WOMYBOOT
00097  P00070  EC000580   P0058C               BO      ERR43            NO ICR STACKS AVAILABLE
00098  P00074  AC800604   P00604               LW      R1,LICRINX       FETCH PHYSICAL ICR INDEX
00099  P00078  D5200644   P00644               STW     R2,PICRTAB,R1    STORE ALLOCATED ICR ONTO STACK
00100  P0007C  D500060C   P0060C               STW     R2,CURRICRP      STORE IN CURRENT ICR
00101  P00080  AF900010   P00010               LW      R7,*LOGONIT      STORE THE LOGICAL UNIT IN THE IMRLOTAB
00102  P00084  D7A0067C   P0067C               STW     R7,IMRLOTAB,R1   IN THE SAME POSITION AS THE PHYSICAL TAB
00103                                   *
00104                                   *                PERFORM PHYSICAL ICR ALLOCATION
00105                                   *
00106  P00088  715A                             SLL     R2,26            ICR # IN BITS 1-5
00107  P0008A       1820                        SBR     R2,0             SET BIT 0 FOR TIMER
00108  P0008C  C8800300                        LI      R1,WADAMRNX      I/O INDEX
00109  P00090  F8000060   Y0006C               BL      WOMYBOOT
00110  P00094  EC0005F1   P005F0               BO      ERROUT
00111  P00098  EC0000F1   P000F0               BO      SAVELOGO
00112  P0009C  C8800700                 DIGMETHD LI     R1,WADAMICR      I/O INDEX TO S/W ALLOC. NON-PP ICR
00113  P000A0  AE00006A   Y00068               LD      R4,WOISKNOM
00114  P000A4  F8000091   Y00090               BL      WOMYBOOT
00115  P000A8  EC000580   P0058C               BO      ERR43            NO ICR(S) AVAILABLE
00116  P000AC  AC800604   P00604               LW      R1,LICRINX       FETCH INDEX
00117  P000B0  D5200644   P00644               STW     R2,PICRTAB,R1    STORE ARAY ALLOCATED ICR
00118  P000B4  D500060C   P0060C               STW     R2,CURRICRP      STORE IN CURRENT ICR
00119  P000B8  EC0000F1   P000F0               BO      SAVELOGO
00120  P000BC  C8800705                 PPMETHOD LI     R1,WADAICRP      I/O INDEX FOR PP ICR ALLOCATION
00121  P000C0  AD000000   X00000               LW      R2,WOLSLNUM      LSL # = DATA WORD FOR THIS ALLOCATION
00122  P000C4  AE0000A2   Y000A0               LD      R4,WOISKNOM
00123  P000C8  F8000A5    Y000A4               BL      WOMYBOOT
00124  P000CC  EC000580   P0058C               BO      ERR43
00125                                   *
00126                                   *                IN THIS CASE LSL# = ICR #
00127                                   *
00128  P000D0  AC800604   P00604               LW      R1,LICRINX       STACK INDEX
00129  P000D4  AD0000C0   Y000C0               LW      R2,WOLSLNUM      = ICR# ))))))
00130  P000D8  D5200644   P00644               STW     R2,PICRTAB,R1    STORE IN PHYS. ICR TABLE
00131  P000DC  D500060C   P0060C                STW     R2,CURRICRP
00132                                   *
00133                                   *                PERFORM PHYSICAL ICR RUN ALLOCATION
00134                                   *
00135  P000E0  715A                             SLL     R2,26            ICR IN BITS 1-5
       P000E2       0002
00136  P000E4  C8800300                        LI      R1,WADAMRNX      I/O INDEX
00137  P000E8  F8000C9    Y000C8               BL      WOMYBOOT
00138  P000EC  EC0005F1   P005F0               BO      ERROUT
00139                                   *
00140                                   *                COMES HERE TO SAVE LOGICAL ICR# AND SPLIT
00141                                   *
00142  P000F0  AF900010   P00010     SAVELOGO  LW      R7,*LOGONIT      FETCH USER'S LOGICAL UNIT
00143  P000F4  AD000604   P00604               LW      R2,LICRINX       STACK INDEX
00144  P000F8  D7L0062C   P0062C               STW     R7,LICRTAB,R2
00145  P000FC  D7800608   P00608               STW     R7,CURRICRL      SAVE THE CURRENT LOGICAL ICR #
00146  P00100  A2860607   P00607               ABM     29,LICRINX       BUMP INDEX BY 1 WORD
00147  P00104  EC100001   P00000               BO      *RIN1            SPLIT
00149                                   * TITLE: CONSTRUCT DAM CHANNEL PROGRAM (WADACPR) REV. LEV. A000   L
00150                                   * DATE:  AUGUST 1976
00151                                   * COPYRIGHTED BY ELECTRONIC ASSOCIATES INC., 1976
00152                                   * 600/32 VERSION
00153                                   *
00154                                   *                CALLING SENQUENCE:
00155                                   *
```

```
00156                                   *              CALL GWBDACPR(LOGUNIT,IFCH,ILCH,NBLKS,VALARY,JAM)
00157                                   *
00158                                   *              INPUT ARGUMENTS:
00159                                   *
00160                                   *              LOGUNIT; THE IDENTICAL INTEGER VARIABLE OR CONSTANT
00161                                   *                       THAT WAS EMPLOYED IN THE LAST CALL TO GSDAMICR
00162                                   *              IFCH;INTEGER VARIABLE OR CONSTANT SPECIFYING
00163                                   *                    THE FIRST "LOGICAL" DAM CHANNEL WITHIN THE BLOCK'S
00164                                   *              ILCH; INTEGER VARIABLE OR CONSTANT SPECIFYING
00165                                   *                    THE LAST "LOGICAL" DAM CHANNEL WITHIN THE BLOCK'S
00166                                   *              NBLKS; INTEGER VARIABLE OR CONSTANT SPECIFYING
00167                                   *                    THE NUMBER OF BLOCKS TO TRANSFER
00168                                   *              VALARY; NAME OF THE DAM OUTPUT BUFFER
00169                                   *              JAM;  INTEGER VARIABLE OR CONSTANT SPECIFYING
00170                                   *                    MODE OF DAM TRANSFER
00171                                   *
00172                                   *              ERROR CONDITIONS:
00173                                   *
00174                                   *              1-    NO ERROR
00175                                   *              40-   IFCH OR ILCH ILLEGAL
00176                                   *              41-   NBLKS TOO BIG I.E. >32,768
00177                                   *              46-       TCR STACK OVERFLOW
00178                                   *              50-   JAM ILLEGAL
00179                                   *              52-   TRY TO TRANSFER DATA OUTSIDE OF TASK AREA
00180                                   *              54-   CALLED AFTER GSDALOOP AND PRIOR TO GIDALP
00181                                   *              57-    LOGUNIT IS NOT THE IDENTICAL INTEGER VARIABLE OR
00182                                   *                       CONSTANT THAT WAS EMPLOYED IN THE LAST CALL
00183                                   *                       TO GSDAMICR
00184                                   *
00185  P00108                           RIN      RES      1W
00186  P0010C  D4000108   P00108        GWBDACPR STW      R0,RIN
00187  P00110  F8000009   Y00008                 BL       GFPR          PASS ARGS
00188  P00114  00000018                           DATAW    6W
00189  P00118                           LOGUNIT1 RES      1W
00190  P0011C                           IFCH     RES      1W
00191  P00120                           ILCH     RES      1W
00192  P00124                           NBLKS    RES      1W
00193  P00128                           VALARY   RES      1W
00194  P0012C                           JAM      RES      1W
00195  P00130  A0000108   P00108              LW        R2,RIN        PUT PROPER ADR OF USER'S
00196  P00134  D5000614   P00614              STW       R2,FORTLOC    LINK-IN INTO THE FORTLOC VARIABLE
00197  P00138  C900004A                       LI        R2,NGWBDACP   STORE ROUTINE # FOR THIS ROUTINE
00198  P0013C  D5000610   P00610              STW       R2,ROUTNUM
00199  P00140  A0000600   P00600              LW        R2,LOOPFLG    CHECK FOR ERROR 54
00200  P00144  F2000500   P0050C              BCF       ZR,ERR54
00201                                   *
00202                                   *              DOES LOGUNIT ARGUMENT MATCH THE ONE
00203                                   *              FROM THE LAST CALL TO GSDAMICR?
00204                                   *
00205  P00148  AC900118   P00118              LW        R1,*LOGUNIT1
00206  P0014C  90800608   P00608              CAMW      R1,CORRTCRL
00207  P00150  F2000500   P0050C              BCF       EQ,ERR57
00208                                   *
00209                                   *              EDIT ALL ARGS PRIOR TO CONTROL WORD CONSTRUCTION
00210                                   *
00211  P00154  AC90011C   P0011C              LW        R1,*IFCH      EDIT 1ST CHANNEL
00212  P00158  ED800575   P00574              BCT       LT,ERR40
00213  P0015C  90800000   X00000              CAMW      R1,GOLLSTDA   GREATER THAN LAST DAM CHANNEL?
00214                                   *                            CHANNEL FOR THIS CONSOLE??
00215  P00160  ED000575   P00574              BCT       GT,ERR40
00216  P00164  AD900120   P00120              LW        R3,*ILCH      EDIT LAST CHANNEL
00217  P00168  1190                         CAR       R1,R3
       P0016A      0002
```

```
00218  P0016C  ED800575    P00574          BCT     L1,ERR40
00219  P00170  91800150    Y0015C          CAMW    R3,GOCLSTDA     GREATER THAN LAST DAM CHANNEL?
00220  P00174  ED000575    P00574          BCT     G1,ERR40
00221  P00178  AD100124    P00124          LW      R2,*NBLKS       EDIT NBLKS
00222  P0017C  EF000570    P0057C          BCT     LE,ERR41
00223                                *
00224                                *           DETERMINE IF TRANSFERS TOO LARGE
00225                                *
00226  P00180  3D90                        SDR     R1,R3           R3 = ILCH-IFCH
       P00182      0002
00227  P00184  C9810001                    ADI     R3,1            R3 = ILCH-IFCH+1
00228  P00188  C1100124    P00124          MPMW    R2,*NBLKS       R3 = (ILCH-IFCH+1)*NBLKS
00229  P0018C  C981FFFF                    ADI     R3,-1           R3 = (ILCH-IFCH+1)*NBLKS - 1
00230  P00190  91800684    P00684          CAMW    R3,=X'FFFF'     GREATER THAN 16 BITS WIDE??
00231  P00194  ED000570    P0057C          BCT     G1,ERR41
00232                                *
00233                                *           DETERMINE IF DAA + # OF TRANS OUTSIDE TASK AREA
00234                                *
00235  P00198  D1100128    P00128          LEA     R2,*VALARY      PICK UP ADR. OF VALARY
00236  P0019C  85000688    P00688          ANMW    R2,=X'FFFFC'    STRIP AWAY POSSIBLE LEA BITS FOR 1
00237  P001A0  91000610    P0061C          CAMW    R2,TASKLL       IS VALARY (1) LESS THAN
00238  P001A4  ED800580    P0058C          BCT     L1,ERR52        TASK LOWER LIMIT?
00239  P001A8  2F20                        TRR     R2,R6           SAVE DAA IN R6
00240                                *
00241                                *           # OF TRANS IS IN BINARY --  TO GET IT IN
00242                                *           WORD ADDRESSING MODE MUST MULTIPLY IT BY 4.
00243                                *
00244  P001AA      2F80                    TRR     R3,R7           R7 NOW ALSO = # OF TRANS
00245  P001AC  73C2                        SLL     R7,2            R7 = R7 * 4
00246  P001AE      3970                    ADR     R7,R2           R2 = DAA + # OF TRANS(IN WORD ADD)
00247  P001B0  91000618    P00618          CAMW    R2,TASKUL
00248  P001B4  EE800580    P0058C          BCT     GE,ERR52
00249                                *
00250                                *           EDIT JAM
00251                                *
00252  P001B8  AE10012C    P0012C          LW      R4,*JAM
00253  P001BC  ED8005AD    P005AC          BCT     L1,ERR50
00254  P001C0  CA050002                    CI      R4,2
00255  P001C4  ED0005AD    P005AC          BCT     G1,ERR50
00256                                *
00257                                *           BEGIN CONSTRUCTION OF CONTROL WORDS
00258                                *
00259                                *           AT THIS TIME:
00260                                *           R1=IFCH
00261                                *           R3=# OF TRANS
00262                                *           R4=JAM
00263                                *           R5"IDRERR
00264                                *           R6=DAA (ADDRESS)
00265                                *
00266                                *           CONSTRUCT CPCW1 IN REGISTER 2
00267                                *
00268  P001C8  2D60                        TRR     R6,R2           R2 = DAA
00269  P001CA      18A1                    SBR     R2,9            SET BIT 9 => FROM MEMORY
00270  P001CC  725B                        SLL     R4,27           OR IN JAM BITS 4-5
00271  P001CE      0940                    ORR     R4,R2
00272  P001D0  AE000004    Y00004          LW      R4,GOCLSNOM     FETCH CURRENTLY SELECTED CONSOLE
00273  P001D4  7257                        SLL     R4,23           MOVE TO BITS 6-8
00274  P001D6      0940                    ORR     R4,R2           "OR" INTO CPCW1
00275                                *
00276                                *           CONSTRUCT CPCW2 IN REGISTER 6
00277                                *
00278  P001D8  2F30                        TRR     R3,R6
```

```
00279  P001DA      7350                          SLL     R6,16          SHIFT # OF TRANS TO BITS 0-15
00280  P001DC  AF900120   P00120                LW      R7,*ILCH       "OR" IN ILCH (LAST CHANNEL)
00281  P001E0  73C8                             SLL     R7,8
00282  P001E2      0870                          ORR     R7,R6
00283  P001E4  AC90011C   P0011C                LW      R1,*IFCH       FETCH 1ST CHANNEL
00284  P001E8  0810                             ORR     R1,R6
       P001EA      0002
00285  P001EC  AD800620   P00620                LW      R3,ICRINDEX
00286  P001F0  C9850010                         CI      R3,4W
00287  P001F4  ED000590   P0059C                BCT     GT,ERR46
00288  P001F8  C8800701                         LI      R1,GLDAMCPX    I/O INDEX
00289  P001FC  AF80060C   P0060C                LW      R7,CURRTCRP    FETCH THE PHYSICAL TCR #
00290  P00200  F8800DE9   P00DE8                BL      GNRTBOUT       INVOKE MIOCS
00291  P00204  EC000209   P00208                BU      $+1W           NO ERROR IS POSSIBLE
00292  P00208  A2080623   P00623                ABM     2B,ICRINDEX    BUMP ICRINDEX BY 2 WORDS. (OR 8 BYTES
00293  P0020C  F8000624   P00624                ZBM     CHNFLG         RESET THE CHAIN FLAG
00294  P00210  9888062B   P0062B                SBM     S1,GWDAFLG     SET GWDAFLG TO SIGNIFY THAT THIS
00295                                   *                              ROUTINE HAS BEEN CALLED
00296  P00214  EC100615   P00614                BU      *FORTLOC       SPLIT
00298                                   * TITLE: CHAIN DAM CONTROL WORDS(GSDACHN)     REV. LEV. A000          L
00299                                   * DATE:  AUGUST 1976
00300                                   * COPYRIGHTED BY ELECTRONIC ASSOCIATES INC., 1976
00301                                   * 600/52 VERSION
00302                                   *
00303                                   *              CALLING SEQUENCE:
00304                                   *
00305                                   *              CALL GSDACHN(LOGUNIT)
00306                                   *
00307                                   *              ARGUMENT:
00308                                   *
00309                                   *              LOGUNIT: THE IDENTICAL INTEGER VARIABLE OR CONSTANT THAT
00310                                   *                       WAS EMPLOYED IN THE LAST CALL TO GSDAMTCR
00311                                   *
00312                                   *              ERROR CONDITIONS:
00313                                   *
00314                                   *              1 - NO ERROR
00315                                   *              46- ATTEMPT TO CALL THIS ROUTINE PRIOR TO CALLING
00316                                   *                  GWBDALPR
00317                                   *              54-   CALLED AFTER GSEALOOP AND PRIOR TO GIDACP
00318                                   *              57-  LOGUNIT DIFFERS FROM THE LAST ONE USED IN
00319                                   *                   THE LAST CALL TO GSDAMTCR
00320                                   *
00321                                   *              59-  MORE THAN TWO CALLS TO THIS ROUTINE WITH THE SAME
00322                                   *                   LOGUNIT PRIOR TO A CALL TO GIDACP
00323                                   *
00324                                   *
00325  P00218                           GSDACHN EQU     $
00326  P00218  C900004C                         LI      R2,NGSDACHN    STORE ROUTINE # FOR THIS ROUTINE
00327  P0021C  D5000610   P00610                STW     R2,ROUTNUM
00328  P00220  D4000614   P00614                STW     R0,FORTLOC     STORE FORTRAN LOCATION
00329  P00224  AFA00000    00000                LW      R7,0,R1        FETCH LOGUNIT ARGUMENT
00330  P00228  93800608   P00608                LAMW    R7,CURRTCRL    IS IT THE CURRENT LOGICAL UNIT?
00331  P0022C  F2000500   P0050C                BCF     EQ,ERR57
00332  P00230  AD000600   P00600                LW      R2,LOOPFLG     CHECK FOR ERROR 54
00333  P00234  F2005C00   P005CC                BCF     ZR,ERR54
00334  P00238  AC800628   P00628                LW      R1,GWDAFLG     IF GWDAFLG = 0 => NO CP TO CHAIN FROM
00335  P0023C  EE0005A5   P005A4                BCT     ZR,ERR46
00336  P00240  AD800620   P00620                LW      R3,ICRINDEX    FETCH DYNAMIC TCR INDEX
00337  P00244  C9850014                         LI      R3,5W
00338  P00248  ED0005ED   P005EC                BCT     GT,ERR59       HE HAS OVER-CHAINED
00339  P0024C  C981FFF8                         ADI     R3,-2W         JUMP BACK 2 SPACES (IF YOU LAND ON
00340                                   *                              THE READING RAILROAD TAKE A RIDE TO
00341                                   *                              THE BOARDWALK)
```

```
00342  P00250  C8000702                    LI      R1,GCHDACPX     I/O INDEX
00343  P00254  AF80060C   P0060C           LW      R7,CURRTCRP     FETCH PHYSICAL TCB #
00344  P00258  F8800201   Y00200           BL      GGMYBOOT
00345  P0025C  EC000261   P00260           BO      $+1W            NO ERROR POSSIBLE
00346  P00260  9880062F   P0062F           SBM     7,CONFLG+3      IF THIS FLAG IS STILL 1 WHEN
00347                                *                               WIDACP IS CALLED => WSDACHN
00348                                *                               HAS BEEN CALLED WITHOUT A CALL
00349                                *                               TO GWBDALPR
00350  P00264  EC100615   P00614           BO      *FORTLOC        SPLIT
00352                                * TITLE: LOOP DAP CHANNEL PROGRAM(WSDALOOP)   REV. LEV. A000        L
00353                                * DATE:  AUGUST 1976
00354                                * COPYRIGHTED BY ELECTRONIC ASSOCIATES INC., 1976
00355                                * 600/32 VERSION
00356                                *
00357                                *              CALLING SEQUENCE:
00358                                *
00359                                *              CALL WSDALOOP(LOGUNIT)
00360                                *
00361                                *              ARGUMENT:
00362                                *
00363                                *              LOGUNIT; THE IDENTICAL INTEGER VARIABLE OR CONSTANT
00364                                *                       THAT WAS EMPLOYED IN THE LAST CALL TO WSDAMICR
00365                                *
00366                                *
00367                                *              ERROR CONDITIONS:
00368                                *
00369                                *              1 -   NO ERROR
00370                                *              48-   CALLED WITHOUT CALLING WWBDACPR
00371                                *              54-   CALLED AFTER WSDALOOP AND PRIOR TO WIDALP
00372                                *              57-   LOGUNIT IS NOT THE IDENTICAL INTEGER VARIABLE OR
00373                                *                       CONSTANT THAT WAS EMPLOYED IN THE LAST CALL
00374                                *                       TO WSDMICR
00375                                *
00376  P00268                        WSDALOOP EQU     $
00377  P00268  C900004E                       LI      R2,NWSDALOO     STORE ROUTINE # FOR THIS ROUTINE
00378  P0026C  D5000610   P00610              STW     R2,ROUTNOR
00379  P00270  04000614   P00614              STW     R0,FORTLOC      STORE FORTRAN LOCATION
00380  P00274  AD000600   P00600              LW      R2,LOOPFLG      CHECK FOR ERROR 54
00381  P00278  F2000500   P0050C              BCF     ZR,ERR54
00382                                *
00383                                *              DOES LOGUNIT ARGUMENT MATCH THE ONE
00384                                *              FROM THE LAST CALL TO WSDMICR?
00385                                *
00386  P0027C  AFA00000   00000                LW      R7,0,R1         FETCH LOGUNIT
00387  P00280  93800608   P00608              CAMW    R7,CURRTCRL
00388  P00284  F2000500   P0050C              BCF     EQ,ERR57
00389                                *
00390                                *              HAS WWBDALPR BEEN CALLED?
00391                                *
00392  P00288  AC800628   P00628              LW      R1,GWDAFLG
00393  P0028C  EE0005A5   P005A4              BCT     ZR,ERR48
00394                                *
00395                                *              SET CHAIN IN THE LAST CPCW
00396                                *
00397  P00290  AD800620   P00620              LW      R3,TCRINDEX     FETCH TCB INDEX
00398  P00294  C981FFF8                       ADI     R3,-2W          GO BACK 2 SPACES
00399  P00298  C8800702                       LI      R1,GCHDACPX     INDEX TO CHAIN
00400  P0029C  AF80060C   P0060C              LW      R7,CURRTCRP     FETCH CURRENT PHYSICAL TCB #.
00401  P002A0  F8800259   Y00258              BL      GGMYBOOT
00402  P002A4  EC0002A9   P002A8              BO      $+1W            NO ERROR POSSIBLE
00403                                *
00404                                *              LOOP IT
00405                                *
```

```
00406  P002A8  AD000620   P00620          LW      R3,TCRINDEX     TCR INDEX
00407  P002AC  C8800703                   LI      R1,GLEFDALPX    IZU INDEX
00408  P002B0  F88002A1   T002A0          BL      GWAYMOUT
00409  P002B4  EC000289   P00288          BU      EXIT
00410                                 *
00411                                 *          THE ONLY ROUTINE THAT THE USER MAY CALL NOW IS
00412                                 *          WIDALP - HE MAY NOT CALL WSDACA,GWBDALPR,WSDACHN
00413                                 *          OR WSDALOOP. SO-LOOPFLG IS SET TO 1. WIDALP WILL
00414                                 *          RESET THIS FLAG AFTER CP INITIATION. WSDACA,GWBDALPR,
00415                                 *          WSDACHN, AND WSDALOOP CHECK THIS FLAG IN THEIR
00416                                 *          FRONT ENDS.
00417                                 *
00418  P00288  A3880003   P00003          ABM     7,LOOPFLG+3
00419                                 *
00420                                 *          RESET THE CHNFLG
00421                                 *
00422  P002BC  F8000624   P00624          ZRW     CHNFLG
00423  P002C0  EC100615   P00614          BU      *FORTEOL
00424                                 * TITLE: INITIATE A DAP CHANNEL PROGRAM(WIDALP) REV. LEV. A000      L
00425                                 * DATE   AUGUST 1976
00426                                 * COPYRIGHTED BY ELECTRONIC ASSOCIATES INC., 1976
00427                                 * 800732 VERSION
00428                                 *
00429                                 *          CALLING SEQUENCE
00430                                 *
00431                                 *          CALL WIDALP(LOGUNIT)
00432                                 *
00433                                 *          ARGUMENT
00434                                 *
00435                                 *          LOGUNIT; THE IDENTICAL INTEGER VARIABLE OR CONSTANT THAT
00436                                 *                   WAS EMPLOYED IN THE LAST CALL TO WSDAMTCR
00437                                 *
00438                                 *          ERROR CONDITIONS
00439                                 *
00440                                 *          1 - NO ERROR
00441                                 *          26- HYBRID I/O TIMED OUT
00442                                 *          45- NO VALID CHANNEL PROGRAM HAS BEEN CONSTRUCTED
00443                                 *          57-   LOGUNIT DIFFERS FROM THE LAST ONE USED IN THE
00444                                 *                   LAST CALL TO WSDAMTCR
00445                                 *
00446                                 *
00447  P002C4                         WIDALP  EQU     $
00448  P002C4  C9000051                       LI      R2,RWIDALP      STORE ROUTINE # FOR THIS ROUTINE
00449  P002C8  D5000610   P00610          STW     R2,ROUTNUM
00450  P002CC  D4000614   P00614          STW     R0,FORTEOL      STORE FORTRAN LOCATION
00451  P002D0  AFA00000   00000          LW      R7,0,R1         FETCH LOGUNIT
00452  P002D4  93800608   P00608          CAMW    R7,CURRTCRL     IS IT THE CURRENT LOGICAL TCR #?
00453  P002D8  F2000500   P00500          BLF     EQ,ERR57
00454                                 *
00455                                 *          HAS GWBDALPR BEEN CALLED(ALSO IMPLIES
00456                                 *
00457  P002DC  AD000628   P00628          LW      R2,GWBFLG
00458  P002E0  EE000595   P00594          BLT     ZR,ERR45
00459                                 *
00460                                 *          HAS WSDACHN BEEN CALLED AND A CALL TO GWBDALPR HAS NOT
00461                                 *          OCCURED WHICH WOULD ALLOW IN DCM TO ACCESS A
00462                                 *          CONTROL DOUBLEWORD OF GARBAGE.
00463                                 *          IF CHNFLG = 1 => WSDACHN HAS BEEN CALLED
00464                                 *                           AND GWBDALPR HAS NOT BEEN CALLED
00465                                 *          IF CHNFLG =0 => GWBDALPR HAS BEEN CALLED
00466                                 *
00467  P002E4  AD000624   P00624          LW      R2,CHNFLG
00468  P002E8  F2000595   P00594          BLF     ZR,ERR45
00469                                 *
```

```
00470                                   *               LET'S START IT UP
00471                                   *
00472  P002EC  C8800301                         LI      R1,WHDACPRX
00473                                   *
00474                                   *               DATA WORD IS THE PHYSICAL TCR # IN BITS 1-5
00475                                   *
00476  P002F0  AD00060C   P00060C               LW      R2,CURRTCRP
00477  P002F4  715A                              SLL     R2,26
       P002F6      0002
00478  P002F8  F8000281   Y00280                BL      WHYBOUT
00479  P002FC  EC0005F1   P005F0                BU      ERROUT          MIOCS DETECTED ERROR 26
00480                                   *
00481                                   *               RESET VARIOUS FLAGS SO ONE MAY RE-CONSTRUCT
00482                                   *               CONTROL DOUBLEWORDS.
00483                                   *
00484  P00300  F8000628   P00628                ZMW     WADAFLG
00485  P00304  F8000600   P00600                ZMW     LOOPFLG
00486  P00308  F8000624   P00624                ZMW     CMDFLG
00487  P0030C  EC100615   P00614                BU      *FORTLOC        SPLIT
00489                                   * TITLE: DIGITALLY ACTIVATE A BLOCK OF DAMS(DSDAMTRA) REV. LEV. A000  L
00490                                   * DATE:  APRIL 4 1976
00491                                   * COPYRIGHTED BY ELECTRONIC ASSOCIATES INC., 1976
00492                                   * 600/32 VERSION
00493                                   *
00494                                   *               CALLING SEQUENCE
00495                                   *
00496                                   *               CALL DSDAMTRA(LOGUNIT)
00497                                   *
00498                                   *               INPUT ARGUMENT:
00499                                   *
00500                                   *               LOGUNIT: THE IDENTICAL INTEGER VARIABLE OR CONSTANT
00501                                   *                        THAT WAS EMPLOYED IN A PREVIOUS CALL
00502                                   *                        TO DSDAMTCR
00503                                   *
00504                                   *               ERROR CONDITIONS:
00505                                   *
00506                                   *               26-     HYBRID I/O TIMED OUT
00507                                   *               57      LOGUNIT HAS NOT BEEN PREVIOUSLY DEFINED
00508                                   *                       VIA A PRIOR CALL TO DSDAMTCR
00509                                   *
00510  P00310                           DSDAMTRA EQU    $
00511  P00310  04000614   P00614                SIW     R0,FORTLOC      SAVE LINK-OUT
00512  P00314  C900005C                         LI      R2,NDSDAMTR     SAVE ROUTINE ID
00513  P00318  05000610   P00610                SIW     R2,ROUTNUM
00514  P0031C  AE200000    00000                LW      R4,0,R1         FETCH LOGICAL TCR #.
00515  P00320  F88004C9   P004C8                BL      TCRMAP          FETCH PHYSICAL TCR IN BITS 1-5 OF R2
00516  P00324  C8800302                         LI      R1,DSDAMRNX     I/O INDEX
00517  P00328  F8800279   Y0027B                BL      WHYBOUT
00518  P0032C  EC0005F1   P005F0                BU      ERROUT          MIOCS DETECTED ERROR 26
00519  P00330  EC100615   P00614                BU      *FORTLOC        SPLIT
00521                                   * TITLE: HALT A DAM CHANNEL PROGRAM (WHDACP)          REV. LEV. A000 L
00522                                   * DATE:  APRIL 5 1976
00523                                   *COPYRIGHTED BY ELECTRONIC ASSOCIATES, INC., 1976
00524                                   * 600/32 VERSION
00525                                   *
00526                                   *               CALLING SEQUENCE:
00527                                   *
00528                                   *               CALL WHDACP(LOGUNIT)
00529                                   *
00530                                   *               ARGUMENT:
00531                                   *
```

```
00532                                  *              LOGUNIT; THE IDENTICAL INTEGER VARIABLE OR CONSTANT
00533                                  *                       THAT WAS EMPLOYED IN A PREVIOUS CALL TO
00534                                  *                       GSDAMICR
00535                                  *
00536                                  *              ERROR CONDITIONS:
00537                                  *
00538                                  *              26-  HYBRID I/O TIMED OUT
00539                                  *              56-  DCM FAILED TO HALT
00540                                  *              57-  LOGUNIT HAS NOT BEEN PREVIOUSLY DEFINED
00541                                  *                   VIA A PRIOR CALL TO GSDAMICR
00542                                  *
00543  P00334                          GHDACP   EQU      *
00544  P00334  D4000614   P00614               STW      R0,FORTLOC       SAVE LINK-OUT
00545  P00338  E9000052                         LI       R2,GHHDACP
00546  P0033C  D5000610   P00610               STW      R2,ROUTNUM       SAVE ROUTINE ID
00547                                  *
00548                                  *              CALCULATE THE INDEX TO FETCH THE
00549                                  *              PHYSICAL TCR NUMBER
00550                                  *
00551  P00340  AE200000    00000                LW       R4,0,R1          FETCH LOGUNIT
00552  P00344  F8800409   P00408                BL       TCRMAP           FETCH PHYSICAL TCR IN BITS 1-5 OF R2
00553  P00348  C8800303                         LI       R1,GHDAMCPX      I/O INDEX
00554  P0034C  F8800329   P00328                BL       GOHYBOUT
00555  P00350  EC0005F1   P005F0                BU       ERROUT           HIOCS DETECTED ERROR 26
00556                                  *
00557                                  *              READ STATUS TO SEE IF IT ACTUALLY DID HALT
00558                                  *
00559  P00354  C8800200                         LI       R1,GRDASTAX      I/O INDEX - R2 HAS TCR # IN BITS 1-5
00560  P00358  2FA0                             IRR      R2,R7
       P0035A       0002
00561  P0035C  F8800001   X00000               BL       GOHYBIN
00562  P00360  EC0005F1   P005F0                BU       ERROUT           HIOCS DETECTED ERROR 26
00563  P00364  2420                             IRR      R2,0
       P00366       0002
00564  P00368  EC800505   P00504                BCT      SET,ERR56        STILL BUSY
00565                                  *
00566                                  *              RESET FLAGS TO ENABLE THE USER TO RE-CONSTRUCT A CHANNEL
00567                                  *              PROGRAM USING THE SAME TCR
00568                                  *
00569  P0036C  F8000600   P00600                ZMW      LOOPFLG
00570  P00370  F8000624   P00624                ZMW      CHNFLG
00571  P00374  F8000628   P00628                ZMW      GWDAFLG
00572  P00378  F8000620   P00620                ZMW      TCRINDEX
00573  P0037C  EC100615   P00614                BU       *FORTLOC         SPLIT CITY
00575                                  * TITLE: READ DAM CHANNEL PROGRAM STATUS(GRDASI) REV. LEV. A000     L
00576                                  * DATE:  AUGUST 1976
00577                                  * COPYRIGHTED BY ELECTRONIC ASSOCIATES INC., 1976
00578                                  * 000752 VERSION
00579                                  *
00580                                  *              CALLING SEQUENCE:
00581                                  *              CALL GRDASI(LOGUNIT,IBUSY,ICR)
00582                                  *
00583                                  *              ARGUMENTS:
00584                                  *              LOGUNIT,  THE IDENTICAL INTEGER VARIABLE OR CONSTANT
00585                                  *                        THAT WAS EMPLOYED IN A PREVIOUS CALL TO
00586                                  *                        GSDAMICR
00587                                  *              IBUSY; INTEGER VARIABLE WHICH REFLECTS IF A DAM CHANNEL
00588                                  *                     IS ACTIVE IBUSY =1 => CP IN OPERATION
00589                                  *              ICR,  INTEGER VARIABLE WHICH REFLECTS THE NUMBER OF
00590                                  *                    DATA TRANSFERS REMAINING
00591                                  *
```

```
00592                                   *                ERROR CONDITIONS:
00593                                   *                26 - HYBRID I/O TIMED OUT
00594                                   *                57-  LOGUNIT HAS NOT BEEN PREVIOUSLY DEFINED
00595                                   *                     VIA A CALL TO GSDAMICR
00596                                   *
00597  P00380                           RTN2     RES       1W
00598  P00384  D4000380    P00380      GRDAS1   STW       R0,RTN2
00599  P00388  F8000111    Y00110               BL        GFPR
00600  P0038C  0000000C                         DATAW     3W
00601  P00390                           LOGUNITS RES       1W
00602  P00394                           IBUSY    RES       1W
00603  P00398                           ICR      RES       1W
00604  P0039C  AC800380    P00380               LW        R1,RTN2
00605  P003A0  D4800614    P00614               STW       R1,FORTLOC
00606  P003A4  C8000054                         LI        R1,NORDAS1
00607  P003A8  D4800610    P00610               STW       R1,ROUTNUM
00608                                   *
00609                                   *                CALCULATE THE INDEX TO FETCH THE PHYSICAL
00610                                   *                ICR NUMBER
00611                                   *
00612  P003AC  AE100390    P00390               LW        R4,*LOGUNITS     FETCH LOGUNIT
00613  P003B0  F8000409    P00408               BL        ICRMAP           FETCH PHYSICAL ICR IN BITS 1-5 OF R2
00614  P003B4  C8000200                         LI        R1,GRDASTAX      I/O INDEX
00615  P003B8  2FA0                             IRR       R2,R7
       P003BA       0002
00616  P003BC  F8000350    Y00350               BL        GWMYBIN
00617  P003C0  EC0005F1    P005F0               BD        ERROUT           BIOCS DETECTED ERROR 26
00618  P003C4  2DA0                             IRR       R2,R3
00619  P003C6       711F                        SRL       R2,31            SHIFT BUSY BIT TO BIT 31
00620  P003C8  D5100394    P00394               STW       R2,*IBUSY        PASS TO USER
00621  P003CC  91800684    P00684               CAMW      R3,=X'FFFF'      SPECIAL CASE FOR NO TRANSFERS LEFT
00622  P003D0  EE0003E1    P003E0               BLT       EW,ZED
00623  P003D4  C9810001                         ADI       R3,1             DUMP BY N.ONE (H/W COUNT LESS BY 1)
00624  P003D8  D5900398    P00398      STORECR  STW       R3,*ICR
00625  P003DC  EC100381    P00380               BD        *RTN2            SPLIT
00626  P003E0  0DB0                     ZED      ZR        R3               NO COUNTS
       P003E2       0002
00627  P003E4  EC0003D9    P003D8               BD        STORECR
00629                                   * TITLE: LOAD A DAM DCR TIMER (GWDADCMI)     REV. LEV. A000
00630                                   * DATE:  AUGUST 1976
00631                                   * COPYRIGHTED BY ELECTRONIC ASSOCIATES INC., 1976
00632                                   * 600/32 VERSION
00633                                   *
00634                                   *                CALLING SEQUENCE:
00635                                   *
00636                                   *                CALL GWDADCMI(LOGUNIT,TIME)
00637                                   *
00638                                   *                ARGUMENTS:
00639                                   *
00640                                   *                LOGUNIT; THE IDENTICAL INTEGER VARIABLE OR CONSTANT THAT
00641                                   *                         WAS EMPLOYED IN A PREVIOUS CALL TO GSDAMICR
00642                                   *                TIME;    INTEGER VARIABLE OR CONSTANT SPECIFYING THE TIME
00643                                   *                         OR NUMBER OF COUNTS IN USECS. TO BE LOADED
00644                                   *
00645                                   *                ERROR CONDITIONS:
00646                                   *
00647                                   *                26- HYBRID I/O TIMED OUT
00648                                   *                31- ILLEGAL TIME
00649                                   *                57- LOGUNIT HAS NOT BEEN DEFINED
00650                                   *
00651  P003E8                           RTN4     RES       1W
00652  P003EC  D40003E8    P003E8       GWDADCMI STW       R0,RTN4
```

```
00653  P003F0  F8000389  Y00388          BL      WFPR          PASS THE ARGUMENT ADDRESSES
00654  P003F4  00000008                  DATAW   2W
00655  P003F8                  LOGUNIT4  RES     1W
00656  P003FC                  TIME4     RES     1W
00657  P00400  C8800060                  LI      R1,WORDADCM   ROUTINE ID
00658  P00404  D4800610  P00610          STW     R1,ROUTNUM
00659  P00408  AC8003E8  P003E8          LW      R1,RIN4       SAVE FORTRAN LOCATION
00660  P0040C  D4800614  P00614          STW     R1,FORTLOC
00661  P00410  AE1003F8  P003F8          LW      R4,*LOGUNIT4  FETCH LOGICAL TCR UNIT
00662  P00414  F80004C9  P004C8          BL      TCRMAP        FETCH PHYSICAL TCR NUMBER
00663  P00418  6D00006A4  P006A4         SUMR    R2,TIMERDA    SUB1 TO CHANGE ADR RANGE FROM
00664  P0041C  7142                      SLL     R2,2          1-6 TO 0-5
       P0041E       0002
00665  P00420  89000688  P006A8          ORMW    R2,DAMTIMER   DAM GROUP BIT
00666  P00424  AE1003FC  P003FC          LW      R4,*TIME4     FETCH TIME VALUE
00667  P00428  92000680  P006B0          CAMR    R4,MAXTIMER   = 1048575
00668  P0042C  ED000565  P00564          BLT     GT,ERR51
00669  P00430  0940                      OPR     R4,R2
       P00432       0002
00670  P00434  C8800401                  LI      R1,WADATRAB   I/O WADEX
00671  P00438  F8000340  Y0034C          BL      WGHYBOUT
00672  P0043C  EC0005F1  P005F0          BU      ERROUT        HIOCS DETECTED ERROR 26
00673  P00440  EC1003E9  P003E8          BU      *RIN4         SPECIT
00675                                  * TITLE: READ A DAM PCP TIMER(WRDADCMT)      REV. LEV. A000        L
00676                                  * DATE:  APRIL 1977
00677                                  * COPYRIGHTED BY ELECTRONIC ASSOCIATES INC., 1976
00678                                  * 600/32 VERSION
00679                                  *
00680                                  *              CALLING SEQUENCE:
00681                                  *
00682                                  *              CALL WRDADCMT(LOGUNIT,TIME)
00683                                  *
00684                                  *              ARGUMENTS:
00685                                  *
00686                                  *              LOGUNIT; THE IDENTICAL INTEGER VARIABLE OR CONSTANT THAT
00687                                  *                       WAS EMPLOYED IN APREVIOUS CALL TO WSDAMTCR
00688                                  *              TIME;    INTEGER VARIABLE WHERE THE COUNTS WILL BE
00689                                  *                       RETURNED
00690                                  *
00691                                  *              ERROR CONDITIONS
00692                                  *
00693                                  *              26- HYBRID I/O TIMED OUT
00694                                  *              57- LOGUNIT HAS NOT BEEN PREVIOUSLY DEFINED VIA
00695                                  *                  A CALL TO WSDAMTCR
00696                                  *
00697  P00444                          RIN5    RES     1W
00698  P00448  D4000444  P00444        WRDADCMT STW    R0,RIN5
00699  P0044C  F80003F1  Y003F0         BL      WFPR
00700  P00450  00000008                 DATAW   2W
00701  P00454                  LOGUNIT5 RES     1W
00702  P00458                  TIME5    RES     1W
00703  P0045C  C8800062                 LI      R1,WORDADCM   ROUTINE ID
00704  P00460  D4800610  P00610         STW     R1,ROUTNUM
00705  P00464  AC800444  P00444         LW      R1,RIN5       FORTRAN LOCATION
00706  P00468  D4800614  P00614         STW     R1,FORTLOC
00707  P0046C  AE100454  P00454         LW      R4,*LOGUNIT5  FETCH LOGICAL TCR UNIT
00708  P00470  F80004C9  P004C8         BL      TCRMAP        FETCH PHYSICAL TCR NUMBER
00709  P00474  6D00006A4  P006A4        SUMR    R2,TIMERDA    SUB 1 TO CHANGE ADR RANGE FROM
00710  P00478  7142                     SLL     R2,2          1-6 TO 0-5
       P0047A       0002
00711  P0047C  89000688  P006A8         ORMW    R2,DAMTIMER   DAM GROUP BIT
00712  P00480  2FA0                     IPR     R2,R7
       P00482       0002
```

```
00713  P00484  D78006AC   P006AC          STW     R7,CURRTIM      SAVE CURRENT DAM TIMER ADDRESS
00714  P00488  C980FFFB                   LI      R3,-5
00715  P0048C  C8800300                   LI      R1,WRDATRXS     I/O INDEX
00716  P00490  F8800380   Y0038C   RDAM1  BL      WWHYBIN         SET UP TO READ DAM TIMER
00717  P00494  EC0005F1   P005F0          BU      ERROUT
00718  P00498  C8800301                   LI      R1,WRDATRXR
00719  P0049C  F8800491   Y00490          BL      WWHYBIN         READ DAM TIMER
00720  P004A0  EC0005F1   P005F0          BU      ERROUT
00721  P004A4  2E20                       TRR     R2,R4
       P004A6      0002
00722  P004A6  860006A0   P006A0          ANMW    R4,TIMEADRL
00723  P004AC  920006AC   P006AC          CAMW    R4,CURRTIM      MAKE SURE TIMER ADR COMPARES
00724  P004B0  EE0004B0   P004BC          BLT     EQ,RDAM2
00725  P004B4  F5800491   P00490          BIB     R3,RDAM1
00726  P004B8  EC000560   P0056C          BU      ERR54
00727  P004BC  8500080    P00080   RDAM2  ANMW    R2,MAXTIMER     REMOVE TIMER ADDRESS
00728  P004C0  D5100458   P00458          STW     R2,*TTIMES      PASS TIME TO USER
00729  P004C4  EC100445   P00444          BU      *RTNS           SPLIT CITY!
00730  P004C8                      TCRMAP  EQU     $
00731                               *
00732                               *               FIND THE CORRESPONDING PHYSICAL TCR #
00733                               *               AS A FUNCTION OF THE LOGICAL TCR NUM
00734                               *
00735  P004CB  C980FFEB                   LI      R3,-6F          R3 = ITERATION AND INDEX
00736  P004CC  9260067C   P0067C   TRARCRF CAMW    R4,TMRLDTAB,R3
00737  P004D0  EE0004D0   P004DC          BLT     EQ,$+5W
00738  P004D4  F5C004C0   P004CC          BIW     R3,TRARCRF
00739  P004D8  EC000500   P0050C          BU      ERR57           LUGUNIT IS UNDEFINED
00740  P004DC  C9810018                   ADI     R3,6W           R3 = INDEX OF PHYSICAL TCR TABLE
00741  P004E0  AD600644   P00644          LW      R2,PTCRTAB,R3   FETCH PHYSICAL TCR #.
00742  P004E4  715A                       SLL     R2,26           MOVE TO BITS 1-5
00743  P004E6      2800                   TRSW    R0              RETURN
00745                               * TITLE: START DAM DCR TIMER(S) (WSDATMR)    REV. LEV. A000        L
00746                               * DATE:  JULY 1977
00747                               * COPYRIGHTED BY ELECTRONIC ASSOCIATES INC., 1977
00748                               * 600/32 VERSION
00749                               *
00750                               *               CALLING SEQUENCE:
00751                               *
00752                               *               CALL WSTDATMR(LUARRAY)
00753                               *
00754                               *               INPUT ARGUMENT:
00755                               *
00756                               *               LUARRAY; INTEGER ARRAY THAT CONTAINS THE LOGICAL UNITS,
00757                               *                        AS SPECIFIED IN CALL(S) TO WSADCTCR, OF ALLOCATED
00758                               *                        DAM TRANSFER CONTROL REGISTERS THAT EMPLOY THE
00759                               *                        TIMERS. THE LAST ELEMENT OF LUARRAY MUST BE A
00760                               *                        -1.
00761                               *
00762                               *               ERROR CONDITION.
00763                               *
00764                               *               26 - HYBRID I/O TIMED OUT
00765                               *               57 - A MEMBER OF LUARRAY HAS NOT BEEN ALLOCATED FOR
00766                               *                    TIMER USAGE
00767  P004E8  D4000614   P00614   WSTDATMR STW     R0,FORTRLOC     SAVE LINK-OUT
00768  P004EC  C8000069                   LI      R0,NWSTDATM
00769  P004F0  D4000610   P00610          STW     R0,ROUTNUM      SAVE ROUTINE I.D.
00770  P004F4  0020                       ZR      R2              ZERO OUT DATA WORD
       P004F6      0002
00771  P004F8  F8000525   P00524          BL      LTOPTMR         PROCESS FIRST LUARRAY MEMBER
00772  P004FC  EC000500   P0050C          BU      ERR57           1ST ELEMENT IS INVALID
00773  P00500  C800FFFA                   LI      R0,-6           MAX OF 5 MORE LOGICAL UNITS
```

```
00774  P00504  F8800525  P00524  LOOPIMR  BL    LIOPIMR        KEEP PROCESING LOARRAY MEMBERS
00775  P00508  EC000515  P00514           BU    FINIIMR
00776  P00500  F7000505  P00504           BID   R0,LOOPIMR
00777  P00510  EC000500  P00500           BU    ERR57          NO DELIMETER FOUND
00778  P00514  C8800402          FINIIMR  LI    R1,WSIDAIMX    I/O INDEX
00779  P00518  F8800439  P00438           BL    WGMYBOOT
00780  P0051C  EC0005F1  P005F0           BU    ERROUT         ERROR 26 ENCOUNTERED
00781  P00520  EC100615  P00614           BU    *FORILOL       SPLIT
00782                             *
00783                             *              FOLLOWING SUBROUTINE MAPS LOGICAL TCR UNITS OF TCR'S THAT
00784                             *              EMPLOY TCR TIMERS TO THE PHYSICAL TIMERS AND PACKS THE
00785                             *              PHYSICAL TCR BITS IN 1-6 OF R2
00786                             *
00787  P00524  AFA00000    00000  LIOPIMR  LA    R7,0,R1        FETCH CURRENT LOARRAY ELEMENT
00788  P00528  C085FFFF                    LI    R7,-1
00789  P0052C  F2000535  P00534           BLE   EO,*+24
00790  P00530  2800                        TRSW  R0             RETURN DELIMETER FOUND OR 1ST
00791                             *                            ELEMENT = A BOGUS -1
       P00532       0002
00792  P00534  C980FFE8                    LI    R3,-6A         USE R3 AS INDEX THROUGH TMRLOTAB
00793  P00538  AEE00694  P00694  TMRMAPX  LA    R5,TMRLOTAB+6A,R3 FETCH 1ST/NEXT TMRLOTAB ELEMENT
00794  P0053C  1300                        CAR   R5,R7          = ?
       P0053E       0002
00795  P00540  EE00054D  P0054C           BLT   EO,TMRMATCH
00796  P00544  F5C00539  P00538           BIM   R3,TMRMAPX
00797  P00548  2800                        TRSW  R0             ERROR RETURN NO MATCH FOUND
       P0054A       0002
00798  P0054C  C9810018          TMRMATCH ADI   R3,6A          FORM INDEX FOR PHYSICAL TCR PICK-UP
00799  P00550  ADE00644  P00644           LA    R3,PICKTAB,R3  R3 HAS THE PHYSICAL TCR #
00800  P00554  71C1                        SLL   R3,1           R3 = HALF WORD INDEX
       P00556       0002
00801  P00556  AEE00693  P00692           LH    R5,R2BITTAB-1H,R3 CONSTRUCT PROPER SET BIT IN R2
00802  P0055C  0950                        ORR   R5,R2
00803  P0055E       2283                   ABR   R0,29          BUMP LINK OUT BY 1 WORD
00804  P00560  2293                        ABR   R1,29          LOOK AT NEXT LOARRAY MEMBER
00805  P00562       2800                   TRSW  R0             GOOD RETURN
00807                             *
00808                             *              FOLLOWING ARE LINKAGES TO THE ERROR PRINT OUT
00809                             *              ROUTINE WOERRORS. WOERRORS MAY OR MAY NOT ABORT THE JOB
00810                             *
00811  P00564  C900001F          ERR31  LI    R2,31
00812  P00568  EC0005F1  P005F0           BU    ERROUT
00813  P0056C  C9000022          ERR34  LI    R2,34
00814  P00570  EC0005F1  P005F0           BU    ERROUT
00815  P00574  C9000028          ERR40  LI    R2,40
00816  P00578  EC0005F1  P005F0           BU    ERROUT
00817  P0057C  C9000029          ERR41  LI    R2,41
00818  P00580  EC0005F1  P005F0           BU    ERROUT
00819  P00584  C900002A          ERR42  LI    R2,42
00820  P00588  EC0005F1  P005F0           BU    ERROUT
00821  P0058C  C900002B          ERR43  LI    R2,43
00822  P00590  EC0005F1  P005F0           BU    ERROUT
00823  P00594  C900002D          ERR45  LI    R2,45
00824  P00598  EC0005F1  P005F0           BU    ERROUT
00825  P0059C  C900002E          ERR46  LI    R2,46
00826  P005A0  EC0005F1  P005F0           BU    ERROUT
00827  P005A4  C9000030          ERR48  LI    R2,48
00828  P005A8  EC0005F1  P005F0           BU    ERROUT
00829  P005AC  C9000032          ERR50  LI    R2,50
00830  P005B0  EC0005F1  P005F0           BU    ERROUT
00831  P005B4  C9000033          ERR51  LI    R2,51
00832  P005B8  EC0005F1  P005F0           BU    ERROUT
00833  P005BC  C9000034          ERR52  LI    R2,52
```

```
00834  P005C0  EC0005F1  P005F0          BU      ERROUT
00835  P005C4  C9000035          ERR55   LI      R2,55
00836  P005C8  EC0005F1  P005F0          BU      ERROUT
00837  P005CC  C9000036          ERR54   LI      R2,54
00838  P005D0  EC0005F1  P005F0          BU      ERROUT
00839  P005D4  C9000036          ERR56   LI      R2,56
00840  P005D8  EC0005F1  P005F0          BU      ERROUT
00841  P005DC  C9000039          ERR57   LI      R2,57
00842  P005E0  EC0005F1  P005F0          BU      ERROUT
00843  P005E4  C900003A          ERR58   LI      R2,58
00844  P005E8  EC0005F1  P005F0          BU      ERROUT
00845  P005EC  C900003B          ERR59   LI      R2,59
00846  P005F0  AC800610  P00610  ERROUT  LW      R1,ROUTNUM
00847  P005F4  AD800614  P00614          LW      R3,FORTLOC
00848  P005F8  F8000001  X00000       BL      GOERRORS
00849  P005FC  EC100015  P00614       BU      *FORTLOC        MAY NOT GET BACK TO HERE IF
00850                                 *                       ERROR IS DEEMED FATAL.
00851                                 *
00852                                 *       VARIABLES USED BY NUMEROUS ROUTINES
00853                                 *
00854  P00600  00000000          LOOPFLG DATAW   0       IF 0 => USDALOOP HAS NOT BEEN CALLED
00855                                 *                       IF 1 => USDALOOP HAS BEEN CALLED
00856  P00604  00000000          LTCRINX DATAW   0               INDEX FOR SAVING MULTIPLE LOGUNITS
00857  P00608                    CURRTCRL RES    1W              USER'S LOGICAL NAME FOR CURRENT TCR
00858  P0060C                    CURRTCRP RES    1W              PHYSICAL TCR # FOR CURRENT TCR.
00859  P00610                    ROUTNUM RES     1W              ROUTINE ID.
00860  P00614                    FORTLOC RES     1W              FORTRAN-LOCATION FROM USER'S CALL
00861  P00618                    TASKUL  RES     1W              TASK UPPER LIMIT
00862  P0061C                    TASKLL  RES     1W              TASK LOWER LIMIT
00863  P00620                    TCRINDEX RES    1W              DYNAMIC TCR STACK INDEX
00864  P00624  00000000          CHNFLG  DATAW   0               IF 1 => USDACHN HAS BEEN CALLED
00865                                 *                       IT IS RESET BY GNDALPH,USDALOOP
00866  P00628  00000000          GNDAFLG DATAW   0               IF NOT 0 => GNNDALPH HAS BEEN CALLED
00867  P0062C                    GNDALTCR EQU    *
00868  P0062C  FFFFABCD          LTCRTAB DATAW   X'FFFFABCD'     THIS 6 DEEP QUEUE WILL CONTAIN THE
00869  P00630  FFFFABCD                  DATAW   X'FFFFABCD'     USER'S LOGICAL TCR UNITS
00870  P00634  FFFFABCD                  DATAW   X'FFFFABCD'
00871  P00638  FFFFABCD                  DATAW   X'FFFFABCD'
00872  P0063C  FFFFABCD                  DATAW   X'FFFFABCD'
00873  P00640  FFFFABCD                  DATAW   X'FFFFABCD'
00874  P00644  FFFFDCBA          PTCRTAB DATAW   X'FFFFDCBA'     THIS 6 DEEP QUEUE WILL CONTAIN THE
00875  P00648  FFFFDCBA                  DATAW   X'FFFFDCBA'     USER'S ALLOCATED PHYSICAL TCR #(S).
00876  P0064C  FFFFDCBA                  DATAW   X'FFFFDCBA'
00877  P00650  FFFFDCBA                  DATAW   X'FFFFDCBA'
00878  P00654  FFFFDCBA                  DATAW   X'FFFFDCBA'
00879  P00658  FFFFDCBA                  DATAW   X'FFFFDCBA'
00880  P0065C  00000000          TIMCTAB DATAW   0               THIS TABLE WILL HAVE BIT 0 SET IF
00881  P00660  00000000                  DATAW   0               THE CORRESPONDING TCR HAS BEEN
00882  P00664  00000000                  DATAW   0               ALLOCATED AS THE "GORILLA" TCR.
00883  P00668  00000000                  DATAW   0
00884  P0066C  00000000                  DATAW   0
00885  P00670  00000000                  DATAW   0
00886                                 *
00887                                 *               FOLLOWING TABLE COUNTS THE # OF HOLEY ALLOC REQS
00888                                 *
00889  P00674  00000000          CSLTCNT DATAB   0,0,0,0,0,0
       P00678  0000
00890                                 *
00891                                 *               FOLLOWING IS A TABLE OF LOGICAL UNITS THAT EMPLOY
00892                                 *               TIMERS THE ELEMENTS ARE IN THE SAME POSITION AS IN
00893                                 *               PTCRTAB II
       P0067A     0002
```

```
00894  P0067C  00000000          INRLOIAB DATAW     0,0,0,0,0,0
       P00680  00000000
       P00684  00000000
       P00688  00000000
       P0068C  00000000
       P00690  00000000
00895  P00694  00400080          R2BITIAB DATAW     x'40',x'80',x'100',x'200',x'400',x'800'
       P00698  01000200
       P0069C  04000800
00896  P006A0  F8000000          TIMEADRL DATAW     x'F8000000'
00897  P006A4  00200000          TIMERDA  DATAW     x'200000'
00898  P006A8  80000000          DAMTIMER DATAW     x'80000000'
00899  P006AC                    CURRTIM  RES       1W
00900  P006B0  000FFFFF          MAXTIMER DATAW     x'FFFFF'
       P006B4  000FFFFF
       P006B8  000FFFFF
00901  P006BC                          END
*  0000  ERRORS IN DAMDCM
```

```
 2/08/78     16:22:15    LIOYTA          SYSTEMS REAL-TIME MONITOR-6.0
 H.IP25              H.IP25                                                    321011G
00002                                 ************************************************************************
00003                                 **
00004                                 **
00005                                 *                UNDEFINED INSTRUCTION TRAP PROCESSOR -AND-
00006                                 *                HYBRID INPUT/OUTPUT CONTROL SYSTEM
00007                                 *                (HIOCS)
00008                                 **  600/32 VERSION
00009                                 **
00010                                 **
00011                                 ************************************************************************
00012                                         PROGRAM   H.IP25
00013  P00000                                M.EQUS
                                              ENDM
00014  P00000                                M.HEQUS6
                                              ENDM
00015                                 *
00016                                 *            FOLLOWING EQU(S) SET UP THE LENGTH OF THE LIST OF
00017                                 *            CD INSTRUCTIONS FOR THE FOUR  CARDS, USED WHEN QJOB "ORS"
00018                                 *            IN THE DEA(S) IN THESE CD INSTRUCTIONS
00019                                 *
00020  P00000  00000001              HAT       DATAW     1
00021  P00004  0000000C    P0000C              ACW       INT.PSW
00022  P00008  00000025                        DATAW     X'25'
00023  P0000C                        INT.PSW   RES       1W
00024  P00010                                  M.TRAC    3,HAT
                                              ENDM
00025  P00010  93002330    P02330              CAMW      R6,=X'ABCDEF37'      ILLEGAL INST. OR HIOCS CALL??
00026  P00014  F2000FA1    P00FA0              BCF       EQ,HMONS          EITHER A TERMINATING TASK OR ILLEGAL
00027                                 *                                      INSTRUCTION TRAP
00028                                 *
00029                                 *            R3 = 0 => OUTPUT REQUEST  R3 = 4 => INPUT REQUEST
00030                                 *
00031  P00018  EC60001D    P0001C              BU        $+1W,R3
00032  P0001C  EC00015D    P0015C              BU        HYBOUT            HYBRID OUTPUT
00034                                 *
00035                                 *            COMES HERE FOR HYBRID INPUT
00036                                 *
00037  P00020                        HYBIN     EQU       $
00038  P00020  2D90                             TRR       R1,R3             PUT I/O INDEX INTO R3 ALSO
00039  P00022      7186                         SRL       R3,6              MAKE WORD INDEX OUT OF TYPE
00040  P00024  EC600029    P00028              BU        $+1W,R3
```

```
00041  P00028  EC000041   P00040          BU       PAMINPUT        INPUT FROM THE PAM
00042  P0002C  EC000061   P00060          BU       ADCINPUT        INPUT FROM THE ADC DCM
00043  P00030  EC000075   P00074          BU       DAMINPUT        INPUT FROM THE DAM DCM
00044  P00034  EC000089   P00088          BU       RTCINPUT        INPUT FROM THE RTHC
00045  P00036  EC0000CD   P000CC          BU       NOHINPUT        NON-HYBRID INPUT
00046  P0003C  EC00014D   P0014C          BU       MVFGIN          INPUT STATUS FROM MVFG
00047                                 ***********************************************************************
00048                                 *
00049                                 *              TYPE 0 INPUT ALL PAM INPUT
00050                                 *
00051                                 ***********************************************************************
00052  P00040  AFC00000    00000     PAMINPUT LW       R7,0,R2         R7 = CSL CONFIGURATION IN BITS (1-6)
00053  P00044  EE000A9D   P00A9C              BCT      ZR,ERRORCSL     NO CONSOLE IS SELECTED ERROR16.
00054  P00048  FC030000                        AI       0
00055  P0004C  D7900CE4   P00CE4              STW      R7,*PAMTCW      STORE CSL CONFIRURATION IN PAM TCW
00056  P00050  70C2                            SLL      R1,2            FORM WORD INDEX OUT OR R1
       P00052        0002
00057  P00054  A8200AC5   P00AC4              EXM      PAMCDRD,R1      EXECUTE INDEXED PAM CD READ INST.
00058  P00058  0C00                            ZR       R0
       P0005A        0002
00059  P0005C  EC000A69   P00A68              BU       STATLOOP
00060                                 ***********************************************************************
00061                                 *
00062                                 *              TYPE 1 INPUT ADC DCM INPUT
00063                                 *
00064                                 ***********************************************************************
00065  P00060  D7900CE8   P00CE8     ADCINPUT STW      R7,*ADCTCW      STORE TCR BITS IN ADC DCM TCW
00066  P00064  70C2                            SLL      R1,2            FORM WORD INDEX OUT OF R1
       P00066        0002
00067  P00068  A8200749   P00748              EXM      ADCCDRD-X'400',R1 EXECUTE INDEXED ADC CD READ INST
00068  P0006C  C9800004                        LI       R3,1W
00069  P00070  EC000A69   P00A68              BU       STATLOOP
00070                                 ***********************************************************************
00071                                 *
00072                                 *              TYPE 2 INPUT DAM DCM INPUT
00073                                 *
00074                                 ***********************************************************************
00075  P00074  D7900CEC   P00CEC     DAMINPUT STW      R7,*DAMTCW      STORE TCR BITS IN DAM DCM TCW
00076  P00078  70C2                            SLL      R1,2            FORM WORD INDEX IN R1
       P0007A        0002
00077  P0007C  A8200361   P00360              EXM      DAMCDRD-X'800',R1   EXECUTE INDEXED DAM CD READ INST
00078  P00080  C9800008                        LI       R3,2W
00079  P00084  EC000A69   P00A68              BU       STATLOOP
00080                                 ***********************************************************************
00081                                 *
00082                                 *              TYPE 3 ONPUT ITC (RTHC) INPUT
00083                                 *
00084                                 ***********************************************************************
00085  P00088  2C70                    RTCINPUT TRR      R7,R0           SET UP READ TIMER DATA WORD
       P0008A        0002
00086  P0008C  AFC00000    00000              LW       R7,0,R2         R7 = CSL CONFIGURATION IN BITS(1-6)
00087  P00090  93800CF8   P00CF8              CAMW     R7,RTHCSL
00088  P00094  ED800A95   P00A94              BCT      LT,ERROR6       TIMER CONSOLE SELECTED?
00089  P00098  70C2                            SLL      R1,2            FORM WORD INDEX OUT OF R1
       P0009A        0002
00090  P0009C  A827FF79   PFFF78              EXM      RTHCCDRD-X'C00',R1 EXECUTE INDEXED ITC CD READ
00091  P000A0  C980000C                        LI       R3,3W
00092  P000A4  CB80FFE7                        LI       R7,-25          STATUS LOOP TIME OUT AFTER 25
00093  P000A8  A86008D5   P00BD4     TDLOP    EXM      PAMTD,R3        ATTEMPTS - EXECUTE TD INSTRUCTION
00094  P000AC  EF8000B5   P000B4              BCT      7,IONOTDN       I/O DONE WHEN ALL CC ARE RESET
00095  P000B0  EC0000BD   P000BC              BU       GODRTN          A-OK
00096  P000B4  F78000A9   P000A8     IONOTDN  BIB      R7,TDLOP        TRY AGAIN
00097  P000B8  EC000AA5   P00AA4              BU       ERROR26
00098  P000BC  2D00                    GODRTN   TRR      R0,R2           MOVE USER DATA
       P000BE        0002
00099  P000C0  CB800001                        LI       R7,1            NO ERROR
00100  P000C4  A288000F   P0000F              ABM      29,INT.PSW
00101  P000C8  F9100000   P0000C              BRI      *INT.PSW        RETURN TO USER
00102                                 ***********************************************************************
00103                                 *
00104                                 *              TYPE 4 INPUT NON-I/O HIOCS INPUT FUNCTIONS
00105                                 *
00106                                 ***********************************************************************
00107  P000CC  70C2                    NOHINPUT SLL      R1,2            FORM WORD INDEX OUT OF R1
       P000CE        0002
00108  P000D0  EC27F0D5   PFF0D4              BU       $+1W-X'1000',R1
00109  P000D4  EC0000E9   P000E8              BU       DVRYGET
00110  P000D8  EC0000F1   P000F0              BU       RALOCCSL            *
00111  P000DC  EC000135   P00134              BU       DCMERORS
00112  P000E0  EC000145   P00144              BU       GORADR
00113  P000E4  0000                           HALT                     FOR DEBUG
00114                                 *
```

```
00115                                   *                COMES HERE TO FETCH THE ADDRESS OF THE LIST THAT
00116                                   *                CONTAINS THE CONSOLE #S AND TASK NAMES OF RELAY
00117                                   *                I/O SUSPENDED TASKS
00118                                   *
        P000E6        0002
00119   P000E8  D1000CFC    P00CFC      DVRYGET  LEA     R2,DVRYLIST
00120   P000EC  EC000A85    P00A84               BU      GOODRTN9
00121                                   *
00122                                   *                COMES HERE FOR ANALOG CONSOLE ALLOCATION INQUIRY
00123                                   *
00124   P000F0                          RALOCCSL EQU     $                R7 HAS CSL # TO BE TESTED
00125   P000F0  CB00FFFA                         LI      R6,-6            SCAN THE PHYSICAL CSL# TABLE FOR MATCH
00126   P000F4  0DB0                             ZR      R3               INDEX
        P000F6        0002
00127   P000F8  ACE00EC8    P00EC8      LOOPRAL  LW      R1,ALOCCSLL,R3
00128   P000FC  1390                             CAR     R1,R7
        P000FE        0002
00129   P00100  EE000115    P00114               BCT     EQ,CSLMATHY      FOUND A MATCH
00130   P00104  C981000C                         ADI     R3,3W            BUMP INDEX
00131   P00108  F70000F9    P000F8               BIB     R6,LOOPRAL       2,4,6,8 LET'S ITERATE
00132                                   *
00133                                   *                FALLS THROUGH IS CSL IS NOT ALLOCATED
00134                                   *
00135   P0010C  C9000001                         LI      R2,1
00136   P00110  EC000A85    P00A84               BU      GOODRTN9
00137   P00114  92600ECC    P00ECC      CSLMATHY CAMW    R4,ALOCCSLL+1W,R3   IS IT ALLOCATED TO THE
00138   P00118  F200012D    P0012C               BCF     EQ,NOTSAMTK      CALLING TASK??
00139   P0011C  92E00ED0    P00ED0               CAMW    R5,ALOCCSLL+2W,R3
00140   P00120  F200012D    P0012C               BCF     EQ,NOTSAMTK
00141   P00124  0D20                             ZR      R2               COMES HERE IF IT IS ALLOCATED TO THE
        P00126        0002
00142   P00128  EC000A85    P00A84               BU      GOODRTN9         CALLING TASK
00143   P0012C  C900FFFF                NOTSAMTK LI      R2,-1            COMES HERE IF CSL IS NOT ALLOCATED TO
00144   P00130  EC000A85    P00A84               BU      GOODRTN9         THE CALLING TASK
00145                                   *
00146                                   *                COMES HERE TO PASS BACK TO THE USER THE
00147                                   *                NUMBER OF DCM ERROR INTERRUPTS RECEIVED
00148                                   *
00149   P00134  2CF0                    DCMERORS TRR     R7,R1
        P00136        0002
00150   P00138  AD2021AC    P021AC               LW      R2,DAFP1FLG,R1
00151   P0013C  F82021AC    P021AC               ZMW     DAFP1FLG,R1
00152   P00140  EC000A85    P00A84               BU      GOODRTN9
00153                                   *
00154                                   *                COMES HERE TO PASS BACK TO ADR. OF GORACC
00155                                   *
00156   P00144  D1001E80    P01E80      GORADR   LEA     R2,GORACC
00157   P00148  EC000A85    P00A84               BU      GOODRTN9
00158                                   ******************************************************************
00159                                   *
00160                                   *                TYPE 5 - INPUT MVFG STATUS
00161                                   *
00162                                   ******************************************************************
00163   P0014C                          MVFGIN   EQU     $
00164   P0014C  FC030000                         AI      0
00165   P00150  A8000B99    P00B98               EXM     MVFGCDRD         REQUEST MVFG STATUS WORD
00166   P00154  C9800010                         LI      R3,4W            TEST STATUS OF HARDWARE
00167   P00158  EC000A69    P00A68               BU      STATLOOP
00169                                   *
00170                                   *                COMES HERE FOR HYBRID OUTPUT
00171                                   *
00172   P0015C                          HYBOUT   EQU     $
00173   P0015C  2D90                             TRR     R1,R3
00174   P0015E        7186                       SRL     R3,6             R3 = TYPE INDEX IN WORDS
00175   P00160  EC600165    P00164               BU      $+1W,R3
00176   P00164  EC000189    P00188               BU      PAMOUTPT         PAM RELAY I/O
00177   P00168  EC000189    P00188               BU      PAMOUTPT         PAM NON-RELAY OUTPUT
00178   P0016C  EC0001B9    P001B8               BU      ADCOUTPT         ADC DCM OUTPUT
00179   P00170  EC0001DD    P001DC               BU      DAMOUTPT         DAM DCM OUTPUT
00180   P00174  EC000201    P00200               BU      ITCOUTPT         ITC (RTHC) OUTPUT
00181   P00178  EC000221    P00220               BU      NONHYOUT         NON HYBRID OUTPUT FUNCTIONS
00182   P0017C  EC00082F    P0082E               BU      ADCNONOT         ADC NON OUTPUT FUNCTIONS
00183   P00180  EC000941    P00940               BU      DAMNONOT         DAM NON OUTPUT FUNCTIONS
00184   P00184  EC000A55    P00A54               BU      MVFGOUT          MVFG OUTPUT ( CONTROL OR DATA)
00185                                   ******************************************************************
00186                                   *
00187                                   *                OUTPUT TYPE 0 - RELAY OUTPUT  AND  TYPE 1
00188                                   *              - ALL PAM OUTOUT -
00189                                   *
00190                                   ******************************************************************
00191   P00188  2FA5                    PAMOUTPT XCR     R2,R7            R2 NOW = ADR. OF QQCSLNSH
        P0018A        0002
00192   P0018C  FC030000                         AI      0
```

```
00193                                  *                                        R7 NOW = DATA WORD
00194  P00190  AF400000     00000              LW       R6,0,R2                 R6 = CONSOLE CONFIG IN BITS 1-6 + INX
00195  P00194  0BE0                            ORR      R6,R7                   R7 = DATA WORD + CONSOLE #.
       P00196       0002
00196  P00198  D7900CE4    P00CE4              STW      R7,*PAMTCW              STORE DATA WORD + CSL IN PAM TCW
00197  P0019C  70C2                           SLL      R1,2                    FORM WORD INDEX OUT OF R1
00198  P0019E       2692                      TBR      R1,21                   IF 21 SET => NON RELAY I/O
00199  P001A0  EC8001A9    P001A8              BCT      SET,NONRLY
00200  P001A4  C8810024                       ADI      R1,NORLYLST             INDEX AROUND NON-RELAY OUTPUT
00201  P001A8  1E92                   NONRLY   ZBR      R1,21                   RESET INDEX BIT FOR TYPE 1 OUTPUT
       P001AA       0002
00202  P001AC  A8200B01    P00B00              EXM      PAMCDWR,R1              EXECUTE INDEXED PAM CD WRITE INST.
00203  P001B0  0DB0                            ZR       R3
       P001B2       0002
00204  P001B4  EC000A69    P00A68              BU       STATLOOP
00205                                  ************************************************************************
00206                                  *
00207                                  *                OUTPUT TYPE -2-  ADC DCM OUTPUT
00208                                  *
00209                                  ************************************************************************
00210  P001B8                          ADCOUTPT EQU      $
00211                                  *
00212                                  *                IF ADC TIME CRITICAL ENABLE THE SI INTERRUPT
00213                                  *                FOR ADC OVERSCALE AND ADC DATA-RATE
00214                                  *                ERROR MONITORING
00215                                  *
00216  P001B8  C8850204                           CI       R1,QSADTIMC
00217  P001BC  F20001C9    P001C8              BCF      EQ,NOTADTC
00218  P001C0  A80021A5    P021A4              EXM      DISAADSI                DISABLE THE INTERRUPT TO
00219                                  *                                        RESET THE FLOP
00220  P001C4  A800219D    P0219C              EXM      ENABADSI                ENABLE THE INTERRUPT
00221  P001C8                          NOTADTC  EQU      $
00222  P001C8  D5100CE8    P00CE8              STW      R2,*ADCTCW              STORE DATA IN ADC DCM TCW LOCATION
00223  P001CC  70C2                           SLL      R1,2                    FORM WORD INDEX OUT OF R1
       P001CE       0002
00224  P001D0  A8200340    P0034C              EXM      ADCCDWR-X'800',R1 EXECUTE INDEXED CD INSTRUCTION
00225  P001D4  C9800004                       ADCBK10  LI       R3,1W
00226  P001D8  EC000A69    P00A68              BU       STATLOOP
00227                                  ************************************************************************
00228                                  *
00229                                  *                OUTPUT TYPE -3-  DAM DCM OUTPUT
00230                                  *
00231                                  ************************************************************************
00232  P001DC                          DAMOUTPT EQU      $
00233                                  *
00234                                  *                IF DAM TIME CRITICAL ENABLE THE SI INTERRUPT FOR DAM
00235                                  *                FLOATING POINT OVERFLOW AND DATA RATE ERROR MONITORING
00236                                  *
00237  P001DC  C8850304                           CI       R1,QSDATIMC
00238  P001E0  F20001ED    P001EC              BCF      EQ,NOTDAMTC
00239  P001E4  A80021A9    P021A8              EXM      DISADASI                DISABLE THE INTERRUPT TO RESET FLOP
00240  P001E8  A80021A1    P021A0              EXM      ENABDASI                ENABLE THE INTERRUPT
00241  P001EC                          NOTDAMTC EQU      $
00242  P001EC  D5100CEC    P00CEC              STW      R2,*DAMTCW              STORE DATA IN DAM DCMTCW LOCATION
00243  P001F0  70C2                           SLL      R1,2                    FORM WORD INDEX OUT OF R1
       P001F2       0002
00244  P001F4  A827FF65    PFFF64              EXM      DAMCDWR-X'C00',R1 EXECUTE INDEXED CD INSTRUCTION
00245  P001F8  C9800008                       DAMBK10  LI       R3,2W
00246  P001FC  EC000A69    P00A68              BU       STATLOOP
00247                                  ************************************************************************
00248                                  *
00249                                  *                OUTPUT TYPE -4- ITC (RTHC) OUTPUT
00250                                  *
00251                                  ************************************************************************
00252  P00200                          ITCOUTPT EQU      $
00253  P00200  2C20                           TRR      R2,R0                   PREPARE DATA OUT WORD
00254  P00202       2FA5                      XCR      R2,R7
00255  P00204  AF400000     00000              LW       R6,0,R2
00256  P00208  93000CF8    P00CF8              CAMW     R6,RTHCSL
00257  P0020C  ED800A95    P00A94              BCT      LT,ERROR6               ILLEGAL OR NO CONSOLE SELECTED
00258  P00210  70C2                           SLL      R1,2                    FORM WORD INDEX OUT OF R1
       P00212       0002
00259  P00214  A827FB81    PFFB80              EXM      ITCCDWR-X'1000',R1 EXECUTE INDEXED ITC CD INSTRUCTION
00260  P00218  C980000C                       LI       R3,3W
00261  P0021C  EC000A69    P00A68              BU       STATLOOP
00262                                  ************************************************************************
00263                                  *
00264                                  *                OUTPUT TYPE -5- NON HYBRID OUTPUT FUNCTION S
00265                                  *
00266                                  ************************************************************************
00267  P00220  70C2                   NONHYOUT SLL      R1,2                    FORM WORD INDEX OUT OF R1
       P00222       0002
00268  P00224  FC030000                           AI       0
```

```
00269  P00228  EC27EE2D  PFEE2C              BU      $+1W-X'1400',R1
00270  P0022C  EC000261  P00260              BU      ALLOCCSL        ALLOCATE ANALOG CONSOLE
00271  P00230  EC0002C1  P002C0              BU      SELCTCSL        SELECT   ANALOG CONSOLE
00272  P00234  EC0002F5  P002F4              BU      CONNINT         CONNECT HYBRID INT. TO SUBROUTINE
00273  P00238  EC0003F1  P003F0              BU      DISCINT         DISCONNECT HYBRID INTERRUPT
00274  P0023C  EC000409  P00408              BU      REQINT          REQUEST A HYBRID INTERRUPT
00275  P00240  EC000411  P00410              BU      ENABEXEC        ENABLE RTM EXECUTIVE
00276  P00244  EC000419  P00418              BU      DISEXEC         DISABLE RTM EXECUTIVE
00277  P00248  EC0006DD  P006DC              BU      INITHINT        INITIALIZE HYBRID INTERRUPTS
00278  P0024C  EC000421  P00420              BU      DVRYTASK        ENTER A TASK # AND CSL# FOR A TASK
00279                                  *                              SUSPENDED FOR RELAY I/O
00280  P00250  EC000451  P00450              BU      INITHIO         INITIALIZE THE CD(S),TD(S) AND TCW(S)
00281  P00254  EC0006A7  P006A6              BU      DALOCSL         DE-ALLOCATE ANALOG CONSOLE
00282  P00258  EC00078D  P0078C              BU      GORT            GORILLA BLOSSOMING REQUEST
00283  P0025C  EC0007C9  P007C8              BU      NOTGORT         TO BE AN UN-GORILLA
00284                                  *
00285                                  *               COMES HERE TO ALLOCATE AN ANALOG CONSOLE
00286                                  *
00287  P00260  0C90                    ALLOCCSL ZR     R1              EMPLOY R1 AS AN INDEX THROUGH ALOCCSL
       P00262      0002
00288  P00264  CB80FFFA                        LI      R7,-6           R7 EMPLOYED FOR ITERATION CONTROL
00289  P00268  AF200EC8  P00EC8       REALCSL LW      R6,ALOCCSLL,R1  HAS THIS CONSOLE BEEN PREVIOUSLY ALOC
00290  P0026C  1320                           CAR     R2,R6
       P0026E      0002
00291  P00270  EE0002AD  P002AC              BCT     EQ,ISSAME       IS THE CSL ALREADY ALLOCATED TO THE
00292  P00274  C881000C                      ADI     R1,3W           BUMP INDEX
00293  P00278  F7800269  P00268              BIB     R7,REALCSL      2,4,6,8 LET'S ITERATE
00294  P0027C  CB80FFFA                      LI      R7,-6           FIND AN EMPTY SLOT
00295  P00280  0C90                           ZR      R1
       P00282      0002
00296  P00284  AF200EC8  P00EC8       REALOMTH LW     R6,ALOCCSLL,R1
00297  P00288  CB05FFFF                      CI      R6,-1
00298  P0028C  EE00029D  P0029C              BCT     EQ,ALOMATCH
00299  P00290  C881000C                      ADI     R1,3W           BUMP INDEX
00300  P00294  F7800285  P00284              BIB     R7,REALOMTH
00301  P00298  EC000AAD  P00AAC              BU      ERROR62         NO SLOTS AVAILABLE
00302  P0029C  D5200EC8  P00EC8       ALOMATCH STW    R2,ALOCCSLL,R1  FOUND THE NEXT AVAILABLE SLOT]
00303  P002A0  D6200ECC  P00ECC              STW     R4,ALOCCSLL+1W,R1   STORE TASK ID (1ST WORD)
00304  P002A4  D6A00ED0  P00ED0              STW     R5,ALOCCSLL+2W,R1   STORE TASK ID (2ND WORD)
00305  P002A8  EC000A85  P00A84              BU      GOODRTN9        SPLIT
00306                                  *                              CALLING TASK, IF IT IS => NO-OPERATION
00307  P002AC  92200ECC  P00ECC       ISSAME  CAMW    R4,ALOCCSLL+1W,R1  IS CSL ALREADY ALLOC. TO THE
00308  P002B0  F2000AAD  P00AAC              BCF     EQ,ERROR62      CALLING TASK
00309  P002B4  92A00ED0  P00ED0              CAMW    R5,ALOCCSLL+2W,R1
00310  P002B8  F2000AAD  P00AAC              BCF     EQ,ERROR62
00311  P002BC  EC000A85  P00A84              BU      GOODRTN9        REDUNDANT ALLOCATION = NO-OPERATION
00312                                  *
00313                                  *               COMES HERE TO SELECT AN ANALOG CONSOLE
00314                                  *
00315  P002C0                          SELCTCSL EQU    $               SEE IF THE USER HAS BEEN PREVIOUSLY
00316  P002C0  CB80FFFA                       LI      R7,-6           ALLOCATED THIS CONSOLE
00317  P002C4  0C90                           ZR      R1
       P002C6      0002
00318  P002C8  AF200EC8  P00EC8       RESEL   LW      R6,ALOCCSLL,R1
00319  P002CC  1160                           CAR     R6,R2
       P002CE      0002
00320  P002D0  EE0002E1  P002E0              BCT     EQ,SELTSKOK     CSL MATCH; ARE TASKS THE SAME?
00321  P002D4  C881000C                      ADI     R1,3W
00322  P002D8  F78002C9  P002C8              BIB     R7,RESEL
00323  P002DC  EC000AAD  P00AAC              BU      ERROR62         CONSOLE HAS NOT BEEN ALLOCATED
00324  P002E0  92200ECC  P00ECC       SELTSKOK CAMW   R4,ALOCCSLL+1W,R1
00325  P002E4  F2000AAD  P00AAC              BCF     EQ,ERROR62
00326  P002E6  92A00ED0  P00ED0              CAMW    R5,ALOCCSLL+2W,R1
00327  P002EC  F2000AAD  P00AAC              BCF     EQ,ERROR62
00328  P002F0  EC000A85  P00A84              BU      GOODRTN9        CONSOLE IS SELECTED
00329                                  *
00330                                  *               COMES HERE TO CONNECT A R/A HYBRID INTERRUPT
00331                                  *
00332  P002F4                          CONNINT EQU     $
00333  P002F4  ADC00000     00000             LW      R3,0,R2         R3 = ADR OF 1ST TRAP LOCATION
00334                                  *
00335                                  *               CALCULATE THE PRIORITY OF THE 1ST R/A INTERRUPT
00336                                  *               AS A FUNCTION OF ITS TRAP LOCATION
00337                                  *
00338                                  *               PRIORITY = (TRAP LOCATION)/4 - 64
00339                                  *
00340  P002F8  2F30                           TRR     R3,R6
00341  P002FA      7302                       SRL     R6,2
00342  P002FC  CB01FFC0                      ADI     R6,-64          R6 = T/4-64
00343  P00300  D7001E68  P01E68              STW     R6,RA0PRIO      SAVE IN RA0PRIO
00344  P00304  C9010004                      ADI     R2,1W           R1 = ADR OF RA PRIO 0 ROUTINE
00345  P00308  0C90                           ZR      R1              R1 INDEXES THROUGH METH TABLE
       P0030A      0002
```

```
00346  P00300  CB80FFC0                 LI      R7,-16W        R7 = ITERATION CONTROL
00347  P00310  AF400000   00000  CONLOOP LW      R6,0,R2        FETCH 1ST/NEXT SUBROUTINE ADR
00348  P00314  ED80035D  P0035C         BCT     LT,CONITER     = -1 => NOT BEING USED
00349  P00318  2EE0                     TRR     R6,R5
00350  P0031A      7298                 SRL     R5,27          SHIFT METHOD BIT FROM BIT 2
00351  P0031C  D6A82180  P02180         STB     R5,METHO,R1    TO BIT 4 AND STORE IN METH(N)
00352  P00320  1D60                     ZBR     R6,2           ZERO OUT METHOD BIT
       P00322      0002
00353  P00324  8B001E6C  P01E6C         ORMW    R6,BLINST      R6 = BL TO FORTRAN SUB
00354  P00328  70C2                     SLL     R1,2           FORM WORD INDEX OUT OF R1
       P0032A      0002
00355  P0032C  A8200381  P00380         EXM     STRRABL,R1     STORE THE BL INST IN PROPER SLOT
00356  P00330  A8200371  P00370         EXM     RATRAPTB,R1    R4 = ADR OF INTERRUPT HANDLER
00357  P00334  86002334  P02334         ANMW    R4,=X'7FFFC'   STRIP LEA GARBAGE BITS
00358  P00338  D6600000   00000         STW     R4,0,R3        STORE INTO PROPER TRAP LOCATION
00359  P0033C  7082                     SRL     R1,2           RESTORE R1 TO BYTE INDEX
       P0033E      0002
00360  P00340  AF001E78  P01E78         LW      R6,DISAINST    DISABLE THE RA INT LEVEL TO RESET
00361  P00344  AE801E68  P01E68         LW      R5,RAOPRIO     THE FLOP, THEN ENABLE THE INTERRUPT
00362  P00348  3A90                     ADR     R1,R5          LEVEL
00363  P0034A      72D3                 SLL     R5,19
00364  P0034C  0B50                     ORR     R5,R6          R6 HAS COMPLETED DISABLE INSTRUCTION
       P0034E      0002
00365  P00350  CB070000                 EXR     R6             DISABLE THE INTERRUPT
00366  P00354  1FE1                     ZBR     R6,15          CONSTRUCT ENABLE INSTRUCTION
       P00356      0002
00367  P00358  CB070000                 EXR     R6             ENABLE THE INTERRUPT
00368  P0035C  C9810004         CONITER ADI     R3,1W          BUMP POINTER TO TRAP LOCATION
00369  P00360  C9010004                 ADI     R2,1W          BUMP POINTER TO SUBROUTINE ADDRESSES
00370  P00364  C8810001                 ADI     R1,1B
00371  P00368  F7C00311  P00310         BIW     R7,CONLOOP     ITERATE
00372  P0036C  EC000A85  P00A84         BU      GOODRTN9       SPLIT
00373  P00370  D20010D8  P010D8  RATRAPTB LEA    R4,RAINT0
00374  P00374  D2001154  P01154         LEA     R4,RAINT1
00375  P00378  D2001100  P011D0         LEA     R4,RAINT2
00376  P0037C  D20012CC  P012CC         LEA     R4,RAINT3
00377  P00380  D20012C8  P012C8         LEA     R4,RAINT4
00378  P00384  D2001344  P01344         LEA     R4,RAINT5
00379  P00388  D20013C0  P013C0         LEA     R4,RAINT6
00380  P0038C  D200143C  P0143C         LEA     R4,RAINT7
00381  P00390  D2001488  P01488         LEA     R4,RAINT8
00382  P00394  D2001534  P01534         LEA     R4,RAINT9
00383  P00398  D20015B0  P015B0         LEA     R4,RAINT10
00384  P0039C  D200162C  P0162C         LEA     R4,RAINT11
00385  P003A0  D20016A8  P016A8         LEA     R4,RAINT12
00386  P003A4  D2001724  P01724         LEA     R4,RAINT13
00387  P003A8  D20017A0  P017A0         LEA     R4,RAINT14
00388  P003AC  D200181C  P0181C         LEA     R4,RAINT15
00389  P003B0  D7001140  P01140  STRRABL STW     R6,RABL0
00390  P003B4  D700118C  P0118C         STW     R6,RABL1
00391  P003B8  D7001238  P01238         STW     R6,RABL2
00392  P003BC  D7001284  P01284         STW     R6,RABL3
00393  P003C0  D7001330  P01330         STW     R6,RABL4
00394  P003C4  D70013AC  P013AC         STW     R6,RABL5
00395  P003C8  D7001428  P01428         STW     R6,RABL6
00396  P003CC  D70014A4  P014A4         STW     R6,RABL7
00397  P003D0  D7001520  P01520         STW     R6,RABL8
00398  P003D4  D700159C  P0159C         STW     R6,RABL9
00399  P003D8  D7001618  P01618         STW     R6,RABL10
00400  P003DC  D7001694  P01694         STW     R6,RABL11
00401  P003E0  D7001710  P01710         STW     R6,RABL12
00402  P003E4  D700178C  P0178C         STW     R6,RABL13
00403  P003E8  D7001808  P01808         STW     R6,RABL14
00404  P003EC  D7001884  P01884         STW     R6,RABL15
00405                            *
00406                            *                COMES HERE TO DISCONNECT A HYBRID INTERRUPT
00407                            *
00408  P003F0                    DISCINT EQU     $
00409                            *                COMES HERE TO DISCONNECT A R/A HYBRID INTERRUPT
00410  P003F0  AF801E78  P01E78         LW      R7,DISAINST    JUST DISABLE THE INT LEVEL
00411  P003F4  AF001E68  P01E68  INTMRG LW      R6,RAOPRIO     FETCH IN R6 PRIORITY OF 1ST RA INT
00412  P003F8  3820                     ADR     R2,R6
00413  P003FA      7353                 SLL     R6,19
00414  P003FC  0BE0                     ORR     R6,R7          R7 NOW HAS CONSTRUCTED DISABLE INST.
       P003FE      0002
00415  P00400  CB870000                 EXR     R7             DISABLE THE INT LEVEL
00416  P00404  EC000A85  P00A84         BU      GOODRTN9
00417                            *
00418                            *                COMES HERE TO REQUEST A HYBRID INTERRUPT
00419  P00408                    REQINT  EQU     $
00420                            *                COMES HERE TO REQUEST A R/A HYBRID INTERRUPT
00421  P00408  AF80220C  P0220C         LW      R7,RIINT
00422  P0040C  EC0003F5  P003F4         BU      INTMRG         SAME PROCESSING AS DISCONNECT R/A
```

```
00423                                   *
00424                                   *              COMES HERE TO ENABLE THE RTM EXECUTIVE
00425                                   *
00426  P00410                           ENABEXEC EQU       $
00427  P00410                                    M.OPEN
       P00410  A80008B9     008B8                EXM       C.XDAI
                                                 ENDM
00428  P00414  EC000A85    P00A84                BU        GOODRTN9
00429                                   *
00430                                   *              COMES HERE TO DISABLE THE RTM EXECUTIVE
00431                                   *
00432  P00418                           DISEXEC  EQU       $
00433  P00418                                    M.SHUT
       P00418  A80008B5     008B4                EXM       C.EXAI
                                                 ENDM
00434  P0041C  EC000A85    P00A84                BU        GOODRTN9
00435                                   *
00436                                   *              COMES HERE TO ADD A SUSPENDED TASK'S NAME AND CSL#
00437                                   *              TO THE DVRY LIST OF SUSPENDED TASKS
00438                                   *
00439  P00420                           DVRYTASK EQU       $
00440  P00420  0DB0                              ZR        R3                FIND AN EMPTY SLOT IN "DVRYLIST"
       P00422      0002
00441  P00424  CB00FFFA                          LI        R6,-6             TAKE OUT AFTER DEBUG
00442  P00426  AFE00CFC    P00CFC   DVRYMTLP LW        R7,DVRYLIST,R3    EMPTY => -1 AS AN ENTRY
00443  P0042C  CB85FFFF                          CI        R7,-1
00444  P00430  EE000441    P00440                BCT       EQ,DVRYMACH
00445  P00434  C9810000                          ADI       R3,3W             BUMP LIST INDEX BY 3 WORDS
00446  P00438  F7000429    P00428                BIB       R6,DVRYMTLP
00447  P0043C  0000                              HALT                        THIS SHOULD BE AN IMPOSSIBLE SITUATION
       P0043E      0002
00448  P00440  D5600CFC    P00CFC   DVRYMACH STW       R2,DVRYLIST,R3    FOUND A MATCH ; STORE CSL #
00449  P00444  D6600D00    P00D00                STW       R4,DVRYLIST+1W,R3   STORE TASK ID
00450  P00448  D6E00D04    P00D04                STW       R5,DVRYLIST+2W,R3
00451  P0044C  EC000A85    P00A84                BU        GOODRTN9          SPLIT
00452                                   *
00453                                   *              FOLLOWING INITIALIZES THE DEVICE ENTRY ADDRESSES FOR THE
00454                                   *              CD AND TD INSTRUCTIONS FOR THE 5 HYBRID CARDS.  IT ALSO
00455                                   *              INITIALIZES THE TCW LOCATIONS AS A FUNCTION OF THE DEA(S)
00456                                   *
00457  P00450                           INITHIO  EQU       $
00458  P00450  AF882238    P02238                LB        R7,HYINTFLG       HAS A PRIOR TASK INITIALIZED HIOCS
00459  P00454  F2000A85    P00A84                BCF       ZR,GOODRTN9       ALREADY? IF SO SKIP IT...
00460  P00458  A3882238    P02238                ABM       7,HYINTFLG
00461                                   *
00462                                   *              FOLLOWING IS PROCESSING FOR THE PAM1
00463                                   *
00464  P0045C  AFC00000     00000                LW        R7,0,R2           FETCH PAM1 DEA
00465  P00460  2E70                              TRR       R7,R4             SAVE PAM1 DEA IN R1
00466  P00462      73D3                          SLL       R7,19             MOVE TO BITS 6-12
00467  P00464  C880FF7C                          LI        R1,-PAMLIST       FETCH NEGATIVE LENGTH OF PAM CD LIST
00468  P00468  AEA00B48    P00B48   PAM1LOOP LW        R5,PAMCDRD+PAMLIST,R1  FETCH 1ST/NEXT CD INSTRUCTION
00469  P0046C  0AF0                              ORR       R7,R5             OR IN THE DEA ONFO
       P0046E      0002
00470  P00470  D6A00B48    P00B48                STW       R5,PAMCDRD+PAMLIST,R1
00471  P00474  F4C00469    P00468                BIW       R1,PAM1LOOP       2,4,6,8 LET'S ITERATE
00472  P00478  AE800BD4    P00BD4                LW        R5,PAMTD          "OR" IN THE DEA FOR THE PAM TD INST.
00473  P0047C  0AF0                              ORR       R7,R5
       P0047E      0002
00474  P00480  D6800BD4    P00BD4                STW       R5,PAMTD
00475  P00484  F8800689    P00688                BL        DEATCWMP          VIA SUBROUTINE "DEATCWMP" FETCH THE
00476                                   *                                     TCW LOCATION FOR THE DEA
00477  P00488  D4800CE4    P00CE4                STW       R1,PAMTCW
00478                                   *
00479                                   *              ADC DCM PROCESSING
00480                                   *
00481  P0048C  AFC00004     00004                LW        R7,1W,R2          FETCH ADC DCM DEA
00482  P00490  2E70                              TRR       R7,R4             SAVE IN R4
00483  P00492      73D3                          SLL       R7,19             SHIFT TO BITS 6-12
00484  P00494  C880FFE8                          LI        R1,-ADCLIST       FETCH NEGATIVE LENGTH OF ADC CD LIST
00485  P00498  AEA00B60    P00B60   ADCLOOP  LW        R5,ADCCDRD+ADCLIST,R1  FETCH 1ST/NEXT ADC DCM CD LIST
00486  P0049C  25D0                              TBR       R5,3              IF BIT3 RESET => NOT A CD BUT A BU
       P0049E      0002
00487  P004A0  F08004AD    P004AC                BCF       SET,ADCBYPAS
00488  P004A4  0AF0                              ORR       R7,R5             OR IN THE DEA FIELD
       P004A6      0002
00489  P004A8  D6A00B60    P00B60                STW       R5,ADCCDRD+ADCLIST,R1
00490  P004AC  F4C00499    P00498   ADCBYPAS BIW       R1,ADCLOOP        ITERATE
00491  P004B0  AE800BB0    P00BB0                LW        R5,ADCCDSTR       OR IN TEH DEA FOR THE LOAD CPCW INST.
00492  P004B4  0AF0                              ORR       R7,R5
       P004B6      0002
00493  P004B8  D6800BB0    P00BB0                STW       R5,ADCCDSTR
```

```
00494  P0048C  AE8008D8   P00BD8              LW      R5,ADCTD        OR IN THE DEA INTO THE ADC DCM TD INST.
00495  P004C0  0AF0                           ORR     R7,R5
       P004C2       0002
00496  P004C4  D68008D8   P00BD8              STW     R5,ADCTD
00497  P004C8  F8800689   P00688              BL      DEATCWMP        FIND THE PROPER TCW ADDRESS
00498  P004CC  D4800CE8   P00CE8              STW     R1,ADCTCW
00499                                  *
00500                                  *            DAM DCM PROCESSING
00501                                  *
00502  P004D0  AFC00008    00008              LW      R7,2W,R2        FETCH DAM DCM DEA
00503  P004D4  2E70                           TRR     R7,R4           SAVE IN R4
00504  P004D6       73D3                      SLL     R7,19           SHIFT TO BITS 6-12
00505  P004D8  C880FFE8                       LI      R1,-DAMLIST     FETCH NEGATIVE LENGTH OF DAM CD LIST
00506  P004DC  AEA00878   P00B78    DAMLOOP   LW      R5,DAMCORD+DAMLIST,R1  FETCH 1ST/NEXT DAM DCM CD INSTR.
00507  P004E0  25D0                           TBR     R5,3            IF BIT 3 RESET => NOT CD BUT BU
       P004E2       0002
00508  P004E4  F08004F1   P004F0              BCF     SET,DAMBYPAS
00509  P004E8  0AF0                           ORR     R7,R5           OR IN THE DEA
       P004EA       0002
00510  P004EC  D6A00878   P00B78              STW     R5,DAMCORD+DAMLIST,R1
00511  P004F0  F4C004DD   P004DC    DAMBYPAS  BIW     R1,DAMLOOP      ITERATE
00512  P004F4  AE800BCC   P00BCC              LW      R5,DAMCDSTR     OR IN THE DEA FOR LOAD CPCW CD INST.
00513  P004F8  0AF0                           ORR     R7,R5
       P004FA       0002
00514  P004FC  D6800BCC   P00BCC              STW     R5,DAMCDSTR
00515  P00500  AE800BDC   P00BDC              LW      R5,DAMTD        FIX-UP THE DAM TD INST.
00516  P00504  0AF0                           ORR     R7,R5
       P00506       0002
00517  P00508  D6800BDC   P00BDC              STW     R5,DAMTD
00518  P0050C  F8800689   P00688              BL      DEATCWMP        FIND THE TCW LOCATION
00519  P00510  D4800CEC   P00CEC              STW     R1,DAMTCW
00520                                  *
00521                                  *            FOLLOWING IS PROCESSING FOR THE ITC (RTHC)
00522                                  *
00523  P00514  AFC0000C    0000C              LW      R7,3W,R2        FETCH ITC DEA
00524  P00518  2E70                           TRR     R7,R4           SAVE IN R4
00525  P0051A       73D3                      SLL     R7,19           MOVE TO BITS 6-12
00526  P0051C  C880FFE8                       LI      R1,-ITCLIST     FETCH NEGATIVE LENGTH OF ITC CD LIST
00527  P00520  AEA00B90   P00B90    ITCLOOP   LW      R5,RTHCCORD+ITCLIST,R1  FETCH 1ST/NEXT ITC CD INSTR.
00528  P00524  0AF0                           ORR     R7,R5           OR IN THE DEA BITS
       P00526       0002
00529  P00528  D6A00B90   P00B90              STW     R5,RTHCCORD+ITCLIST,R1
00530  P0052C  F4C00521   P00520              BIW     R1,ITCLOOP
00531  P00530  AE800BE0   P00BE0              LW      R5,ITCTD        OR DEA INTO THE ITC TD INST.
00532  P00534  0AF0                           ORR     R7,R5
       P00536       0002
00533  P00538  D6800BE0   P00BE0              STW     R5,ITCTD
00534  P0053C  F8800689   P00688              BL      DEATCWMP
00535  P00540  D4800CF0   P00CF0              STW     R1,ITCTCW
00536                                  *
00537                                  *
00538                                  *            INITIALIZE ROUTINE FOR MVFG'S
00539                                  *
00540                                  *
00541  P00544  AFC00000    00000    INITMVFG LW      R7,0W,R2        FETCH PAM DEA
00542  P00548  2E70                           TRR     R7,R4           SAVE MVFG DEA IN R4
00543  P0054A       23F3                      ABR     R7,31           ADJUST PAM DEA TO MVFG DEA
00544  P0054C  73D3                           SLL     R7,19           SHIFT TO BITS 6 - 12
       P0054E       0002
00545  P00550  C880FFF4                       LI      R1,-MVFGLIST    FETCH NEG. LENGTH OF MVFG CD'S
00546  P00554  AEA00B9C   P00B9C    MVFGLOOP  LW      R5,MVFGCDWR+MVFGLIST,R1      FETCH MVFG CD INSTR.
00547  P00558  0AF0                           ORR     R7,R5           OR IN THE DEA
       P0055A       0002
00548  P0055C  D6A00B9C   P00B9C              STW     R5,MVFGCDWR+MVFGLIST,R1
00549  P00560  F4C00555   P00554              BIW     R1,MVFGLOOP     2,4,6,8  ETC, ETC, ETC
00550  P00564  AE800BE4   P00BE4              LW      R5,MVFGTD       'OR' IN THE DEA FOR THE
00551  P00568  0AF0                           ORR     R7,R5           MVFG TD INSTRUCTION
       P0056A       0002
00552  P0056C  D6800BE4   P00BE4              STW     R5,MVFGTD
00553  P00570  F8800689   P00688              BL      DEATCWMP
00554  P00574  D4800CF4   P00CF4              STW     R1,MVFGTCW
00555                                  *
00556                                  *
00557                                  *            FOLLOWING CODE IS FOR DEVICE READY INTERRUPT INITIALIZATION
00558                                  *
00559                                  *            CALCULATE THE PRIORITY OF THE DEVICE READY INTERRUPT
00560                                  *            AND CONSTRUCT THE DISABLE, DEACTIVATE, AND ENABLE
00561                                  *            INSTRUCTIONS
00562                                  *
00563                                  *            PRIORITY = (TCW-X'100')/4 + X'14'
00564                                  *
00565  P00578  AF800CE4   P00CE4              LW      R7,PAMTCW
```

```
00566  P0057C  CB81FF00                          ADI     R7,-X'100'
00567  P00580  7382                               SRL     R7,2
       P00582      0002
00568  P00584  CB810014                          ADI     R7,X'14'        R7 NOW = PRIORITY #
00569  P00588  2D70                               TRR     R7,R2           SAVE PRIORITY
00570  P0058A      73D3                           SLL     R7,19           SHIFT PRIORITY TO BITS 6-12
00571  P0058C  AF000CB0    P00CB0                LW      R6,DISADVRY     CONSTRUCT DISABLE INSTRUCTION
00572  P00590  0B70                               ORR     R7,R6
       P00592      0002
00573  P00594  D7000CB0    P00CB0                STW     R6,DISADVRY
00574  P00598  AF000CAC    P00CAC                LW      R6,ENABDVRY     CONSTRUCT THE ENABLE INSTRUCTION
00575  P0059C  0B70                               ORR     R7,R6
       P0059E      0002
00576  P005A0  D7000CAC    P00CAC                STW     R6,ENABDVRY
00577                                  *
00578                                  *        CONNECT THE DEVICE READY INTERRUPT TO THE TRAP LOCATION
00579                                  *
00580                                  *        TRAP LOCATION = TCW LOCATION + X'40'
00581                                  *
00582  P005A4  AC800CE4    P00CE4                LW      R1,PAMTCW
00583  P005A8  C8810040                          ADI     R1,X'40'
00584  P005AC  D3800BE8    P00BE8                LEA     R7,DVRYHAND
00585  P005B0  87802334   P02334                ANMW    R7,=X'7FFFC'
00586  P005B4  D7A00000     00000                STW     R7,0,R1
00587                                  *
00588                                  *        STORE THE ADR OF THER PAM SI INTERRUPT (DVRY)
00589                                  *        INTO THE TABLE OF HIOCS SI HANDLER ADDRESSES
00590                                  *
00591  P005B8  C901FFEC                          ADI     R2,-X'14'       FORM WORD INDEX OUT OF PRIORITY
00592  P005BC  7142                               SLL     R2,2            (0W-15W)
       P005BE      0002
00593  P005C0  D7C01EE0    P01EE0                STW     R7,HYBSI1,R2    SHOVE IT INTOP THE TABLE
00594                                  *
00595                                  *        DISABLE THE DEVICE READY INTERRUPT TO CLEAR THE FLOP
00596                                  *
00597  P005C4  A8000CB1    P00CB0                EXM     DISADVRY
00598                                  *
00599                                  *        ENABLE THE DEVICE READY INTERRUPT
00600                                  *
00601  P005C8  A8000CAD    P00CAC                EXM     ENABDVRY
00602                                  *
00603                                  *        FOLLOWING CODE REPLACES THE NONPRESENT
00604                                  *        MEMORY TRAP WITH AN HIOCS HANDLER
00605                                  *
00606  P005CC  FC030000                          AI      0               TURN EVERYBODY OFF
00607  P005D0  AE800190     00190                LW      R5,X'190'       SAVEKTM'S ADDRESS
00608  P005D4  D6802218   P02218                STW     R5,NONMEMIH
00609  P005D8  D2001BC0   P01BC0                LEA     R4,HYBNOMEM     REPLACE WITH THE HANDLER
00610  P005DC  86002334   P02334                ANMW    R4,=X'7FFFC'    WITHIN HIOCS
00611  P005E0  D6000190     00190                STW     R4,X'190'
00612                                  *
00613                                  *        FOLLOWING CODE REPLACES THE ARITHMETIC
00614                                  *        EXCEPTION TRAP WITH AN HIOCS HANDLER
00615                                  *
00616  P005E4  AE8001A4     001A4                LW      R5,X'1A4'       SAVE RTM'S ADDRESS
00617  P005E8  D6802224   P02224                STW     R5,ARITHEXC
00618  P005EC  D2001C24   P01C24                LEA     R4,ARITHAND     REPLACE WITH THE
00619  P005F0  86002334   P02334                 ANMW    R4,=X'7FFFC'   HANDLER WITHIN HIOCS
00620  P005F4  D6001A4      001A4               STW     R4,X'1A4'
00621  P005F8  FC040000                           DAI     0               TURN EVERYBODY ON]]
00622                                  *
00623                                  *        CONSTRUCT THE ENABLE AND DISABLE INTERRUPT
00624                                  *        FOR THE DAM DCM SI INTERRUPT
00625                                  *
00626                                  *        PRIORITY =(TCW-X'100')/4 +X'14'
00627                                  *
00628  P005FC  AF800CEC    P00CEC                LW      R7,DAMTCW
00629  P00600  CB81FF00                          ADI     R7,-X'100'
00630  P00604  7382                               SRL     R7,2
       P00606      0002
00631  P00608  CB810014                          ADI     R7,X'14'        R7 NOW = PRIORITY #
00632  P0060C  2CF0                               TRR     R7,R1           SAVE PRIORITY
00633  P0060E      73D3                           SLL     R7,19           SHIFT PRIORITY TO BITS 6-12
00634  P00610  8B802198   P02198                ORMW    R7,DISAPROT     "OR" PRIORITY WITH DI 0 INSTRUCTION
00635  P00614  D78021A8   P021A8                STW     R7,DISADASI     STORE AWAY
00636  P00618  1FF1                               ZBR     R7,15           FORM AND SAVE ENABLE INSTRUCTION
       P0061A      0002
00637  P0061C  D78021A0   P021A0                STW     R7,ENABDASI
00638                                  *
00639                                  *        STORE THE ADR OF THE DAM DCM SI HANDLER INTO
00640                                  *        THE TABLE OF HIOCS SI HANDLER ADDRESSES
00641                                  *        AND INTO THE DAM SI TRAP LOCATION
```

```
00642                                   *
00643  P00620  C881FFEC                         ADI     R1,-X'14'        FORM WORD INDEX OUT OF PRIORITY
00644  P00624  70C2                             SLL     R1,2
       P00626      0002
00645  P00628  D30019CC     P019CC              LEA     R6,DAMDCMSI      FETCH ADR OF HANDLER
00646  P0062C  87002334     P02334              ANMW    R6,=X'7FFFC'
00647  P00630  D7201EE0     P01EE0              STW     R6,HYBSI1,R1     STORE ADR INTO TABLE
00648  P00634  AD800CEC     P00CEC              LW      R3,DAMTCW        SI LOCATION = TCW + X'40'
00649  P00638  C9810040                         ADI     R3,X'40'
00650  P0063C  D7600000      00000              STW     R6,0,R3          SHOVE IT INTO THE TRAP LOCATION
00651                                   *
00652                                   *                CONSTRUCT THE ENABLE AND DISABLE INTERRUPT
00653                                   *                INSTRUCTIONS FOR THE ADC DCM SI INTERRUPT
00654                                   *
00655  P00640  AF800CE8     P00CE8              LW      R7,ADCTCW
00656  P00644  C881FF00                         ADI     R7,-X'100'
00657  P00648  7382                             SRL     R7,2
       P0064A      0002
00658  P0064C  C8810014                         ADI     R7,X'14'
00659  P00650  2CF0                             TRR     R7,R1            SAVE PRIORITY
00660  P00652      73D3                         SLL     R7,19
00661  P00654  88802198     P02198              ORMW    R7,DISAPROT
00662  P00658  D78021A4     P021A4              STW     R7,DISAADSI
00663  P0065C  1FF1                             ZBR     R7,15
       P0065E      0002
00664  P00660  D780219C     P0219C              STW     R7,ENABADSI
00665                                   *
00666                                   *                STORE THE ADR OF THE ADC DCM SI HANDLER INTO
00667                                   *                THE TABLE OF MIOCS SI HANDLER ADDRESSES
00668                                   *                AND INTO THE ADC SI TRAP LOCATION
00669                                   *
00670  P00664  C881FFEC                         ADI     R1,-X'14'        FORM WORD INDEX OUT OF PRIORITY
00671  P00668  70C2                             SLL     R1,2
       P0066A      0002
00672  P0066C  D30018B8     P01B8B              LEA     R6,ADCDCMSI      FETCH ADR OF HANDLER
00673  P00670  87002334     P02334              ANMW    R6,=X'7FFFC'
00674  P00674  D7201EE0     P01EE0              STW     R6,HYBSI1,R1     STORE ADR INTO TABLE
00675  P00678  AD800CE8     P00CE8              LW      R3,ADCTCW        ADC SI TRAP LOCATION = TCW + X'40'
00676  P0067C  C9810040                         ADI     R3,X'40'
00677  P00680  D7600000      00000              STW     R6,0,R3          SHOVE IT INTO SI TRAP LOCATION
00678  P00684  EC000A85     P00A84              BU      GOODRTN9         SPLIT
00679                                   *
00680                                   *                INTERNAL SUBROUTINE ''DEATCWMP''
00681                                   *
00682                                   *                THIS ROUTINE MAPS A DEA (R4) TO THE CORRESPONDING TCW
00683                                   *
00684  P00688  C880FFF0                 DEATCWMP LI     R1,-16           R1 = INDEX AND ITERATION CONTROL
00685  P0068C  AEA80CC4     P00CC4      DEATCWLP LB     R5,DEALIST+16B,R1   FIND A MATCH
00686  P00690  1250                             CAR     R5,R4            =?
       P00692      0002
00687  P00694  EE00069F     P0069E              BCT     EQ,DEATCWMA
00688  P00698  F480068D     P0068C              BIB     R1,DEATCWLP      TRY AGAIN
00689  P0069C  0000                             HALT                     THIS HALT IS FOR DEBUG ONLY NEVER HAPPEN
00690                                   *
00691                                   *                TCW ADR = (R1+16)*4 + X'100'
00692                                   *
00693  P0069E      70C1                 DEATCWMA SLL    R1,1             FORM 1/2 WORD INDEX OUT OF R1
00694  P006A0  ACA00CE5     P00CE4              LH      R1,TCWLIST+16H,R1   FETCH PROPER TCW LOCATION
00695  P006A4  2800                             TRSW    R0               SPLIT
00696                                   *
00697                                   *                COMES HERE TO DE-ALLOCATE AN ANALOG CONSOLE
00698                                   *
00699  P006A6                           DALOCSL EQU     $
       P006A6      0002
00700  P006A8  C880FFFA                         LI      R7,-6            FIND A MATCH
00701  P006AC  0C90                             ZR      R1
       P006AE      0002
00702  P006B0  AF200EC8     P00EC8      DALOOP8 LW      R6,ALOCCSLL,R1
00703  P006B4  1160                             CAR     R6,R2
       P006B6      0002
00704  P006B8  EE0006C9     P006C8              BCT     EQ,DAMATCH       FOUND A MATCH??
00705  P006BC  C881000C                         ADI     R1,3W            BUMP TABLE INDEX
00706  P006C0  F78006B1     P006B0              BIB     R7,DALOOP8      2,4,6,8 LET'S ITERATE
00707  P006C4  0000                             HALT                     NEVER SHOULD GET HERE}}}}}
       P006C6      0002
00708  P006C8  C880FFFF                 DAMATCH LI      R7,-1            DELETE THE ALLOCATION TABLE ENTRY
00709  P006CC  D7E00EC8     P00EC8              STW     R7,ALOCCSLL,R3
00710  P006D0  D7E00ECC     P00ECC              STW     R7,ALOCCSLL+1W,R3
00711  P006D4  D7E00ED0     P00ED0              STW     R7,ALOCCSLL+2W,R3
00712  P006D8  EC000A85     P00A84              BU      GOODRTN9         SPLIT
00713                                   *
00714                                   *                COMES HERE TO CONNECT A DCM ERROR INTERRUPT
```

```
00715                                   *                TO A USER'S FORTRAN SUBROUTINE
00716                                   *
00717  P006DC                           INITHINT EQU      $
00718  P006DC  2CA0                             TRR      R2,R1
00719  P006DE       709B                        SRL      R1,27          FORM WORD INDEX OUT OF INTERRUPT TYPE
00720  P006E0  84802338     P02338              ANMW     R1,=X'C'       STRIP IT
00721  P006E4  2E20                             TRR      R2,R4
       P006E6       0002
00722  P006E8  86002334     P02334              ANMW     R4,=X'7FFFC'   CONSTRUCT A BRANCH AND LINK INSTRUCT-
00723  P006EC  8A001E6C     P01E6C              ORMW     R4,BLINST      ION IN R4
00724  P006F0  7118                             SRL      R2,24          FORM WORD INDEX OUT OF TCR #
       P006F2       0002
00725  P006F4  C901FFFC                         ADI      R2,-1W         R2 = (0W-5W) AS AN INDEX OF TCR(S)
00726  P006F8  8500233C     P0233C              ANMW     R2,=X'1C'      STRI7  3
00727  P006FC  EC200701     P00700              BU       $+1W,R1
00728  P00700  EC000715     P00714              BU       CONADCOV       R1 = 0 => ADC OVERSCALE
00729  P00704  EC00071D     P0071C              BU       CONADCDE       R1 = 1W=> ADC DATA RATE ERROR
00730  P00708  EC000725     P00724              BU       CONDAMFP       R1 = 2W=> DAM FLOATING POINT OVERFLOW
00731  P0070C  A8400720     P0072C   CONDAMDE  EXM      DAMDETAB,R2    R1 = 3W=> DAM DATA RATE ERROR
00732  P00710  EC000A85     P00A84              BU       GOODRTN9
00733  P00714  A8400775     P00774   CONADCOV  EXM      ADCOVTAB,R2
00734  P00718  EC000A85     P00A84              BU       GOODRTN9
00735  P0071C  A8400745     P00744   CONADCDE  EXM      ADCDETAB,R2
00736  P00720  EC000A85     P00A84              BU       GOODRTN9
00737  P00724  A8400750     P0075C   CONDAMFP  EXM      DAMFPTAB,R2
00738  P00728  EC000A85     P00A84              BU       GOODRTN9
00739  P0072C  D6001A2C     P01A2C   DAMDETAB  STW      R4,DAMDER1
00740  P00730  D6001A34     P01A34              STW      R4,DAMDER2
00741  P00734  D6001A3C     P01A3C              STW      R4,DAMDER3
00742  P00738  D6001A44     P01A44              STW      R4,DAMDER4
00743  P0073C  D6001A4C     P01A4C              STW      R4,DAMDER5
00744  P00740  D6001A24     P01A24              STW      R4,DAMDER6
00745  P00744  D60018F8     P018F8   ADCDETAB  STW      R4,ADCDER1
00746  P00748  D6001900     P01900              STW      R4,ADCDER2
00747  P0074C  D6001908     P01908              STW      R4,ADCDER3
00748  P00750  D6001910     P01910              STW      R4,ADCDER4
00749  P00754  D6001918     P01918              STW      R4,ADCDER5
00750  P00758  D60018F0     P018F0              STW      R4,ADCDER6
00751  P0075C  D6001A74     P01A74   DAMFPTAB  STW      R4,DAMFLT1
00752  P00760  D6001A7C     P01A7C              STW      R4,DAMFLT2
00753  P00764  D6001A84     P01A84              STW      R4,DAMFLT3
00754  P00768  D6001A8C     P01A8C              STW      R4,DAMFLT4
00755  P0076C  D6001A94     P01A94              STW      R4,DAMFLT5
00756  P00770  D6001A6C     P01A6C              STW      R4,DAMFLT6
00757  P00774  D6001940     P01940   ADCOVTAB  STW      R4,ADCOVRS1
00758  P00778  D6001948     P01948              STW      R4,ADCOVRS2
00759  P0077C  D6001950     P01950              STW      R4,ADCOVRS3
00760  P00780  D6001958     P01958              STW      R4,ADCOVRS4
00761  P00784  D6001960     P01960              STW      R4,ADCOVRS5
00762  P00788  D6001938     P01938              STW      R4,ADCOVRS6
00763                                   *
00764                                   *                COMES HERE TO REQUEST REAL-TIME(GORILLA) USAGE
00765                                   *
00766  P0078C                           GORT     EQU      $
00767  P0078C  AC801E70     P01E70              LW       R1,GORTASK     IS ANOTHER GORILLA IN THE SYSTEM
00768  P00790  EE000799     P00798              BCT      EQ,$+2W
00769  P00794  F910000D     P0000C              BRI      *INT.PSW       ANOTHER GORILLA IS ACTIVE
00770                                   *                               RETURN TO CALLER
00771  P00798  D6001E72     P01E70              STD      R4,GORTASK     SAVE THE TASK ID OF THE GORILLA TASK
00772  P0079C  AD00088C      0088C              LW       R2,C.MOOD      THIS CODE SAVES THE
00773  P007A0  AD400008      00008              LW       R2,H.MONS*1W,R2 ADDRESS OF THE ABORT
00774  P007A4  AD400050      00050              LW       R2,20W,R2      ROUTINE
00775  P007A8  D5002210     P02210              STW      R2,SAVABORT    FOR THE GORILLA
00776  P007AC  AC800878      00878              LW       R1,C.TSAD
00777  P007B0  D4802214     P02214              STW      R1,GORTSA      SAVE ADR OF GORILLA TSA
00778                                   *
00779                                   *                ENABLE THE ADC AND DAM DCM SI INTERRUPTS
00780                                   *
00781  P007B4  A80021A9     P021A8              EXM      DISADASI
00782  P007B8  A80021A1     P021A0              EXM      ENABDASI
00783  P007BC  A80021A5     P021A4              EXM      DISAADSI
00784  P007C0  A800219D     P0219C              EXM      ENABADSI
00785  P007C4  EC000A85     P00A84              BU       GOODRTN9       SPLIT
00786                                   *
00787                                   *                COMES HERE TO UN-GORILLAZE THE CURRENT GORILLA
00788                                   *
00789  P007C8  F88007D1     P007D0   NOTGORT  BL       UNGORILA
00790  P007CC  EC000A85     P00A84              BU       GOODRTN9
00791                                   *
00792                                   *                THIS INTERNAL SUBROUTINE UNGORILLIZES
00793                                   *                THE CURRENT GORILLA
00794  P007D0  A80021A5     P021A4   UNGORILA EXM       DISAADSI       DISABLE THE ADC DCM SI
```

```
00795  P007D4  A80021A9   P021A8          EXM      DISADASI        DISABLE THE DAM DCM SI
00796  P007D8  AF801E68   P01E68          LW       R7,RA0PRIO      FETCH PRIORITY OF 1ST R/A INTERRUPT
00797  P007DC  7303                       SLL      R7,19
       P007DE       0002
00798  P007E0  8B802198   P02198          ORMW     R7,DISAPROT     R7 = DISABLE R/A 0 INST.
00799  P007E4  CB00FFF0                   LI       R6,-16          R6 = ITERATION CONTROL
00800  P007E8  CB870000              UNGORLOP EXR  R7              DISABLE 1ST/NEXT R/A INTERRUPT
00801  P007EC  2271                       ABR      R7,12
       P007EE       0002
00802  P007F0  F70007E9   P007E8          BIB      R6,UNGORLOP
00803  P007F4  F8081E80   P01E80          ZMB      GORACC          ZERO OUT # OF GORILLAS ACTIVE COUNT
00804  P007F8  F8001E72   P01E70          ZMD      GORTASK         ZERO OUT THE GORILLA FLAG
00805                                 *
00806                                 *              RESET THE AMPLIFIER OVERLOAD MASK
00807                                 *
00808  P007FC  F8100CE4   P00CE4          ZMW      *PAMTCW
00809  P00800  A8000821   P00820          EXM      SETAMPMK
00810  P00804  C900F82F                   LI       R2,-2001        LOOP ONM TO 8000 TILL ALL CC(S) RESET
00811  P00808  A8000BD5   P00BD4          EXM      PAMTD
00812  P0080C  EF800815   P00814          BCT      7,$+2W
00813  P00810  EC00081D   P0081C          BU       $+3W
00814  P00814  F5000809   P00808          BIB      R2,$-3W
00815  P00818  0000                       HALT                     THE PAM IS BROKEN
       P0081A       0002
00816  P0081C  F8002220   P0222C          ZMH      RAOCCURD        ZERO OUT # OF GORILLA INTS OCCURED
00817  P00820  C900FFA0                   LI       R2,-24W         ZERO OUT DCM ERROR COUNTERS
00818  P00824  F840220C   P0220C          ZMW      DAFP1FLG+24W,R2
00819  P00828  F5400825   P00824          BIW      R2,$-1W
00820  P0082C  2800                       TRSW     R0              RETURN
00821                                 ***********************************************************************
00822                                 *
00823                                 *              TYPE 6 OUTPUT  --  ADC NO OUTPUT FUNCTIONS
00824                                 *
00825                                 ***********************************************************************
00826  P0082E                         ADCNONOT EQU  $
00827  P0082E       70C2                     SLL      R1,2            FORM WORD INDEX OUT OF R1
00828  P00830  EC27F035   PFF034          BU       $+1W-X'1800',R1
00829  P00834  EC000840   P0084C          BU       ADALOTCR
00830  P00838  EC000889   P00888          BU       ADCPCWLD
00831  P0083C  EC000881   P00880          BU       ADCHAIN
00832  P00840  EC0008CD   P008CC          BU       ADLOOP
00833  P00844  EC0008F9   P008F8          BU       ADOALTCR
00834  P00848  EC000919   P00918          BU       ADALTCRP
00835                                 *
00836                                 *              COMES HERE TO ALLOCATE (S/W ALLOCATION) AN ADC TCR
00837                                 *              FOR TIMER AND DIGITAL INST. ONLY
00838                                 *
00839  P0084C                         ADALOTCR EQU  $
00840  P0084C  D7800D44   P00D44          STW      R7,INDIRECT     SAVE ADR. OF QQHYBOUT PUSH STACK
00841  P00850  CB80FFFA                   LI       R7,-6           FIND AN EMPTY SLOT IN THE
00842  P00854  C880003C                   LI       R1,15W          BACKWARDS SEARCH OF THE LIST
00843  P00858  AF200F10   P00F10      ADTCRBK LW       R6,ADTCRTAB,R1
00844  P0085C  ED80086D   P0086C          BCT      LT,ADTCRMAP
00845  P00860  C881FFF4                    ADI      R1,-3W
00846  P00864  F7800859   P00858          BIB      R7,ADTCRBK      ITERATE
00847  P00868  EC000AB5   P00AB4          BU       ERROR43         NO ADC TCR'S ARE AVAILABLE
00848  P0086C  2FF4                   ADTCRMAP TRN  R7,R7           FOUND AN EMPTY ADC TCR SLOT
       P0086E       0002
00849  P00870  D7A00F10   P00F10          STW      R7,ADTCRTAB,R1  PUT TCR # INTO ITS SLOT
00850  P00874  D6200F14   P00F14          STW      R4,ADTCRTAB+1W,R1 PUT TASK ID INTO THE NEXT TWO WORDS
00851  P00878  D6A00F18   P00F18          STW      R5,ADTCRTAB+2W,R1
00852  P0087C  AC800D44   P00D44          LW       R1,INDIRECT     PASS THE PHYSICAL TCR # INTO THE
00853  P00880  D7A00008    00008          STW      R7,2W,R1        R2 POSITION OF THE QQHYBOUT REGISTER
00854  P00884  EC000A85   P00A84          BU       GOODRTN9
00855                                 *
00856                                 *              COMES HERE TO STORE A CPCW WITHIN A TCR CPCW STACK
00857                                 *
00858  P00888                         ADCPCWLD EQU  $
00859  P00888  2CF0                     TRR      R7,R1           R1 NOW AAS ADR OF QQHYBOUT REG STACK
       P0088A       0002
00860  P0088C  ADA0001C    0001C          LW       R3,7W,R1        FETCH PHYSICAL TCR # IN R3
00861  P00890  C981FFFF                   ADI      R3,-1           FORM INDEX OF CPCW STACKS OUT OF R3
00862  P00894  71C5                       SLL      R3,5             *32
       P00896       0002
00863  P00898  B9A0000C    0000C          ADMW     R3,3W,R1        ADD IN THE TCR STACK INDEX
00864  P0089C  AF200008    00008          LW       R6,2W,R1        FETCH CPCW1
00865  P008A0  D7600D48   P00D48          STW      R6,ADCCPCW1,R3  STORE IN PROPER CPCW STACK
00866  P008A4  AF200018    00018          LW       R6,6W,R1        FETCH CPCW2
00867  P008A8  D7600D4C   P00D4C          STW      R6,ADCCPCW1+1W,R3  STORE IN PROPER CPCW STACK
00868  P008AC  EC000A85   P00A84          BU       GOODRTN9
00869                                 *
00870                                 *              COMES HERE TO STORE A CPCW WITHIN A TCR CPCW STACK
```

```
00871                                  *
00872                                  *
00873                                  *              COMES HERE TO CHAIN TWO ADC CPCW(S)
00874                                  *
00875  P008B0                          ADCHAIN  EQU      $
00876  P008B0  2CF0                            TRR      R7,R1            R1, HAS ADR OF QQHYBOUT REGISTER STACS
       P008B2       0002
00877  P008B4  ADA0001C     0001C              LW       R3,7W,R1         FETCH PHYSICAL TCR#
00878  P008B8  C981FFFF                       ADI      R3,-1            FORM INDEX
00879  P008BC  71C5                           SLL      R3,5             MULTIPLY BY 32
       P008BE       0002
00880  P008C0  B9A0000C     0000C              ADMW     R3,3W,R1         ADD IN CPCW STACK INDEX
00881  P008C4  99680D48    P00D48              SBM      2,ADCCPCW1,R3    SET THE CHAIN BIT
00882  P008C8  EC000A85    P00A84              BU       GOODRTN9
00883                                  *
00884                                  *              COMES HERE TO SET THE LOOP BIT IN A CPCW (ADC)
00885                                  *
00886  P008CC                          ADLOOP   EQU      $
00887  P008CC  2CF0                            TRR      R7,R1            R1 HAS ADR OF QQHYBOUT REGISTER STACK
       P008CE       0002
00888  P008D0  ADA0001C     0001C              LW       R3,7W,R1         FETCH PHYSICAL TCR #
00889  P008D4  2E30                           TRR      R3,R4            PUT TCR # IN BITS 1-5 OF R4
00890  P008D6       725A                      SLL      R4,26
00891  P008D8  C981FFFF                       ADI      R3,-1            FORM INDEX
00892  P008DC  71C5                           SLL      R3,5             * 32
       P008DE       0002
00893  P008E0  D3600D48    P00D48              LEA      R6,ADCCPCW1,R3   FETCH ADR. OF TOP OF STACK
00894  P008E4  87002334    P02334              ANMW     R6,=X'7FFFC'     STRIP AWAY LEA GARBAGE BITS
00895  P008E8  0B40                           ORR      R4,R6            "OR" IN TCR IN BITS 1-5
00896  P008EA       1860                      SBR      R6,0             SET LOOP BIT
00897  P008EC  B9A0000C     0000C              ADMW     R3,3W,R1         ADD IN CPCW STACK INDEX
00898  P008F0  D7600D48    P00D48              STW      R6,ADCCPCW1,R3   STORE IN CPCW STACK
00899  P008F4  EC000A85    P00A84              BU       GOODRTN9
00900                                  *
00901                                  *              COMES HERE TO DE-ALLOCATE AN ADC TCR
00902                                  *
00903  P008F8                          ADDALTCR EQU      $
00904  P008F8  C901FFFF                       ADI      R2,-1            FORM INDEX OUT OF TCR #
00905  P008FC  7142                           SLL      R2,2
00906  P008FE       2DA0                      TRR      R2,R3
00907  P00900  C9030003                       MPI      R2,3             ANSWER IN R3
00908  P00904  C900FFFF                       LI       R2,-1
00909  P00908  D5600F10    P00F10              STW      R2,ADTCRTAB,R3      PUT-J INTO THE
00910  P0090C  D5600F14    P00F14              STW      R2,ADTCRTAB+1W,R3   SLOTS (3 IN TOTAL)
00911  P00910  D5600F18    P00F18              STW      R2,ADTCRTAB+2W,R3
00912  P00914  EC000A85    P00A84              BU       GOODRTN9
00913                                  *
00914                                  *              COMES HERE TO ALLOCATE AN ADC TCR FOR PATCH PANEL CONTROL
00915                                  *
00916  P00918                          ADALTCRP EQU      $
00917                                  *              INDEX THROUGH THE PHYSICAL TCR TABLE = 12(CSL#)-12
00918  P00918  2F20                            TRR      R2,R6            SAVE CSL #
00919  P0091A       2DA0                      TRR      R2,R3            CALCULATE INDEX IN R3
00920  P0091C  C903000C                       MPI      R2,12
00921  P00920  C981FFF4                       ADI      R3,-12
00922  P00924  AFE00F10    P00F10              LW       R7,ADTCRTAB,R3   IS THE TCR FREE?????
00923  P00928  ED800931    P00930              BCT      LT,$+2W
00924  P0092C  EC000A85    P00A84              BU       ERROR43
00925  P00930  D7600F10    P00F10              STW      R6,ADTCRTAB,R3   STORE CSL#
00926  P00934  D6600F14    P00F14              STW      R4,ADTCRTAB+1W,R3   STORE TASK ID
00927  P00938  D6E00F18    P00F18              STW      R5,ADTCRTAB+2W,R3
00928  P0093C  EC000A85    P00A84              BU       GOODRTN9         SPLIT
00929                                  ***********************************************************************
00930                                  *
00931                                  *              TYPE 7 OUTPUT  --  DAM NO OUTPUT FUNCTIONS
00932                                  *
00933                                  ***********************************************************************
00934  P00940                          DAMNONOT EQU      $
00935  P00940  70C2                            SLL      R1,2             FORM WORD INDEX OUT OF R1
       P00942       0002
00936  P00944  EC27ED49    PFED48              BU       $+1W-X'1C00',R1
00937  P00948  EC000961    P00960              BU       DAALOTCR         ALLOCATE A DAM TCR
00938  P0094C  EC00099D    P0099C              BU       DACPCWLD         LOAD A DAM CPCW WITHIN A CPCW STACK
00939  P00950  EC0009C5    P009C4              BU       DACHAIN          SET THE CHAIN BIT IN A DAM CPCW
00940  P00954  EC0009E1    P009E0              BU       DALOOP           SET THE LOOP BIT IN A DAM CPCW
00941  P00958  EC000A0D    P00A0C              BU       DADALTCR         DEALLOCATE A DAM TCR
00942  P0095C  EC000A2D    P00A2C              BU       DAALTCRP
00943                                  *
00944                                  *              COMES HERE TO ALLOCATE (S/W ALLOCATION) A DAM TCR
00945                                  *              FOR TIMER AND DIGITAL INST. ONLY
00946                                  *
00947  P00960                          DAALOTCR EQU      $
```

```
00948  P00960  D7800D44   P00D44              STW     R7,INDIRECT       SAVE ADR. OF QQHYBOUT PUSH STACK
00949  P00964  C880FFFA                       LI      R7,-6             FIND AN EMPTY SLOT IN THE
00950  P00968  C880003C                       LI      R1,15W            BACKWARDS SEARCH OF THE LIST
00951  P0096C  AF200F58   P00F58    DATCRBK   LW      R6,DATCRTAB,R1
00952  P00970  ED800981   P00980              BCT     LT,DATCRMAP
00953  P00974  C881FFF4                        ADI     R1,-3W
00954  P00978  F780096D   P0096C              BIB     R7,DATCRBK
00955  P0097C  EC000A85   P00AB4              BU      ERROR43           NO DAM TCR'S ARE AVAILABLE
00956  P00980  2FF4                  DATCRMAP TRN     R7,R7             FOUND AN EMPTY SLOT IN THE DAM TCR LS
       P00982        0002
00957  P00984  D7A00F58   P00F58              STW     R7,DATCRTAB,R1    PUT TER# INTO SLOT
00958  P00988  D6200F5C   P00F5C              STW     R4,DATCRTAB+1W,R1   PUT TASK ID INTO NEXT 2 WORDS
00959  P0098C  D6A00F60   P00F60              STW     R5,DATCRTAB+2W,R1
00960  P00990  AC800D44   P00D44              LW      R1,INDIRECT       PASS THE PHYSICAL TCR# INTO THE
00961  P00994  D7A00008    00008              STW     R7,2W,R1          R2 POSITION OF THE QQHYBOUT REGISTER
00962  P00998  EC000A85   P00A84              BU      GOODRTN9
00963                                  *
00964                                  *                COMES HERE TO STORE A CPCW WITHIN A TCR CPCW STACK
00965                                  *
00966  P0099C                          DACPCWLD EQU     $
00967  P0099C  2CF0                            TRR     R7,R1             R1 = ADR OF QQHYBOUT REGISTER STACK
       P0099E        0002
00968  P009A0  ADA0001C    0001C              LW      R3,7W,R1          FETCH PHYSCIAL TCR # 1W R3
00969  P009A4  C981FFFF                       ADI     R3,-1             FORM INDEX OF CPCW STACKS OUT OF R3
00970  P009A8  71C5                           SLL     R3,5              MULTIPLY BY 32
       P009AA        0002
00971  P009AC  89A0000C    0000C              ADMW    R3,3W,R1          ADD IN THE TCR STACK INDEX
00972  P009B0  AF200008    00008              LW      R6,2W,R1          FETCH CPCW1
00973  P009B4  D7600E08   P00E08              STW     R6,DAMCPCW1,R3    STORE IN PROPER CPCW STACK
00974  P009B8  AF200018    00018              LW      R6,6W,R1          FETCH CPCW2
00975  P009BC  D7600E0C   P00E0C              STW     R6,DAMCPCW1+1W,R3
00976  P009C0  EC000A85   P00A84              BU      GOODRTN9
00977                                  *
00978                                  *                COMES HERE TO CHAIN TWO DAM CPCW(S)
00979                                  *
00980  P009C4                          DACHAIN  EQU     $
00981  P009C4  2CF0                            TRR     R7,R1             R1 HAS ADR. OF QQHYBOUT REG STACK
       P009C6        0002
00982  P009C8  ADA0001C    0001C              LW      R3,7W,R1          FETCH PHYSCIAL TCR #
00983  P009CC  C981FFFF                       ADI     R3,-1             FORM INDEX
00984  P009D0  71C5                           SLL     R3,5              * 32
       P009D2        0002
00985  P009D4  89A0000C    0000C              ADMW    R3,3W,R1          ADD IN CPCW STACK INDEX
00986  P009D8  99680E08   P00E08              SBM     2,DAMCPCW1,R3     SET THE CHAIN BIT
00987  P009DC  EC000A85   P00A84              BU      GOODRTN9
00988                                  *
00989                                  *                COMES HERE TO SET THE LOOP BIT IN A DAM CPCW
00990                                  *
00991  P009E0                          DALOOP   EQU     $
00992  P009E0  2CF0                            TRR     R7,R1             R1 HAS ADR OF QQHYBOUT REGISTER STACK
       P009E2        0002
00993  P009E4  ADA0001C    0001C              LW      R3,7W,R1          FETCH PHYSCIAL TCR #
00994  P009E8  2E30                           TRR     R3,R4             PUT TCR # IN BITS 1-5 OF R4
00995  P009EA       725A                      SLL     R4,26
00996  P009EC  C981FFFF                       ADI     R3,-1             FORM INDEX
00997  P009F0  71C5                           SLL     R3,5              $ 32
       P009F2        0002
00998  P009F4  D3600E08   P00E08              LEA     R6,DAMCPCW1,R3    FETCH ADR. OF TOP OF STACK
00999  P009F8  87002334   P02334              ANMW    R6,=X'7FFFC'      STRIP AWAY LEA GARBAGE BITS
01000  P009FC  0B40                           ORR     R4,R6             "OR" IN TCR IN BITS 1-5
01001  P009FE       1860                      SBR     R6,0              SET LOOP BIT
01002  P00A00  89A0000C    0000C              ADMW    R3,3W,R1          ADD IN CPCW STACK INDEX
01003  P00A04  D7600E08   P00E08              STW     R6,DAMCPCW1,R3    STORE IN CPCW STACK
01004  P00A08  EC000A85   P00A84              BU      GOODRTN9
01005                                  *
01006                                  *                COMES HERE TO DE-ALLOCATE A DAM TCR
01007                                  *
01008  P00A0C                          DADALTCR EQU     $
01009  P00A0C  C901FFFF                       ADI     R2,-1             FORM INDEX OUT OF TCR #
01010  P00A10  7142                           SLL     R2,2
01011  P00A12       2DA0                      TRR     R2,R3
01012  P00A14  C9030003                       MPI     R2,3
01013  P00A18  C900FFFF                       LI      R2,-1
01014  P00A1C  D5600F58   P00F58              STW     R2,DATCRTAB,R3
01015  P00A20  D5600F5C   P00F5C              STW     R2,DATCRTAB+1W,R3  PUT-1 INTO THE 3 SLOTS
01016  P00A24  D5600F60   P00F60              STW     R2,DATCRTAB+2W,R3
01017  P00A28  EC000A85   P00A84              BU      GOODRTN9
01018                                  *
01019                                  *                COMES HERE TO ALLOCATE AN DAM TCR FOR PATCH PANEL CONTROL
01020                                  *
01021  P00A2C                          DAALTCRP EQU     $
01022                                  *        INDEX THROUGH THE PHYSICAL TCR TABLE = 12(CSL#)-12
01023  P00A2C  2F20                            TRR     R2,R6             SAVE CSL #
```

```
01024  P00A2E      2DA0                        TRR     R2,R3            CALCULATE INDEX IN R3
01025  P00A30  C903000C                        MPI     R2,12
01026  P00A34  C981FFF4                        ADI     R3,-12
01027  P00A38  AFE00F58   P00F58               LW      R7,DATCRTAB,R3   IS THE TCR FREE?????
01028  P00A3C  ED800A45   P00A44               BCT     LT,S+2W
01029  P00A40  EC000AB5   P00AB4               BU      ERROR43
01030  P00A44  D7600F58   P00F58               STW     R6,DATCRTAB,R3   STORE CSL#
01031  P00A48  D6600F5C   P00F5C               STW     R4,DATCRTAB+1W,R3   STORE TASK ID
01032  P00A4C  D6E00F60   P00F60               STW     R5,DATCRTAB+2W,R3
01033  P00A50  EC000A85   P00A84               BU      GOODRTN9         SPLIT
01034                                 ***********************************************************
01035                                 *
01036                                 *              OUTPUT TYPE 8 - MVFG OUTPUT
01037                                 *
01038                                 ***********************************************************
01039  P00A54                         MVFGOUT EQU     $
01040  P00A54  FC030000               AI      0
01041  P00A58  D5100CE4   P00CE4               STW     R2,*PAMTCW       STORE WORD IN TCW FOR MVFG
01042  P00A5C  70C2                           SLL     R1,2
       P00A5E       0002
01043  P00A60  C9800010                        LI      R3,4W            TEST STATUS OF HARDWARE
01044  P00A64  EC000A69   P00A68               BU      STATLOOP
01045                                 *
01046                                 *              ALL ACTUAL HYBRID I/O COMES HERE AFTER THE CD
01047                                 *              INSTRUCTION TO TEST UPON THE TD INSTRUCTION. R3
01048                                 *              IS AN INDEX WHICH DETERMINES WHICH TD INSTRUCTION
01049                                 *              IS TO BE EXECUTED AND WHICH TCW IS EMPLOYED.
01050                                 *
01051  P00A68  C880FFE7               STATLOOP LI     R7,-25           TIME OUT AFTER 25 ATTEMPTS
01052  P00A6C  A86008D5   P00BD4     TDLOOP  EXM     PAMTD,R3         EXECUTE THE INDEXED TD INSTRUCTION
01053  P00A70  EF800A79   P00A78               BCT     7,IONOTDON       I/O COMPLETED WHEN ALL CC(S) ARE RESET
01054  P00A74  EC000A81   P00A80               BU      GOODRTN          A-OK
01055  P00A78  F7800A6D   P00A6C     IONOTDON BIB    R7,TDLOOP        2,4,6,8, LET'S ITERATE]]]]]]
01056  P00A7C  EC000AA5   P00AA4               BU      ERROR26          I/O TIMED OUT CALL CUSTOMER SERVICE
01057  P00A80  AD700CE4   P00CE4     GOODRTN  LW      R2,*PAMTCW,R3    FETCH DATA FROM THE PROPER TCW LOCATION
01058  P00A84  C8800001               GOODRTN9 LI     R7,1             NO ERROR
01059  P00A88  FC040000               DAI     0
01060  P00A8C  A288000F   P0000F               ABM     29,INT.PSW       BUMP LINK-OUT BY 1 WORD
01061  P00A90  F9100000   P0000C               BRI     *INT.PSW         POP THE INTERRUPT AND RETURN TO USER
01063                                 *
01064                                 *              FOLLOWING ARE HIOCS ERROR PROCEDURES
01065                                 *
01066  P00A94  C8800006               ERROR6  LI      R7,6             ILLEGAL ANALOG CONSOLE NUMBER
01067  P00A98  EC000AB9   P00AB8               BU      ERROUT
01068                                 *
01069                                 *              COMES HERE IS I/O WAS ATTEMPTED AND NO ANALOG
01070                                 *              CONSOLE IS SELECTED
01071                                 *
01072                                 *              GENERATES AN ERROR 16
01073                                 *
01074  P00A9C  C8800010               ERRORCSL LI     R7,16
01075  P00AA0  EC000AB9   P00AB8               BU      ERROUT
01076                                 *
01077                                 *              COMES HERE IF THE H/W IS TIMED OUT
01078                                 *
01079  P00AA4  C880001A               ERROR26 LI      R7,26
01080  P00AA8  EC000AB9   P00AB8               BU      ERROUT
01081                                 *
01082                                 *              COMES HERE IF AN ATTEMPT WAS MADE TO ALLOCATE A PREVIOUSLY
01083                                 *              ALLOCATED ANALOG CONSOLE ; OR TO SELECT AN ANALOG
01084                                 *              CONSOLE THAT HAS NOT BEEN ALLOCATED TO THE TASK.
01085                                 *
01086  P00AAC  C880003E               ERROR62 LI      R7,62
01087  P00AB0  EC000AB9   P00AB8               BU      ERROUT
01088                                 *
01089                                 *              NO ADC OR DAM TCR(S) ARE AVAILABLE FOR ALLOCATION
01090                                 *
01091  P00AB4  C8800028               ERROR43 LI      R7,43
01092  P00AB8  A288000F   P0000F     ERROUT  ABM     29,INT.PSW       BUMP PAST 2ND ILLEGAL INST,
01093  P00ABC  FC040000               DAI     0
01094  P00AC0  F9100000   P0000C               BRI     *INT.PSW
01096                                 *
01097                                 *              PAM1 CD READ LIST   (QJOB WILL OR IN CORRECT DEA'S)
01098                                 *
01099  P00AC4  FC06B226               PAMCDRD CD      X'0',X'B226'     READ ANALOG STSTUS WORD
01100  P00AC8  FC06B223               CD      X'0',X'B223'     READ ANALOG FAULT WORD
01101  P00ACC  FC06B221               CD      X'0',X'B221'     READ DVM
01102  P00AD0  FC06B224               CD      X'0',X'B224'     READ ANALOG ADDRESS
01103  P00AD4  FC06B239               CD      X'0',X'B239'     READ AND INCREMENT DCA/DCL
01104  P00AD8  FC06B225               CD      X'0',X'B225'     READ COMPARATOR STATUS
01105  P00ADC  FC06B222               CD      X'0',X'B222'     READ A BANK OF SENSE LINES
01106  P00AE0  FC06B320               CD      X'0',X'B320'     TEST AND RESET SENSE LINE 0
01107  P00AE4  FC06B321               CD      X'0',X'B321'     TEST AND RESET SENSE LINE 1
```

```
P00AE8  FC06B322                 CD        X'0',X'B322'    TEST AND RESET SENSE LINE 2
P00AEC  FC06B323                 CD        X'0',X'B323'    TEST AND RESET SENSE LINE 3
P00AF0  FC06B324                 CD        X'0',X'B324'    TEST AND RESET SENSE LINE 4
P00AF4  FC06B325                 CD        X'0',X'B325'    TEST AND RESET SENSE LINE 5
P00AF8  FC06B326                 CD        X'0',X'B326'    TEST AND RESET SENSE LINE 6
P00AFC  FC06B327                 CD        X'0',X'B327'    TEST AND RESET SENSE LINE 7
                        *
                        *                PAM1 CD WRITE LIST  (QJOB WILL OR IN CORRECT DEA'S)
                        *                                    -NON-RELAY OUTPUT FIRST-
P00B00  FC06A02A        PAMCDWR  CD        X'0',X'A02A'    SELECT LOGIC MODE
P00B04  FC06A139                 CD        X'0',X'A139'    SELECT DCA/DCL BINARY ADDRESS
P00B08  FC06A039                 CD        X'0',X'A039'    LOAD AND INCR. DCA/DCL ADDRESS
P00B0C  FC06A122                 CD        X'0',X'A122'    JAM A BANK OF CONTROL LINES
P00B10  FC06A123                 CD        X'0',X'A123'    RESET A BANK OF CONTROL LINES
P00B14  FC06A121                 CD        X'0',X'A121'    SET A BANK OF CONTROL LINES
P00B18  FC06A138                 CD        X'0',X'A138'    SELECT DCFG ADDRESS
P00B1C  FC06A038                 CD        X'0',X'A038'    LOAD DCFG X/Y DATA
P00B20  FC06A02B        SETAMPMK CD        X'0',X'A02B'    SET/RESET AMP OVERLOAD MASK
P00B24                  NONRLYXX EQU       $
                        * NEXT ARE RELAY ORIENTATED CD(S)
P00B24  FC06A02E                 CD        X'0',X'A02E'    DVM CONVERT
P00B28  FC06A024                 CD        X'0',X'A024'    SELECT ANALOG ADDRESS
P00B2C  FC06A027                 CD        X'0',X'A027'    SELECT ANALOG MODE
P00B30  FC06A025                 CD        X'0',X'A025'    TRANSFER ANALOG VALUE
P00B34  FC06A02D                 CD        X'0',X'A02D'    SET SERVO POT
P00B38  FC06A029                 CD        X'0',X'A029'    SET COARSE TIME SCALE
P00B3C  FC06A028                 CD        X'0',X'A028'    SET FINE TIME SCALE
P00B40  FC06A124                 CD        X'0',X'A124'    SET A FUNCTION RELAY POSITIVE
P00B44  FC06A125                 CD        X'0',X'A125'    SET A FUNCTION RELAY NEGATIVE
                        *
                        *                ADC CD READ LIST    (QJOB WILL OR IN CORRECT DEA)
                        *
P00B48  FC06B320        ADCCDRD  CD        X'0',X'B320'    READ ADC STATUS
                        *
                        *                ADC DCM DC WRITE LIST (QJOB WILL OR IN CORRECT DEA'S)
                        *
P00B4C  FC06A120        ADCCDWR  CD        X'0',X'A120'    ALLOCATE ADC RUN
P00B50  EC000B9D  P00B9C         BU        STRADCP         MUST ADD ADR OF CPCW STACK
P00B54  FC06A121                 CD        X'0',X'A121'    REQUEST ADC RUN - 1 BLOCK
P00B58  FC06A122        HALTADCP CD        X'0',X'A122'    HALT ADC CHANNEL PROGRAM
P00B5C  FC06A123                 CD        X'0',X'A123'    REQUEST ADC TIME CRITICAL
                        *
                        *                DAM CD READ LIST    (QJOB WILL OR IN CORRECT DEA)
                        *
                        *
P00B60  FC06B320        DAMCDRD  CD        X'0',X'B320'    READ DAM STATUS
P00B64  FC06A020        DAMCDWR  CD        X'0',X'A020'    ALLOCATE DAM RUN CONTROLS
P00B68  EC000B89  P00BB8         BU        STRDACP         MUST ADD ADR OF CPCW STACK TO TCW LOC
P00B6C  FC06A121                 CD        X'0',X'A121'    REQUEST DAM RUN - 1 BLOCK -
P00B70  FC06A122        HALTDACP CD        X'0',X'A122'    HALT DAM CHANNEL PROGRAM
P00B74  FC06A123                 CD        X'0',X'A123'    REQUEST DAM C. P. TIME CRITICAL
                        *
                        *                RTHC(REAL TIME HYBRID CLOCK)  RTHC CD READ LIST
                        *
P00B78  FC06002B        RTHCCDRD CD        X'0',X'002B'    READ TIMER (SET UP)
P00B7C  FC06004B                 CD        X'0',X'004B'    READ TIMER BUFFER
P00B80  FC06002A        ITCCDWR  CD        X'0',X'002A'    HOLD TIMERS IN PARALLEL
P00B84  FC060028                 CD        X'0',X'0028'    LOAD A TIMER
P00B88  FC060029                 CD        X'0',X'0029'    START TIMERS IN PARALLEL
P00B8C  FC060020                 CD        X'0',X'0020'    PROGRAM R/A
P00B90                  RTHCDEND EQU       $
                        *
                        *
                        *                MVFG CD WRITE LIST  (QJOB  WILL OR IN THE CORRECT DEA)
                        *
P00B90  FC06A107        MVFGCDWR CD        X'0',X'A107'    TRANSFER CONTROL WORD TO MVFG
P00B94  FC06A007                 CD        X'0',X'A007'    TRANSFER DATA WORD TO THE MVFG
                        *
                        *                MVFG CD READ LIST  ( QJOB WILL 'OR' IN
                        *                                    THE CORRECT DEA)
                        *
P00B98  FC06B307        MVFGCDRD CD        X'0',X'B307'        READ CONTROL WORD FROM MVFG
P00B9C                  MVFGCDEN EQU       $
                        *
                        *                COMES HERE TO "OR" IN THE ADR. OF THE CPLW STACK
                        *
P00B9C  7115            STRADCP  SRL       R2,21           FORM WORD INDEX OUT OF TCR #
P00B9E        0002
P00BA0  C901FFE0                 ADI       R2,-32
P00BA4  D1400D48  P00D48         LEA       R2,ADCCPCW1,R2  FETCH ADR. OF INDEXED CPCW STACK
P00BA8  85002334  P02334         ANMW      R2,=X'7FFFC'    STRIP AWAY LEA GARBAGE BITS.
P00BAC  E9100CE8  P00CE8         ARMW      R2,*ADCTCW      OR IN THE ADR. OF THE CPCW TO TCW LOC
P00BB0  FC068020        ADCCDSTR CD        X'0',X'8020'    START CHANNEL PROGRA (BLOCK CD MODE)
```

```
P00BB4  EC000105  P001D4          BU       ADCBK10
                                  *
                                  *        COMES HERE TO "OR" IN THE ADR OF THE DAM CPCW STACK
                                  *
P00BB8  7115                      STRDACP  SRL      R2,21            FORM WORD INDEX OUT OF TCR #
P00BBA     0002
P00BBC  C901FFE0                  ADI      R2,-32
P00BC0  D1400E08  P00E08          LEA      R2,DAMCPCW1,R2   FETCH ADDRESS OF INDEXED CPCW STACK
P00BC4  85002334  P02334          ANMW     R2,=X'7FFFC'     STRIP AWAY LEA GARBAGE BITS
P00BC8  E9100CEC  P00CEC          ARMW     R2,*DAMTCW       OR IN THE ADR. OF CPCW TO TCW LOCATON
P00BCC  FC068020                  DAMCDSTR CD       X'0',X'8020'     START DAM CHANNEL PROGRAM (BLOCK I/O)
P00BD0  EC0001F9  P001F8          BU       DAMBK10
                                  *
                                  *        THE FOLLOWING TD INSTRUCTIONS ARE PROTOTYPES
                                  *        FOR THE 5 CARDS. QJOB WILL "OR" IN THE PROPER
                                  *        DEA(S)
                                  *
P00BD4  FC058000                  PAMTD    TD       X'0',X'8000'     PAM TD
P00BD8  FC058000                  ADCTD    TD       X'0',X'8000'     ADC DCM TD
P00BDC  FC058000                  DAMTD    TD       X'0',X'8000'     DAM DCM TD
P00BE0  FC058000                  ITCTD    TD       X'0',X'8000'     ITCTD
P00BE4  FC058000                  MVFGTD   TD       X'0',X'8000'     MVFG TD INSTRUCTION
                                  *
                                  *        FOLLOWING IS THE HANDLER FOR THE DEVICE READY INTERRUPT
                                  *
P00BE8                            DVRYHAND RES      1W               PSW PUSH
P00BEC  DC002120  P02120          STF      R0,DVRYSAVE      SAVE REGISTERS
                                  *
                                  *        DISABLE THE RTM EXECUTIVE NOT TO LOOSE CONTROL
                                  *
                                  *
                                  *        WHICH ANALOG CONSOLE GENERATED THE DVRY?
                                  *
P00BF0  A8000AC9  P00AC8          EXM      PAMCDRD+1W       READ THE ANALOG FAULT WORD
P00BF4  CB80F82F                  LI       R7,-2001         LOOP ON TD 8000 FOR A WHILE
P00BF8  A8000BD5  P00BD4          EXM      PAMTD
P00BFC  EF800C05  P00C04          BCT      7,$+2W
P00C00  EC000C0D  P00C0C          BU       $+3W
P00C04  F7800BF9  P00BF8          BIB      R7,$-3W
P00C08  0000                      HALT                      PAM I/O TIMED OUT
P00C0A     0002
P00C0C  AE100CE4  P00CE4          LW       R4,*PAMTCW       FETCH THE DATA FROM TCW LOVATION
P00C10  7204                      SRL      R4,4             SHIFT TO LSB(S)
P00C12     0002
P00C14  86002340  P02340          ANMW     R4,=7
P00C18  CB00FFFA                  LI       R6,-6            ATTEMPT TO FIND A MATCH ON DVRYLIST
P00C1C  0D20                      ZR       R2
P00C1E     0002
P00C20  AFC00CFC  P00CFC  DVRYLOP6 LW      R7,DVRYLIST,R2   FETCH 1ST/NEXT CONSOLE #
P00C24  13C0                      CAR      R4,R7
P00C26     0002
P00C28  EE000C39  P00C38          BCT      EQ,DVRYMATH      A MATCH HAS BEEN FOUND
P00C2C  C901000C                  ADI      R2,3W
P00C30  F7000C21  P00C20          BIB      R6,DVRYLOP6      2,4,6,8, LET'S ITERATE
P00C34  EC000CA1  P00CA0          BU       NOMATH6          A SEEMINGLY SPURIOUS DVRY INTERRUPT
                                  *
                                  *        COMES HERE IF A MATCH WAS FOUND BETWEEN A TASK
                                  *        SUSPENDED DUE TO RELAY I/O AND THE PARTICULAR
                                  *        ANALOG CONSOLE THAT GENERATED THE
                                  *        DEVICE READY INTERRUPT
                                  *
                                  *        DELETE THE TIMER ENTRY FOR THE RELAY I/O
                                  *        HARDWARE TIME-OUT TASK
                                  *
                                  *        LOGICAL TIMER # = G'AA' + CONSOLE #
                                  *
P00C38  C8814141                  DVRYMATH ADI      R7,G'AA'
P00C3C  B7080808  00808           LNB      R6,C.TENT
P00C40  AC800870  00870           LW       R1,C.TTAB
P00C44  93A00003  00002           M.6.A    CAMH     R7,1H,R1         MATCH FOUND??
P00C48  F2000C55  P00C54          BCF      EQ,$+3W
P00C4C  9CA80000  00000           ZBM      1,0,R1           DELETE THE TIMER ENTRY
P00C50  EC000C5F  P00C5E          BU       M.DONE
P00C54  C8810014                  ADI      R1,5W            2,4,6,8 LET' ITERATE
P00C58  F7000C45  P00C44          BIB      R6,M.6.A
P00C5C  0000                      HALT                      NO MATCH ON TIMER ENTRIES
P00C5E                            M.DONE   EQU      $
                                  *
                                  *        RESUME THE SUSPENDED TASK
                                  *
P00C5E     0002
P00C60  AF400D00  P00D00          LW       R6,DVRYLIST+1W,R2
P00C64  AFC00D04  P00D04          LW       R7,DVRYLIST+2W,R2
```

```
01268  P00C68  AD80091B   0091A     LH        R3,C.FRST+1H
01269  P00C6C  9360001A   00018  TA21 CAMD    R6,6W,R3
01270  P00C70  EE000C81   P00C80     BCT       EQ,EX1
01271  P00C74  ADE00003   00002     LH        R3,1H,R3
01272  P00C78  F2000C6D   P00C6C     BCF       ZR,TA21
01273  P00C7C  0000                 HALT                        TASK NAME NOT FOUND
       P00C7E       0002
01274  P00C80  9C680000   00000  EX1 ZBM       0,0,R3            RESET SUSPEND BIT
01275  P00C84  AF680000   00000     LB        R6,0,R3           RESET BIT 11 IF ABLE TO
01276  P00C88  F2000C91   P00C90     BCF       ZR,M.16.RT
01277  P00C8C  9DE80001   00001     ZBM       11,0,R3
01278  P00C90                  M.16.RT EQU    $
01279  P00C90  CB00FFFF            LI        R6,-1
01280  P00C94  D7400CFC   P00CFC     STW       R6,DVRYLIST,R2
01281  P00C98  D7400D00   P00D00     STW       R6,DVRYLIST+1W,R2
01282  P00C9C  D7400D04   P00D04     STW       R6,DVRYLIST+2W,R2
01283  P00CA0                  NOMATH6 EQU    $
01284  P00CA0  CC002120   P02120     LF        R0,DVRYSAVE       PULL THE REGISTERS
01285  P00CA4  A8000881   00880     EXM       C.EXRI            REQUEST THE RTM EXECUTIVE
01286  P00CA8  F9100BE9   P00BE8     BRI       *DVRYHAND         RETURN TO INTERRUPTED USER
01287  P00CAC  FC000000            ENABDVRY DATAW   X'FC000000'   EI X'0' INSTRUCTION
01288  P00CB0  FC010000            DISADVRY DATAW   X'FC010000'   DI X'0' INSTRUCTION
01290                               *
01291                               *          FOLLOWING IS A LIST OF VALID 3200 DEA(S)
01292                               *
01293  P00CB4  0004080C            DEALIST DATAB    0,4,8,X'C'
01294  P00CB8  10182030                    DATAB    X'10',X'18',X'20',X'30'
01295  P00CBC  40506070                    DATAB    X'40',X'50',X'60',X'70'
01296  P00CC0  787A7C7E                    DATAB    X'78',X'7A',X'7C',X'7E'
01297                               *
01298                               *          FOLLOWING IS A LIST OF TCW LOCATIONS
01299                               *
01300  P00CC4  01000104            TCWLIST DATAH    X'100',X'104',X'108',X'10C'
       P00CC8  0108010C
01301  P00CCC  01100114                    DATAH    X'110',X'114',X'118',X'11C'
       P00CD0  0118011C
01302  P00CD4  01200124                    DATAH    X'120',X'124',X'128',X'12C'
       P00CD8  0128012C
01303  P00CDC  01300134                    DATAH    X'130',X'134',X'138',X'13C'
       P00CE0  0138013C
01304                               *
01305                               *          FOLLOWING TABLE CONTAINS THE TCW LOCATION ADDRESSES
01306                               *          FOR THE 5 CARDS IN THE SYSTEM. THESE ARE INITIALIZED
01307                               *          EACH TIME QJOB IS INVOKED.
01308                               *
01309  P00CE4                       PAMTCW  RES      1W
01310  P00CE8                       ADCTCW  RES      1W                TCW FOR DAM CARD
01311  P00CEC                       DAMTCW  RES      1W                TCW FOR ADC CARD
01312  P00CF0                       ITCTCW  RES      1W                TCW FOR ITC CARD
01313  P00CF4                       MVFGTCW RES      1W               TCW FOR MVFG
01314  P00CF8  10000000             RTHCSL  DATAW    X'10000000'       RTHC#2 ADDRESS
01315                               *
01316                               *          FOLLOWS IS A LIST OF HYBRID TASKS AND PHYSICAL CONSOLE
01317                               *          #S SUSPENDED DUE TO RELAY I/O
01318                               *
01319                               *          FORMAT:
01320                               *
01321                               *          WORD1 = CONSOLE #
01322                               *          WORD2 & WORD3 = TASK NAME
01323                               *
01324  P00CFC  FFFFFFFF            DVRYLIST DATAW   -1,-1,-1,-1,-1,-1
       P00D00  FFFFFFFF
       P00D04  FFFFFFFF
       P00D08  FFFFFFFF
       P00D0C  FFFFFFFF
       P00D10  FFFFFFFF
01325  P00D14  FFFFFFFF                    DATAW    -1,-1,-1,-1,-1,-1
       P00D18  FFFFFFFF
       P00D1C  FFFFFFFF
       P00D20  FFFFFFFF
       P00D24  FFFFFFFF
       P00D28  FFFFFFFF
01326  P00D2C  FFFFFFFF                    DATAW    -1,-1,-1,-1,-1,-1
       P00D30  FFFFFFFF
       P00D34  FFFFFFFF
       P00D38  FFFFFFFF
       P00D3C  FFFFFFFF
       P00D40  FFFFFFFF
01327  P00D44                       INDIRECT RES     1W
01328                               *
01329                               *          FOLLOWING ARE THE ADC CPCW STACKS
01330                               *
```

```
01331  P00D48  FFFFFFFF          ADCCPCW1 DATAW     -1,-1,-1,-1,-1,-1,-1,-1
       P00D4C  FFFFFFFF
       P00D50  FFFFFFFF
       P00D54  FFFFFFFF
       P00D58  FFFFFFFF
       P00D5C  FFFFFFFF
       P00D60  FFFFFFFF
       P00D64  FFFFFFFF
01332  P00D68  FFFFFFFF          ADCCPCW2 DATAW     -1,-1,-1,-1,-1,-1,-1,-1
       P00D6C  FFFFFFFF
       P00D70  FFFFFFFF
       P00D74  FFFFFFFF
       P00D78  FFFFFFFF
       P00D7C  FFFFFFFF
       P00D80  FFFFFFFF
       P00D84  FFFFFFFF
01333  P00D88  FFFFFFFF          ADCCPCW3 DATAW     -1,-1,-1,-1,-1,-1,-1,-1
       P00D8C  FFFFFFFF
       P00D90  FFFFFFFF
       P00D94  FFFFFFFF
       P00D98  FFFFFFFF
       P00D9C  FFFFFFFF
       P00DA0  FFFFFFFF
       P00DA4  FFFFFFFF
01334  P00DA8  FFFFFFFF          ADCCPCW4 DATAW     -1,-1,-1,-1,-1,-1,-1,-1
       P00DAC  FFFFFFFF
       P00DB0  FFFFFFFF
       P00DB4  FFFFFFFF
       P00DB8  FFFFFFFF
       P00DBC  FFFFFFFF
       P00DC0  FFFFFFFF
       P00DC4  FFFFFFFF
01335  P00DC8  FFFFFFFF          ADCCPCW5 DATAW     -1,-1,-1,-1,-1,-1,-1,-1
       P00DCC  FFFFFFFF
       P00DD0  FFFFFFFF
       P00DD4  FFFFFFFF
       P00DD8  FFFFFFFF
       P00DDC  FFFFFFFF
       P00DE0  FFFFFFFF
       P00DE4  FFFFFFFF
01336  P00DE8  FFFFFFFF          ADCCPCW6 DATAW     -1,-1,-1,-1,-1,-1,-1,-1
       P00DEC  FFFFFFFF
       P00DF0  FFFFFFFF
       P00DF4  FFFFFFFF
       P00DF8  FFFFFFFF
       P00DFC  FFFFFFFF
       P00E00  FFFFFFFF
       P00E04  FFFFFFFF
01337                          *
01338                          *              FOLLOWING ARE THE DAM CPCW STACKS
01339                          *
01340  P00E08  FFFFFFFF          DAMCPCW1 DATAW     -1,-1,-1,-1,-1,-1,-1,-1
       P00E0C  FFFFFFFF
       P00E10  FFFFFFFF
       P00E14  FFFFFFFF
       P00E18  FFFFFFFF
       P00E1C  FFFFFFFF
       P00E20  FFFFFFFF
       P00E24  FFFFFFFF
01341  P00E28  FFFFFFFF          DAMCPCW2 DATAW     -1,-1,-1,-1,-1,-1,-1,-1
       P00E2C  FFFFFFFF
       P00E30  FFFFFFFF
       P00E34  FFFFFFFF
       P00E38  FFFFFFFF
       P00E3C  FFFFFFFF
       P00E40  FFFFFFFF
       P00E44  FFFFFFFF
01342  P00E48  FFFFFFFF          DAMCPCW3 DATAW     -1,-1,-1,-1,-1,-1,-1,-1
       P00E4C  FFFFFFFF
       P00E50  FFFFFFFF
       P00E54  FFFFFFFF
       P00E58  FFFFFFFF
       P00E5C  FFFFFFFF
       P00E60  FFFFFFFF
       P00E64  FFFFFFFF
01343  P00E68  FFFFFFFF          DAMCPCW4 DATAW     -1,-1,-1,-1,-1,-1,-1,-1
       P00E6C  FFFFFFFF
       P00E70  FFFFFFFF
       P00E74  FFFFFFFF
       P00E78  FFFFFFFF
       P00E7C  FFFFFFFF
       P00E80  FFFFFFFF
       P00E84  FFFFFFFF
```

```
01344  P00E88  FFFFFFFF          DAMCPCW5 DATAW     -1,-1,-1,-1,-1,-1,-1,-1
       P00E8C  FFFFFFFF
       P00E90  FFFFFFFF
       P00E94  FFFFFFFF
       P00E98  FFFFFFFF
       P00E9C  FFFFFFFF
       P00EA0  FFFFFFFF
       P00EA4  FFFFFFFF
01345  P00EA8  FFFFFFFF          DAMCPCW6 DATAW     -1,-1,-1,-1,-1,-1,-1,-1
       P00EAC  FFFFFFFF
       P00EB0  FFFFFFFF
       P00EB4  FFFFFFFF
       P00EB8  FFFFFFFF
       P00EBC  FFFFFFFF
       P00EC0  FFFFFFFF
       P00EC4  FFFFFFFF
01346                           *
01347                           *
01348                           *              THE FOLLOWING TABLE MAPS THE ALLOCATION OF ANALOG
01349                           *              CONSOLES TO HYBRID TASKS
01350                           *
01351                           *              THE FIRST WORD CONTAINS A PHYSICAL ANALOG CONSOLE
01352                           *              NUMBER (1,2,,6) ; THE NEXT 2 WORDS CONTAIN THE
01353                           *              TASK NAME.  THERE ARE 6 MEMBERS IN THIS TABLE
01354                           *
01355  P00EC8  FFFFFFFF          ALOCCSLL DATAW     -1,-1,-1
       P00ECC  FFFFFFFF
       P00ED0  FFFFFFFF
01356  P00ED4  FFFFFFFF                   DATAW     -1,-1,-1
       P00ED8  FFFFFFFF
       P00EDC  FFFFFFFF
01357  P00EE0  FFFFFFFF                   DATAW     -1,-1,-1
       P00EE4  FFFFFFFF
       P00EE8  FFFFFFFF
01358  P00EEC  FFFFFFFF                   DATAW     -1,-1,-1
       P00EF0  FFFFFFFF
       P00EF4  FFFFFFFF
01359  P00EF8  FFFFFFFF                   DATAW     -1,-1,-1
       P00EFC  FFFFFFFF
       P00F00  FFFFFFFF
01360  P00F04  FFFFFFFF                   DATAW     -1,-1,-1
       P00F08  FFFFFFFF
       P00F0C  FFFFFFFF
01361                           *
01362                           *              THE FOLLOWING TABLE MAPS THE ALLOCATION OF ADC TCR(S)
01363                           *              TO HYBRID TASKS
01364                           *
01365  P00F10  FFFFFFFF          ADTCRTAB DATAW     -1,-1,-1        ADC TCR1
       P00F14  FFFFFFFF
       P00F18  FFFFFFFF
01366  P00F1C  FFFFFFFF                   DATAW     -1,-1,-1        ADC TCR 2
       P00F20  FFFFFFFF
       P00F24  FFFFFFFF
01367  P00F28  FFFFFFFF                   DATAW     -1,-1,-1        ADC TCR 3
       P00F2C  FFFFFFFF
       P00F30  FFFFFFFF
01368  P00F34  FFFFFFFF                   DATAW     -1,-1,-1        ADC TCR 4
       P00F38  FFFFFFFF
       P00F3C  FFFFFFFF
01369  P00F40  FFFFFFFF                   DATAW     -1,-1,-1        ADC TCR 5
       P00F44  FFFFFFFF
       P00F48  FFFFFFFF
01370  P00F4C  FFFFFFFF                   DATAW     -1,-1,-1        ADC TCR 6
       P00F50  FFFFFFFF
       P00F54  FFFFFFFF
01371                           *
01372                           *              THE FOLLOWING TABLE MAPS THE ALLOCATION
01373                           *              OF DAM TCR(S) TO HYBRID TASKS
01374                           *
01375  P00F58  FFFFFFFF          DATCRTAB DATAW     -1,-1,-1        DAM TCR 1
       P00F5C  FFFFFFFF
       P00F60  FFFFFFFF
01376  P00F64  FFFFFFFF                   DATAW     -1,-1,-1        DAM TCR 2
       P00F68  FFFFFFFF
       P00F6C  FFFFFFFF
01377  P00F70  FFFFFFFF                   DATAW     -1,-1,-1        DAM TCR 3
       P00F74  FFFFFFFF
       P00F78  FFFFFFFF
01378  P00F7C  FFFFFFFF                   DATAW     -1,-1,-1        DAM TCR 4
       P00F80  FFFFFFFF
       P00F84  FFFFFFFF
01379  P00F88  FFFFFFFF                   DATAW     -1,-1,-1        DAM TCR 5
```

```
         P00F8C  FFFFFFFF
         P00F90  FFFFFFFF
01380    P00F94  FFFFFFFF                        DATAW    -1,-1,-1        DAM TCR 6
         P00F98  FFFFFFFF
         P00F9C  FFFFFFFF
01382                                   *
01383                                   *                IS THIS A REQUEST FROM AN RTM TASK THAT IS TERMINATING
01384                                   *                VIA H.MONS,18 OR H.MONS,19 OR H.MONS,20.  OR JUST A PLAIN
01385                                   *                OLD ILLEGAL INSTRUCTION
01386                                   *
01387    P00FA0                         HMONS    EQU     $
01388    P00FA0  93002344  P02344                CAMW     R6,=X'ABCDEF38' = TO TERMINATING TASK KEY??
01389    P00FA4  F2002240  P0224C                BCF      EQ,NOTHIOCS     ILLEGAL INSTRUCTION
01390                                   *
01391                                   *                FALLS THROUGH WHEN ANY TASK TERMINATES
01392                                   *
01393                                   *
01394                                   *                FOLLOWING POST TASK PROCESSING MUST BE PERFORMED TO INSURE
01395                                   *                SYSTEM INTEGRITY WHEN A HYBRID TASK TERMINATES
01396                                   *
01397                                   *                1.   DELETE THE ENTRY(S) FROM THE ALLOCATED CONSOLES LIST
01398                                   *                2.   DELETE THE ENTRY IF ANY FROM THE DVRYLIST.
01399                                   *                3.   ISSUE HALT INSTRUCTIONS TO ANY ADC CHANNEL PROGRAMS
01400                                   *                     THAT THE TASK HAS BEEN USING AND DELETE THE ENTRY(S)
01401                                   *                     FROM THE ADTCRTAB.
01402                                   *                4.    ISSUE HALT INSTRUCTIONS TO ANY DAM CHANNEL PROGRAMS
01403                                   *                     THAT THE TASK HAS BEEN USING AND DELETE THE ENTRY(S)
01404                                   *                FROM THE DATCRTAB
01405                                   *
01406                                   *                PREMISE: ALL HYBRID TASKS MUST HAVE AT LEAST 1 ENTRY
01407                                   *                ON THE ALOCCSLL LIST.
01408                                   *
01409    P00FA8  C980FFFF                        LI       R3,-1           USED TO DELETE ENTRIES
01410    P00FAC  0D20                            ZR       R2              AFTER THE FOLLOWING LOOP IF R2 = 0 =>
01411                                   *                                  THE TASK TERMINATING IS NOT A HYBRID
01412                                   *                                  TASK. IF R2 = 8 => TERMINATION TASK
01413                                   *                                  IS A HYBRID TASK
         P00FAE       0002
01414    P00FB0  C800FFFA                        LI       R6,-6           ITERATION CONTROL
01415    P00FB4  C8800004                        LI       R1,1W           R1 = INDEX THROUGH ALOCCSLL
01416    P00FB8  92200EC8  P00EC8       HMONLOOP CAMW     R4,ALOCCSLL,R1       ATTEMPT TO FIND A MATCH OF TASK
01417    P00FBC  F2000FD9  P00FD8                BCF      EQ,NOMATCH1          NAMES
01418    P00FC0  92A00ECC  P00ECC                CAMW     R5,ALOCCSLL+1W,R1
01419    P00FC4  F2000FD9  P00FD8                BCF      EQ,NOMATCH1
01420                                   *
01421                                   *                FALLS THROUGH WHEN A MATCH WAS FOUND
01422                                   *
01423    P00FC8  C9000008                        LI       R2,2W           R2 = 8 => TASK IS A HYBRID TASK
01424    P00FCC  D5A00EC4  P00EC4                STW      R3,ALOCCSLL-1W,R1   DELETE THE ENTRY ON ALOCCSLL
01425    P00FD0  D5A00EC8  P00EC8                STW      R3,ALOCCSLL,R1
01426    P00FD4  D5A00ECC  P00ECC                STW      R3,ALOCCSLL+1W,R1
01427    P00FD8  C881000C                NOMATCH1 ADI     R1,3W           BUMP INDEX
01428    P00FDC  F7000FB9  P00FB8                BIB      R6,HMONLOOP     2,4,6,8 LET'S ITERATE
01429    P00FE0  EC400FE5  P00FE4                BU       $+1W,R2
01430    P00FE4  A288000F  P0000F                ABM      29,INT.PSW      BUMP PAST 2ND ILLEGAL INST.
01431    P00FE8  F9100000  P0000C                BRI      *INT.PSW        NOT A HYBRID TASK SO GO BYE BYE!!
01432                                   *
01433                                   *                DELETE ANY ENTRY UPON THE DVRYLIST
01434                                   *
01435    P00FEC  C800FFFA                        LI       R6,-6           ITERATION CONTROL
01436    P00FF0  C8800004                        LI       R1,1W           INDEX THROUGH DVRYLIST
01437    P00FF4  92200CFC  P00CFC       DVRYDELL CAMW     R4,DVRYLIST,R1  ATTEMPT TO FIND A MATCH OF TASK NAMES
01438    P00FF8  F2001011  P01010                BCF      EQ,NOMATCH2
01439    P00FFC  92A00D00  P00D00                CAMW     R5,DVRYLIST+1W,R1
01440    P01000  F2001011  P01010                BCF      EQ,NOMATCH2
01441                                   *
01442                                   *                FALLS THROUGH WHEN A MATCH HAS BEEN FOUND
01443                                   *
01444    P01004  D5A00CF8  P00CF8                STW      R3,DVRYLIST-1W,R1   DELETE THE ENTRY
01445    P01008  D5A00CFC  P00CFC                STW      R3,DVRYLIST,R1
01446    P0100C  D5A00D00  P00D00                STW      R3,DVRYLIST+1W,R1
01447    P01010  C881000C                NOMATCH2 ADI     R1,3W           BUMP INDEX
01448    P01014  F7000FF5  P00FF4                BIB      R6,DVRYDELL     2,4,6,8 LET'S ITERATE
01449                                   *
01450                                   *                IF AN ENTRY EXISTS ON THE ADC DCM TCR LIST (ADTCRTAB)
01451                                   *                ISSUE A HALT INSTRUCTION TO THAT TCR AND DELETE THE ENTRY
01452                                   *
01453    P01018  C800FFFA                        LI       R6,-6           R6 FOR ITERATION CONTROL
01454    P0101C  C8800004                        LI       R1,1W           R1 = INDEX THROUGH ADTCRTAB
01455    P01020  92200F10  P00F10       ADCTCRDL CAMW     R4,ADTCRTAB,R1  ATTEMPT TO MATCH THE TASK NAMES
```

```
01456  P01024  F2001065   P01064              BCF      EQ,NOMATCH3
01457  P01028  92A00F14   P00F14              CAMW     R5,ADTCRTAB+1W,R1
01458  P01020  F2001065   P01064              BCF      EQ,NOMATCH3
01459                                  *
01460                                  *            FOUND A MATCH SO ISSUE A HALT INSTRUCTION
01461                                  *
01462  P01030  AFA00F0C   P00F0C              LW       R7,ADTCRTAB-1W,R1   FETCH TCR #
01463  P01034  73DA                           SLL      R7,26               SHIFT TO BITS 1-5
       P01036      0002
01464  P01038  D7900CE8   P00CE8              STW      R7,*ADCTCW          STORE IN ADC DCM TCW
01465  P0103C  A8000B59   P00B58              EXM      HALTADCP            ISSUE THE HALT INSTRUCTION
01466                                  *
01467                                  *            LOOP ON STATUS FOR A WHILE
01468                                  *
01469  P01040  C880F82F                       LI       R7,-2001            LIKE "STAR WARS"
01470  P01044  A8000BD9   P00BD8              EXM      ADCTD               EXECUTE THE ADC DCM TD INSTRUCTION
01471  P01048  EF801051   P01050              BCT      7,$+2W              DONE YET??
01472  P0104C  EC001059   P01058              BU       $+3W
01473  P01050  F7801045   P01044              BIB      R7,$-3W             AGAIN
01474  P01054  0000                           HALT                         I/O TIMED OUT CALL EAI CUSTOMER SERVICE
01475                                  *
01476                                  *            DELETE THE ENTRY FROM THE ADTCRTAB
01477                                  *
       P01056      0002
01478  P01058  D5A00F0C   P00F0C              STW      R3,ADTCRTAB-1W,R1
01479  P0105C  D5A00F10   P00F10              STW      R3,ADTCRTAB,R1
01480  P01060  D5A00F14   P00F14              STW      R3,ADTCRTAB+1W,R1
01481  P01064  C881000C                NOMATCH3 ADI     R1,3W               BUMP INDEX
01482  P01068  F7001021   P01020              BIB      R6,ADCTCRDL         2 4 6 8 LET'S ITERATE
01483                                  *
01484                                  *            IF AN ENTRY EXISTS ON THE DAM DCM TCR LIST (DATCRTAB)
01485                                  *            ISSUE A HALT CHANNEL PROGRAM COMMAND AND DELETE THE ENTRY
01486                                  *            FROM THE DATCRTAB.
01487                                  *
01488  P0106C  C800FFFA                       LI       R6,-6               R6 = ITERATION CONTROL
01489  P01070  C8800004                       LI       R1,1W               R1 = INDEX THROUGH DATCRTAB
01490  P01074  92200F58   P00F58       DAMTCRDL CAMW   R4,DATCRTAB,R1      ATTEMPT TO FIND A MATCH OF TASK NAMES
01491  P01078  F2001089   P010B8              BCF      EQ,NOMATCH4
01492  P0107C  92A00F5C   P00F5C              CAMW     R5,DATCRTAB+1W,R1
01493  P01080  F2001089   P010B8              BCF      EQ,NOMATCH4
01494                                  *
01495                                  *            FALLS THROUGH IF A MATCH OF TASK NAMES IS FOUND
01496                                  *
01497  P01084  AFA00F54   P00F54              LW       R7,DATCRTAB-1W,R1   FETCH TCR #
01498  P01088  73DA                           SLL      R7,26               SHIFT TO BITS 1-5
       P0108A      0002
01499  P0108C  D7900CEC   P00CEC              STW      R7,*DAMTCW          STORE IN THE DAM DCM TCW
01500  P01090  A8000B71   P00B70              EXM      HALTDACP            ISSUE THE HALT CHANNEL PROG COMMAND
01501                                  *
01502                                  *            LOOP ON STATUS FOR A WHILE
01503                                  *
01504  P01094  C880F82F                       LI       R7,-2001
01505  P01098  A8000BDD   P00BDC              EXM      DAMTD               EXECUTE THE DAM TD INSTRUCTION
01506  P0109C  EF8010A5   P010A4              BCT      7,$+2W              DONE YET??
01507  P010A0  EC0010AD   P010AC              BU       $+3W
01508  P010A4  F7801099   P01098              BIB      R7,$-3W             TRY AGAIN
01509  P010A8  0000                           HALT                         I/O TIMED OUT
01510                                  *
01511                                  *            DELETE THE ENTRY FROM THE DATCRTAB
01512                                  *
       P010AA      0002
01513  P010AC  D5A00F54   P00F54              STW      R3,DATCRTAB-1W,R1
01514  P010B0  D5A00F58   P00F58              STW      R3,DATCRTAB,R1
01515  P010B4  D5A00F5C   P00F5C              STW      R3,DATCRTAB+1W,R1
01516  P010B8  C881000C                NOMATCH4 ADI     R1,3W               BUMP THE INDEX
01517  P010BC  F7001075   P01074              BIB      R6,DAMTCRDL         ITERATE
01518                                  *
01519                                  *            IF TERMINATING TASK IS A GORILLA TASK
01520                                  *            DISABLE THE K/A INTS, DCM SI(J)
01521                                  *            AND RESET THE GORILLA FLAG
01522  P010C0  92001E72   P01E70              CAMD     R4,GORTASK
01523  P010C4  F20010CD   P010CC              BCF      EQ,$+2W
01524  P010C8  F88007D1   P007D0              BL       UNGORILA
01525  P010CC                                 M.OPEN
       P010CC  A8000889    00888              EXM      C.XDAI
                                              ENDM
01526  P010D0  A288000F   P0000F              ABM      29,INT.PSW          BUMP PAST 2ND ILLEGAL INST.
01527  P010D4  F910000D   P0000C              BRI      *INT.PSW            RETURN TO EITHER H.MONS,18,H,MONS,19
01528                                  *                                    OR  H.MONS,20
```

```
01530                                   *
01531                                   *              FOLLOWING ARE THE INTERRUPT HANDLERS
01532                                   *              FOR THE 16 R/A INTERRUPTS
01533                                   *
01534                                   *              COMMENTS ARE ONLY ON R/A INT 0
01535                                   *              ALL OTHERS ARE SIMILAR
01536                                   *
01537  P010D8  00000000                 RAINT0   DATAW    0                 PSW PUSH
01538  P010DC  FC030000                          AI       0                 TURN OFF INTS
01539  P010E0  A3881E80  P01E80                 ABM      7,GORACC          IF GORACC = 0 => NO GORILLA INT IS IN
01540  P010E4  DC001F20  P01F20                 STF      R0,RAINT0SK       SAVE GPR(S)
01541  P010E8  AF80222D  P0222C                 LH       R7,RAOCCURD
01542  P010EC  F200111D  P0111C                 BCF      ZR,RANESTD0
01543  P010F0  9C880800   00800                 ZBM      C,BTCH,C.BIT1     RESET BATCH EXECUTION BIT
01544  P010F4  F08010FD  P010FC                 BCF      SET,BEXEC0
01545  P010F8  9A881E81  P01E81                 SBM      5,BATCHSAV        SIGNIFY TO SET BATCH BIT AFTER PROCESSING
01546  P010FC  CC000140   00140   REXEC0       LF       R0,X'140'         SWAP SI POINTERS
01547  P01100  DC001EA0  P01EA0                 STF      R0,SISAVE1
01548  P01104  CC001EE0  P01EE0                 LF       R0,HYBSI1
01549  P01108  DC000140   00140                 STF      R0,X'140'
01550  P0110C  CC000160   00160                 LF       R0,X'160'
01551  P01110  DC001EC0  P01EC0                 STF      R0,SISAVE2
01552  P01114  CC001F00  P01F00                 LF       R0,HYBSI2
01553  P01118  DC000160   00160                 STF      R0,X'160'
01554  P0111C  9808222C  P0222C   RANESTD0      SBM      0,RAOCCURD        SET RA OCCURRED BIT
01555  P01120  AC881E80  P01E80                 LB       R1,GORACC         SAVE CURRENT METHOD
01556  P01124  AD882180  P02180                 LB       R3,METH0
01557  P01128  D5A82238  P02238                 STB      R3,METHSAVE-1B,R1
01558  P0112C  EE00113D  P0113C                 BCT      ZR,NOSUPRG0
01559  P01130  FD410000                         DI       X'28'             USER IS RUNNING IS SUPER GORILLA MODE
01560  P01134  FC990000                         DI       X'13'             DISABLE CLOCK,ATTN AND ARITHMETIC
01561  P01138  FD490000                         DI       X'29'             EXCEPTION INTERRUPTS
01562  P0113C  FC040000   NOSUPRG0              DAI      0                 TURN INTERRUPTS BACK ON
01563  P01140  0002       RABL0                 NOP                        BRANCH AND LINK INST WILL
01564  P01142      0002                         NOP                        BE CONSTRUCTED HERE
01565  P01144  F8801C4D  P01C4C                 BL       POPINT
01566  P01148  CC001F20  P01F20                 LF       R0,RAINT0SK
01567  P0114C  9C08222C  P0222C                 ZBM      0,RAOCCURD        RESET THE INTERRUPT OCCURED FLAG
01568  P01150  F9101009  P010D8                 BRI      *RAINT0           POP THE INTERRUPT
01569  P01154  00000000   RAINT1   DATAW    0
01570  P01158  FC030000                          AI       0                 TURN OFF INTS
01571  P0115C  A3881E80  P01E80                 ABM      7,GORACC          IF GORACC = 0 => NO GORILLA INT IS IN
01572  P01160  DC001F40  P01F40                 STF      R0,RAINT1SK
01573  P01164  AF80222D  P0222C                 LH       R7,RAOCCURD
01574  P01168  F2001199  P01198                 BCF      ZR,RANESTD1
01575  P0116C  9C880800   00800                 ZBM      C,BTCH,C.BIT1
01576  P01170  F0801179  P01178                 BCF      SET,BEXEC1
01577  P01174  9A881E81  P01E81                 SBM      5,BATCHSAV
01578  P01178  CC000140   00140   REXEC1       LF       R0,X'140'
01579  P0117C  DC001EA0  P01EA0                 STF      R0,SISAVE1
01580  P01180  CC001EE0  P01EE0                 LF       R0,HYBSI1
01581  P01184  DC000140   00140                 STF      R0,X'140'
01582  P01188  CC000160   00160                 LF       R0,X'160'
01583  P0118C  DC001EC0  P01EC0                 STF      R0,SISAVE2
01584  P01190  CC001F00  P01F00                 LF       R0,HYBSI2
01585  P01194  DC000160   00160                 STF      R0,X'160'
01586  P01198  9888222C  P0222C   RANESTD1      SBM      1,RAOCCURD
01587  P0119C  AC881E80  P01E80                 LB       R1,GORACC         SAVE CURRENT METHOD
01588  P011A0  AD882181  P02181                 LB       R3,METH1
01589  P011A4  D5A82238  P02238                 STB      R3,METHSAVE-1B,R1
01590  P011A8  EE001189  P011B8                 BCT      ZR,NOSUPRG1
01591  P011AC  FD410000                         DI       X'28'
01592  P011B0  FC990000                         DI       X'13'
01593  P011B4  FD490000                         DI       X'29'
01594  P011B8  FC040000   NOSUPRG1              DAI      0
01595  P011BC  0002       RABL1                 NOP
       P011BE      0002
01596  P011C0  F8801C4D  P01C4C                 BL       POPINT
01597  P011C4  CC001F40  P01F40                 LF       R0,RAINT1SK
01598  P011C8  9C88222C  P0222C                 ZBM      1,RAOCCURD
01599  P011CC  F9101155  P01154                 BRI      *RAINT1
01600  P011D0  00000000   RAINT2   DATAW    0
01601  P011D4  FC030000                          AI       0                 TURN OFF INTS
01602  P011D8  A3881E80  P01E80                 ABM      7,GORACC
01603  P011DC  DC001F60  P01F60                 STF      R0,RAINT2SK
```

```
01604  P011E0  AF80222D  P0222C            LH      R7,RAOCCURD
01605  P011E4  F2001215  P01214            BCF     ZR,RANESTD2
01606  P011E8  9C880800   00800            ZBM     C.BTCH,C.BIT1
01607  P011EC  F08011F5  P011F4            BCF     SET,BEXEC2
01608  P011F0  9A881E81  P01E81            SBM     5,BATCHSAV
01609  P011F4  CC000140   00140  BEXEC2    LF      R0,X'140'
01610  P011F8  DC001EA0  P01EA0            STF     R0,SISAVE1
01611  P011FC  CC001EE0  P01EE0            LF      R0,HYBSI1
01612  P01200  DC000140   00140            STF     R0,X'140'
01613  P01204  CC000160   00160            LF      R0,X'160'
01614  P01208  DC001EC0  P01EC0            STF     R0,SISAVE2
01615  P0120C  CC001F00  P01F00            LF      R0,HYBSI2
01616  P01210  DC000160   00160            STF     R0,X'160'
01617  P01214  9908222C  P0222C  RANESTD2 SBM     2,RAOCCURD
01618  P01218  AC881E80  P01E80            LB      R1,GORACC        SAVE CURRENT METHOD
01619  P0121C  AD882182  P02182            LB      R3,METH2
01620  P01220  D5A82238  P02238            STB     R3,METHSAVE-1B,R1
01621  P01224  EE001235  P01234            BCT     ZR,NOSUPRG2
01622  P01228  FD410000                    DI      X'28'
01623  P0122C  FC990000                    DI      X'13'
01624  P01230  FD490000                    DI      X'29'
01625  P01234  FC040000          NOSUPRG2  DAI     0
01626  P01238  0002              RABL2     NOP
       P0123A     0002
01627  P0123C  F8801C4D  P01C4C            BL      POPINT
01628  P01240  CC001F60  P01F60            LF      R0,RAINT2SK
01629  P01244  9008222C  P0222C            ZBM     2,RAOCCURD
01630  P01248  F91011D1  P011D0            BRI     *RAINT2
01631  P0124C  00000000          RAINT3    DATAW   0
01632  P01250  FC030000                    AI      0                TURN OFF INTS
01633  P01254  A3881E80  P01E80            ABM     7,GORACC
01634  P01258  DC001F80  P01F80            STF     R0,RAINT3SK
01635  P0125C  AF80222D  P0222C            LH      R7,RAOCCURD
01636  P01260  F2001291  P01290            BCF     ZR,RANESTD3
01637  P01264  9C880800   00800            ZBM     C.BTCH,C.BIT1
01638  P01268  F0801271  P01270            BCF     SET,BEXEC3
01639  P0126C  9A881E81  P01E81            SBM     5,BATCHSAV
01640  P01270  CC000140   00140  BEXEC3    LF      R0,X'140'
01641  P01274  DC001EA0  P01EA0            STF     R0,SISAVE1
01642  P01278  CC001EE0  P01EE0            LF      R0,HYBSI1
01643  P0127C  DC000140   00140            STF     R0,X'140'
01644  P01280  CC000160   00160            LF      R0,X'160'
01645  P01284  DC001EC0  P01EC0            STF     R0,SISAVE2
01646  P01288  CC001F00  P01F00            LF      R0,HYBSI2
01647  P0128C  DC000160   00160            STF     R0,X'160'
01648  P01290  9988222C  P0222C  RANESTD3 SBM     3,RAOCCURD
01649  P01294  AC881E80  P01E80            LB      R1,GORACC        SAVE CURRENT METHOD
01650  P01298  AD882183  P02183            LB      R3,METH3
01651  P0129C  D5A82238  P02238            STB     R3,METHSAVE-1B,R1
01652  P012A0  EE001281  P012B0            BCT     ZR,NOSUPRG3
01653  P012A4  FD490000                    DI      X'29'
01654  P012A8  FC990000                    DI      X'13'
01655  P012AC  FD410000                    DI      X'28'
01656  P012B0  FC040000          NOSUPRG3  DAI     0
01657  P012B4  0002              RABL3     NOP
       P012B6     0002
01658  P012B8  F8801C4D  P01C4C            BL      POPINT
01659  P012BC  CC001F80  P01F80            LF      R0,RAINT3SK
01660  P012C0  9088222C  P0222C            ZBM     3,RAOCCURD
01661  P012C4  F910124D  P0124C            BRI     *RAINT3
01662  P012C8  00000000          RAINT4    DATAW   0
01663  P012CC  FC030000                    AI      0                TURN OFF INTS
01664  P012D0  A3881E80  P01E80            ABM     7,GORACC
01665  P012D4  DC001FA0  P01FA0            STF     R0,RAINT4SK
01666  P012D8  AF80222D  P0222C            LH      R7,RAOCCURD
01667  P012DC  F200130D  P0130C            BCF     ZR,RANESTD4
01668  P012E0  9C880800   00800            ZBM     C.BTCH,C.BIT1
01669  P012E4  F08012ED  P012EC            BCF     SET,BEXEC4
01670  P012E8  9A881E81  P01E81            SBM     5,BATCHSAV
01671  P012EC  CC000140   00140  BEXEC4    LF      R0,X'140'
01672  P012F0  DC001EA0  P01EA0            STF     R0,SISAVE1
01673  P012F4  CC001EE0  P01EE0            LF      R0,HYBSI1
01674  P012F8  DC000140   00140            STF     R0,X'140'
01675  P012FC  CC000160   00160            LF      R0,X'160'
01676  P01300  DC001EC0  P01EC0            STF     R0,SISAVE2
```

```
01677  P01304  CC001F00  P01F00              LF        R0,HYBSI2
01678  P01308  DC000160   00160              STF       R0,X'160'
01679  P0130C  9A08222C  P0222C  RANESTD4   SBM       4,RAOCCURD
01680  P01310  AC881E80  P01E80              LB        R1,GORACC        SAVE CURRENT METHOD
01681  P01314  AD882184  P02184              LB        R3,METH4
01682  P01318  D5A82238  P02238              STB       R3,METHSAVE-1B,R1
01683  P0131C  EE00132D  P0132C              BCT       ZR,NOSUPRG4
01684  P01320  FD490000                      DI        X'29'
01685  P01324  FC990000                      DI        X'13'
01686  P01328  FD410000                      DI        X'28'
01687  P0132C  FC040000              NOSUPRG4 DAI      0
01688  P01330  0002                  RABL4   NOP
       P01332      0002
01689  P01334  F8801C4D  P01C4C              BL        POPINT
01690  P01338  CC001FA0  P01FA0              LF        R0,RAINT4SK
01691  P0133C  9E08222C  P0222C              ZBM       4,RAOCCURD
01692  P01340  F91012C9  P012C8              BRI       *RAINT4
01693  P01344  00000000              RAINT5  DATAW     0
01694  P01348  FC030000                      AI        0                TURN OFF INTS
01695  P0134C  A3881E80  P01E80              ABM       7,GORACC
01696  P01350  DC001FC0  P01FC0              STF       R0,RAINT5SK
01697  P01354  AF80222D  P0222C              LH        R7,RAOCCURD
01698  P01358  F2001389  P01388              BCF       ZR,RANESTD5
01699  P0135C  9C880800   00800              ZBM       C.BTCH,C.BIT1
01700  P01360  F0801369  P01368              BCF       SET,BEXEC5
01701  P01364  9A881E81  P01E81              SBM       5,BATCHSAV
01702  P01368  CC000140   00140  BEXEC5      LF        R0,X'140'
01703  P0136C  DC001EA0  P01EA0              STF       R0,SISAVE1
01704  P01370  CC001EE0  P01EE0              LF        R0,HYBSI1
01705  P01374  DC000140   00140              STF       R0,X'140'
01706  P01378  CC000160   00160              LF        R0,X'160'
01707  P0137C  DC001EC0  P01EC0              STF       R0,SISAVE2
01708  P01380  CC001F00  P01F00              LF        R0,HYBSI2
01709  P01384  DC000160   00160              STF       R0,X'160'
01710  P01388  9A88222C  P0222C  RANESTD5   SBM       5,RAOCCURD
01711  P0138C  AC881E80  P01E80              LB        R1,GORACC        SAVE CURRENT METHOD
01712  P01390  AD882185  P02185              LB        R3,METH5
01713  P01394  D5A82238  P02238              STB       R3,METHSAVE-1B,R1
01714  P01398  EE0013A9  P013A8              BCT       ZR,NOSUPRG5
01715  P0139C  FD410000                      DI        X'28'
01716  P013A0  FC990000                      DI        X'13'
01717  P013A4  FD490000                      DI        X'29'
01718  P013A8  FC040000              NOSUPRG5 DAI      0
01719  P013AC  0002                  RABL5   NOP
       P013AE      0002
01720  P013B0  F8801C4D  P01C4C              BL        POPINT
01721  P013B4  CC001FC0  P01FC0              LF        R0,RAINT5SK
01722  P013B8  9E88222C  P0222C              ZBM       5,RAOCCURD
01723  P013BC  F9101345  P01344              BRI       *RAINT5
01724  P013C0  00000000              RAINT6  DATAW     0
01725  P013C4  FC030000                      AI        0                TURN OFF INTS
01726  P013C8  A3881E80  P01E80              ABM       7,GORACC
01727  P013CC  DC001FE0  P01FE0              STF       R0,RAINT6SK
01728  P013D0  AF80222D  P0222C              LH        R7,RAOCCURD
01729  P013D4  F2001405  P01404              BCF       ZR,RANESTD6
01730  P013D8  9C880800   00800              ZBM       C.BTCH,C.BIT1
01731  P013DC  F08013E5  P013E4              BCF       SET,BEXEC6
01732  P013E0  9A881E81  P01E81              SBM       5,BATCHSAV
01733  P013E4  CC000140   00140  BEXEC6      LF        R0,X'140'
01734  P013E8  DC001EA0  P01EA0              STF       R0,SISAVE1
01735  P013EC  CC001EE0  P01EE0              LF        R0,HYBSI1
01736  P013F0  DC000140   00140              STF       R0,X'140'
01737  P013F4  CC000160   00160              LF        R0,X'160'
01738  P013F8  DC001EC0  P01EC0              STF       R0,SISAVE2
01739  P013FC  CC001F00  P01F00              LF        R0,HYBSI2
01740  P01400  DC000160   00160              STF       R0,X'160'
01741  P01404  9808222C  P0222C  RANESTD6   SBM       6,RAOCCURD
01742  P01408  AC881E80  P01E80              LB        R1,GORACC        SAVE CURRENT METHOD
01743  P0140C  AD882186  P02186              LB        R3,METH6
01744  P01410  D5A82238  P02238              STB       R3,METHSAVE-1B,R1
01745  P01414  EE001425  P01424              BCT       ZR,NOSUPRG6
01746  P01418  FD410000                      DI        X'28'
01747  P0141C  FC990000                      DI        X'13'
01748  P01420  FD490000                      DI        X'29'
01749  P01424  FC040000              NOSUPRG6 DAI      0
```

```
01750  P01428  0002                  RARL6    NOP
       P0142A      0002
01751  P0142C  F8801C4D  P01C4C               BL       POPINT
01752  P01430  CC001FE0  P01FE0               LF       R0,RAINT6SK
01753  P01434  9F08222C  P0222C               ZBM      6,RAOCCURD
01754  P01438  F91013C1  P013C0               BRI      *RAINT6
01755  P0143C  00000000                RAINT7   DATAW    0
01756  P01440  FC030000                        AI       0                TURN OFF INTS
01757  P01444  A3881E80  P01E80               ABM      7,GORACC
01758  P01448  DC002000  P02000               STF      R0,RAINT7SK
01759  P0144C  AF80222D  P0222C               LH       R7,RAOCCURD
01760  P01450  F2001481  P01480               BCF      ZR,RANESTD7
01761  P01454  9C880800   00800               ZBM      C,BTCH,C,BIT1
01762  P01458  F0801461  P01460               BCF      SET,BEXEC7
01763  P0145C  9A881E81  P01E81               SBM      5,BATCHSAV
01764  P01460  CC000140   00140        BEXEC7 LF       R0,X'140'
01765  P01464  DC001EA0  P01EA0               STF      R0,SISAVE1
01766  P01468  CC001EE0  P01EE0               LF       R0,HYBSI1
01767  P0146C  DC000140   00140               STF      R0,X'140'
01768  P01470  CC000160   00160               LF       R0,X'160'
01769  P01474  DC001EC0  P01EC0               STF      R0,SISAVE2
01770  P01478  CC001F00  P01F00               LF       R0,HYBSI2
01771  P0147C  DC000160   00160               STF      R0,X'160'
01772  P01480  9B88222C  P0222C        RANESTD7 SBM    7,RAOCCURD
01773  P01484  AC881E80  P01E80               LR       R1,GORACC        SAVE CURRENT METHOD
01774  P01488  AD882187  P02187               LB       R3,METH7
01775  P0148C  D5A82238  P02238               STB      R3,METHSAVE-1B,R1
01776  P01490  EE0014A1  P014A0               BCT      ZR,NOSUPRG7
01777  P01494  FD410000                        DI       X'28'
01778  P01498  FC990000                        DI       X'13'
01779  P0149C  FD490000                        DI       X'29'
01780  P014A0  FC040000                NOSUPRG7 DAI     0
01781  P014A4  0002                    RARL7    NOP
       P014A6      0002
01782  P014A8  F8801C4D  P01C4C               BL       POPINT
01783  P014AC  CC002000  P02000               LF       R0,RAINT7SK
01784  P014B0  9F88222C  P0222C               ZBM      7,RAOCCURD
01785  P014B4  F9101430  P0143C               BRI      *RAINT7
01786  P014B8  00000000                RAINT8   DATAW    0
01787  P014BC  FC030000                        AI       0                TURN OFF INTS
01788  P014C0  A3881E80  P01E80               ABM      7,GORACC
01789  P014C4  DC002020  P02020               STF      R0,RAINT8SK
01790  P014C8  AF80222D  P0222C               LH       R7,RAOCCURD
01791  P014CC  F20014FD  P014FC               BCF      ZR,RANESTD8
01792  P014D0  9C880800   00800               ZBM      C,BTCH,C,BIT1
01793  P014D4  F08014DD  P014DC               BCF      SET,BEXEC8
01794  P014D8  9A881E81  P01E81               SBM      5,BATCHSAV
01795  P014DC  CC000140   00140        BEXEC8 LF       R0,X'140'
01796  P014E0  DC001EA0  P01EA0               STF      R0,SISAVE1
01797  P014E4  CC001EE0  P01EE0               LF       R0,HYBSI1
01798  P014E8  DC000140   00140               STF      R0,X'140'
01799  P014EC  CC000160   00160               LF       R0,X'160'
01800  P014F0  DC001EC0  P01EC0               STF      R0,SISAVE2
01801  P014F4  CC001F00  P01F00               LF       R0,HYBSI2
01802  P014F8  DC000160   00160               STF      R0,X'160'
01803  P014FC  9808222D  P0222D        RANESTD8 SBM    8,RAOCCURD
01804  P01500  AC881E80  P01E80               LR       R1,GORACC        SAVE CURRENT METHOD
01805  P01504  AD882188  P02188               LB       R3,METH8
01806  P01508  D5A82238  P02238               STB      R3,METHSAVE-1B,R1
01807  P0150C  EE00151D  P0151C               BCT      ZR,NOSUPRG8
01808  P01510  FD410000                        DI       X'28'
01809  P01514  FC990000                        DI       X'13'
01810  P01518  FD490000                        DI       X'29'
01811  P0151C  FC040000                NOSUPRG8 DAI     0
01812  P01520  0002                    RARL8    NOP
       P01522      0002
01813  P01524  F8801C4D  P01C4C               BL       POPINT
01814  P01528  CC002020  P02020               LF       R0,RAINT8SK
01815  P0152C  9C08222D  P0222D               ZBM      8,RAOCCURD
01816  P01530  F91014B9  P014B8               BRI      *RAINT8
01817  P01534  00000000                RAINT9   DATAW    0
01818  P01538  FC030000                        AI       0                TURN OFF INTS
01819  P0153C  A3881E80  P01E80               ABM      7,GORACC
01820  P01540  DC002040  P02040               STF      R0,RAINT9SK
01821  P01544  AF80222D  P0222C               LH       R7,RAOCCURD
```

```
01822  P01548  F2001579  P01578              BCF     ZR,RANESTD9
01823  P0154C  9C880800   00800              ZBM     C.BTCH,C.BIT1
01824  P01550  F0801559  P01558              BCF     SET,BEXEC9
01825  P01554  9A881E81  P01E81              SBM     5,BATCHSAV
01826  P01558  CC000140   00140   BEXEC9     LF      R0,X'140'
01827  P0155C  DC001EA0  P01EA0              STF     R0,SISAVE1
01828  P01560  CC001EE0  P01EE0              LF      R0,HYBSI1
01829  P01564  DC000140   00140              STF     R0,X'140'
01830  P01568  CC000160   00160              LF      R0,X'160'
01831  P0156C  DC001EC0  P01EC0              STF     R0,SISAVE2
01832  P01570  CC001F00  P01F00              LF      R0,HYBSI2
01833  P01574  DC000160   00160              STF     R0,X'160'
01834  P01578  9888222D  P0222D   RANESTD9   SBM     9,RAOCCURD
01835  P0157C  AC881E80  P01E80              LB      R1,GORACC        SAVE CURRENT METHOD
01836  P01580  AD882189  P02189              LB      R3,METH9
01837  P01584  D5A82238  P02238              STB     R3,METHSAVE-1B,R1
01838  P01588  EE001599  P01598              BCT     ZR,NOSUPRG9
01839  P0158C  FD410000                      DI      X'28'
01840  P01590  FC990000                      DI      X'13'
01841  P01594  FD490000                      DI      X'29'
01842  P01598  FC040000          NOSUPRG9    DAI     0
01843  P0159C  0002              RABL9       NOP
       P0159E     0002
01844  P015A0  F8801C4D  P01C4C              BL      POPINT
01845  P015A4  CC002040  P02040              LF      R0,RAINT9SK
01846  P015A8  9C88222D  P02220              ZBM     9,RAOCCURD
01847  P015AC  F9101535  P01534              BRI     *RAINT9
01848  P015B0  00000000          RAINT10     DATAW   0
01849  P015B4  FC030000                      AI      0                TURN OFF INTS
01850  P015B8  A3881E80  P01E80              ABM     7,GORACC
01851  P015BC  DC002060  P02060              STF     R0,RAINT10K
01852  P015C0  AF80222D  P0222C              LH      R7,RAOCCURD
01853  P015C4  F20015F5  P015F4              BCF     ZR,RANEST10
01854  P015C8  9C880800   00800              ZBM     C.BTCH,C.BIT1
01855  P015CC  F08015D5  P015D4              BCF     SET,BEXEC10
01856  P015D0  9A881E81  P01E81              SBM     5,BATCHSAV
01857  P015D4  CC000140   00140   BEXEC10    LF      R0,X'140'
01858  P015D8  DC001EA0  P01EA0              STF     R0,SISAVE1
01859  P015DC  CC001EE0  P01EE0              LF      R0,HYBSI1
01860  P015E0  DC000140   00140              STF     R0,X'140'
01861  P015E4  CC000160   00160              LF      R0,X'160'
01862  P015E8  DC001EC0  P01EC0              STF     R0,SISAVE2
01863  P015EC  CC001F00  P01F00              LF      R0,HYBSI2
01864  P015F0  DC000160   00160              STF     R0,X'160'
01865  P015F4  9908222D  P0222D   RANEST10   SBM     10,RAOCCURD
01866  P015F8  AC881E80  P01E80              LB      R1,GORACC        SAVE CURRENT METHOD
01867  P015FC  AD88218A  P0218A              LB      R3,METH10
01868  P01600  D5A82238  P02238              STB     R3,METHSAVE-1B,R1
01869  P01604  EE001615  P01614              BCT     ZR,NOSUPR10
01870  P01608  FD410000                      DI      X'28'
01871  P0160C  FC990000                      DI      X'13'
01872  P01610  FD490000                      DI      X'29'
01873  P01614  FC040000          NOSUPR10    DAI     0
01874  P01618  0002              RABL10      NOP
       P0161A     0002
01875  P0161C  F8801C4D  P01C4C              BL      POPINT
01876  P01620  CC002060  P02060              LF      R0,RAINT10K
01877  P01624  9D08222D  P0222D              ZBM     10,RAOCCURD
01878  P01628  F91015B1  P015B0              BRI     *RAINT10
01879  P0162C  00000000          RAINT11     DATAW   0
01880  P01630  FC030000                      AI      0                TURN OFF INTS
01881  P01634  A3881E80  P01E80              ABM     7,GORACC
01882  P01638  DC002080  P02080              STF     R0,RAINT11K
01883  P0163C  AF80222D  P0222C              LH      R7,RAOCCURD
01884  P01640  F2001671  P01670              BCF     ZR,RANEST11
01885  P01644  9C880800   00800              ZBM     C.BTCH,C.BIT1
01886  P01648  F0801651  P01650              BCF     SET,BEXEC11
01887  P0164C  9A881E81  P01E81              SBM     5,BATCHSAV
01888  P01650  CC000140   00140   BEXEC11    LF      R0,X'140'
01889  P01654  DC001EA0  P01EA0              STF     R0,SISAVE1
01890  P01658  CC001EE0  P01EE0              LF      R0,HYBSI1
01891  P0165C  DC000140   00140              STF     R0,X'140'
01892  P01660  CC000160   00160              LF      R0,X'160'
01893  P01664  DC001EC0  P01EC0              STF     R0,SISAVE2
01894  P01668  CC001F00  P01F00              LF      R0,HYBSI2
```

```
01895  P0166C  DC000160    00160              STF     R0,X'160'
01896  P01670  9988222D   P0222D   RANEST11  SBM     11,RAOCCURD
01897  P01674  AC881E80   P01E80              LH      R1,GORACC        SAVE CURRENT METHOD
01898  P01678  AD882188   P0218B              LB      R3,METH11
01899  P0167C  D5A82238   P02238              STB     R3,METHSAVE-1B,R1
01900  P01680  EE001691   P01690              BCT     ZR,NOSUPR11
01901  P01684  FD410000                       DI      X'28'
01902  P01688  FC990000                       DI      X'13'
01903  P0168C  FD490000                       DI      X'29'
01904  P01690  FC040000                NOSUPR11 DAI    0
01905  P01694  0002                    RABL11  NOP
       P01696      0002
01906  P01698  F8801C4D   P01C4C              BL      POPINT
01907  P0169C  CC002080   P02080              LF      R0,RAINT11K
01908  P016A0  9D88222D   P0222D              ZBM     11,RAOCCURD
01909  P016A4  F910162D   P0162C              BRI     *RAINT11
01910  P016A8  00000000                RAINT12 DATAW   0
01911  P016AC  FC030000                       AI      0                TURN OFF INTS
01912  P016B0  A3881E80   P01E80              ABM     7,GORACC
01913  P016B4  DC0020A0   P020A0              STF     R0,RAINT12K
01914  P016B8  AF80222D   P0222C              LH      R7,RAOCCURD
01915  P016BC  F20016ED   P016EC              BCF     ZR,RANEST12
01916  P016C0  9C880800    00800              ZBM     C,BTCH,C,BIT1
01917  P016C4  F08016CD   P016CC              BCF     SET,BEXEC12
01918  P016C8  9A881E81   P01E81              SBM     5,BATCHSAV
01919  P016CC  CC000140    00140     BEXEC12  LF      R0,X'140'
01920  P016D0  DC001EA0   P01EA0              STF     R0,SISAVE1
01921  P016D4  CC001EE0   P01EE0              LF      R0,HYBSI1
01922  P016D8  DC000140    00140              STF     R0,X'140'
01923  P016DC  CC000160    00160              LF      R0,X'160'
01924  P016E0  DC001EC0   P01EC0              STF     R0,SISAVE2
01925  P016E4  CC001F00   P01F00              LF      R0,HYBSI2
01926  P016E8  DC000160    00160              STF     R0,X'160'
01927  P016EC  9A08222D   P0222D   RANEST12  SBM     12,RAOCCURD
01928  P016F0  AC881E80   P01E80              LB      R1,GORACC        SAVE CURRENT METHOD
01929  P016F4  AD88218C   P0218C              LB      R3,METH12
01930  P016F8  D5A82238   P02238              STB     R3,METHSAVE-1B,R1
01931  P016FC  EE00170D   P0170C              BCT     ZR,NOSUPR12
01932  P01700  FD410000                       DI      X'28'
01933  P01704  FC990000                       DI      X'13'
01934  P01708  FD490000                       DI      X'29'
01935  P0170C  FC040000                NOSUPR12 DAI    0
01936  P01710  0002                    RABL12  NOP
       P01712      0002
01937  P01714  F8801C4D   P01C4C              BL      POPINT
01938  P01718  CC0020A0   P020A0              LF      R0,RAINT12K
01939  P0171C  9E08222D   P0222D              ZBM     12,RAOCCURD
01940  P01720  F91016A9   P016A8              BRI     *RAINT12
01941  P01724  00000000                RAINT13 DATAW   0
01942  P01728  FC030000                       AI      0                TURN OFF INTS
01943  P0172C  A3881E80   P01E80              ABM     7,GORACC
01944  P01730  DC0020C0   P020C0              STF     R0,RAINT13K
01945  P01734  AF80222D   P0222C              LH      R7,RAOCCURD
01946  P01738  F2001769   P01768              BCF     ZR,RANEST13
01947  P0173C  9C880800    00800              ZBM     C,BTCH,C,BIT1
01948  P01740  F0801749   P01748              BCF     SET,BEXEC13
01949  P01744  9A881E81   P01E81              SBM     5,BATCHSAV
01950  P01748  CC000140    00140     BEXEC13  LF      R0,X'140'
01951  P0174C  DC001EA0   P01EA0              STF     R0,SISAVE1
01952  P01750  CC001EE0   P01EE0              LF      R0,HYBSI1
01953  P01754  DC000140    00140              STF     R0,X'140'
01954  P01758  CC000160    00160              LF      R0,X'160'
01955  P0175C  DC001EC0   P01EC0              STF     R0,SISAVE2
01956  P01760  CC001F00   P01F00              LF      R0,HYBSI2
01957  P01764  DC000160    00160              STF     R0,X'160'
01958  P01768  9A88222D   P0222D   RANEST13  SBM     13,RAOCCURD
01959  P0176C  AC881E80   P01E80              LB      R1,GORACC        SAVE CURRENT METHOD
01960  P01770  AD88218D   P0218D              LB      R3,METH13
01961  P01774  D5A82238   P02238              STB     R3,METHSAVE-1B,R1
01962  P01778  EE001789   P01788              BCT     ZR,NOSUPR13
01963  P0177C  FD410000                       DI      X'28'
01964  P01780  FC990000                       DI      X'13'
01965  P01784  FD490000                       DI      X'29'
01966  P01788  FC040000                NOSUPR13 DAI    0
01967  P0178C  0002                    RABL13  NOP
```

```
        P0178E      0002
01968   P01790  F8801C4D  P01C4C          BL      POPINT
01969   P01794  CC0020C0  P020C0          LF      R0,RAINT13K
01970   P01798  9E88222D  P02220          ZBM     13,RAOCCURD
01971   P0179C  F9101725  P01724          BRI     *RAINT13
01972   P017A0  00000000          RAINT14 DATAW   0
01973   P017A4  FC030000                  AI      0              TURN OFF INTS
01974   P017A8  A3881E80  P01E80          ABM     7,GORACC
01975   P017AC  DC0020E0  P020E0          STF     R0,RAINT14K
01976   P017B0  AF80222D  P0222C          LH      R7,RAOCCURD
01977   P017B4  F20017E5  P017E4          BCF     ZR,RANEST14
01978   P017B8  9C880800   00800          ZBM     C.BTCH,C.BIT1
01979   P017BC  F08017C5  P017C4          BCF     SET,BEXEC14
01980   P017C0  9A881E81  P01E81          SBM     5,BATCHSAV
01981   P017C4  CC000140   00140  BEXEC14 LF      R0,X'140'
01982   P017C8  DC001EA0  P01EA0          STF     R0,SISAVE1
01983   P017CC  CC001EE0  P01EE0          LF      R0,HYBSI1
01984   P017D0  DC000140   00140          STF     R0,X'140'
01985   P017D4  CC000160   00160          LF      R0,X'160'
01986   P017D8  DC001EC0  P01EC0          STF     R0,SISAVE2
01987   P017DC  CC001F00  P01F00          LF      R0,HYBSI2
01988   P017E0  DC000160   00160          STF     R0,X'160'
01989   P017E4  9808222D  P0222D  RANEST14 SBM    14,RAOCCURD
01990   P017E8  AC881E80  P01E80          LB      R1,GORACC      SAVE CURRENT METHOD
01991   P017EC  AD88218E  P0218E          LB      R3,METH14
01992   P017F0  D5A82238  P02238          STB     R3,METHSAVE-1B,R1
01993   P017F4  EE001805  P01804          BCT     ZR,NOSUPR14
01994   P017F8  FD410000                  DI      X'28'
01995   P017FC  FC990000                  DI      X'13'
01996   P01800  FD490000                  DI      X'29'
01997   P01804  FC040000          NOSUPR14 DAI    0
01998   P01808  0002              RABL14  NOP
        P0180A      0002
01999   P0180C  F8801C4D  P01C4C          BL      POPINT
02000   P01810  CC0020E0  P020E0          LF      R0,RAINT14K
02001   P01814  9F08222D  P0222D          ZBM     14,RAOCCURD
02002   P01818  F91017A1  P017A0          BRI     *RAINT14
02003   P0181C  00000000          RAINT15 DATAW   0
02004   P01820  FC030000                  AI      0              TURN OFF INTS
02005   P01824  A3881E80  P01E80          ABM     7,GORACC
02006   P01828  DC002100  P02100          STF     R0,RAINT15K
02007   P0182C  AF80222D  P0222C          LH      R7,RAOCCURD
02008   P01830  F2001861  P01860          BCF     ZR,RANEST15
02009   P01834  9C880800   00800          ZBM     C.BTCH,C.BIT1
02010   P01838  F0801841  P01840          BCF     SET,BEXEC15
02011   P0183C  9A881E81  P01E81          SBM     5,BATCHSAV
02012   P01840  CC000140   00140  BEXEC15 LF      R0,X'140'
02013   P01844  DC001EA0  P01EA0          STF     R0,SISAVE1
02014   P01848  CC001EE0  P01EE0          LF      R0,HYBSI1
02015   P0184C  DC000140   00140          STF     R0,X'140'
02016   P01850  CC000160   00160          LF      R0,X'160'
02017   P01854  DC001EC0  P01EC0          STF     R0,SISAVE2
02018   P01858  CC001F00  P01F00          LF      R0,HYBSI2
02019   P0185C  DC000160   00160          STF     R0,X'160'
02020   P01860  9B88222D  P0222D  RANEST15 SBM    15,RAOCCURD
02021   P01864  AC881E80  P01E80          LB      R1,GORACC      SAVE CURRENT METHOD
02022   P01868  AD88218F  P0218F          LB      R3,METH15
02023   P0186C  D5A82238  P02238          STB     R3,METHSAVE-1B,R1
02024   P01870  EE001881  P01880          BCT     ZR,NOSUPR15
02025   P01874  FD410000                  DI      X'28'
02026   P01878  FC990000                  DI      X'13'
02027   P0187C  FD490000                  DI      X'29'
02028   P01880  FC040000          NOSUPR15 DAI    0
02029   P01884  0002              RABL15  NOP
        P01886      0002
02030   P01888  F8801C4D  P01C4C          BL      POPINT
02031   P0188C  CC002100  P02100          LF      R0,RAINT15K
02032   P01890  9F88222D  P0222D          ZBM     15,RAOCCURD
02033   P01894  F910181D  P0181C          BRI     *RAINT15
02034                             *
02035                             *                FOLLOWING IS THE ADC DCM INTERRUPT HANDLER
02036                             *
02037   P01898  00000000          ADCDCMSI DATAW  0
02038   P0189C  DC002140  P02140          STF     R0,ADCSISTK    SAVE GPR(S)
02039   P018A0  A8000849  P00848          EXM     ADCCDRD        READ THE ADCDCM STATUS
```

```
02040  P018A4  C880F82F                    LI      R1,-2001        LOOP ON TO 8000 TILL ALL CC(S) RESET
02041  P018A8  A8000BD9   P00BD8           EXM     ADCTO           LOOP ON TO X'8000' STATUS
02042  P018AC  EF8018B5   P018B4           BCT     7,$+2W
02043  P018B0  EC0018BD   P0188C           BU      $+3W
02044  P018B4  F48018A9   P018A8           BIB     R1,$-3W
02045  P018B8  0000                        HALT                    THE ADC DCM IS BROKEN
       P018BA       0002
02046  P018BC  AC900CE8   P00CE8           LW      R1,*ADCTCW      FETCH ADC STATUS FROM TCW LOCATION
02047  P018C0  2D10                        TRR     R1,R2
02048  P018C2       7091                  SRL     R1,17           IF R1 = 0 => ADC OVERSCALE
02049  P018C4  84802348   P02348           ANMW    R1,=4           IF R1 = 4 => ADC DATA RATE ERROR
02050  P018C8  710E                        SRL     R2,14
       P018CA       0002
02051  P018CC  8500233C   P0233C           ANMW    R2,=X'1C'
02052  P018D0  EC2018D5   P018D4           BU      $+1W,R1
02053  P018D4  EC001921   P01920           BU      ADCOVRSC
02054  P018D8  EC4018D9   P018D8           BU      $,R2
02055  P018DC  EC0018F9   P018F8           BU      ADCDER1
02056  P018E0  EC001901   P01900           BU      ADCDER2
02057  P018E4  EC001909   P01908           BU      ADCDER3
02058  P018E8  EC001911   P01910           BU      ADCDER4
02059  P018EC  EC001919   P01918           BU      ADCDER5
02060  P018F0  F88019C5   P019C4   ADCDER6 BL      ADCDE6DF        BL TO DEFAULT OR USER'S ROUTINE
02061  P018F4  EC001965   P01964           BU      ADCSIBYE        FOR
02062  P018F8  F8801990   P0199C   ADCDER1 BL      ADCDE1DF
02063  P018FC  EC001965   P01964           BU      ADCSIBYE
02064  P01900  F88019A5   P019A4   ADCDER2 BL      ADCDE2DF        DATA
02065  P01904  EC001965   P01964           BU      ADCSIBYE        RATE
02066  P01908  F88019AD   P019AC   ADCDER3 BL      ADCDE3DF
02067  P0190C  EC001965   P01964           BU      ADCSIBYE
02068  P01910  F8801985   P019B4   ADCDER4 BL      ADCDE4DF
02069  P01914  EC001965   P01964           BU      ADCSIBYE
02070  P01918  F880198D   P019BC   ADCDER5 BL      ADCDE5DF
02071  P0191C  EC001965   P01964           BU      ADCSIBYE
02072                                 *
02073                                 *            COMES HERE FOR ADC OVERSCALE INTERRUPT
02074                                 *
02075  P01920  EC401921   P01920   ADCOVRSC BU      $,R2
02076  P01924  EC001941   P01940           BU      ADCOVRS1
02077  P01928  EC001949   P01948           BU      ADCOVRS2
02078  P0192C  EC001951   P01950           BU      ADCOVRS3
02079  P01930  EC001959   P01958           BU      ADCOVRS4
02080  P01934  EC001961   P01960           BU      ADCOVRS5
02081  P01938  F8801995   P01994   ADCOVRS6 BL      ADCOV6DF
02082  P0193C  EC001965   P01964           BU      ADCSIBYE
02083  P01940  F8801960   P0196C   ADCOVRS1 BL      ADCOV1DF
02084  P01944  EC001965   P01964           BU      ADCSIBYE
02085  P01948  F8801975   P01974   ADCOVRS2 BL      ADCOV2DF
02086  P0194C  EC001965   P01964           BU      ADCSIBYE
02087  P01950  F880197D   P0197C   ADCOVRS3 BL      ADCOV3DF
02088  P01954  EC001965   P01964           BU      ADCSIBYE
02089  P01958  F8801985   P01984   ADCOVRS4 BL      ADCOV4DF
02090  P0195C  EC001965   P01964           BU      ADCSIBYE
02091  P01960  F880198D   P0198C   ADCOVRS5 BL      ADCOV5DF
02092  P01964  CC002140   P02140   ADCSIBYE LF      R0,ADCSISTK     PULL THE REGISTER STACK
02093  P01968  F9101899   P01898           BRI     *ADCDCMSI       POP THE INTERRUPT
02094                                 *
02095                                 *            FOLLOWING ARE THE DEFAULT PROCESSORS
02096                                 *            FOR THE ADCDCM SI INTERRUPTS
02097                                 *
02098  P0196C  A38821DF   P021DF   ADCOV1DF ABM     31,ADOV1FLG
02099  P01970  2800                        TRSW    R0
       P01972       0002
02100  P01974  A38821E3   P021E3   ADCOV2DF ABM     31,ADOV2FLG
02101  P01978  2800                        TRSW    R0
       P0197A       0002
02102  P0197C  A38821E7   P021E7   ADCOV3DF ABM     31,ADOV3FLG
02103  P01980  2800                        TRSW    R0
       P01982       0002
02104  P01984  A38821EB   P021EB   ADCOV4DF ABM     31,ADOV4FLG
02105  P01988  2800                        TRSW    R0
       P0198A       0002
02106  P0198C  A38821EF   P021EF   ADCOV5DF ABM     31,ADOV5FLG
02107  P01990  2800                        TRSW    R0
       P01992       0002
```

```
02108  P01994  A38821F3   P021F3   ADCOV6DF ABM     31,ADOV6FLG
02109  P01998  2800                         TRSW    R0
       P019A        0002
02110  P019C   A38821F7   P021F7   ADCDE1DF ABM     31,ADDE1FLG
02111  P019A0  2800                         TRSW    R0
       P019A2        0002
02112  P019A4  A38821FB   P021FB   ADCDE2DF ABM     31,ADDE2FLG
02113  P019A8  2800                         TRSW    R0
       P019AA        0002
02114  P019AC  A38821FF   P021FF   ADCDE3DF ABM     31,ADDE3FLG
02115  P019B0  2800                         TRSW    R0
       P019B2        0002
02116  P019B4  A3882203   P02203   ADCDE4DF ABM     31,ADDE4FLG
02117  P019B8  2800                         TRSW    R0
       P019BA        0002
02118  P019BC  A3882207   P02207   ADCDE5DF ABM     31,ADDE5FLG
02119  P019C0  2800                         TRSW    R0
       P019C2        0002
02120  P019C4  A388220B   P0220B   ADCDE6DF ABM     31,ADDE6FLG
02121  P019C8  2800                         TRSW    R0
02122                                *
02123                                *          FOLLOWING IS THE DAM DCM INTERRUPT HANDLER
02124                                *
       P019CA        0002
02125  P019CC  00000000             DAMDCMSI DATAW   0
02126  P019D0  DC002160   P02160            STF     R0,DAMSISTK      SAVE GPR(S)
02127  P019D4  A8000861   P00B60            EXM     DAMCDRD          READ THE DAM DCM STATUS
02128  P019D8  C880F82F                     LI      R1,-2001         LOOP ON TD 8000 TILL ALL CC(S) RESET
02129  P019DC  A80008DD   P00BDC            EXM     DAMTD            LOOP ON TD X'8000' STATUS
02130  P019E0  EF8019E9   P019E8            BCT     7,$+2W
02131  P019E4  EC0019F1   P019F0            BU      $+3W
02132  P019E8  F48019DD   P019DC            BIB     R1,$-3W
02133  P019EC  0000                        HALT                     THE DAM DCM IS BRODEN
       P019EE        0002
02134  P019F0  AC900CEC   P00CEC            LW      R1,*DAMTCW       FETCH DAM STATUS FROM TCW LOCATION
02135  P019F4  2010                        TRR     R1,R2
02136  P019F6        7091                  SRL     R1,17            IF R1 = 0 => DAM FLT. PT. OVERFLOW
02137  P019F8  84802348   P02348            ANMW    R1,=4            IF R1 = 4 => DAM DATA RATE
02138  P019FC  710E                        SRL     R2,14
       P019FE        0002
02139  P01A00  8500233C   P0233C            ANMW    R2,=X'1C'        R2 = A WORD TCR INDEX
02140  P01A04  EC201A09   P01A08            BU      $+1W,R1
02141  P01A08  EC001A55   P01A54            BU      DAMFLTPT
02142  P01A0C  EC401A0D   P01A0C            BU      $,R2             COMES HERE FOR DATA RATE ERROR
02143  P01A10  EC001A2D   P01A2C            BU      DAMDER1
02144  P01A14  EC001A35   P01A34            BU      DAMDER2
02145  P01A18  EC001A3D   P01A3C            BU      DAMDER3
02146  P01A1C  EC001A45   P01A44            BU      DAMDER4
02147  P01A20  EC001A4D   P01A4C            BU      DAMDER5
02148  P01A24  F8801AF9   P01AF8   DAMDER6 BL      DAMDE6DF
02149  P01A28  EC001A9D   P01A9C            BU      DAMSIBYE
02150  P01A2C  F8801AD5   P01AD4   DAMDER1 BL      DAMDE1DF
02151  P01A30  EC001A9D   P01A9C            BU      DAMSIBYE
02152  P01A34  F8801ADD   P01ADC   DAMDER2 BL      DAMDE2DF
02153  P01A38  EC001A9D   P01A9C            BU      DAMSIBYE
02154  P01A3C  F8801AE9   P01AE8   DAMDER3 BL      DAMDE3DF
02155  P01A40  EC001A9D   P01A9C            BU      DAMSIBYE
02156  P01A44  F8801AE5   P01AE4   DAMDER4 BL      DAMDE4DF
02157  P01A48  EC001A9D   P01A9C            BU      DAMSIBYE
02158  P01A4C  F8801AF1   P01AF0   DAMDER5 BL      DAMDE5DF
02159  P01A50  EC001A9D   P01A9C            BU      DAMSIBYE
02160                                *
02161                                *          COMES HERE FOR DAM FLOATING POINT OVERFLOW INTERRUPT
02162                                *
02163  P01A54  EC401A55   P01A54   DAMFLTPT BU      $,R2
02164  P01A58  EC001A75   P01A74            BU      DAMFLT1
02165  P01A5C  EC001A7D   P01A7C            BU      DAMFLT2
02166  P01A60  EC001A85   P01A84            BU      DAMFLT3
02167  P01A64  EC001A8D   P01A8C            BU      DAMFLT4
02168  P01A68  EC001A95   P01A94            BU      DAMFLT5
02169  P01A6C  F8801ACD   P01ACC   DAMFLT6 BL      DAMFP6DF
02170  P01A70  EC001A9D   P01A9C            BU      DAMSIBYE
02171  P01A74  F8801AA5   P01AA4   DAMFLT1 BL      DAMFP1DF
02172  P01A78  EC001A9D   P01A9C            BU      DAMSIBYE
02173  P01A7C  F8801AAD   P01AAC   DAMFLT2 BL      DAMFP2DF
```

```
02174  P01A80  EC001A9D  P01A9C                 BU        DAMSIBYE
02175  P01A84  F8801A85  P01A84   DAMFLT3       BL        DAMFP3DF
02176  P01A88  EC001A9D  P01A9C                 BU        DAMSIBYE
02177  P01A8C  F8801A8D  P01A8C   DAMFLT4       BL        DAMFP4DF
02178  P01A90  EC001A9D  P01A9C                 BU        DAMSIBYE
02179  P01A94  F8801AC5  P01AC4   DAMFLT5       BL        DAMFP5DF
02180  P01A98  EC001A9D  P01A9C                 BU        DAMSIBYE
02181  P01A9C  CC002160  P02160   DAMSIBYE      LF        R0,DAMSISTK      PULL THE REGISTER STACK
02182  P01AA0  F91019CD  P019CC                 BRI       *DAMDCMSI        POP THE INTERRUPT
02183                             *
02184                             *                 FOLLOWING ARE THE DEFAULT PROCESSORS
02185                             *                 FOR THE DAM DCM SI INTERRUPTS
02186                             *
02187  P01AA4  A38821AF  P021AF   DAMFP1DF  ABM       31,DAFP1FLG
02188  P01AA8  2800                          TRSW      R0
       P01AAA      0002
02189  P01AAC  A38821B3  P02183   DAMFP2DF  ABM       31,DAFP2FLG
02190  P01AB0  2800                          TRSW      R0
       P01AB2      0002
02191  P01AB4  A38821B7  P021B7   DAMFP3DF  ABM       31,DAFP3FLG
02192  P01AB8  2800                          TRSW      R0
       P01ABA      0002
02193  P01ABC  A38821BB  P021BB   DAMFP4DF  ABM       31,DAFP4FLG
02194  P01AC0  2800                          TRSW      R0
       P01AC2      0002
02195  P01AC4  A38821BF  P021BF   DAMFP5DF  ABM       31,DAFP5FLG
02196  P01AC8  2800                          TRSW      R0
       P01ACA      0002
02197  P01ACC  A38821C3  P021C3   DAMFP6DF  ABM       31,DAFP6FLG
02198  P01AD0  2800                          TRSW      R0
       P01AD2      0002
02199  P01AD4  A38821C7  P021C7   DAMDE1DF  ABM       31,DADE1FLG
02200  P01AD8  2800                          TRSW      R0
       P01ADA      0002
02201  P01ADC  A38821CB  P021CB   DAMDE2DF  ABM       31,DADE2FLG
02202  P01AE0  2800                          TRSW      R0
       P01AE2      0002
02203  P01AE4  A38821D3  P021D3   DAMDE4DF  ABM       31,DADE4FLG
02204  P01AE8  A38821CF  P021CF   DAMDE3DF  ABM       31,DADE3FLG
02205  P01AEC  2800                          TRSW      R0
02206  P01AEE      2800                      TRSW      R0
02207  P01AF0  A38821D7  P021D7   DAMDE5DF  ABM       31,DADE5FLG
02208  P01AF4  2800                          TRSW      R0
       P01AF6      0002
02209  P01AF8  A38821DB  P021DB   DAMDE6DF  ABM       31,DADE6FLG
02210  P01AFC  2800                          TRSW      R0
       P01AFE      0002
02211  P01B00  00000000                      SIOHAND   DATAW     0
02212  P01B04  98081E66  P01E66               SBM       0,SIOCCURD       LOG THE OCCURRANCE OF THE SI INTERRPT
02212  P01B04  98081E66  P01E66               SBM       0,SIOCCURD       LOG THE OCCURRANCE OF THE SI INTERRPT
02213  P01B08  F9101B01  P01B00               BRI       *SIOHAND         RETURN TO GORILLA PROCESSING
02214  P01B0C  00000000                      SI1HAND   DATAW     0
02215  P01B10  98881E66  P01E66               SBM       1,SIOCCURD
02216  P01B14  F9101B0D  P01B0C               BRI       *SI1HAND
02217  P01B18  00000000                      SI2HAND   DATAW     0
02218  P01B1C  99081E66  P01E66               SBM       2,SIOCCURD
02219  P01B20  F9101B19  P01B18               BRI       *SI2HAND
02220  P01B24  00000000                      SI3HAND   DATAW     0
02221  P01B28  99881E66  P01E66               SBM       3,SIOCCURD
02222  P01B2C  F9101B25  P01B24               BRI       *SI3HAND
02223  P01B30  00000000                      SI4HAND   DATAW     0
02224  P01B34  9A081E66  P01E66               SBM       4,SIOCCURD
02225  P01B38  F9101B31  P01B30               BRI       *SI4HAND
02226  P01B3C  00000000                      SI5HAND   DATAW     0
02227  P01B40  9A881E66  P01E66               SBM       5,SIOCCURD
02228  P01B44  F9101B3D  P01B3C               BRI       *SI5HAND
02229  P01B48  00000000                      SI6HAND   DATAW     0
02230  P01B4C  9B081E66  P01E66               SBM       6,SIOCCURD
02231  P01B50  F9101B49  P01B48               BRI       *SI6HAND
02232  P01B54  00000000                      SI7HAND   DATAW     0
02233  P01B58  9B881E66  P01E66               SBM       7,SIOCCURD
02234  P01B5C  F9101B55  P01B54               BRI       *SI7HAND
02235  P01B60  00000000                      SI8HAND   DATAW     0
02236  P01B64  98081E67  P01E67               SBM       8,SIOCCURD
02237  P01B68  F9101B61  P01B60               BRI       *SI8HAND
02238  P01B6C  00000000                      SI9HAND   DATAW     0
02239  P01B70  98881E67  P01E67               SBM       9,SIOCCURD
02240  P01B74  F9101B6D  P01B6C               BRI       *SI9HAND
02241  P01B78  00000000                      SI10HAND  DATAW     0
02242  P01B7C  99081E67  P01E67               SBM       10,SIOCCURD
02243  P01B80  F9101B79  P01B78               BRI       *SI10HAND
02244  P01B84  00000000                      SI11HAND  DATAW     0
```

```
02245  P01B88  99881E67  P01E67              SBM       11,SIOCCURD
02246  P01B8C  F9101B85  P01B84              BRI       *SI11HAND
02247  P01B90  00000000              SI12HAND DATAW     0
02248  P01B94  9A081E67  P01E67              SBM       12,SIOCCURD
02249  P01B98  F9101B91  P01B90              BRI       *SI12HAND
02250  P01B9C  00000000              SI13HAND DATAW     0
02251  P01BA0  9A881E67  P01E67              SBM       13,SIOCCURD
02252  P01BA4  F9101B9D  P01B9C              BRI       *SI13HAND
02253  P01BA8  00000000              SI14HAND DATAW     0
02254  P01BAC  9B081E67  P01E67              SBM       14,SIOCCURD
02255  P01B80  F9101BA9  P01BA8              BRI       *SI14HAND
02256  P01BB4  00000000              SI15HAND DATAW     0
02257  P01BB8  9B881E67  P01E67              SBM       15,SIOCCURD
02258  P01BBC  F9101BB5  P01BB4              BRI       *SI15HAND
02259                                *
02260                                *              FOLLOWING IS THE 1HR FOR NONPRESENT MEMORY TRAP
02261                                *
02262  P01BC0  00000000              HYBNOMEM DATAW     0
02263  P01BC4  D480221C  P0221C              STW       R1,NONMEMSV
02264  P01BC8  AC881E80  P01E80              LB        R1,GORACC        IS THE GORRILLA ACTIVE?
02265  P01BCC  EE001C09  P01C08              BCT       ZR,NOGORMEM
02266  P01BD0  AC802214  P02214              LW        R1,GORTSA        R1= ADR OF GORILLA'J TSA
02267  P01BD4  A0A8005F   0005F              ABM       25,T.REGP,R1     INCREMENT PUSH-DOWN POINTER
02268  P01BD8  A128005F   0005F              ABM        26,T.REGP,R1
02269  P01BDC  ACA0005C   0005C              LW        R1,T.REGP,R1
02270  P01BE0  DC200000   00000              STF       R0,0,R1          PUSH-DOWN REGISTERS
02271  P01BE4  AD00221C  P0221C              LW         R2,NONMEMSV
02272  P01BE8  D5200004   00004              STW       R2,1W,R1         PUSH-DOWN R1
02273  P01BEC  AD01BC0   P01BC0              LW        R2,HYBNOMEM
02274  P01BF0  D5200020   00020              STW       R2,8W,R1         PUSH-DOWN PSW
02275  P01BF4  AD002210  P02210              LW        R2,SAVABORT      R2 = GORILLA ABORT ADDRESS
02276  P01BF8  AE80234C  P0234C              LW        R5,=C'HY71'      ABORT CODE FOR NONPRESENT MEMORY
02277  P01BFC  F8801E31  P01E30              BL         DAIGINTS        DEACTIVATE GORILLA INTERRUPTS
02278  P01C00  F88007D1  P007D0              BL         UNGORILA
02279  P01C04  F9400001   00000              BRI       0,R2             RESET INTERRUPT ABORT
02280                                *
02281                                *              COMES HERE IF A GORILLA WAS NOT ACTIVE WHEN
02282                                *              THE NON-PRESENT MEMORY TRAP OCCURRED
02283                                *
02284  P01C08  AC801BC0  P01BC0      NOGORMEM LW       R1,HYBNOMEM      PUT OLD PSW INTO RTM'S PUSH WORD
02285  P01C0C  D4902218  P02218              STW       R1,*NONMEMIH
02286  P01C10  AC80221C  P0221C              LW        R1,NONMEMSV      CONSTRUCT INDIRECT
02287  P01C14  C8810004                      ADI       R1,1W            NECTOR TO BRANCH
02288  P01C18  D4802220  P02220              STW       R1,RTMNOMEM      INTO RTM'S HANDLER
02289  P01C1C  AC80221C  P0221C              LW        R1,NONMEMSV      RESTORE RI
02290  P01C20  EC102221  P02220              BU         *RTMNOMEM
02291                                *
02292                                *              FOLLOWING IS THE 1HR FOR THE
02293                                *              ARITHMETIC EXECPTION TRAP
02294                                *
02295  P01C24  00000000              ARITHAND DATAW     0                PSN PUSH
02296  P01C28  D4802228  P02228              STW       R1,ARITHSAV
02297  P01C2C  AC881E80  P01E80              LB        R1,GORACC        IS THE GORILLA ACTIVE?
02298  P01C30  EE001C45  P01C44              BCT       ZR,NOGORATH
02299                                *                                    SET THE ARITHMETIC EXECPTION BIT
02300                                *                                    IN THE GORILLA TSA
02301  P01C34  AC802214  P02214              LW        R1,GORTSA
02302  P01C38  98280008   00008      POPARITH SBM      T.EXCP,T.BIT1,R1     SET THE BIT IN PROPER TSA
02303  P01C3C  AC802228  P02228              LW        R1,ARITHSAV      RESTORE RI
02304  P01C40  F9101C25  P01C24              BRI       *ARITHAND        RESET LEVEL
02305  P01C44  AC800878   00878      NOGORATH LW       R1,C.TSAD        SET THE ARITHMETIC EXECPTION BIT
02306                                *                                    IN THE NON-DIRECTLY CONNECTED
02307                                *                                    TASK'S TASK SERVICE AREA
02308  P01C48  EC001C39  P01C38              BU         POPARITH
02309                                *              THIS SUBROUTINE IS INVOKED AT THE END OF EACH GORILLA
02310                                *              INTERRUPT HANDLER. IT CHECKS TO SEE IF SOME NON-HYBRID
02311                                *              SI OCCURED VIA CHECKING "SIOCCURD" . IF AN SI DID OCCUR
02312                                *              DURING A GORILLA FRAME THE LEVEL IS ACTIVATED AND THE
02313                                *              HANDLER IS ENTERED
02314                                *
02315  P01C4C  AC881E80  P01E80      POPINT   LB       R1,GORACC        DECREMENT # OF GORILLAS
02316  P01C50  C881FFFF                      ADI       R1,-1
02317  P01C54  D4881E80  P01E80              STB       R1,GORACC
02318  P01C58  F2001E05  P01E04              BCF       ZR,NESTED1       BRANCH IF ANOTHER RA ACTIVE
02319  P01C5C  AC881E81  P01E81              LB        R1,BATCHSAV      RESTORE BATCH STATUS
02320  P01C60  A8202191  P02190              EXM       BTCHRSTR,R1
02321  P01C64  9E881E81  P01E81              ZBM       5,BATCHSAV       RESET BATCH INDICATOR
02322  P01C68  FC030000                      AI        0                TURN OFF INTERRUPT STRUCTURE
02323  P01C6C  CE001EA0  P01EA0              LF        R4,SISAVE1       RESTORE RTM SI POINTERS
02324  P01C70  DE000140   00140              STF       R4,X'140'
02325  P01C74  CE001E80  P01E80              LF        R4,SISAVE1+4W
02326  P01C78  DE000150   00150              STF       R4,X'150'
02327  P01C7C  CE001EC0  P01EC0              LF        R4,SISAVE2
```

```
02328  P01C80  DE000160   00160              STF     R4,X'160'
02329  P01C84  CE001ED0  P01ED0              LF      R4,SISAVE2+4W
02330  P01C88  DE000170   00170              STF     R4,X'170'
02331  P01C8C  FC040000                      DAI     0                 TURN ON INTERRUPT STRUCTURE
02332  P01C90  AC801E67  P01E66  SICHECKS   LH      R1,SIOCCURD       IF THE OCCURRANCE FLAGS ARE 0
02333  P01C94  F2001C9D  P01C9C              BCF     ZR,$+2W           => NO SI OCCURRED : RETURN
02334  P01C98  EC001E1D  P01E1C              BU      ENABRTM3
02335  P01C9C  9C081E66  P01E66              ZBM     0,SIOCCURD
02336  P01CA0  EC801D21  P01D20              BCT     SET,SI0HAPND      SI 0 OCCURRED
02337  P01CA4  9C881E66  P01E66              ZBM     1,SIOCCURD
02338  P01CA8  EC801D2D  P01D2C              BCT     SET,SI1HAPND
02339  P01CAC  9D081E66  P01E66              ZBM     2,SIOCCURD
02340  P01CB0  EC801D39  P01D38              BCT     SET,SI2HAPND
02341  P01CB4  9D881E66  P01E66              ZBM     3,SIOCCURD
02342  P01CB8  EC801D45  P01D44              BCT     SET,SI3HAPND
02343  P01CBC  9E081E66  P01E66              ZBM     4,SIOCCURD
02344  P01CC0  EC801D51  P01D50              BCT     SET,SI4HAPND
02345  P01CC4  9E881E66  P01E66              ZBM     5,SIOCCURD
02346  P01CC8  EC801D5D  P01D5C              BCT     SET,SI5HAPND
02347  P01CCC  9F081E66  P01E66              ZBM     6,SIOCCURD
02348  P01CD0  EC801D69  P01D68              BCT     SET,SI6HAPND
02349  P01CD4  9F881E66  P01E66              ZBM     7,SIOCCURD
02350  P01CD8  EC801D75  P01D74              BCT     SET,SI7HAPND
02351  P01CDC  9C081E67  P01E67              ZBM     8,SIOCCURD
02352  P01CE0  EC801D81  P01D80              BCT     SET,SI8HAPND
02353  P01CE4  9C881E67  P01E67              ZBM     9,SIOCCURD
02354  P01CE8  EC801D8D  P01D8C              BCT     SET,SI9HAPND
02355  P01CEC  9D081E67  P01E67              ZBM     10,SIOCCURD
02356  P01CF0  EC801D99  P01D98              BCT     SET,SI10HAPN
02357  P01CF4  9D881E67  P01E67              ZBM     11,SIOCCURD
02358  P01CF8  EC801DA5  P01DA4              BCT     SET,SI11HAPN
02359  P01CFC  9E081E67  P01E67              ZBM     12,SIOCCURD
02360  P01D00  EC801DB1  P01DB0              BCT     SET,SI12HAPN
02361  P01D04  9E881E67  P01E67              ZBM     13,SIOCCURD
02362  P01D08  EC801DBD  P01DBC              BCT     SET,SI13HAPN
02363  P01D0C  9F081E67  P01E67              ZBM     14,SIOCCURD
02364  P01D10  EC801DBD  P01DBC              BCT     SET,SI13HAPN
02365  P01D14  9F881E67  P01E67              ZBM     15,SIOCCURD
02366  P01D18  EC801DD5  P01DD4              BCT     SET,SI15HAPN
02367  P01D1C  0000                          HALT                      THIS WILL NEVER HAPPEN BUT LET'S SEE
       P01D1E      0002
02368  P01D20  FCA30000            SI0HAPND  AI      X'14'
02369  P01D24  0020                          ZR      R2
       P01D26      0002
02370  P01D28  EC001DDD  P01DDC              BU      SIMERGE
02371  P01D2C  FCAB0000            SI1HAPND  AI      X'15'
02372  P01D30  C9000004                      LI      R2,1W
02373  P01D34  EC001DDD  P01DDC              BU      SIMERGE
02374  P01D38  FCB30000            SI2HAPND  AI      X'16'
02375  P01D3C  C9000008                      LI      R2,2W
02376  P01D40  EC001DDD  P01DDC              BU      SIMERGE
02377  P01D44  FCBB0000            SI3HAPND  AI      X'17'
02378  P01D48  C900000C                      LI      R2,3W
02379  P01D4C  EC001DDD  P01DDC              BU      SIMERGE
02380  P01D50  FCC30000            SI4HAPND  AI      X'18'
02381  P01D54  C9000010                      LI      R2,4W
02382  P01D58  EC001DDD  P01DDC              BU      SIMERGE
02383  P01D5C  FCCB0000            SI5HAPND  AI      X'19'
02384  P01D60  C9000014                      LI      R2,5W
02385  P01D64  EC001DDD  P01DDC              BU      SIMERGE
02386  P01D68  FCD30000            SI6HAPND  AI      X'1A'
02387  P01D6C  C9000018                      LI      R2,6W
02388  P01D70  EC001DDD  P01DDC              BU      SIMERGE
02389  P01D74  FCDB0000            SI7HAPND  AI      X'1B'
02390  P01D78  C900001C                      LI      R2,7W
02391  P01D7C  EC001DDD  P01DDC              BU      SIMERGE
02392  P01D80  FCE30000            SI8HAPND  AI      X'1C'
02393  P01D84  C9000020                      LI      R2,8W
02394  P01D88  EC001DDD  P01DDC              BU      SIMERGE
02395  P01D8C  FCEB0000            SI9HAPND  AI      X'1D'
02396  P01D90  C9000024                      LI      R2,9W
02397  P01D94  EC001DDD  P01DDC              BU      SIMERGE
02398  P01D98  FCF30000            SI10HAPN  AI      X'1E'
02399  P01D9C  C9000028                      LI      R2,10W
02400  P01DA0  EC001DDD  P01DDC              BU      SIMERGE
02401  P01DA4  FCFB0000            SI11HAPN  AI      X'1F'
02402  P01DA8  C9000004                      LI      R2,1W
02403  P01DAC  EC001DDD  P01DDC              BU      SIMERGE
02404  P01DB0  FD030000            SI12HAPN  AI      X'20'
02405  P01DB4  C9000030                      LI      R2,12W
02406  P01DB8  EC001DDD  P01DDC              BU      SIMERGE
02407  P01DBC  FD0B0000            SI13HAPN  AI      X'21'
02408  P01DC0  C9000034                      LI      R2,13W
```

```
02409  P01DC4  EC001DDD  P01DDC              BU        SIMERGE
02410  P01DC8  FD130000              SI14HAPN AI        X'22'
02411  P01DCC  C9000038                      LI        R2,14W
02412  P01DD0  EC001DDD  P01DDC              BU        SIMERGE
02413  P01DD4  FD1B0000              SI15HAPN AI        X'23'
02414  P01DD8  C900003C                      LI        R2,15W
02415  P01DDC                        SIMERGE EQU       $
02416  P01DDC  FC030000                      AI        0                 TURN OFF INT STRUCTURE
02417  P01DE0  ACC01EA0  P01EA0              LW        R1,SISAVE1,R2
02418  P01DE4  84802334  P02334              ANMW      R1,=X'7FFFC'      THIS WAS A TRICKY ONE
02419  P01DE8  D3801C90  P01C90              LEA       R7,SICHECKS       AND PUT SPECIAL RTN ADR THERE
02420  P01DEC  87802334  P02334              ANMW      R7,=X'7FFFC'
02421  P01DF0  1870                          SBR       R7,0              SET PRIVELDGED BIT
       P01DF2       0002
02422  P01DF4  D7A00000   00000              STW       R7,0,R1
02423  P01DF8  C8810004                      ADI       R1,1W             BRANCH INTO RTM HANDLER
02424  P01DFC  FC040000                      DAI       0                 TURN ON INT. STRUCTURE
02425  P01E00  EC200001   00000              BU        0,R1              BYE - (OFF TO MONITOR LAND)
02426  P01E04  AD282239  P02239     NESTED1  LB        R2,METHSAVE,R1    LA?
02427  P01E08  EE001E1D  P01E1C              BCT       ZR,ENABRTM3
02428  P01E0C  FD410000                      DI        X'28'             YES = SUPERGORILLA
02429  P01E10  FC990000                      DI        X'13'
02430  P01E14  FD490000                      DI        X'29'
02431  P01E18  2800                          TRSW      R0
       P01E1A       0002
02432  P01E1C  FD490000              ENABRTM3 DI        X'29'             NO = LITTLE GORILLA
02433  P01E20  FD480000                      EI        X'29'
02434  P01E24  FD400000                      EI        X'28'
02435  P01E28  FC980000                      EI        X'13'
02436  P01E2C  2800                          TRSW      R0
       P01E2E       0002
02437  P01E30  AF001E68  P01E68     DAIGINTS LW        R6,RAOPRIO        CONSTRUCT DE-ACTIVATE FOR IST RA/INT
02438  P01E34  7353                          SLL       R6,19             DEACTIVATE ALL GORILLA
       P01E36       0002
02439  P01E38  8B002350  P02350              ORMW      R6,=X'FC040000'   LEVELS THAT WERE ACTIVE
02440  P01E3C  CA00FFFE                      LI        R4,-2             R4 IS FOR OUTER LOOP CONTROL
02441  P01E40  AF802230  P02230              LW        R7,TBM1           R7 = "TBM 0,RAOCCURD"
02442  P01E44  C980FFF8              DEALOOP1 LI        R3,-8             R3 = INNER LOOP CONTROL
02443  P01E48  CB870000              DEALOOP  EXR       R7                TEST 1ST/NEXT BIT IN RAOCCURD
02444  P01E4C  F0801E55  P01E54              BCF       SET,$+2W
02445  P01E50  CB070000                      EXR       R6                THE INTERRUPT LEVEL WAS ACTIVE SO
02446                                 *                                  DEACTIVATE IT
02447  P01E54  2261                          ABR       R6,12             BUMP THE RPIORITY FIELD OF DEA INST.
02448  P01E56       2071                     ABR       R7,8              ADD 1 TO BIT FIELD OF "TBM INST"
02449  P01E58  F5801E49  P01E48              BIB       R3,DEALOOP        PERFORM INNER LOOP 8 TIMES
02450  P01E5C  AF802234  P02234              LW        R7,TBM2           R7 NOW =  "TBM  0,RAOCCURD+1B"
02451  P01E60  F6001E45  P01E44              BIB       R4,DEALOOP1
02452  P01E64  2800                          TRSW      R0                RETURN
02453  P01E66       0000             SIOCCURD DATAH     0                 SI OCCURRANCE FLAGS
02454  P01E68  00000000              RAOPRIO  DATAW     0                 PRIORITY OF 1ST RA INT IN LSB(S)
02455  P01E6C  F8800001   00000      BLINST   BL        0                 PROTOTYPE BRANCH AND LINK INSTRUCTION
02456  P01E70                                BOUND     1D
02457  P01E70  00000000              GORTASK  DATAD     0                 TASK IS OF CURRENT GORILLA TASK
       P01E74  00000000
02458  P01E78  FC010000              DISAINST DI        0                 PROTOTYPE DISABLE INSTRUCTION
02459  P01E7C  FC020000              RIINST   RI        0                 PROTOTYPE REQUEST INSTRUCTION
02460  P01E80  00                    GORACC   DATAB     0
02461  P01E81    00                  BATCHSAV DATAB     0      IF = 4 => INTERRUPTED OUT OF A BATCH PROGRAM
02462  P01EA0                                BOUND     8W
02463  P01EA0  00000000              SISAVE1  REZ       8W
       P01EA4  00000000
       P01EA8  00000000
       P01EAC  00000000
       P01EB0  00000000
       P01EB4  00000000
       P01EB8  00000000
       P01EBC  00000000
02464  P01EC0  00000000              SISAVE2  REZ       8W
       P01EC4  00000000
       P01EC8  00000000
       P01ECC  00000000
       P01ED0  00000000
       P01ED4  00000000
       P01ED8  00000000
       P01EDC  00000000
02465  P01EE0  00001B00  P01B00     HYBSI1   ACW       SI0HAND           TABLE OF ADDRESSES OF THE
02466  P01EE4  00001B0C  P01B0C              ACW       SI1HAND           HIOCS SI HANDLERS
02467  P01EE8  00001B18  P01B18              ACW       SI2HAND
02468  P01EEC  00001B24  P01B24              ACW       SI3HAND
02469  P01EF0  00001B30  P01B30              ACW       SI4HAND
02470  P01EF4  00001B3C  P01B3C              ACW       SI5HAND
02471  P01EF8  00001B48  P01B48              ACW       SI6HAND
02472  P01EFC  00001B54  P01B54              ACW       SI7HAND
```

```
02473  P01F00  00001B60   P01B60   HYBSI2    ACW       SI8HAND
02474  P01F04  0000186C   P01B6C             ACW       SI9HAND
02475  P01F08  00001878   P01B78             ACW       SI10HAND
02476  P01F0C  00001B84   P01B84             ACW       SI11HAND
02477  P01F10  00001B90   P01B90             ACW       SI12HAND
02478  P01F14  0000189C   P01B9C             ACW       SI13HAND
02479  P01F18  000018A8   P01BA8             ACW       SI14HAND
02480  P01F1C  00001BB4   P01BB4             ACW       SI15HAND
02481  P01F20                     RAINT0SK  RES       8W      INTERRUPT GPR SAVE AREAS
02482  P01F40                     RAINT1SK  RES       8W
02483  P01F60                     RAINT2SK  RES       8W
02484  P01F80                     RAINT3SK  RES       8W
02485  P01FA0                     RAINT4SK  RES       8W
02486  P01FC0                     RAINT5SK  RES       8W
02487  P01FE0                     RAINT6SK  RES       8W
02488  P02000                     RAINT7SK  RES       8W
02489  P02020                     RAINT8SK  RES       8W
02490  P02040                     RAINT9SK  RES       8W
02491  P02060                     RAINT10K  RES       8W
02492  P02080                     RAINT11K  RES       8W
02493  P020A0                     RAINT12K  RES       8W
02494  P020C0                     RAINT13K  RES       8W
02495  P020E0                     RAINT14K  RES       8W
02496  P02100                     RAINT15K  RES       8W
02497  P02120                     DVRYSAVE  RES       8W                REGISTER SAVE AREA THE DVRY INTERRUPT
02498  P02140                     ADCSISTK  RES       8W                ADC DCM SI REGISTER STACK
02499  P02160                     DAMSISTK  RES       8W                DAM DCM SI REGISTER STACK
02500  P02180  00                 METH0     DATAB     0       THESE FLAGS ARE CONSTRUCTED BY QCONCT
02501  P02181    00               METH1     DATAB     0       IF 0 => ALL HIGHER INTERRUPTS ENABLED
02502  P02182      00             METH2     DATAB     0       IF 4 => SEL RTM CLOCK AND ATTN INT DISABLED
02503  P02183        00           METH3     DATAB     0
02504  P02184  00                 METH4     DATAB     0
02505  P02185    00               METH5     DATAB     0
02506  P02186      00             METH6     DATAB     0
02507  P02187        00           METH7     DATAB     0       AND ARITHMETIC EXCEPTION INTERRUPT
02508  P02188  00                 METH8     DATAB     0
02509  P02189    00               METH9     DATAB     0
02510  P0218A      00             METH10    DATAB     0
02511  P0218B        00           METH11    DATAB     0
02512  P0218C  00                 METH12    DATAB     0
02513  P0218D    00               METH13    DATAB     0
02514  P0218E      00             METH14    DATAB     0
02515  P0218F        00           METH15    DATAB     0
02516  P02190  9CA80800   00800   BTCHRSTR  ZBM       C.BTCH,C.BIT1  BATCH FLAG WAS NOT ON UPON ENTRY
02517  P02194  94880800   00800             SBM       C.BTCH,C.BIT1  BBATCH FLAG WAS ON UPON ENTRY
02518  P02198  FC010000           DISAPROT  DI        0              DISABLE INTERRUPT PROTO TYPE
02519  P0219C  00000000           ENABADSI  REZ       1W             ENABLE ADC SI INTERRUPT INSTRUCTION
02520  P021A0  00000000           ENABDASI  REZ       1W             ENABLE DAM SI INTERRUPT INSTRUCTION
02521  P021A4  00000000           DISAADSI  REZ       1W             DISABLE ADC SI INTERRUPT INSTRUCTION
02522  P021A8  00000000           DISADASI  REZ       1W             DISABLE DAM SI INTERRUPT INSTRUCTION
02523  P021AC  00000000           DAFP1FLG  DATAW     0              DEFAULT COUNTERS FOR
02524  P021B0  00000000           DAFP2FLG  DATAW     0              THE OCCURANCE OF DAM
02525  P021B4  00000000           DAFP3FLG  DATAW     0              FLOATING POINT OVERFLOW
02526  P021B8  00000000           DAFP4FLG  DATAW     0              INTERRUPTS
02527  P021BC  00000000           DAFP5FLG  DATAW     0
02528  P021C0  00000000           DAFP6FLG  DATAW     0
02529  P021C4  00000000           DADE1FLG  DATAW     0              DEFAULT COUNTERS FOR
02530  P021C8  00000000           DADE2FLG  DATAW     0              THE OCCURANCE OF DAM
02531  P021CC  00000000           DADE3FLG  DATAW     0              DATA RATE ERROR
02532  P021D0  00000000           DADE4FLG  DATAW     0              INTERRUPTS
02533  P021D4  00000000           DADE5FLG  DATAW     0
02534  P021D8  00000000           DADE6FLG  DATAW     0
02535  P021DC  00000000           ADOV1FLG  DATAW     0              DEFAULT COUNTERS FOR
02536  P021E0  00000000           ADOV2FLG  DATAW     0              THE OCCURANCE OF ADC-OVERSCALE
02537  P021E4  00000000           ADOV3FLG  DATAW     0              INTERRUPTS
02538  P021E8  00000000           ADOV4FLG  DATAW     0
02539  P021EC  00000000           ADOV5FLG  DATAW     0
02540  P021F0  00000000           ADOV6FLG  DATAW     0
02541  P021F4  00000000           ADDE1FLG  DATAW     0              DEFAULT COUNTERS FOR
02542  P021F8  00000000           ADDE2FLG  DATAW     0              THE OCCURANCE OF ADC-DATA
02543  P021FC  00000000           ADDE3FLG  DATAW     0              RATE ERROR INTERRUPTS
02544  P02200  00000000           ADDE4FLG  DATAW     0
02545  P02204  00000000           ADDE5FLG  DATAW     0
02546  P02208  00000000           ADDE6FLG  DATAW     0
02547  P0220C  FC020000           RIINT     RI        0              PROTOTYPE REQUEST INT INST.
02548  P02210  00000000           SAVABORT  DATAW     0              ADR. OF GORILL'S ABORT ROUTINE
02549  P02214  00000000           GORTSA    DATAW     0              ADR. OF GORILLA'S TSA
02550  P02218  00000000           NONMEMIH  DATAW     0              ADR OF RTM NON PRESENT MEMORY 1 HR
02551  P0221C  00000000           NONMEMSV  DATAW     0              PI SAVE AREA
02552  P02220  00000000           RTMNOMEM  DATAW     0              INDIRECT VECTOR TO RTM HANDLER
02553  P02224  00000000           ARITHEXC  DATAW     0              ADDRESS OF RTM'S ARITH ECEPTION HAND
02554  P02228  00000000           ARITHSAV  DATAW     0              RI SAVE AREA
```

```
02555  P0222C  0000                    RAOCCURD DATAH    0                 EACH BIT CORRESPONDS TO THE
02556                                  *                                   OCCURANCE OF THE CORRESPONDING RA INT
       P0222E      0002
02557  P02230  A408222C  P0222C        TBM1     TBM      0,RAOCCURD
02558  P02234  A4082220  P02220        TBM2     TBM      0,RAOCCURD+18
02559  P02238  00                      HYINTFLG DATAB    0
02560  P02239    000000                METHSAVE REZ      168               TABLE OF PAST METHODS
       P0223C  00000000
       P02240  00000000
       P02244  00000000
       P02248  00
02561  P0224C                                   BOUND    1W
02563  P0224C                          NOTHIOCS EQU      $
02564  P0224C  D4802320  P02320                 STW      R1,INT.X
02565  P02250  AC800878   00878                 LW       R1,C.TSAD         FETCH ADR. OF TSA
02566                                  *
02567                                  *                DETERMINE IF THE GORILLA COMMITTED
02568                                  *                THE ILLEGAL INSTRUCTION
02569                                  *
02570  P02254  AC881E80  P01E80                 LB       R1,GORACC
02571  P02258  EE002261  P02260                 BCT      ZR,$+2W
02572  P0225C  AC802214  P02214                 LW       R1,GORTSA         FETCH GORILLA'S TSA #
02573  P02260  A0A8005F   0005F                 ABM      25,T.REGP,R1      INCREMENT PUSH-DOWN POINTER
02574  P02264  A128005F   0005F                 ABM      26,T.REGP,R1
02575  P02268  ACA0005C   0005C                 LW       R1,T.REGP,R1
02576  P0226C  DC200000   00000                 STF      R0,0,R1           PUSH-DOWN REGISTERS INTO TSA AREA
02577  P02270  AD002320  P02320                 LW       R2,INT.X
02578  P02274  D5200004   00004                 STW      R2,1W,R1          PUSH-DOWN R1.
02579  P02278  AD00000C  P0000C                 LW       R2,INT.PSW
02580  P0227C  D5200020   00020                 STW      R2,8W,R1          PUSH-DOWN PSW.
02581  P02280  2720                             TBK      R2,6              TEST IF PREV. INSTR. WAS A RIGHT
02582  P02282      2723                         TBK      R2,30               OR LEFT HALFWORD INSTRUCTION.
02583  P02284  EC8022F1  P022F0                 BCT      1,INT.BYE
02584  P02288  ED0022F1  P022F0                 BCT      2,INT.BYE
02585  P0228C  AEC7FFFC   FFFFC                 LW       R5,-1W,R2         GET TRAPPED INSTRUCTION.
02586  P02290  AE002324  P02324                 LW       R4,INT.MSK        R4 = X'FC000000'
02587  P02294  2F58                             TRRM     R5,R6
02588  P02296      7748                         SLC      R6,8
02589  P02298  CB0500C8                         CI       R6,X'C8'          IS IT 'EXR'?
02590  P0229C  F20022B1  P022B0                 BCF      EQ,INT.1
02591  P022A0  72C6                             SLL      R5,6
02592  P022A2      729D                         SRL      R5,29
02593  P022A4  72C2                             SLL      R5,2
02594  P022A6      38D0                         ADR      R5,R1
02595  P022A8  AEA00000   00000                 LW       R5,0,R1           GET REGISTER FROM PUSH-DOWN STACK.
02596  P022AC  EC0022C9  P022C8                 BU       INT.2
02597  P022B0  CB0500A8                INT.1    CI       R6,X'A8'          IS IT 'EXM'.
02598  P022B4  F20022CD  P022CC                 BCF      EQ,INT.3
02599  P022B8  D6802320  P02320                 STW      R5,INT.X          SAVE 'EXM'.
02600  P022BC  CC200000   00000                 LF       R0,0,R1           RESTORE USER'S INDEX REGS.
02601  P022C0  AE902320  P02320                 LW       R5,*INT.X         GET INSTRUCTION FROM MEMORY.
02602  P022C4  AE002324  P02324                 LW       R4,INT.MSK
02603  P022C8  2F58                    INT.2    TRRM     R5,R6
02604  P022CA      7748                         SLC      R6,8
02605  P022CC  CB0500E0                INT.3    CI       R6,X'E0'          IS IT 'ADFW','ADFD','SUFW',OR 'SUFD'.
02606  P022D0  EE0022DD  P022DC                 BCT      EQ,INT.SIM
02607  P022D4  CB0500E4                         CI       R6,X'E4'          IS IT 'MPFW','MPFD','DVFW',OR 'DVFD'.
02608  P022D8  F20022F1  P022F0                 BCF      EQ,INT.BYE
02609                                  *
02610                                  *                FLOATING POINT INST. FOR SIMULATION FOUND.
02611                                  *
02612  P022DC                          INT.SIM  EQU      $
02613  P022DC  A7880801   00801                 TBM      C.FPSW,C.BIT1     IS SIMULATION SOFTWARE PRESENT?
02614  P022E0  F08022E9  P022E8                 BCF      SET,INT.BYEE
02615  P022E4  F9100A41   00A40                 BRI      *C.FLPT           ENTER FLOATING POINT SIMULATOR.
02616                                  *
02617                                  *                UNIMPLEMENTED INSTRUCTION => ABORT USER.
02618                                  *
02619  P022E8                          INT.BYEE EQU      $
02620  P022E8  AE80232C  P0232C                 LW       R5,INT.ABT2
02621  P022EC  EC0022F5  P022F4                 BU       INT.OUT
02622  P022F0                          INT.BYE  EQU      $
02623  P022F0  AE802328  P02328                 LW       R5,INT.ABT1
02624  P022F4                          INT.OUT  EQU      $
02625  P022F4  AD081E80  P01E80                 LB       R2,GORACC
02626  P022F8  EE002311  P02310                 BCT      ZR,NOGORILL
02627  P022FC  F88007D1  P007D0                 BL       UNGORILA          DISABLE GORILLA INTERRUPTS
02628  P02300  F8801E31  P01E30                 BL       DAIGINTS          DEACTIVATE GORILLA INTERRUPTS
02629                                  *                                   THAT ARE PRESENTLY ACTIVE
02630  P02304  AE802354  P02354                 LW       R5,=C'HY72'       ABORT CODE
02631  P02308  AD002210  P02210                 LW       R2,SAVABORT       GORILLA'S ABORT ADDRESS
02632  P0230C  F9400001   00000                 BRI      0,R2              ABORT THE GORILLA
02633  P02310                          NOGORILL EQU      $
```

```
02634  P02310  AD00088C   0088C            LW      R2,C.MODD        MODULE ADDR. TABLE ADDRESS IN R2
02635  P02314  AD400008   00008            LW      R2,H.MONS*1W,R2  ADDRESS OF H.MONS IN R2.
02636  P02318  AD400050   00050            LW      R2,20W,R2        ADDRESS OF ABORT ROUTINE IN R2.
02637  P0231C  F9400001   00000            BRI     0,R2
02638  P02320                     INT.X    RES     1W
02639  P02324  FC000000           INT.MSK  DATAW   X'FC000000'
02640  P02328  55493031           INT.ABT1 DATAW   C'UI01'
02641  P0232C  55493032           INT.ABT2 DATAW   C'UI02'
02642   00084                      PAMLIST EQU     ADCCDRD-PAMCDRD LENGTH OF THE CD INSTRUCTIONS FOR THE PAM
02643   00018                      ADCLIST EQU     DAMCDRD-ADCCDRD LENGTH OF THE CD INSTRUCTION LIST FOR THE ADC
02644   00018                      DAMLIST EQU     RTHCCDRD-DAMCDRD     DAM LIST LENGTH
02645   00018                      ITCLIST EQU     RTHCDEND-RTHCCDRD          ITC LIST LENGTH
02646   00024                      NORLYLST EQU    NONRLYXX-PAMCDWR
02647   0000C                      MVFGLIST EQU    MVFGCDEN-MVFGCDWR    LENGTH OF THE CD INSTRUCTIONS
02648                              *                                     FOR THE MVFG
       P02330  ABCDEF37
       P02334  0007FFFC
       P02338  0000000C
       P0233C  0000001C
       P02340  00000007
       P02344  ABCDEF38
       P02348  00000004
       P0234C  48593731
       P02350  FC040000
       P02354  48593732
02649  P02358                P00000          END     HAT
*  0000  ERRORS IN H.IP25


00002                              * TITLE: CONNECT SUBROUTINE TO HYBRID INTERRUPT(QCONCT) R.L. A000  L
00003                              * DATE:  AUGUST 1976
00004                              * COPYRIGHTED BY ELECTRONIC ASSOCIATES INC., 1976
00005                              * 700/32 VERSION
00006                              *
00007                              *          CALLING SEQUENCE
00008                              *          CALL QCONCT(NAME,LEVEL,METHOD)
00009                              *
00010                              *          ARGUMENTS:
00011                              *          NAME;  NAME OF THE SUBROUTINE TO BE CONNECTED
00012                              *          LEVEL; LOGICAL INTERRUPT PRIORITY OF THE INTERRUPT
00013                              *                 LEVEL MUST BE BETWEEN 0-15 INCLUSIVE WITH 0
00014                              *                 THE HIGHEST PRIORITY AND IS THE LOWEST
00015                              *          METHOD; THIS ARGUMENT DESCRIBES THE METHOD OF DIRECT
00016                              *                 CONNECTION. METHOD MUST BE BETWEEN 1-2
00017                              *
00018                              *          ERROR CONDITIONS:
00019                              *
00020                              *          15 - ILLEGAL METHOD
00021                              *          68 - ILLEGAL LOGICAL INTERRUPT PRIORITY
00022                              *
00023                                    PROGRAM   QCONCT
00024                                    DFF       QCONCT
00025                                    EXT       QFPR,QQERRORS,QQTSKNUM,QQBIGAPE,QQINTTAB
00026  P00000                        M.REQS
                                        ENDM
00027  P00000                        M.HEQUS7
                                        ENDM
00028  P00000                     RTN      RES     1W
00029  P00004  D4000000   P00000   QCONCT  STW     R0,RTN
00030  P00008  F8800001   X00000           BL      QFPR             PASS THE ARGUMENTS
00031  P0000C  0000000C                     DATAW   3W               3 ARGUMENTS
00032  P00010                     NAME     RES     1W
00033  P00014                     LEVEL    RES     1W
00034  P00018                     METHOD   RES     1W
00035  P0001C  AD900014   P00014           LW      R3,*LEVEL
00036  P00020  ED800085   P00084           BCT     LT,ERR68         LEVEL < 0?
00037  P00024  C985000F                    CI      R3,15
00038  P00028  ED000085   P00084           BCT     GT,ERR68         LEVEL S 15?
00039                              *
00040                              *          EDIT METHOD TO BE 1-3 INCLUSIVE AND IF 2 OR 3
00041                              *          SEE IF THIS TASK IS AUTHORIZED TO RUN IN THE
00042                              *       MAMA OR PAPA GORILLA MODE.
00043                              *
00044  P0002C  AF900018   P00018           LW      R7,*METHOD
00045  P00030  ED80008D   P0008C           BCT     LT,ERR15
00046  P00034  CB850001                    CI      R7,1             = 1 => BABY GORILLA MODE OF OPERATION
00047  P00038  EE000065   P00064           BCT     EQ,NORIGAPE
00048  P0003C  CB850002                    CI      R7,2
00049  P00040  ED00008D   P0008C           BCT     GT,ERR15
00050                              *
00051                              *          FALLS THROUGH IF THE METHOD = 2
00052                              *          CAN THIS PROGRAMMER DO THIS?
00053                              *
```

```
00054  P00044  CA80FFF6                        LI        R5,-10          SCAN THE "BIG APE" TABLE IN QQPARMS
00055                                  *                                  TO SEE IF THIS TASK MAY EXECUTE IN
00056                                  *                                  THIS MODE
00057  P00048  0D20                            ZR        R2
       P0004A        0002
00058  P0004C  AF000002  X00000      BIGAPELP LD        R6,QQTSKNUM     R6&R7 = TASK ID
00059  P00050  93400002  X00000               CAMD      R6,QQBIGAPE,R2  FIND A MATCH
00060  P00054  EE000065  P00064               BCT       EQ,NOBIGAPE
00061  P00058  C9010008                       ADI       R2,1D           BUMP INDEX
00062  P0005C  F680004D  P0004C               BIB       R5,BIGAPELP     2,4,6,8 LET'S ITERATE
00063  P00060  EC000085  P00084               BU        ERR68           TASK NOT AUTHORIZED TO RUN IN
00064                                  *                                  PAPA OR MAMA GOLILLA MODE
00065  P00064  71C2                    NOBIGAPE SLL       R3,2            FORM WORD INDEX OUT OF R3
       P00066        0002
00066  P00068  CB81FFFF                       ADI       R7,-1
00067  P0006C  73DD                           SLL       R7,29           SHIFT MEHHOD TO BITS 1 AND 2
       P0006E        0002
00068  P00070  AF000010  P00010               LW        R6,NAME         FETCH ADDRESS OF INTERRPUT SUBROUTINE
00069  P00074  870000A8  P000A8               ANMW      R6,=X'7FFFC'    STRIP IT
00070  P00078  0B70                           ORR       R7,R6           OR IN MEHOTD FIELD
       P0007A        0002
00071  P0007C  D7600000  X00000               STW       R6,QQINTTAB,R3  STORE IN QQPARMS INTERRUPT TABLE
00072  P00080  EC100001  P00000               BU        *RTN            SPLIT
00073                                  *
00074                                  *                ERROR PROCEDURES
00075                                  *
00076  P00084  C9000044                ERR68    LI        R2,68
00077  P00088  EC000091  P00090               BU        ERR15+1W
00078  P0008C  C900000F                ERR15    LI        R2,15
00079  P00090  AD800000  P00000               LW        R3,RTN          FORTRAN LOCATION
00080  P00094  C880005A                       LI        R1,NQCONCT      ROUTINE ID
00081  P00098  F8800001  X00000               BL        QQERRORS
00082  P0009C  EC100001  P00000               BU        *RTN
00083  P000A0                          PARMS    RES       2W
       P000A8  0007FFFC
00084  P000AC                                  END
*  0000  ERRORS IN QCONCT
```

```
00002                                  * TITLE: SELECT ANALOG CONSOLE(QSC)          REV. LEV. A000        L
00003                                  * DATE:  AUGUST 1976
00004                                  * COPYRIGHTED BY ELECTRONIC ASSOCIATES INC., 1976
00005                                  * 700/32 VERSION
00006                                  *
00007                                  *                CALLING SEQUENCE:
00008                                  *                CALL  QSC(ICON)
00009                                  *
00010                                  *                ARGUMENT:
00011                                  *                ICON; INTEGER CONSTANT OR VARIABLE SPECIFING WHAT
00012                                  *                      PREVIOUSLY ALLOCATED CONSOLE IS TO BE SELECTED
00013                                  *
00014                                  *                ERROR CONDITIONS:
00015                                  *                6 - ILLEGAL ICON
00016                                  *                62- REQUESTED CONSOLE HAS BEEN ALLOCATED
00017                                  *                    TO ANOTHER TASK
00018                                  *
00019                                           PROGRAM   QSC
00020                                           DEF       QSC
00021                                           EXT       QQLSTCSL,QQHYBOUT,QQQQ1,QQPARSCL,QQERRORS
00022                                           EXT       QQCSLNUM
00023                                           EXT       QQCURCSL,QQALLCSL,QQTCWCSL,QQTIMCSL
00024  P00000                                   M.REQS
                                                ENDM
00025  P00000                                   M.REQUS7
                                                ENDM
00026  P00000                           RTN      RES       1W
00027  P00004  D4000000  P00000         QSC      STW       R0,RTN
00028  P00008  AD200000  00000                   LW        R2,0,R1         PICK UP ICON - EDIT AND PROCESS
00029  P0000C  C9050000                           CI        R2,0
00030  P00010  EDA000C1  P000C0                  BCT       LT,ERR6
00031  P00014  91000000  X00000                  CAMW      R2,QQLSTCSL
00032  P00018  ED000UC1  P000C0                  BCT       GT,ERR6
00033  P0001C  D5000000  X00000                  STW       R2,QQCSLNUM     SAVE THE CURRENTLY SELECTED CONSOLE
00034  P00020  C9050000                           CI        R2,0
00035  P00024  F200003D  P0003C                  BCF       EQ,QSC1
00036  P00028  D5000000  X00000                  STW       R2,QQCURCSL     CLEAR CURRENT, "OR" OF ALL CONS
00037  P0002C  D5000000  X00000                  STW       R2,QQALLCSL     AND CURRENT INSTR. CONSOLE WORDS
00038  P00030  D5000000  X00000                  STW       R2,QQTCWCSL
00039  P00034  D5000000  X00000                  STW       R2,QQTIMCSL     RTHC ADDRESS
00040  P00038  EC100001  P00000                  BU        *RTN
00041                                  *
```

```
00042                                   *                STORE THE CSL # SHIFTED TO BITS 1-6 IN THE SIX DEEP
00043                                   *                STACK IN QQPARMS.
00044                                   *
00045  P0003C  AFC800E7   P000E7        QSC1     LR       R7,CSLTAB-1B,R2 FETCH THE PROPER PARTICULAR BIT
00046  P00040  73D9                                SLL      R7,25           SHIFT TO BITS 1-6
       P00042      0002
00047  P00044  C9050003                            CI       R2,3
00048  P00048  ED000050   P0005C                   BCT      GT,QSC2
00049  P0004C  2DA0                                TRR      R2,R3
00050  P0004E      71C2                            SLL      R3,2
00051  P00050  AE6000D8   P000D8                   LW       R4,RTHCSEL-1W,R3
00052  P00054  8A000034   Y00034                   ORMW     R4,QQTIMCSL
00053  P00058  D6000054   Y00054                   STW      R4,QQTIMCSL
00054  P0005C  D7800028   Y00028        QSC2     STW      R7,QQCURCSL
00055  P00060  D7800030   Y00030                   STW      R7,QQTCWCSL     SET UP CURRENT, "OR" OF ALL CONS
00056  P00064  AE00002C   Y0002C                   LW       R4,QQALLCSL     AND CURRENT INSTR CONSOLE WORDS
00057  P00068  0A70
       P0006A      0002
00058  P0006C  D6000064   Y00064                   STW      R4,QQALLCSL
00059  P00070  C8800501                            LI       R1,QSACNX       INDEX FOR SELECT CONSOLE
00060  P00074  F8800001   X00000                   BL       QQHYBOUT
00061  P00078  EC0000C5   P000C4                   BU       ERR62           THIS TASK HAS NOT BEEN ALLOCATED
00062                                   *                                   THIS CONSOLE
00063                                   *
00064                                   *                MOVE CONSOLE DEPENDENT PARAMETERS TO
00065                                   *                THE QQPARCSL BUFFER WHICH LIVES IN QJOB
00066                                   *
00067  P0007C  D3800000   X00000                   LEA      R7,QQPARSCL     PICK UP ADR OF DESTINATION BUFFER
00068  P00080  8B8000F0   P000F0                   ORMW     R7,=X'200000'   MAKE IT INDEXES BY R1
00069  P00084  D7800008   P000D8                   STW      R7,ADRPARCL
00070  P00086  D3800000   X00000                   LEA      R7,QQQQ1        PICK UP BASE ADR. OF CSL PARMS
00071  P0008C  8B8000F4   P000F4                   ORMW     R7,=X'600000'   MAKE IT INDEXED BY R3
00072  P00090  D78000D4   P000D4                   STW      R7,ADRQQQQ1
00073  P00094  C901FFFF                            ADI      R2,-1           FORM R3 AS THE INDEX FOR QQQQ1,
00074                                   *                                   QQQQ2,...QQQQ6
00075  P00098  7142                                SLL      R2,2            WORD INDEX
00076  P0009A      2DA0                            TRR      R2,R3
00077  P0009C  C9030020                            MPI      R2,45           R3 SHOULD NOW HAVE PROPER BASE INDEX
00078  P000A0  0C90                                ZR       R1              CLEAR QQPARSCL INDEX
       P000A2      0002
00079  P000A4  C880FFD3                            LI       R7,-45          R7 USED FOR ITERATION CONTROL
00080  P000A8  AE9000D4   P000D4        LOOP     LW       R5,*ADRQQQQ1    INDIRECT THEN INDEXED BY R3
00081  P000AC  D69000D8   P000D8                   STW      R5,*ADRPARCL    INDIRECT THEN INDEXED BY R1
00082  P000B0  C9810004                            ADI      R3,1W           BUMP BOTH INDEXES
00083  P000B4  C8810004                            ADI      R1,1W
00084  P000B6  F78000A9   P000A8                   BIB      R7,LOOP
00085  P000BC  EC100001   P00000                   BU       *RTN            SPLIT
00086                                   *
00087                                   *                ERROR PROCEDURES
00088                                   *
00089  P000C0  C9000006                   ERR6     LI       R2,6
00090  P000C4  AD800000   P00000        ERR62    LW       R3,RTN          FORTRAN LOCATION
00091  P000C8  C8800007                            LI       R1,NQSC         ROUTINE ID
00092  P000CC  F8800001   X00000                   BL       QQERRORS
00093  P000D0  EC100001   P00000                   BU       *RTN
00094  P000D4                           ADPQQQQ1 RES      1W
00095  P000D8                           ADRPARCL RES      1W
00096  P000DC  00001000                 RTHCSEL  DATAW     X'1000'
00097  P000E0  00002000                           DATAW     X'2000'
00098  P000E4  00004000                           DATAW     X'4000'
00099  P000E8  20100804                 CSLTAB   DATAB     X'20',X'10',8,4,2,1
       P000EC  0201
       P000EE      0002
       P000F0  00200000
       P000F4  00600000
00100  P000F8                                    END
*  0000  ERRORS IN QSC


00002                                   * TITLE: ALLOCATE AN ANALOG CONSOLE(QSACI)   REV. LEV. A000        L
00003                                   * DATE:  AUGUST 1976
00004                                   * COPYRIGHTED BY ELECTRONIC ASSOCIATES INC., 1976
00005                                   * 700/32 VERSION
00006                                   *
00007                                   *                CALLING SEQUENCE
00008                                   *                CALL QSACI(ICON)
00009                                   *
00010                                   *                ARGUMENT:
00011                                   *                ICON; INTERGER CONSTANT OR VARIABLE SPECIFYING
00012                                   *                      THE ANALOG CONSOLE TO BE ALLOCATED.
```

```
00013                                   *
00014                                   *              ERROR CONDITIONS
00015                                   *              6 - ILLEGAL ICON
00016                                   *              62- REQUESTED CONSOLE HAS BEEN ALLOCATED
00017                                   *                  TO ANOTHER TASK
00018                                   *
00019                                           PROGRAM   QSACI
00020                                           DEF       QSACI
00021                                           EXT       QQHYBOUT,QQERRORS,QQLSTCSL
00022                                           EXT       QQCSLALO
00023  P00000                                   M.REQS
                                                ENDM
00024  P00000                                   M.REQUS7
                                                ENDM
00025  P00000                           RTN     RES       1W
00026  P00004  D4000000    P00000      QSACI   STW       R0,RTN
00027  P00008  AD200000     00000              LW        R2,0,R1          PICK UP ICON
00028  P0000C  C9050001                        CI        R2,1             <1.??
00029  P00010  ED80003D    P0003C              BCT       LT,ERR6
00030  P00014  91000000    X00000              CAMW      R2,QQLSTCSL      > LAST SYSTEM CONSOLE?
00031  P00018  ED00003D    P0003C              BCT       G1,ERR6
00032  P0001C  C8800500                        LI        R1,QALOCSLX      INDEX FOR ALLOCATION OF CONSOLE
00033  P00020  F8800001    X00000              BL        QQHYBOUT
00034  P00024  EC000041    P00040              BU        ERROR62          CSL HAS BEEN ALLOCATED TO ANOTHER TASK
00035  P00028  2CA0                            TRR       R2,R1
       P0002A       0002
00036  P0002C  C881FFFF                        ADI       R1,-1
00037  P00030  70C2                            SLL       R1,2
       P00032       0002
00038  P00034  D5200000    X00000              STW       R2,QQCSLALO,R1   STACK ALLOCATED CONSOLE
00039  P00038  EC100001    P00000              BU        *RTN             SPLIT
00040                                   *
00041                                   *              ERROR PROCEDURES
00042                                   *
00043  P0003C  C9000006                 ERR6    LI        R2,6
00044  P00040  AD800000    P00000      ERROR62 LW        R3,RTN           FORTRAN LOCATION
00045  P00044  C8800004                        LI        R1,NQSACI        ROUTINE ID
00046  P00048  F8800001    X00000              BL        QQERRORS
00047  P0004C  EC100001    P00000              BU        *RTN
00048  P00050                                  END
*  0000  ERRORS IN QSACI
```

```
00002                                   * TITLE: SYSTEM INITIALIZATION(QJOB)          REV. LEV. A000
00003                                   * DATE:  AUGUST 1976
00004                                   * COPYRIGHTED BY ELECTRONIC ASSOCIATES INC., 1976
00005                                   * 000/32 VERSION
00006                                   *
00007                                   *              CALLING SEQUENCE:
00008                                   *              CALL  NJOB(IEIERR,MODE,IERRDEV)
00009                                   *
00010                                   *              ARGUMENTS:
00011                                   *              IERROR; INTEGER VARIABLE OR CONSTANT
00012                                   *                      =0 => CONTINUE PROCESSING UPON SOFTWARE
00013                                   *                            INPUT ARGUMENT ERROR
00014                                   *                      =1 => TERMINATE UPON SOFTWARE INPUT
00015                                   *                            ARGUMENT ERROR
00016                                   *                      =2 => CONTINUE ON ALL ERRORS
00017                                   *              MODE;   INTEGER VARIABLE OR CONSTANT
00018                                   *                      =0 => HOS DESIGNATED TIME CRITICAL ROUTINES
00019                                   *                            EXECUTE IN THE "FAST" MODE
00020                                   *                      =1 => HOS DESIGNATED TIME CRITICAL ROUTINES
00021                                   *                            EXECUTE IN THE DIAGNOSTIC MODE
00022                                   *              IERRDEV;INTEGER VARIABLE OR CONSTANT SPECIFYING:
00023                                   *                      IERRDEV = -1   DO NOT LOG RUN-TIME ERRORS
00024                                   *                      IERRDEV =  0   LOG ERRORS UPON THE CONSOLE
00025                                   *                                     DEVICE
00026                                   *                      IERRDEV = 1 LOG ERRORS UPON THE
00027                                   *                      LOGICAL FILE DEV THAT MUST BE PREVIOUSLY
00028                                   *                      ASSIGNED BY THE USER
00029                                   *
00030                                   *              ERROR PROCEDURES
```

```
00031                                   *                =61- WWPARMS (DISC) FILE ABSENT FROM THE DISC
00032                                   *                =65- ILLEGAL IERROC,MODE OR IERRDEV ARGUMENT (FATAL ERROR
00033                                            PROGRAM   WJOB
00034                                            DEF       WJOB
00035                                            EXT       WGTSKSTR
00036                                            EXT       WWFSTIRP,WWFSTIRP1,WWORIGPR
00037                                            EXT       WWDEAPM1
00038                                            EXT       WGSPEED,WWESTCSE,WWERRDEV,WGTSKNUM,WWERRPN1
00039                                            EXT       WWABORT,WWFCB,WWERROR2,WWERR30,WWNYNOW1
00040                                            EXT       WPPR
00041                                            EXT       WWRTN
00042  P00000                                    M.EWJS
                                                 ENDM
00043  P00000                                    M.NEWJSB
                                                 ENDM
00044  P00000                           RTN      RES       1W
00045  P00004  04000000    P00000      WJOB     STW       R0,RTN
00046  P00008  F8000001    X00000               BL        WPPR            PASS THE ARGUMENTS
00047  P0000C  00000000                         DATAW     $W
00048  P00010                           IERROC   RES       1W
00049  P00014                           MODE     RES       1W
00050  P00018                           IERRDEV  RES       1W
00051                                   *
00052                                   *                EDIT AND PROCESS IERROC ARGUMENT
00053                                   *
00054  P0001C  AF000010    P00010               LW        R7,*IERROC      EDIT IT
00055  P00020  EE000070    P0007C               BCT       ZR,IERROCOK
00056  P00024  C8650002                         CI        R7,2
00057  P00028  EE000065    P00064               BCT       EQ,CONTALLE
00058  P0002C  C8650001                         CI        R7,1
00059  P00030  F2000131    P00130               BCF       EQ,ERR05        ROUTI
00060                                   *
00061                                   *                INDICES TO ABORT UPON STATUS ERROR THE
00062                                   *                INTERNAL ROUTINE "WWERRORS" MUST BE MODIFIED
00063                                   *                TO "BU WWABORT" FOR ALL "BC, ARTN(S)" =(EXCEPT
00064                                   *                FOR ERROR 25 OVR OVERRANGE)
00065                                   *
00066  P00034  C8B0FFEF                         LI        R1,-18          1ST CHANGE ERRORS (2-19) INCLUSIVE
00067  P00038  0020                             ZR        R2              CLEAR INDEX REGISTER
       P0003A       0002
00068  P0003C  AF0001DC    P0016C               LW        R7,WWPATCH
00069  P00040  D7C00000    X00000      LOOP1    STW       R7,WWERROR2,R2  STORE 1ST/NEXT  "BU WWABORT"
00070  P00044  C9010004                         ADI       R2,1W           BUMP INDEX BY 1WORD
00071  P00048  F4800041    P00040               BIB       R1,LOOP1
00072  P0004C  C8B0FFD8                         LI        R1,-40          CHANGE ERRORS (30-69) INCLUSIVE
00073  P00050  0020                             ZR        R2
       P00052       0002
00074  P00054  D7C00000    X00000      LOOP2    STW       R7,WWERR30,R2   STORE 1ST/NEXT "BU WWABORT"
00075  P00058  C9010004                         ADI       R2,1W
00076  P0005C  F4000055    P00054               BIB       R1,LOOP2
00077  P00060  EC000070    P0007C               BU        IERROCOK
00078                                   *
00079                                   *                IN WWERRORS CHANGE ALL "BU WWABORT"
00080                                   *                TO "BU *WWRTN"
00081                                   *                THIS WILL CONTINUE PROCESSING UPON ALL ERRORS
00082                                   *
00083  P00064                           CONTALLE EQU     $
00084  P00064  0020                             ZR        R2              INDEX FOR WWERRORS AREA
       P00066       0002
00085  P00068  C8B0FFBC                         LI        R7,-66          USED FOR ITERATION CONTROL
00086  P0006C  AF000170    P00170               LW        R6,WWPATCH1     =BU   *WWRTN
00087  P00070  D7400040    Y00040      LOOP3    STW       R6,WWERROR2,R2  STICK IT TO 'EM
```

```
00088  P00074  C9010004                        AL1     R2,1W          BUMP INDEX BY ONE WORD
00089  P00078  F7000071   P00070               BIB     R7,LOOP3       2,4,6,8, LET'S ITERATE
00090  P0007C                          IEPRGLOK EQU    *
00091                                   *
00092                                   *          GET AND PROCESS MODE ARGUMENT
00093                                   *
00094  P0007C  AF000014   P00014               LW      R7,*MODE
00095  P00080  EE000080   P00080               BCT     ZR,MODEOK
00096  P00084  C0850001                        LI      R7,1
00097  P00088  F2000131   P00130               BCF     EQ,ERR05       ABORT
00098  P0008C                          MODEOK  EQU     *
00099  P0008C  7BC2                            SLL     R7,2           FOR WORD INDEX
       P0008E       0002
00100  P00090  D7000000   X00000               STW     R7,WWSPEED
00101                                   *
00102                                   *          FETCH THE TOTAL SYSTEM PARAMETERS
00103                                   *          FROM THE DISC FILE WWPARMS
00104                                   *
00105                                   *          LET'S ALLOCATE THE FILE
00106                                   *
00107  P00094                                   M.ALOC  ERROR,WWPARMSN,1,PWWPARMS
                                                LIST    NONE
       P00094  00000138   P00138               LEA     1,ERROR
       P00096  AE000168   P00168               LW      5,WWPARMSN
       P0009C  72C6                            SLL     5,6
       P0009E       7288                       SRL     5,8
       P000A0  AF000162   P00160               LD      6,PWWPARMS
       P000A4  1BD0                            SHR     5,7
       P000A6       3040                       CALM    X'40'
                                                LIST    NOLIST
                                                ENDM
00108                                   *
00109                                   *          NOW LET'S OPEN THE FILE
00110                                   *
00111  P000A8                                   M.FILE  WWIFCB,R
                                                LIST    NONE
       P000A8  00000140   P00140               LEA     1,WWIFCB
       P000AC  1C90                            ZBR     1,1
       P000AE       3050                       CALM    X'50'
                                                LIST    NOLIST
                                                ENDM
00112                                   *
00113                                   *          READ IN THE WWPARMS FILE
00114                                   *
00115  P000B0                                   M.READ  WWIFCB
       P000B0  00000140   P00140               LEA     1,WWIFCB
       P000B4  3051                            CALM    X'51'
                                                ENDM
00116                                   *
00117                                   *          CLOSE THE FILE
00118                                   *
00119  P000B6                                   M.CLSE  WWIFCB
                                                LIST    NONE
       P000B6       0002
       P000B8  00000140   P00140               LEA     1,WWIFCB
       P000BC  3059                            CALM    X'59'
                                                LIST    NOLIST
                                                ENDM
00120                                   *
00121                                   *          DEALLOCATE THE FILE (DEVICE)
00122                                   *
```

```
00123  P0008F                                   M.DALL    WWPARMSN
       P0008F       0002
       P00090  AL800168     P00168              LR        5,WWPARMSN
       P00094  3041                             CALM      X'41'
                                                ENDM
00124                                  *
00125                                  *              EDIT AND PROCESS THE IERRDEV ARGUMENT
00126                                  *
       P00096       0002
00127  P00098  AD900018     P00018              LW        R3,*IERRDEV
00128  P0009C  EE0000E0     P0009E              BCT       ZR,NOALOCED.     LOG ERRORS ON CONSOLE DEVICE
00129  P00000  C965FFFF                         LI        R3,-1
00130  P00004  EE000125     P00124              BCT       EQ,DOGIPRNT      LOGGING OF ERRORS IS DISABLED
00131  P00008  C9850001                         LI        R3,1
00132  P0000C  F2000131     P00130              BCF       EQ,ERROR         SYNTAX ERROR
00133  P0000E0  D5800000     X00000              STW       R3,WWERRDEV      MAKE WWERRDEV NOT = 0 SO THAT
00134                                  *                                   WWERRORS DOES NOT LOG ERRORS
00135                                  *                                   OFFLINE SYSTEM CONSOLE DEVICE
00136                                  *
00137                                  *              OPEN THE LOGICAL FILE CONSOLE ONLY
00138                                  *
00139  P0009E4                                   M.FILE    WWFCB,RW
                                                 LIST      NOMO
       P0009E4  D0800000     X00000              LEA       1,WWFCB
       P0009E8  1890                             SHR       1,1
       P0009EA       3050                        CALM      X'50'
                                                 LIST      NOLIST
                                                 EXITM
00140  P0009EC                         NOALOCED  EQU       *
00141                                  *
00142                                  *              FETCH TASK NAME AND STORE IN WWTSKNUM
00143                                  *
00144  P0009EC  AD800878      00878               LW        R3,C.TSAD        C.TSAD = POINTER TO TOP OF TSA
00145  P0009F0  AF000002      00000               LD        R6,0,R3          PICK UP TASK 8 ASCII CHAR. NAME
00146  P0009F4  D7000002     X00000               STD       R6,WWTSKNUM
00147                                  *
00148                                  *              SAVE THE TASK'S ORIGINAL PRIORITY
00149                                  *
00150  P0009F8  AF080920      00920               LR        R6,C.DUM1
00151  P0009FC  D7000000     X00000               STW       R6,WWORIGPR
00152                                  *
00153                                  *              FETCH STARTING ADDRESS FOR THE TASK
00154                                  *
00155  P00100                                    M.ADRS
       P00100  3044                              CALM      X'44'
                                                 ENDM
       P00102       0002
00156  P00104  D7000000     X00000               STW       R6,WWTSKSTR
00157                                  *
00158                                  *              INVOKE MIOCS TO INITIALIZE THE HYBRID I/O SYSTEM
00159                                  *              THIS INCLUDES "DORING" IN THE DEA(S) FOR CD AND ID INSTS.
00160                                  *              ARE CALCULATING THE ICW LOCATIONS AS A FUNCTION OF THE DEA(S)
00161                                  *
00162  P00108  D1000000     X00000               LEA       R2,WWDEAPM1      R2 = ADR. OF THE DEA LIST
00163  P0010C  C8800509                          LI        R1,WINITMIO      I/O INDEX
00164  P00110  F8800001     X00000               BL        WWMYBOOT
00165  P00114  0000                              HALT                       NO ERROR POSSIBLE
       P00116       0002
00166  P00118  AF800000     X00000               LW        R7,WWFSTIRP
00167  P0011C  D7800000     X00000               STW       R7,WWFSTIRP1
00168                                  *
00169                                  *              TIME TO RETURN TO CALLER
```

```
00170                                   *
00171  P00120  EC100001  P00000                BC      *RIW            SPLIT
00172  P00124  C4800001                 DONIPRET LI      R7,1
00173  P00128  07800000  X00000                STW     R7,GGERREP.1    DISABLE PRINTING OF RUN-TIME ERRORS
00174  P0012C  EC0000E0  P000EC                BC      GGALOCER
00175                                   *
00176                                   *                ERROR PROCEDURES
00177                                   *
00178  P00130                           ERR05    EQU     *               ABORT THIS BUT-INPUT ARG. ERROR
00179  P00130  AE80017C  P0017C                  LA      R5,=C'HY05'     HYBRID ERROR 05
00180  P00134  5057                              CALM    X'57'
       P00136      0002
00181  P00138  AE800180  P00180    ERR01        LA      R5,=C'HY01'     HYBRID ABORT CODE
00182  P0013C  5057                              CALM    X'57'
       P0013E      0002
00183  P00140  00515130              GGIFCB   DATAW   G'GGO'          LOGICAL FILE CODE = C'GGO' FOR GGPARM
00184  P00144  00080000  X80000                DER     12/1536,20/0(GGLSTLSE)
00185  P00148  00000000                        DATAW   0
00186  P0014C                                 RES     2W
00187  P00154  00000000                        DATAW   0
00188  P00158  00000158  P00158                ALW     ERR01
00189                                   *
00190                                   *                PARMS FOR THE ALLOCATION OF THE ERROR LISTING DEVICE
00191                                   *
00192  P00160                                   BOUND   0
00193  P00160  51515041              PARPARMS DATAD   C'GGPARMSO'     GGO/32 M.P.E. DATA BASE NAME
       P00164  52405336
00194  P00168  00515130              GGPARMSN DATAW   G'GGO'          =C'GGO' = LOGICAL NAME F/GGPARMS
00195  P0016C  EC000001  X00000      GGPATCH  BC      GGABORT         IF CODE = 1 => ATCH FOR GGERRORS
00196  P00170  EC100001  X00000      GGPATCH1 BC      *GWRTE          USED TO PATCH GGERRORS
00197  P00174  00444940              ERPARG2  DATAW   G'JIM'          LOGICAL FILE CODE
00198  P00178                        ERPARG3  RES     1W              DEVICE TYPE CODE AND ADDRESS(IF NEED)
       P0017C  48595635
       P00180  48595631
00199  P00184                                   END
*  0000  ERRORS IN OJOB
```

What is claimed is:

1. An analog/hybrid system for at least two hybrid users comprising a digital computer having a main digital memory, a plurality of analog computers running on individual analog programs with at least one of the analog programs becoming time critical, means for linking flow of data between the analog computers and the digital computer, and means coupled to said linking means for substantially preempting and allocating said data flow from nontime critical analog programs to the time critical analog program during ongoing data flow and as available allocating data flow to the nontime critical analog program.

2. The analog/hybrid system of claim 1 in which there is provided a time critical digital program associated with said time critical analog program and in which said allocating means includes means for substantially allocating all of said data flow additionally to said time critical digital program whereby data flows with respect to the time critical analog and digital programs without digital computer intervention.

3. The analog/hybrid system of claim 1 in which there is provided interrupt means coupled to said allocating means for providing interrupts to said digital computer all allocated to the time critical analog program.

4. The analog/hybrid system of claim 3 in which said interrupt means includes resource allocator means controlled by the digital computer for selecting interrupt sources only from the time critical analog program.

5. The analog/hybrid system of claim 1 in which each of said hybrid users has at least one analog program and at least one hybrid program and in which there is provided a plurality of data flow channels coupled between the analog computers and the digital computer.

6. The analog/hybrid system of claim 5 in which said allocating means includes channel control means coupled to said data flow channels without digital computer intervention for automatically passing flow of data through the data flow channels associated with the time critical analog program.

7. The analog/hybrid system of claim 5 in which said allocating means includes channel control means for providing first control signals for selecting the addresses of the data flow channels associated with the time critical analog program.

8. The analog/hybrid system of claim 7 in which said channel control means includes means for providing further first control signals to select as available addresses of data flow channels associated with analog programs that are not time critical.

9. The analog/hybrid system of claim 7 in which said channel control means includes means for providing second control signals to select addresses in main memory for data from and to the analog computers.

10. The analog/hybrid system of claim 9 in which said control signal means produces second control signals for selecting addresses in main memory solely for data from and to the time critical analog program.

11. The analog/hybrid system of claim 10 in which said second control signal means produces second control signals for selecting addresses in main memory for data from and to nontime critical analog programs.

12. The analog/hybrid system of claim 9 in which said allocating means includes means for saving over a selected period of time at least one of said first and second control signals relating to each of the nontime critical analog computers.

13. The analog/hybrid system of claim 12 in which said saving means includes activate multiplex means for saving the first and second control signals and in turn reintroducing said saved control signals when the time critical program is no longer time critical.

14. An analog/hybrid system for at least two hybrid users operating their respective hybrid simulations on a time sharing basis comprising a digital computer having a main digital memory, a plurality of analog computers having their own independent and distinct analog programs in which at any time at least one analog program may become time critical, analog to digital and digital to analog means for linking data flow between the analog computers and the digital computer, and multiplex means for controlling the linking means to substantially automatically preempt and allocate all of said data flow from nontime critical analog programs to the time critical analog program during ongoing data flow.

15. The analog/hybrid system of claim 14 in which said multiplex means includes means for further controlling the linking means to allocate as available data flow to at least one nontime critical analog program.

16. The analog/hybrid system of claim 14 in which there is provided a time critical digital program associated with said time critical analog program and in which said multiplex means includes means for substantially allocating all of said data flow additionally to said time critical digital program whereby data flows with respect to the time critical analog and digital programs without digital computer intervention.

17. The analog/hybrid system of claim 15 in which there is provided interrupt means coupled to said multiplex means for providing interrupt signals all allocated to the time critical analog program.

18. The analog/hybrid system of claim 17 in which each of said hybrid users has at least one analog program and at least one hybrid program and in which said linking means includes a plurality of data flow channels coupled between the analog computers and the digital computer.

19. The analog/hybrid system of claim 18 in which said multiplex means includes channel control means for providing first control signals for selecting the addresses of the data flow channels of the linking means associated with the time critical analog program.

20. The analog/hybrid system of claim 18 in which said multiplex means includes channel control means coupled to said data flow channels without digital computer intervention for passing the flow of data through the data flow channels associated with the time critical analog program.

21. The analog/hybrid system of claim 19 in which said channel control means includes means for providing further first control signals to select as available addresses of data flow channels associated with analog programs that are not time critical.

22. The analog/hybrid system of claim 21 in which there is provided means coupled to said data flow channels for passing flow of data from and to the time critical analog computer in response to said first control signals.

23. The analog/hybrid system of claim 21 in which said channel control means includes means for providing second control signals to select addresses in main memory for data from and to the analog computers.

24. The analog/hybrid system of claim 23 in which said second control signal means produces second control signals for selecting addresses in main memory solely for data from and to the time critical analog program.

25. The analog/hybrid system of claim 24 in which said second control signal means produces second control signals for selecting addresses in main memory for data from and to nontime critical analog programs.

26. The analog/hybrid system of claim 24 in which said multiplex means includes means for saving over a selected period of time at least one of said first and second control signals relating to each of the nontime critical analog computers.

27. The analog/hybrid system of claim 25 in which there is provided saving means for saving at least one of said first and second control signals relating to nontime critical analog computers and to reintroduce such said control signals when a nontime critical analog computer can resume hybrid operation and become active.

28. The analog/hybrid system of claim 26 in which said saving means includes activate multiplex means for saving the first and second control signals and in turn reintroducing said saved control signals when the time critical program is no longer time critical.

29. The analog/hybrid system of claim 27 in which said channel control means provides third control signals for controlling the fixed point and floating point nature of the data to be stored in said main memory.

30. The analog/hybrid system of claim 23 in which said interrupt means includes means responsive to said channel control means for providing interrupt signals to said digital computer only with respect to interrupt sources from the time critical analog program.

31. The analog/hybrid system of claim 30 in which said responsive means includes resource allocator means controlled by the digital computer for selecting the interrupt sources only from the time critical analog program.

32. The analog/hybrid system of claim 31 in which there is provided interval timer means for timing predetermined intervals of selected ones of the interrupt signals.

33. The analog hybrid system of claim 30 in which said interval timing means includes means for providing timing signals for controlling the data flow channels of said linking means.

34. The analog/hybrid system of claim 30 in which said interval timing means includes means for sampling the analog computers to determine the intervals on the basis of events in the analog computers.

35. The analog/hybrid system of claim 34 in which there is provided parallel multiplex means for coordinating the digital program in the main memory with the time critical analog program.

36. A method of operating an analog/hybrid system having a digital computer including a main digital memory for at least two hybrid users having their own individual analog programs comprising the steps of (a) running the analog programs with at least one of the analog programs becoming time critical, (b) linking the data flow between the analog computers and the digital computer under the control of the main digital memory, and (c) controlling the linking during ongoing data flow for preempting and allocating the data flow from nontime critical analog programs to the time critical analog program and as available allocating data flow to the nontime critical analog programs.

37. The method of claim 36 in which step (a) includes running digital programs for said hybrid users with at least one of the digital programs associated with the time critical analog program becoming time critical and step (c) includes substantially allocating all of said data flow additionally to said time critical digital program whereby data flows with respect to the time critical analog and digital programs without digital computer intervention.

38. The method of claim 36 in which there is provided the further step of (d) providing interrupt signals all allocated to the time critical analog program.

39. The method of claim 36 in which step (a) includes the running of at least one analog program and at least one digital program for each hybrid user.

40. The method of claim 39 in which step (b) includes linking the data flow into channels of data flow and step (c) includes selecting and substantially allocating all of the channels of data flow between the analog computers and the digital computer to the time critical analog program thereby providing data flow without digital computer intervention.

41. The method of claim 40 in which step (c) includes selecting and allocating as available channels of data flow between the analog computers and the digital computer to the analog programs that are not time critical.

42. The method of claim 41 in which there is provided the further step of selecting addresses in main memory for the data from and to the analog computers.

43. The method of claim 40 in which there is provided the further step of providing first control signals for selecting addresses of channels of data flow between the analog computers and the digital computer relating to the time critical analog program.

44. The method of claim 43 in which there is provided the further step of providing first control signals for selecting addresses of available channels of data flow between the analog computers and the digital computer relating to other than the time critical analog program.

45. The method of claim 44 in which step (c) includes controlling the data flow channels for passing flow of data from and to the analog computers in response to said first control signals.

46. The method of claim 45 in which there is provided the further step of providing second control signals to select addresses in main memory for data from and to the analog computers.

47. The method of claim 46 in which the step of providing second control signals includes selecting addresses in main memory solely for data from and to the time critical analog program.

48. The method of claim 47 in which the step of providing second control signals includes selecting addresses in main memory for data from and to nontime critical analog programs.

49. The method of claim 46 in which there is provided the further step of saving over a selected period of time at least one of the first and second control signals relating to each of the nontime critical analog computers.

50. The method of claim 49 in which the step of saving control signals includes reintroducing the saved control signals when the time critical program is no longer time critical.

51. The method of claim 50 in which there is provided the further step of producing third control signals for controlling the fixed point and floating point nature of the data to be stored in the main memory.

52. The method of claim 38 in which step (d) includes providing interrupt signals to the digital computer only with respect to interrupt sources from the time critical analog program.

53. The method of claim 52 in which there is provided the further step of selecting interrupt sources only from the time critical analog program.

54. The method of claim 53 in which there is provided the further step of timing predetermined intervals of selected ones of the interrupt signals.

55. The method of claim 54 in which the step of timing intervals includes providing timing signals for controlling the data flow channels.

56. The method of claim 55 in which there is provided the further step of sampling the analog computers to determine intervals on the basis of events in the analog computers.

* * * * *